US008950323B2

(12) United States Patent
Kamoda et al.

(10) Patent No.: US 8,950,323 B2
(45) Date of Patent: Feb. 10, 2015

(54) METHOD AND APPARATUS FOR DRIVING PROCESSOR

(75) Inventors: Hiroyoshi Kamoda, Noda (JP); Hiromitsu Numauchi, Tsukuba (JP)

(73) Assignee: Komori Corporation, Tokyo (JP)

( * ) Notice: Subject to any disclaimer, the term of this patent is extended or adjusted under 35 U.S.C. 154(b) by 657 days.

(21) Appl. No.: 12/508,626

(22) Filed: Jul. 24, 2009

(65) Prior Publication Data

US 2010/0037789 A1 Feb. 18, 2010

(30) Foreign Application Priority Data

Aug. 13, 2008 (JP) ..... 2008-208363

(51) Int. Cl.
*B41F 5/06* (2006.01)
*B41F 13/004* (2006.01)
*B41F 33/00* (2006.01)

(52) U.S. Cl.
CPC ..... *B41F 13/0045* (2013.01); *B41F 33/0009* (2013.01); *B41P 2213/72* (2013.01); *B41P 2213/73* (2013.01); *B41P 2213/734* (2013.01)
USPC ..... 101/183; 101/216; 101/232; 318/48; 318/630

(58) Field of Classification Search
USPC ..... 101/183; 318/48
See application file for complete search history.

(56) References Cited

U.S. PATENT DOCUMENTS

| | | | | | |
|---|---|---|---|---|---|
| 2,707,914 | A * | 5/1955 | Harrold | 101/183 |
| 3,557,692 | A * | 1/1971 | Lee | 101/183 |
| 4,360,354 | A | 11/1982 | Bishop | |
| 5,355,742 | A * | 10/1994 | Herrmann | 101/183 |
| 5,377,585 | A * | 1/1995 | Kipphan et al. | 101/181 |
| 5,524,538 | A * | 6/1996 | Voge et al. | 101/183 |
| 5,729,100 | A * | 3/1998 | Rothstein et al. | 318/48 |
| 6,205,919 | B1 * | 3/2001 | Simeth | 101/183 |
| 6,349,641 | B1 * | 2/2002 | Bayer et al. | 101/183 |
| 6,580,244 | B2 * | 6/2003 | Tanaka et al. | 318/48 |
| 6,810,809 | B2 * | 11/2004 | Detmers et al. | 101/183 |
| 6,823,792 | B2 | 11/2004 | Grutzmacher et al. | |
| 2002/0000166 | A1 | 1/2002 | Nakamura | |
| 2006/0260485 | A1 | 11/2006 | Ohsawa | |

FOREIGN PATENT DOCUMENTS

| | | | |
|---|---|---|---|
| CN | 1864988 | A | 11/2006 |
| DE | 10327423 | A1 | 2/2004 |
| EP | 1155826 | A2 | 11/2001 |
| EP | 1717031 | A2 | 11/2006 |
| JP | 61-266249 | A | 11/1986 |
| JP | 2001-253049 | A | 9/2001 |
| JP | 2002-11847 | A | 1/2002 |
| JP | 2006-305903 | A | 11/2006 |

OTHER PUBLICATIONS

Japanese Office Action issued Japanese Patent Application No. 2008-208363 on Dec. 4, 2012.

* cited by examiner

*Primary Examiner* — Jill Culler
(74) *Attorney, Agent, or Firm* — Birch, Stewart, Kolasch & Birch, LLP

(57) ABSTRACT

In a sheet-fed printing press including; an impression cylinder gear driven by an upstream drive motor of an upstream printing unit group; an impression cylinder rotationally driven by the impression cylinder gear; a transfer cylinder gear of a convertible press mechanism rotationally driven by the upstream drive motor through the impression cylinder; and a transfer cylinder which is provided with a notch and is rotationally driven by the transfer cylinder gear, a load motor is provided to the transfer cylinder or the transfer cylinder gear, and braking force of the load motor is controlled according to load on the upstream drive motor.

20 Claims, 156 Drawing Sheets

METHOD AND APPARATUS FOR DRIVING PROCESSOR

TECHNICAL FIELD

The present invention relates to a method and an apparatus for driving a processor such as a sheet-fed printing press.

BACKGROUND

Sheet-fed printing presses have been equipped with an increasing number of additional processing units (a coater, an embossing unit, and the like) to meet an increase in the number of colors and higher additional values due to recent requirement of higher quality printing. In a conventional sheet-fed convertible offset printing press and such a sheet-fed printing press provided with multiple processing units, all the processing units are driven by a single drive motor.

Accordingly, the drive motor thereof is subjected to large load and needs to have a large capacity. It is therefore necessary to use an expensive motor. Moreover, the drive system needs to be rigid, and further increases in size. As a result of the increase in size, it is necessary to use a motor having an even larger capacity, thus making it impossible to achieve high speed operation.

CITATION LIST

Patent Literature 1

Japanese Patent Application Publication No. 2002-11847

SUMMARY OF INVENTION

Technical Problem

Accordingly, it is considered that a group of processing units on the upstream side in the paper feeding direction and a group of processing units on the downstream side are separately driven by different drive motors, and that speeds and phases of these two different drive motors are synchronously controlled.

In a sheet-fed convertible offset printing press as an example, a notch provided in a transfer cylinder of a convertible press mechanism located at the end of the upstream printing unit group causes uneven distribution of mass of the transfer cylinder. The uneven distribution causes non-uniform rotation because of a gap between a gear of the transfer cylinder of the convertible press mechanism and a gear of an impression cylinder adjacent to the transfer cylinder on the upstream side. Moreover, a notch provided in a suction cylinder located at the top of the downstream printing unit group causes uneven distribution of mass of the suction cylinder. The uneven distribution causes non-uniform rotation because of a gap between a gear of the suction cylinder and a gear of a convertible cylinder adjacent to the suction cylinder on the downstream side.

In addition, there is fluctuation of load between a plate cylinder and a blanket cylinder in each printing unit (for example, there is a difference in load between the state where circumferential surfaces of the plate and bracket cylinders are in contact with each other and the plate and bracket cylinders are subjected to contact pressure, and the state where the notches of the plate and bracket cylinders are opposed to each other and the plate and bracket cylinders are not subjected to contact pressure). Such fluctuation may cause non-uniform rotation because of the gap between gears of the plate and blanket cylinders.

With such non-uniform rotation, when sheets are transferred from the upstream printing unit group to the downstream printing unit group, the sheets cannot be transferred at an accurate position each time, thus causing print failure. Furthermore, greater non-uniformity of the rotation could cause problems including failure in gripping sheets, folding sheet edges, and the like.

An object of the present invention is to solve the aforementioned problems by: separately driving a plurality of processing unit groups with respective driving units; and by providing a braking unit for a rotating section of a rotating body of at least any one of the plurality of processing unit groups, the rotating body having a load fluctuating greatly, and controlling braking force of the braking unit according to the fluctuation of load.

Solution to Problem

To achieve the aforementioned problem, the present invention provides (1) a method for driving a processor, the processor including: first driven means driven by first driving means; second driven means rotationally driven by the first driving means through the first driven means; first rotating body including a notch provided with a first holder holding a processed member, the first rotating body being rotationally driven by the second driven means; and a second rotating body including a notch provided with a second holder which receives the processed member from the first holder of the first rotating body. The method for driving the processor is characterized by including the steps of: providing second driving means rotationally driving the second rotating body; providing first braking means to any one of the first rotating body, the second driven means, and third driven means rotationally driven by the second driven means; and controlling a braking force of the first braking means according to any one of load to rotationally drive the first rotating body and rotational phase of the processor.

(2) The method according to above (1) is characterized in that the braking force of the first braking means is larger when the notch of the first rotating body moves down than when the notch of the first rotating body moves up.

(3) The present invention provides a method for driving a processor, the processor including: first driving means; a first rotating body including a notch provided with a first holder holding a processed member, the first rotating member being rotationally driven by the first driving means; a second rotating body including a notch provided with a second holder which receives the processed member from the first holder of the first rotating body. The method is characterized by including the steps of: providing second driving means, fourth driven means driven by the second driving means, fifth driven means which is rotationally driven by the second driving means through the fourth driven means and rotationally drives the second rotating body, and second braking means provided to any one of the second rotating body, the fifth driven means, and sixth driven means rotationally driven by the fifth driven means; and controlling a braking force of the second braking means according to any one of load to rotationally drive the second rotating body and rotational phase of the processor.

(4) The method according to (3) is characterized in that the braking force of the second braking means is larger when the notch of the second rotating body moves down than when the notch of the second rotating body moves up.

(5) The method according to (1) is characterized in that the first braking means is a load motor.

(6) The method according to (3) is characterized in that the second braking means is a load motor.

(7) The method according to any one of (5) and (6) is characterized in that each of the first and second driving means is an electric motor, and electric power generated by the load motors is used to drive the electric motors.

To achieve the aforementioned problem, the present invention provides (8) an apparatus for driving a processor, the processor including: first driven means driven by first driving means; second driven means rotationally driven by the first driving means through the first driven means; a first rotating body including a notch provided with a first holder holding a processed member, the first rotating body being rotationally driven by the second driven means; and a second rotating body including a notch provided with a second holder which receives the processed member from the first holder of the first rotating body. The driving apparatus is characterized by including: a second driving means rotationally driving the second rotating body; a first braking means provided to any one of the first rotating body, the second driven means and third driven means rotationally driven by the second driven means; and control means controlling a braking force of the first braking means according to any one of load to rotationally drive the first rotating body and rotational phase of the processor.

(9) The driving apparatus according to (8) is characterized in that the control means controls the braking force of the first braking means so that the braking force of the first braking means is larger when the notch of the first rotating body moves down than when the notch of the first rotating body moves up.

(10) The present invention provides an apparatus for driving a processor, the processor including: first driving means; a first rotating body including a notch provided with a first holder holding a processed member, the first rotating body being rotationally driven by the first driving means; a second rotating body including a notch provided with a second holder which receives the processed member from the first holder of the first rotating body. The driving apparatus is characterized by including: second driving means; fourth driven means driven by the second driving means; a fifth driven means which is rotationally driven by the second driving means through the fourth driven means, and rotationally drives the second rotating body; second braking means provided at any one of the second rotating unit, the fifth driven means and sixth driven means rotationally driven by the fifth driven means; and control means controlling the braking force of the second braking means according to any one of load to rotationally drive the second rotating body and rotational phase of the processor.

(11) The driving apparatus according to (10) is characterized in that the control means controls the braking force of the second braking means so that the braking force of the second braking means is larger when the notch of the first rotating body moves down than when the notch of the second rotating body moves up.

(12) The driving apparatus according to (8) is characterized in that the first braking means is a load motor.

(13) The driving apparatus according to (10) is characterized in that the second braking means is a load motor.

(14) The driving apparatus according to any one of (12) and (13) is characterized in that each of the first and second driving means is an electric motor, and electric power generated by the load motors is used to drive the electric motors.

Advantageous Effects of Invention

According to the present invention having the aforementioned configuration, the non-uniform rotation of the rotating bodies including notches can be effectively eliminated by the braking units, and the processed members can be smoothly transferred from one of the rotating bodies to another. This makes it possible to prevent occurrence of printing faults including mackle, failures in gripping sheets and folding sheet edges in a sheet-fed printing press and the like.

Moreover, each braking unit is composed of a load motor. This eliminates the need to replace the components, unlike in the case of using friction brakes or the like, and the braking units can be made maintenance-free. Moreover, the electric power generated by the load motors is recovered as electric power for driving the drive motors, thus achieving energy savings.

BRIEF DESCRIPTION OF DRAWINGS

FIG. 47 is an operational flowchart of the upstream printing unit group drive controller.

FIG. 48A is an operational flowchart of the downstream printing unit group drive controller.

FIG. 48B is an operational flowchart of the downstream printing unit group drive controller.

FIG. 49A is an operational flowchart of the downstream printing unit group drive controller.

FIG. 49B is an operational flowchart of the downstream printing unit group drive controller.

FIG. 49C is an operational flowchart of the downstream printing unit group drive controller.

FIG. 50A is an operational flowchart of the downstream printing unit group drive controller.

FIG. 50B is an operational flowchart of the downstream printing unit group drive controller.

FIG. 50C is an operational flowchart of the downstream printing unit group drive controller.

FIG. 51 is an operational flowchart of the downstream printing unit group drive controller.

FIG. 52A is an operational flowchart of the downstream printing unit group drive controller.

FIG. 52B is an operational flowchart of the downstream printing unit group drive controller.

Figure 52A:
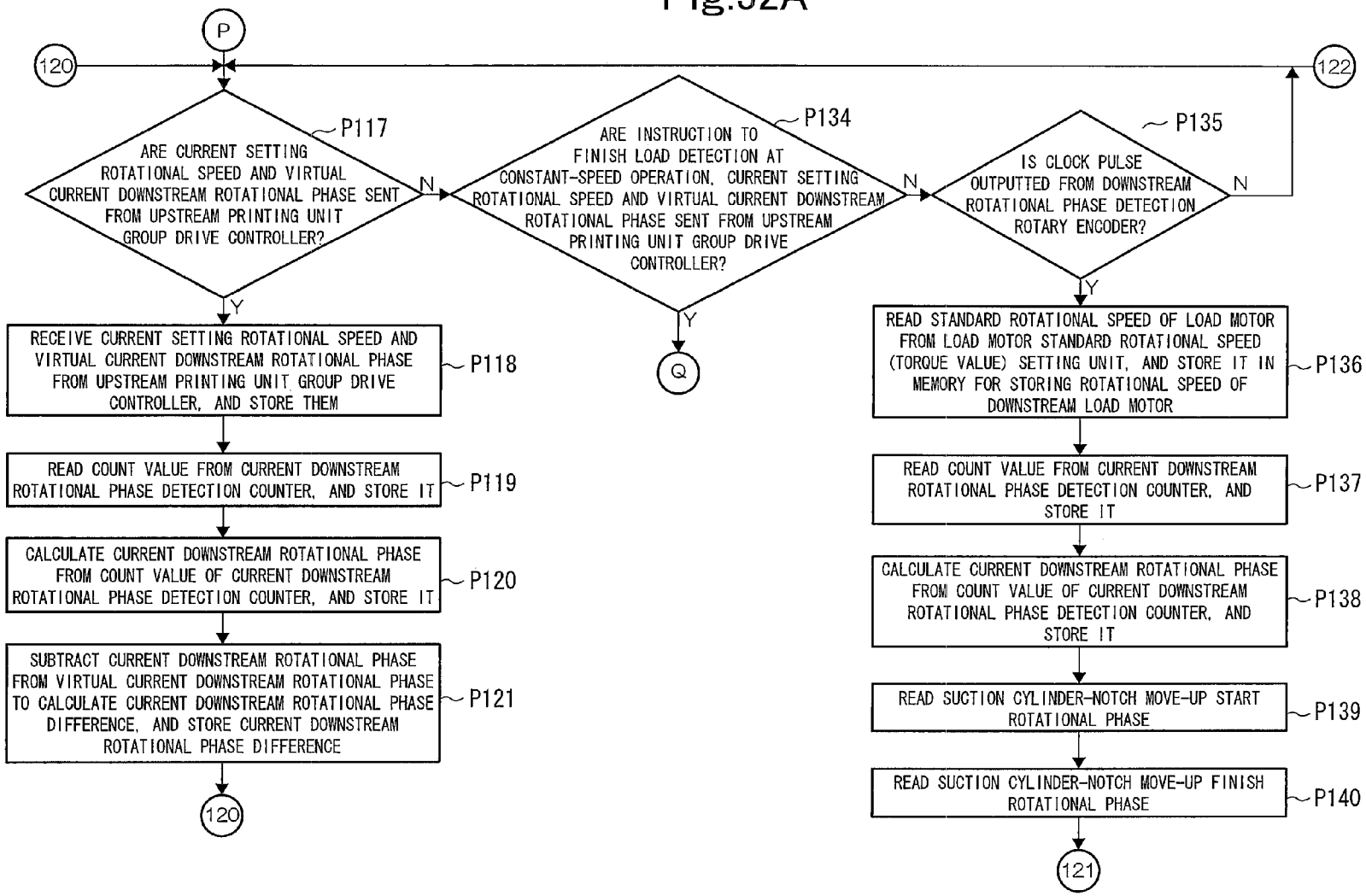
Figure 52B:
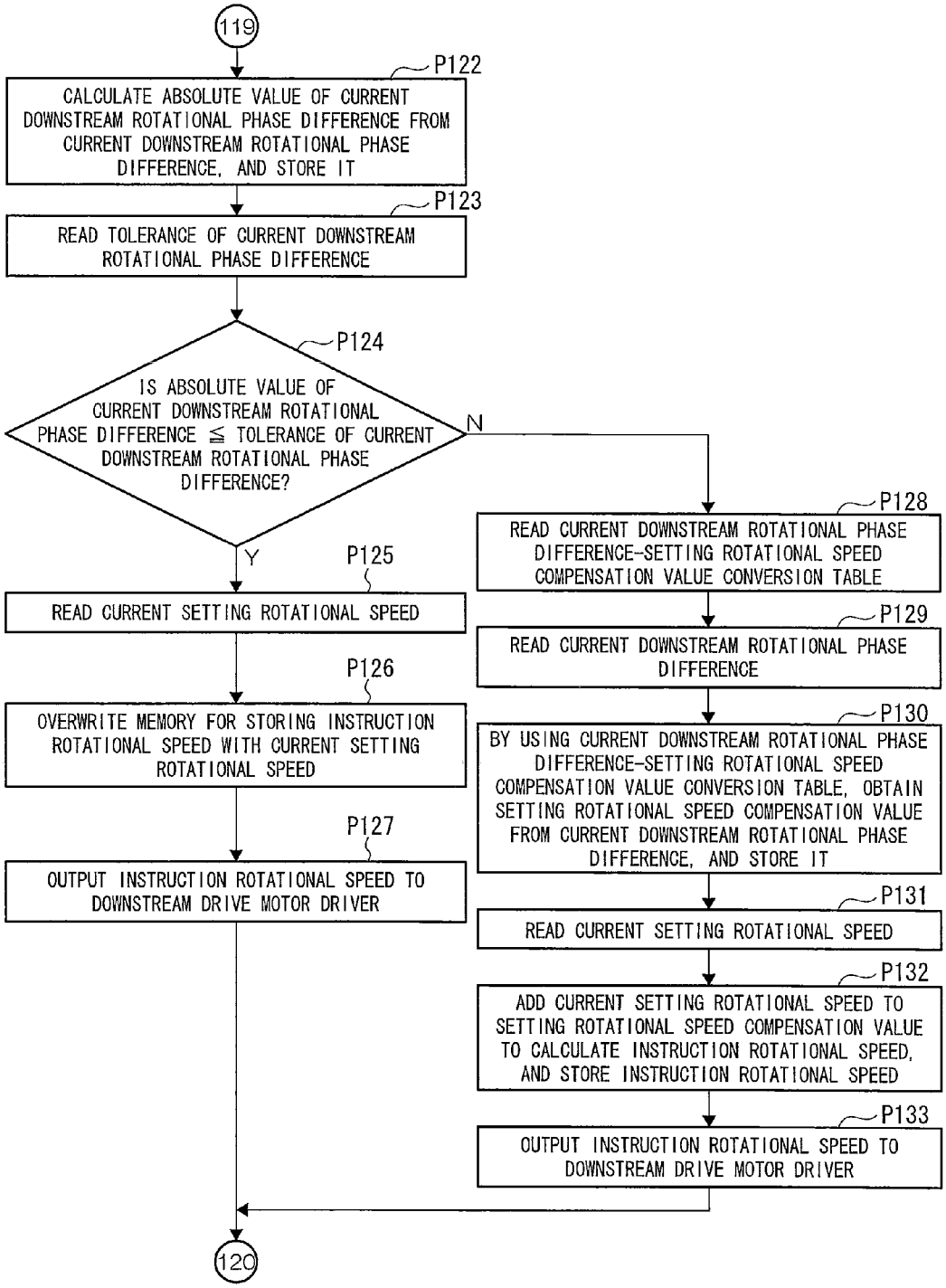
Figure 52C:
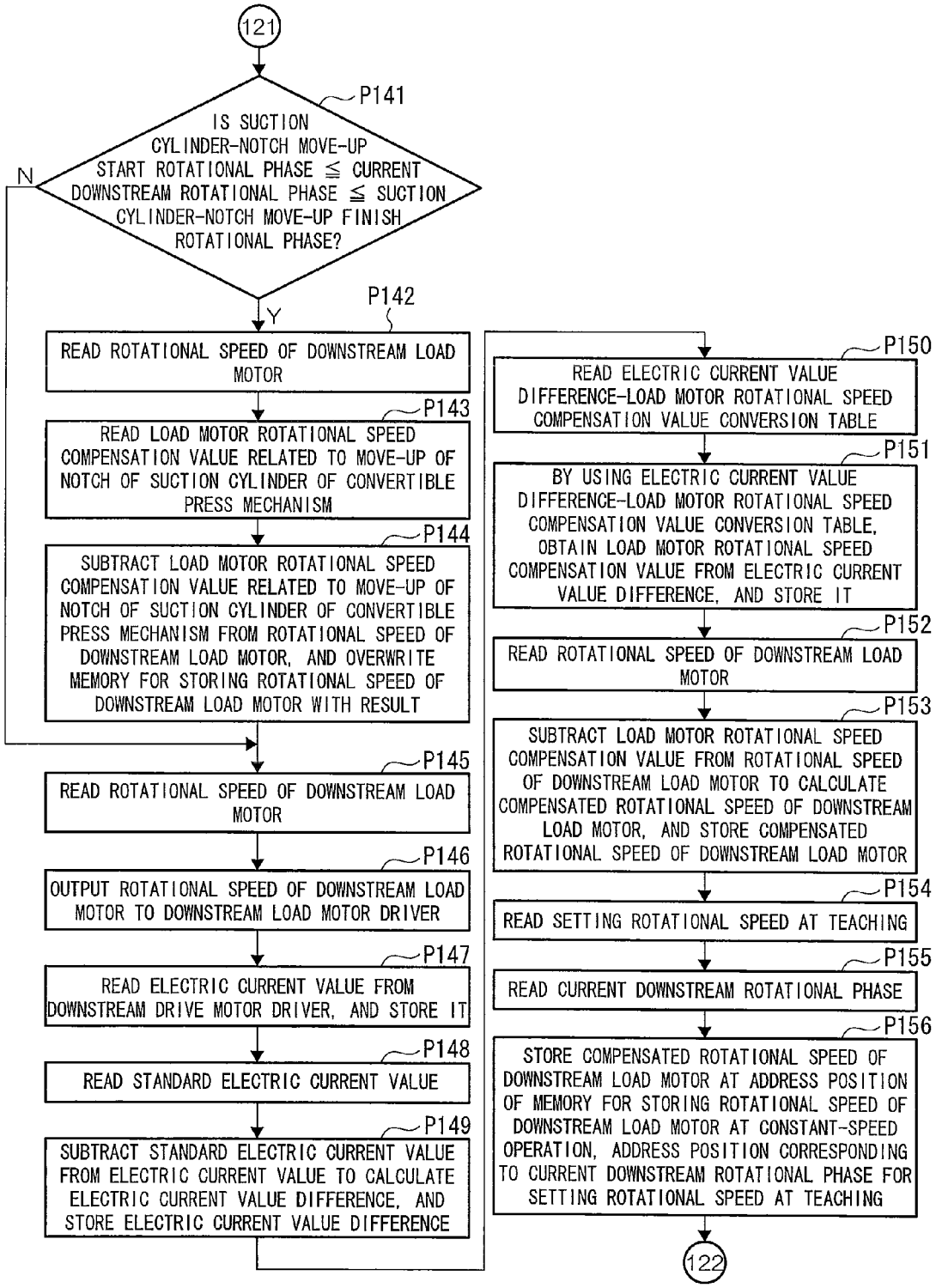

FIG. 52C is an operational flowchart of the downstream printing unit group drive controller.

Figure 53A:
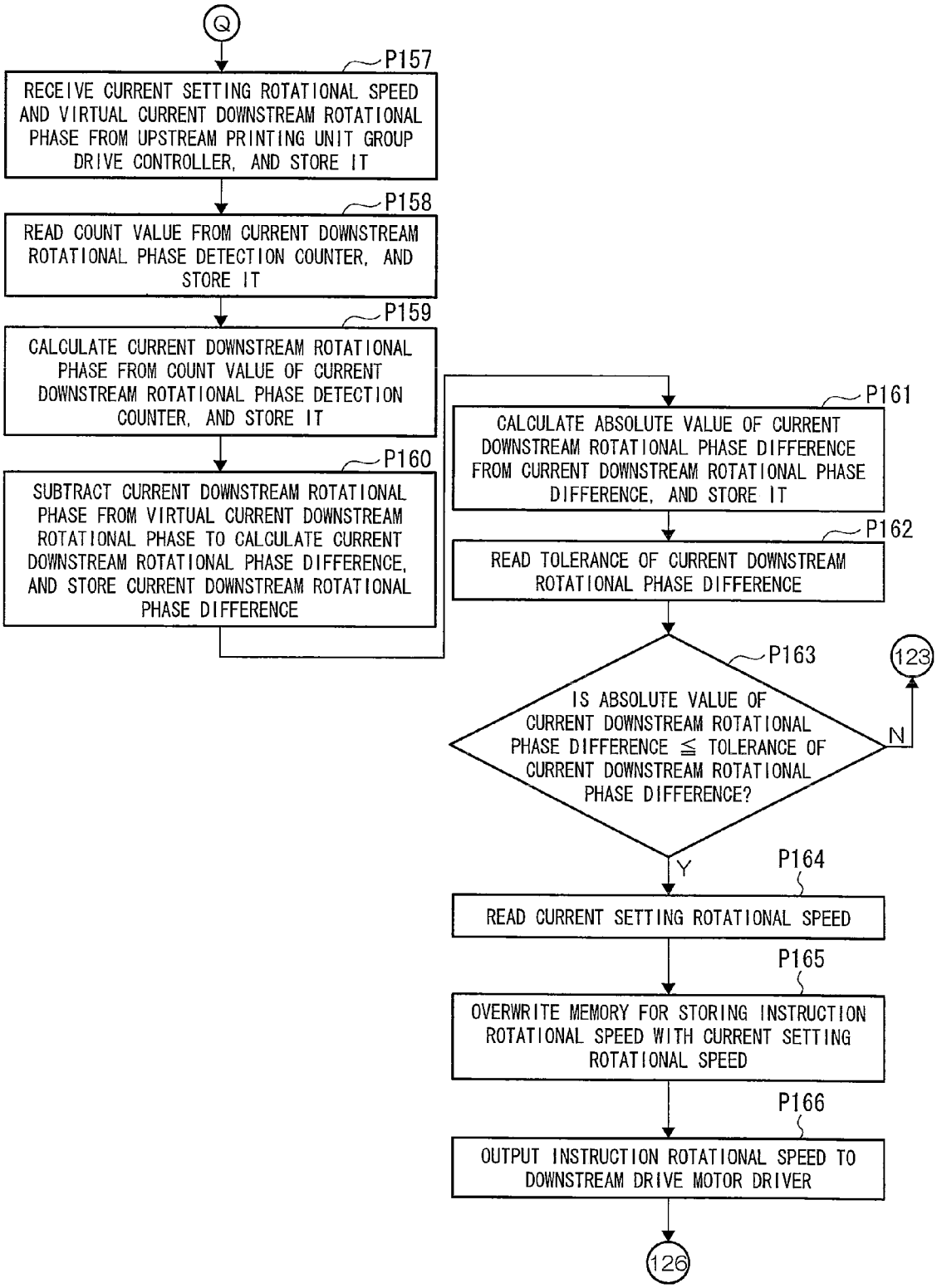

FIG. 53A is an operational flowchart of the downstream printing unit group drive controller.

Figure 53B:
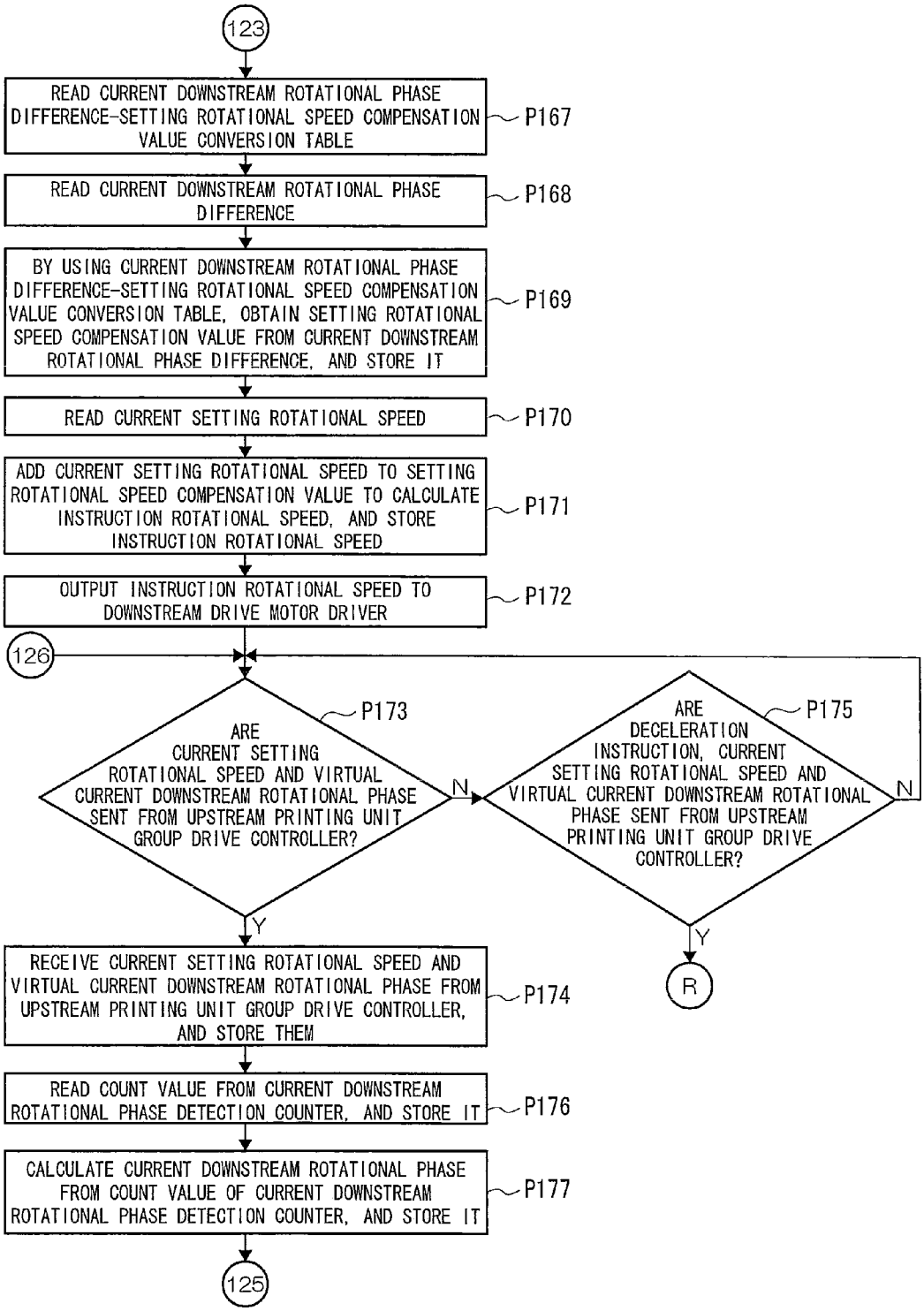

FIG. 53B is an operational flowchart of the downstream printing unit group drive controller.

Figure 53C:
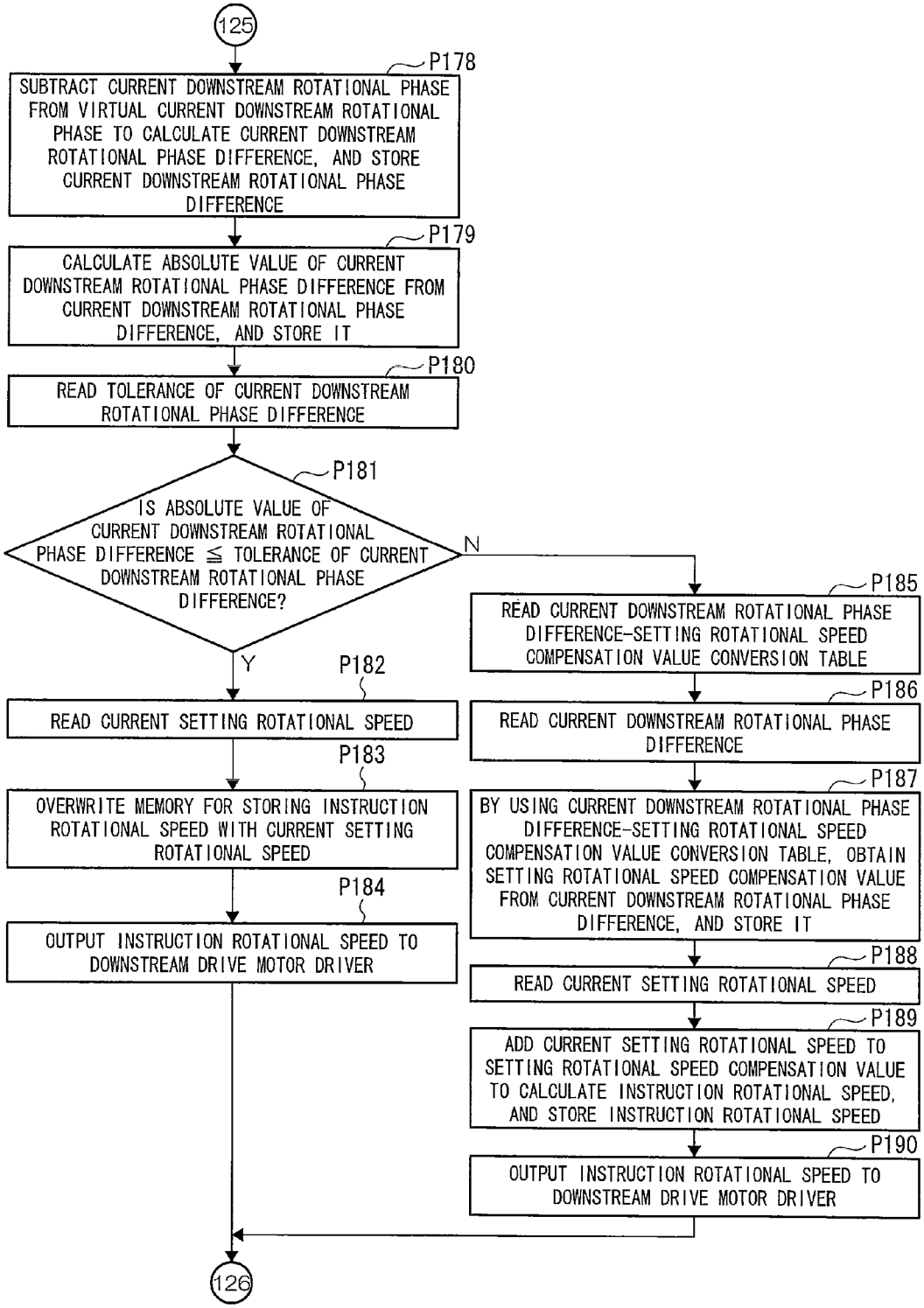

FIG. 53C is an operational flowchart of the downstream printing unit group drive controller.

Figure 54:
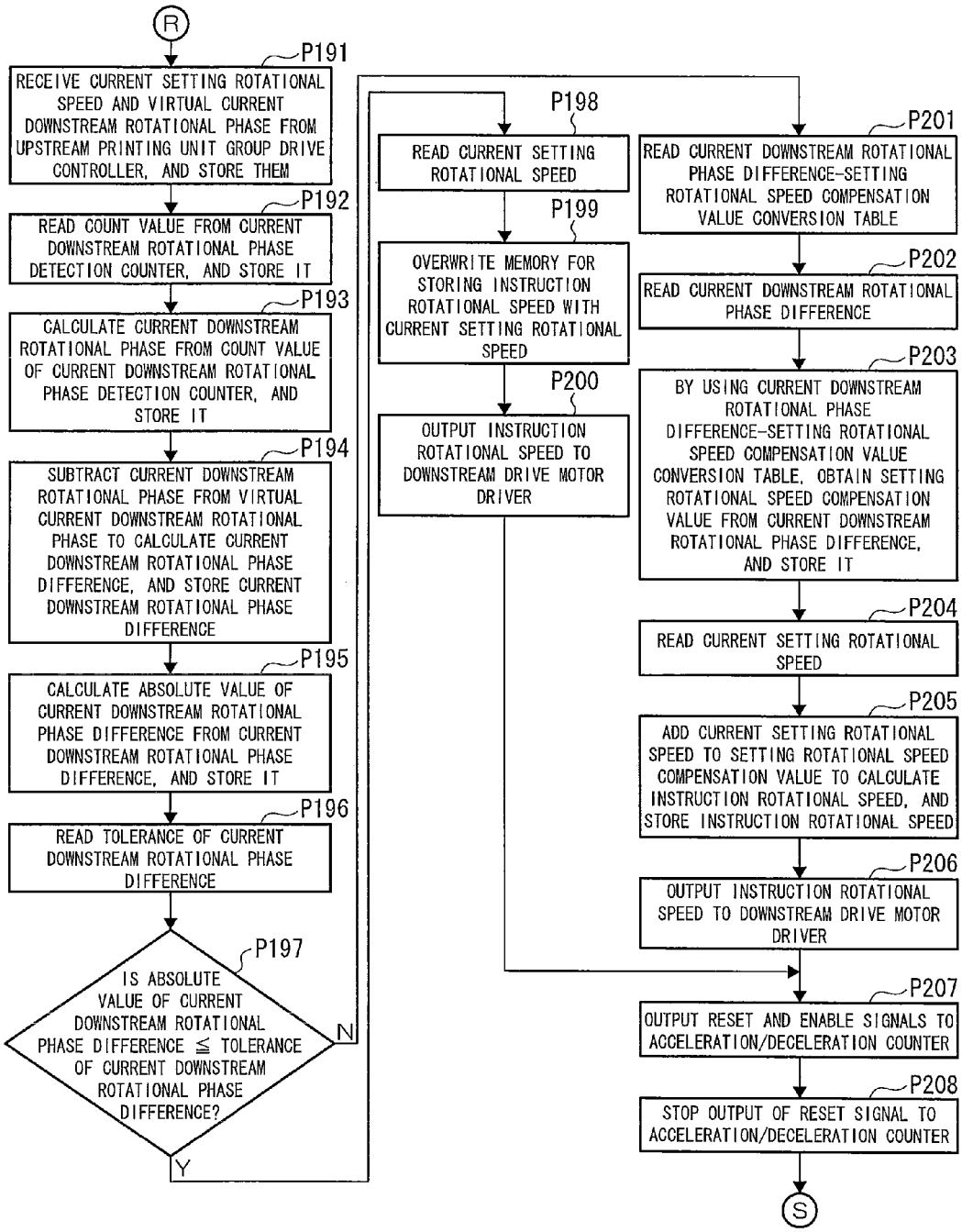

FIG. 54 is an operational flowchart of the downstream printing unit group drive controller.

Figure 55A:
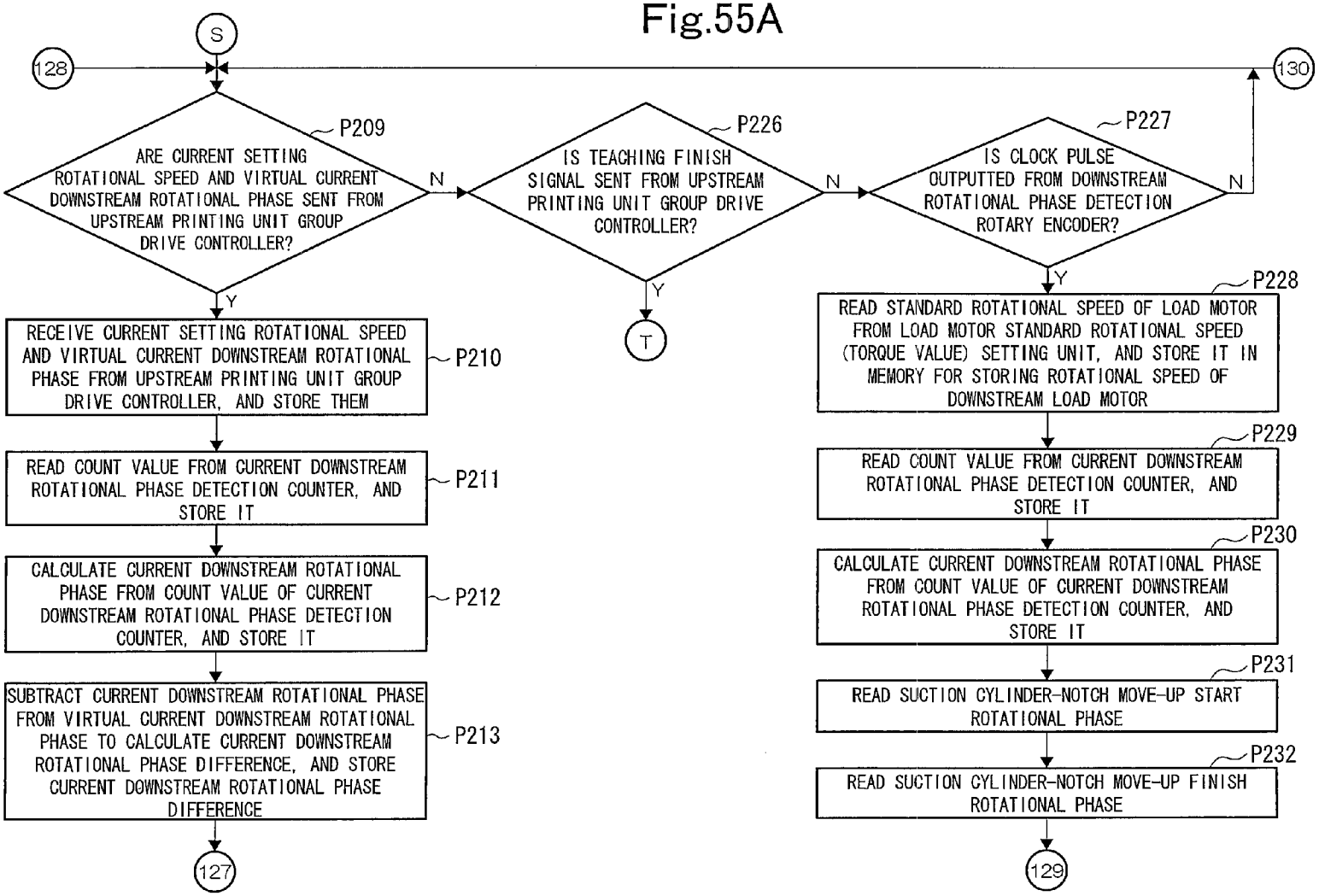

FIG. 55A is an operational flowchart of the downstream printing unit group drive controller.

Figure 55B:
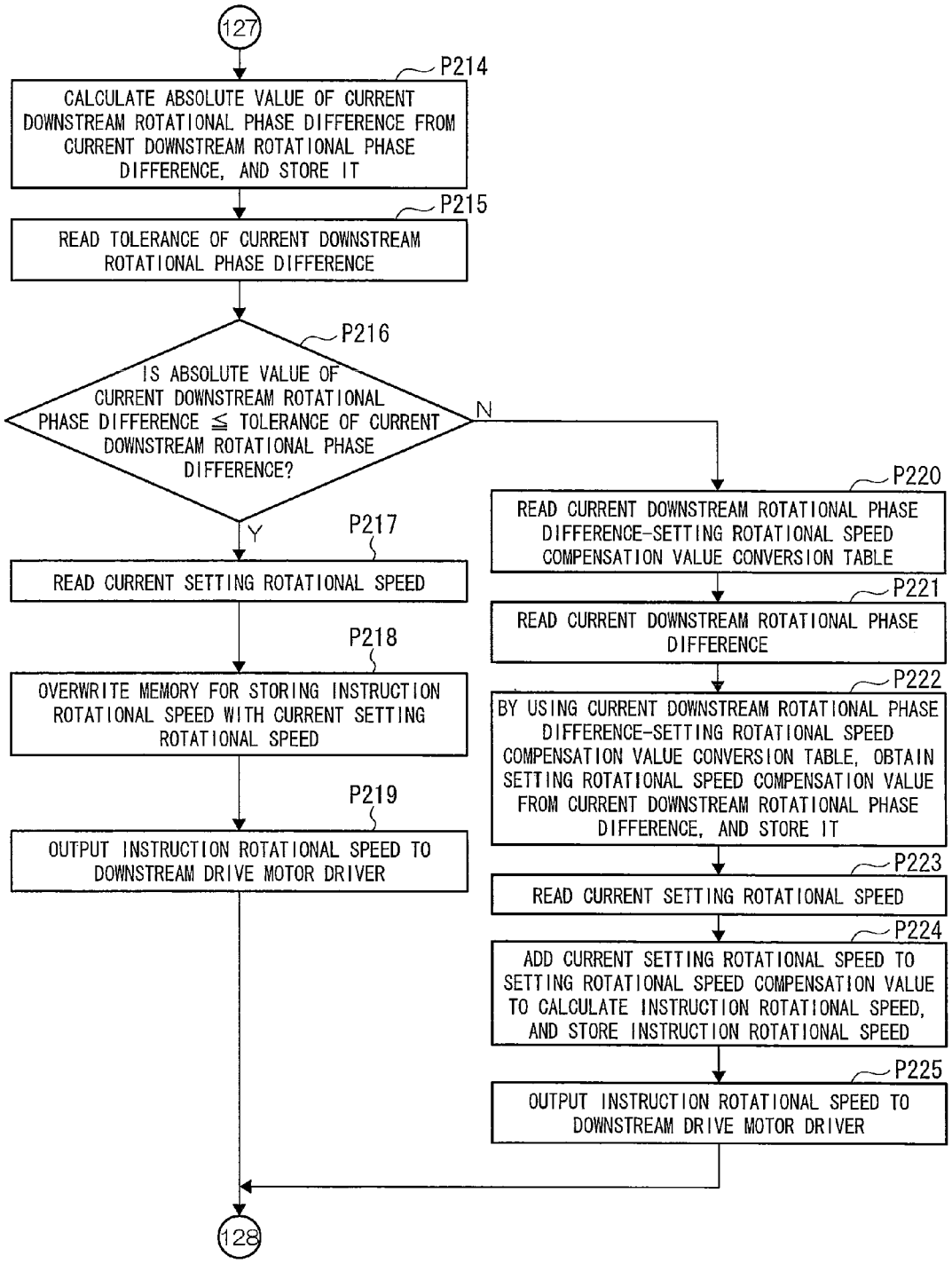

FIG. 55B is an operational flowchart of the downstream printing unit group drive controller.

Figure 55C:
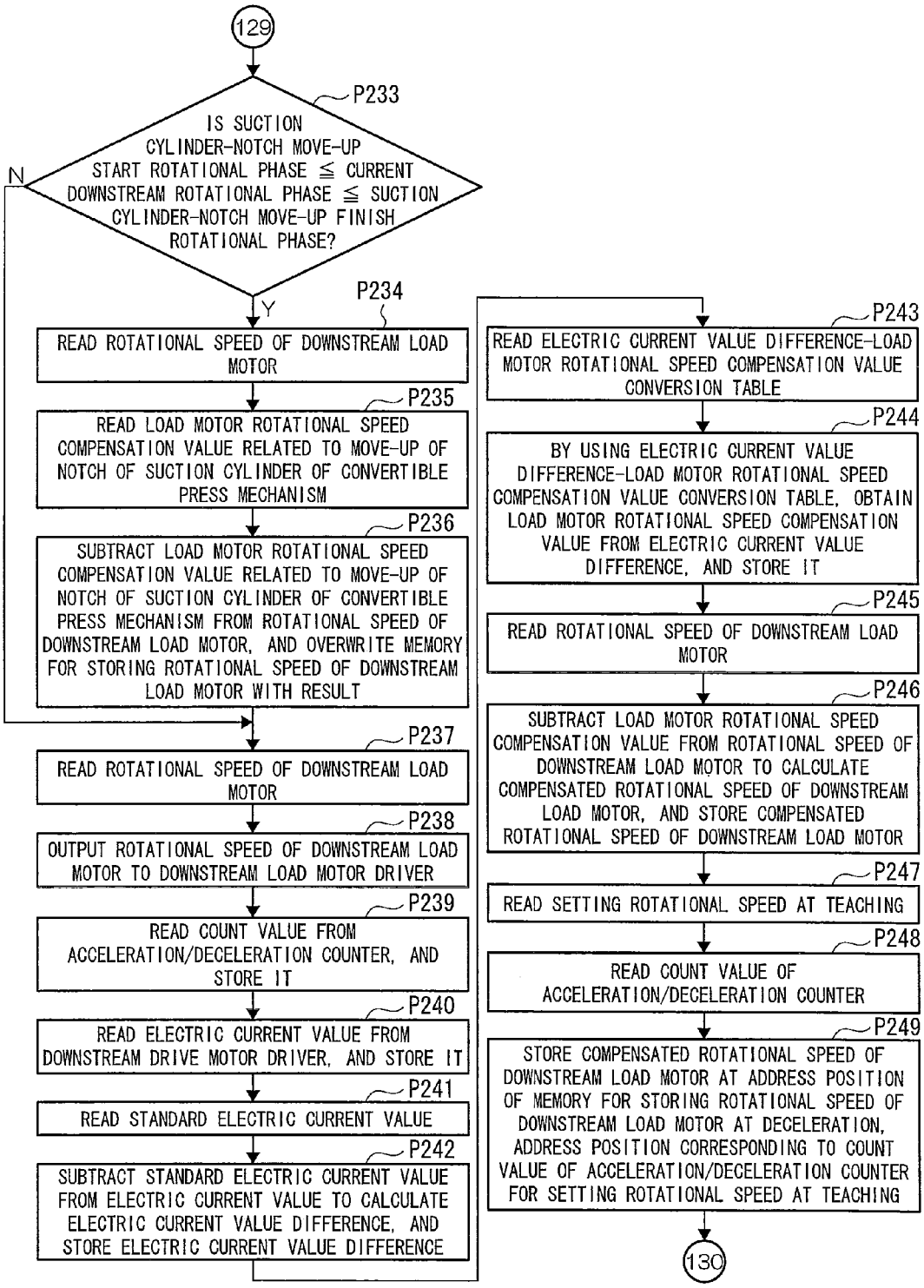

FIG. 55C is an operational flowchart of the downstream printing unit group drive controller.

Figure 56A:
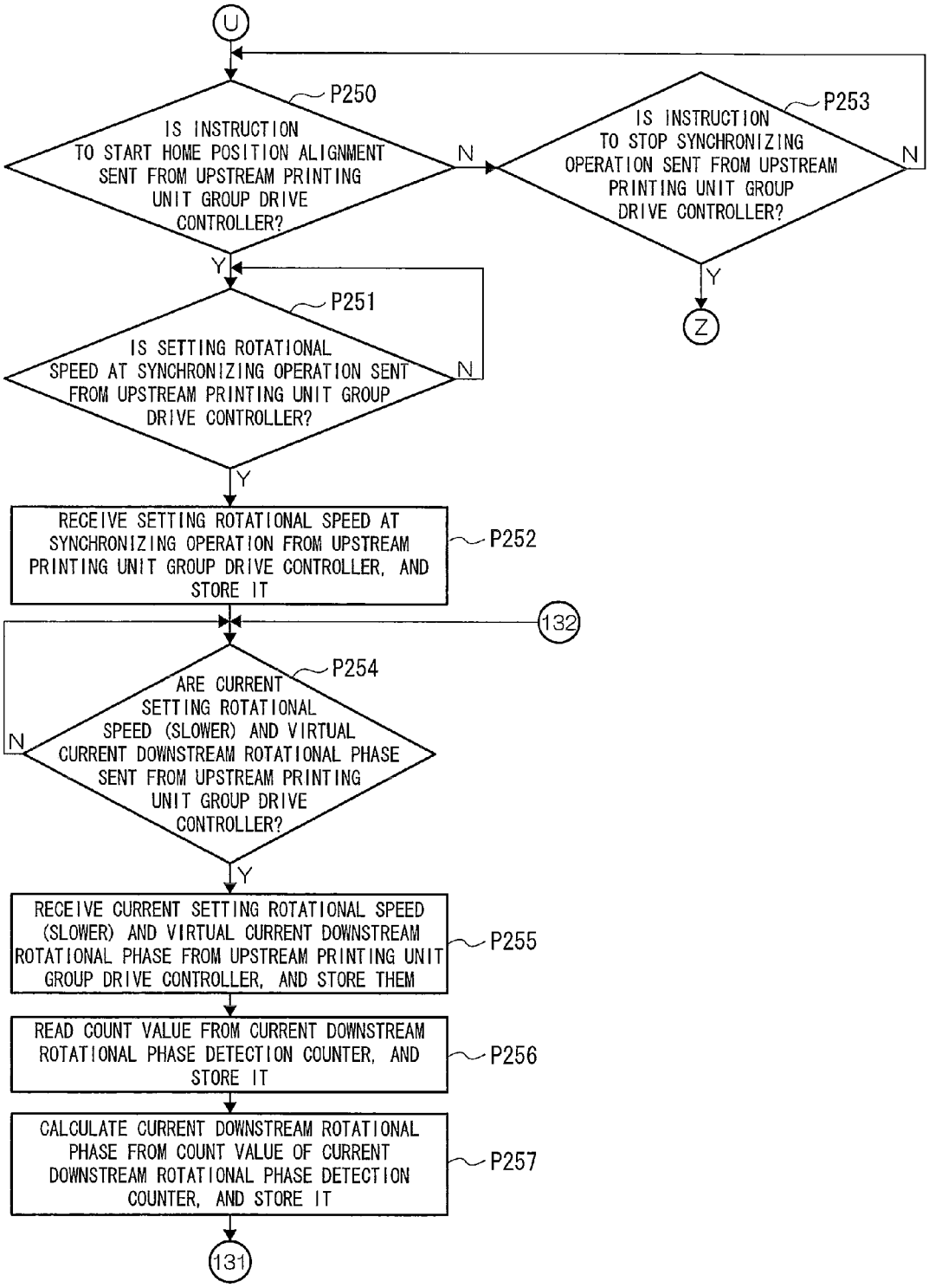

FIG. 56A is an operational flowchart of the downstream printing unit group drive controller.

Figure 56B:
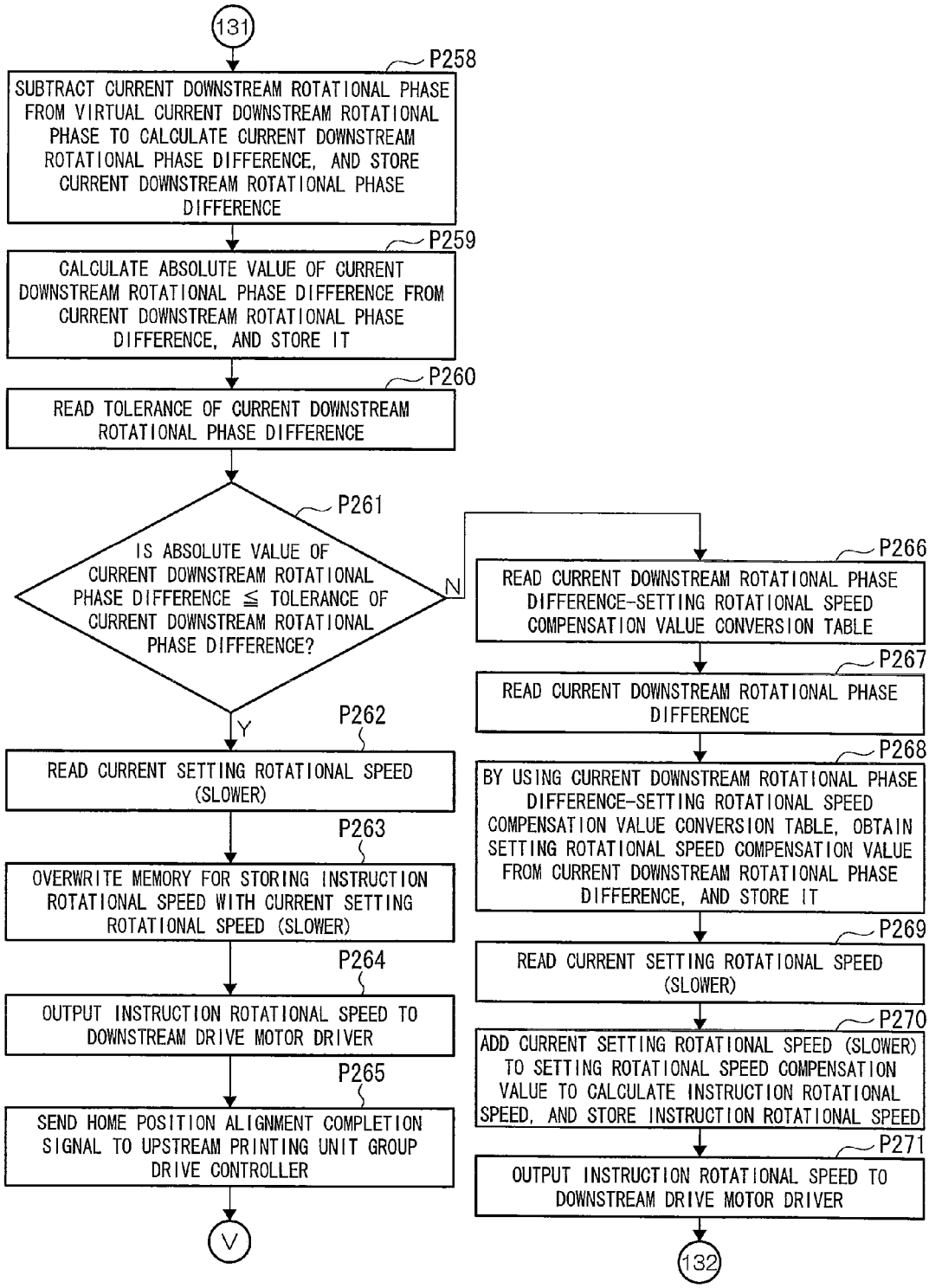

FIG. 56B is an operational flowchart of the downstream printing unit group drive controller.

Figure 57A:
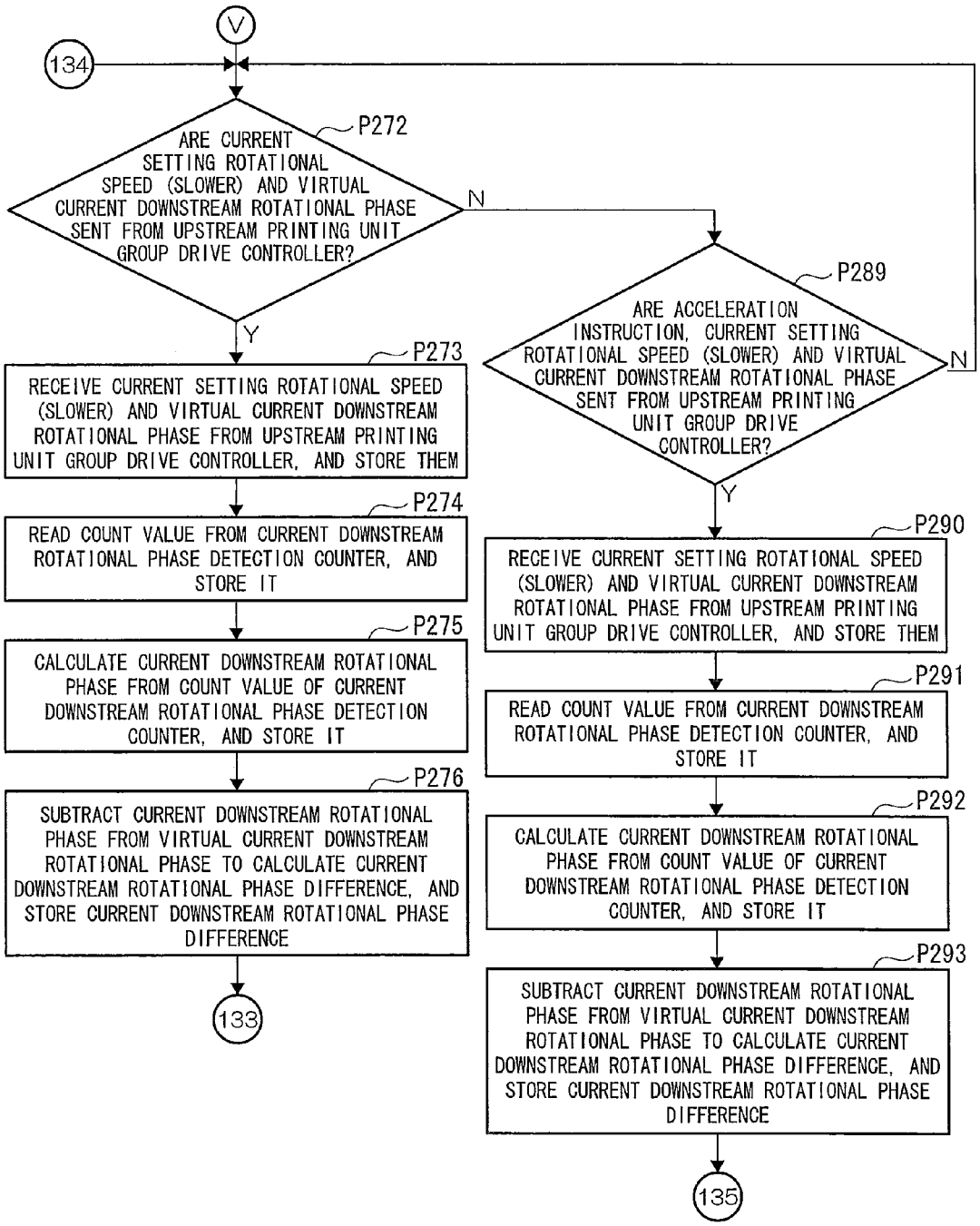

FIG. 57A is an operational flowchart of the downstream printing unit group drive controller.

Figure 57B:
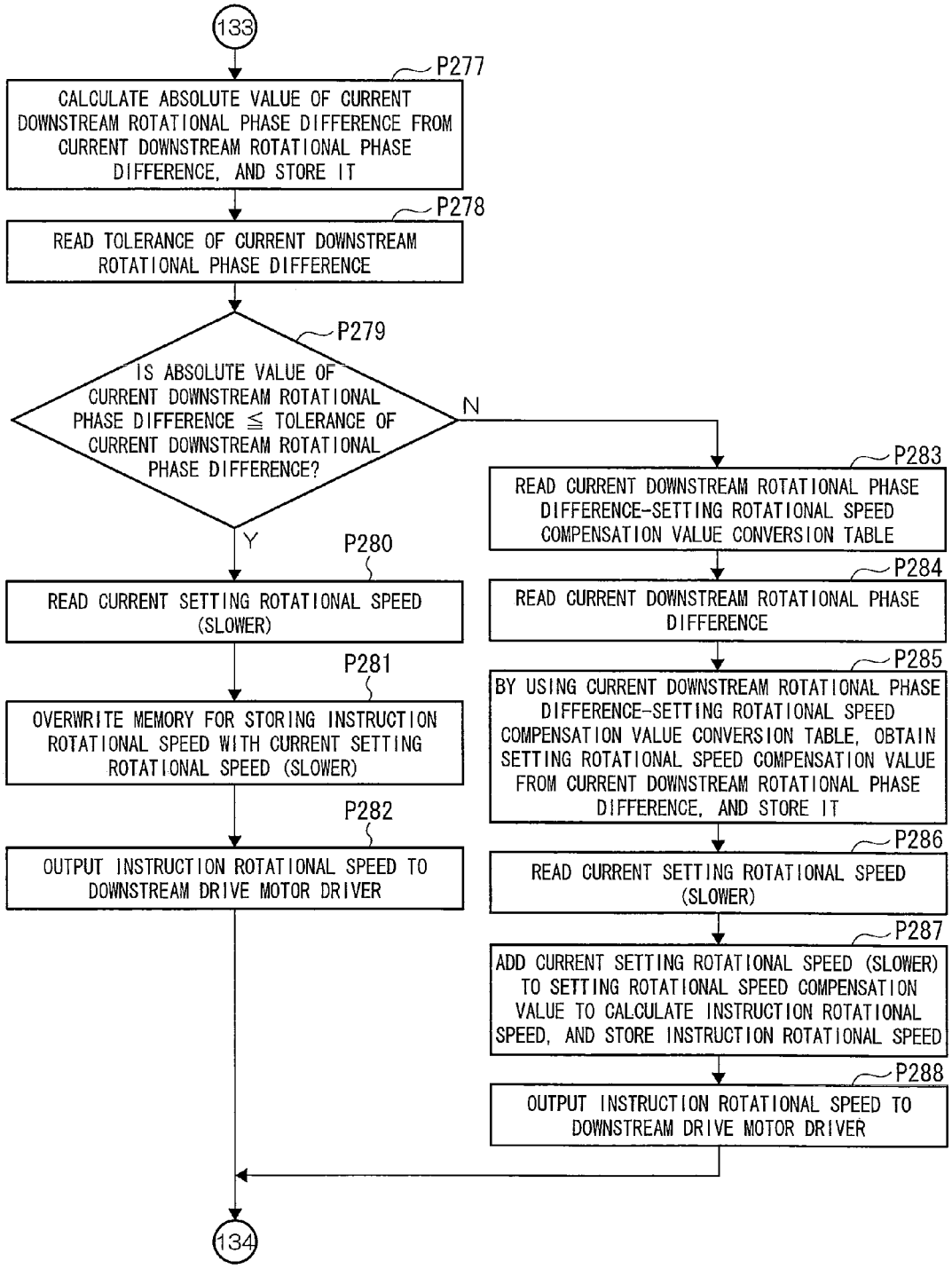

FIG. 57B is an operational flowchart of the downstream printing unit group drive controller.

Figure 57C:
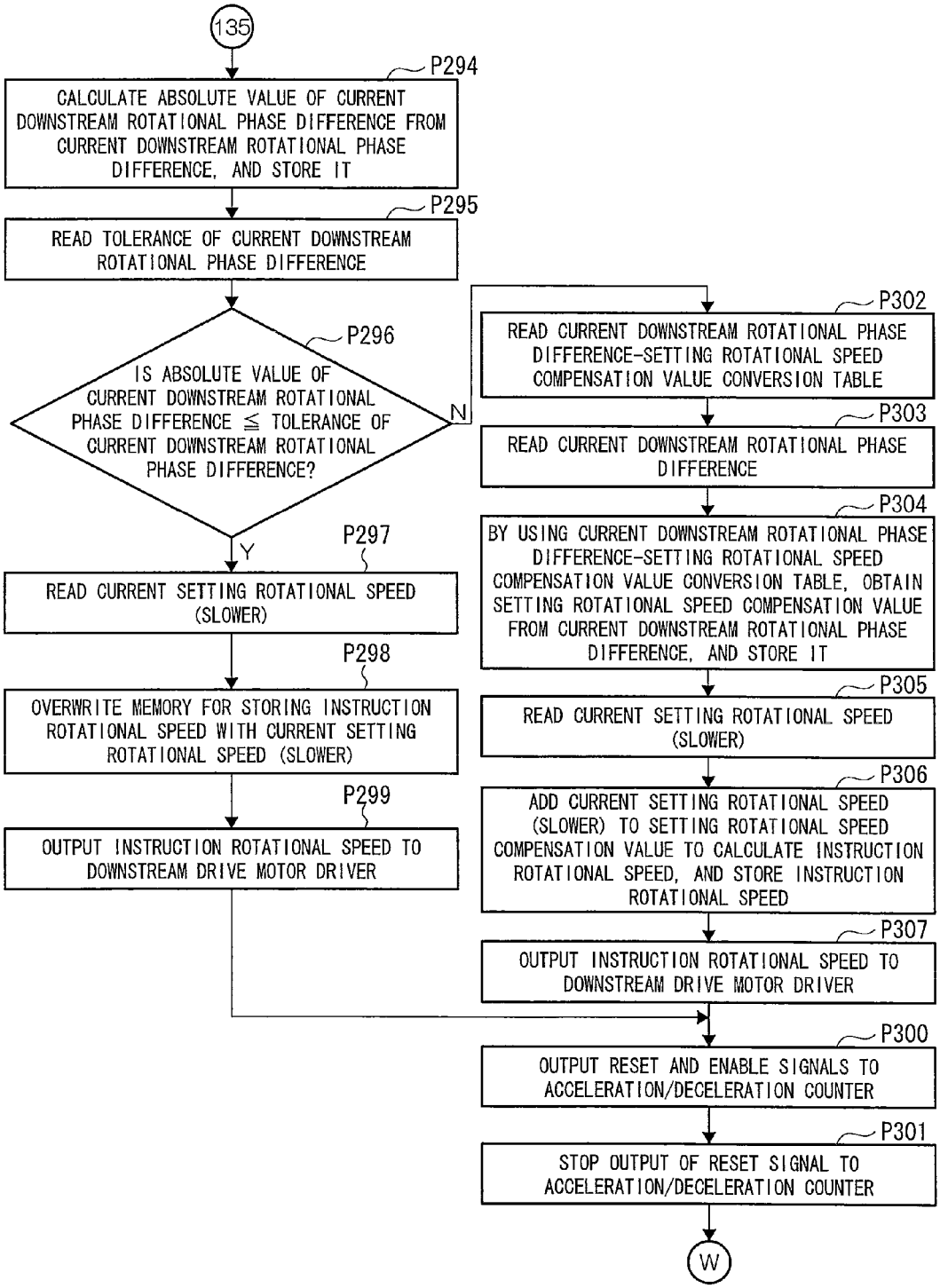

FIG. 57C is an operational flowchart of the downstream printing unit group drive controller.

Figure 58A:
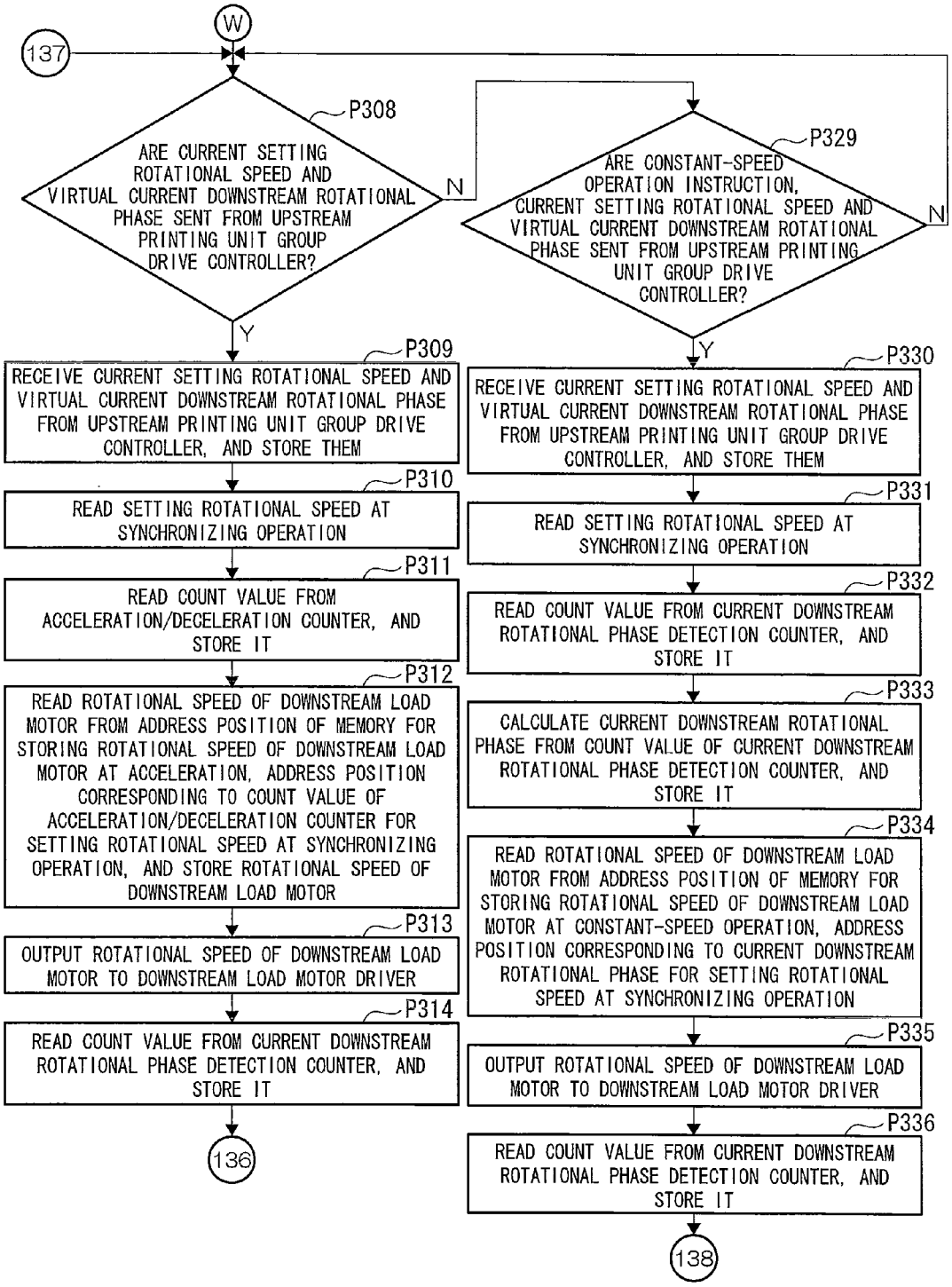

FIG. 58A is an operational flowchart of the downstream printing unit group drive controller.

Figure 58B:
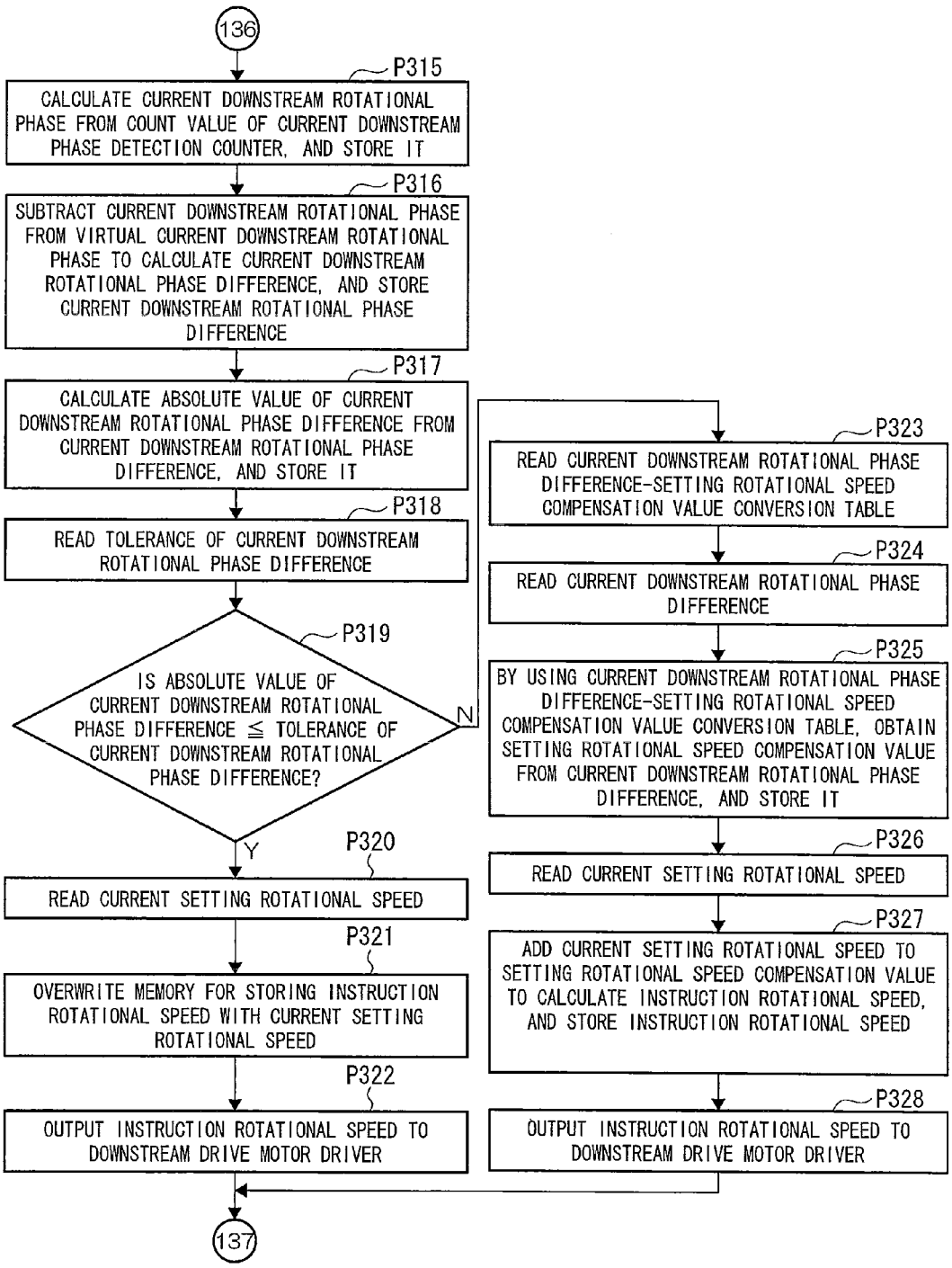

FIG. 58B is an operational flowchart of the downstream printing unit group drive controller.

Figure 58C:
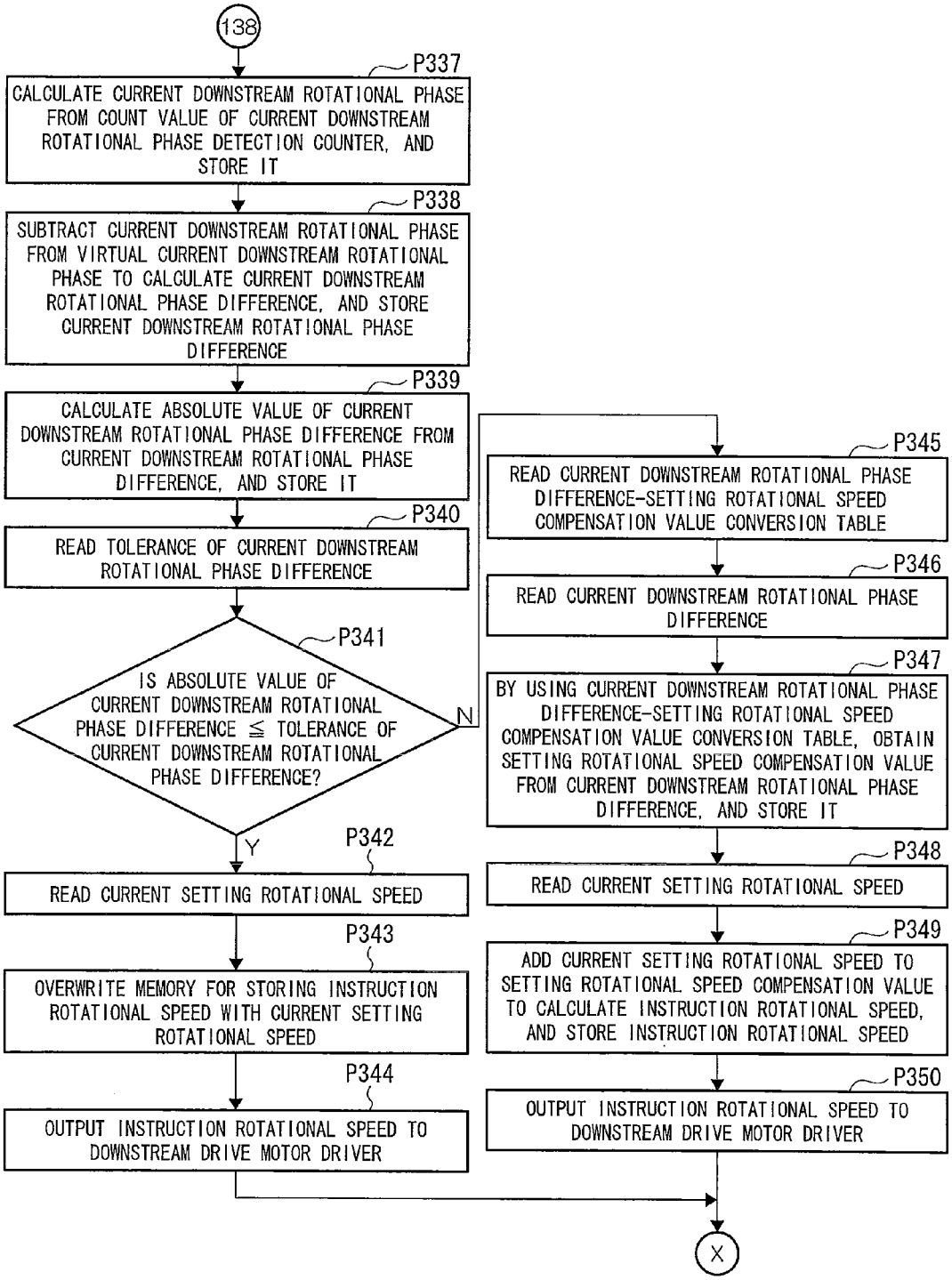

FIG. 58C is an operational flowchart of the downstream printing unit group drive controller.

Figure 59A:
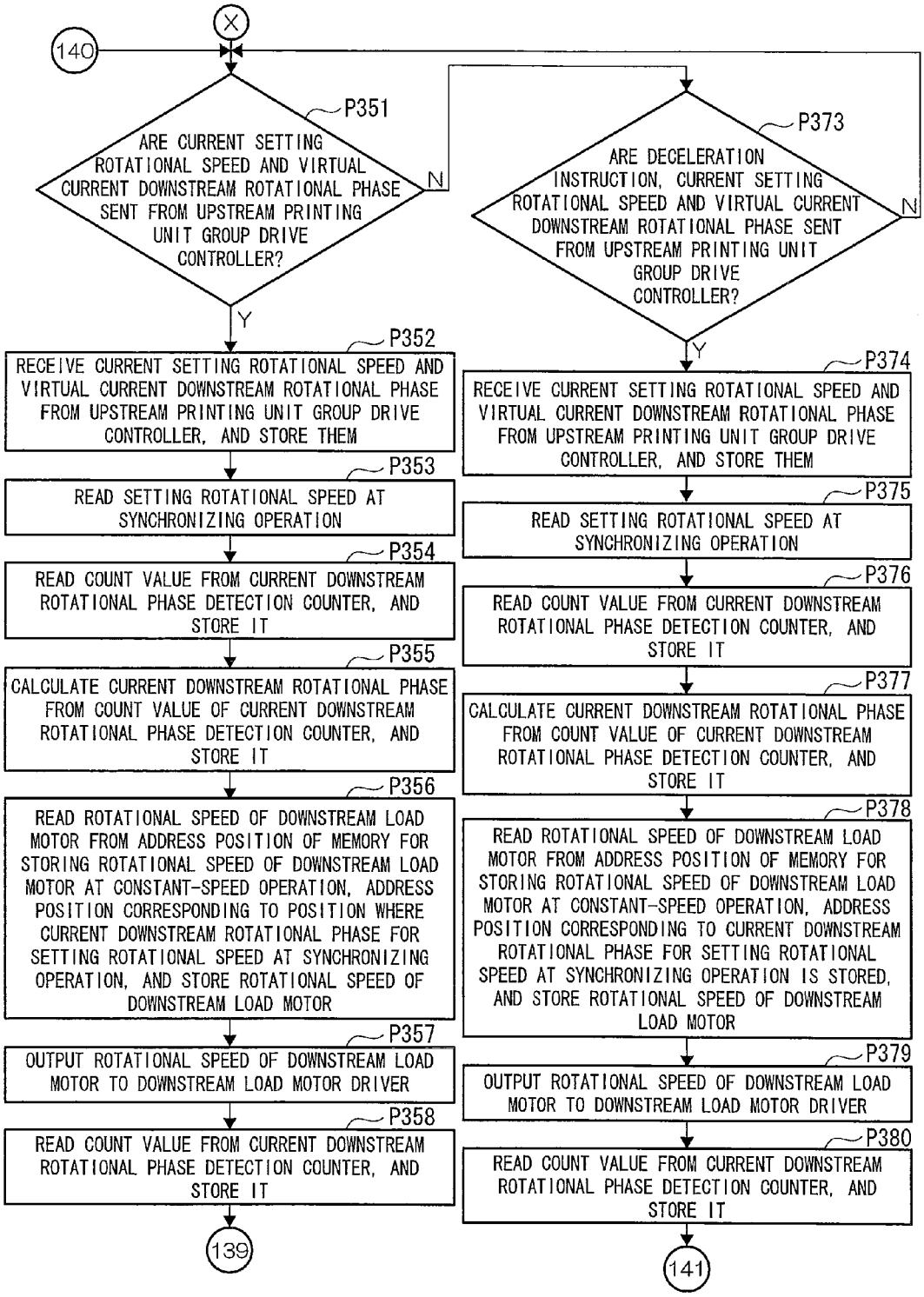

FIG. 59A is an operational flowchart of the downstream printing unit group drive controller.

Figure 59B:
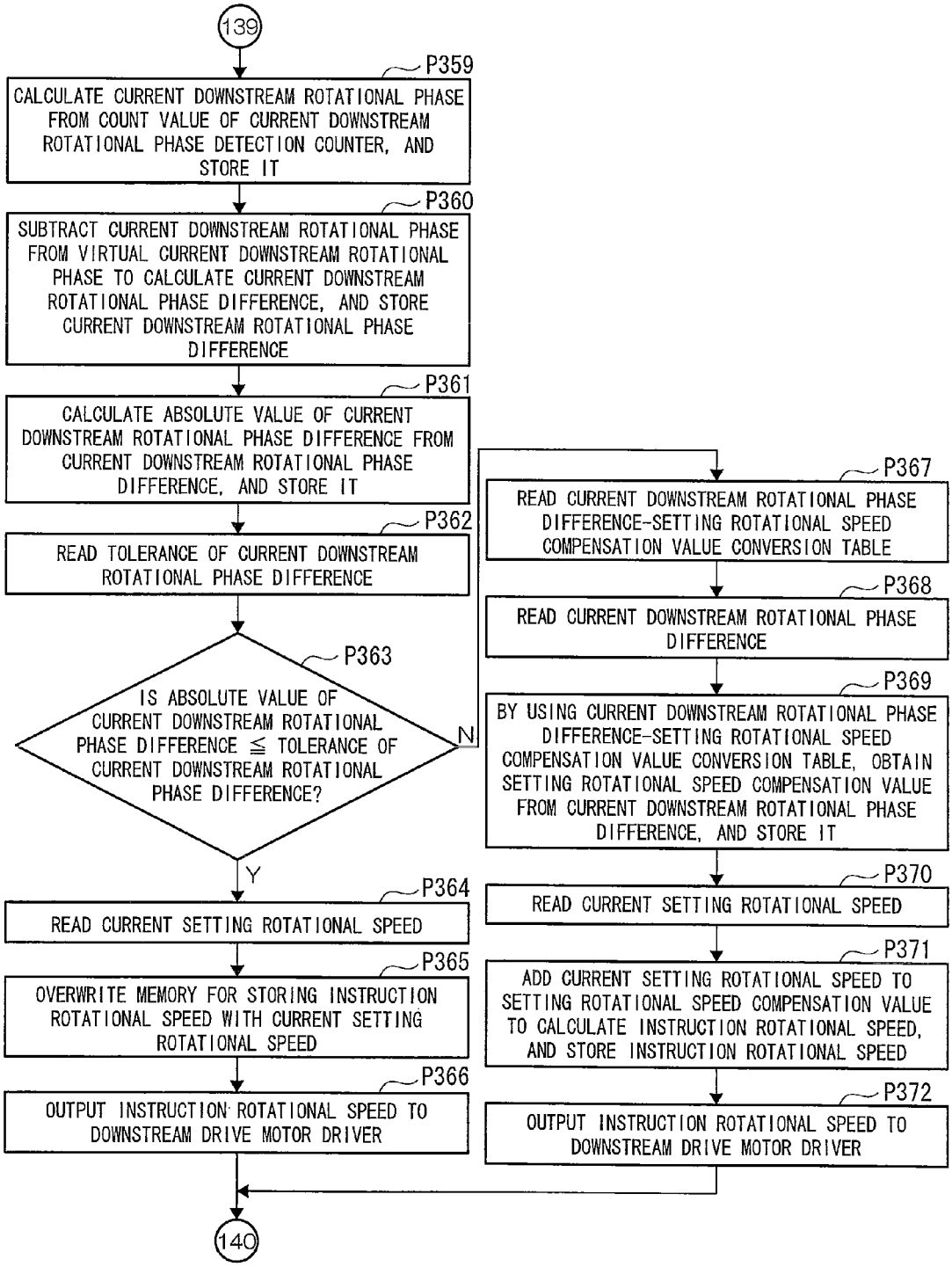

FIG. 59B is an operational flowchart of the downstream printing unit group drive controller.

Figure 59C:
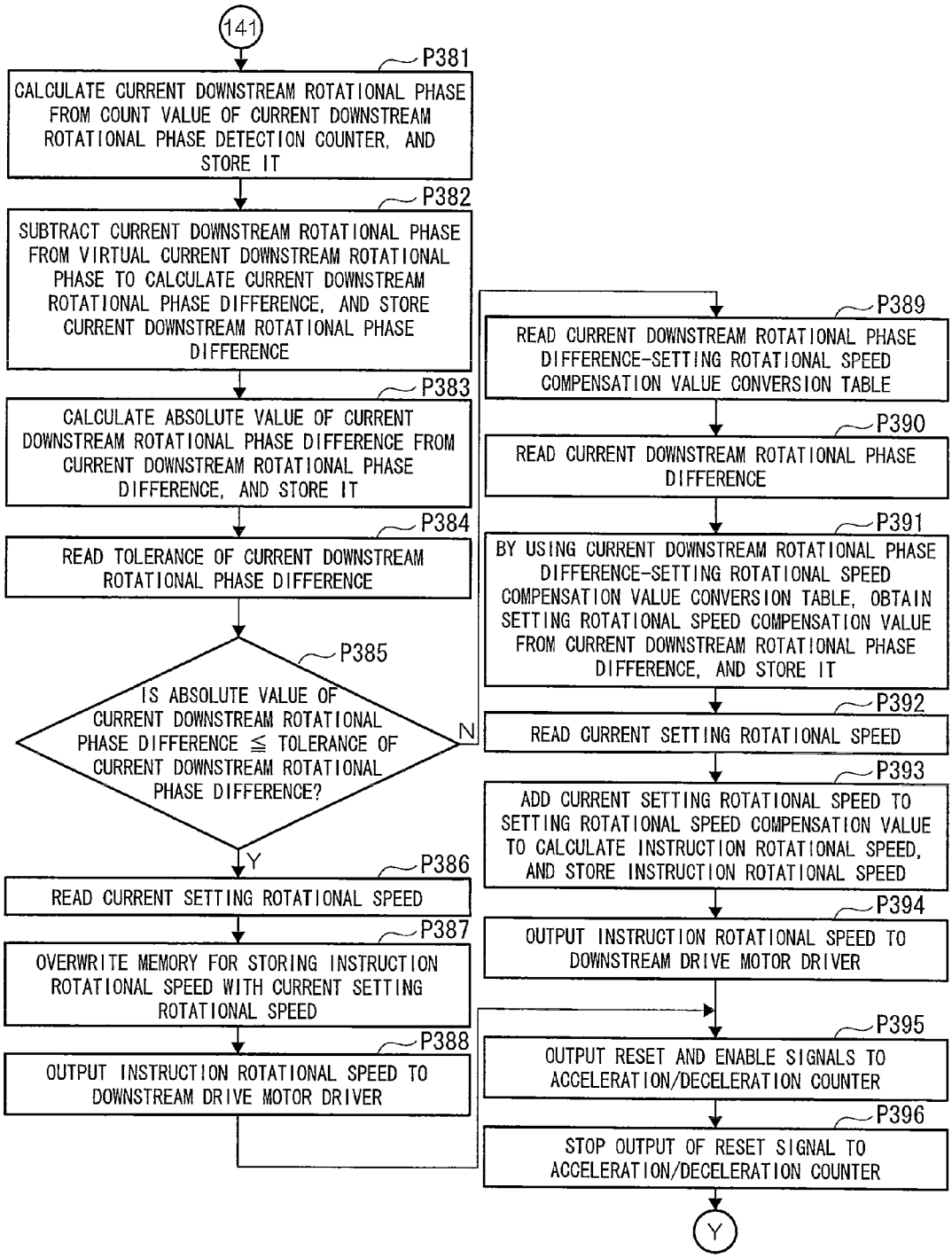

FIG. 59C is an operational flowchart of the downstream printing unit group drive controller.

Figure 60A:
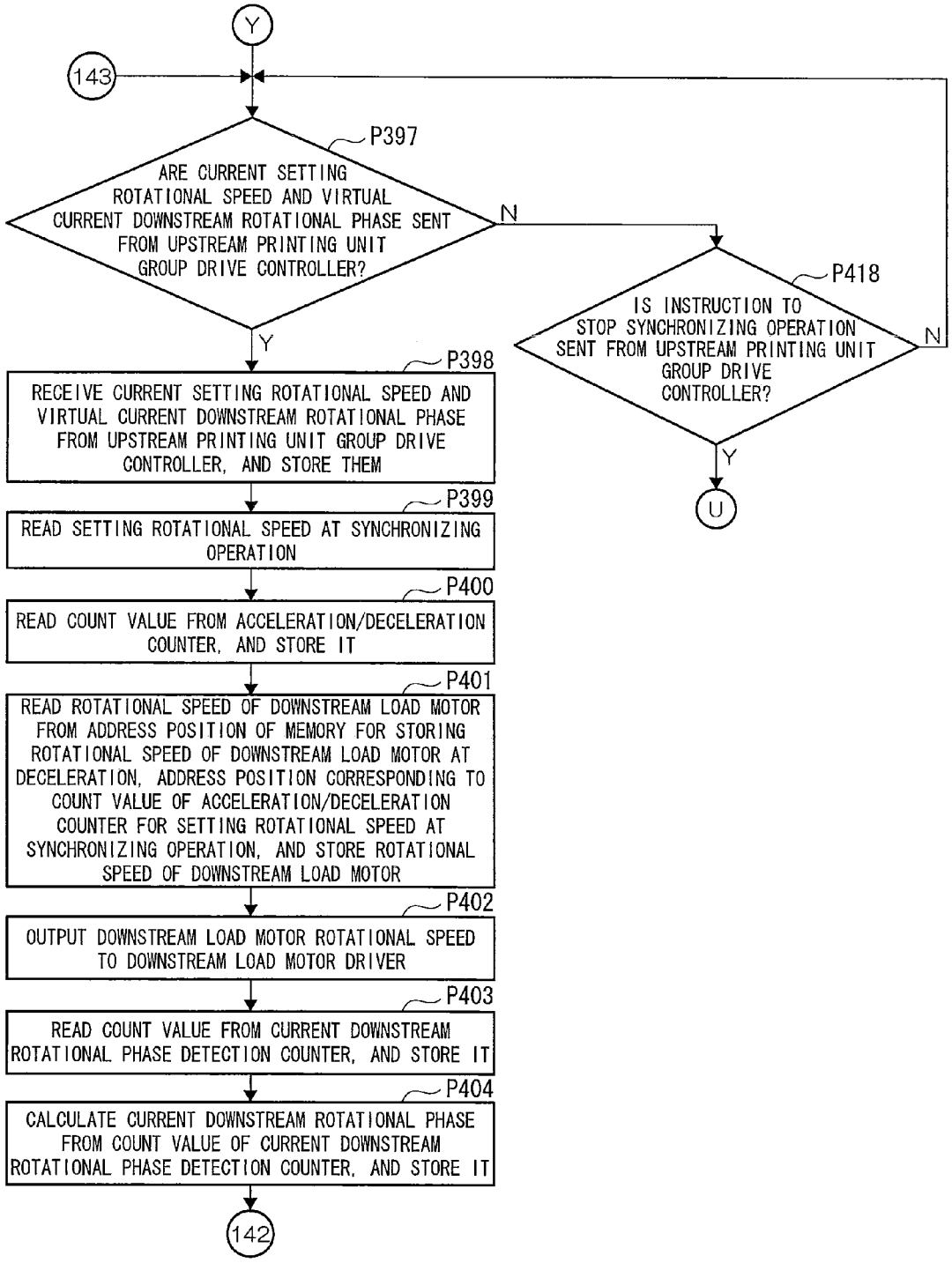

FIG. 60A is an operational flowchart of the downstream printing unit group drive controller.

Figure 60B:
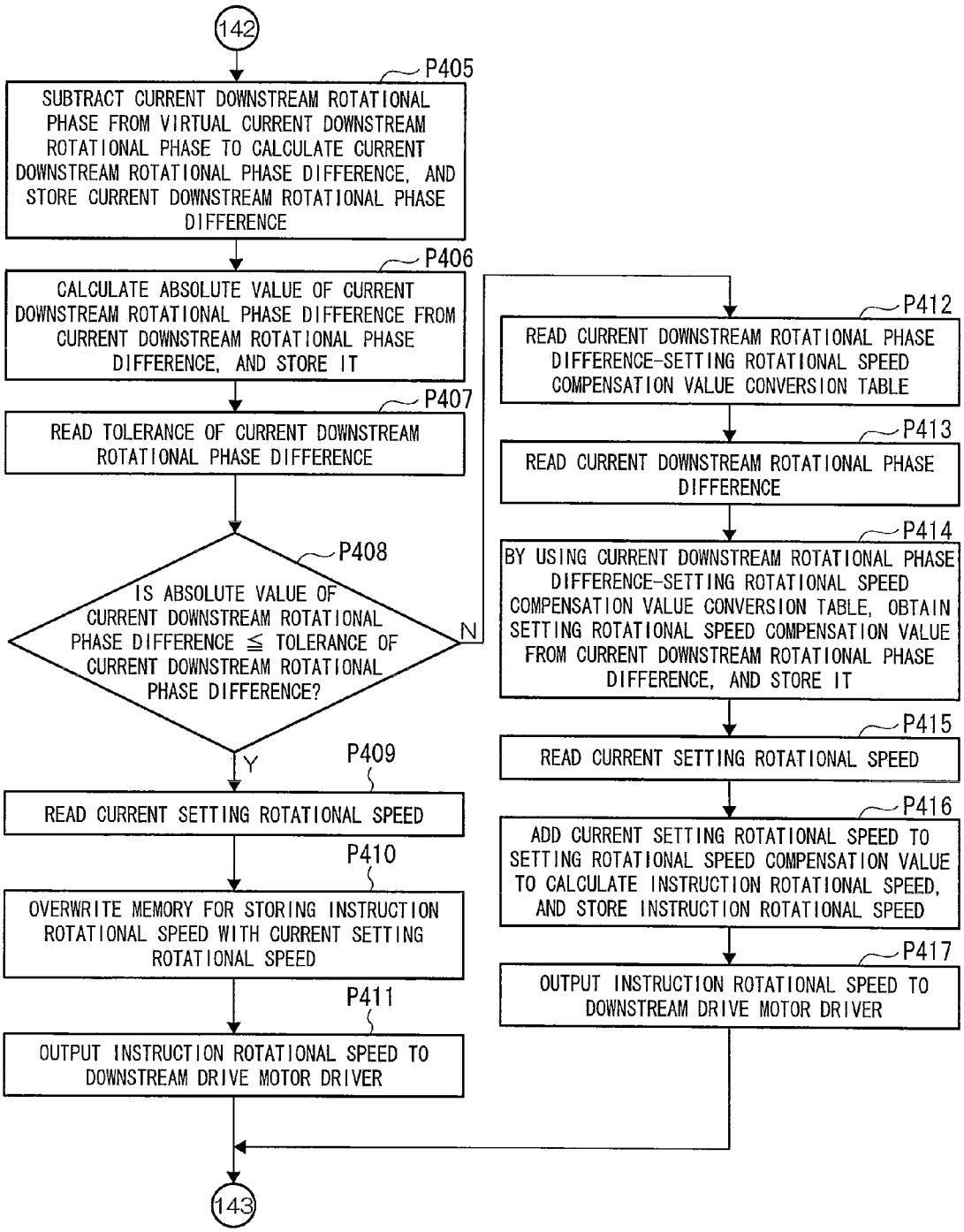

FIG. 60B is an operational flowchart of the downstream printing unit group drive controller.

Figure 61:
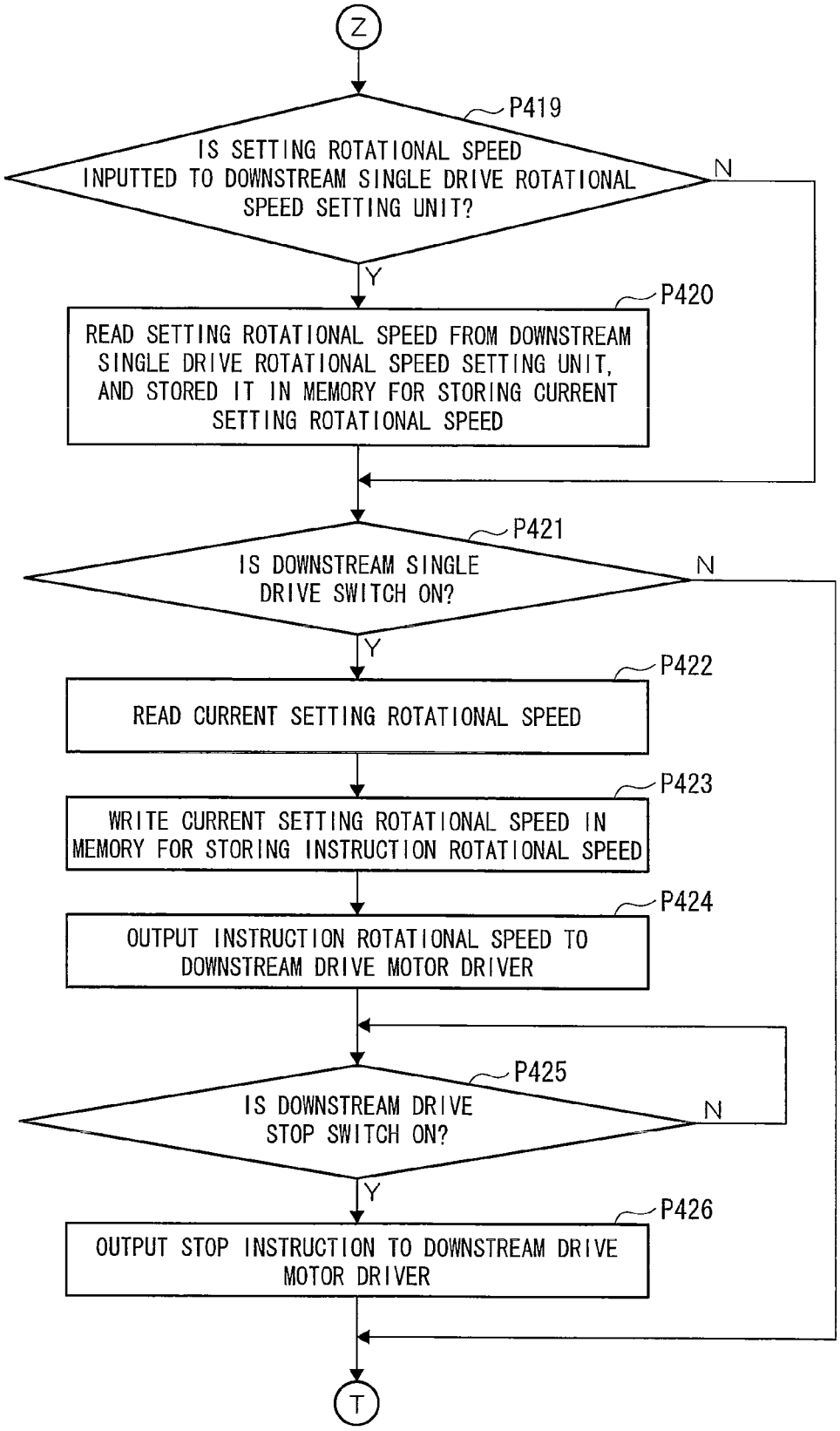

FIG. 61 is an operational flowchart of the downstream printing unit group drive controller.

Figure 62:
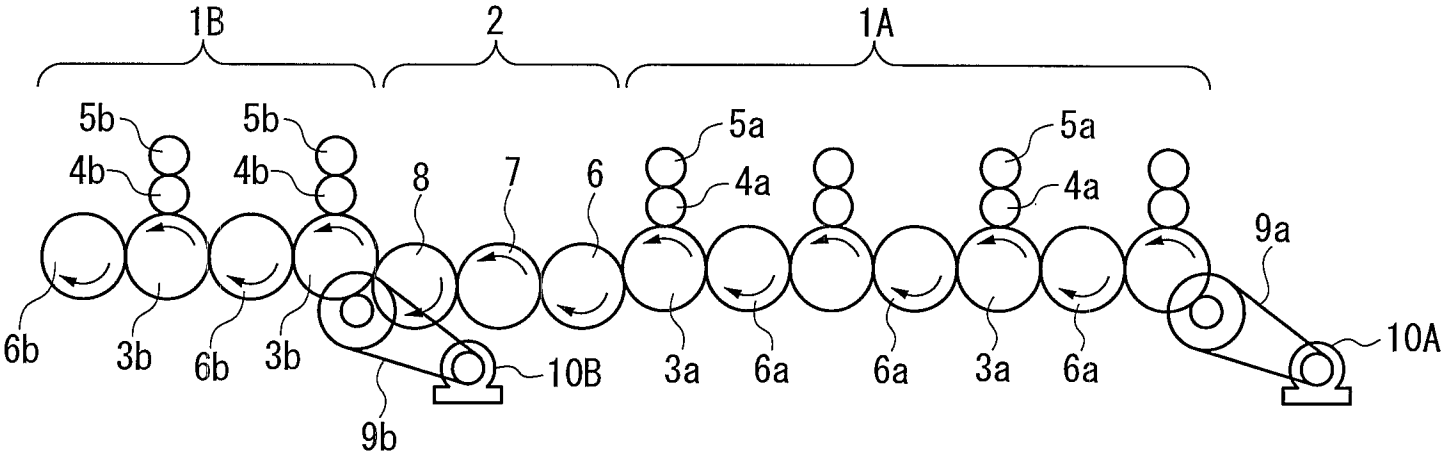

FIG. 62 is a side view showing a schematic structure of a sheet-fed convertible offset printing press.

Figure 63:
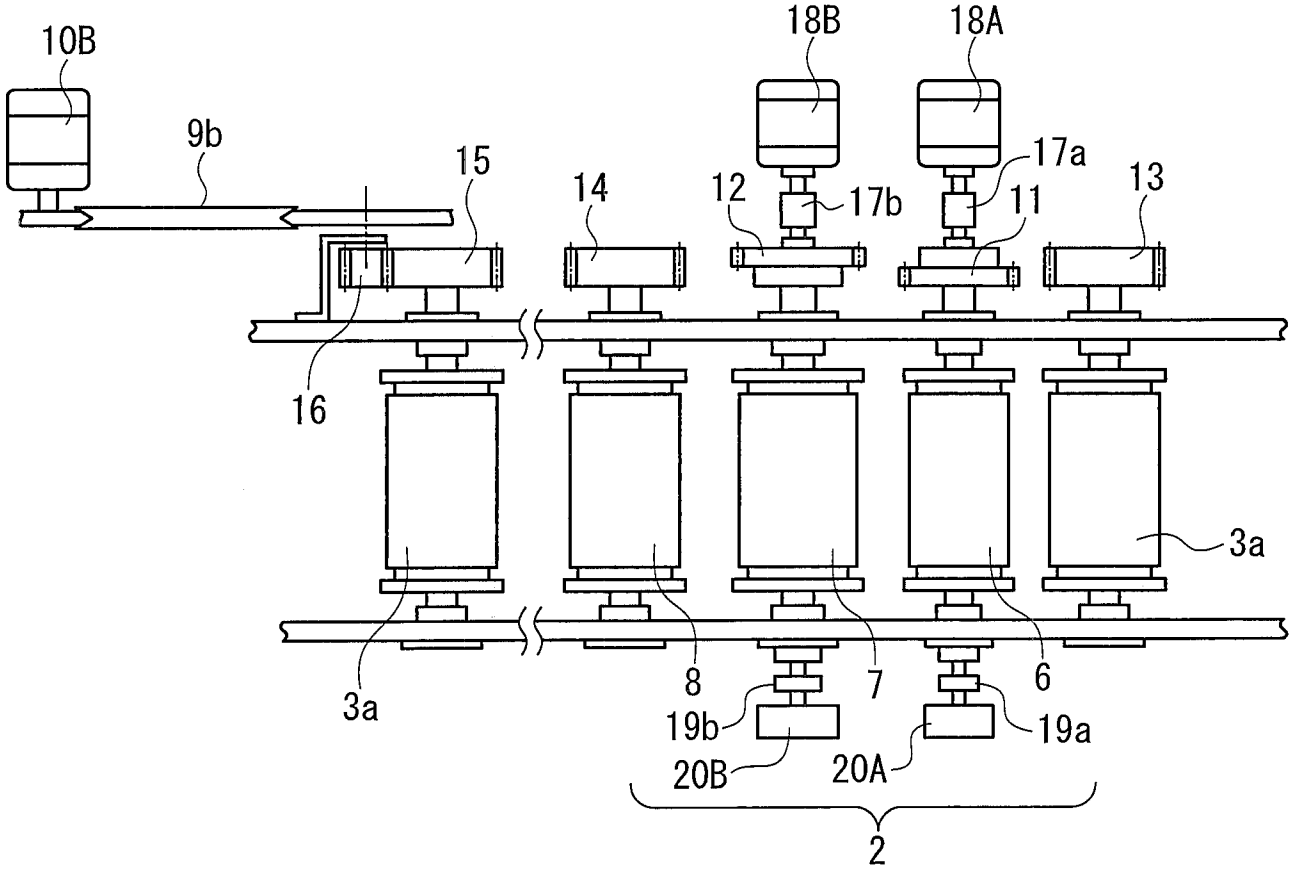

FIG. 63 is a plan view showing a drive separation section of the sheet-fed convertible offset printing press.

Figure 64:
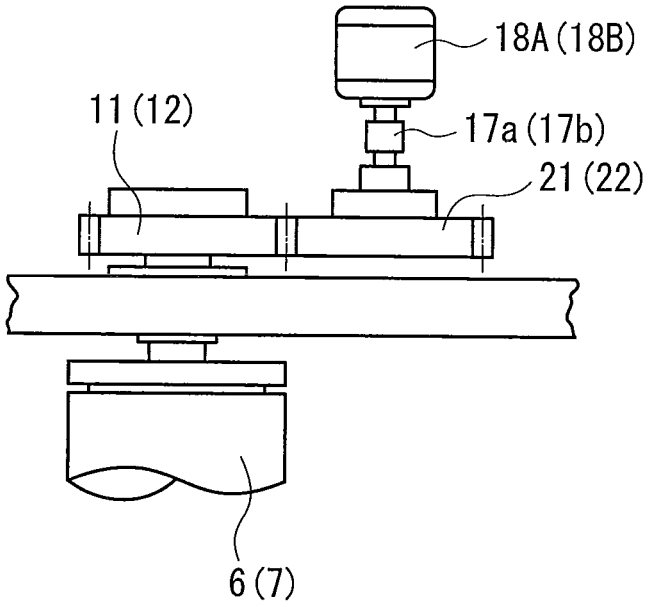

FIG. 64 is a plan view of a main portion showing a modification of the drive separation section of the sheet-fed convertible offset printing press.

DESCRIPTION OF EMBODIMENTS

Hereinafter, with reference to the drawings, a description is given in detail of embodiments of a method and an apparatus for driving a processor according to the present invention.

EXAMPLES

[Embodiment 1]

Figure 1A:
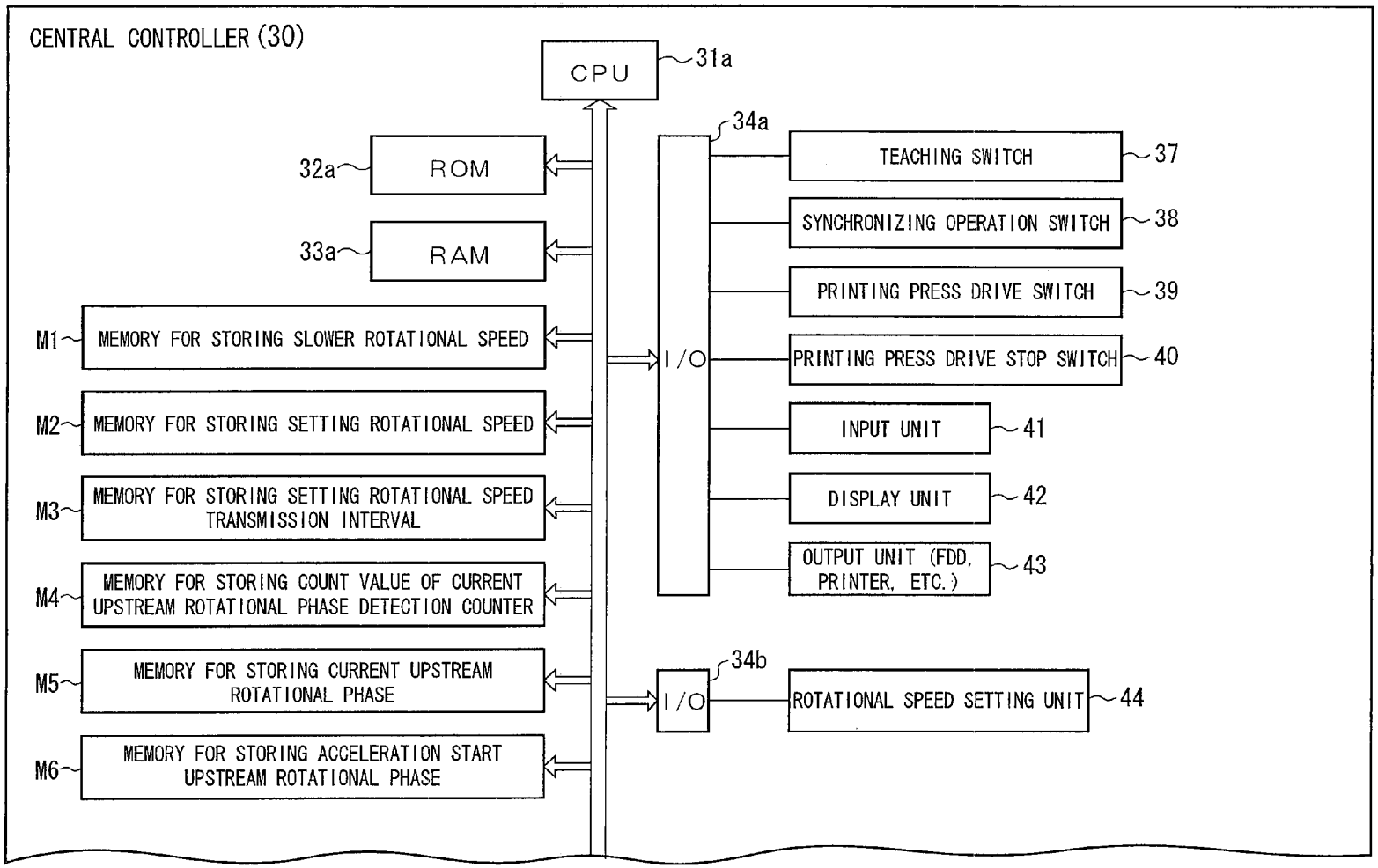
FIG. 1A is a hardware block diagram of a central controller according to Embodiment 1 of the present invention.
Figure 1B:
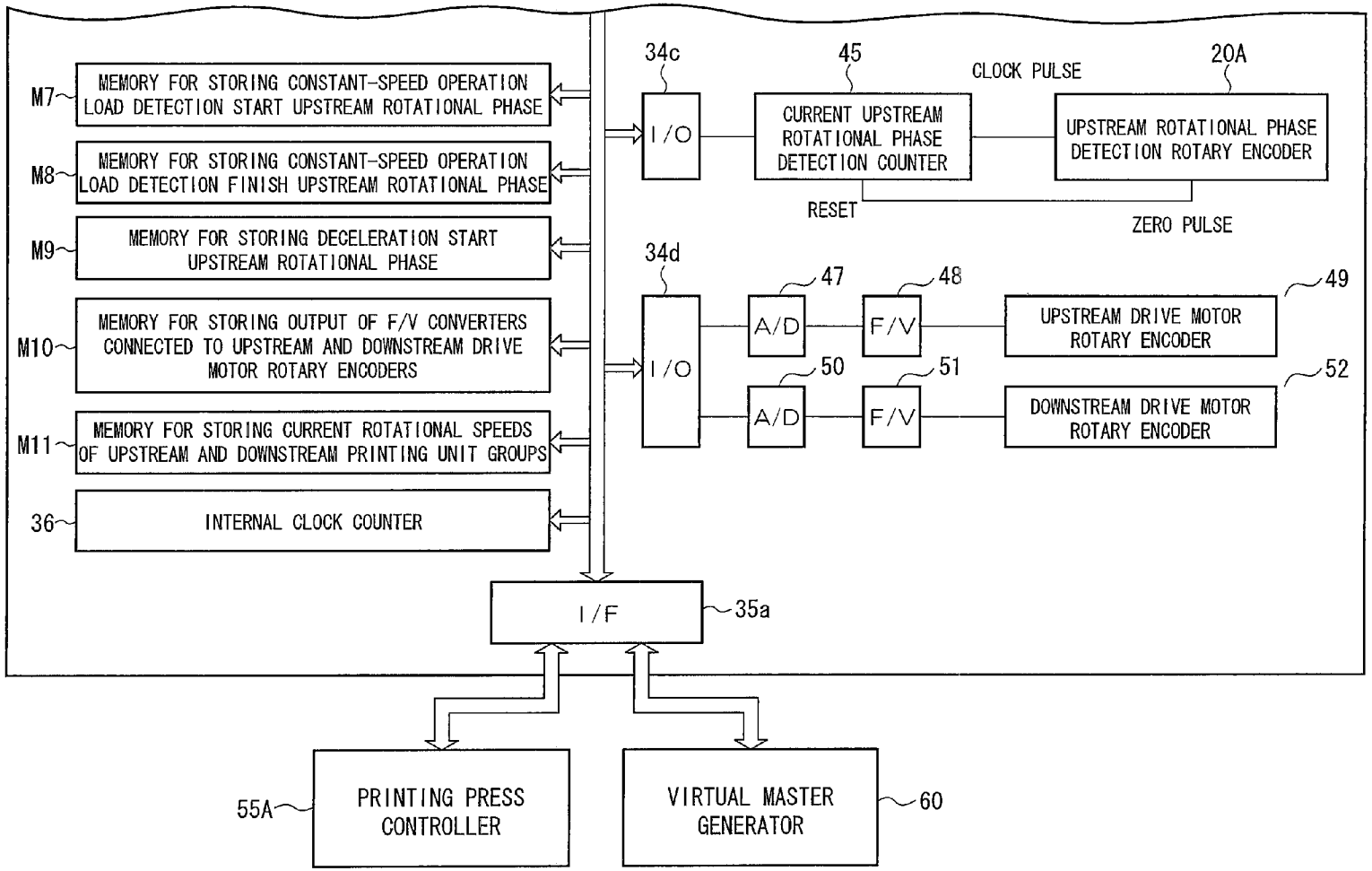
FIG. 1B is a hardware block diagram of the central controller according to Embodiment 1 of the present invention.
Figure 2:
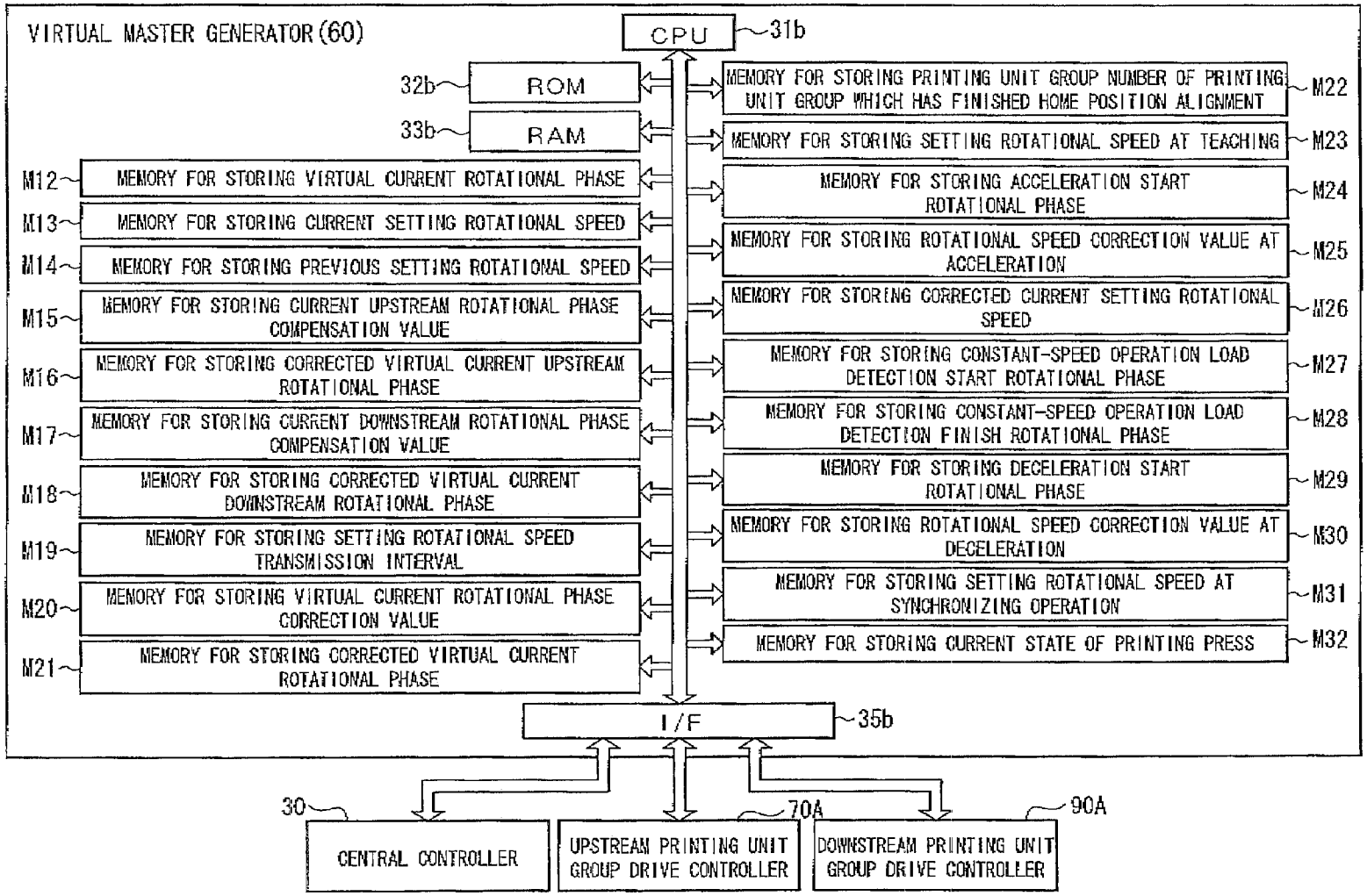
FIG. 2 is a hardware block diagram of a virtual master generator.
Figure 3A:
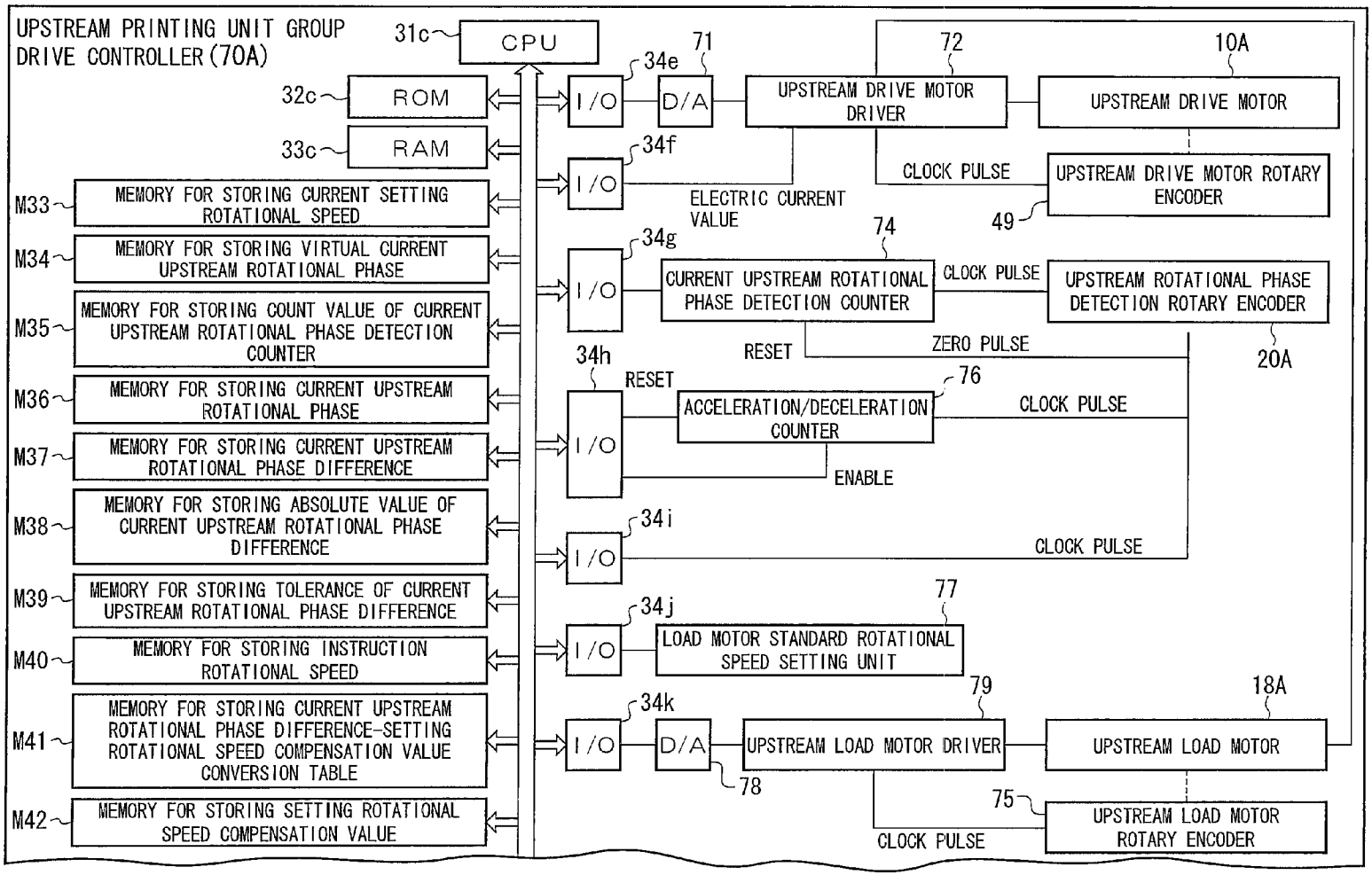
FIG. 3A is a hardware block diagram of an upstream printing unit group drive controller.
Figure 3B:
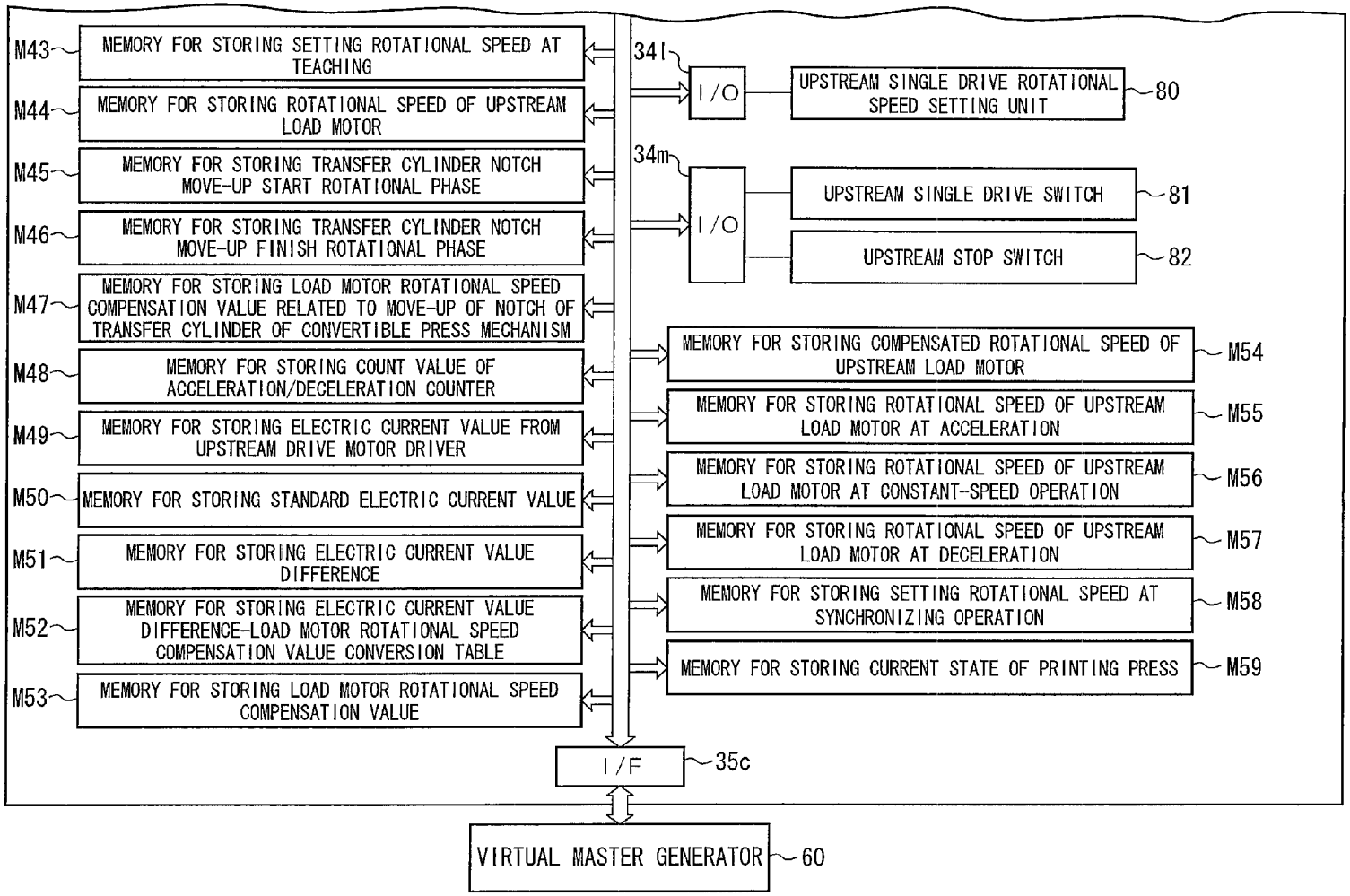
FIG. 3B is a hardware block diagram of the upstream printing unit group drive controller.
Figure 4A:
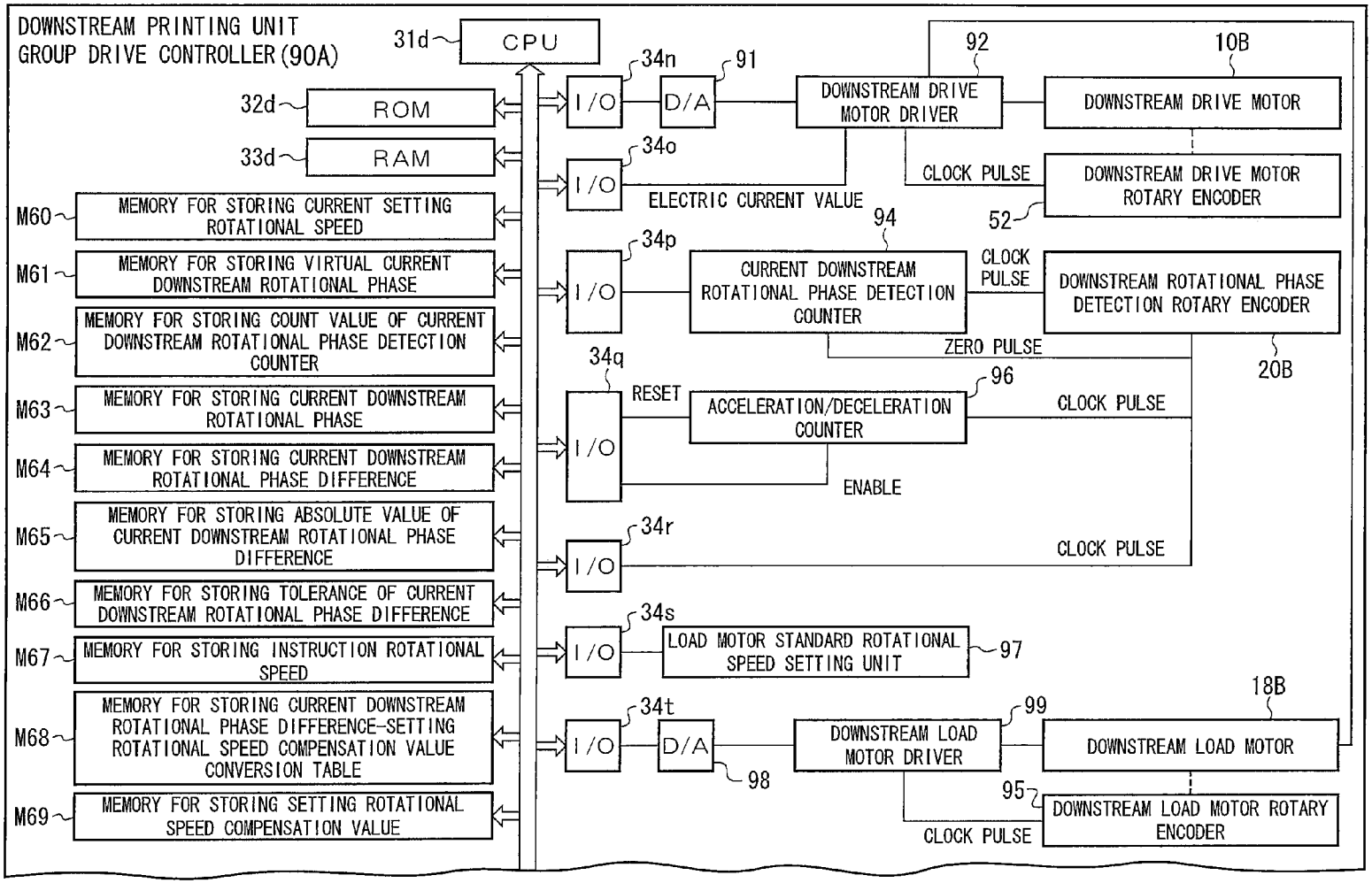
FIG. 4A is a hardware block diagram of a downstream printing unit group drive controller.
Figure 4B:
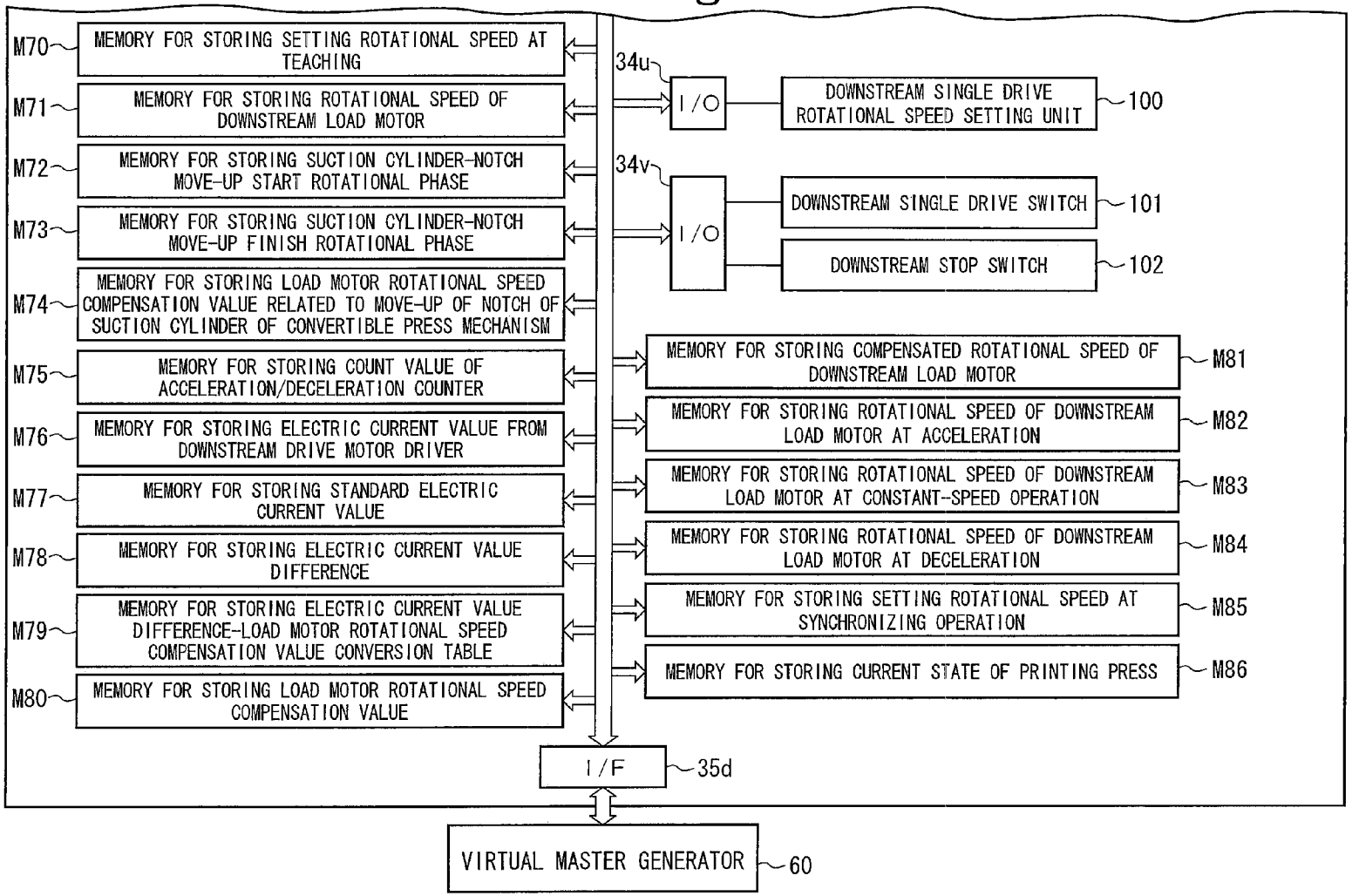
FIG. 4B is a hardware block diagram of the downstream printing unit group drive controller.
Figure 5A:
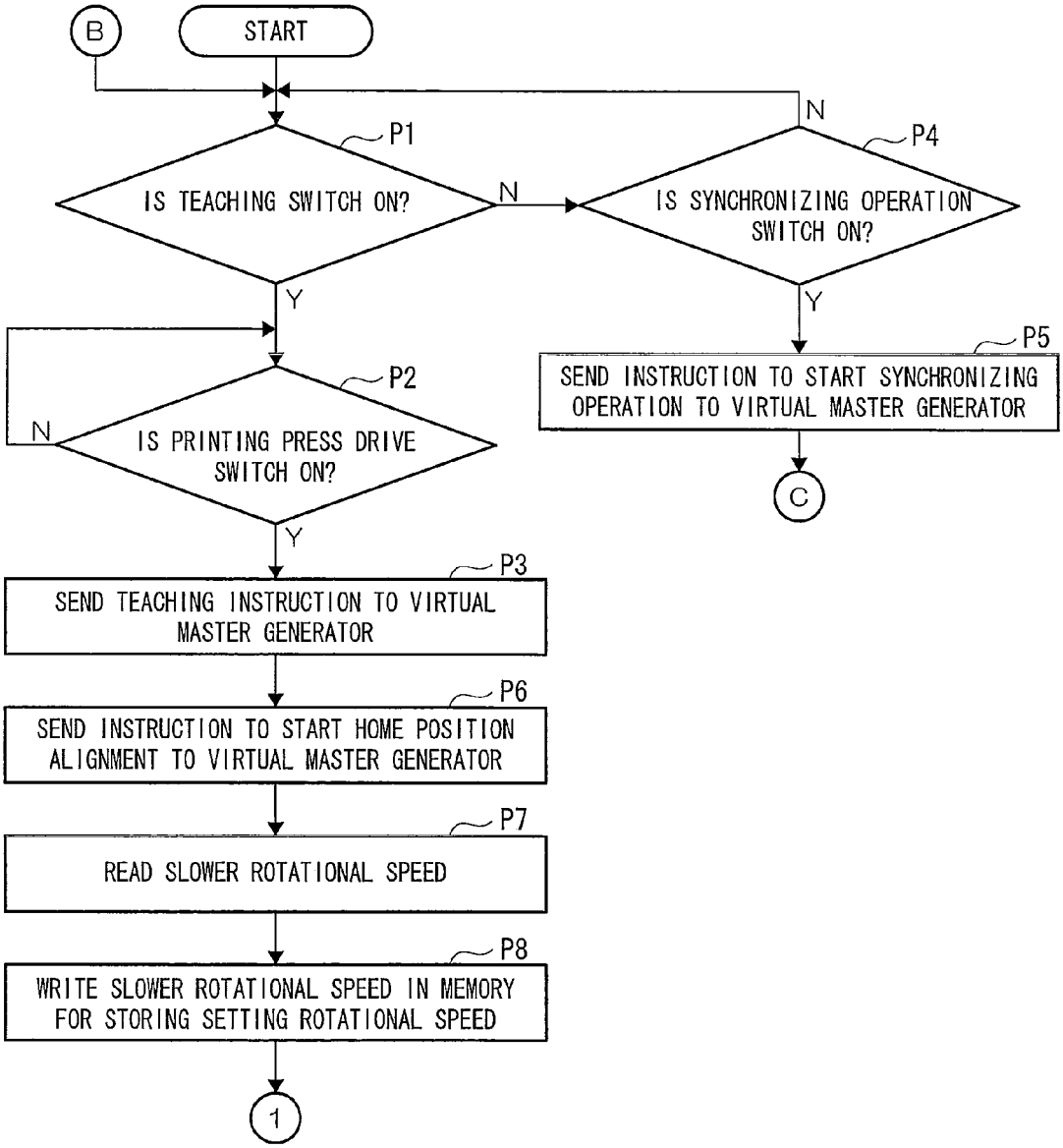
FIG. 5A is an operational flowchart of the central controller.
Figure 5B:
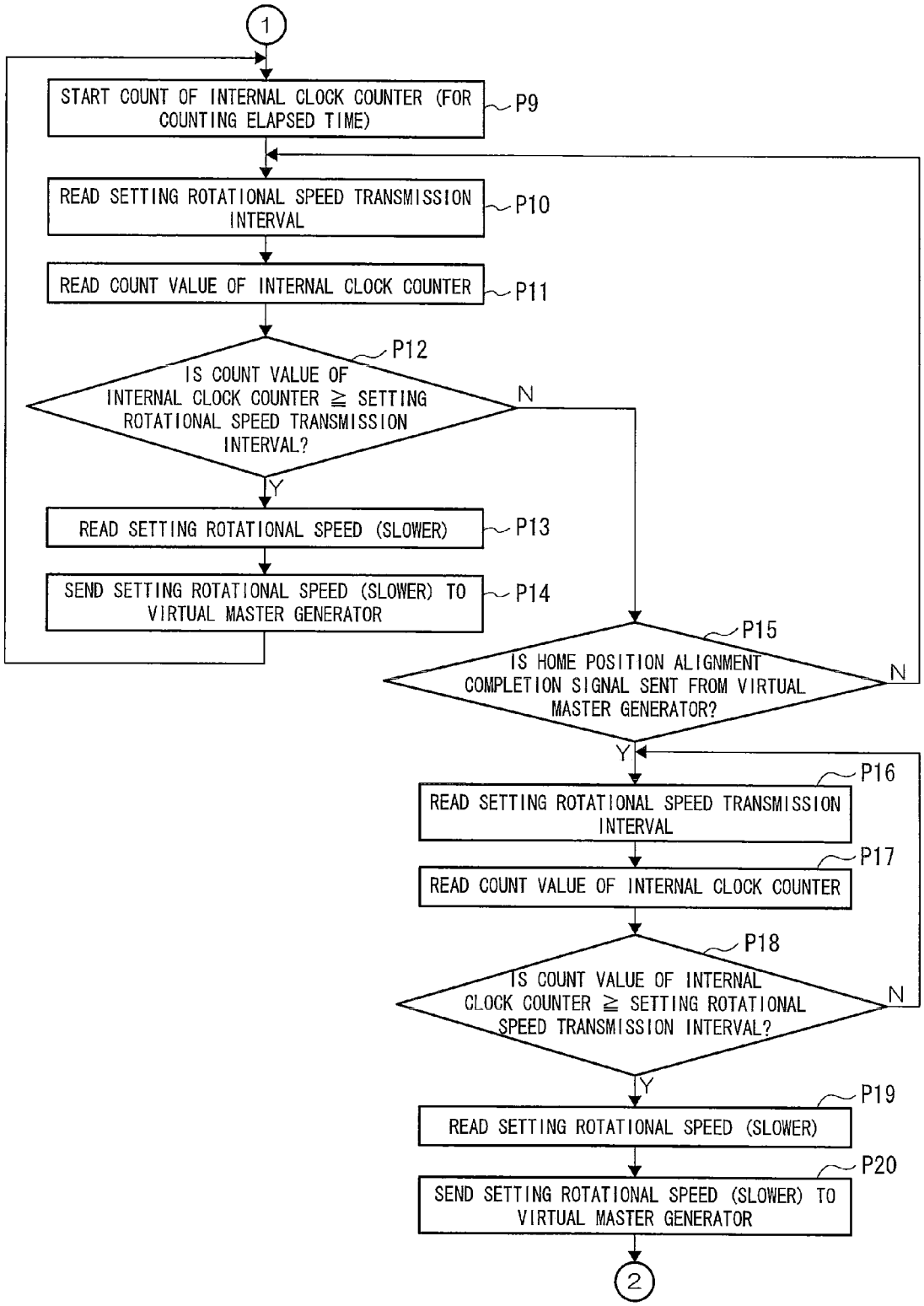
FIG. 5B is an operational flowchart of the central controller.
Figure 5C:
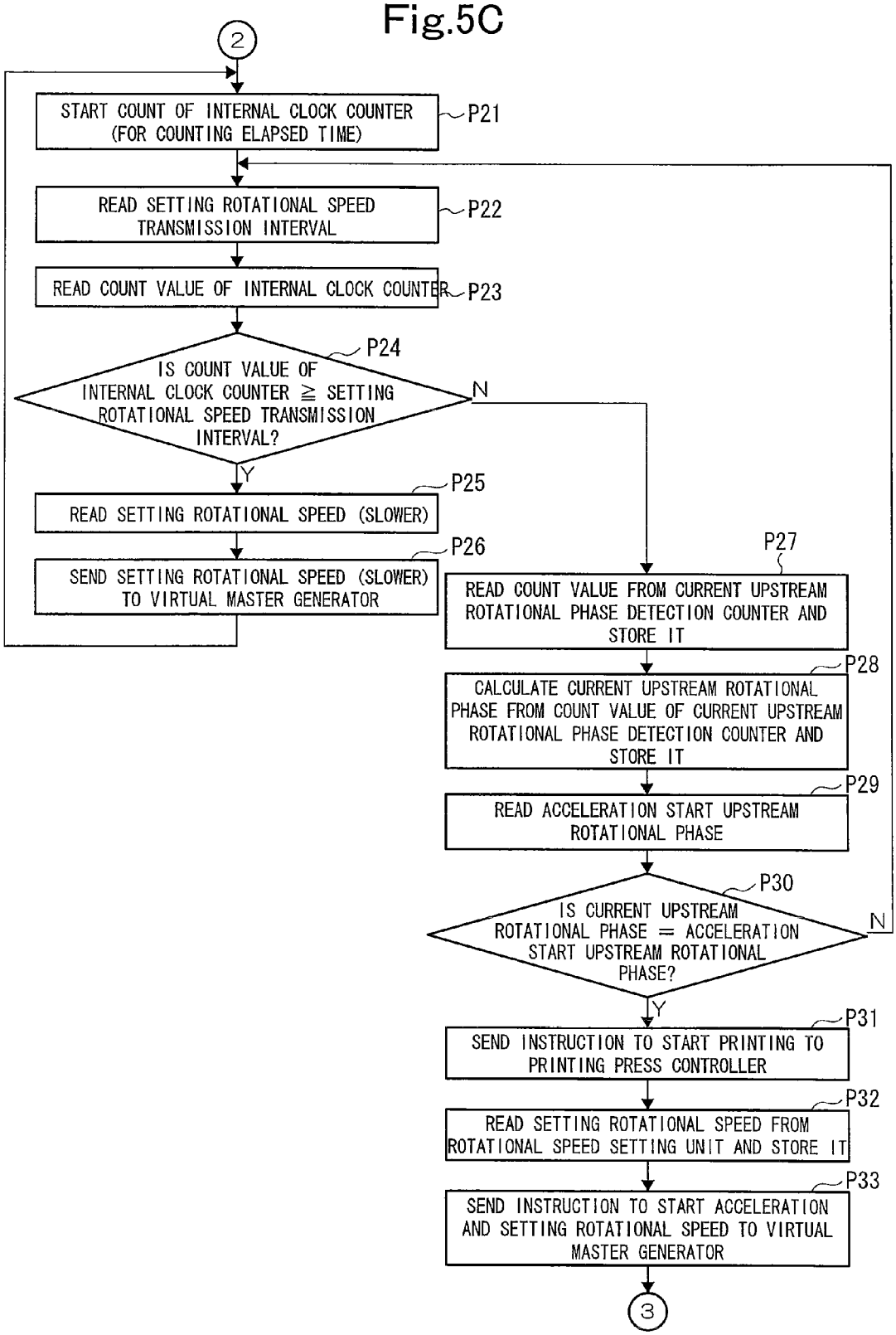
FIG. 5C is an operational flowchart of the central controller.
Figure 5D:
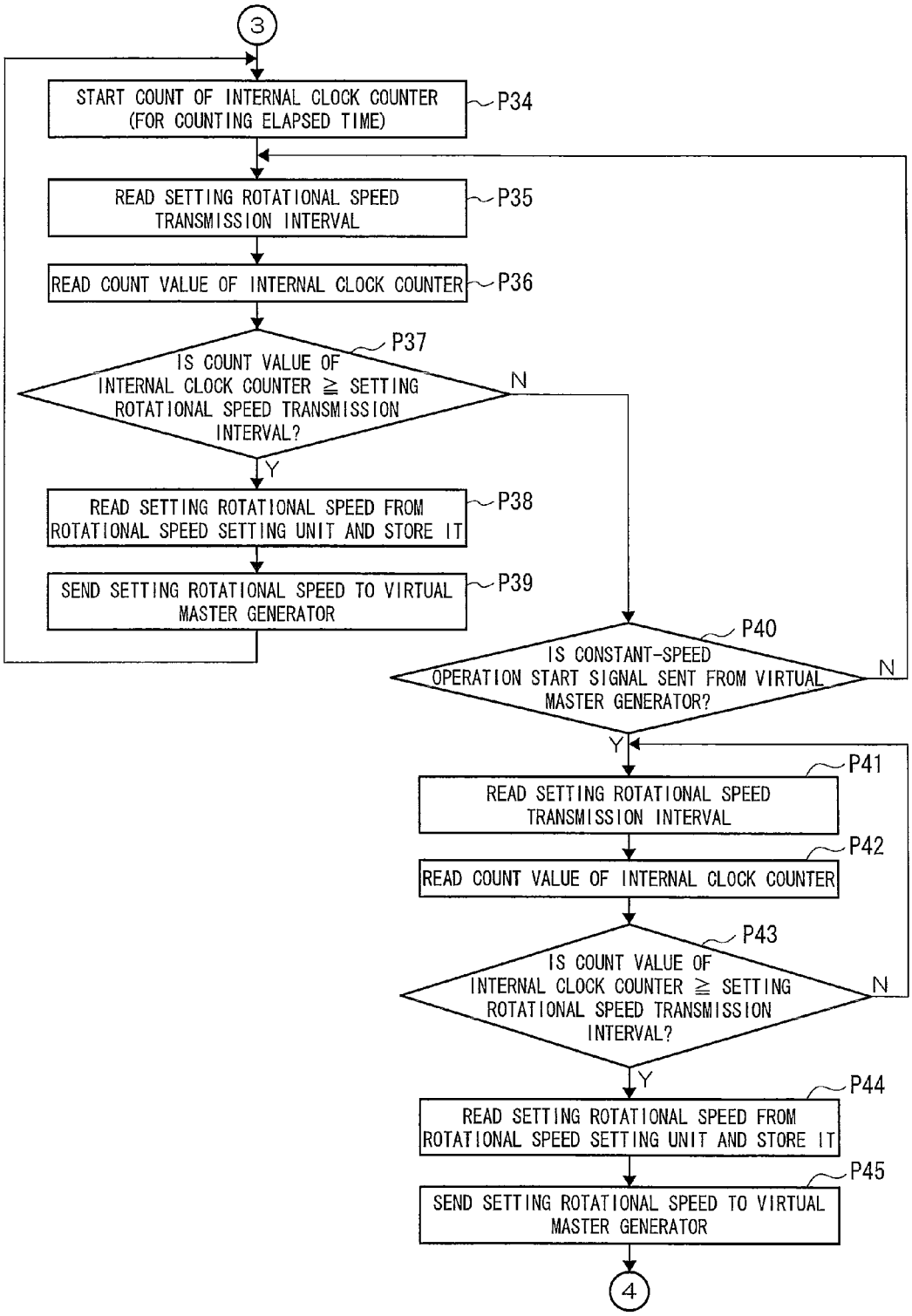
FIG. 5D is an operational flowchart of the central controller.
Figure 5E:
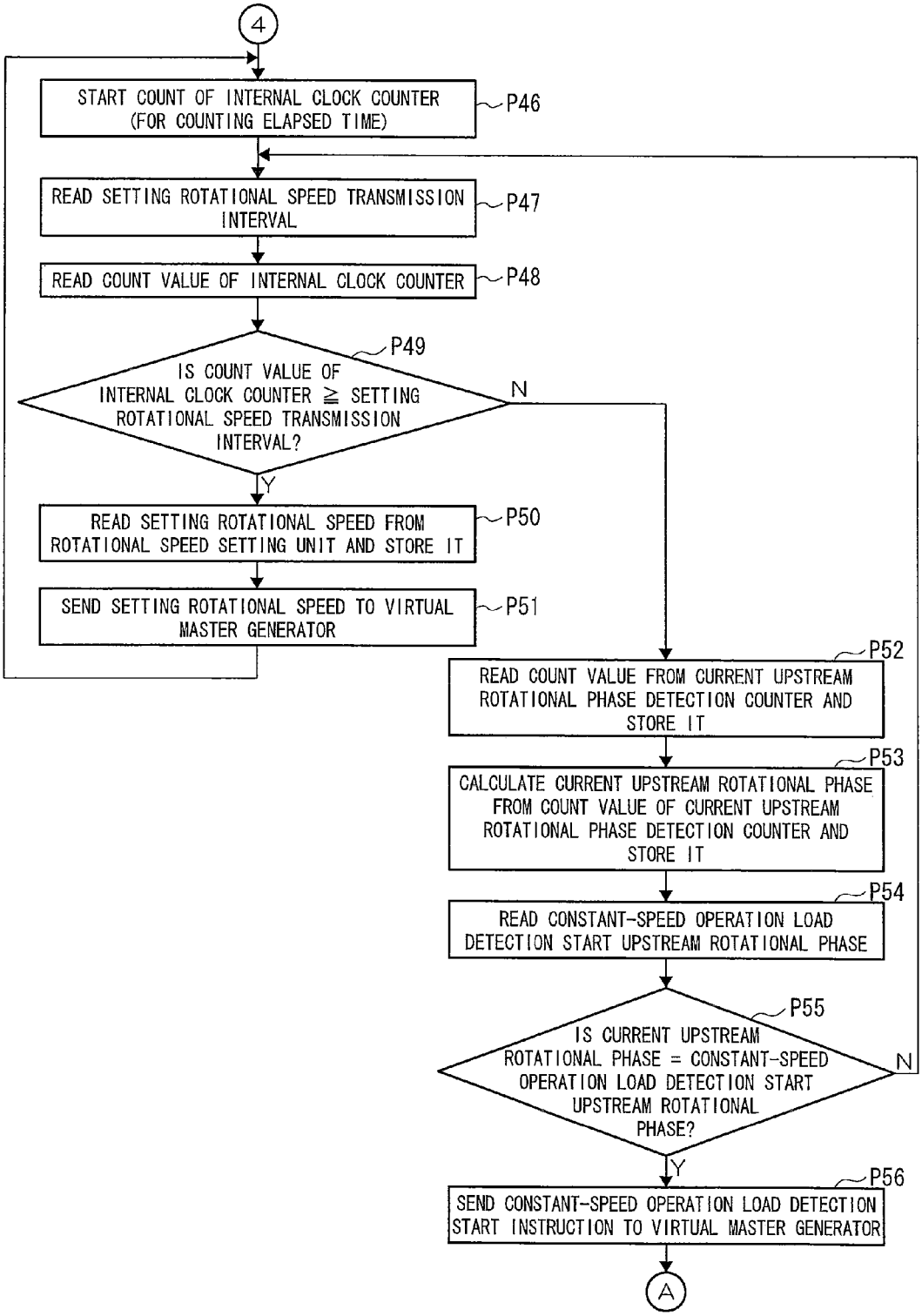
FIG. 5E is an operational flowchart of the central controller.

FIGS. 1A and 1B are hardware block diagrams of a central controller according to Embodiment 1 of the present invention. FIG. 2 is a hardware block diagram of a virtual master generator. FIGS. 3A and 3B are hardware block diagrams of an upstream printing unit group drive controller. FIGS. 4A and 4B are hardware block diagrams of a downstream printing unit group drive controller.

Figure 6A:
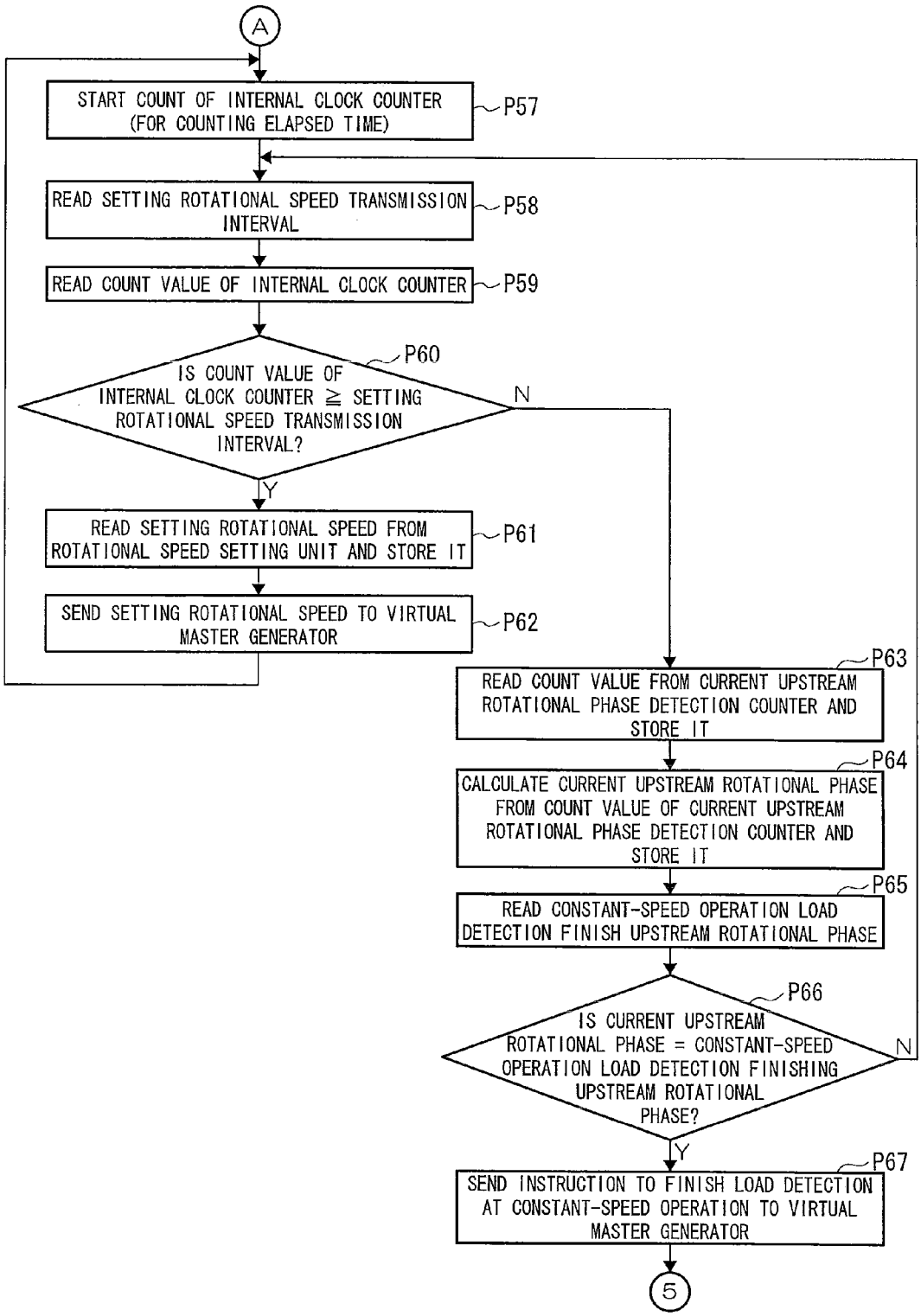
FIG. 6A is an operational flowchart of the central controller.
Figure 6B:
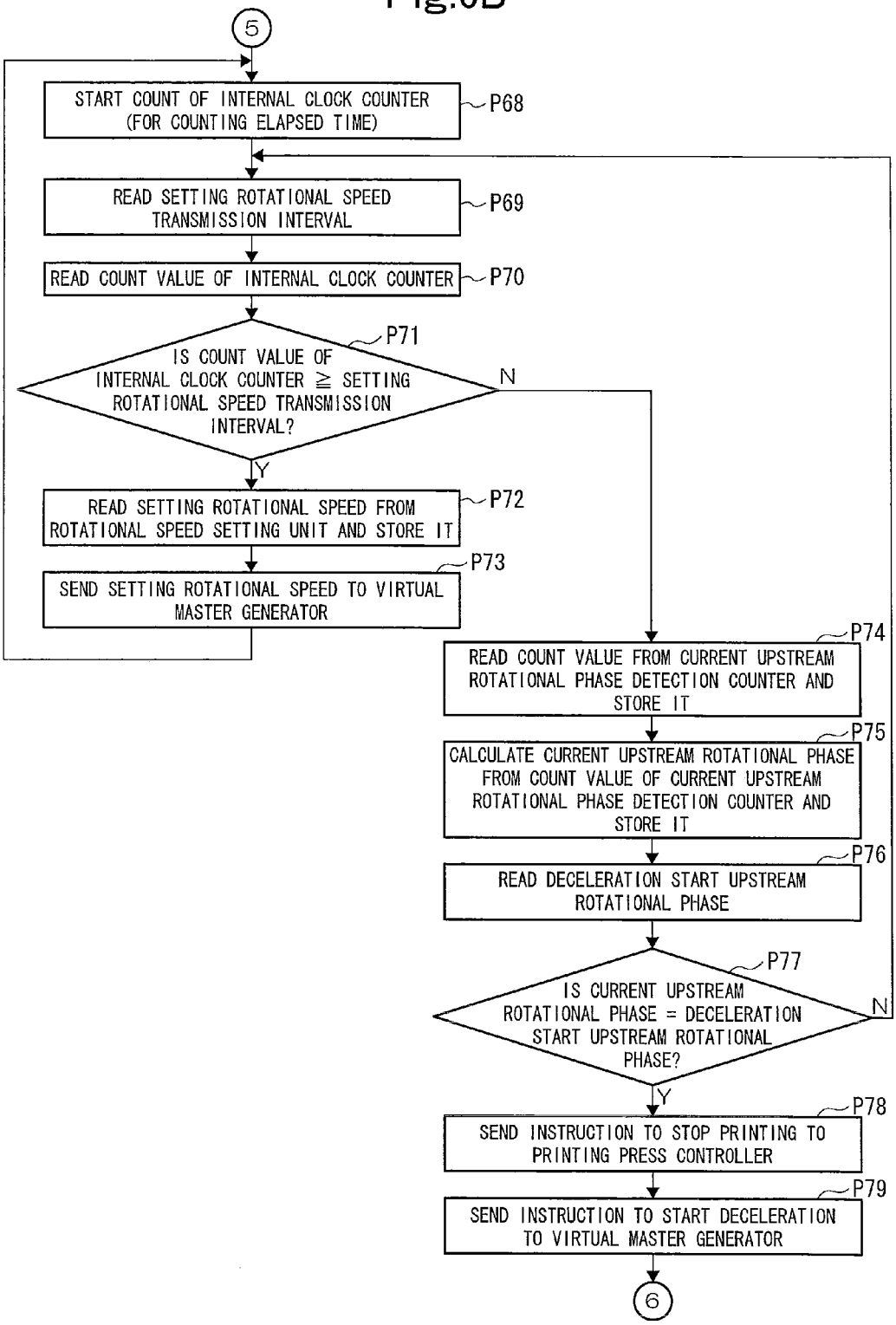
FIG. 6B is an operational flowchart of the central controller.
Figure 6C:
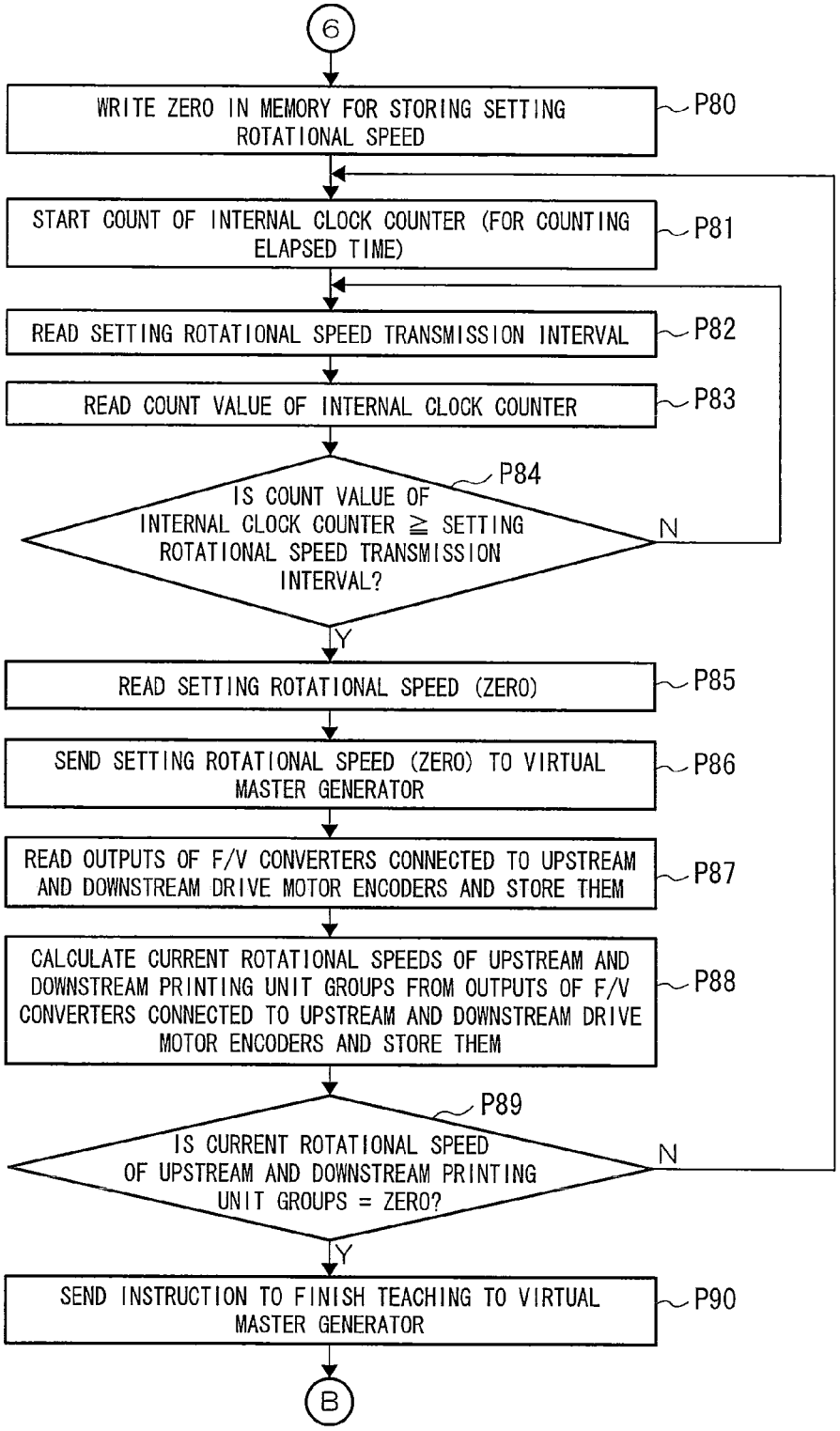
FIG. 6C is an operational flowchart of the central controller.
Figure 7A:
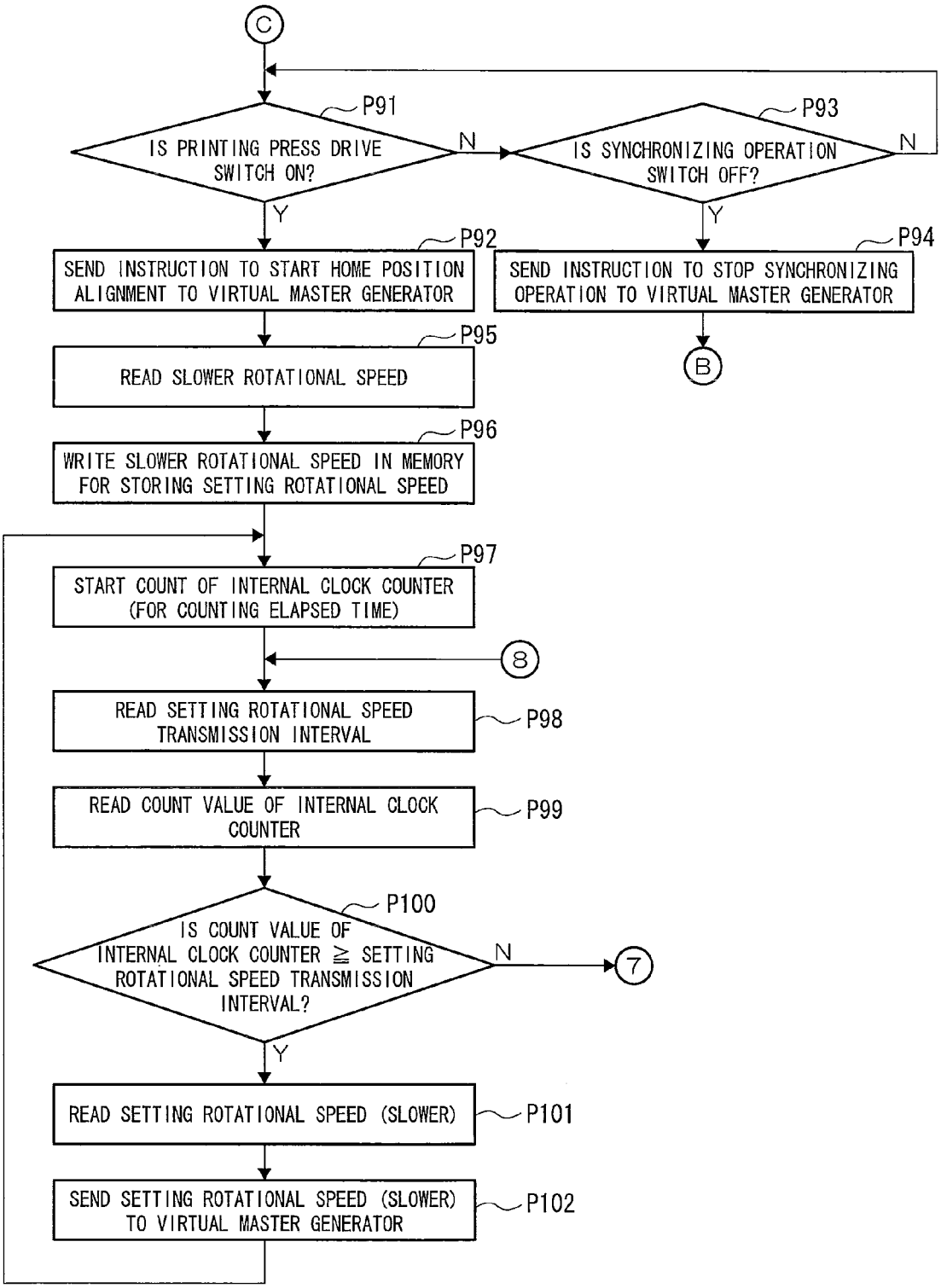
FIG. 7A is an operational flowchart of the central controller.
Figure 7B:
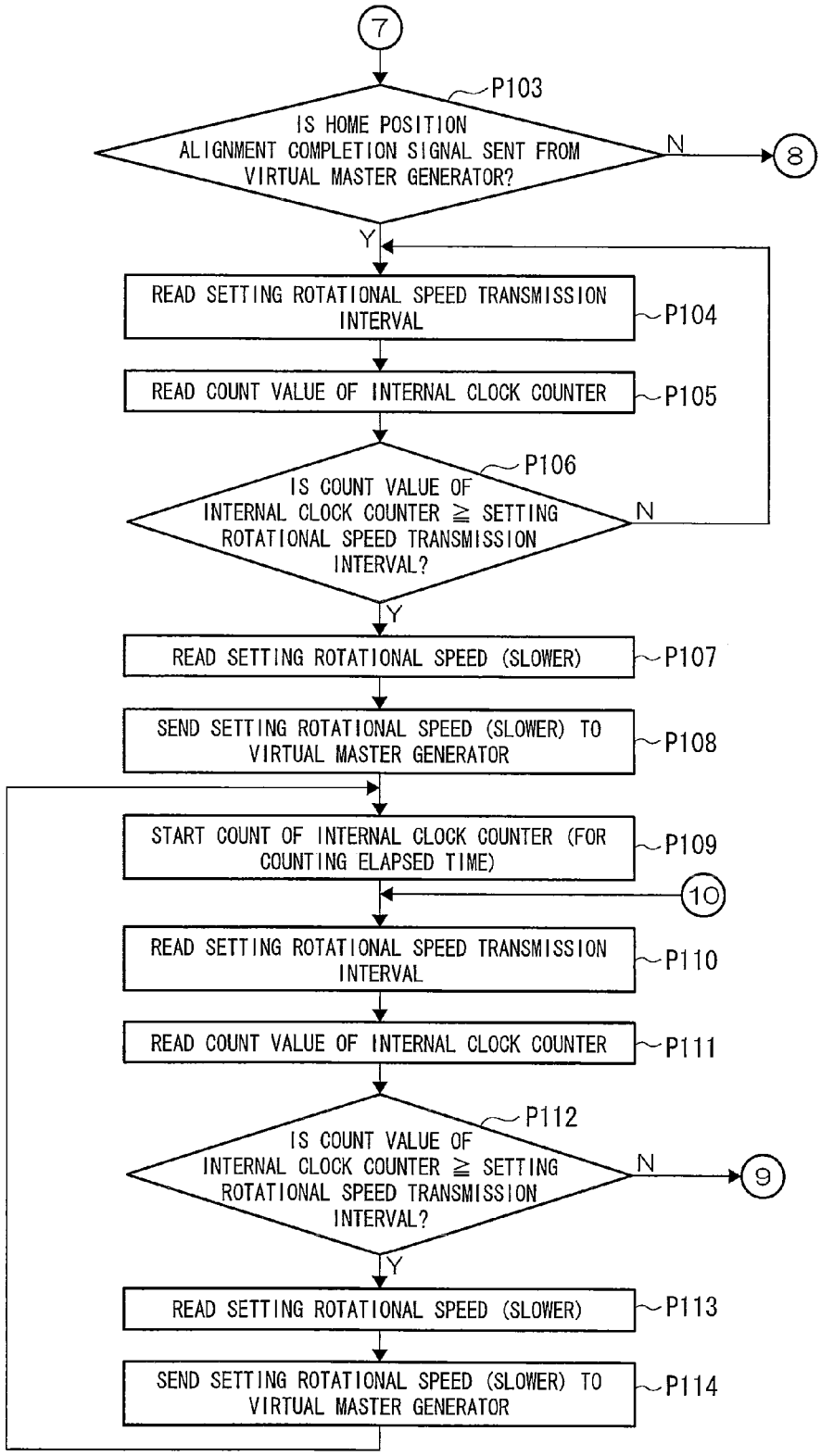
FIG. 7B is an operational flowchart of the central controller.
Figure 7C:
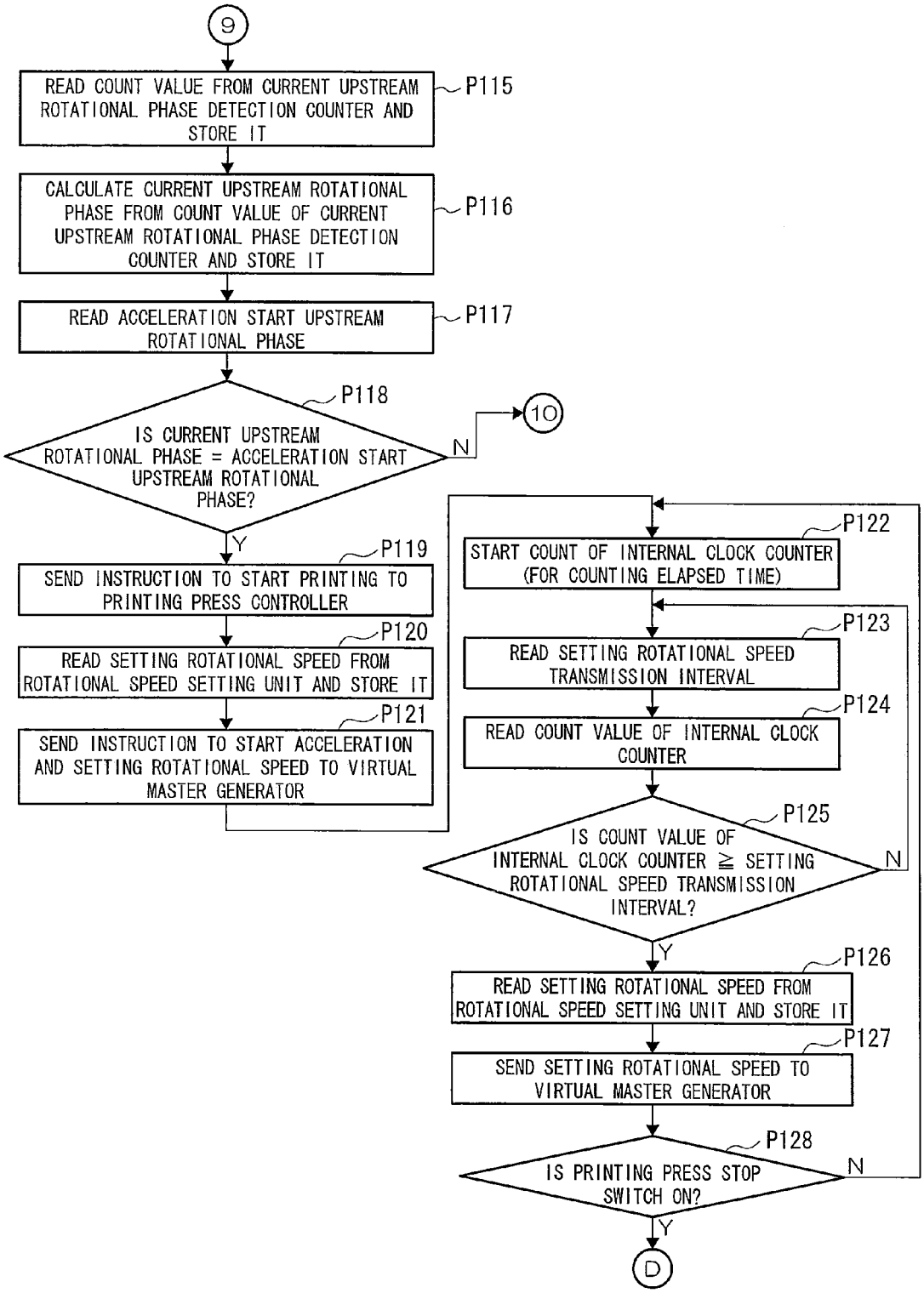
FIG. 7C is an operational flowchart of the central controller.
Figure 8A:
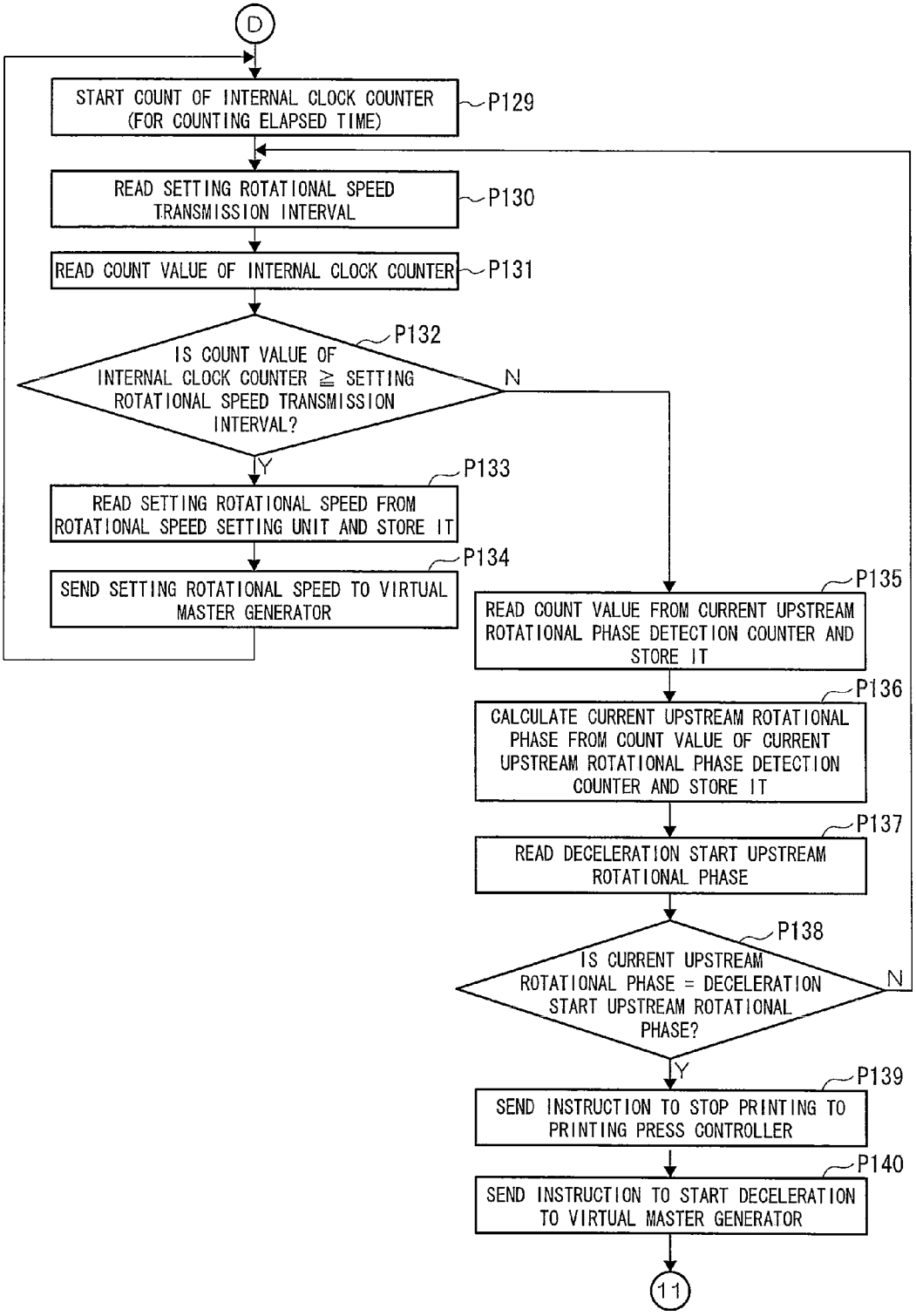
FIG. 8A is an operational flowchart of the central controller.
Figure 8B:
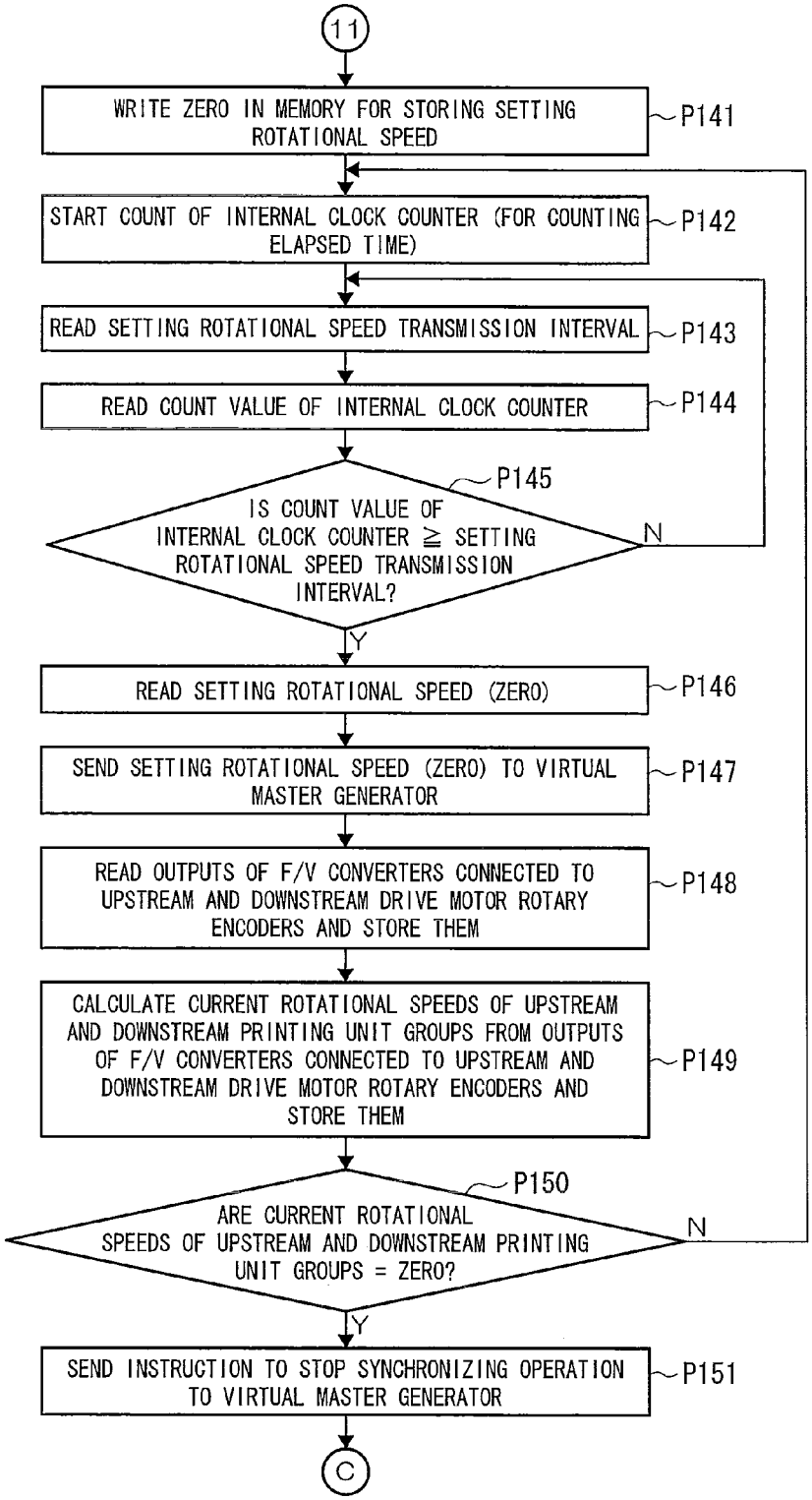
FIG. 8B is an operational flowchart of the central controller.

FIGS. 5A to 5E are operational flowcharts of the central controller. FIGS. 6A to 6C are operational flowcharts of the central controller. FIGS. 7A to 7C are operational flowcharts of the central controller. FIGS. 8A and 8B are operational flowcharts of the central controller.

Figure 9A:
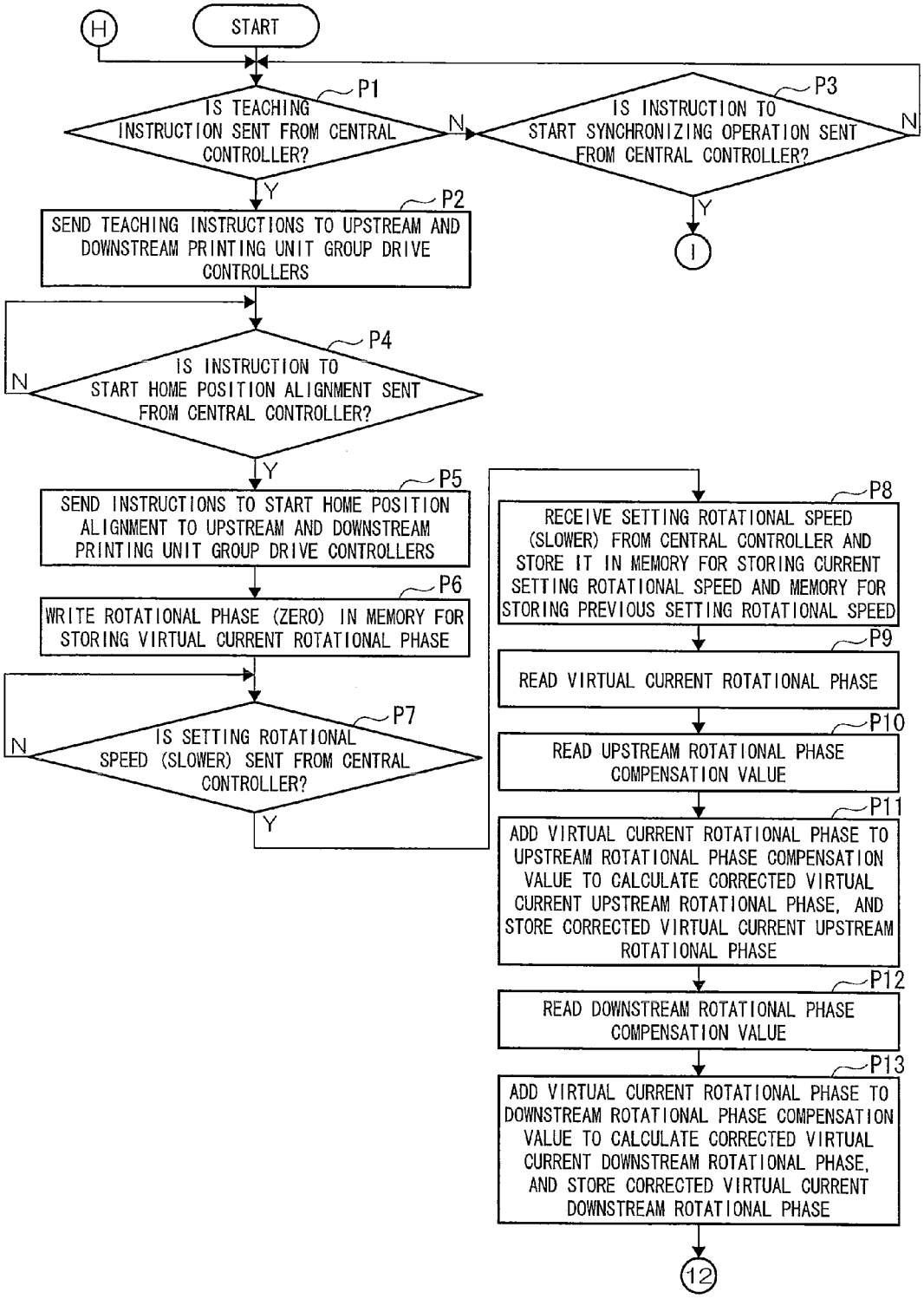
FIG. 9A is an operational flowchart of the virtual master generator.
Figure 9B:
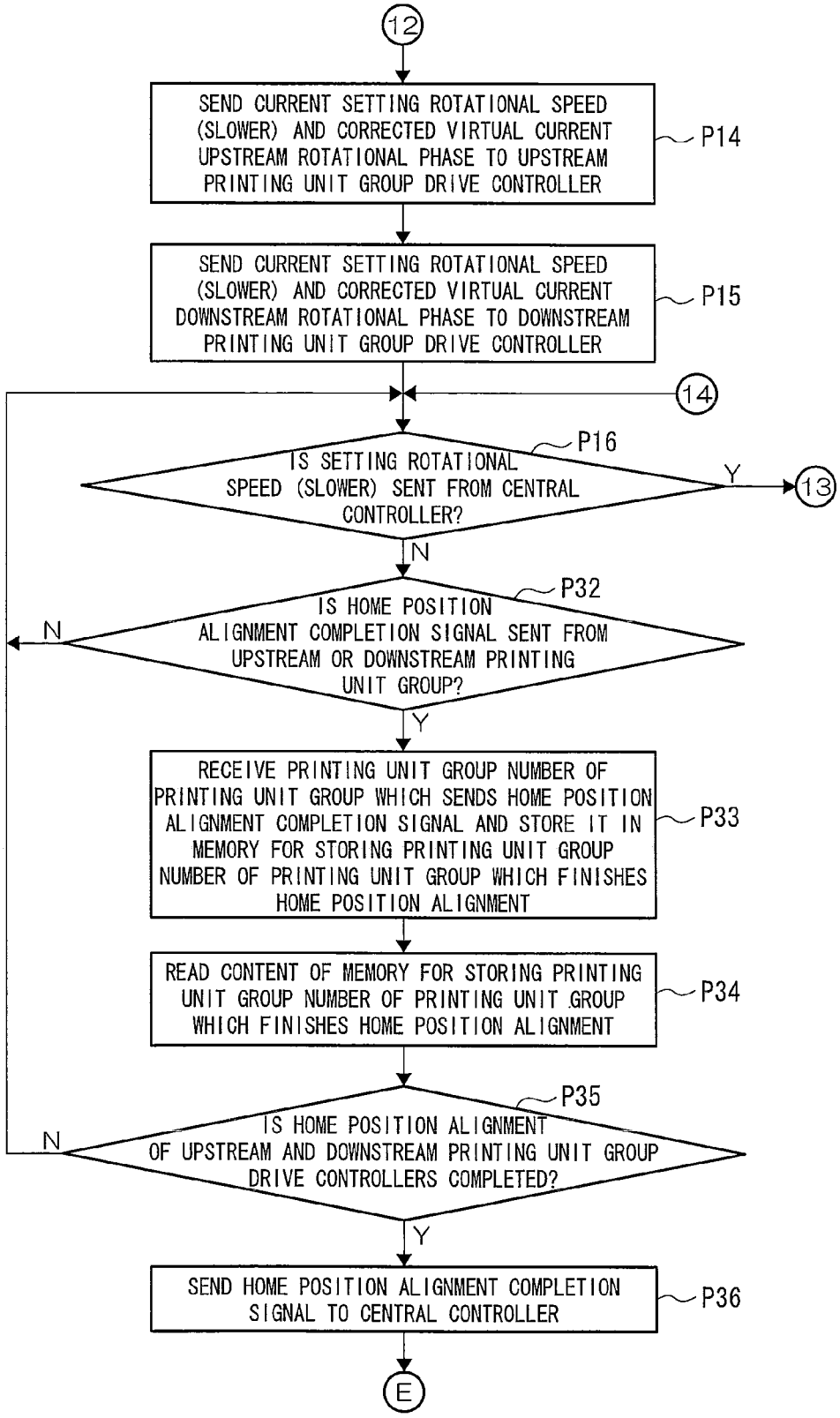
FIG. 9B is an operational flowchart of the virtual master generator.
Figure 9C:
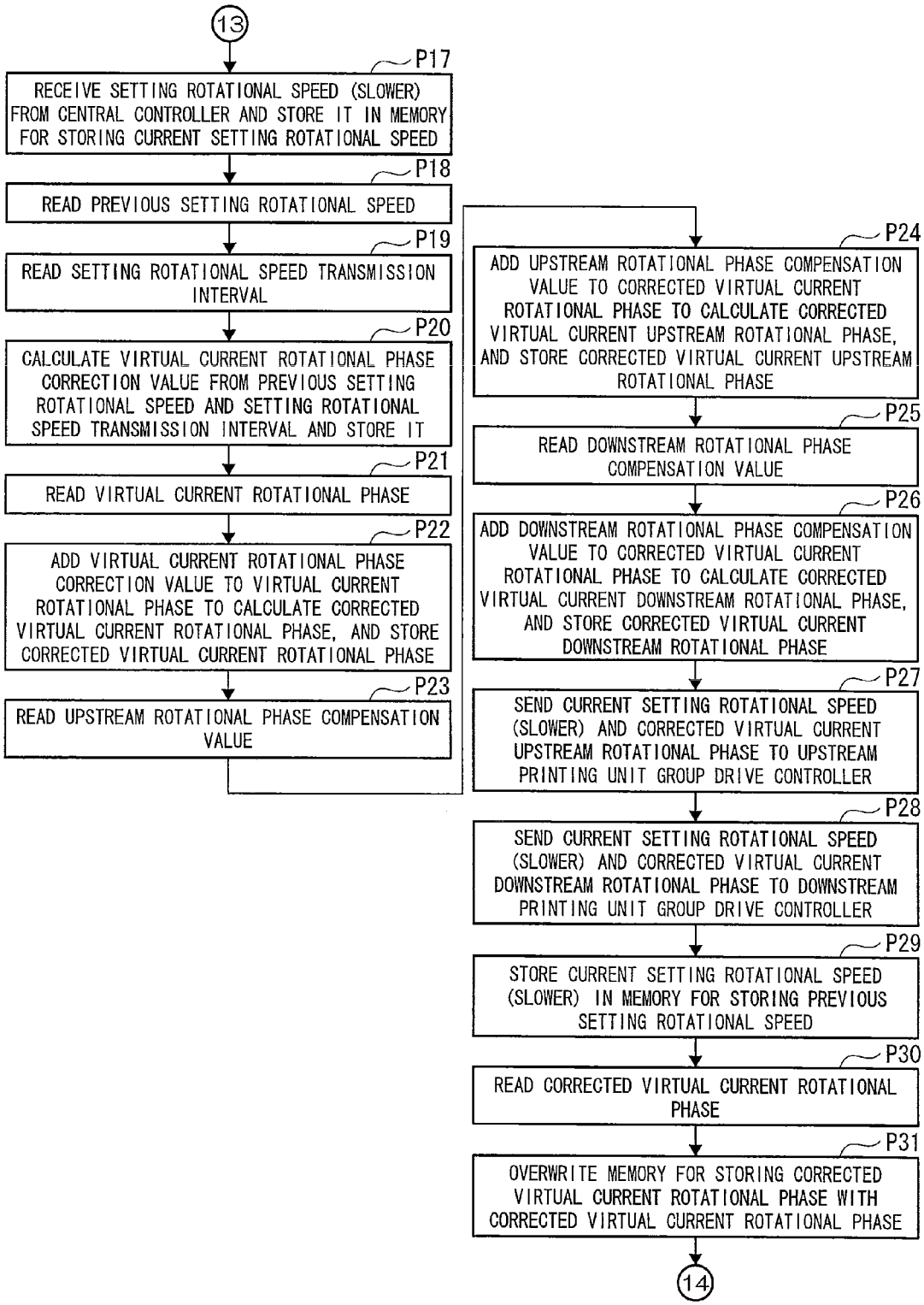
FIG. 9C is an operational flowchart of the virtual master generator.
Figure 10A:
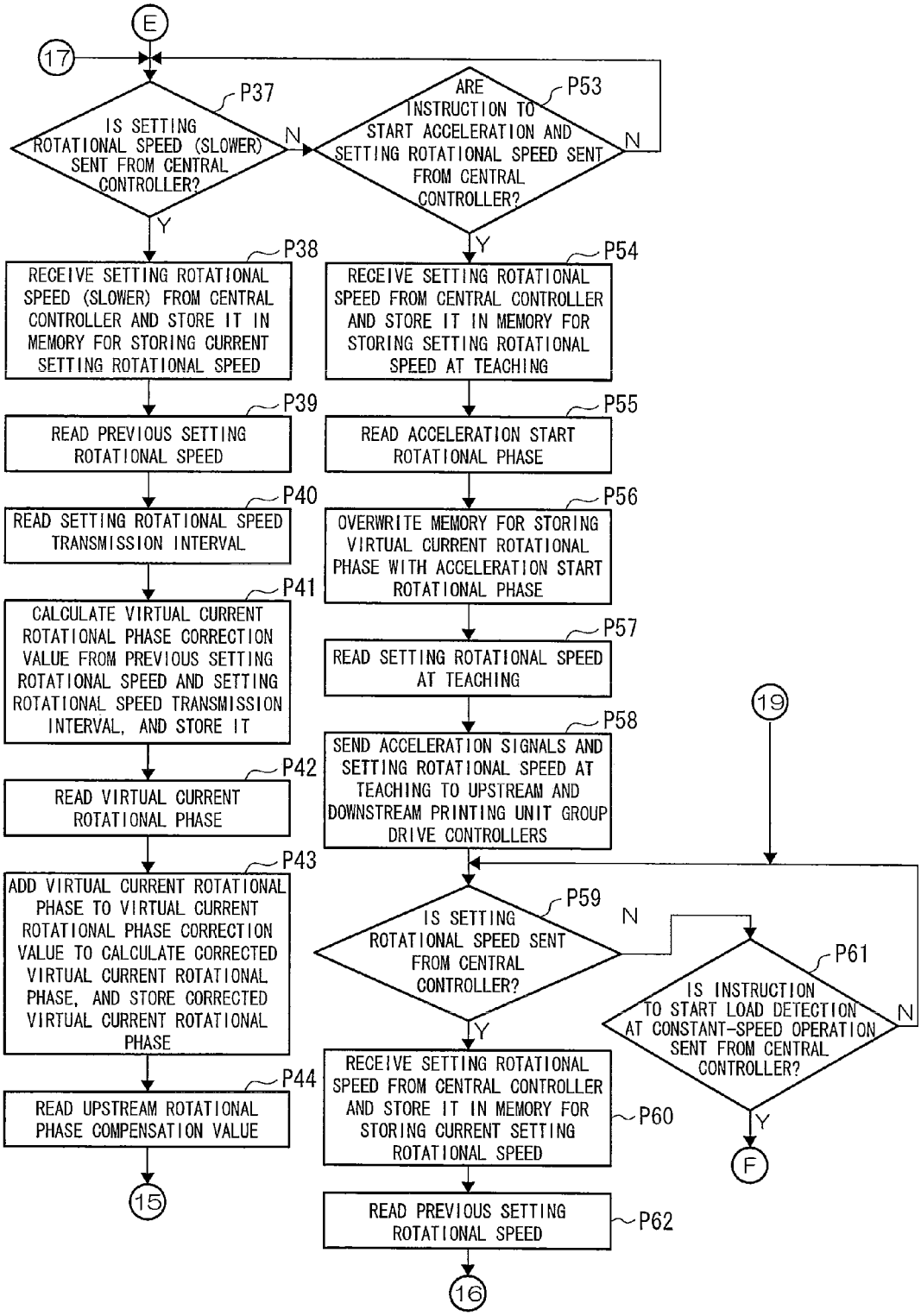
FIG. 10A is an operational flowchart of the virtual master generator.
Figure 10B:
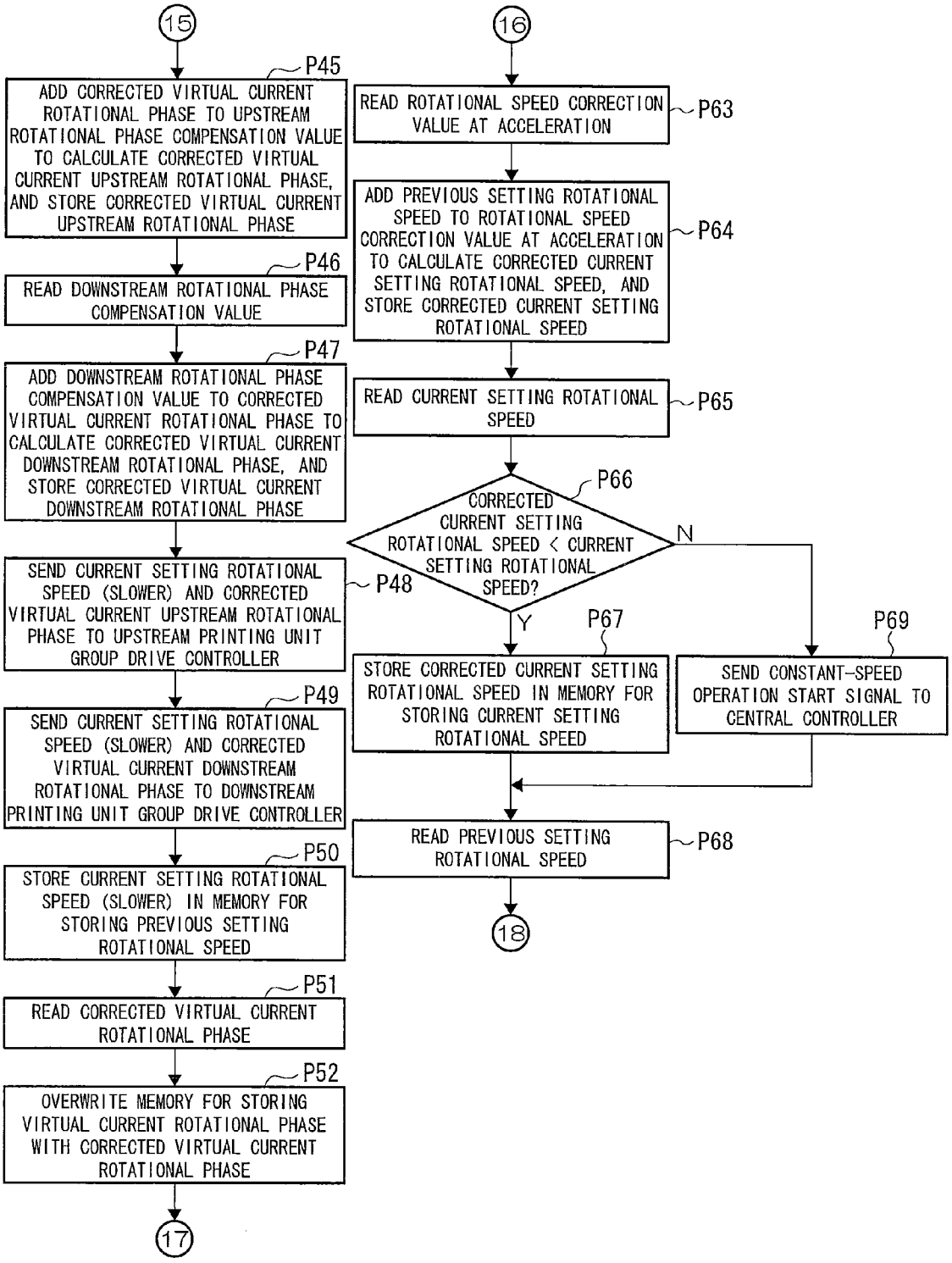
FIG. 10B is an operational flowchart of the virtual master generator.
Figure 10C:
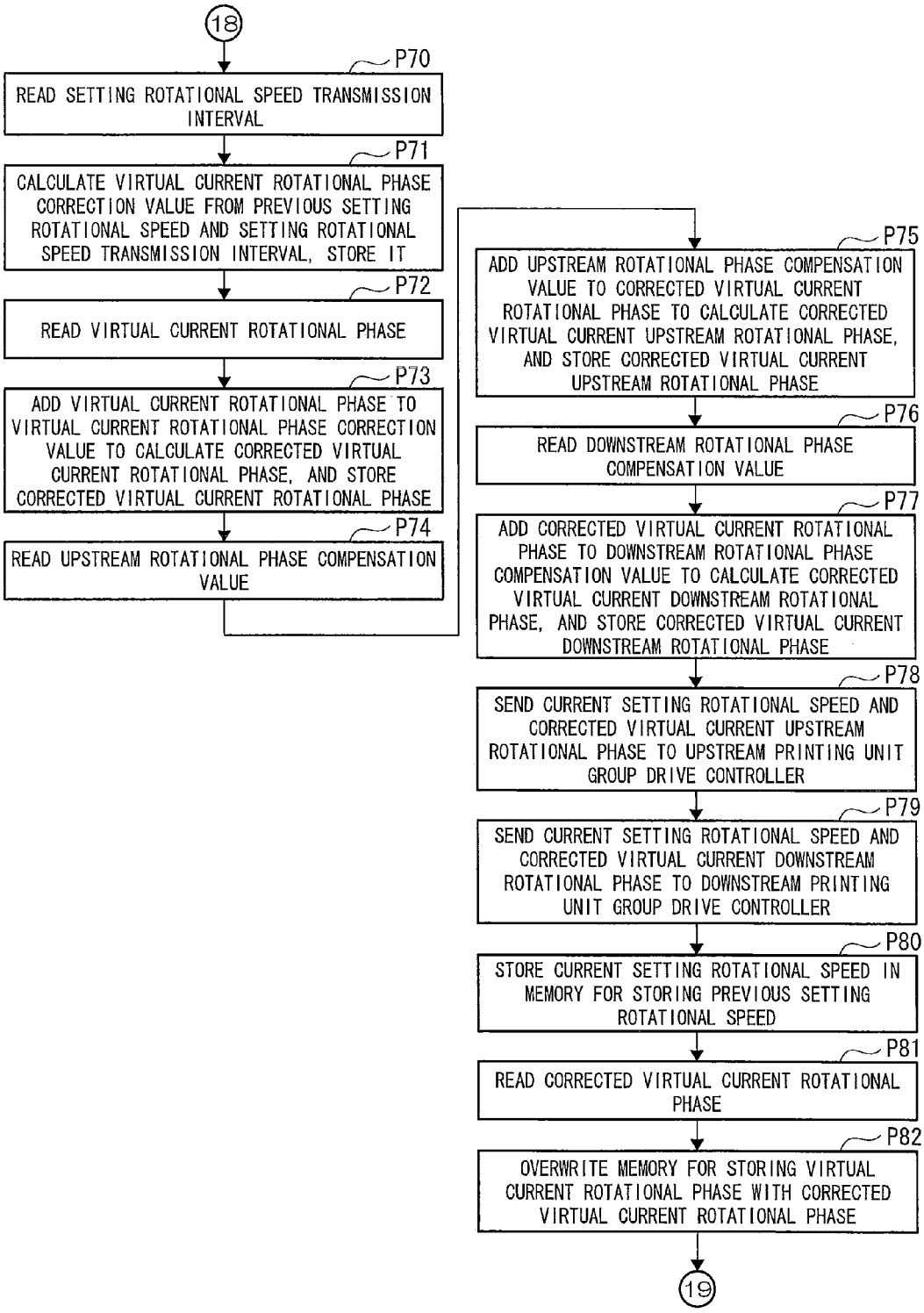
FIG. 10C is an operational flowchart of the virtual master generator.
Figure 11A:
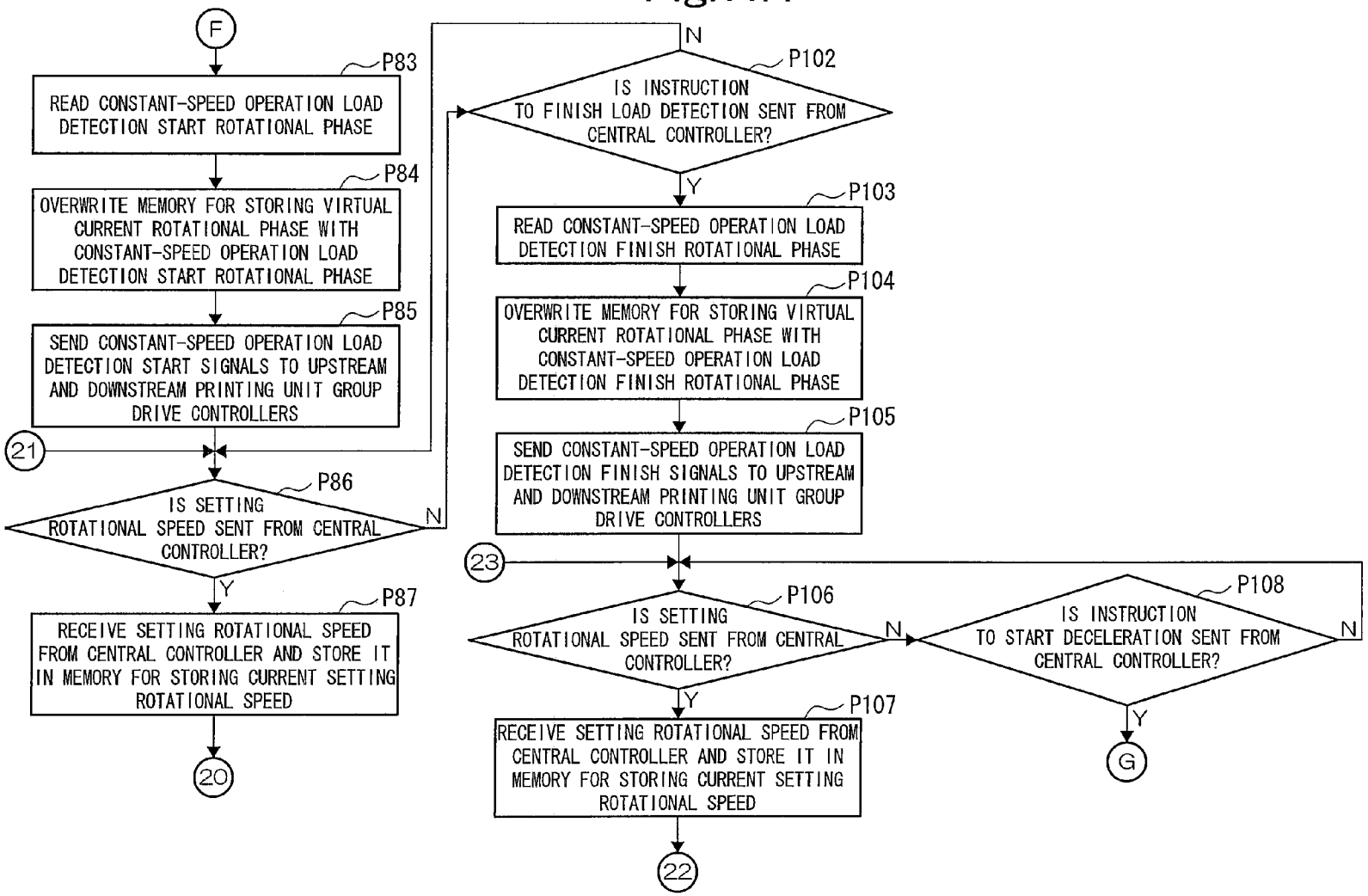
FIG. 11A is an operational flowchart of the virtual master generator.
Figure 11B:
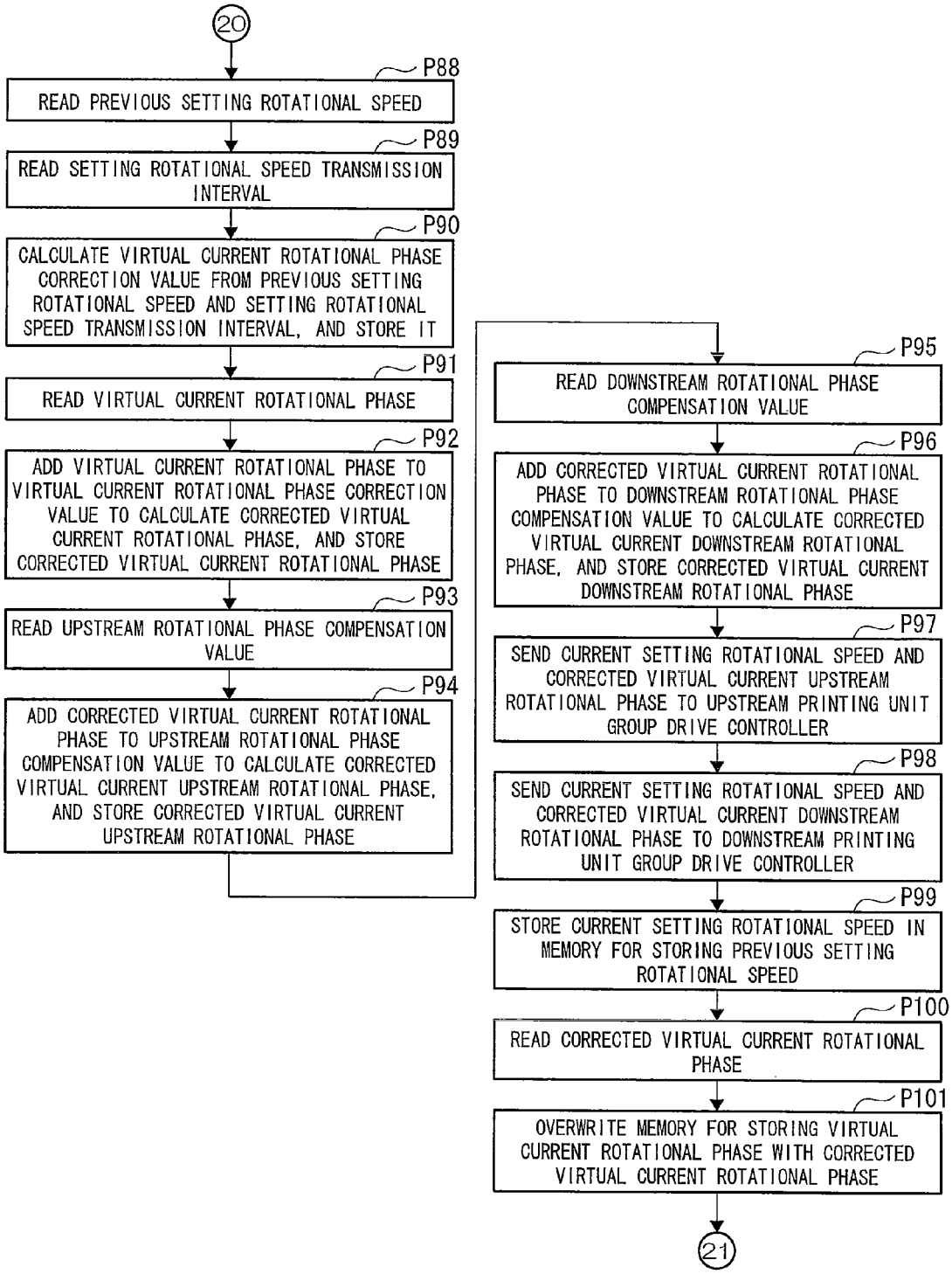
FIG. 11B is an operational flowchart of the virtual master generator.
Figure 11C:
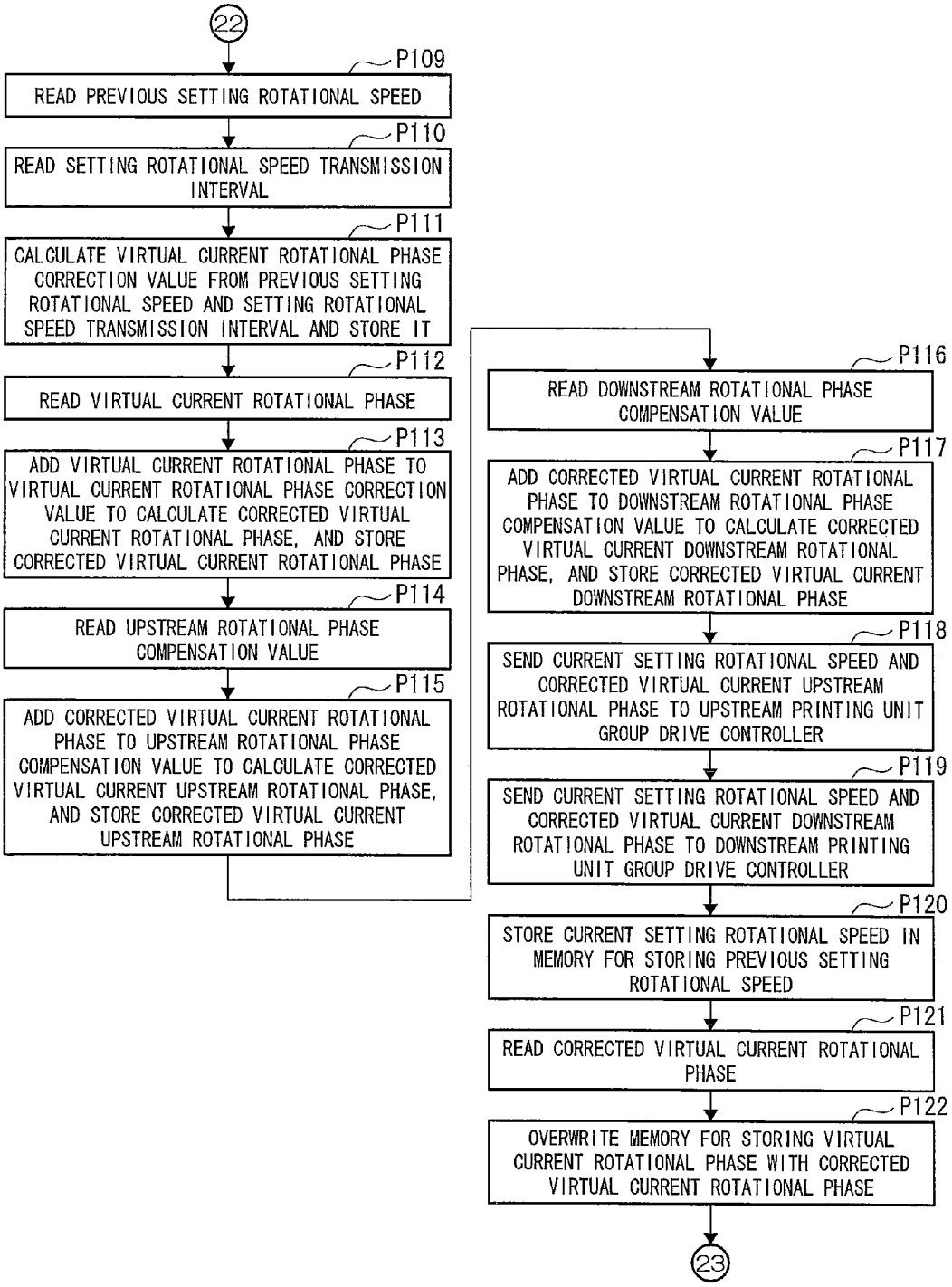
FIG. 11C is an operational flowchart of the virtual master generator.
Figure 12A:
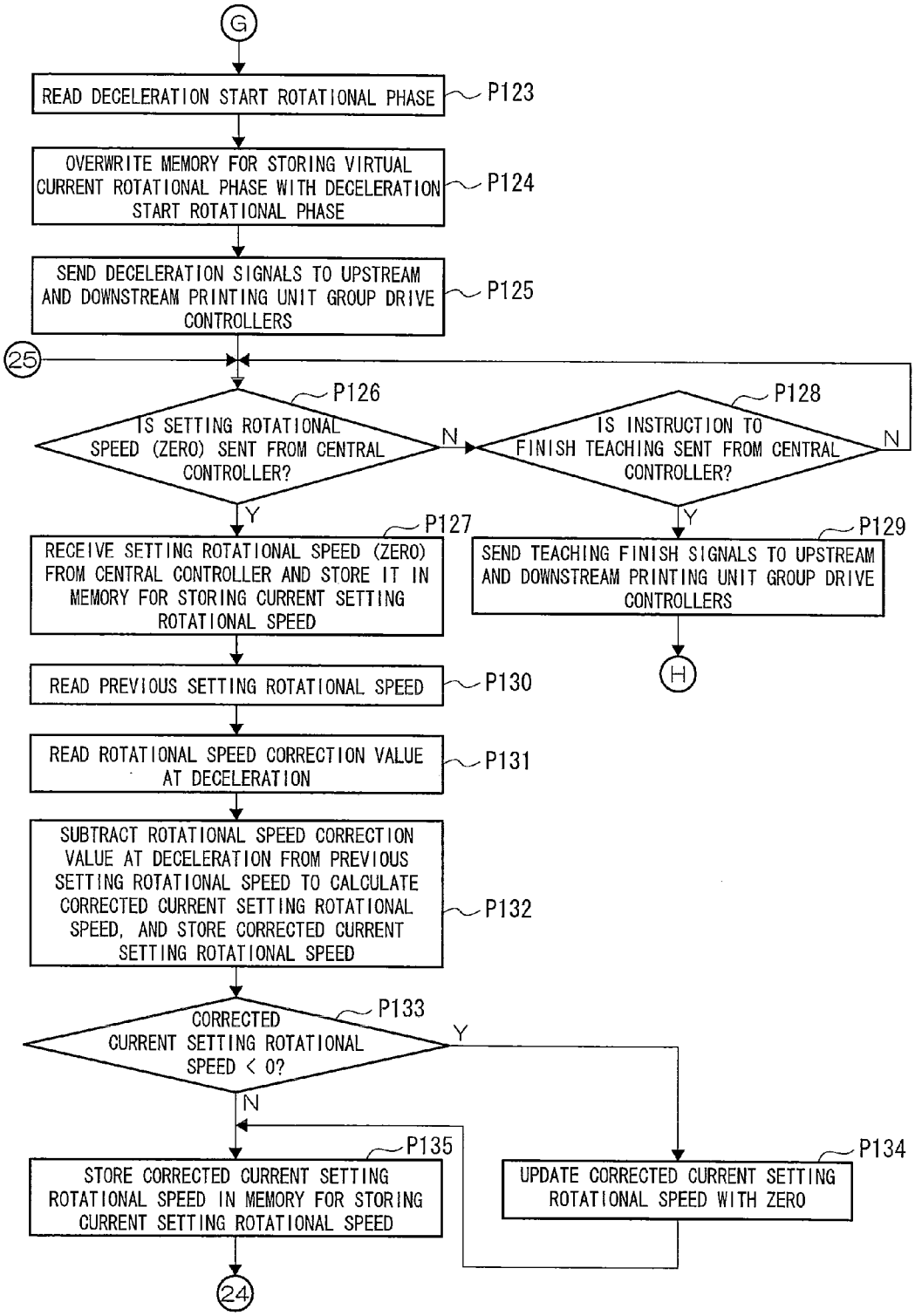
FIG. 12A is an operational flowchart of the virtual master generator.
Figure 12B:
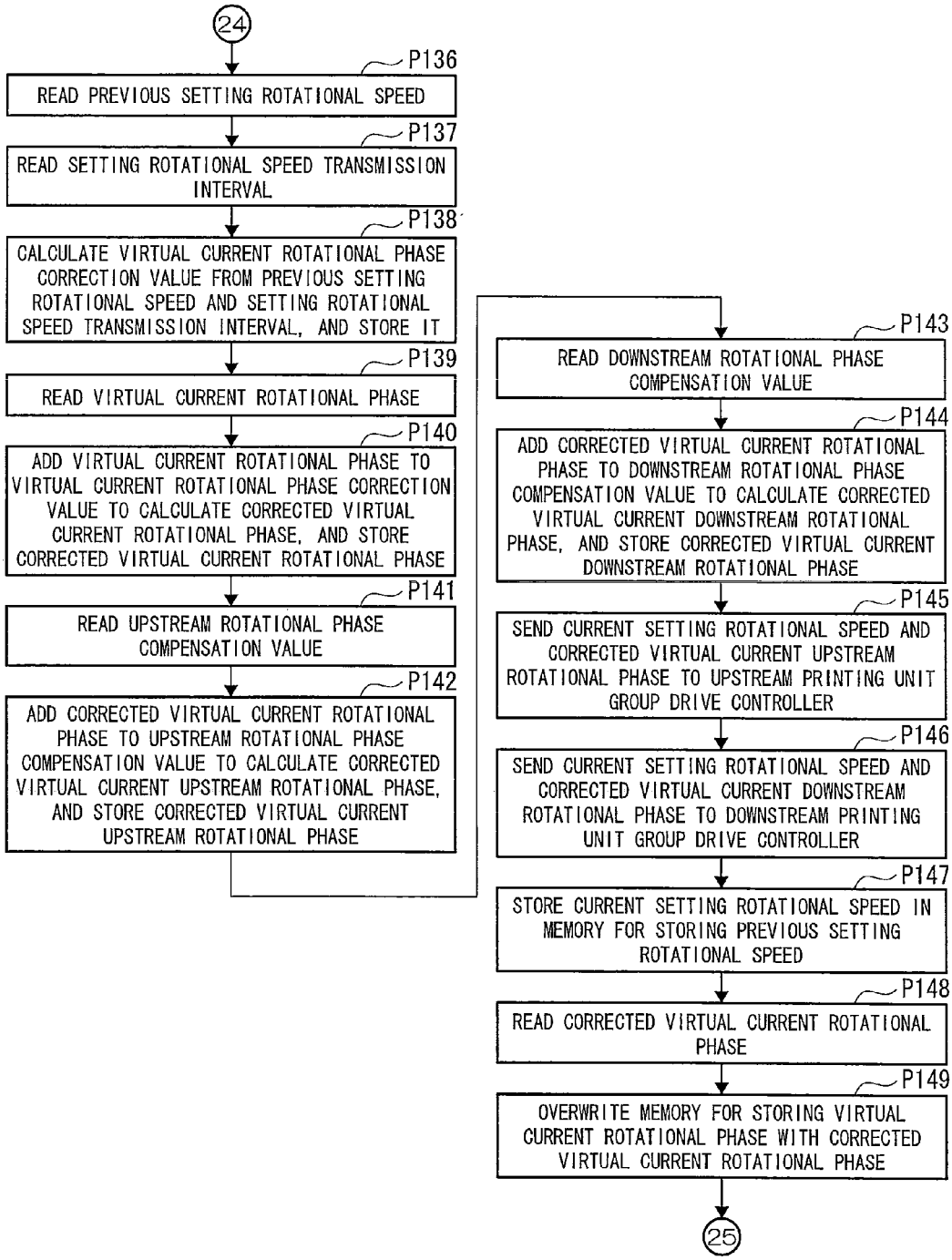
FIG. 12B is an operational flowchart of the virtual master generator.
Figure 13A:
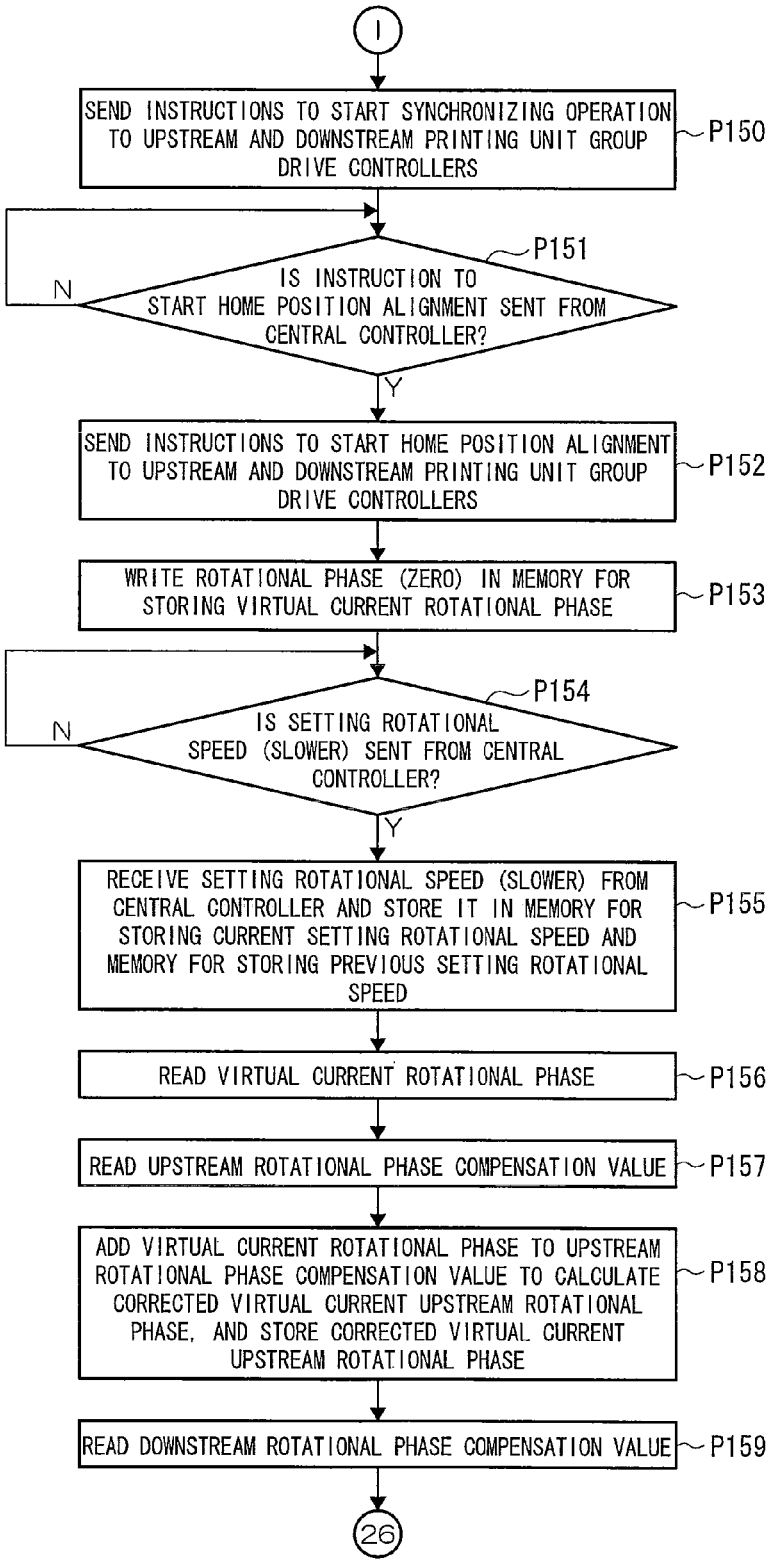
FIG. 13A is an operational flowchart of the virtual master generator.
Figure 13B:
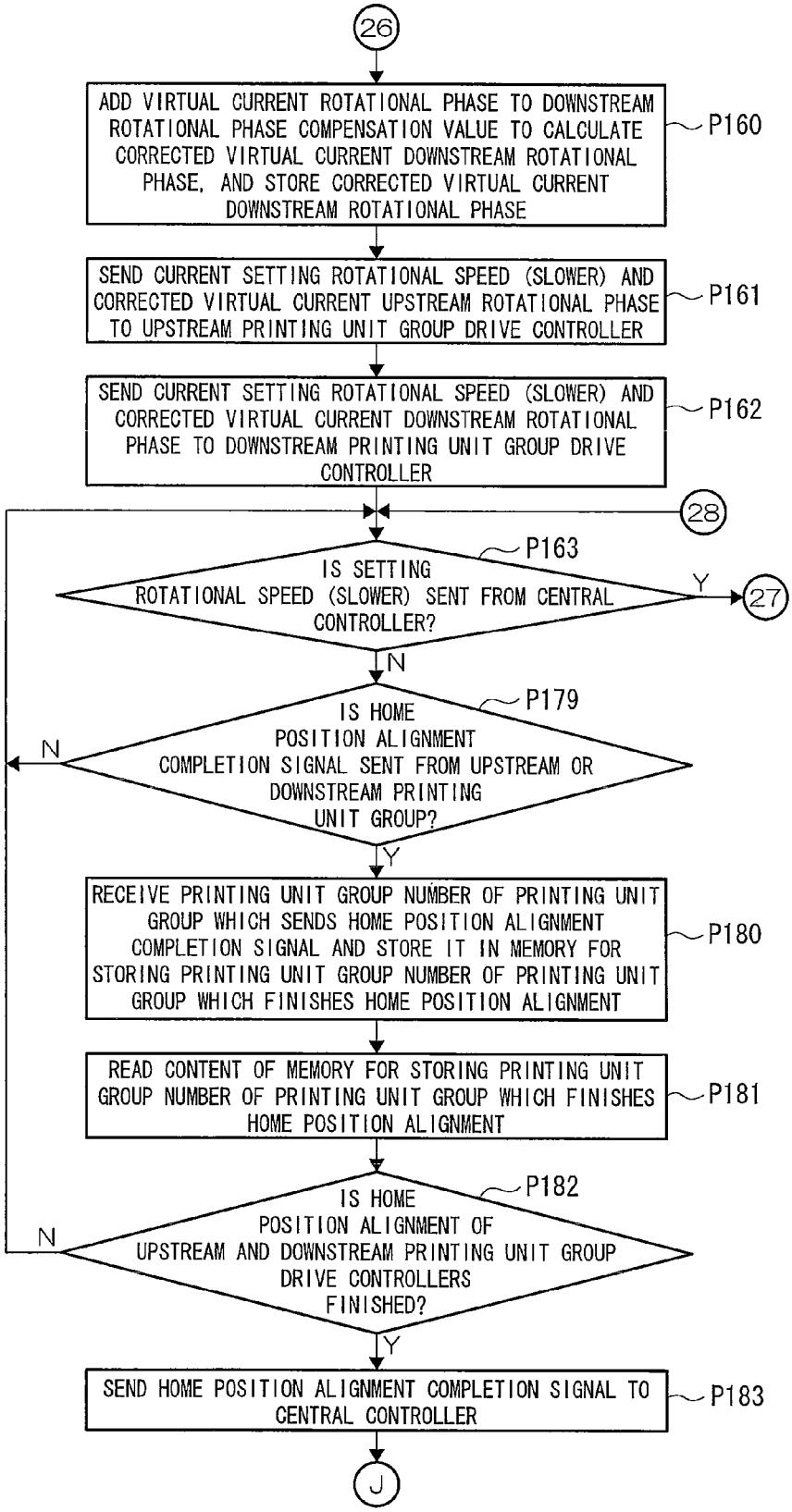
FIG. 13B is an operational flowchart of the virtual master generator.
Figure 13C:
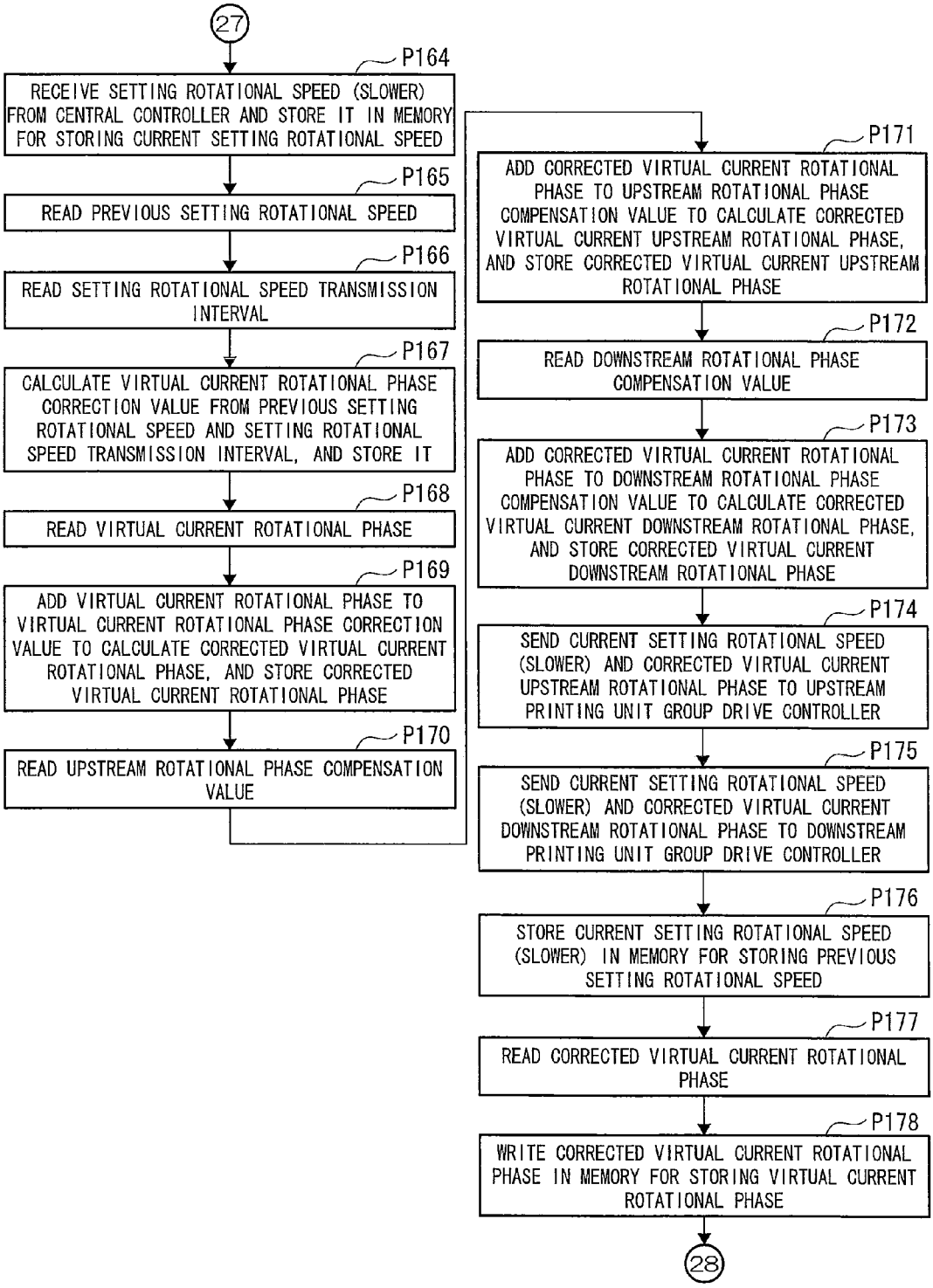
FIG. 13C is an operational flowchart of the virtual master generator.
Figure 14A:
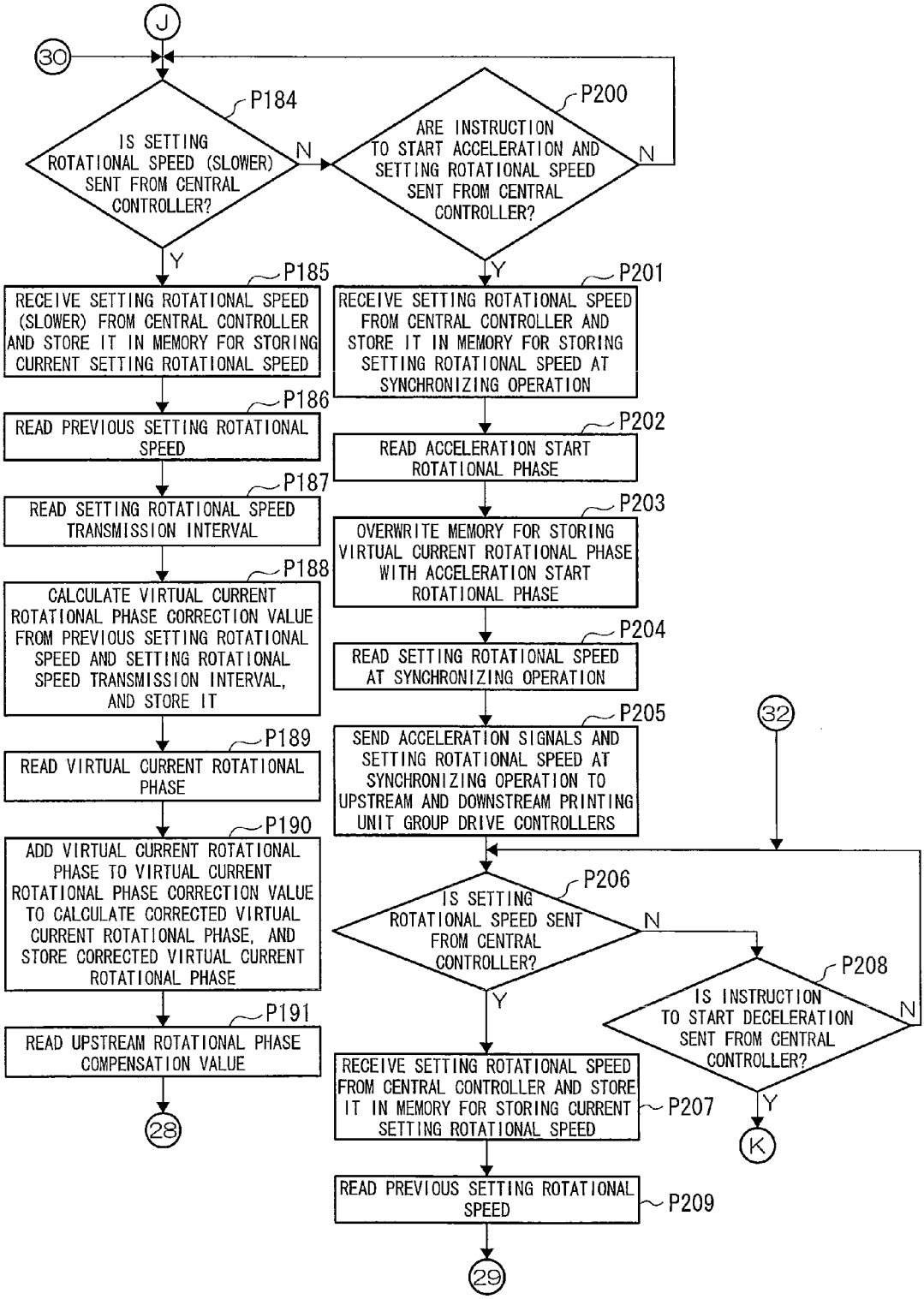
FIG. 14A is an operational flowchart of the virtual master generator.
Figure 14B:
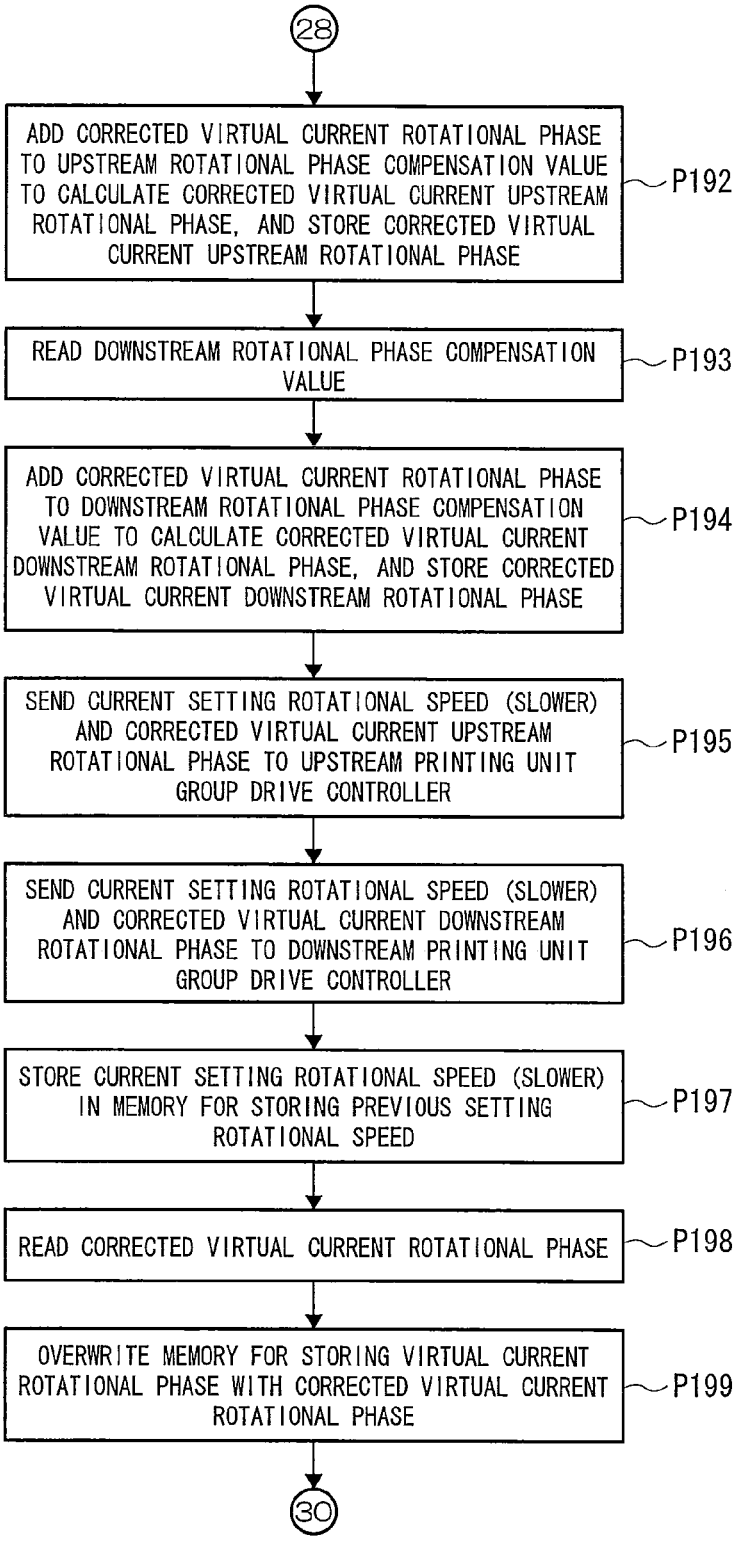
FIG. 14B is an operational flowchart of the virtual master generator.
Figure 14C:
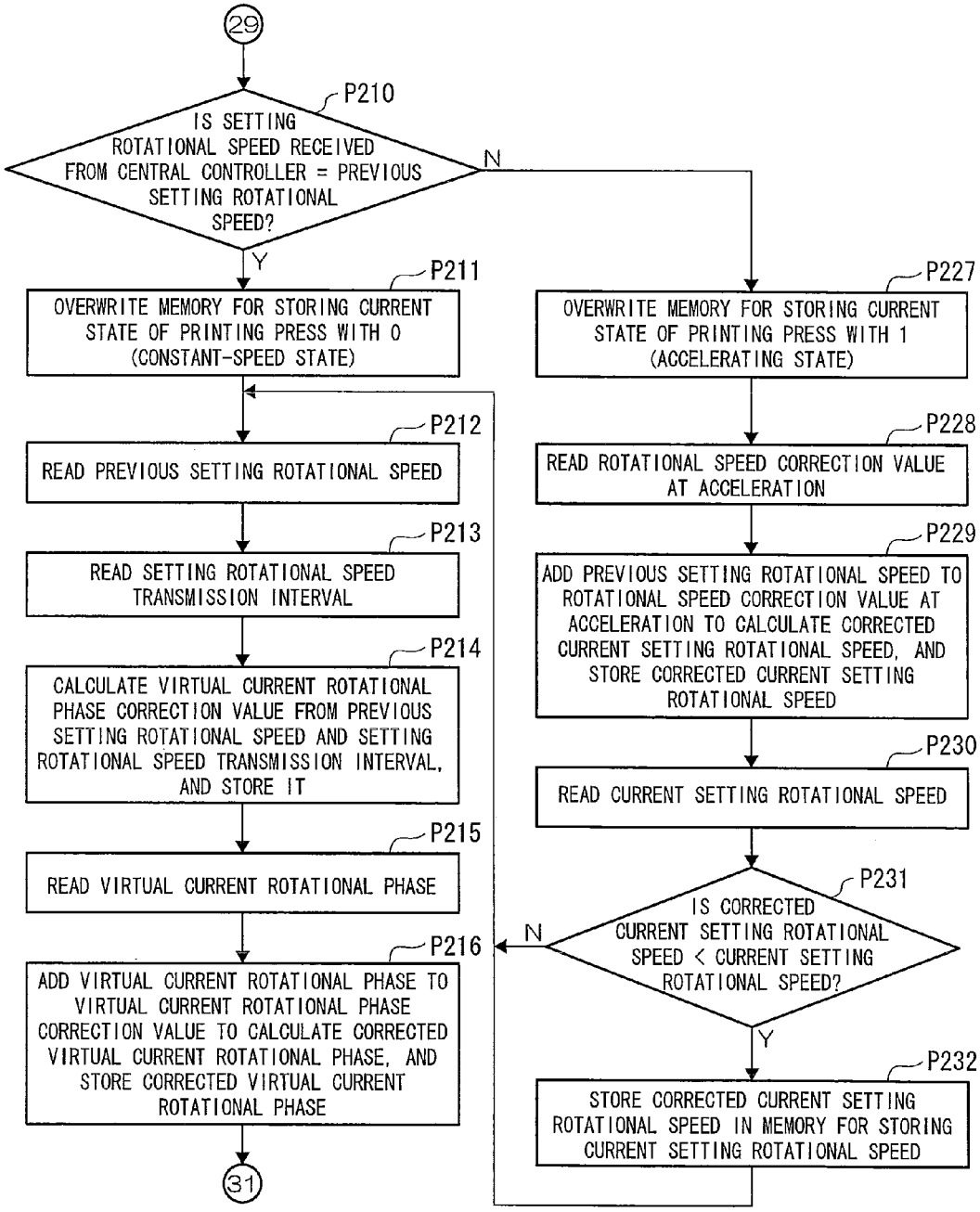
FIG. 14C is an operational flowchart of the virtual master generator.
Figure 14D:
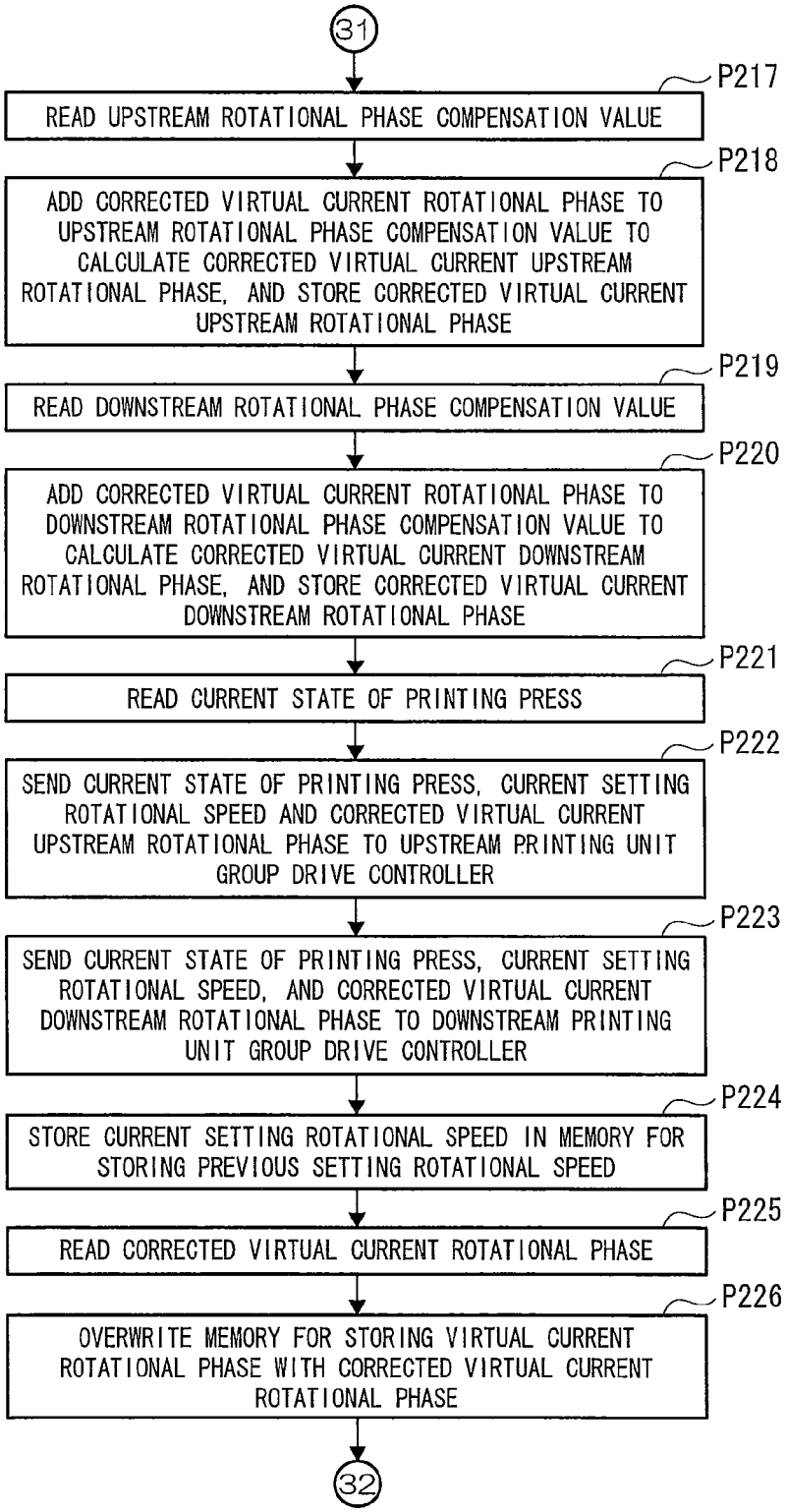
FIG. 14D is an operational flowchart of the virtual master generator.
Figure 15A:
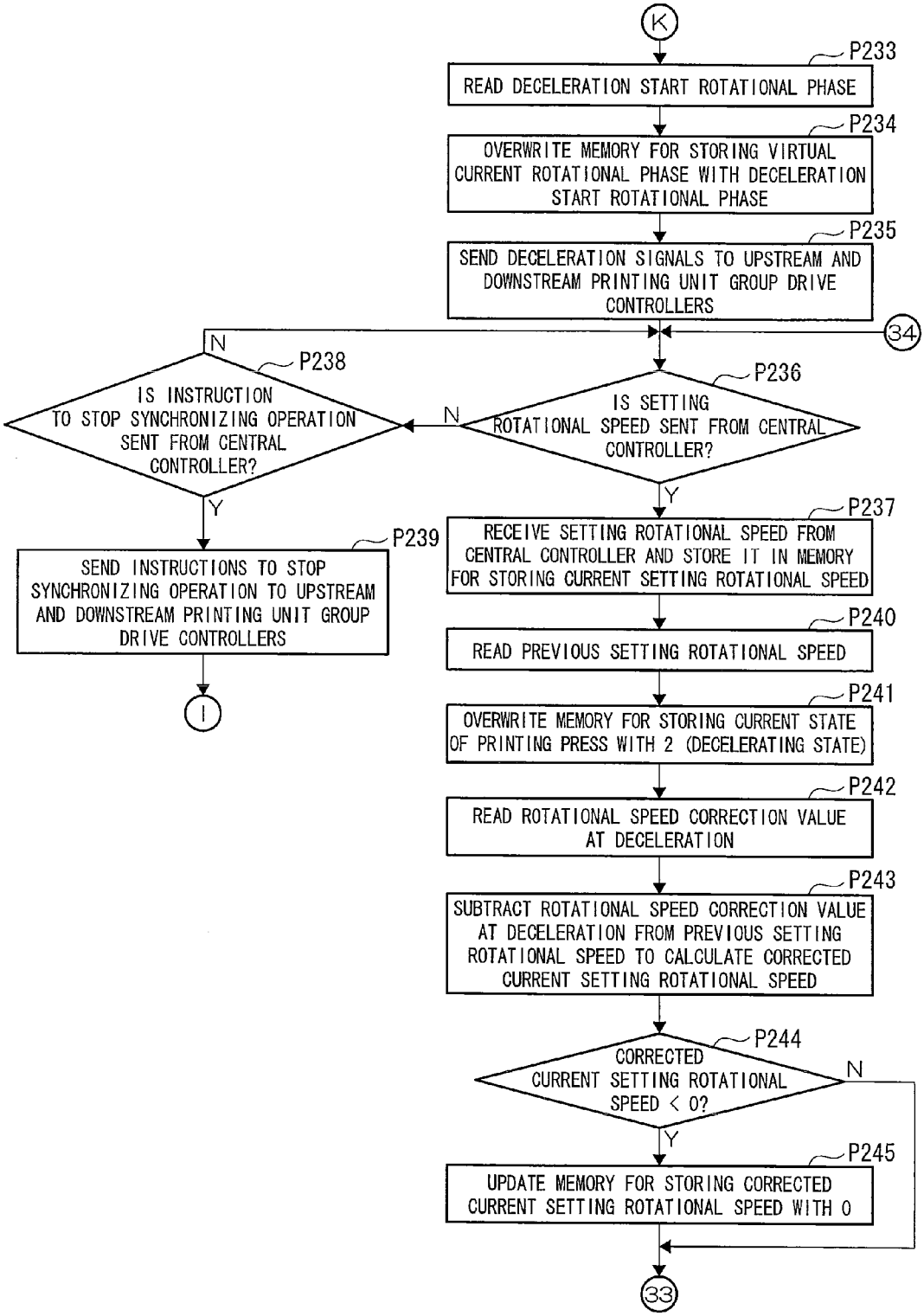
FIG. 15A is an operational flowchart of the virtual master generator.
Figure 15B:
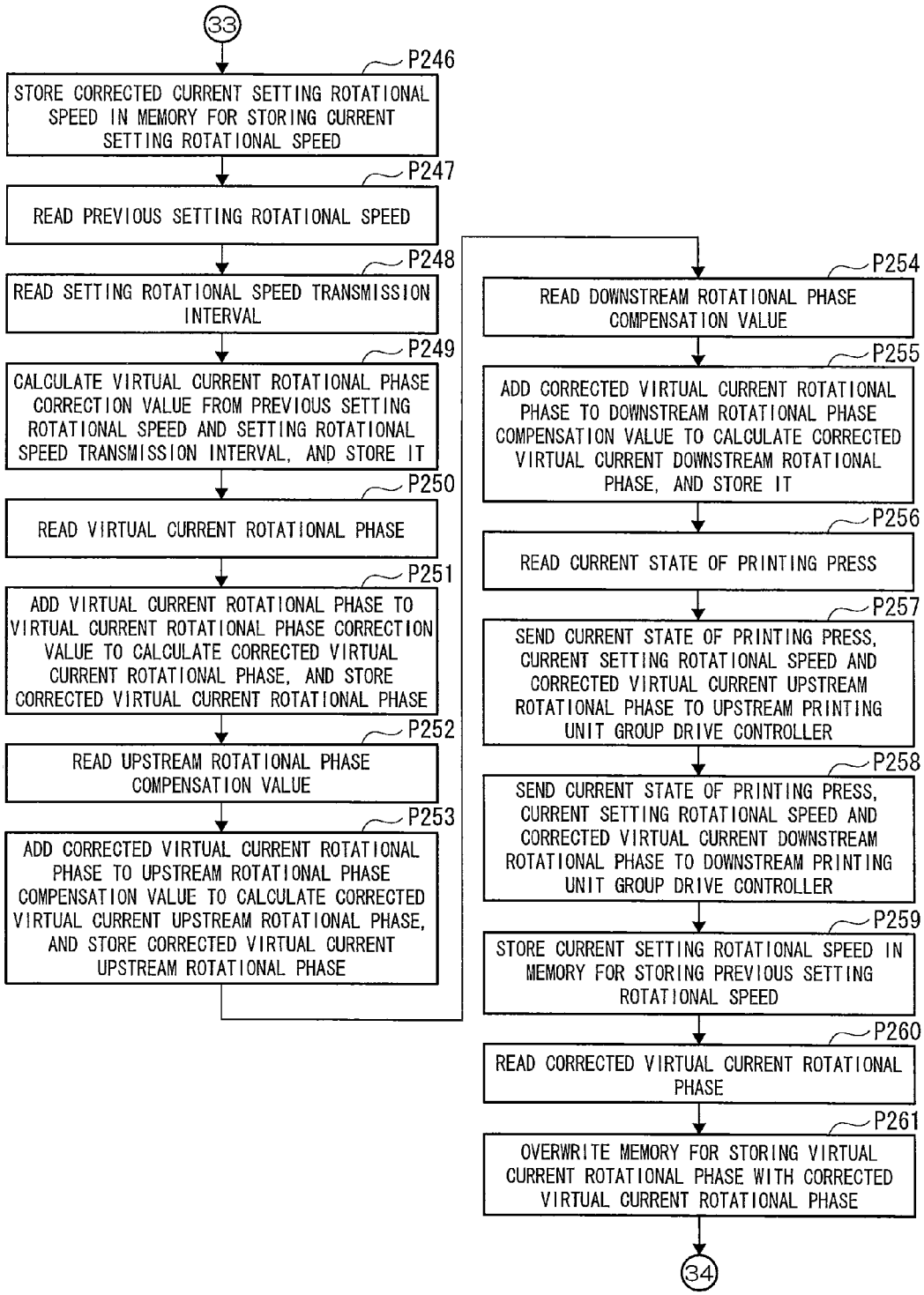
FIG. 15B is an operational flowchart of the virtual master generator.

FIGS. 9A to 9C are operational flowcharts of the virtual master generator. FIGS. 10A to 10C are operational flowcharts of the virtual master generator. FIGS. 11A to 11C are operational flowcharts of the virtual master generator. FIGS. 12A and 12B are operational flowcharts of the virtual master generator. FIGS. 13A to 13C are operational flowcharts of the virtual master generator. FIGS. 14A to 14D are operational flowcharts of the virtual master generator. FIGS. 15A and 15B are operational flowcharts of the virtual master generator.

Figure 16A:
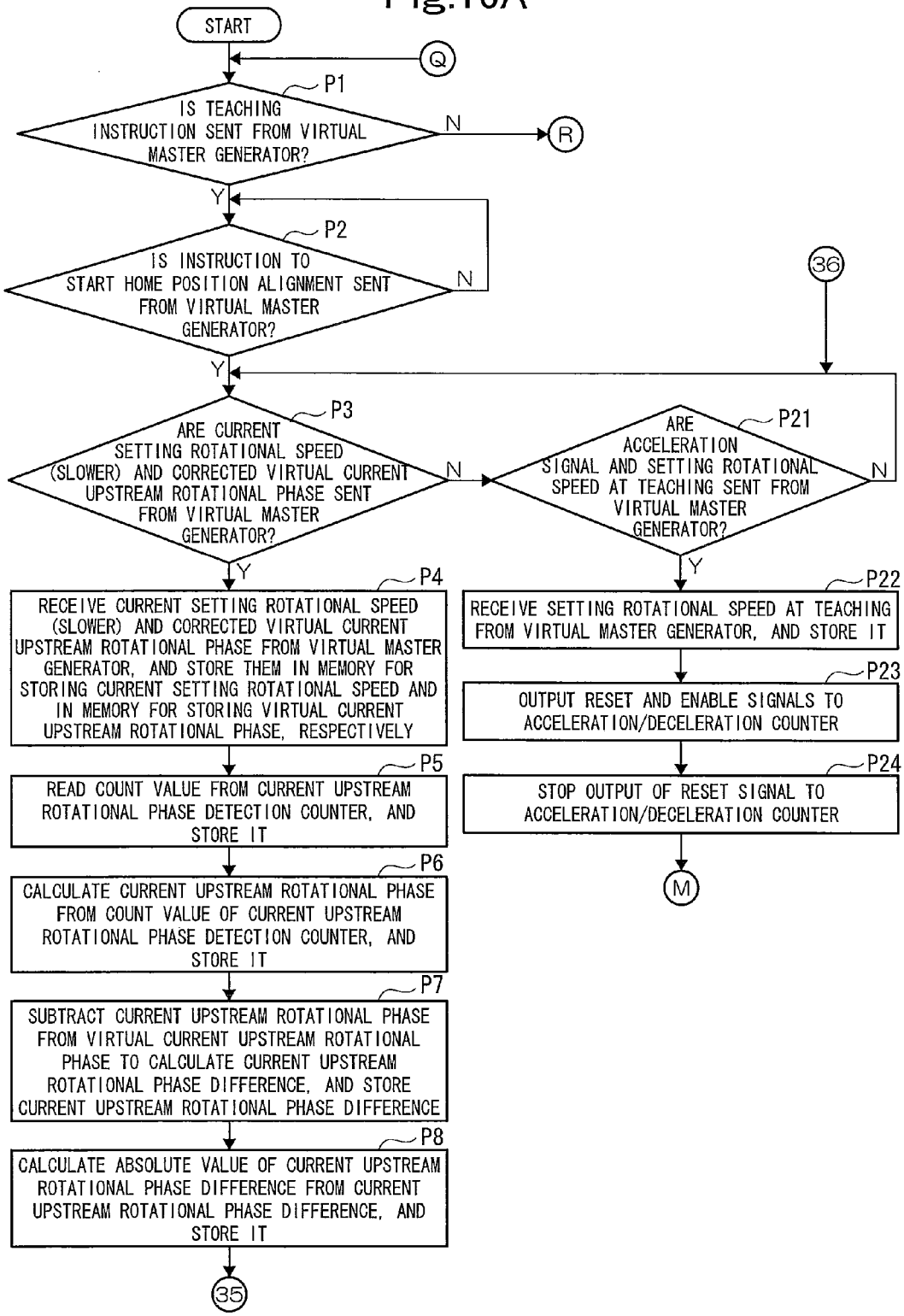
FIG. 16A is an operational flowchart of the upstream printing unit group drive controller.
Figure 16B:
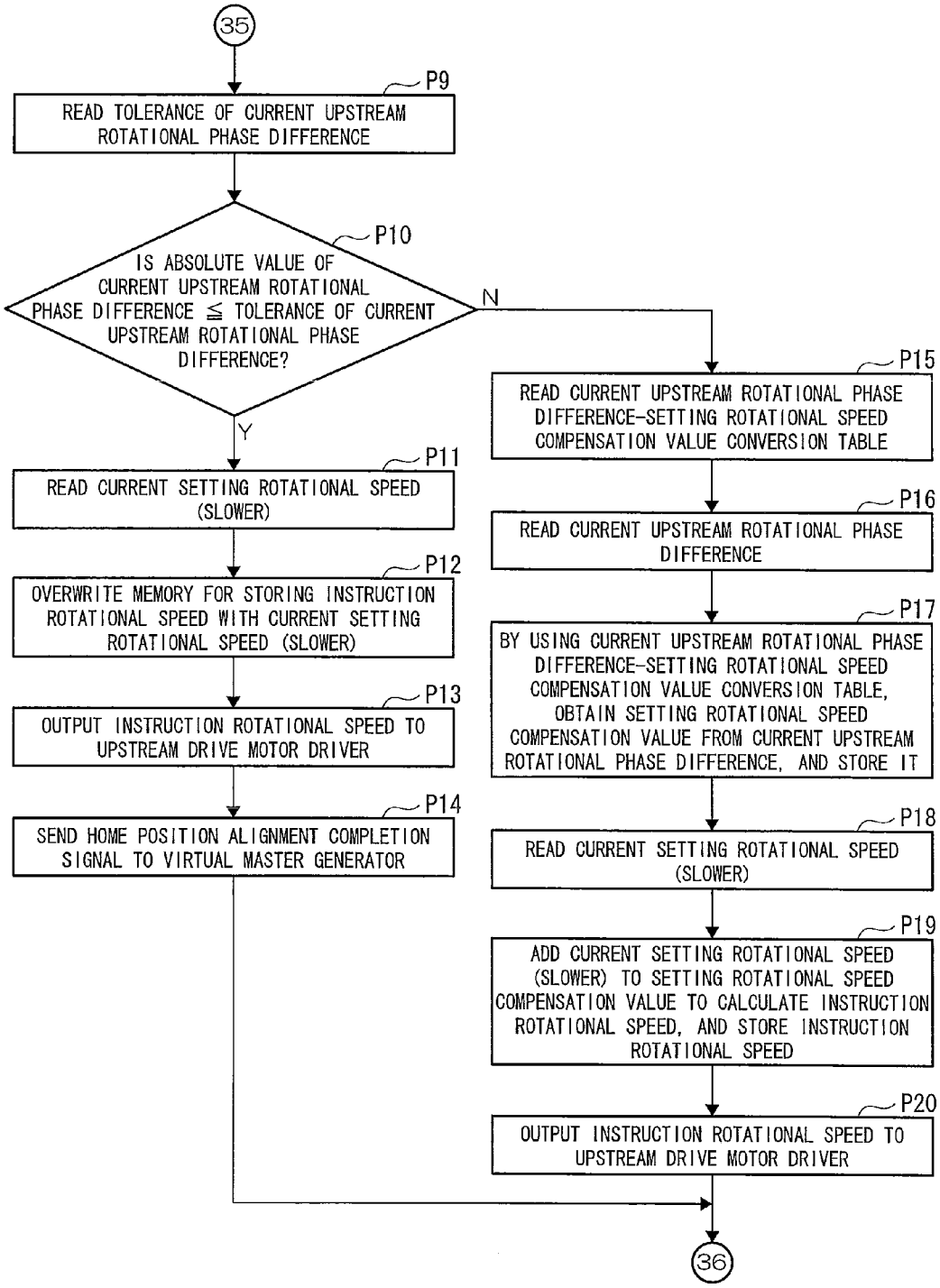
FIG. 16B is an operational flowchart of the upstream printing unit group drive controller.
Figure 17A:
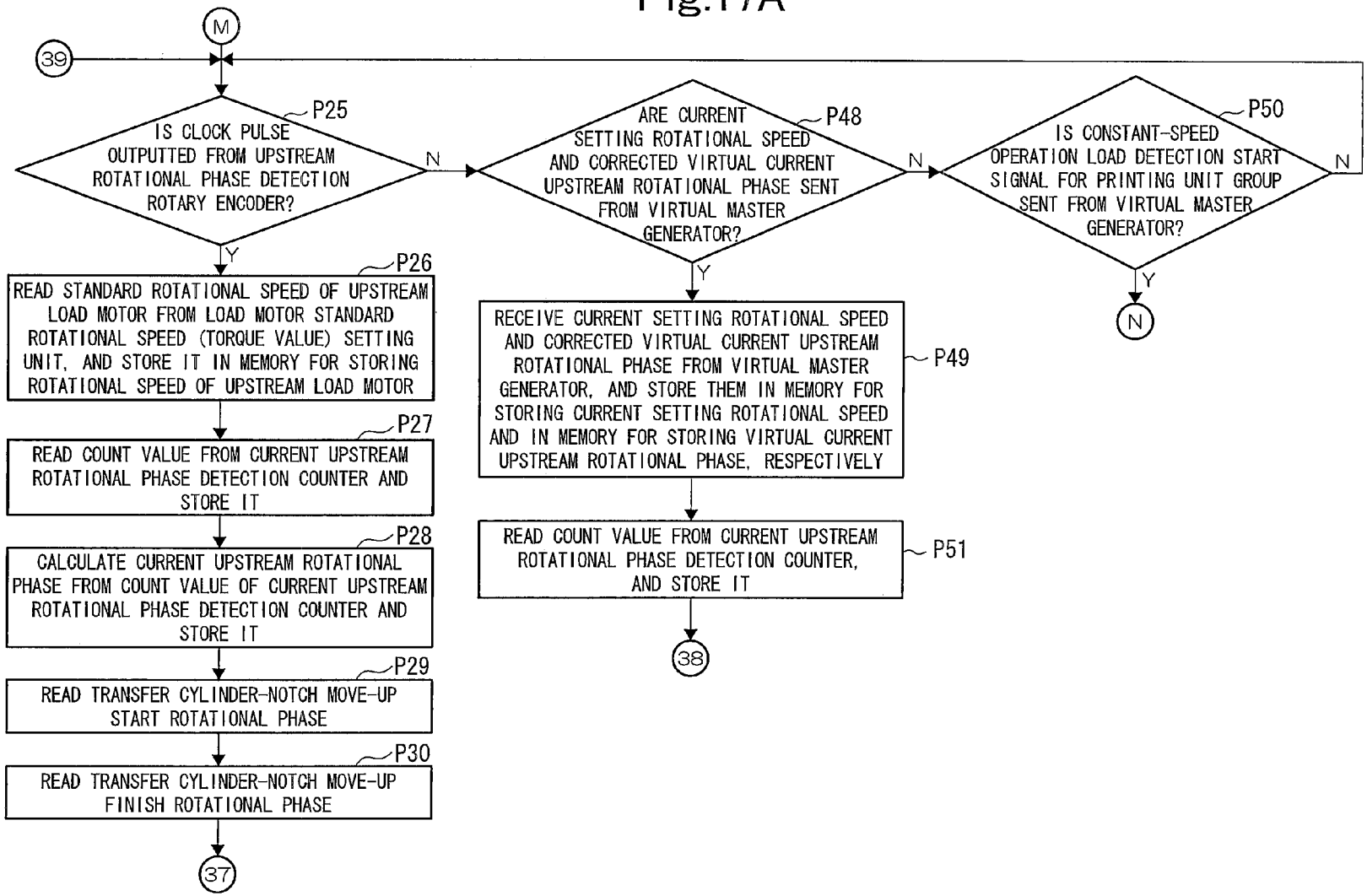
FIG. 17A is an operational flowchart of the upstream printing unit group drive controller.
Figure 17B:
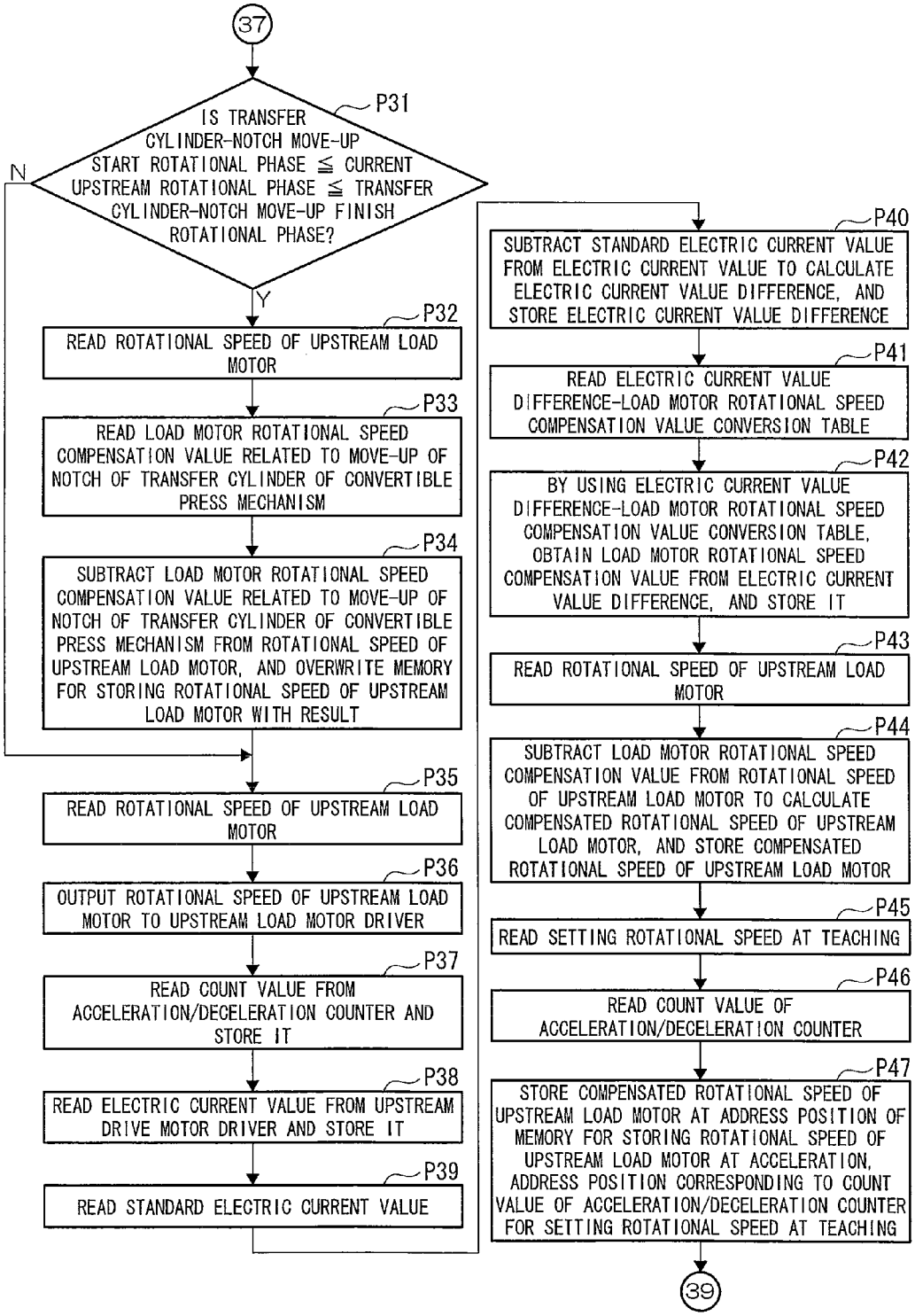
FIG. 17B is an operational flowchart of the upstream printing unit group drive controller.
Figure 17C:
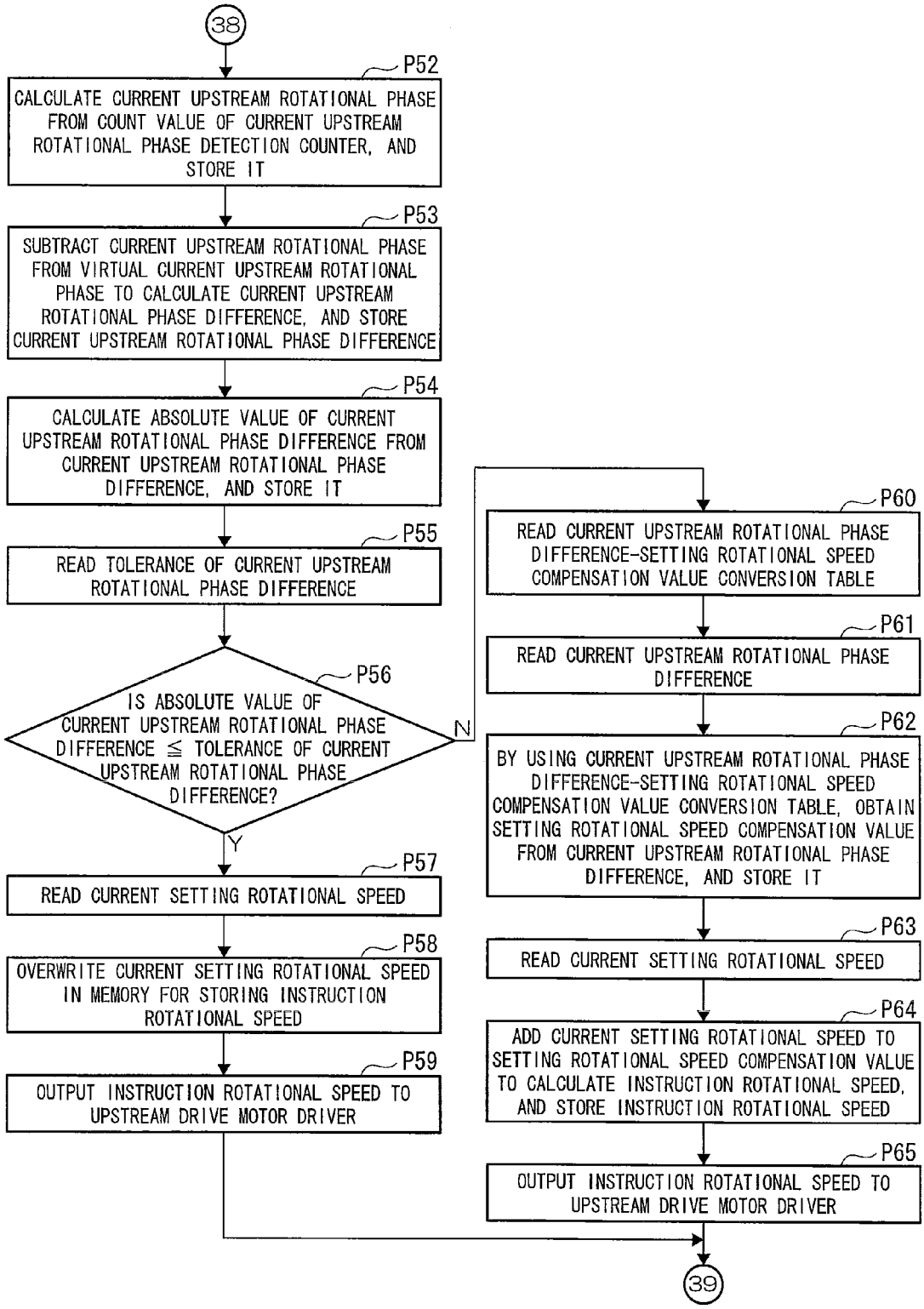
FIG. 17C is an operational flowchart of the upstream printing unit group drive controller.
Figure 18A:
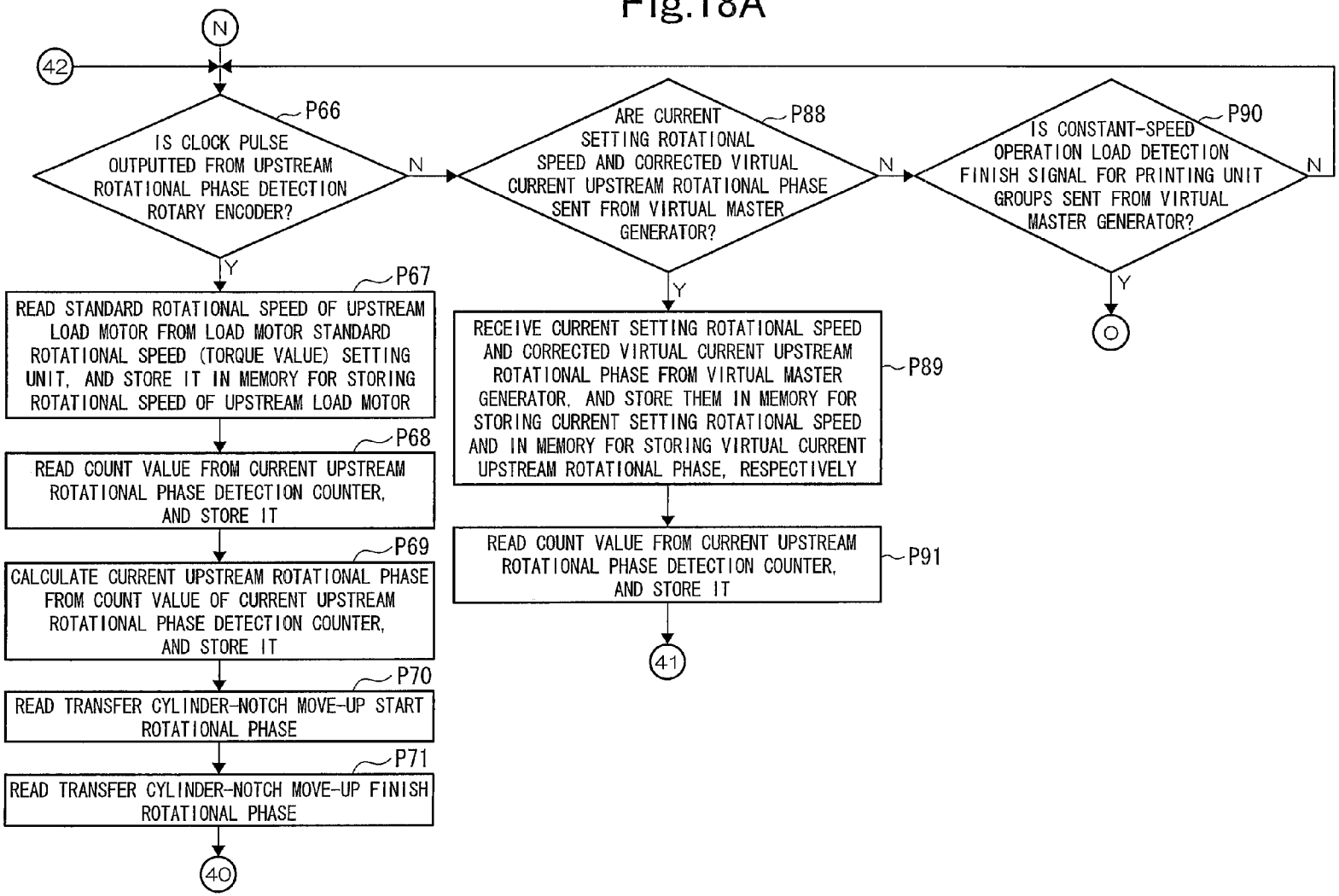
FIG. 18A is an operational flowchart of the upstream printing unit group drive controller.
Figure 18B:
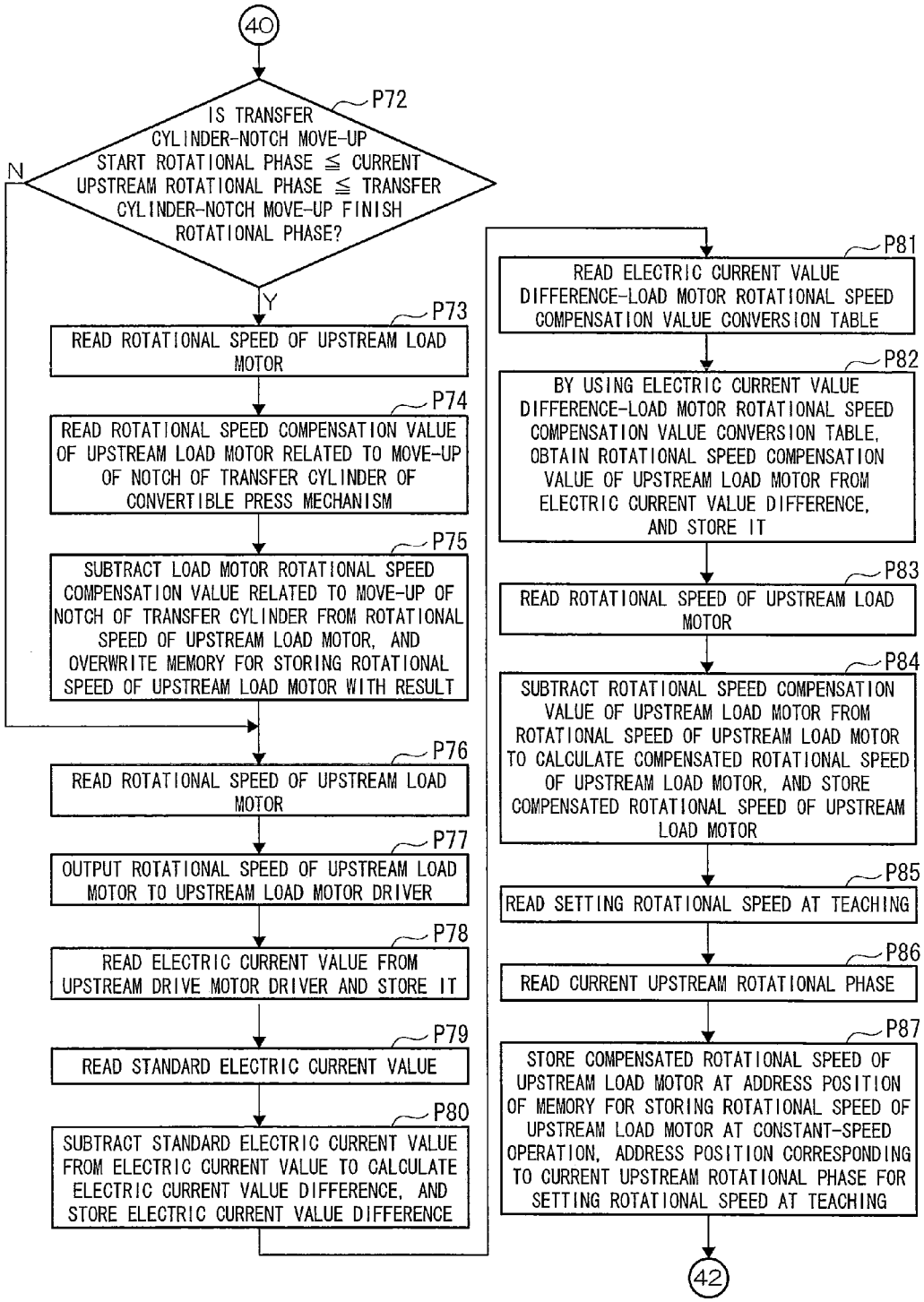
FIG. 18B is an operational flowchart of the upstream printing unit group drive controller.
Figure 18C:
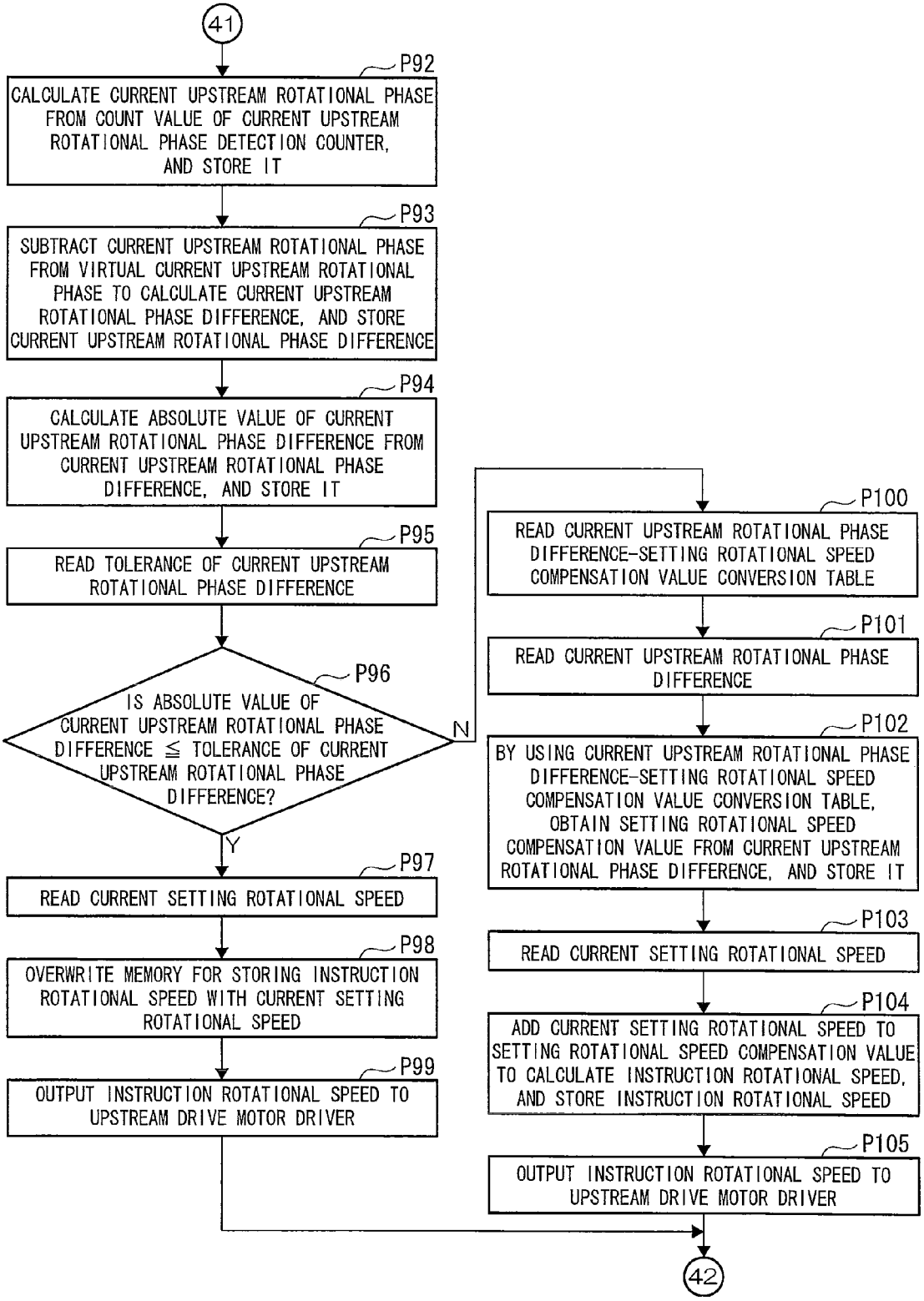
FIG. 18C is an operational flowchart of the upstream printing unit group drive controller.
Figure 19A:
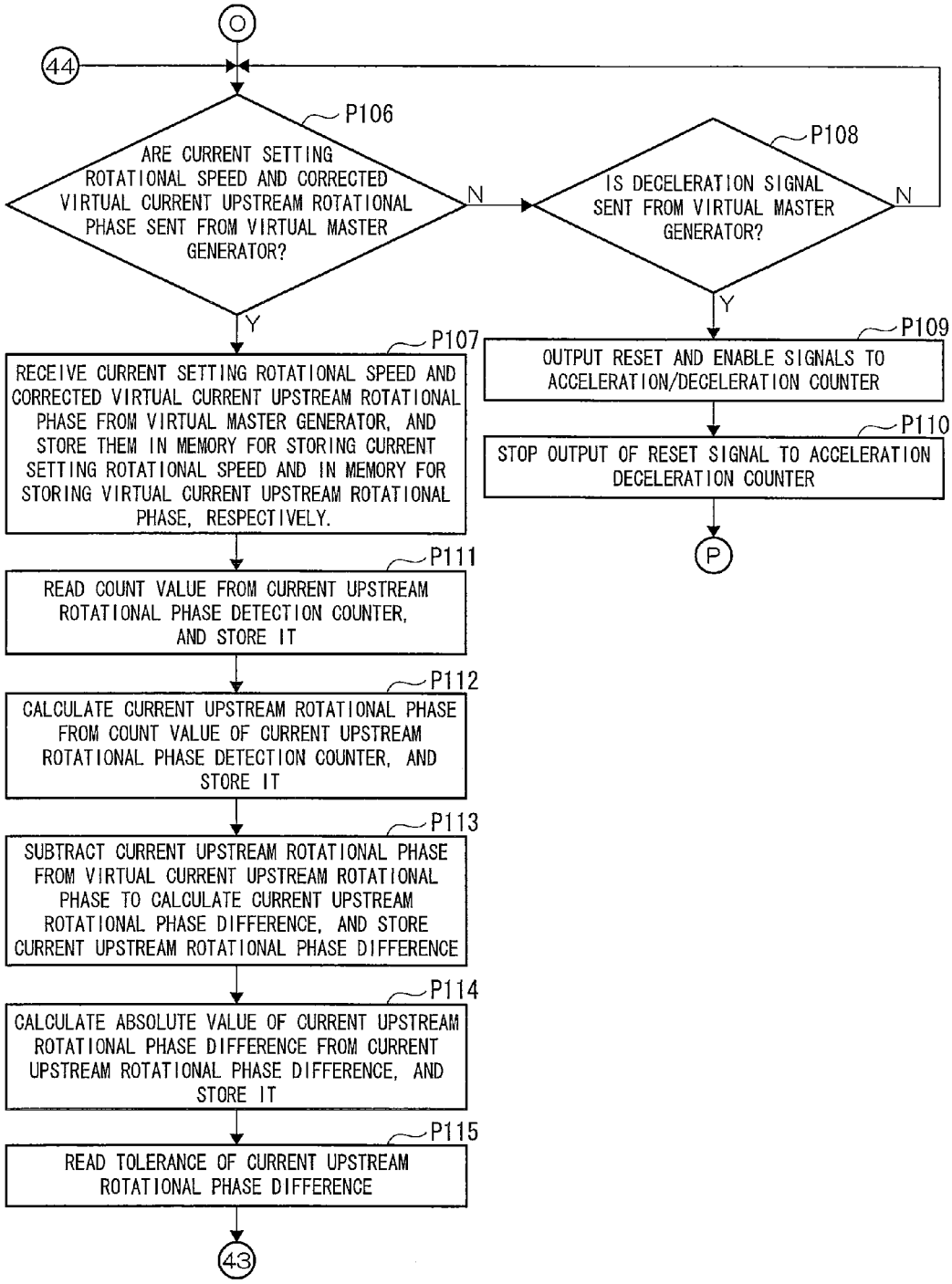
FIG. 19A is an operational flowchart of the upstream printing unit group drive controller.
Figure 19B:
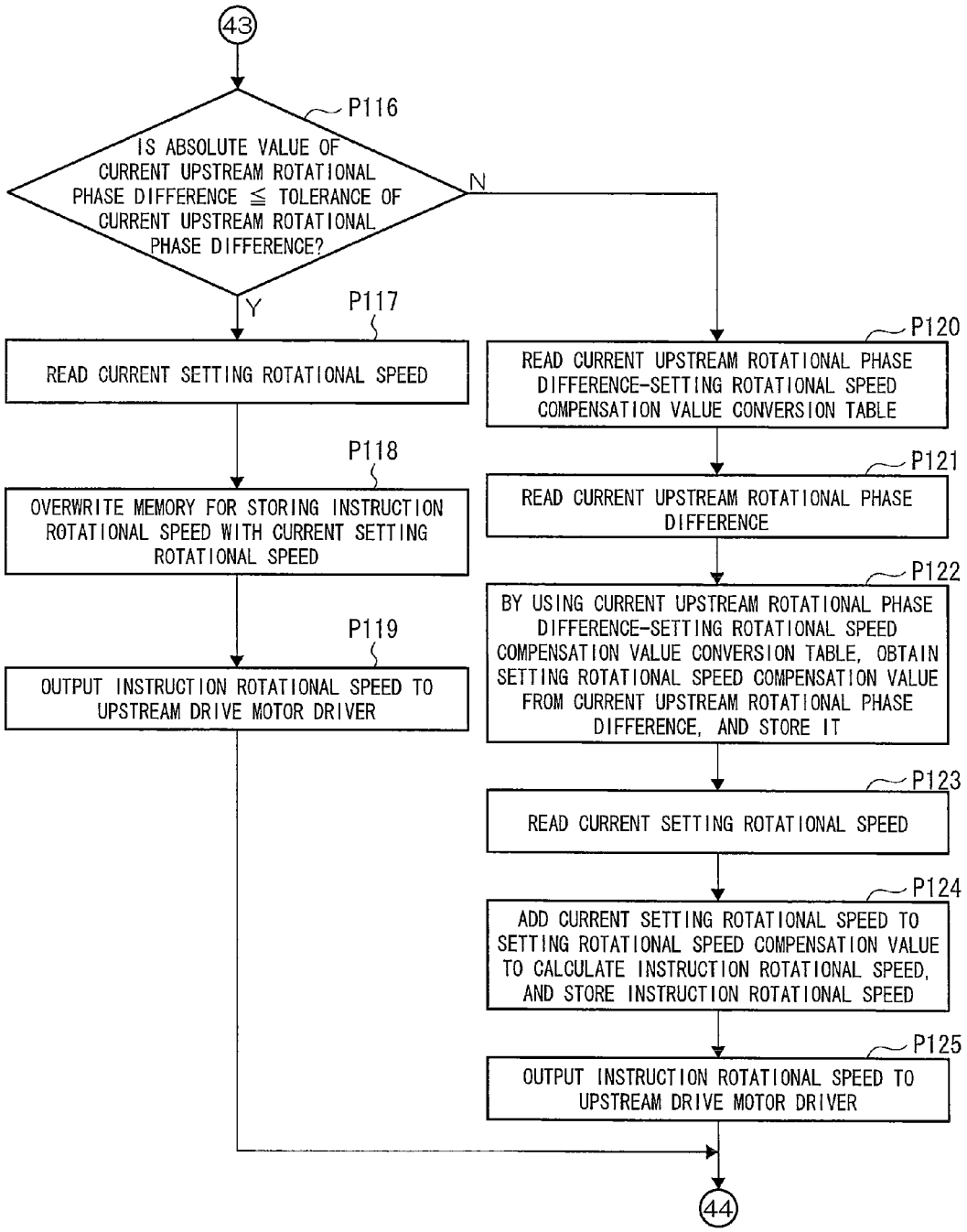
FIG. 19B is an operational flowchart of the upstream printing unit group drive controller.
Figure 20A:
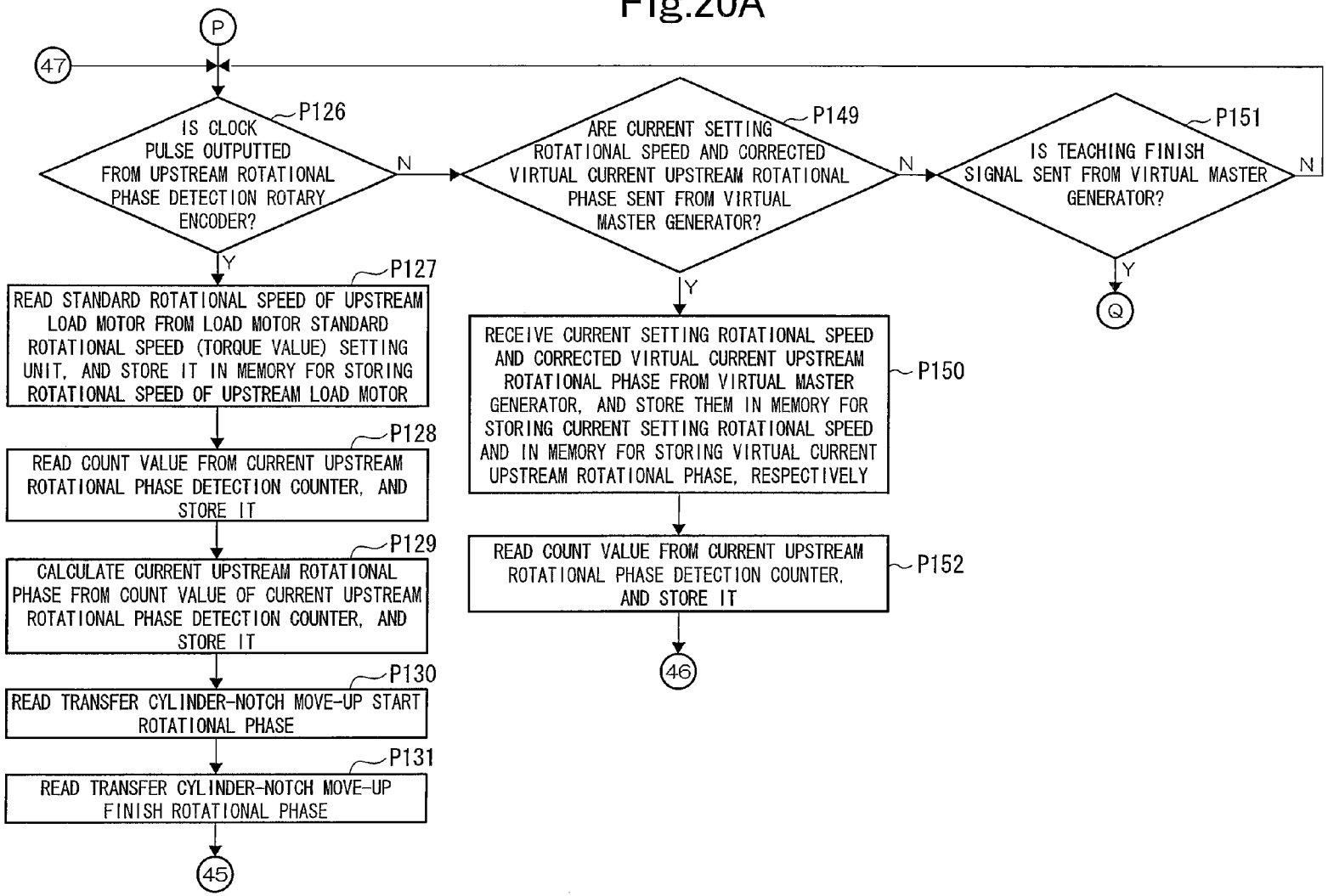
FIG. 20A is an operational flowchart of the upstream printing unit group drive controller.
Figure 20B:
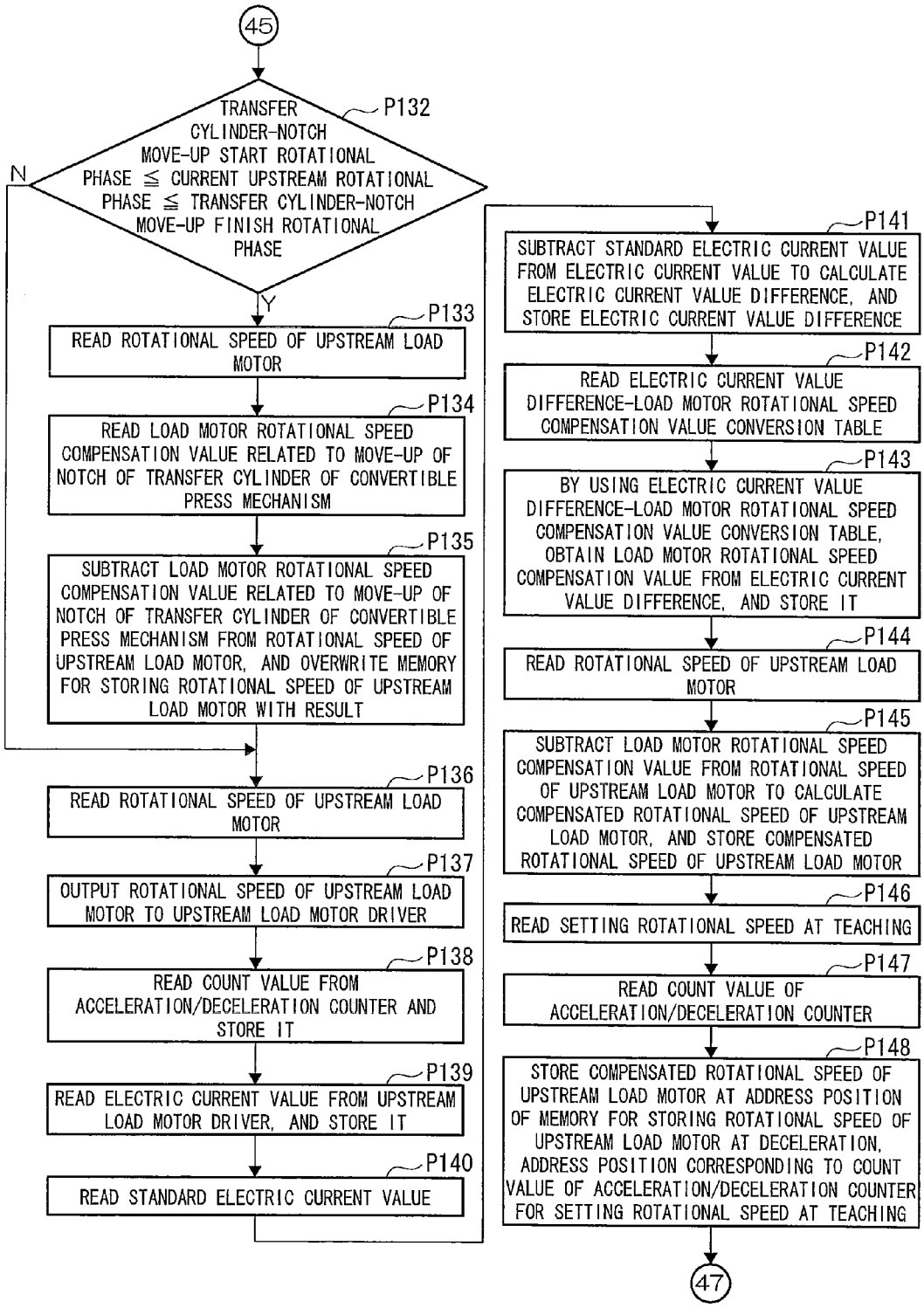
FIG. 20B is an operational flowchart of the upstream printing unit group drive controller.
Figure 20C:
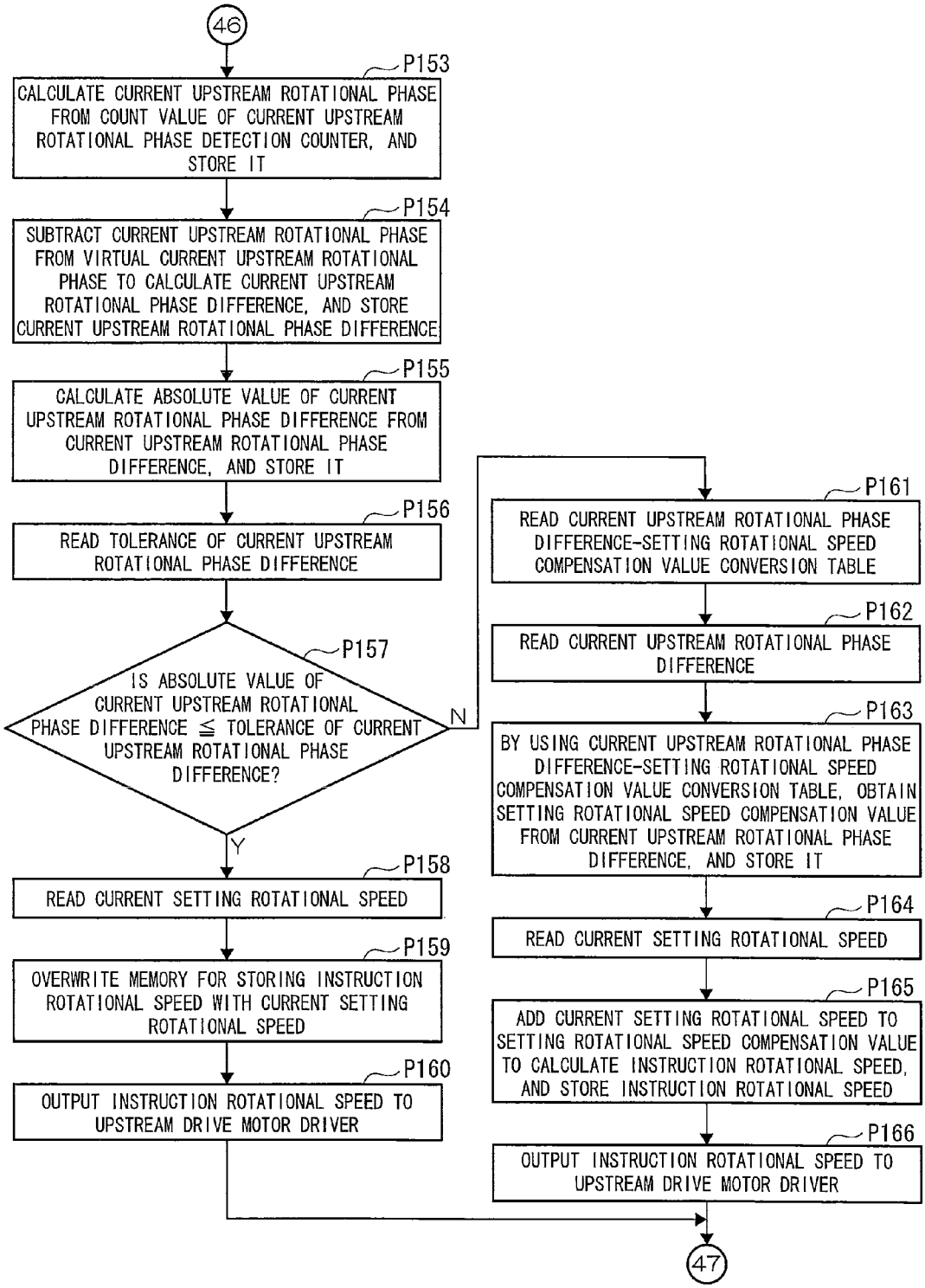
FIG. 20C is an operational flowchart of the upstream printing unit group drive controller.
Figure 21A:
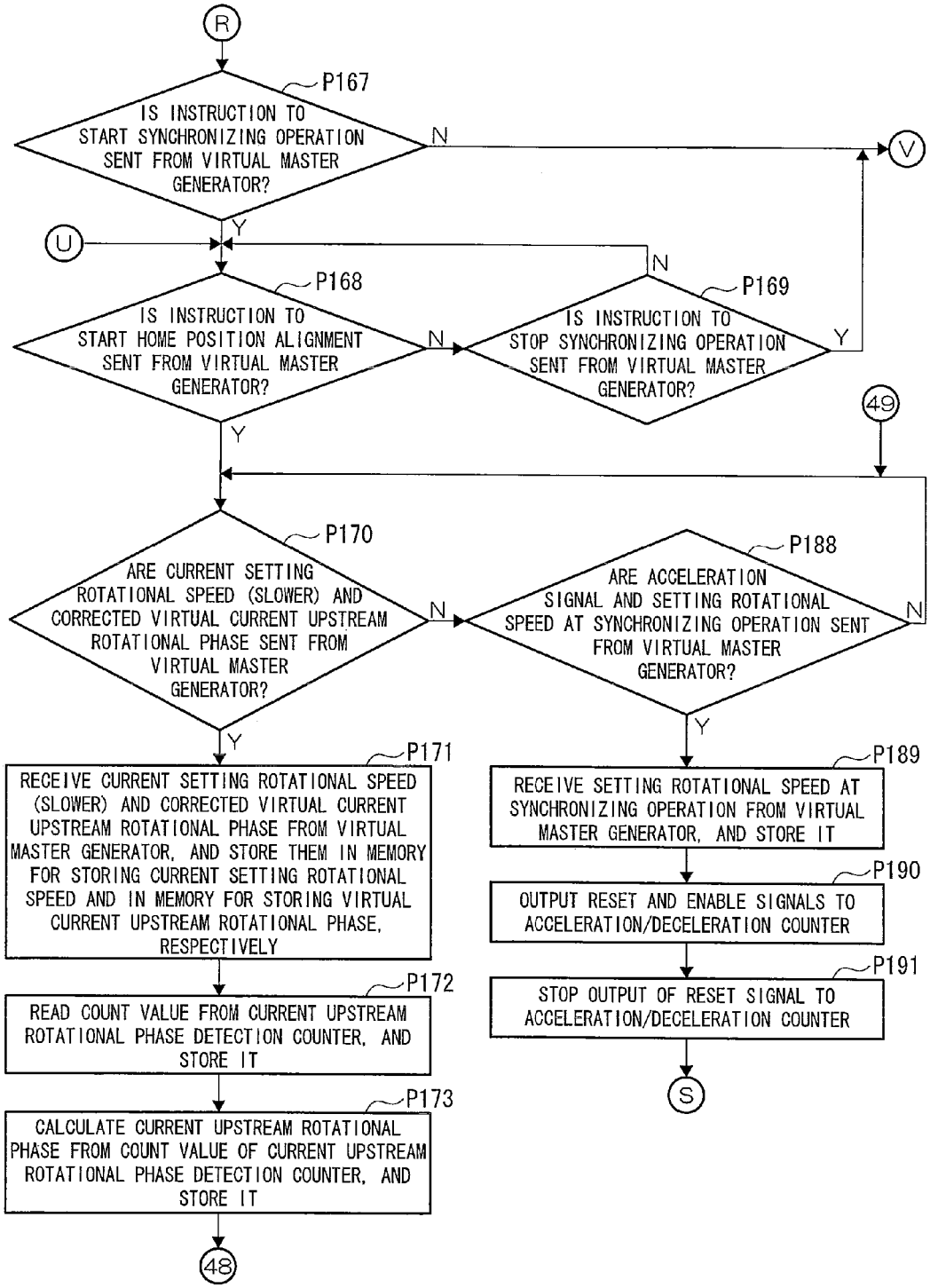
FIG. 21A is an operational flowchart of the upstream printing unit group drive controller.
Figure 21B:
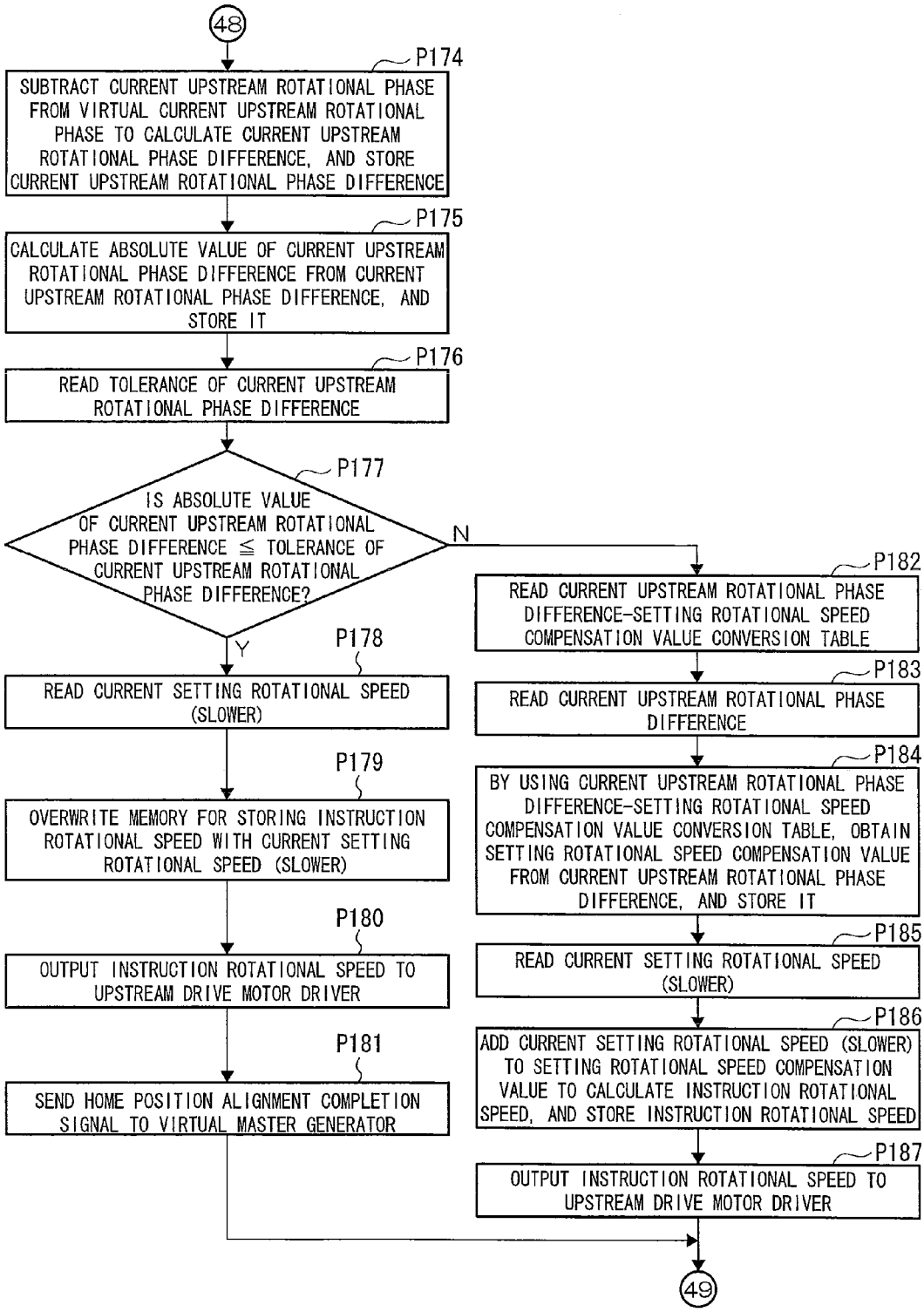
FIG. 21B is an operational flowchart of the upstream printing unit group drive controller.
Figure 22A:
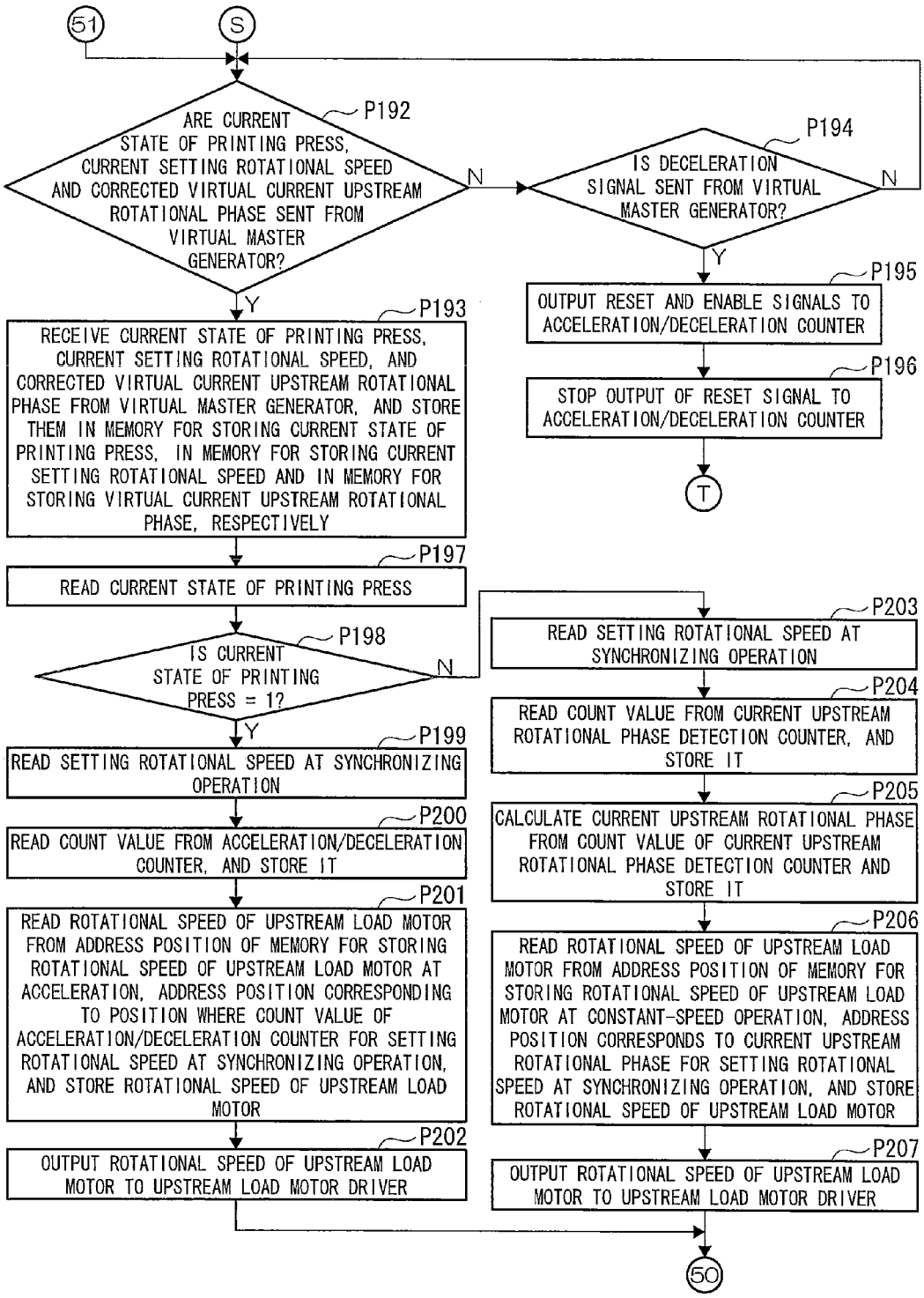
FIG. 22A is an operational flowchart of the upstream printing unit group drive controller.
Figure 22B:
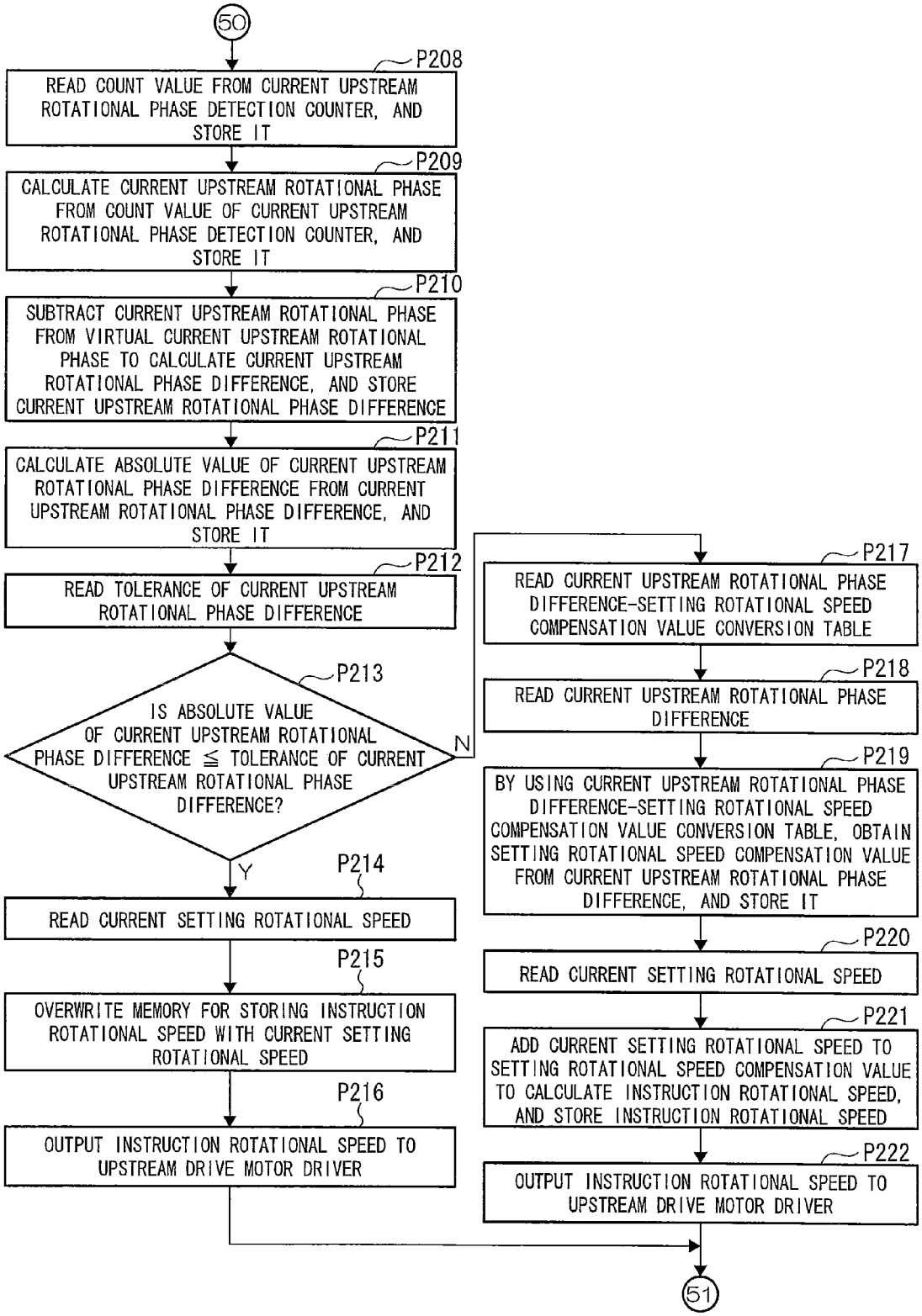
FIG. 22B is an operational flowchart of the upstream printing unit group drive controller.
Figure 23A:
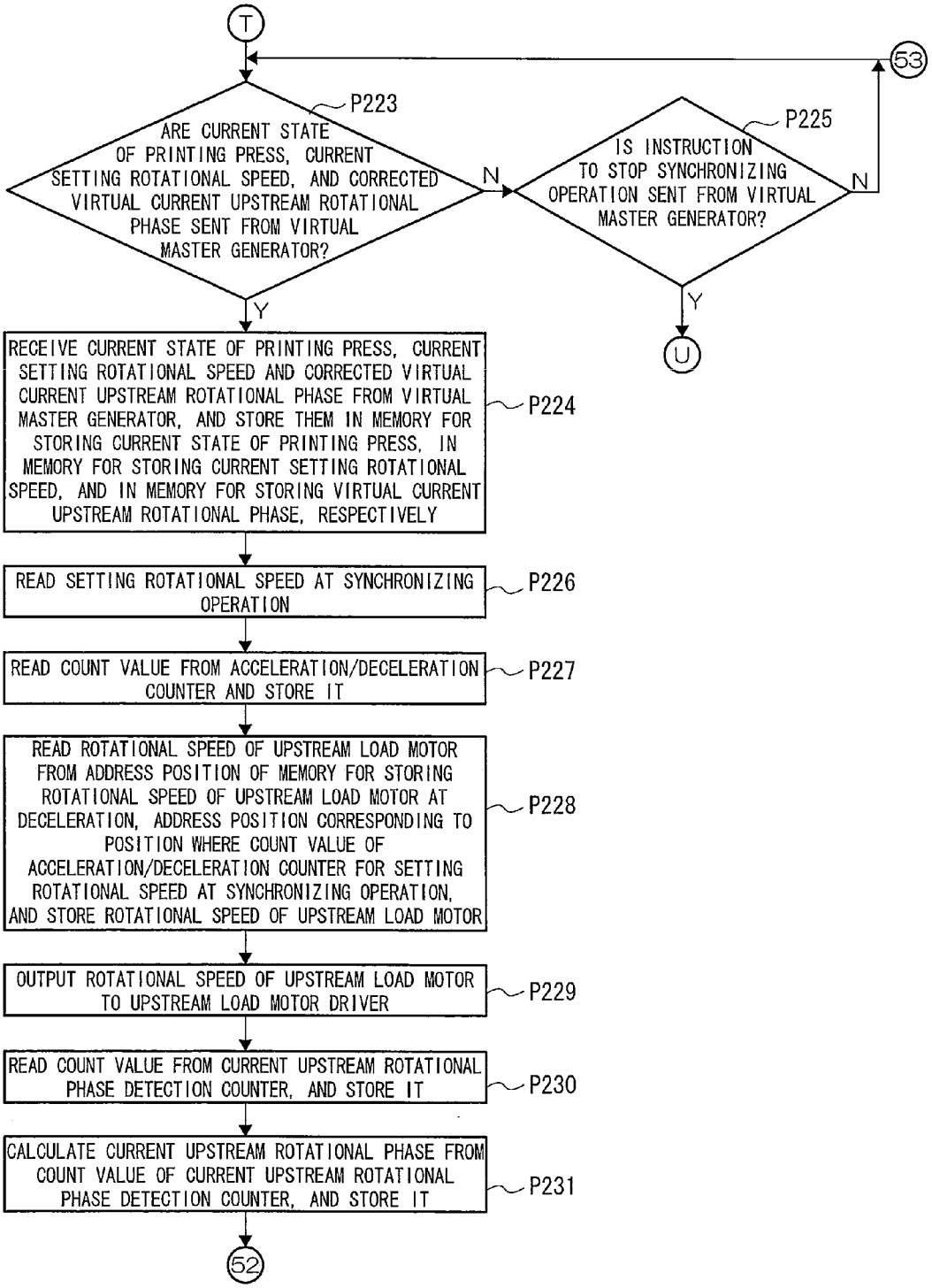
FIG. 23A is an operational flowchart of the upstream printing unit group drive controller.
Figure 23B:
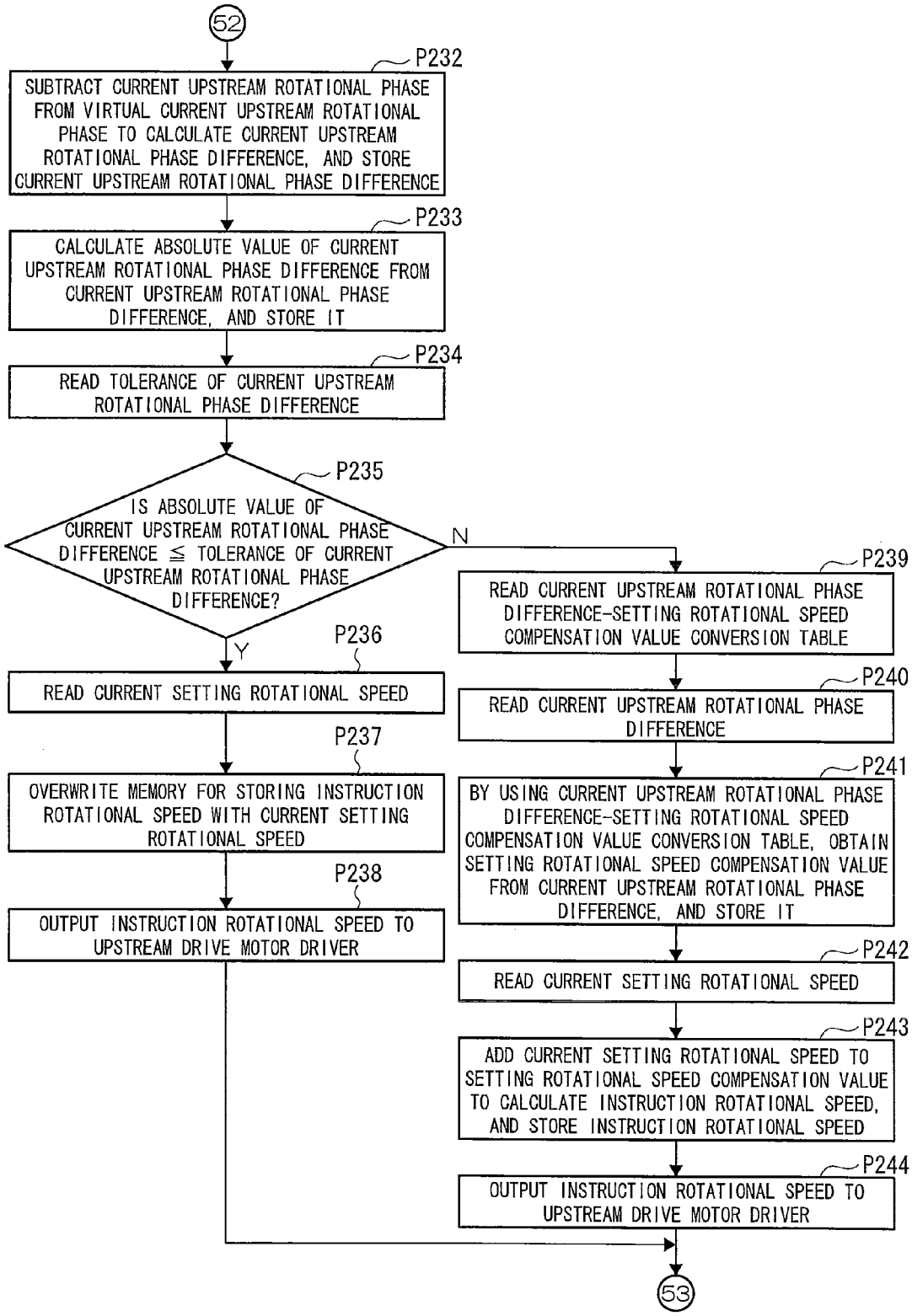
FIG. 23B is an operational flowchart of the upstream printing unit group drive controller.
Figure 24:
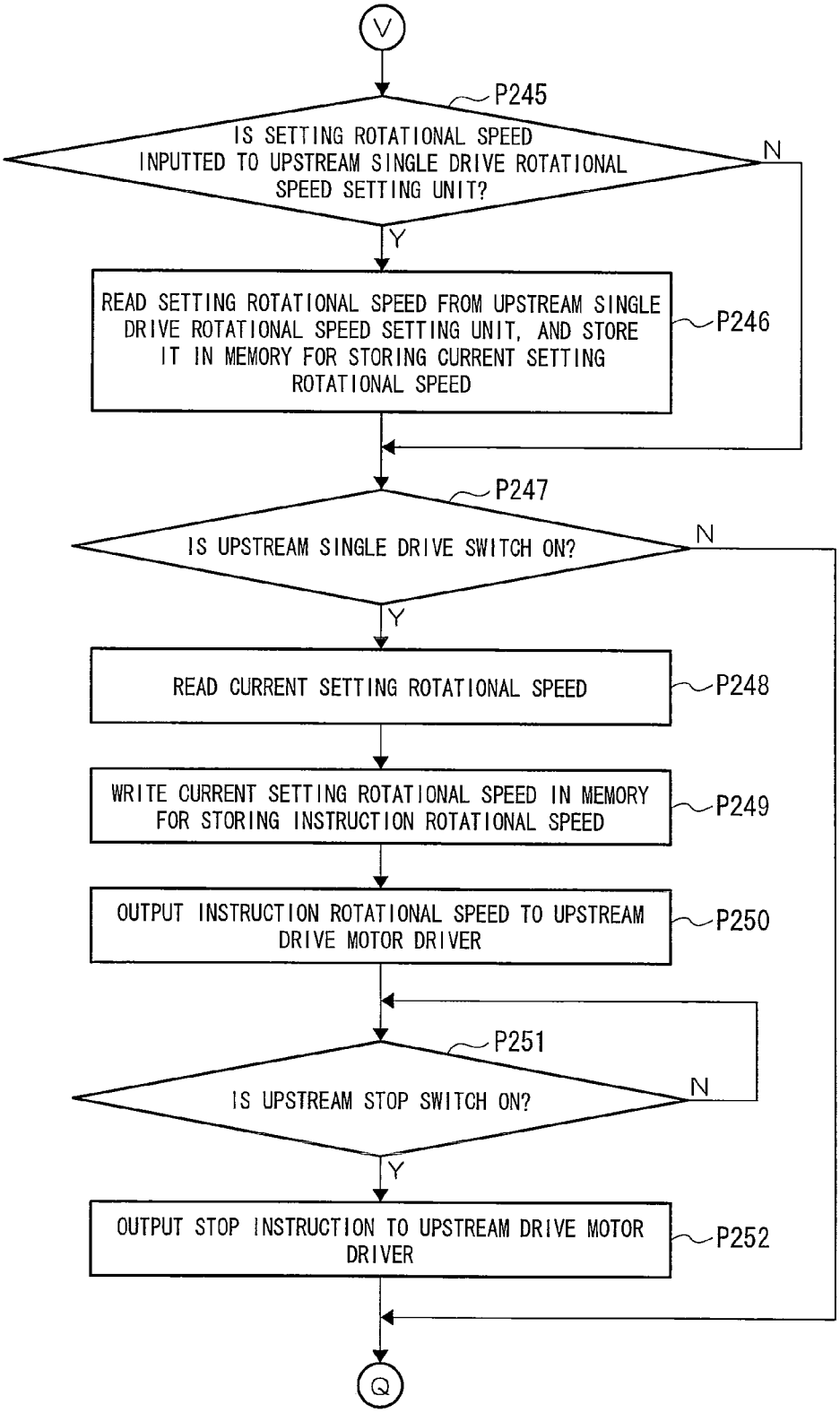
FIG. 24 is an operational flowchart of the upstream printing unit group drive controller.

FIGS. 16A and 16B are operational flowcharts of the upstream printing unit group drive controller. FIGS. 17A to 17C are operational flowcharts of the upstream printing unit group drive controller. FIGS. 18A to 18C are operational flowcharts of the upstream printing unit group drive controller. FIGS. 19A and 19B are operational flowcharts of the upstream printing unit group drive controller. FIGS. 20A to 20C are operational flowcharts of the upstream printing unit group drive controller. FIGS. 21A and 21B are operational flowcharts of the upstream printing unit group drive controller. FIGS. 22A and 22B are operational flowcharts of the upstream printing unit group drive controller. FIGS. 23A and 23B are operational flowcharts of the upstream printing unit group drive controller. FIG. 24 is an operational flowchart of the upstream printing unit group drive controller.

Figure 25A:
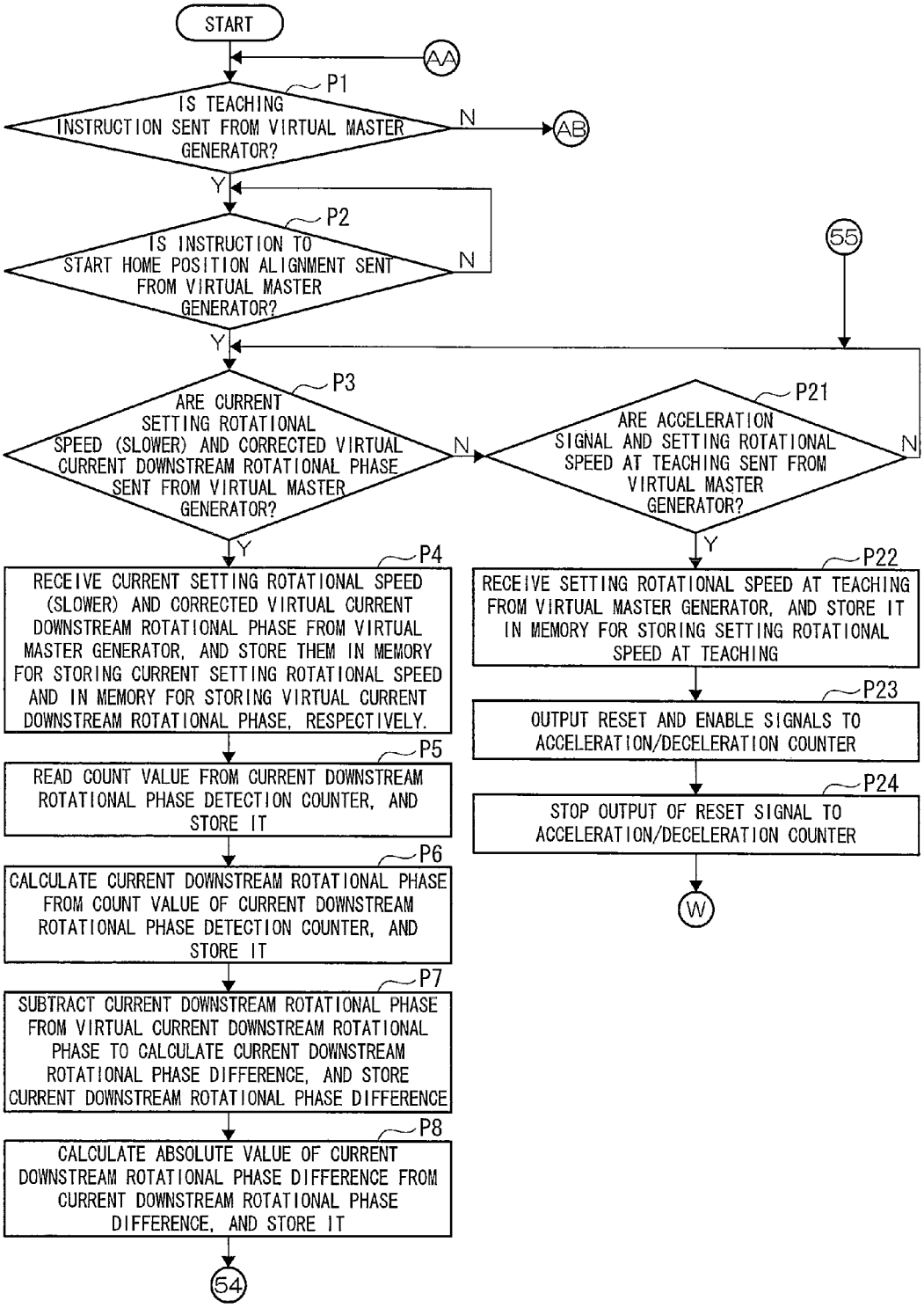
FIG. 25A is an operational flowchart of the downstream printing unit group drive controller.
Figure 25B:
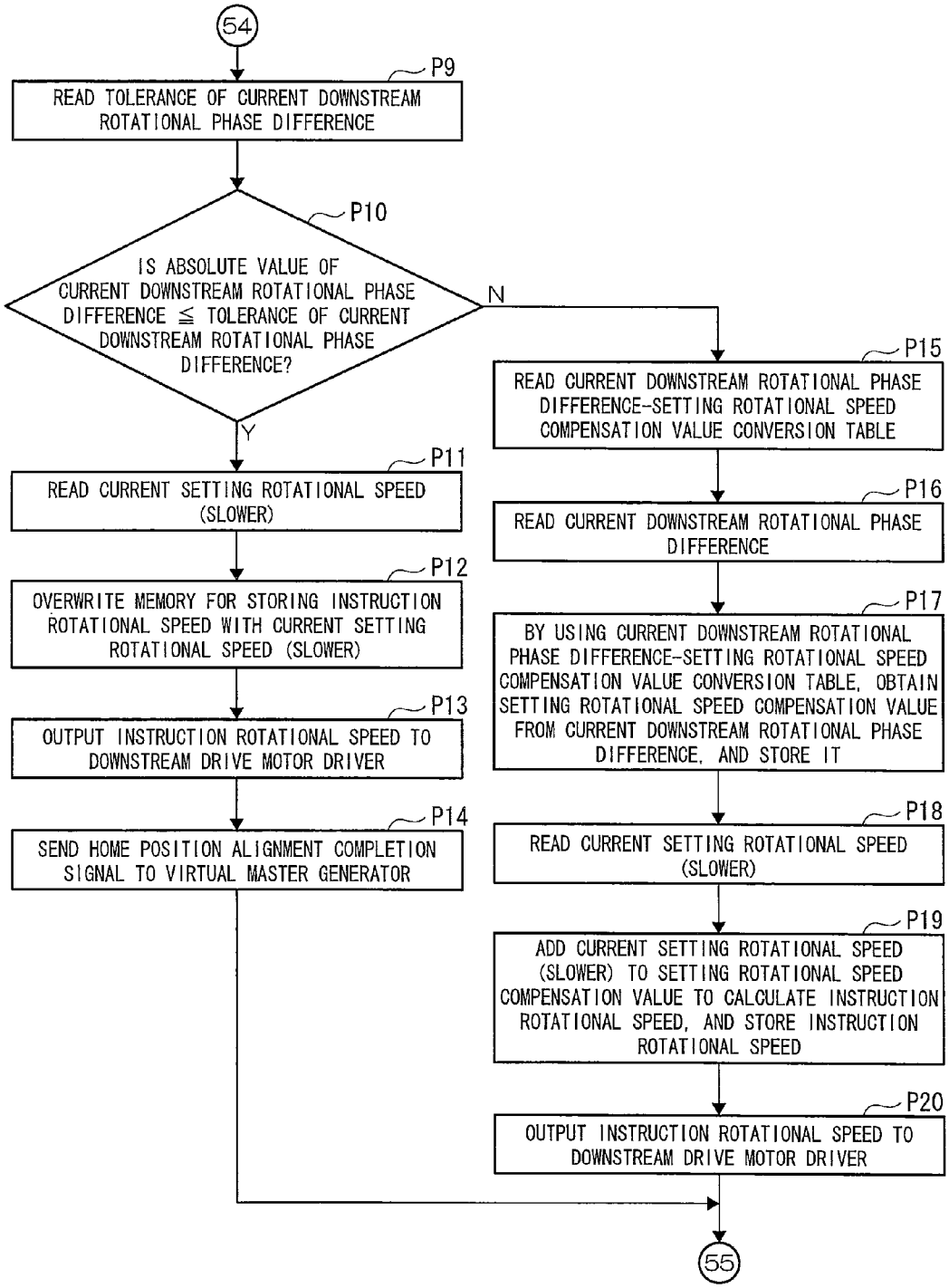
FIG. 25B is an operational flowchart of the downstream printing unit group drive controller.
Figure 26A:
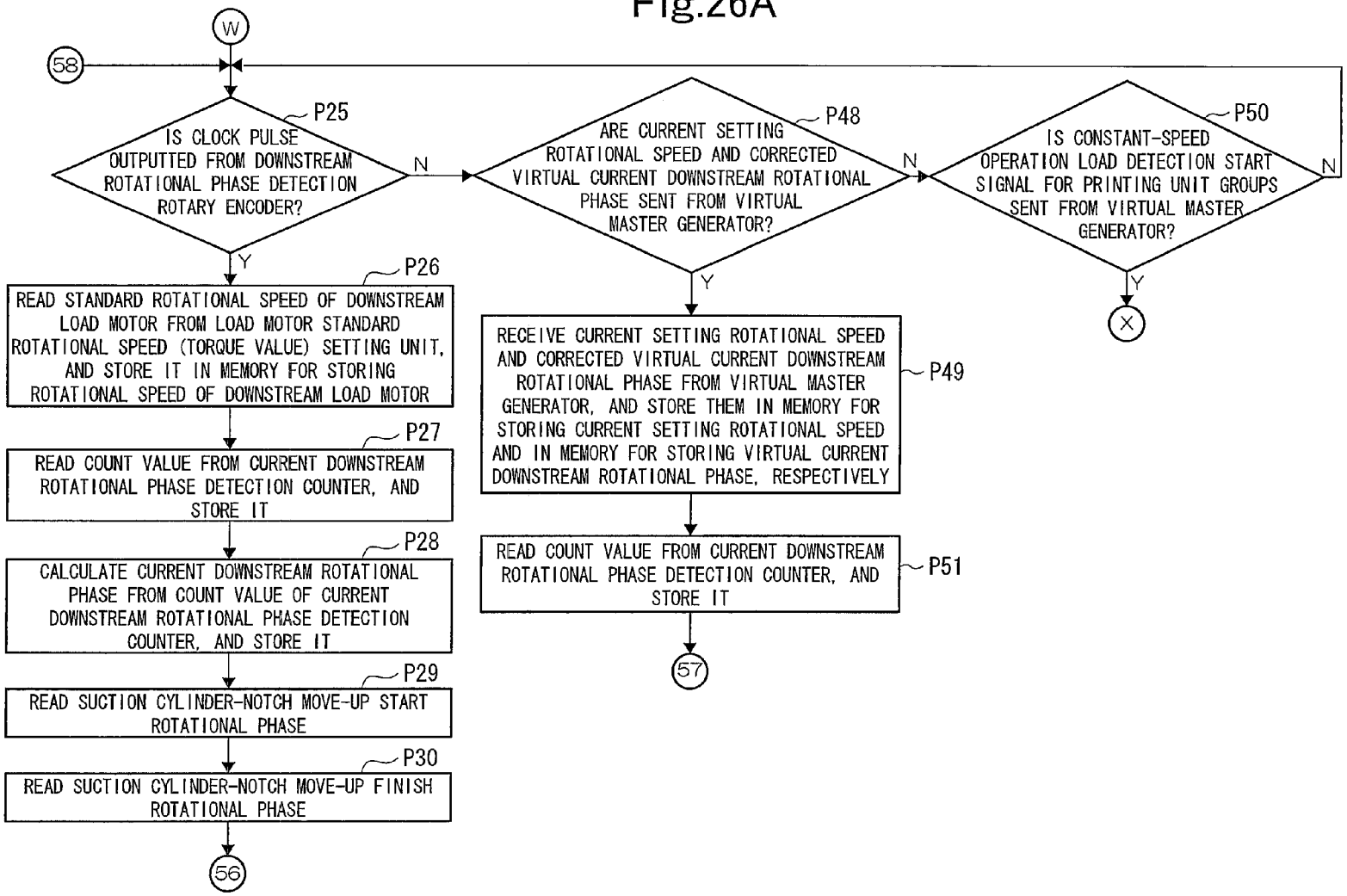
FIG. 26A is an operational flowchart of the downstream printing unit group drive controller.
Figure 26B:
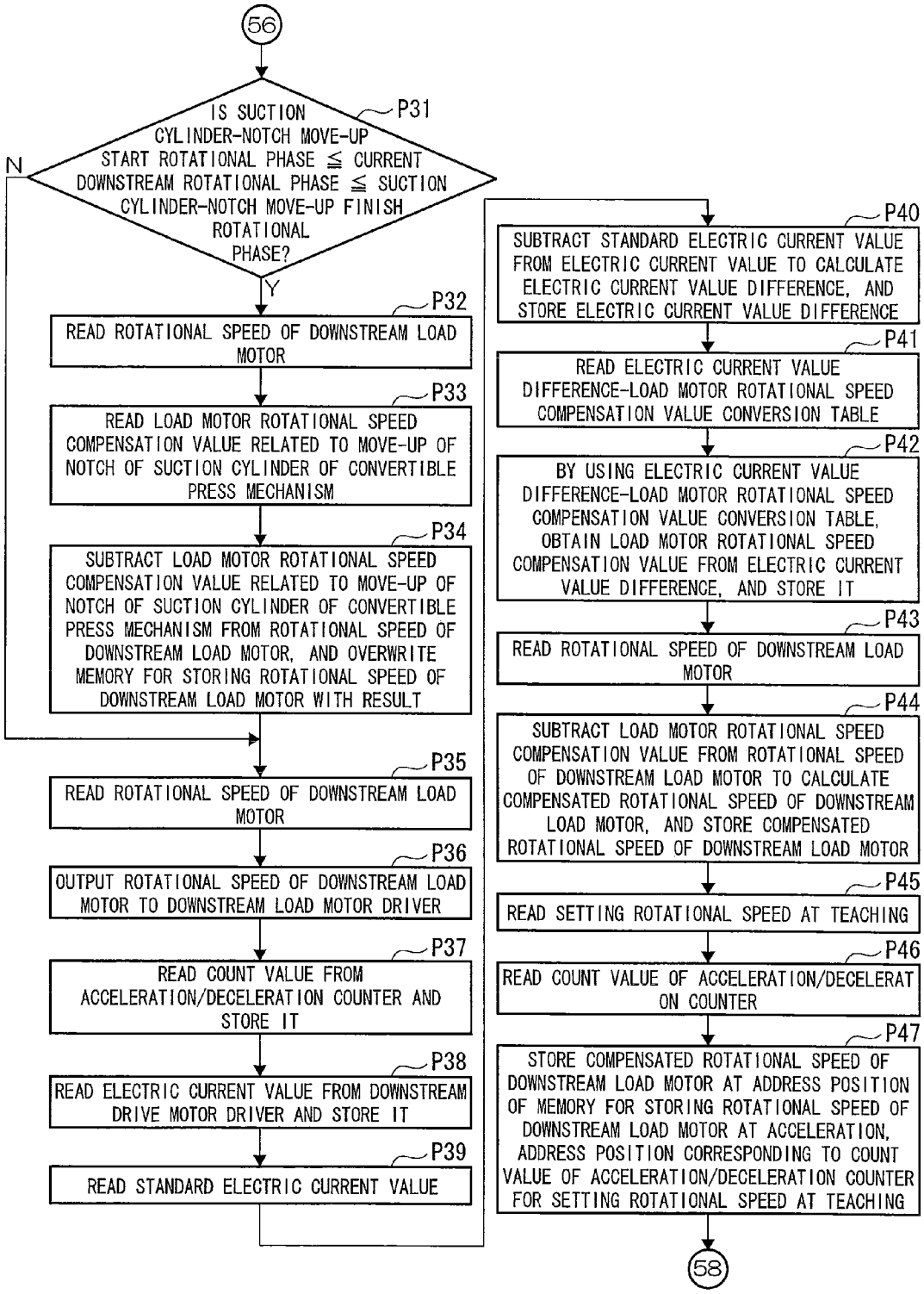
FIG. 26B is an operational flowchart of the downstream printing unit group drive controller.
Figure 26C:
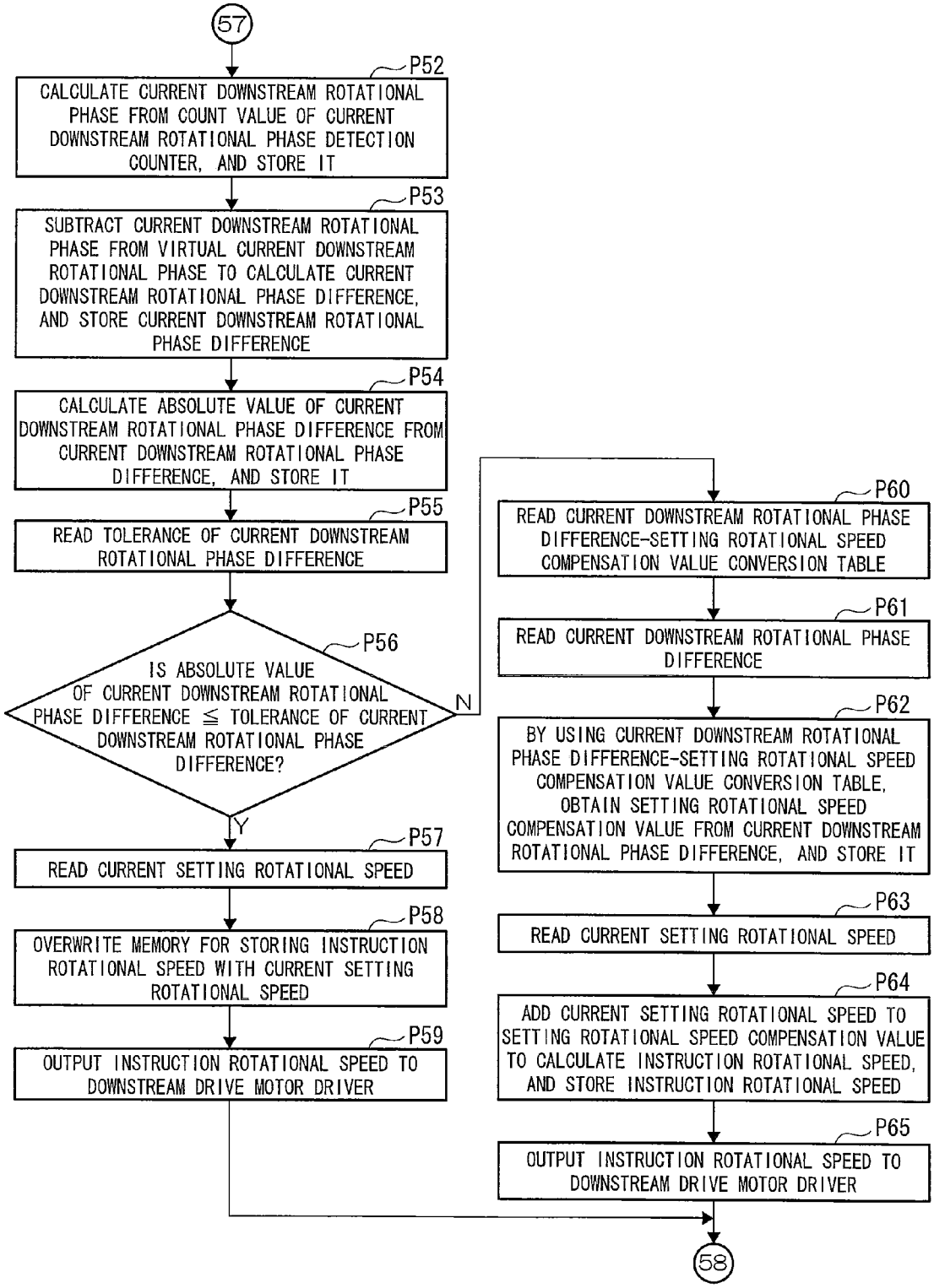
FIG. 26C is an operational flowchart of the downstream printing unit group drive controller.
Figure 27A:
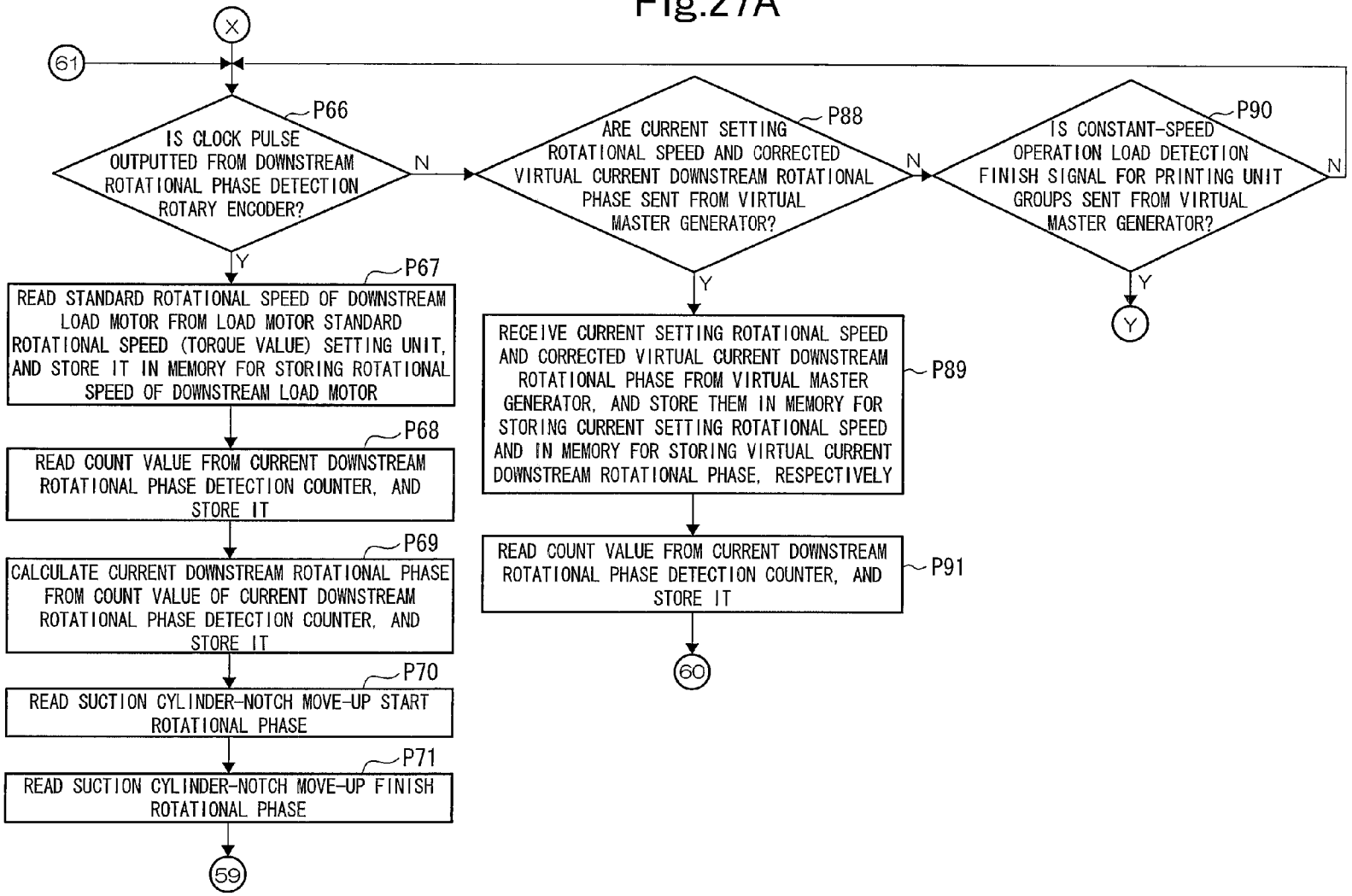
FIG. 27A is an operational flowchart of the downstream printing unit group drive controller.
Figure 27B:
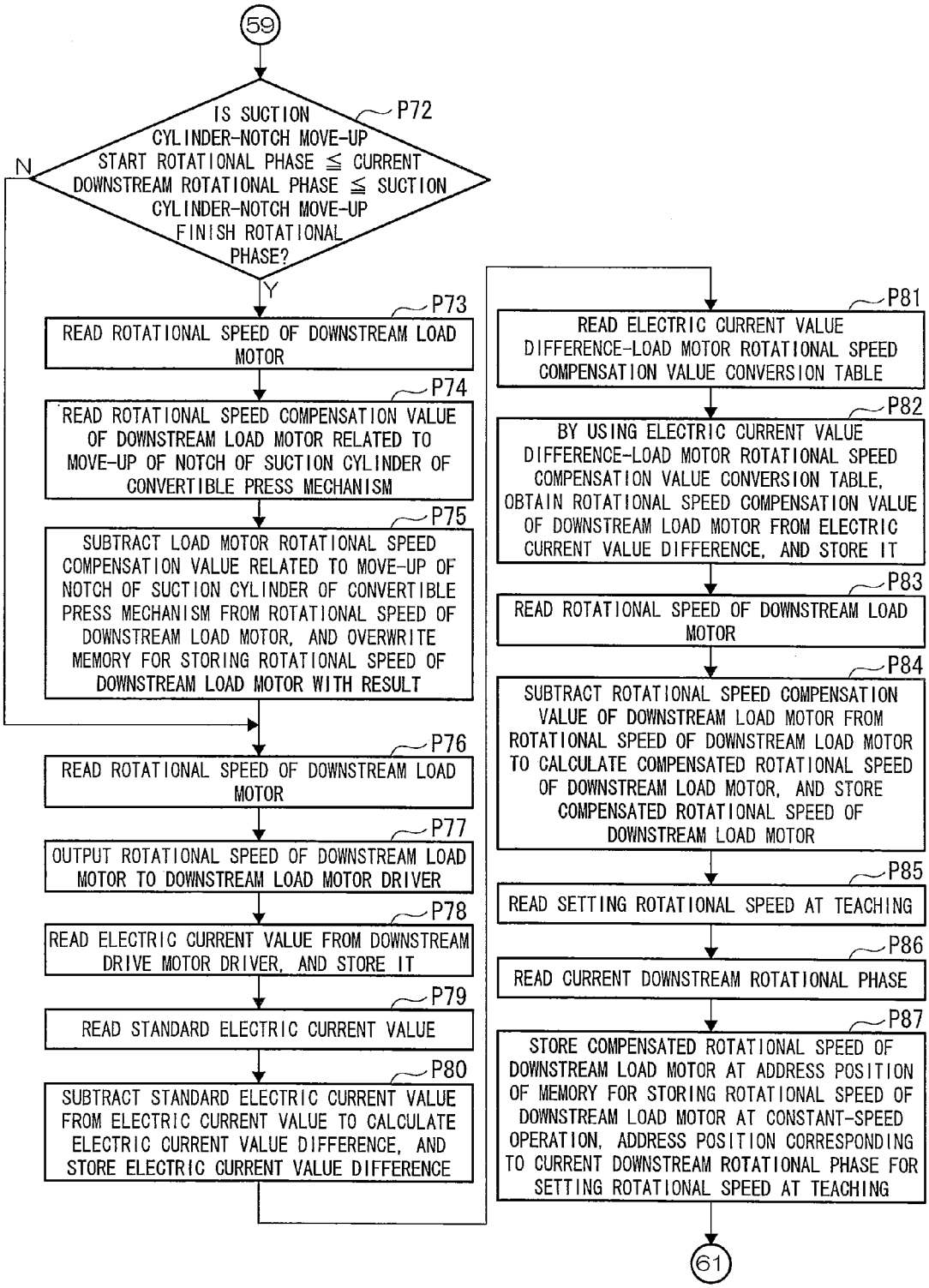
FIG. 27B is an operational flowchart of the downstream printing unit group drive controller.
Figure 27C:
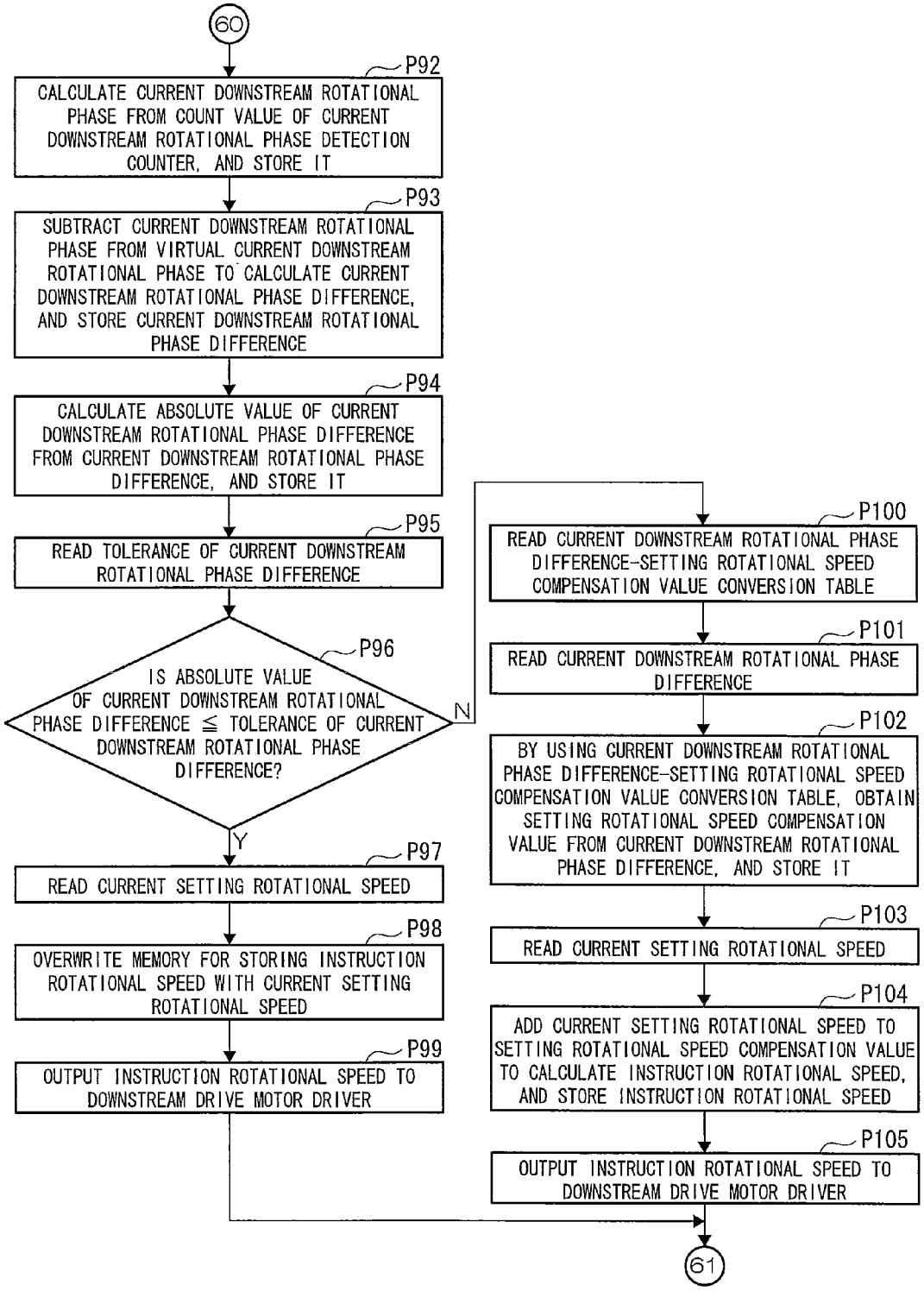
FIG. 27C is an operational flowchart of the downstream printing unit group drive controller.
Figure 28A:
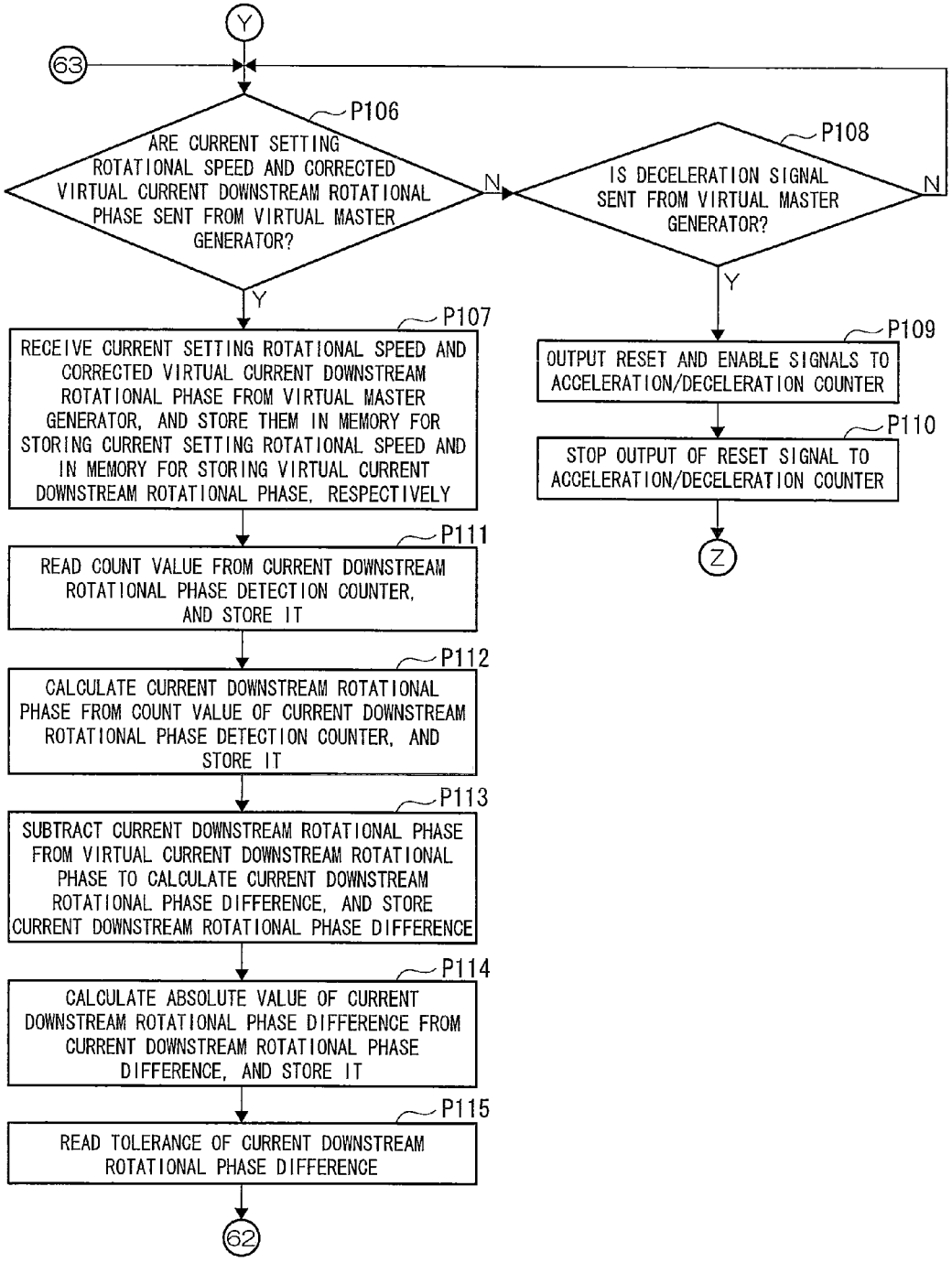
FIG. 28A is an operational flowchart of the downstream printing unit group drive controller.
Figure 28B:
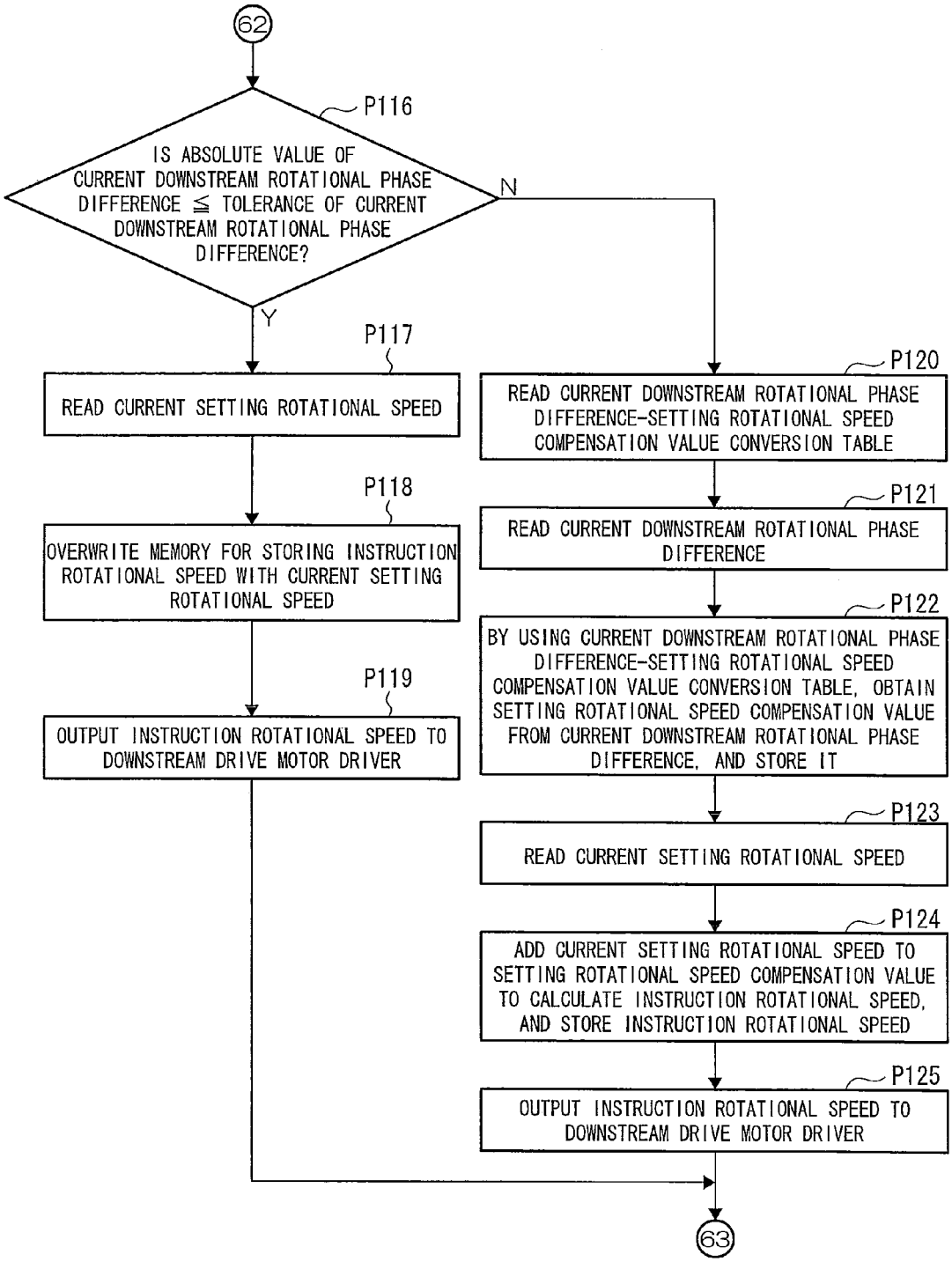
FIG. 28B is an operational flowchart of the downstream printing unit group drive controller.
Figure 29A:
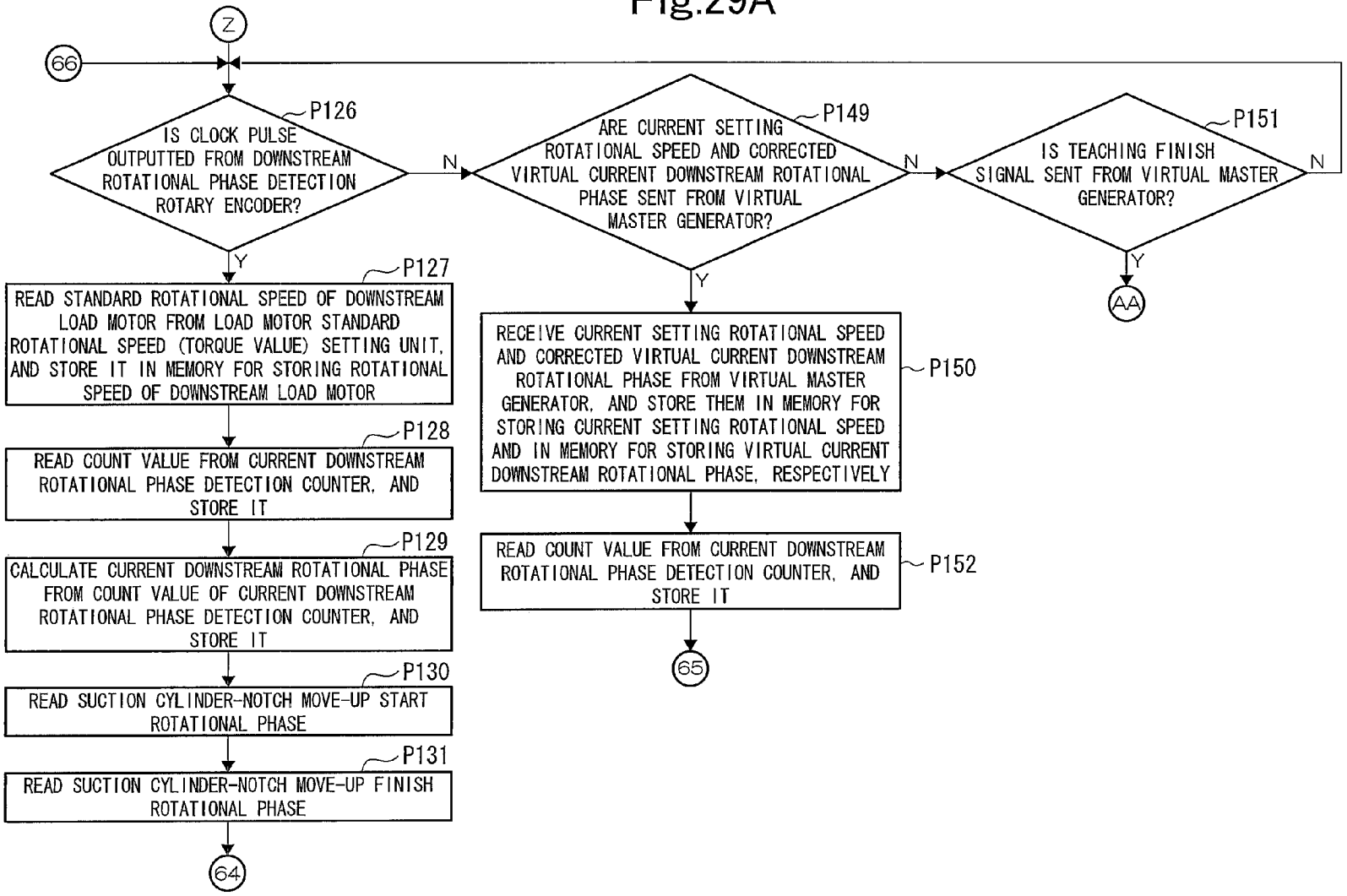
FIG. 29A is an operational flowchart of the downstream printing unit group drive controller.
Figure 29B:
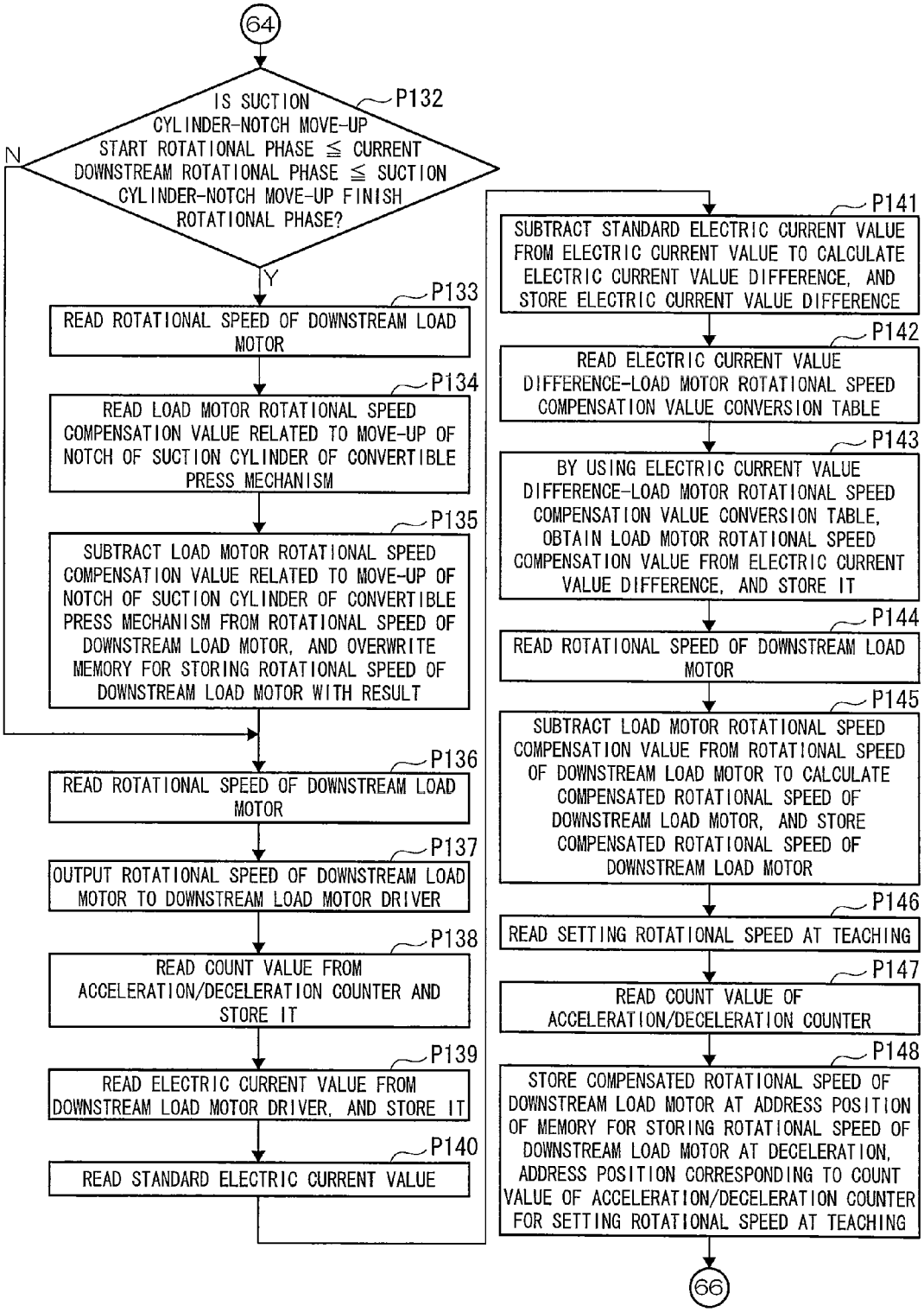
FIG. 29B is an operational flowchart of the downstream printing unit group drive controller.
Figure 29C:
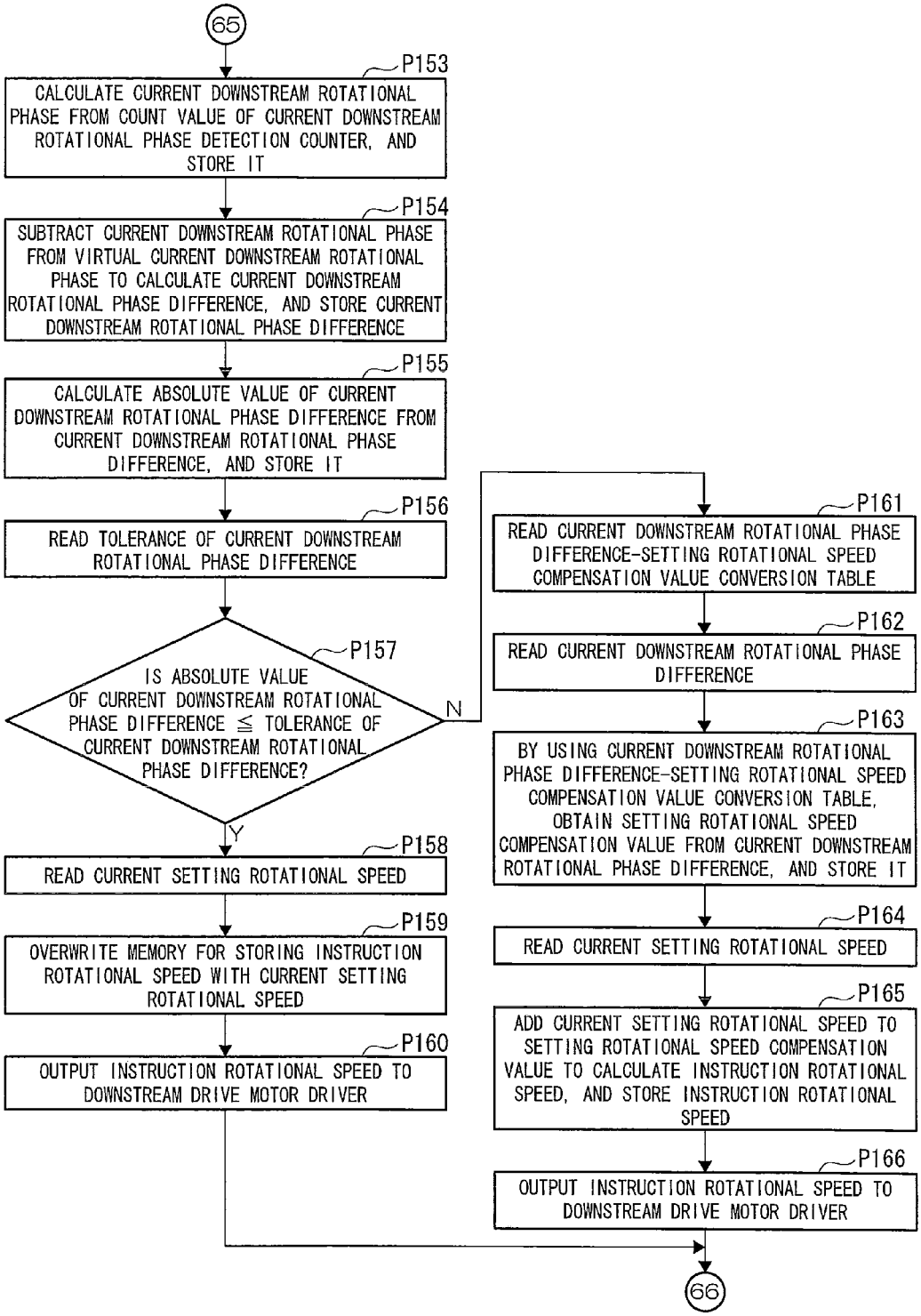
FIG. 29C is an operational flowchart of the downstream printing unit group drive controller.
Figure 30A:
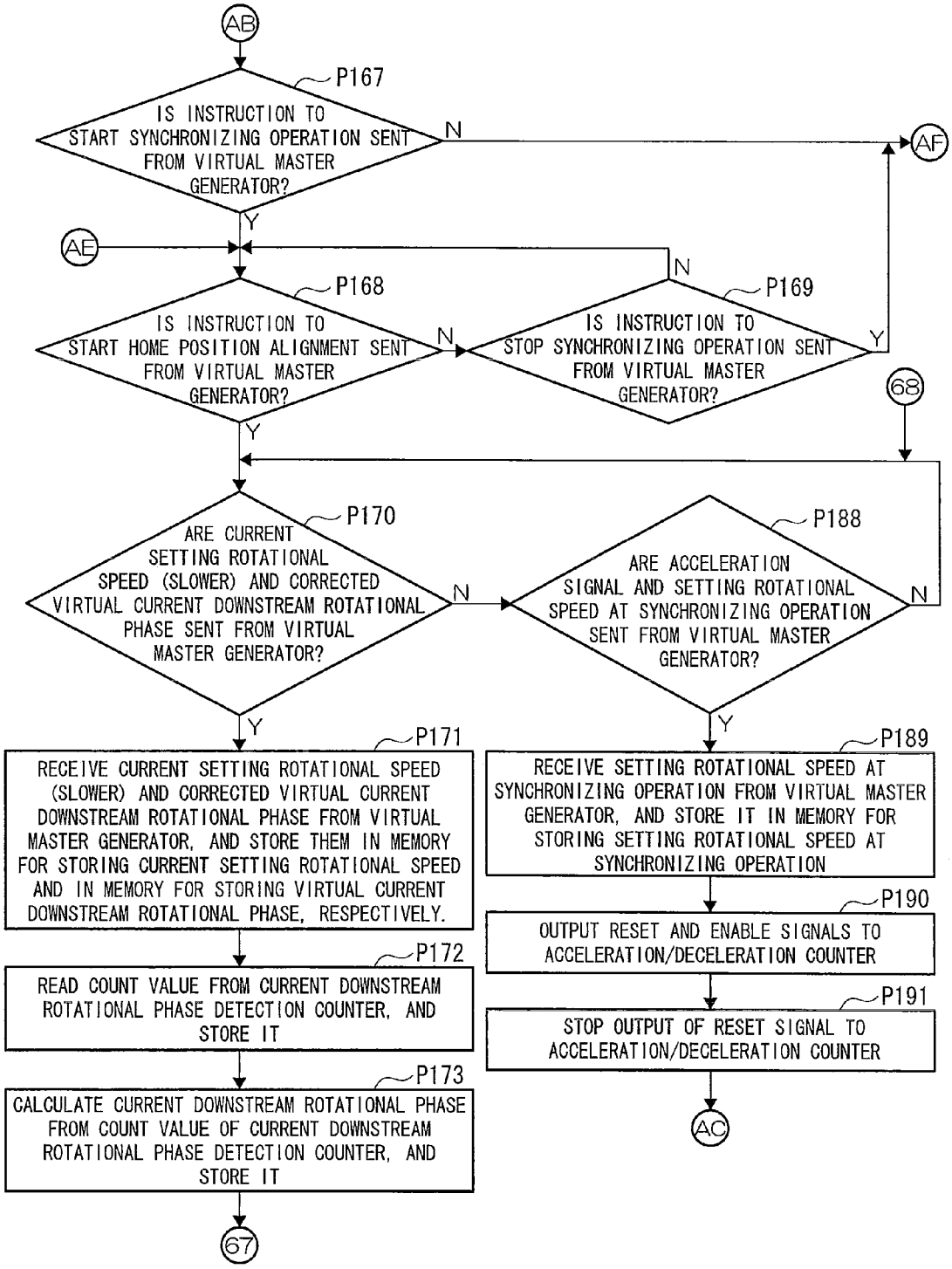
FIG. 30A is an operational flowchart of the downstream printing unit group drive controller.
Figure 30B:
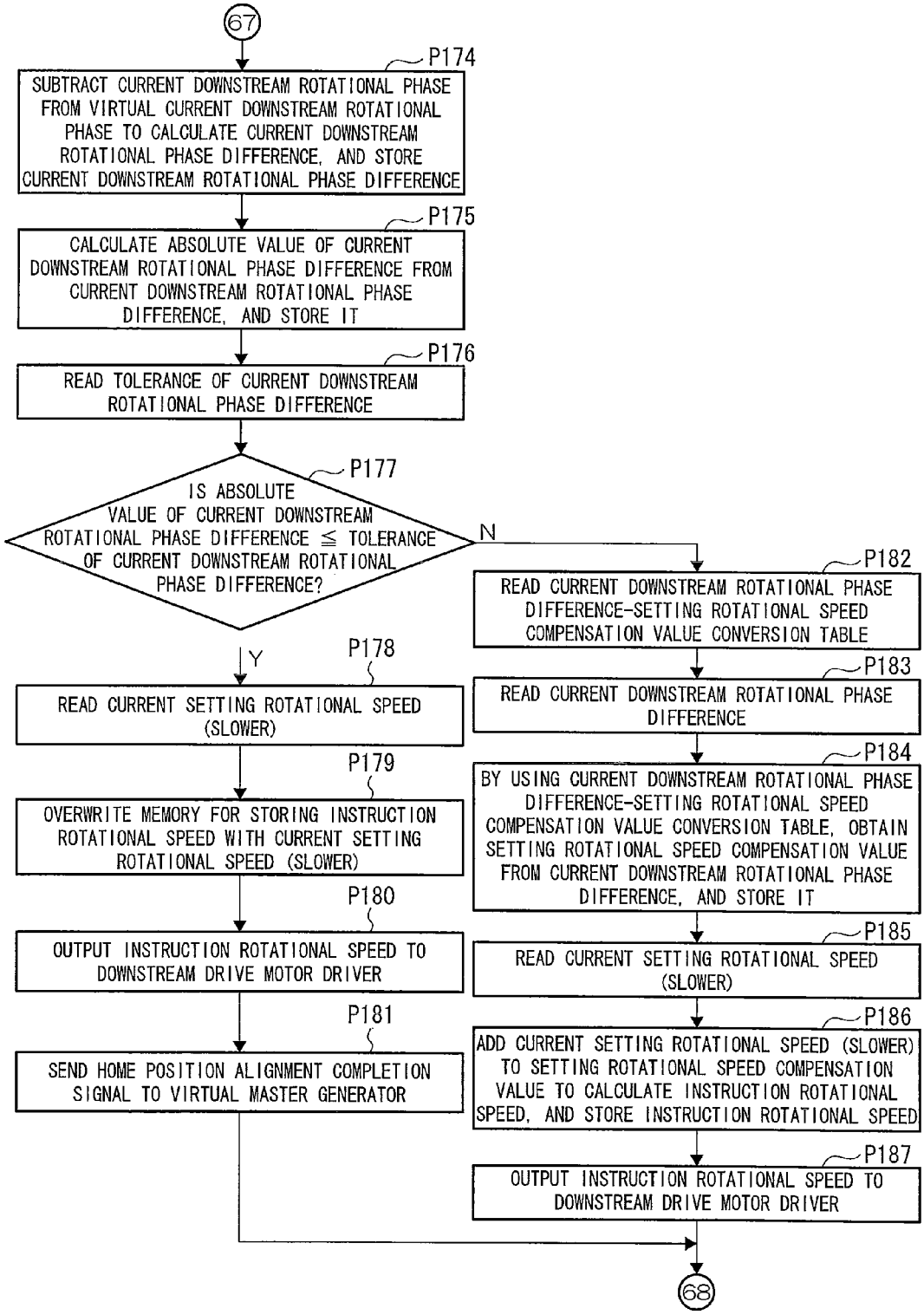
FIG. 30B is an operational flowchart of the downstream printing unit group drive controller.
Figure 31A:
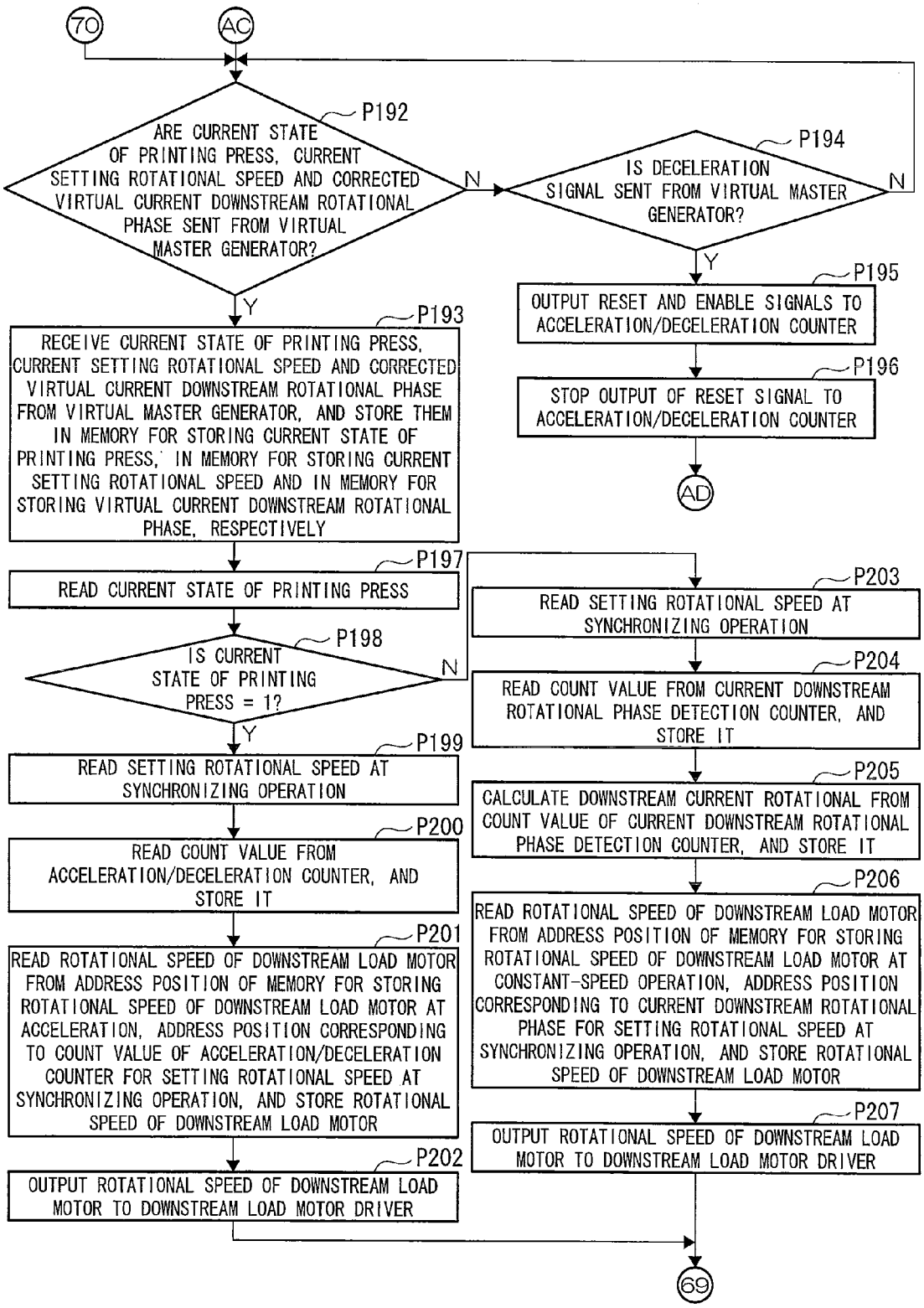
FIG. 31A is an operational flowchart of the downstream printing unit group drive controller.
Figure 31B:
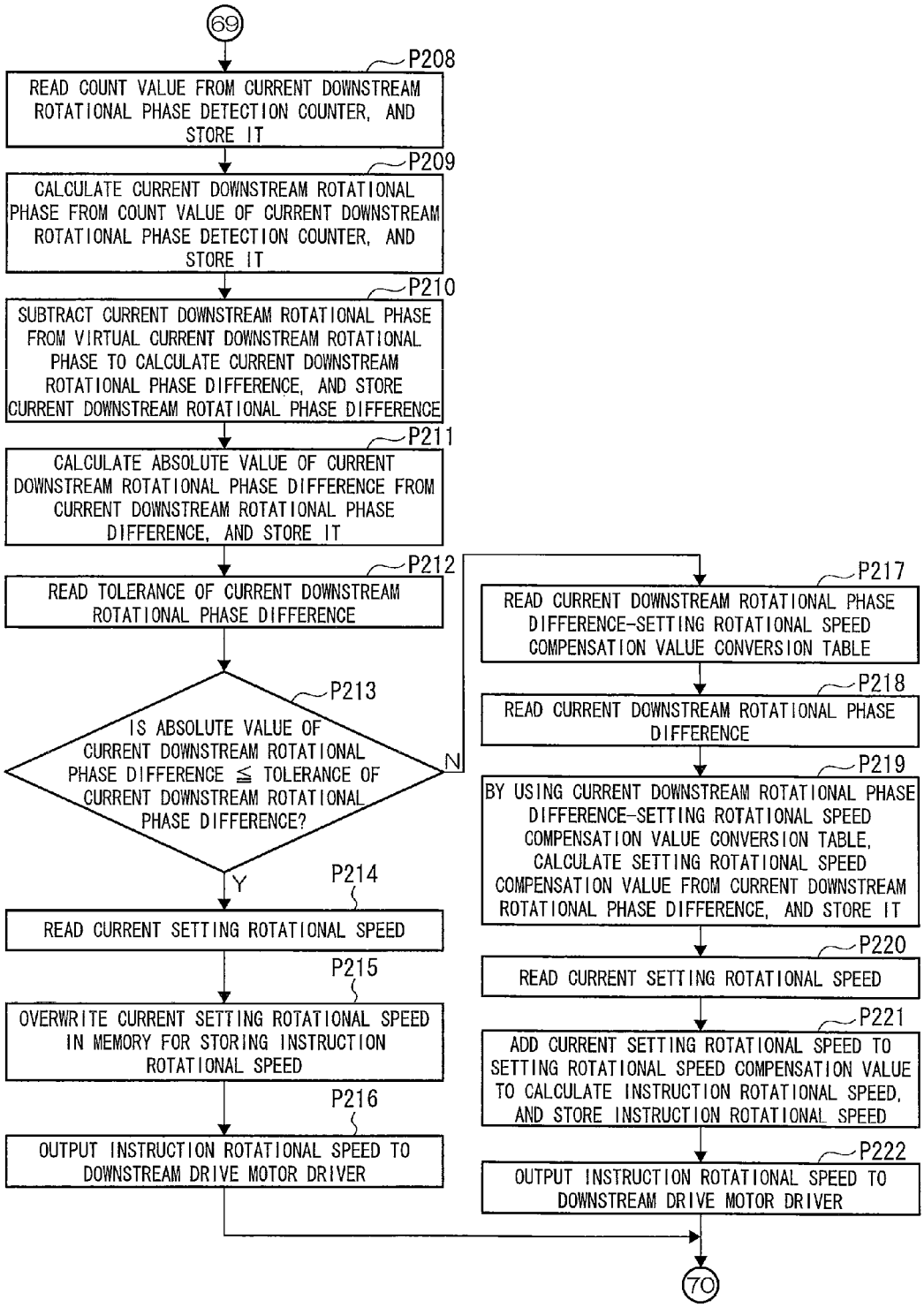
FIG. 31B is an operational flowchart of the downstream printing unit group drive controller.
Figure 32A:
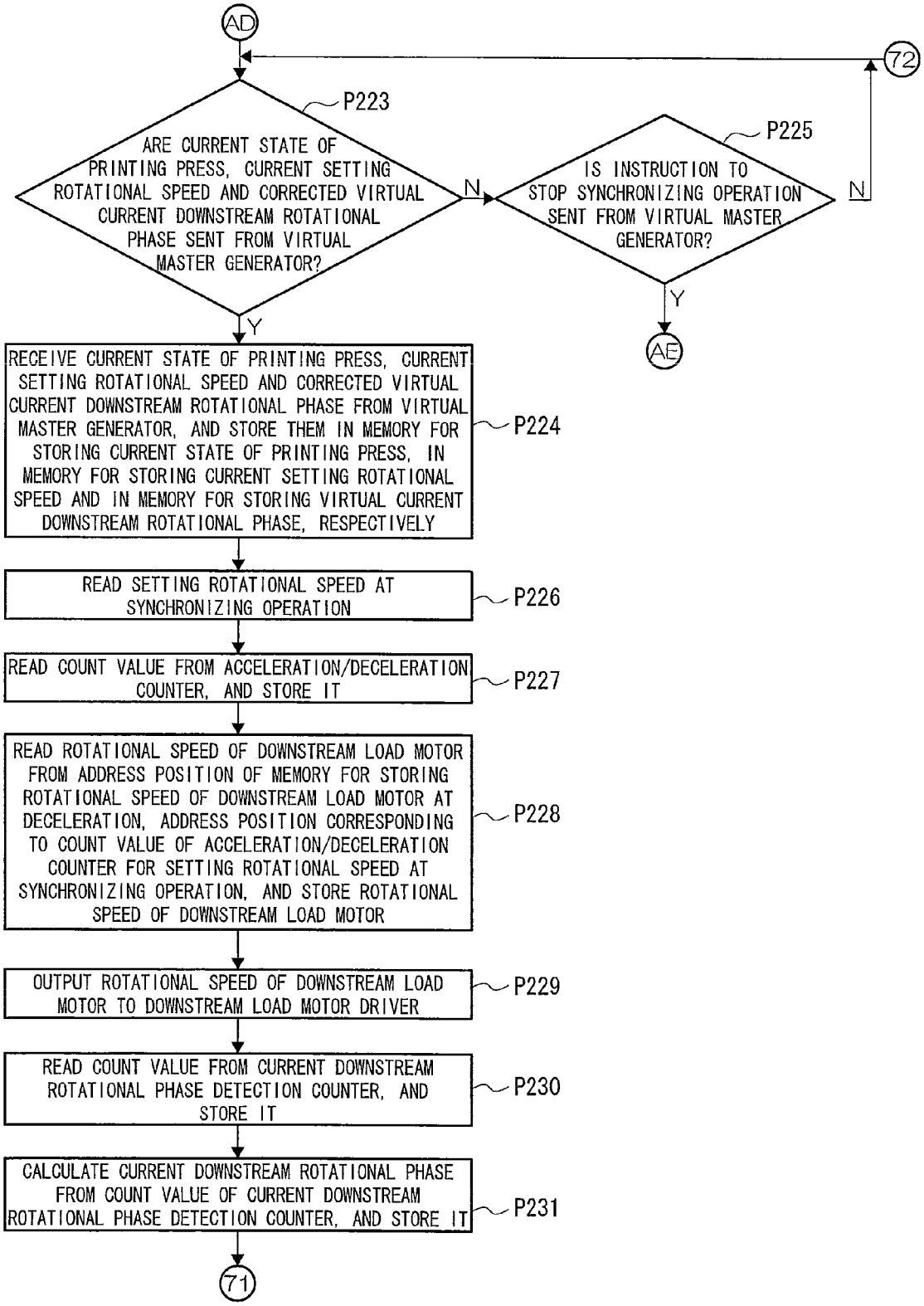
FIG. 32A is an operational flowchart of the downstream printing unit group drive controller.
Figure 32B:
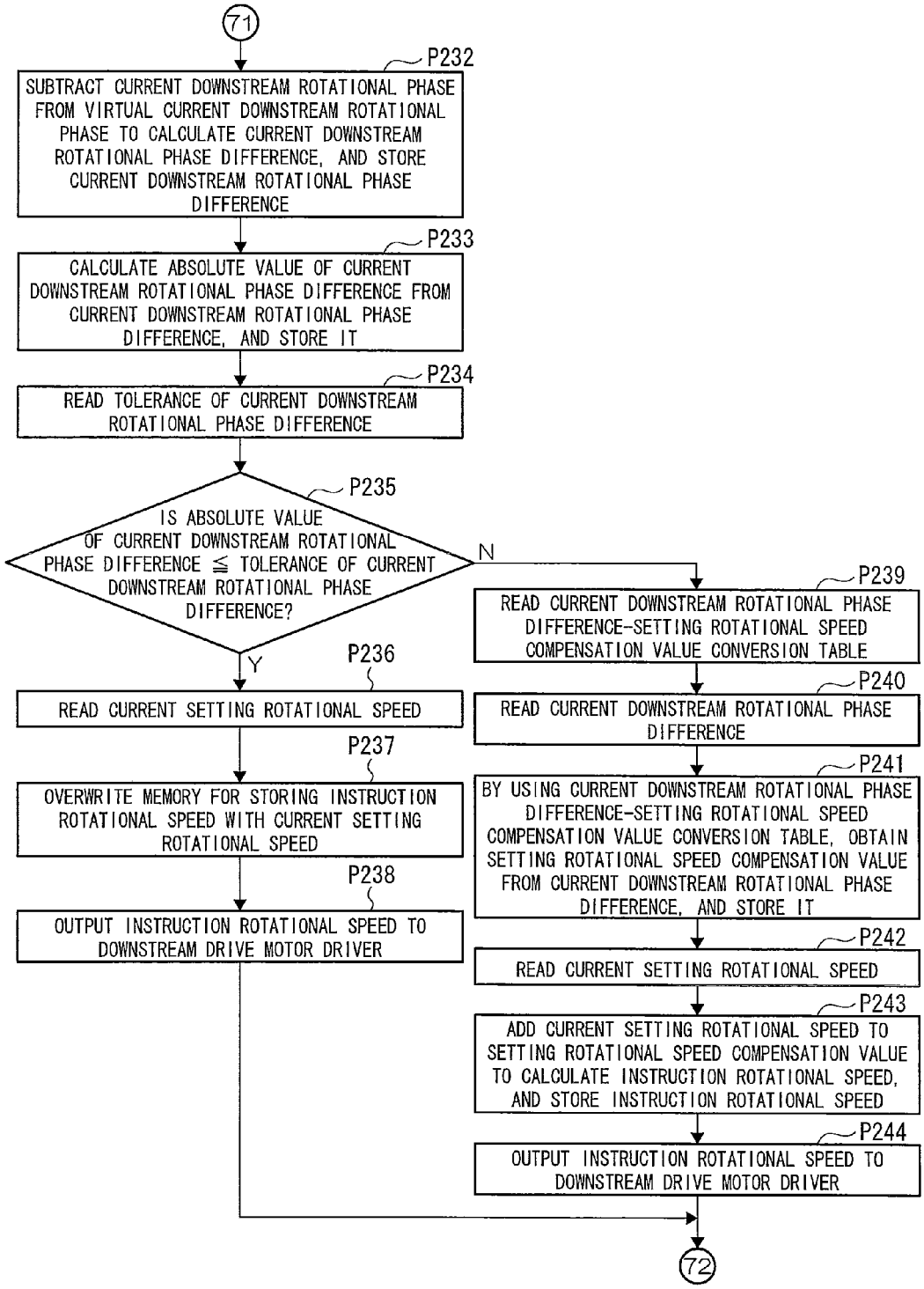
FIG. 32B is an operational flowchart of the downstream printing unit group drive controller.
Figure 33:
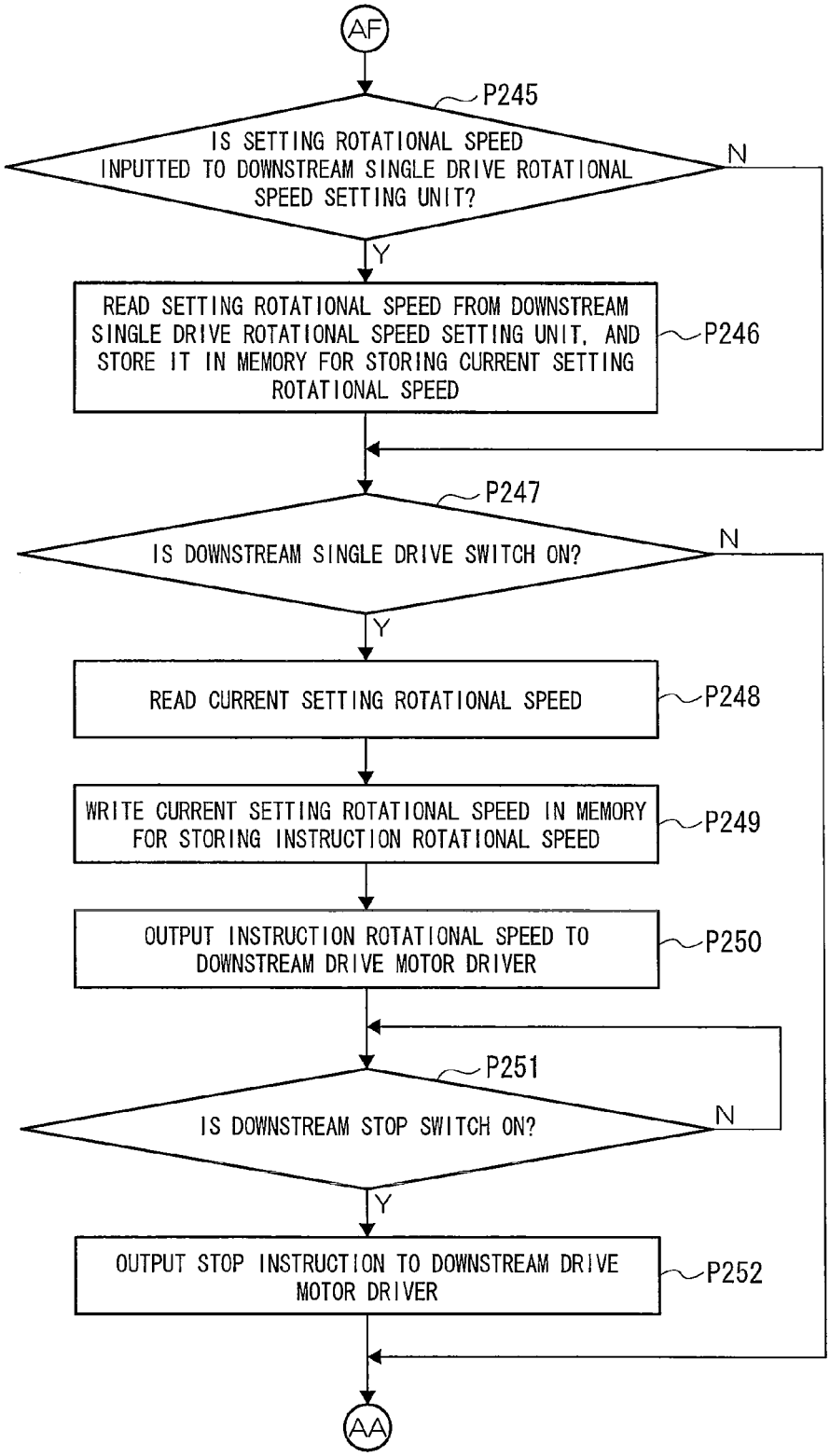
FIG. 33 is an operational flowchart of the downstream printing unit group drive controller.

FIGS. 25A and 25B are operational flowcharts of the downstream printing unit group drive controller. FIGS. 26A to 26C are operational flowcharts of the downstream printing unit group drive controller. FIGS. 27A to 27C are operational flowcharts of the downstream printing unit group drive controller. FIGS. 28A and 28B are operational flowcharts of the downstream printing unit group drive controller. FIGS. 29A to 29C are operational flowcharts of the downstream printing unit group drive controller. FIGS. 30A and 30B are operational flowcharts of the downstream printing unit group drive controller. FIGS. 31A and 31B are operational flowcharts of the downstream printing unit group drive controller. FIGS. 32A and 32B are operational flowcharts of the downstream printing unit group drive controller. FIG. 33 is an operational flowchart of the downstream printing unit group drive controller.

FIG. 62 is a side view showing a schematic structure of a sheet-fed convertible offset printing press. FIG. 63 is a plan view showing a drive separation section of the sheet-fed convertible offset printing press. FIG. 64 is a plan view of a main portion showing a modification of the drive separation section of the sheet-fed convertible offset printing press.

As shown in FIG. 62, the sheet-fed convertible offset printing press (processor) includes an upstream printing unit group 1A for a plurality of colors (four colors in the example of FIG. 62) and a downstream printing unit group 1B for a plurality of colors (two colors in the example of FIG. 62) which are connected with a convertible press mechanism 2 interposed therebetween. A sheet (printed member) is printed on the obverse surface at the upstream printing unit group 1A; converted by the convertible press mechanism 2; and then printed on the reverse surface at the downstream printing unit group 1B.

To be specific, in the upstream and downstream printing unit groups 1A and 1B, between impression cylinders 3*a* and 3*b* and blanket cylinders 4*a* and 4*b*, pictures transferred from plate cylinders 5*a* and 5*b* to the bracket cylinders 4*a* and 4*b* are printed on obverse and reverse surfaces of the sheet, respectively. In the convertible press mechanism 2, the sheet is gripped by a transfer cylinder (a first rotating body) 6 provided with a gripper (a first holder) in a not-shown notch and is then gripped by a suction cylinder (a second rotating body) 7 provided with a gripper (a second holder) in a not-shown notch. The printing surface of the transferred sheet is converted from the obverse to the reverse surface by a convertible cylinder 8 which includes a known gripper for converting (see Patent Literature 1) in a not-shown notch. Reference numerals 6*a* and 6*b* in FIG. 62 denote transfer cylinders of the upstream and downstream printing unit groups 1A and 1B, respectively.

In this embodiment, the upstream and downstream printing unit groups 1A and 1B are separately driven by an upstream drive motor (a first driving means; an electric motor) 10A and a downstream drive motor (a second driving unit; an electric motor) 10B through belt transmissions such as a belt 9*a* and a belt 9*b*, respectively.

As shown in FIG. 63, a gear (a second driven means) 11 of the transfer cylinder 6 in the convertible press mechanism 2 and a gear (a fifth driven means) 12 of the suction cylinder 7 are not engaged with each other. The gear 11 of the transfer cylinder 6 is engaged with a gear (a first driven means) 13 of the impression cylinder 3*a* of the upstream printing unit group 1A to constitute a gear train of the upstream printing unit group 1A, which transmits drive force of the upstream drive motor 1A. The gear 12 of the suction cylinder 7 is engaged with a gear (a fourth driven means) 14 of the convertible cylinder 8, which is engaged with a gear 15 of the impression cylinder 3*b* of the downstream printing unit group 1B to constitute a gear train of the downstream printing unit 1B, transmitting drive force of the downstream drive motor 10B. Reference numeral 16 in FIG. 63 denotes a drive pinion.

To an end of a cylinder shaft fixed to the gear 11 of the transfer cylinder 6, an upstream load motor (a first braking means; a torque motor) 18A is attached with a coupling 17*a* interposed therebetween. To the other end thereof, a rotary encoder 20A for detecting rotational phase of the upstream printing unit group (hereinafter, upstream rotational phase detection rotary encoder 20A) is attached with a coupling 19*a* interposed therebetween.

On the other hand, to an end of a cylinder shaft fixed to the gear 12 of the suction cylinder 7, a downstream load motor (a second braking means; a torque motor) 18B is attached with a coupling 17*b* interposed therebetween. To the other end of the cylinder shaft, a rotary encoder 20B for detecting rotational phase of the downstream printing unit group (hereinafter, downstream rotational phase detection rotary encoder 20B) is attached with a coupling 19*b* interposed therebetween.

Upstream drive motor rotary encoders 49 and 118, downstream drive motor rotary encoders 52 and 129, upstream load motor rotary encoders 73 and 120, and downstream load motor rotary encoders 93 and 141, which are described later, are provided integrally on rear ends of drive shafts of the upstream drive motor 10A, the downstream drive motor 10B, the upstream load motor 18A and the downstream load motor 18B, respectively. Herein, these rotary encoders are not shown in the drawings.

As shown in FIG. 64, instead of being respectively attached to the cylinder shafts fixed to the gears 11 and 12 of the transfer and suction cylinders 6 and 7, the upstream and downstream load motors 18A and 18B may be respectively attached to rotation shafts fixed to intermediate gears (third and sixth driven means) 21 and 22 engaged with the gears 11 and 12 in order to solve the problem of limited attachment space.

Moreover, the drives of the upstream drive motor 10A and the upstream load motor 18A are controlled by a later-described upstream printing unit group drive controller (controlling unit) 70A. The drives of the downstream drive motor 10B and the downstream load motor 18B are controlled by a later-described downstream printing unit group drive controller (controlling unit) 90A.

The upstream printing unit group drive controller 70A controls braking force of the upstream load motor 18A according to fluctuation in load of the transfer cylinder 6 in the convertible press mechanism 2, and recovers and controls electric power generated by the upstream load motor 18A as power for driving the upstream drive motor 10A.

On the other hand, the downstream printing unit group drive controller 90A controls braking force of the downstream load motor 18B according to fluctuation in load of the suction cylinder 7 in the convertible press mechanism 2, and recovers and controls electric power generated by the downstream load motor 18B as power for driving the downstream drive motor 10B.

The speed and phase of the upstream and downstream drive motors 10A and 10B are controlled and synchronized by later described central controller (control means) 30 and virtual master generator (control means) 60.

As shown in FIGS. 1A and 1B, the central controller 30 includes a CPU 31*a*, a ROM 32*a*, a RAM 33*a*, input/output units 34*a* to 34*d*, and an interface 35*a* which are connected to each other via a BUS.

The BUS is also connected to: a memory M1 for storing slow rotational speed; a memory M2 for storing setting rotational speed; a memory M3 for storing a time interval at which the setting rotational speed is sent to the virtual master generator; a memory M4 for storing a count value of a current rotational phase detection counter of the upstream printing unit group (hereinafter, current upstream rotational phase detection counter); a memory M5 for storing current rotational phase of the upstream printing unit group (hereinafter, current upstream rotational phase); a memory M6 for storing rotational phase of the upstream printing unit group at which acceleration is started (hereinafter, acceleration start upstream rotational phase); a memory M7 for storing rotational phase of the upstream printing unit group at which detection of load at constant-speed operation is started (hereinafter, constant-speed operation load detection start upstream rotational phase); a memory M8 for storing rotational phase of the upstream printing unit group at which the detection of load at constant-speed operation is terminated (hereinafter, constant-speed operation load detection finish upstream rotational phase); a memory M9 for storing rotational phase of the upstream printing unit group at which deceleration is started (hereinafter, deceleration start upstream rotational phase); a memory M10 for storing an output of an F/V converter connected to the upstream and downstream drive motor rotary encoders; a memory M11 for storing current rotational speeds of the upstream and downstream printing unit groups, respectively; and an internal clock counter 36.

The input/output unit 34*a* is connected to a teaching switch 37, a synchronizing operation switch 38, a printing press drive switch 39, a printing press drive stop switch 40, input units 41 such as a keyboard and various types of switches and buttons, display unit 42 such as a CRT and a lamp and output unit 43 such as a printer and a floppy disk (registered trademark) drive.

The input/output unit 34*b* is connected to a rotational speed setting unit 44. The input/output unit 34*c* is connected to the upstream rotational phase detection rotary encoder 20A through the current upstream rotational phase detection counter 45.

The input/output unit 34*d* is connected to the upstream drive motor rotary encoder 49 through an A/D converter 47 and the F/V converter 48, and is connected to the downstream drive motor rotary encoder 52 through an A/D converter 50 and an F/V converter 51.

The interface 35*a* is connected to a printing press controller 55A and the virtual master generator 60.

As shown in FIG. 2, the virtual master generator 60 includes a CPU 31*b*, a ROM 32*b*, a RAM 33*b*, and an interface 35*b* which are connected to each other through a BUS.

The BUS is also connected to: a memory M12 for storing virtual current rotational phase; a memory M13 for storing current setting rotational speed; a memory M14 for storing previous setting rotational speed; a memory M15 for storing a current rotational phase compensation value of the upstream printing unit group (hereinafter, upstream rotational phase compensation value); a memory M16 for storing corrected virtual current upstream rotational phase; a memory M17 for storing a current rotational phase correction value of the downstream printing unit group (hereinafter, downstream rotational phase compensation value); a memory M18 for storing corrected virtual current rotational phase of the downstream printing unit group; a memory M19 for storing a time interval at which setting rotational speed is sent from the central controller to the virtual master generator; a memory M20 for storing a virtual current rotational phase correction value; and a memory M21 for storing corrected virtual current rotational phase.

The BUS is also connected to: a memory M22 for storing a printing unit group number of the printing unit group which has finished home position alignment; a memory M23 for storing setting rotational speed at teaching; a memory M24 for storing acceleration start upstream rotational phase; a memory M25 for storing a rotational speed correction value at acceleration; a memory M26 for storing corrected current setting rotational speed; a memory M27 for storing constant-speed operation load detection start upstream rotational phase; a memory M28 for storing constant-speed operation load detection finish upstream rotational phase; a memory M29 for storing deceleration start upstream rotational phase; a memory M30 for storing a rotational speed correction value at deceleration; a memory M31 for storing setting rotational speed at synchronizing operation; and a memory M32 for storing a current state of the printing press.

The interface 35*b* is connected to the central controller 30 and upstream and downstream printing unit group drive controllers 70A and 90A.

As shown in FIGS. 3A and 3B, the upstream printing unit group drive controller 70A includes a CPU 31*c*, a ROM 32*c*, a RAM 33*c*, input/output units 34*e* to 34*m*, and an interface 35*c* which are connected to each other through a BUS.

The BUS is connected to: a memory M33 for storing current setting rotational speed; a memory M34 for storing virtual current upstream rotational phase; a memory M35 for storing a count value of a counter for detecting current upstream rotational phase; a memory M36 for storing current upstream rotational phase; a memory M37 for storing virtual current upstream rotational phase difference; a memory M38 for storing an absolute value of the virtual current upstream rotational phase difference; a memory M39 for storing a tolerance of the virtual current upstream rotational phase difference; a memory M40 for storing an instruction rotational speed; a memory M41 for storing a table for converting the virtual current upstream rotational phase difference to the setting rotational speed compensation value (hereinafter, current upstream rotational phase difference-setting rotational speed compensation value conversion table); a memory M42 for storing a setting rotational speed compensation value; a memory M43 for storing setting rotational speed at teaching; and a memory M44 for storing rotational speed of the upstream load motor.

The BUS also connected to a memory M45 for storing rotational phase at which a notch of the transfer cylinder in the convertible press mechanism starts to move up (hereinafter, transfer-cylinder notch move-up start rotational phase); a memory M46 for storing rotational phase at which the notch of the transfer cylinder of the convertible press mechanism finishes moving up (hereinafter, transfer-cylinder notch move-up finish rotational phase); a memory M47 for storing a load motor rotational speed compensation value related to the move-up of the notch of the transfer cylinder of the convertible press mechanism; a memory M48 for storing a count value of an acceleration/deceleration counter; a memory M49 for storing an electric current value from an upstream drive motor driver; a memory M50 for storing a standard electric current value; a memory M51 for storing an electric current value difference; a memory M52 for storing a table for converting the electric current value difference to the load motor rotational speed compensation value (hereinafter, electric current value difference-load motor rotational speed compensation value conversion table); a memory M53 for storing the load motor rotational speed compensation value; a memory M54 for storing compensated rotational speed of the upstream load motor; a memory M55 for storing rotational speed of the upstream load motor at acceleration; a memory M56 for storing rotational speed of the upstream load motor at constant-speed operation; a memory M57 for storing rotational speed of the upstream load motor at deceleration; a memory M58 for storing setting rotational speed at synchronizing operation; and a memory M59 for storing the current state of the printing press.

The input/output unit 34*e* is connected to the upstream drive motor 10A through the D/A converter 71 and an upstream drive motor driver 72. The upstream drive motor driver 72 is connected to the input/output unit 34*f* and the upstream drive motor rotary encoder 49 coupled with and driven by the upstream drive motor 10A.

The input/output unit 34*g* is connected to the upstream rotational phase detection rotary encoder 20A through a current upstream rotational phase detection counter 74. The input/output unit 34*h* is connected to the upstream rotational phase detection rotary encoder 20A through an acceleration/deceleration counter 76. The input/output unit 34*i* is connected to the upstream rotational phase detection rotary encoder 20A. The input/output unit 34*j* is connected to a load motor standard rotational speed setting unit 77.

The input/output unit 34*k* is connected to the upstream load motor 18A through the D/A converter 78 and an upstream load motor driver 79. The upstream load motor 18A is also connected to the upstream drive motor driver 72. The upstream load motor driver 79 is connected to the upstream load motor rotary encoder 73 which is coupled with and driven by the upstream load motor 18A.

The input/output unit 341 is connected to a single drive rotational speed setting unit 80 of the upstream printing unit group (hereinafter, upstream single drive rotational speed setting unit 80). The input/output unit 34*m* is connected to a single drive switch 81 and a stop switch 82 of the upstream printing unit group (hereinafter, upstream single drive switch 81 and upstream stop switch 82).

The interface 35*c* is connected to the virtual master generator 60.

As shown in FIGS. 4A and 4B, the downstream printing unit group drive controller 90A includes a CPU 31*d*, a ROM 32*d*, a RAM 33*d*, input/output units 34*n* to 34*v* and an interface 35*d* which are connected to each other through a BUS.

The BUS is connected to: a memory M60 for storing current setting rotational speed; a memory M61 for storing virtual current downstream rotational phase; a memory M62 for storing a count value of a counter for detecting a current rotational phase of the downstream printing unit group; a memory M63 for storing the current rotational phase of the downstream printing unit group (hereinafter, current downstream rotational phase); a memory M64 for storing a current rotational phase difference of the downstream printing unit group; a memory M65 for storing an absolute value of the current rotational phase difference of the downstream printing unit group; a memory M66 for storing a tolerance of the current rotational phase difference of the downstream printing unit group; a memory M67 for storing an instruction rotational speed; a memory M68 for storing a table for converting the current rotational phase difference of the downstream printing unit group to a setting rotational speed compensation value (hereinafter, current downstream rotational phase difference-setting rotational speed compensation value conversion table); a memory M69 for storing the setting rotational speed compensation value; a memory M70 for storing setting rotational speed at teaching; and a memory M71 for storing rotational speed of the downstream load motor.

The BUS is also connected to a memory M72 for storing rotational phase at which a notch of the suction cylinder in the convertible press mechanism starts to move up (hereinafter, suction cylinder-notch move-up start rotational phase); a memory M73 for storing rotational phase at which the notch of the suction cylinder of the convertible press mechanism finishes moving up (hereinafter, suction cylinder-notch move-up finish rotational phase); a memory M74 for storing a rotational speed compensation value of the load motor related to the move-up of the notch of the suction cylinder in the convertible press mechanism; a memory M75 for storing a count value of an acceleration/deceleration counter; a memory M76 for storing an electric current value of a downstream drive motor driver; a memory M77 for storing a standard electric current value; a memory M78 for storing an electric current value difference; a memory M79 for storing the electric current value difference-load motor rotational speed compensation value conversion table; a memory M80 for storing the load motor rotational speed compensation value; a memory M81 for storing compensated rotational speed of the downstream load motor; a memory M82 for storing rotational speed of the downstream load motor at acceleration; a memory M83 for storing rotational speed of the downstream load motor at constant-speed operation; a memory M84 for storing rotational speed of the downstream load motor at deceleration; a memory M85 for storing setting rotational speed at synchronizing operation; and a memory M86 for storing the current state of the printing press.

The input/output unit 34*n* is connected to the downstream drive motor 10B through the D/A converter 91 and a downstream drive motor driver 92. The downstream drive motor driver 92 is connected to the input/output unit 340 and a downstream drive motor rotary encoder 52 which is coupled with and driven by the downstream drive motor 10B.

The input/output unit 34*p* is connected to the downstream rotational phase detection rotary encoder 20B through the current rotational phase detection counter 94 of the downstream printing unit group (hereinafter, current downstream rotational phase detection counter 94). The input/output unit 34*q* is connected to the downstream rotational phase detection rotary encoder 20B through the acceleration/deceleration counter 96. The input/output unit 34*r* is connected to the downstream rotational phase detection rotary encoder 20B. The input/output unit 34*s* is connected to a load motor standard rotational speed setting unit 97.

The input/output unit 34*t* is connected to the downstream load motor 18B through a D/A converter 98 and a downstream load motor driver 99. The downstream load motor 18B is also connected to the downstream drive motor driver 92. The downstream load motor driver 99 is connected to the downstream load motor rotary encoder 95 which is coupled with and driven by the downstream load motor 18B.

The input/output unit 34*u* is connected to a single drive rotational speed setting unit 100 of the downstream printing unit group (hereinafter, downstream single drive rotational speed setting unit 100). The input/output unit 34*v* is connected to a single drive switch 101 and a stop switch 102 of the downstream printing unit group (hereinafter, downstream single drive switch 101 and downstream stop switch 102).

The interface 35*d* is connected to the virtual master generator 60.

The central controller 30 is configured as described above and operates according to operational flows shown in FIGS. 5A to 5E, 6A to 6C, 7A to 7C, and 8A and 8B.

Specifically, in step P1, it is judged whether the teaching switch 37 is turned on. If yes, upon the printing press drive switch 39 being turned on in step P2, a teaching instruction is sent to the virtual master generator 60 in step P3.

On the other hand, if no in step P1, it is judged whether the synchronizing operation switch 38 is turned on in step P4. If yes, in step S5, an instruction to start synchronizing operation is sent to the virtual master generator 60, and then the process proceeds to later-described step P91. If no, the process returns to step P1.

Next, in step P6, an instruction to start home position alignment is sent to the virtual master generator 60. Slow rotational speed is read from the memory M1 in step P7 and is written in the memory M2 for storing the setting rotation speed in step P8.

Next, in step P9, the internal clock counter 36 (for counting elapsed time) starts to count. In step P10, time interval at which the setting rotational speed is sent to the virtual master generator 60 (hereinafter, setting rotational speed transmission interval) is read from the memory M3. Subsequently, the count value of the internal clock counter 36 is read in step P11.

Next, in step P12, it is judged whether the counter value of the internal clock counter 36 is equal to or more than the setting rotational speed transmission interval. If yes, the setting rotational speed (slow) is read from the memory M2 in step P13 and is then sent to the virtual master generator 60 in step P14. The process then returns to step P9.

On the other hand, if no in step P12, in step P15, it is judged whether a home position alignment complete signal is sent from the virtual master generator 60. If yes, the setting rotational speed transmission interval is read from the memory M3 in step P16, and if no, the process returns to step P10.

Next, in step P17, the count value of the internal clock counter 36 is read, and in step P18, it is judged whether the count value of the internal clock counter 36 is equal to or more than setting rotational speed transmission interval. If yes, the setting rotational speed (slow) is read from the memory M2 in step P19, and is sent to the virtual master generator 60 in step P20. If no, the process returns to step P16.

Next, in step P21, the internal clock counter 36 (for counting elapsed time) starts to count. In step P22, the setting rotational phase sending interval is then read from the memory M3, and then in step P23, the count value of the internal clock counter 36 is read.

Next in step P24, it is judged whether the count value of the internal clock counter 36 is equal to or more than the setting rotational phase transmission interval. If yes, the setting rotational speed (slow) is read from the memory M2 in step P25, and is then sent to the virtual master generator 60 in step P26. The process then returns to step P21. On the other hand, if no in step P24, in step P27, a count value is read from the current upstream rotational phase detection counter 45, and stored in the memory M4.

Next, in step P28, from the count value of the current upstream rotational phase detection counter 45, the current upstream rotational phase is calculated and stored in the memory M5. In step P29, the acceleration start upstream rotational phase is read from the memory M6. In step P30, it is then judged whether the current upstream rotational phase is equal to the acceleration start upstream rotational phase.

Next, if yes in step P30, an instruction to start printing is sent to the printing press controller 55A in step P31. If no in step P30, the process returns to step P22. In step P32, the setting rotational speed is read from the rotational speed setting unit 44, and stored in the memory M2. In step P33, an instruction to start acceleration and the setting rotational speed are then sent to the virtual master generator 60.

Next, in step P34, the internal clock counter 36 (for counting elapsed time) starts to count. In step P35, the setting rotational speed transmission interval is read from the memory M3, and then in step P36, the count value of the internal clock counter 36 is read.

Next, in step P37, it is judged whether the count value of the internal clock counter 36 is equal to or more than the setting rotational speed transmission interval. If yes, in step P38, the setting rotational speed is read from the rotational speed setting unit 44, and is stored in the memory M2. In step P39, the setting rotational speed is then sent to the virtual master generator 60, and the process returns to step P34.

If no in step P37, in step P40, it is judged whether a constant-speed operation start signal is sent from the virtual master generator 60. If yes, the setting rotational speed transmission interval is read from the memory M3 in step P41, and if no, the process returns to step P35.

Next, the count value of the internal clock counter 36 is read in step P42. In step P43, it is judged whether the count value of the internal clock counter 36 is equal to or more than the setting rotational speed transmission interval. If yes, in step P44, the setting rotational speed is read from the rotational speed setting unit 44, and is stored in the memory M2. In step P45, the setting rotational speed is then sent to the virtual master generator 60. If no in step P43, the process returns to step P41.

Next, in step P46, the internal clock counter 36 (for counting elapsed time) starts to count. Subsequently, in step P47, the setting rotational speed transmission interval is read from the memory M3, and then in step P48, the count value of the internal clock counter 36 is read.

Next, in step P49, it is judged whether the count value of the internal clock counter 36 is equal to or more than the setting rotational speed transmission interval. If yes, in step P50, the setting rotational speed is read from the rotational speed setting unit 44, and is stored in the memory M2. In step P51, the setting rotational speed is then sent to the virtual master generator 60, and the process returns to step P46. On the other hand, if no in step P49, in step P52, the count value of the current upstream rotational phase detection counter 45 is read and stored in the memory M4.

Next, in step P53, from the count value of the current upstream rotational phase detection counter 45, the current upstream rotational phase is calculated and stored in the memory M5. In step P54, the constant-speed operation load detection start upstream rotational phase is read from the memory M7. Subsequently, it is judged whether the current upstream rotational phase is equal to the constant-speed operation load detection start upstream rotational phase in step P55.

If yes in step P55, in step P56, an instruction to start load detection at constant-speed operation is sent to the master generator 60, and the process proceeds to later-described step P57. On the other hand, if no in step P55, the process returns to step P47.

Next, in step P57, the internal clock counter 36 (for counting elapsed time) starts to count. In step P58, the setting rotational speed transmission interval is read from the memory M3, and then in step P59, the count value of the internal clock counter 36 is read.

Next, in step P60, it is judged whether the count value of the internal clock counter 36 is equal to or more than the setting rotational speed transmission interval. If yes in step P60, the setting rotational speed is read from the rotational speed setting unit 44 and is stored in the memory M2 in step P61. In step P62, the setting rotational speed is sent to the virtual master generator 60, and the process returns to step P57. On the other hand, if no in step p60, in step P63, the count value of the current upstream rotational phase detection counter 45 is read and stored in the memory M4.

Next, in step P64, the current upstream rotational phase is calculated from the count value of the current upstream rotational phase detection counter 45, and is stored in the memory M5. Subsequently, in step P65, the constant-speed operation load detection finish upstream rotational phase is read from the memory M8. It is then judged in step P66 whether the current upstream rotational phase is equal to the constant-speed operation load detection finish upstream rotational phase.

If yes in step P66, an instruction to finish load detection at constant-speed operation is sent to the virtual master generator 60 in step P67. On the other hand, if no in step P66, the process returns to step P58.

Next, in step P68, the internal clock counter 36 (for counting elapsed time) starts to count. In step P69, the setting rotational speed transmission interval is read from the memory M3, and in step P70, the count value of the internal clock counter 36 is read.

Next, in step P71, it is judged whether the count value of the internal clock counter 36 is equal to or more than the setting rotational speed transmission interval. If yes in step P71, in step P72, the setting rotational speed is read from the rotational speed setting unit 44, and is stored in the memory M2. In step P73, the setting rotational speed is then sent to the virtual master generator 60, and the process returns to step P68. On the other hand, if no in step P71, in step P74, the count value of the current upstream rotational phase detection counter 45 is read and stored in the memory M4.

Next, in step P75, the current upstream rotational phase is calculated from the count value of the current upstream rotational phase detection counter 45, and is stored in the memory M5. In step P76, the deceleration start upstream rotational phase is read from the memory M9. In step P77, it is then judged whether the current upstream rotational phase is equal to the deceleration start upstream rotational phase.

If yes in step P77, in step P78, an instruction to stop printing is sent to the printing press controller 55A, and if no, the process returns to step P69.

Next, in step P79, an instruction to start deceleration is sent to the virtual master generator 60, and then in step P80, 0 is written in the memory M2 for storing the setting rotational speed. In step P81, the internal clock counter 36 (for counting elapsed time) starts to count.

Next, in step P82, the setting rotational speed transmission interval is read from the memory M3, and in step P83, the count value of the internal clock counter 36 is read. In step P84, it is judged whether the count value of the internal clock counter 36 is equal to or more than the setting rotational speed transmission interval.

Next, if yes in step P84, the setting rotational speed (0) is read from the memory M2 in step P85, and if no, the process returns to step P82. Subsequently, in step P86, the setting rotational speed (0) is sent to the virtual master generator 60. In step P87, outputs of the F/V converters 48 and 51, which are respectively connected to the upstream and downstream drive motor rotary encoders 49 and 52, are read and stored in the memory M10.

Next, in step P88, from the read outputs of the F/V converters 48 and 51, which are respectively connected to the upstream and downstream drive motor rotary encoders 49 and 52, the current rotational speeds of the upstream and downstream printing unit groups are calculated and stored in the memory M11. In step P89, it is then judged whether the current rotational speeds of the upstream and downstream printing unit groups are equal to 0.

If yes in step P89, in step P90, an instruction to finish teaching is sent to the virtual master generator 60, and the process returns to step P1. If no in step P89, the process returns to step P81.

Next, in step P91 to which the process proceeds from step P5, it is judged whether the printing press drive switch 39 is turned on. If yes in step P91, the process proceeds to later-described step P92, and if no, in step P93, it is judged whether the synchronizing operation switch 38 is off. If yes in step P93, in step P94, an instruction to stop synchronizing operation is sent to the virtual master generator 60, and the process returns to step PI. If no in step P93, the process directly returns to step P91.

Next, the instruction to start home position alignment is sent to the virtual master generator 60 in step P92, and then in step P95, the slow rotational speed is read from the memory Ml. In step P96, the slow rotational speed is written in the memory M2 for storing the setting rotational speed. In step P97, the internal clock counter 36 (for counting elapsed time) starts to count. Subsequently, the setting rotational speed transmission interval is read from the memory M3 in step P98, and the count value of the internal clock counter 36 is read in step P99.

Next, in step P100, it is judged whether the count value of the internal clock counter 36 is equal to or more than the setting rotational speed transmission interval. If yes in step P100, the setting rotational speed (slow) is read from the memory M2 in step P101, and is sent to the virtual master generator 60 in step P102. The process then returns to step P97.

On the other hand, if no in step P100, in step P103, it is judged whether the home position alignment complete signal is sent from the virtual master generator 60. If yes in step P103, in step P104, the setting rotational speed transmission interval is read from the memory M3. If no in step P103, in step P104, the process returns to step P98.

Next, in step P105, the count value of the internal clock counter 36 is read. In step P106, it is judged whether the count value of the internal clock counter 36 is equal to or more than the setting rotational speed transmission interval. If yes in step P106, the setting rotational speed (slow) is read from the memory M2 in step P107, and sent to the virtual master generator 60 in step P108. If no in step P106, the process returns to step P104.

Next, in step P109, the internal clock counter 36 (for counting elapsed time) starts to count. In step P110, the setting rotational speed transmission interval is read from the memory M3, and then in step P111, the count value of the internal clock counter 36 is read.

Next, in step P112, it is judged whether the count value of the internal clock counter 36 is equal to or more than the setting rotational speed transmission interval. If yes in step P112, the setting rotational speed (slow) is read from the memory M2 in step P113, and is sent to the virtual master generator 60 in step P114. The process then returns to step P109.

On the other hand, if no in step P112, in step P115, the count value of the current upstream rotational phase detection counter 45 is read and stored in the memory M4. In step P116, from the count value of the current upstream rotational phase detection counter 45, the current upstream rotational phase is calculated and stored in the memory M5.

Next, in step P117, the acceleration start upstream rotational phase is read from the memory M6. In step P118, it is judged whether the current upstream rotational phase is equal to the acceleration start upstream rotational phase. If yes in step P117, the instruction to start printing is sent to the printing press controller 55A in step P119, and if no in step P117, the process returns to step P110.

Next, in step P120, the setting rotational speed is read from the rotational speed setting unit 44 and is stored in the memory M2. In step P121, an instruction to start acceleration and the setting rotational speed are sent to the virtual master generator 60.

Next, in step P122, the internal clock counter 36 (for counting elapsed time) starts to count. In step P123, the setting rotational speed transmission interval is read from the memory M3, and in step P124, the count value of the internal clock counter 36 is read.

Next, in step P125, it is judged whether the count value of the internal clock counter 36 is equal to or more than the setting rotational speed transmission interval. If yes in step P125, in step P126, the setting rotational speed is read from the rotational speed setting unit 44 and is stored in the memory M2. If no in step P125, the process returns to step P123.

Next, in step P127, the setting rotational speed is sent to the virtual master generator 60. In step P128, it is judged whether the printing press drive stop switch 40 is turned on. If yes in step P128, the process proceeds to later-described step P129, and if no, the process returns to step P122.

Next, in step P129, the internal clock counter 36 (for counting elapsed time) starts to count. In step P130, the setting rotational speed transmission interval is read from the memory M3, and in step P131, the count value of the internal clock counter 36 is read.

Next, in step P132, it is judged whether the count value of the internal clock counter 36 is equal to or more than the setting rotational speed transmission interval. If yes in step P132, in step P133, the setting rotational speed is read from the rotational speed setting unit 44 and is stored in the memory M2. The setting rotational speed is then sent to the virtual master generator 60 in step P134. Thereafter, the process returns to step P129.

On the other hand, if no in step P132, in step P135, the count value of the current upstream rotational phase detection counter 45 is read and stored in the memory M4. In step P136, from the read count value of the current upstream rotational phase detection counter 45, the current upstream rotational phase is calculated and stored in the memory M5.

Next, in step P137, the deceleration start upstream rotational phase is read from the memory M9. In step P138, it is judged whether the current upstream rotational phase is equal to the deceleration start upstream rotational phase. If yes in step P138, in step P139, the instruction to stop printing is sent to the printing press controller 55A. If no in step P138, the process returns to step P130.

Next, in step P140, the instruction to start deceleration is sent to the virtual master generator 60. In step P141, 0 is then written in the memory M2 for storing the setting rotational speed. Subsequently, in step P142, the internal clock counter 36 (for counting elapsed time) starts to count, and in step P143, the setting rotational speed transmission interval is read from the memory M3.

Next, in step P144, the count value of the internal clock counter 36 is read. In step P145, it is then judged whether the count value of the internal clock counter 36 is equal to or more than the setting rotational speed transmission interval.

If yes in step P145, the setting rotational speed (0) is read from the memory M2 in step P146, and in step P147, the setting rotational speed (0) is sent to the virtual master generator 60. If no in step P145, the process returns to step P143.

Next, in step P148, the outputs of the F/V converters 48 and 51, which are respectively connected to the upstream and downstream drive motor rotary encoders 49 and 52, are read and stored in the memory M10. In step P149, from the outputs of the F/V converters 48 and 51, which are respectively connected to the upstream and downstream drive motor rotary encoders 49 and 52, the current rotational speeds of the upstream and downstream printing unit groups are calculated and stored in the memory M11.

Next, in step P150, it is judged whether the current rotational speeds of the upstream and downstream printing unit groups are equal to 0. If yes in step P150, in step P151, the instruction to stop drive of synchronizing operation is sent to the virtual master generator 60, and then the process returns to step P91. If no in step P150, the process returns to step P142. Hereinafter, the above described operations are repeated.

According to the aforementioned operational flows, the printing press drive instruction is sent to the printing press controller 55A, and the teaching instruction and the synchronizing operation instruction are sent to the virtual master generator 60.

The virtual master generator 60 operates according to the operational flows shown in FIGS. 9A to 9C, 10A to 10C, 11A to 11C, 12A and 12B, 13A to 13C, 14A to 14D, and 15A and 15B.

Specifically, in step P1, it is judged whether the teaching instruction is sent from the central controller 30. If yes in step P1, in step P2, teaching instructions are sent to the upstream and downstream printing unit group drive controllers 70A and 90A. If no in step P1, in step P3, it is judged whether the instruction to start synchronizing operation is sent from the central controller 30.

If yes in step P3, the process proceeds to later-described P150, and if no, the process returns to step P1.

Next, when the instruction to start home position alignment is sent from the central controller 30 in step P4, in step P5, instructions to start home position alignment are sent to the upstream and downstream printing unit group drive controllers 70A and 90A.

Next, in step P6, rotational phase (0) is written in the memory M12 for storing the virtual current rotational phase. When the setting rotational speed (slow) is sent from the central controller 30 in step P7, in step P8, the setting rotational speed (slow) is received from the central controller 30, and is stored in the memory M13 for storing current setting rotational speed and the memory M14 for storing previous setting rotational speed.

Next, in step P9, the virtual current rotational phase is read from the memory M12, and in step P10, the upstream rotational phase compensation value is read from the memory M15. Subsequently, in step P11, the virtual current rotational phase is added to the upstream rotational phase compensation value to calculate a corrected virtual current upstream rotational phase, and the corrected virtual current upstream rotational phase is then stored in the memory M16.

Next, in step P12, the downstream rotational phase compensation value is read from the memory M17. In step P13, the virtual current rotational phase is added to the downstream rotational phase compensation value to calculate a corrected virtual current downstream rotational phase, and the corrected virtual current downstream rotational phase is then stored in the memory M18.

Next, in step P14, the current setting rotational speed (slow) and the corrected virtual current upstream rotational phase are sent to the upstream printing unit group drive controller 70A. In step P15, the current setting rotational speed (slow) and the corrected virtual current downstream rotational phase are sent to the downstream printing unit group drive controller 90A.

Next, in step P16, it is judged whether the setting rotational speed (slow) is sent from the central controller 30. If yes in step P16, in step P17, the setting rotational speed (slow) is received from the central controller 30 and is stored in the memory M13. Instep P18, the previous setting rotational speed is read from the memory M14.

Next, in step P19, the setting rotational speed transmission interval sent from the central controller 30 to the virtual master generator 60 is read from the memory M19. In step P20, from the previous setting rotational speed and the setting rotational speed transmission interval, the virtual current rotational phase correction value is calculated and stored in the memory M20. Specifically, the previous setting rotational speed is multiplied by the setting rotational speed transmission interval to calculate a virtual rotational phase by which the upstream and downstream printing unit groups has advanced between previous transmission at the setting rotational speed and current transmission. The calculated virtual rotational phase is stored as the virtual current rotational phase correction value.

Next, in step P21, the virtual current rotational phase is read from the memory M12. In step P22, the virtual current rotational phase correction value is added to the virtual current rotational phase to calculate a corrected virtual current rotational phase, which is then stored in the memory M21.

Next, in step P23, the upstream rotational phase compensation value is read from the memory M15. In step P24, the upstream rotational phase compensation value is added to the corrected virtual current rotational phase to calculate a corrected virtual current upstream rotational phase, which is stored in the memory M16. In step P25, the downstream rotational phase compensation value is read from the memory M17.

Next, in step P26, the downstream rotational phase compensation value is added to the corrected virtual current rotational phase to calculate a corrected virtual current downstream rotational phase, which is then stored in the memory M18. In step P27, the current setting rotational speed (slow) and the corrected virtual current upstream rotational phase are sent to the upstream printing unit group drive controller 70A.

Next, in step P28, the current setting rotational speed (slow) and the corrected virtual current downstream rotational phase are sent to the downstream printing unit group drive controller 90A. In step P29, the current setting rotational speed (slow) is then stored in the memory M14 for storing the previous setting rotational speed.

Next, in step P30, the corrected virtual current rotational phase is read from the memory M21, and in step P31, the memory M12 for storing the virtual current rotational phase is overwritten with the corrected virtual current rotational phase, and the process returns to step p16.

On the other hand, if no in step P16, in step P32, it is judged whether the home position alignment complete signal is sent from the upstream or downstream printing unit group. If yes in step P32, in step P33, the printing unit group number of the printing unit group which had already sent the home position alignment complete signal is received, and is stored in the memory M22 for storing the printing unit group number of the printing unit group which has finished home position alignment. If no in step P32, the process returns to step P16.

Next, in step P34, the content of the memory M22 for storing the printing unit group number of the printing unit group which has finished home position alignment is read. In step P35, it is judged whether the home position alignment of the upstream and downstream printing unit group drive controllers 70A and 90A is completed.

If yes in step P35, in step P36, the home position alignment complete signal is sent to the central controller 30, and the process proceeds to step P37. If no in step P35, the process returns to step P16.

Next, in step P37, it is judged whether the setting rotational speed (slow) is sent from the central controller 30. If yes in step P37, in step P38, the setting rotational speed (slow) is received from the central controller 30 and is stored in the memory M13 for storing the current setting rotational speed. In step P39, the previous setting rotational speed is read from the memory M14.

Next, in step P40, the setting rotational speed transmission interval is read from the memory M19. Instep P41, from the previous setting rotational speed and the setting rotational speed transmission interval, the virtual current rotational phase correction value is calculated and stored in the memory M20.

Next, in step P42, the virtual current rotational phase is read from the memory M12. In step P43, the virtual current rotational phase is added to the virtual current rotational phase correction value to calculate a corrected virtual current rotational phase, which is then stored in the memory M21. Subsequently, in step P44, the upstream rotational phase compensation value is read from the memory M15.

Next, in step P45, the corrected virtual current rotational phase is added to the upstream rotational phase compensation value to calculate the corrected virtual current upstream rotational phase, which is then stored in the memory M16. Instep P46, the downstream rotational phase compensation value is read from the memory M17.

In step P47, the rotational phase compensation value of the downstream printing unit group is added to the corrected virtual current rotational phase to calculate the corrected virtual current downstream rotational phase, which is then stored in the memory M18. In step P48, the current setting rotational speed (slow) and the corrected virtual current upstream rotational phase are sent to the upstream printing unit group drive controller 70A.

In step P49, the current setting rotational speed (slow) and the corrected virtual current downstream rotational phase are sent to the downstream printing unit group drive controller 90A. In step P50, the current setting rotational speed (slow) is then stored in the memory M14 for storing the previous setting rotational speed.

Next, in step P51, the corrected virtual current rotational phase is read from the memory M21. In step P52, the memory M12 for storing the virtual current rotational phase is overwritten with the corrected virtual current rotational phase, and the process returns to step p37.

On the other hand, if no in step P37, in step P53, it is judged whether the instruction to start acceleration and the setting rotational speed are sent from the central controller 30. If yes in step P53, in step P54, the setting rotational speed is received from the central controller 30 and is stored in the memory M23 for storing the setting rotational speed at teaching. If no in step P53, the process returns to step P37.

Next, the acceleration start rotational phase is read from the memory M24 in step P55. In step P56, the memory M12 for storing the virtual current rotational phase is overwritten with the acceleration start rotational phase. Subsequently, in step P57, the setting rotational speed at teaching is read from the memory M23. Herein, the acceleration start rotational phase is obtained by subtracting the upstream rotational phase compensation value stored in the memory M15 of the virtual master generator 60 from the acceleration start upstream rotational phase stored in the memory M6 of the central controller 30.

Next, in step P58, acceleration signals and the setting rotational speed at teaching are sent to the upstream and downstream printing unit group drive controllers 70A and 90A. In step P59, it is judged whether the setting rotational speed is sent from the central controller 30. If yes in step P59, the setting rotational speed is received from the central controller 30 in step P60 and is stored in the memory M13 for storing the current setting rotational speed.

On the other hand, if no in step P59, in step P61, it is judged whether the instruction to start load detection at constant-speed operation is sent from the central controller 30. If yes in step P61, the process proceeds to later-described step P83, and if no, the process returns to step P59.

Next, in step P62, the previous setting rotational speed is read from the memory M14, and in step P63, the rotational speed correction value at acceleration is read from the memory M25. In step P64, the previous setting rotational speed is added to the rotational speed correction value at acceleration to calculate a corrected current setting rotational speed, which is then stored in the memory M26. Instep P65, the current setting rotational speed is read from the memory M13.

Next, in step P66, it is judged whether the corrected current setting rotational speed is less than the current setting rotational speed. If yes in step P66, in step P67, the corrected current setting rotational speed is stored in the memory M13 for storing the current setting rotational speed, and in step P68, the previous setting rotational speed is read from the memory M14. If no in step P66, in step P69, the constant-speed operation start signal is sent to the central controller 30, and the process proceeds to step P68.

Next, in step P70, the setting rotational speed transmission interval is read from the memory M19. In step P71, from the previous setting rotational speed and the setting rotational speed transmission interval, the virtual current rotational phase correction value is calculated and stored in the memory M20.

Next, in step P72, the virtual current rotational phase is read from the memory M12, and then in step P73, the virtual current rotational phase is added to the virtual current rotational phase correction value to calculate the corrected virtual current rotational phase, which is then stored in the memory M21. In step P74, the upstream rotational phase compensation value is read from the memory M15.

Next, in step P75, the upstream rotational phase compensation value is added to the corrected virtual current rotational phase to calculate the corrected virtual current upstream rotational phase, which is then stored in the memory M16. In step P76, the downstream rotational phase compensation value is read from the memory M17.

In step P77, the corrected virtual current rotational phase is added to the downstream rotational phase compensation value to calculate the corrected virtual current downstream rotational phase, which is then stored in the memory M18. In step P78, the current setting rotational speed and the corrected virtual current upstream rotational phase are sent to the upstream printing unit group drive controller 70A.

Next, in step P79, the current setting rotational speed and the corrected virtual current downstream rotational phase are sent to the downstream printing unit group drive controller 90A. In step P80, the current setting rotational speed is stored in the memory M14 for storing the previous setting rotational speed.

Next, the corrected virtual current rotational phase is read from the memory M21 in step P81. In step P82, the memory M12 for storing the virtual current rotational phase is overwritten with the corrected virtual current rotational phase. The process then returns to step P59.

Next, a constant-speed operation load detection start rotational phase is read from the memory M27 in the above-described step P83. In step P84, the memory M12 for storing the virtual current rotational phase is overwritten with the constant-speed operation load detection start rotational phase. The constant-speed operation load detection start rotational phase is obtained by subtracting the upstream rotational phase compensation value stored in the memory M15 of the virtual master generator 60 from the constant-speed operation load detection start upstream rotational phase stored in the memory M7 of the central controller 30.

Next, in step P85, constant-speed operation load detection start signals for the printing unit groups are sent to the upstream and downstream printing unit group drive controllers 70A and 90A. In step P86, it is judged whether the setting rotational speed is sent from the central controller 30. If yes in step P86, in step sp87, the setting rotational speed is received from the central controller 30 and is stored in the memory M13 for storing the current setting rotational speed.

Next, in step P88, the previous setting rotational speed is read from the memory M14, and in step P89, the setting rotational speed transmission interval is read from the memory M19. Subsequently, in step P90, from the previous setting rotational speed and the setting rotational speed transmission interval, the virtual current rotational phase correction value is calculated and stored in the memory M20.

Next, in step P91, the virtual current rotational phase is read from the memory M12. In step P92, the virtual current rotational phase is added to the virtual current rotational phase correction value to calculate the corrected virtual current rotational phase, which is then stored in the memory M21. Subsequently, in step P93, the upstream rotational phase compensation value is read from the memory M15.

Next, in step P94, the corrected virtual current rotational phase is added to the upstream rotational phase compensation value to calculate the corrected virtual current upstream rotational phase, which is stored in the memory M16. Instep P95, the downstream rotational phase compensation value is read form the memory M17.

Next, in step P96, the corrected virtual current rotational phase is added to the downstream rotational phase compensation value to calculate the corrected virtual current downstream rotational phase, which is stored in the memory M18. In step P97, the current setting rotational speed and the corrected virtual current upstream rotational phase are sent to the upstream printing unit group drive controller 70A.

Next, in step P98, the current setting rotational speed and the corrected virtual current downstream rotational phase are sent to the downstream printing unit group drive controller 90A. In step P99, the current setting rotational speed is stored in the memory M14 for storing the previous setting rotational speed.

Next, in step P100, the corrected virtual current rotational phase is read from the memory M21. In step P101, the memory M12 for storing the virtual current rotational phase is overwritten with the corrected virtual current rotational phase, and the process returns to step P86.

On the other hand, if no in step P86, in step P102, it is judged whether the instruction to finish load detection is sent from the central controller 30. If yes in step P102, in step P103, the constant-speed operation load detection finish rotational phase is read from the memory M28. If no in step P86, the process returns to step P86.

Next, in step P104, the memory M12 for storing the virtual current rotational phase is overwritten with the constant-speed operation load detection finish rotational phase. Instep P105, constant-speed operation load detection finish signals for the printing unit groups are sent to the upstream and downstream printing unit group drive controllers 70A and 90A. Herein, the constant-speed operation load detection finish rotational phase is obtained by subtracting the upstream rotational phase compensation value stored in the memory M15 of the virtual master generator 60 from the constant-speed operation load detection finish upstream rotational phase stored in the memory M8 of the central controller 30.

Next, in step P106, it is judged whether the setting rotational speed is sent from the central controller 30. If yes in step P106, in step P107, the setting rotational speed is received from the central controller 30 and is stored in the memory M13 for storing the current setting rotational speed. If no in step P106, in step P108, it is judged whether the instruction to start deceleration is sent from the central controller 30. Herein, if yes in step P108, the process proceeds to later-described step P123, and in if no, the process returns to step P106.

Next, in step P109, the previous setting rotational speed is read from the memory M14, and then in step P110, the setting rotational speed transmission interval is read from the memory M19. In step P111, from the previous setting rotational speed and the setting rotational speed transmission interval, the virtual current rotational phase correction value is calculated and stored in the memory M20.

Next, in step P112, the virtual current rotational phase is read from the memory M12. In step P113, the virtual current rotational phase is added to the virtual current rotational phase correction value to calculate the corrected virtual current rotational phase, which is then stored in the memory M21. In step P114, the upstream rotational phase compensation value is read from the memory M15.

Next, in step P115, the corrected virtual current rotational phase is added to the upstream rotational phase compensation value to calculate the corrected virtual current upstream rotational phase, which is then stored in the memory M16. In step P116, the downstream rotational phase compensation value is read from the memory M17.

Next, in step P117, the corrected virtual current rotational phase is added to the downstream rotational phase compensation value to calculate the corrected virtual current downstream rotational phase, which is then stored in the memory M18. In step P118, the current setting rotational speed and the corrected virtual current upstream rotational phase are sent to the upstream printing unit group drive controller 70A.

In step P119, the current setting rotational speed and the corrected virtual current downstream rotational phase are sent to the downstream printing unit group drive controller 90A. In step P120, the current setting rotational speed is stored in the memory M14 for storing the previous setting rotational speed.

Next, the corrected virtual current rotational phase is read from the memory M21 in step P121. The memory M12 for storing the virtual current rotational phase is overwritten with the corrected virtual current rotational phase in step P122. The process then returns to step P106.

Next, the deceleration start upstream rotational phase is read from the memory M29 in step P123. The memory M12 for storing the virtual current rotational phase is overwritten with the deceleration start rotational phase in step P124. In step P125, deceleration signals are then sent to the upstream and downstream printing unit group drive controllers 70A and 90A. The deceleration start rotational phase is obtained by subtracting the upstream rotational phase compensation value stored in the memory M15 of the virtual master generator 60 from the deceleration start upstream rotational phase stored in the memory M9 of the central controller 30.

Next, in step P126, it is judged whether the setting rotational speed (0) is sent from the central controller 30. If yes in step P126, in step P127, the setting rotational speed (0) is received from the central controller 30 and is stored in the memory M13 for storing the current setting rotational speed. If no in step P126, in step P128, it is judged whether the instruction to finish teaching is sent from the central controller 30. If yes in step P128, in step P129, teaching finish signal are sent to the upstream and downstream printing unit group drive controllers 70A and 90A, and the process returns to step P1. If no in step P128, the process returns to step P126.

Next, in step P130, the previous setting rotational speed is read from the memory M14, and in step P131, the rotational speed correction value at deceleration is read from the memory M30. In step P132, the rotational speed correction value at deceleration is subtracted from the previous setting rotational speed to calculate the corrected current setting rotational speed, which is then stored in the memory M26.

Next, in step P133, it is judged whether the corrected current setting rotational speed is less than 0. If yes in step P133, in step P134, the corrected current setting rotational speed is updated with 0, and the process proceeds to step P135. If no in step P133, the process directly proceeds to step P135. In step P135, the corrected current setting rotational speed is stored in the memory M13 for storing the current setting rotational speed, and in step P136, the previous setting rotational speed is read from the memory M14.

Next, in step P137, the setting rotational speed transmission interval is read from the memory M19. In step P138, from the previous setting rotational speed and the setting rotational speed transmission interval, the virtual current rotational phase correction value is calculated and stored in the memory M20.

Next, in step P139, the virtual current rotational phase is read from the memory M12. In step P140, the virtual current rotational phase is added to the virtual current rotational phase correction value to calculate the corrected virtual current rotational phase, which is then stored in the memory M21. In step P141, the upstream rotational phase compensation value is read from the memory M15.

In step P142, the corrected virtual current rotational phase is added to the upstream rotational phase compensation value to calculate the corrected virtual current upstream rotational phase, which is then stored in the memory M16. In step P143, the downstream rotational phase compensation value is read from the memory M17.

In step P144, the corrected virtual current rotational phase is added to the downstream rotational phase compensation value to calculate the corrected virtual current downstream rotational phase, which is then stored in the memory M18. In step P145, the current setting rotational speed and the corrected virtual current upstream rotational phase are sent to the upstream printing unit group drive controller 70A.

In step P146, the current setting rotational speed and the corrected virtual current downstream rotational phase are sent to the downstream printing unit group drive controller 90A. In step P147, the current setting rotational speed is stored in the memory M14 for storing the previous setting rotational speed.

Next, the corrected virtual current rotational phase is read from the memory M21 in step P148, and the memory M12 for storing the virtual current rotational phase is overwritten with the corrected virtual current rotational phase in step P149. Then, the process returns to step P126.

Next, in step P150 to which the process proceeds from step P3, instructions to start synchronizing operation are sent to the upstream and downstream printing unit group drive controllers 70A and 90A. When the instruction to start home position alignment is sent from the central controller 30 in step P151, in step P152, instructions to start home position alignment are sent to the upstream and downstream printing unit group drive controllers 70A and 90A.

Next, in step P153, the rotational phase (0) is written in the memory M12 for storing the virtual current rotational phase. When the setting rotational speed (slow) is sent from the central controller 30 in step P154, in step P155, the setting rotational speed (slow) is received from the central controller 30 and is stored in the memory M13 for storing the current setting rotational speed and the memory M14 for storing the previous setting rotational speed.

Next, in step P156, the virtual current rotational phase is read from the memory M12, and in step P157, the upstream rotational phase compensation value is read from the memory M15. In step P158, the virtual current rotational phase is added to the upstream rotational phase compensation value to calculate the corrected virtual current upstream rotational phase, which is then stored in the memory M16.

Next, in step P159, the downstream rotational phase compensation value is read from the memory M17. In step P160, the virtual rotational phase is added to the downstream rotational phase compensation value to calculate the corrected virtual current downstream rotational phase, which is then stored in the memory M18.

Next, in step P161, the current setting rotational speed (slow) and the corrected virtual current upstream rotational phase are sent to the upstream printing unit group drive controller 70A. In step P162, the current setting rotational speed (slow) and the corrected virtual current downstream rotational phase are sent to the downstream printing unit group drive controller 90A.

Next, in step P163, it is judged whether the setting rotational speed (slow) is sent from the central controller 30. If yes in step P163, in step P164, the setting rotational speed (slow) is received from the central controller 30 and is stored in the memory M13 for storing the current setting rotational speed. In step P165, the previous setting rotational speed is read from the memory M14.

Next, in step P166, the setting rotational speed transmission interval is read from the memory M19. From the previous setting rotational speed and the setting rotational speed transmission interval, in step P167, the virtual current rotational phase correction value is calculated and stored in the memory M20.

Next, in step P168, the virtual current rotational phase is read from the memory M12. In step P169, the virtual current rotational phase is then added to the virtual current rotational phase correction value to calculate the corrected virtual current rotational phase, which is then stored in the memory M21.

Next, in step P170, the upstream rotational phase compensation value is read from the memory M15. In step P171, the corrected virtual current rotational phase is added to the upstream rotational phase compensation value to calculate the corrected virtual current upstream rotational phase, which is then stored in the memory M16. In step P172, the downstream rotational phase compensation value is read from the memory M17.

In step P173, the corrected virtual current rotational phase is then added to the downstream rotational phase compensation value to calculate the corrected virtual current downstream rotational phase, which is then stored in the memory M18. In step P174, the current setting rotational speed (slow) and the corrected virtual current upstream rotational phase are sent to the upstream printing unit group drive controller 70A.

Next, in step P175, the current setting rotational speed (slow) and the corrected virtual current downstream rotational phase are sent to the downstream printing unit group drive controller 90A. In step P176, the current setting rotational speed (slow) is stored in the memory M14 for storing the previous setting rotational speed.

Next, in step P177, the corrected virtual current rotational phase is read from the memory M21. In step P178, the corrected virtual current rotational phase is written in the memory M12 for storing the virtual current rotational phase, and the process returns to step P163.

On the other hand, if no in step P163, in step P179, it is judged whether a home position alignment complete signal is sent from the upstream or downstream printing unit group. If yes in step P179, in step P180, the printing unit group number of the printing unit group which has sent the home position alignment complete signal is received, and is stored in the memory M22 for storing the printing unit group number of the printing unit group which has finished home position alignment. If no in step P179, the process returns to step P163.

Next, in step P181, the content of the memory M22 for storing the printing unit group number of the printing unit group which has finished home position alignment is read, and then in step P182, it is judged whether the upstream and downstream printing unit group drive controllers 70A and 90A have already finished the home position alignment.

If yes in step P182, in P183, the home position alignment complete signal is sent to the central controller 30, and the process proceeds to step P184. If no in step P182, the process returns to step P163.

Next, in step P184, it is judged whether the setting rotational speed (slow) is sent from the central controller 30. If yes in step P184, in step P185, the setting rotational speed (slow) is received from the central controller 30 and is stored in the memory M13 for storing the current setting rotational speed. In step P186, the previous setting rotational speed is read from the memory M14.

Next, in step P187, the setting rotational speed transmission interval is read from the memory M19. In step P188, from the previous setting rotational speed and the setting rotational speed transmission interval, the virtual current rotational phase correction value is calculated and stored in the memory M20.

Next, in step P189, the virtual current rotational phase is read from the memory M12. In step P190, the virtual current rotational phase is added to the virtual current rotational phase correction value to calculate the corrected virtual current rotational phase, which is then stored in the memory M21. In step P191, the upstream rotational phase compensation value is read from the memory M15.

Next, in step P192, the corrected virtual current rotational phase is added to the upstream rotational phase compensation value to calculate the corrected virtual current upstream rotational phase, which is then stored in the memory M1. In step P193, the downstream rotational phase compensation value is read from the memory M17.

Next, in step P194, the corrected virtual current rotational phase is added to the downstream rotational phase compensation value to calculate the corrected virtual current downstream rotational phase, which is then stored in the memory M18. In step P195, the current setting rotational speed (slow) and the corrected virtual current upstream rotational phase are sent to the upstream printing unit group drive controller 70A.

Next, in step P196, the current setting rotational speed (slow) and the corrected virtual current downstream rotational phase are sent to the downstream printing unit group drive controller 90A. In step P197, the current setting rotational speed (slow) is stored in the memory M14 for storing the previous setting rotational speed.

Next, the corrected virtual current rotational phase is read from the memory M21 in step P198. The memory M12 for storing the virtual current rotational phase is overwritten with the corrected virtual current rotational phase in step P199. The process then returns to step P184.

If no in step P184, in step P200, it is judged whether the instruction to start acceleration and the setting rotational speed are sent from the central controller 30. If yes in step P200, in step P201, the setting rotational speed is received from the central controller 30 and is stored in the memory M31 for storing the setting rotational speed at synchronizing operation. If no in step P200, the process returns to step P184.

Next, in step P202, the acceleration start rotational phase is read from the memory M24. In step P203, the memory M12 for storing the virtual current rotational phase is overwritten with the acceleration start rotational phase. In step P204, setting rotational speed at synchronizing operation is read from the memory M31.

Next, in step P205, the acceleration signals and the setting rotational speed at synchronizing operation are sent to the upstream and downstream printing unit group drive controllers 70A and 90A. In step P206, it is judged whether the setting rotational speed is sent from the central controller 30.

Next, if yes in step P206, in step P207, the setting rotational speed is received from the central controller 30 and is stored in the memory M13 for storing the current setting rotational speed. If no in step P206, in step P208, it is judged whether the instruction to start deceleration is sent from the central controller 30. If yes in step P208, the process proceeds to later-described step P233, and if no, the process returns to step P206.

Next, in step P209, the previous setting rotational speed is read from the memory M14. In step P210, it is judged whether the setting rotational speed received from the central controller 30 is equal to the previous setting rotational speed. If yes in step P210, in step P211, the memory M32 for storing the current state of the printing press is overwritten with 0 (indicating a constant-speed state).

Next, in step P212, the previous setting rotational speed is read from the memory M14. In step P213, the setting rotational speed transmission interval is read from the memory M19. In step P214, from the previous setting rotational speed and the setting rotational speed transmission interval, the virtual current rotational phase correction value is calculated and stored in the memory M20.

Next, in step P215, the virtual current rotational phase is read from the memory M12. In step P216, the virtual current rotational phase is added to the virtual current rotational phase correction value to calculate the corrected virtual current rotational phase, which is then stored in the memory M21. In step P217, the upstream rotational phase compensation value is read from the memory M15.

Next, in step P218, the corrected virtual current rotational phase is added to the upstream rotational phase compensation value to calculate the corrected virtual current upstream rotational phase, which is then stored in the memory M16. In step P219, the downstream rotational phase compensation value is read from the memory M17.

Next, in step P220, the corrected virtual current rotational phase is added to the downstream rotational phase compensation value to calculate the corrected virtual current downstream rotational phase, which is then stored in the memory M18. In step P221, the current state of the printing press is read from the memory M32.

Next, in step P222, the current state of the printing press, the current setting rotational speed and the corrected virtual current upstream rotational phase are sent to the upstream printing unit group drive controller 70A. In step P223, the current state of the printing press, the current setting rotational speed and the corrected virtual current downstream rotational phase are sent to the downstream printing unit group drive controller 90A.

Next, in step P224, the current setting rotational speed is stored in the memory M14 for storing the previous setting rotational speed. The corrected virtual current rotational phase is read from the memory M21 in step P225. The memory M12 for storing the virtual current rotational phase is overwritten with the corrected virtual current rotational phase in step P226. The process then returns to step P206.

On the other hand, if no in step P210, in step P227, the memory M32 for storing the current state of the printing press is overwritten with 1 (indicating an accelerating state). In step P228, the rotational speed correction value at acceleration is read from the memory M25.

Next, in step P229, the previous setting rotational speed is added to the rotational speed correction value at acceleration to calculate the corrected current setting rotational speed, which is then stored in the memory M26. In step P230, the current setting rotational speed is read from the memory M13.

Next, in step P231, it is judged whether the corrected current setting rotational speed is less than the current setting rotational speed. If yes in step P231, in step P232, the corrected current setting rotational speed is stored in the memory M13 for storing the current setting rotational speed, and the process then proceeds to step P212. If no in step P231, the process directly proceeds to step P212.

Next, in step P233 to which the process proceeds from step P208, the deceleration start rotational phase is read from the memory M29. In step P234, the memory M12 for storing the virtual current rotational phase is overwritten with the deceleration start rotational phase.

Next, in step P235, deceleration signals are sent to the upstream and downstream printing unit group drive controllers 70A and 90A. In step P236, it is then judged whether the setting rotational speed is sent from the central controller 30. If yes in step P236, in step P237, the setting rotational speed is received from the central controller 30 and stored in the memory M13 for storing the current setting rotational speed.

On the other hand, if no in step P236, in step P238, it is judged whether the instruction to stop synchronizing operation is sent from the central controller 30. If yes in step P238, in step P239, instructions to stop synchronizing operation are sent to the upstream and downstream printing unit group drive controllers 70A and 90A, and the process returns to step P150. If no in steps P238, the process returns to step P236.

Next, in step P240, the previous setting rotational speed is read from the memory M14. In step P241, the memory M32 for storing the current state of the printing press is overwritten with 2 (indicating a decelerating state). In step P242, a rotational speed correction value at deceleration is read from the memory M30. In step P243, the rotational speed correction value at deceleration is subtracted from the previous setting rotational speed to calculate the corrected current setting rotational speed.

Next, in step P244, it is judged whether the corrected current setting rotational speed is less than 0. If yes in step P244, in step P245, the memory M26 for storing the corrected current setting rotational speed is updated with 0, and in step P246, the corrected current setting rotational speed is stored in the memory M13 for storing the current setting rotational speed. If no in step P244, the process directly proceeds to step P246.

Next, in step P247, the previous setting rotational speed is read from the memory M14, and in step P248, the setting rotational speed transmission interval is read from the memory M19.

Next, in step P249, from the previous setting rotational speed and the setting rotational speed transmission interval, the virtual current rotational phase correction value is calculated and stored in the memory M20. In step P250, the virtual current rotational phase is read from the memory M12.

Next, in step P251, the virtual current rotational phase is added to the virtual current rotational phase correction value to calculate the corrected virtual current rotational phase, which is then stored in the memory M21. In step P252, the upstream rotational phase compensation value is read from the memory M15.

Next, in step P253, the corrected virtual current rotational phase is added to the upstream rotational phase compensation value to calculate the corrected virtual current upstream rotational phase, which is then stored in the memory M16. In step P254, the downstream rotational phase compensation value is read from the memory M17.

Next, in step P255, the corrected virtual current rotational phase is added to the downstream rotational phase compensation value to calculate the corrected virtual current downstream rotational phase, which is then stored in the memory M18. In step P256, the current state of the printing press is read from the memory M32.

Next, in step P257, the current state of the printing press, the current setting rotational speed and the corrected virtual current upstream rotational phase are sent to the upstream printing unit group drive controller 70A. In step P258, the current state of the printing press, the current setting rotational speed and the corrected virtual current downstream rotational phase are sent to the downstream printing unit group drive controller 90A.

Next, in step P259, the current setting rotational speed is stored in the memory M14 for storing the previous setting rotational speed, and then in step P260, the corrected virtual current rotational phase is read from the memory M21. In step P261, the memory M12 for storing the virtual current rotational phase is overwritten with the corrected virtual current rotational phase, and the process returns to step P236. Hereinafter, the aforementioned steps are repeated.

According to the above-described operational flows, the teaching instruction and the synchronizing operation instruction are sent to the upstream and downstream printing unit group drive controllers 70A and 90A.

The upstream printing unit group drive controller 70A operates according to the operational flows shown in FIGS. 16A and 16B, 17A to 17C, 18A to 18C, 19A and 19B, 20A to 20C, 21A and 21B, 22A and 22B, 23A and 23B, and 24.

Specifically, in step P1, it is judged whether the teaching instruction is sent from the virtual master generator 60. If yes in step P1, the process proceeds to step P2. When the instruction to start home position alignment is sent from the virtual master generator 60 in step P2, in step P3, it is judged whether the current setting rotational speed (slow) and the corrected virtual current upstream rotational phase are sent from the virtual master generator 60. If no in step P1, the process proceeds to later-described step P167.

If yes in step P3, in step P4, the current setting rotational speed (slow) and the corrected virtual current upstream rotational phase are received from the virtual master generator 60, and are stored in the memory M33 for storing the current setting rotational speed and the memory M34 for storing the virtual current upstream rotational phase, respectively. In step P5, the count value is read from the current upstream rotational phase detection counter 74 and is stored in the memory M35.

Next, in step P6, from the count value of the current upstream rotational phase detection counter 74, the current upstream rotational phase is calculated and stored in the memory M36. In step P7, the current upstream rotational phase is subtracted from the virtual current upstream rotational phase to calculate a current upstream rotational phase difference, which is then stored in the memory M37.

Next, in step P8, from the current upstream rotational phase difference, the absolute value of the current upstream rotational phase difference is calculated and stored in the memory M38. In step P9, the tolerance of the current upstream rotational phase difference is read from the memory M39.

Next, in step P10, it is judged whether the absolute value of the current upstream rotational phase difference is equal to or less than the tolerance of the current upstream rotational phase difference. If yes in step P10, the current setting rotational speed (slow) is read from the memory M33 in step P11, and if no, the process proceeds to later-described step P15.

Next, in step P12, the memory M40 for storing the instruction rotational speed is overwritten with the current setting rotational speed (slow). In step P13, the instruction rotational speed is outputted to the upstream drive motor driver 72. In step P14, the home position alignment complete signal is sent to the virtual master generator 60, and the process returns to step P3.

Next, in step P15, the current upstream rotational phase difference-setting rotational speed compensation value conversion table is read from the memory M41, and in step P16, the current upstream rotational phase difference is read from the memory M37.

Next, in step P17, by using the current upstream rotational phase difference-setting rotational speed compensation value conversion table, the setting rotational speed compensation value is obtained from the current upstream rotational phase difference, and is stored in the memory M42. In step P18, the current setting rotational speed (slow) is read from the memory M33.

Next, in step P19, the current setting rotational speed (slow) is added to the setting rotational speed compensation value to calculate the instruction rotational speed, which is then stored in the memory M40. In step P20, the instruction rotational speed is outputted to the upstream drive motor driver 72, and the process returns to step P3.

If no in step P3, in step P21, it is judged whether the acceleration signal and the setting rotational speed at teaching are sent from the virtual master generator 60. If yes in step P21, in step P22, the setting rotational speed at teaching is received from the virtual master generator 60 and is stored in the memory M43 for storing the setting rotational speed at teaching. If no in step P21, the process returns to step P3.

Next, in step P23, reset and enable signals are outputted to the acceleration/deceleration counter 76, and in step P24, the output of the reset signal to the acceleration/deceleration counter 76 is stopped.

Next, in step P25, it is judged whether a clock pulse is outputted from the upstream rotational phase detection rotary encoder 20A. If yes in step P25, in step P26, standard rotational speed of the upstream load motor 18A is read from the load motor standard rotational speed setting unit 77 and is stored in the memory M44 for storing the rotational speed of the upstream load motor.

Next, in step P27, the count value is read from the current upstream rotational phase detection counter 74 and is stored in the memory M35. In step P28, from the count value of the current upstream rotational phase detection counter 74, the current upstream rotational phase is calculated and stored in the memory M36.

Next, in step P29, the transfer-cylinder notch move-up start rotational phase is read from the memory M45. In step P30, the transfer-cylinder notch move-up finish rotational phase is read from the memory M46.

Next, in step P31, it is judged whether the current upstream rotational phase is equal to or more than the transfer-cylinder notch move-up start rotational phase, and is equal to or less than the transfer-cylinder notch move-up finish rotational phase. If yes in step P31, in step P32, the rotational speed of the upstream load motor 18A is read from the memory M44, and if no, the process proceeds to later-described step P35.

Next, in step P33, a load motor rotational speed compensation value related to move-up of the notch of the transfer cylinder 6 of the convertible press mechanism 2 is read from the memory M47. In step P34, the load motor rotational speed compensation value related to move-up of the notch of the transfer cylinder 6 of the convertible press mechanism 2 is subtracted from rotational speed of the upstream load motor 18A, and the memory M44 is overwritten with the obtained result.

Next, the rotational speed of the upstream load motor 18A is read from the memory M44 in step P35, and is then outputted to the upstream load motor driver 79 in step P36.

Next, in step P37, the count value is read from the acceleration/deceleration counter 76, and is stored in the memory M48. In step P38, the electric current value is read from the upstream drive motor driver 72 and is stored in the memory M49.

Next, in step P39, a standard electric current value is read from the memory M50. In step P40, the standard electric current value is subtracted from the electric current value to calculate an electric current value difference, which is then stored in the memory M51.

Next, in step P41, the electric current value difference-load motor rotational speed compensation value conversion table is read from the memory M52. In step P42, by using the electric current value difference-load motor rotational speed compensation value conversion table, the load motor rotational speed compensation value is obtained from the electric current value difference and is stored in the memory M53.

Next, in step P43, rotational speed of the upstream load motor 18A is read from the memory M44. In step P44, the load motor rotational speed compensation value is subtracted from the rotational speed of the upstream load motor 18A to calculate a compensated rotational speed of the upstream load motor 18A, which is then stored in the memory M54.

Next, in step P45, the setting rotational speed at teaching is read from the memory M43, and in step P46, the count value of the acceleration/deceleration counter 76 is read from the memory M48. Next, in step P47, the compensated rotational speed of the upstream load motor 18A is stored at an address position of the memory M55 for storing the rotational speed of the upstream load motor at the acceleration, the address position corresponding to the count value of the acceleration/deceleration counter 76 for the setting rotational speed at teaching, and the process returns to step P25.

Next, if no in step P25, in step P48, it is judged whether the current setting rotational speed and the corrected virtual current upstream rotational phase are sent from the virtual master generator 60. If yes in step P48, in step P49, the current setting rotational speed and the corrected virtual current upstream rotational phase are received from the virtual master generator 60, and are stored in the memory M33 for storing the current setting rotational speed and the memory M34 for storing the virtual current upstream rotational phase, respectively.

If no in step P48, in step P50, it is judged whether the constant-speed operation load detection start signal for printing unit groups is sent from the virtual master generator 60. If yes in step P50, the process proceeds to later-described step P66, and if no, the process returns to step P25.

Next, in step P51, the count value is read from the current upstream rotational phase detection counter 74 and is stored in the memory M35. In step P52, from the count value of the current upstream rotational phase detection counter 74, the current upstream rotational phase is calculated and stored in the memory M36.

Next, in step P53, the current upstream rotational phase is subtracted from the virtual current upstream rotational phase to calculate a current upstream rotational phase difference, which is then stored in the memory M37. In step P54, from the current upstream rotational phase difference, the absolute value of the current upstream rotational phase difference is calculated and stored in the memory M38.

Next, in step P55, the tolerance of the current upstream rotational phase difference is read from the memory M39. In step P56, it is judged whether the absolute value of the current upstream rotational phase difference is equal to or less than the tolerance of the current upstream rotational phase difference.

Next, if yes in step P56, the current setting rotational speed is read from the memory M33 in step P57. The memory M40 for storing the instruction rotational speed is overwritten with the current setting rotational speed in step P58. Subsequently, in step P59, the instruction rotational speed is outputted to the upstream drive motor driver 72, and the process returns to step P25.

If no in step P56, in step P60, the current upstream rotational phase difference-setting rotational speed compensation value conversion table is read from the memory M41. In step P61, the current upstream rotational phase difference is read from the memory M37.

Next, in step P62, by using the current upstream rotational phase difference-setting rotational speed compensation value conversion table, the setting rotational speed compensation value is obtained from the current upstream rotational phase difference and is stored in the memory M42. In step P63, the current setting rotational speed is read from the memory M33.

Next, in step P64, the current setting rotational speed is added to the setting rotational speed compensation value to calculate the instruction rotational speed, which is then stored in the memory M40. In step P65, the instruction rotational speed is outputted to the upstream drive motor driver 72, and the process returns to step P25.

Next, in step P66 to which the process proceeds from step P50, it is judged whether the clock pulse is outputted from the upstream rotational phase detection rotary encoder 20A. If yes in step P66, in step P67, the standard rotational speed of the upstream load motor 18A is read from the load motor standard rotational speed setting unit 77 and is stored in the memory M44 for storing the rotational speed of the upstream load motor.

Next, in step P68, the count value is read from the current upstream rotational phase detection counter 74 and is stored in the memory M35. In step P69, from the count value of the current upstream rotational phase detection counter 74, the current upstream rotational phase is calculated and stored in the memory M36.

Next, in step P70, the transfer-cylinder notch move-up start rotational phase is read from the memory M45. In step P71, the transfer-cylinder notch move-up finish rotational phase is read from the memory M46.

Next, in step P72, it is judged whether the current upstream rotational phase is equal to or more than the transfer cylinder notch move-up start rotational phase, and is equal to or less than the transfer cylinder notch move-up finish rotational phase. If yes in step P72, in step P73, the rotational speed of the upstream load motor 18A is read from the memory M44, and if no, the process proceeds to later-described step P76.

Next, in step P74, the load motor rotational speed compensation value related to move-up of the notch of the transfer cylinder 6 of the convertible press mechanism 2 is read from the memory M47. In step P75, the load motor rotational speed compensation value related to move-up of the notch of the transfer cylinder 6 of the convertible press mechanism 2 is subtracted from the rotational speed of the upstream load motor 18A, and the memory M44 for storing the rotational speed of the upstream load motor is overwritten with the obtained result.

Next, the rotational speed of the upstream load motor 18A is read from the memory M44 in step P76, and is then outputted to the upstream load motor driver 79 in step P77.

Next, in step P78, the electric current value is read from the upstream drive motor driver 72 and is stored in the memory M49. In step P79, the standard electric current value is read from the memory M50. Subsequently, in step P80, the standard electric current value is subtracted from the electric current value to calculate the electric current value difference, which is then stored in the memory M51.

Next, in step P81, the electric current value difference-load motor rotational speed compensation value conversion table is read from the memory M52. In step P82, by using the electric current value difference-load motor rotational speed compensation value conversion table, the load motor rotational speed compensation value is obtained from the electric current value difference and is stored in the memory M53.

Next, in step P83, the rotational speed of the upstream load motor 18A is read from the memory M44. In step P84, the load motor rotational speed compensation value is subtracted from the rotational speed of the upstream load motor 18A to calculate the compensated rotational speed of the upstream load motor 18A, which is then stored in the memory M54.

Next, in step P85, the setting rotational speed at teaching is read from the memory M43, and in step P86, the current upstream rotational phase is read from the memory M36. Subsequently, in step P87, the compensated rotational speed of the upstream load motor 18A is stored at an address position of the memory M56 for storing the rotational speed of the upstream load motor at constant-speed operation, the address position corresponding to the current upstream rotational phase for the setting rotational speed at teaching, and the process returns to step P66.

Next, if no in the aforementioned step P66, in step P88, it is judged whether the current setting rotational speed and the corrected virtual current upstream rotational phase are sent from the virtual master generator 60. If yes in step P88, in step P89, the current setting rotational speed and the corrected virtual current upstream rotational phase are received from the virtual master generator 60, and are stored in the memory M33 for storing the current setting rotational speed and the memory M34 for storing the virtual current upstream rotational phase, respectively.

On the other hand, if no in step P88, in step P90, it is judged whether the constant-speed operation load detection termination signal for the printing unit groups is sent from the virtual master generator 60. If yes in step P90, the process proceeds to later-described step P106, and if no, the process returns to step P66.

Next, in step P91, the count value is read from the current upstream rotational phase detection counter 74 and is stored in the memory M35. In step P92, from the count value of the current upstream rotational phase detection counter 74, the current upstream rotational phase is calculated and stored in the memory M36.

Next, in step P93, the current upstream rotational phase is subtracted from the virtual current upstream rotational phase to calculate the current upstream rotational phase difference, which is then stored in the memory M37. In step P94, from the current upstream rotational phase difference, the absolute value of the current upstream rotational phase difference is calculated and stored in the memory M38.

Next, in step P95, the tolerance of the current upstream rotational phase difference is read from the memory M39. In step P96, it is judged whether the absolute value of the current upstream rotational phase difference is equal to or less than the tolerance of the current upstream rotational phase difference.

If yes in step P96, in step P97, the current setting rotational speed is read from the memory M33. In step P98, the memory M40 for storing the instruction rotational speed is overwritten with the current setting rotational speed. Subsequently, in step P99, the instruction rotational speed is outputted to the upstream drive motor driver 72, and the process returns to step P66.

On the other hand, if no in step P96, in step P100, the current upstream rotational phase difference-setting rotational speed compensation value conversion table is read from the memory M41, in step P101, the current upstream rotational phase difference is read from the memory M37.

In step P102, by using the current upstream rotational phase difference-setting rotational speed compensation value conversion table, from the current upstream rotational phase difference, the setting rotational speed compensation value is obtained and stored in the memory M42. In step P103, the current setting rotational speed is read from the memory M33.

Next, in step P104, the current setting rotational speed is added to the setting rotational speed compensation value to calculate the instruction rotational speed, which is then stored in the memory M40. In step P105, the instruction rotational speed is outputted to the upstream drive motor driver 72, and the process returns to step P66.

Next, in step P106 to which the process proceeds from step P90, it is judged whether the current setting rotational speed and the corrected virtual current upstream rotational phase are sent from the virtual master generator 60. If yes in step P106, in step P107, the current setting rotational speed and the corrected virtual current upstream rotational phase are received from the virtual master generator 60, and are stored in the memory M33 storing the current setting rotational speed and the memory M34 for storing the virtual current upstream rotational phase, respectively. The process then proceeds to later-described step P111.

On the other hand, if no in step P106, in step P108, it is judged whether the deceleration signal is sent from the virtual master generator 60. If yes in step P108, in step P109, the reset and enable signals are outputted to the acceleration/deceleration counter 76, and if no, the process returns to step P106. Subsequently, in step P110, the output of the reset signal to the acceleration/deceleration counter 76 is stopped, and the process proceeds to later-described step P126.

Next, in step P111, the count value is read from the current upstream rotational phase detection counter 74 and is stored in the memory M35. In step P112, from the count value of the current upstream rotational phase detection counter 74, the current upstream rotational phase is calculated and stored in the memory M36.

Next, in step P113, the current upstream rotational phase is subtracted from the virtual current upstream rotational phase to calculate the current upstream rotational phase difference, which is stored in the memory M37. In step P114, from the current upstream rotational phase difference, the absolute value of the current upstream rotational phase difference is calculated and stored in the memory M38.

Next, in step P115, the tolerance of the current upstream rotational phase difference is read from the memory M39. In step P116, it is judged whether the absolute value of the current upstream rotational phase difference is equal to or less than the tolerance of the current upstream rotational phase difference.

If yes in step P116, the current setting rotational speed is read from the memory M33 in step P117. The memory M40 for storing the instruction rotational speed is overwritten with the current setting rotational speed in step P118. Subsequently, in step P119, the instruction rotational speed is outputted to the upstream drive motor driver 72, and the process returns to step P106.

On the other hand, if no in step P116, in step P120, the current upstream rotational phase difference-setting rotational speed compensation value conversion table is read from the memory M41, and in step P121, the current upstream rotational phase difference is read from the memory M37.

Next, in step P122, by using the current upstream rotational phase difference-setting rotational speed compensation value conversion table, the setting rotational speed compensation value is obtained from the current upstream rotational phase difference and is stored in the memory M42. In step P123, the current setting rotational speed is read from the memory M33.

Next, in step P124, the current setting rotational speed is added to the setting rotational speed compensation value to calculate the instruction rotational speed, which is then stored in the memory M40. In step P125, the instruction rotational speed is outputted to the upstream drive motor driver 72, and the process returns to step P106.

Next, in step P126 to which the process proceeds from step P110, it is judged whether the clock pulse is outputted from the upstream rotational phase detection rotary encoder 20A. If yes in step P126, in step P127, the standard rotational speed of the upstream load motor 18A is read from the load motor standard rotational speed setting unit 77 and is stored in the memory M44.

Next, in step P128, the count value is read from the current upstream rotational phase detection counter 74 and is stored in the memory M35. In step P129, the current upstream rotational phase is calculated from the count value of the current upstream rotational phase detection counter 74 and is stored in the memory M36.

Next, in step P130, the transfer cylinder notch move-up start rotational phase is read from the memory M45, and in step P131, the transfer cylinder notch move-up finish rotational phase is read from the memory M46.

Next, in step P132, it is judged whether the current upstream rotational phase is equal to or more than the transfer cylinder notch move-up start rotational phase, and is equal to or less than the transfer cylinder notch move-up finish rotational phase. If yes in step P132, in step P133, the rotational speed of the upstream load motor 18A is read from the memory M44, and if no, the process proceeds to later-described step P136.

Next, in step P134, the load motor rotational speed compensation value related to move-up of the notch of the transfer cylinder 6 of the convertible press mechanism 2 is read from the memory M47, and is then subtracted from the rotational speed of the upstream load motor 18A in step P135. The memory M44 for storing the rotational speed of the upstream load motor is then overwritten by the obtained value.

Next, the rotational speed of the upstream load motor 18A is read from the memory M44 in step P136, and is then outputted to the upstream load motor driver 79 in step P137.

Next, in step P138, the count value is read from the acceleration/deceleration counter 76 and is stored in the memory M48. In step P139, the electric current value is read from the upstream drive motor driver 72 and is stored in the memory M49.

Next, the standard electric current value is read from the memory M50 in step P140, and in step P141, is subtracted from the electric current value to calculate the electric current value difference, which is then stored in the memory M51.

Next, in step P142, the electric current value difference-load motor rotational speed compensation value conversion table is read from the memory M52. In step P143, by using the electric current value difference-load motor rotational speed compensation value conversion table, the load motor rotational speed compensation value is obtained from the electric current value difference and is stored in the memory M53.

Next, in step P144, the rotational speed of the upstream load motor 18A is read from the memory M44. In step P145, the load motor rotational speed compensation value is subtracted from the rotational speed of the upstream load motor 18A to calculate the compensated rotational speed of the upstream load motor 18A, which is then stored in the memory M54.

Next, in step P146, the setting rotational speed at teaching is read from the memory M43, and in step P147, the count value of the acceleration/deceleration counter 76 is read from the memory M48. Subsequently, in step P148, the compensated rotational speed of the upstream load motor 18A is stored at an address position of the memory M57 for storing the rotational speed of the upstream load motor at deceleration, the address position corresponding to the count value of the acceleration/deceleration counter 76 for the setting rotational speed at teaching, and the process returns to step P126.

If no in step P126, in step P149, it is judged whether the current setting rotational speed and the corrected virtual current upstream rotational phase are sent from the virtual master generator 60. If yes, in step P150, the current setting rotational speed and the corrected virtual current upstream rotational phase are received from the virtual master generator 60, and are stored in the memory M33 for storing the current setting rotational speed and the memory M34 for storing the virtual current upstream rotational phase, respectively.

On the other hand, if no in step P149, in step P151, it is judged whether the teaching finish signal is sent from the virtual master generator 60. If yes in step P151, the process returns to step P1, and if no, the process returns to step P126.

Next, in step P152, the count value is read from the current upstream rotational phase detection counter 74 and is stored in the memory M35. In step P153, from the count value of the current upstream rotational phase detection counter 74, the current upstream rotational phase is calculated and stored in the memory M36.

Next, in step P154, the current upstream rotational phase is subtracted from the virtual current upstream rotational phase to calculate the current upstream rotational phase difference, which is then stored in the memory M37. In step P155, from the current upstream rotational phase difference, the absolute value of the current upstream rotational phase difference is calculated and stored in the memory M38.

Next, in step P156, the tolerance of the current upstream rotational phase difference is read from the memory M39. In step P157, it is judged whether the absolute value of the current upstream rotational phase difference is not more than the tolerance of the current upstream rotational phase difference.

If yes in step P157, the current setting rotational speed is read from the memory M33 in step P158. The memory M40 for storing the instruction rotational speed is then overwritten with the current setting rotational speed in step P159. Subsequently, in step P160, the instruction rotational speed is outputted to the upstream drive motor driver 72, and the process returns to step P126.

On the other hand, if no in step P157, in step P161, the current upstream rotational phase difference-setting rotational speed compensation value conversion table is read from the memory M41. In step P162, the current upstream rotational phase difference is then read from the memory M37.

Next, in step P163, by using the current upstream rotational phase difference-setting rotational speed compensation value conversion table, the setting rotational speed compensation value is obtained from the current upstream rotational phase difference and is stored in the memory M42. In step P164, the current setting rotational speed is then read from the memory M33.

Next, in step P165, the current setting rotational speed is added to the setting rotational speed compensation value to calculate the instruction rotational speed, which is then stored in the memory M40. In step P166, the instruction rotational speed is outputted to the upstream drive motor driver 72, and the process returns to step P126.

Next, in step P167 to which the process proceeds from step P1, it is judged whether the instruction to start synchronizing operation is sent from the virtual master generator 60. If yes in step P167, in step P168, it is judged whether the instruction to start home position alignment is sent from the virtual master generator 60. If no, the process proceeds to later-described step P245.

If yes in step P168, in step P170, it is judged whether the current setting rotational speed (slow) and the corrected virtual current upstream rotational phase are sent from the virtual master generator 60. If no in step P168, in step P169, it is judged whether the instruction to stop synchronizing operation is sent from the virtual master generator 60. If yes in step P169, the process proceeds to later-described step P245, and if no, the process returns to step P168.

If yes in step P170, in step P171, the current setting rotational speed (slow) and corrected virtual current upstream rotational phase are received from the virtual master generator 60, and are stored in the memory M33 for storing the current setting rotational speed and the memory M34 for storing the virtual current upstream rotational phase, respectively. In step P172, the count value is read from the current upstream rotational phase detection counter 74 and is stored in the memory M35.

Next, in step P173, from the count value of the current upstream rotational phase detection counter 74, the current upstream rotational phase is calculated and stored in the memory M36. In step P174, the current upstream rotational phase is subtracted from the virtual current upstream rotational phase to calculate the current upstream rotational phase difference, which is then stored in the memory M37.

Next, in step P175, from the current upstream rotational phase difference, the absolute value of the current upstream rotational phase difference is calculated and stored in the memory M38. In step P176, the tolerance of the current upstream rotational phase difference is read from the memory M39.

Next, in step P177, it is judged whether the absolute value of the current upstream rotational phase difference is equal to or less than the tolerance of the current upstream rotational phase difference. If yes in step P177, in step P178, the current setting rotational speed (slow) is read from the memory M33, and if no, the process proceeds to later-described step P182.

Next, in step P179, the memory M40 for storing the instruction rotational speed is overwritten with the current setting rotational speed (slow), and in step P180, the instruction rotational speed is outputted to the upstream drive motor driver 72. Subsequently, in step P181, a home position alignment complete signal is sent to the virtual master generator 60, and the process returns to step P170.

Next, in step P182, the current upstream rotational phase difference-setting rotational speed compensation value conversion table is read from the memory M41. In step P183, the current upstream rotational phase difference is read from the memory M37.

Next, in step P184, by using the current upstream rotational phase difference-setting rotational speed compensation value conversion table, the setting rotational speed compensation value is obtained from the current upstream rotational phase difference and is stored in the memory M42. In step P185, the current setting rotational speed (slow) is read from the memory M33.

Next, in step P186, the current setting rotational speed (slow) is added to the setting rotational speed compensation value to calculate the instruction rotational speed, which is then stored in the memory M40. In step P187, the instruction rotational speed is outputted to the upstream drive motor driver 72, and the process returns to step P170.

If no in step P170, in step P188, it is judged whether the acceleration signal and the setting rotational speed at synchronizing operation are sent from the virtual master generator 60. If yes in step P188, in step P189, the setting rotational speed at synchronizing operation is received from the virtual master generator 60 and is stored in the memory M58 for storing the setting rotational speed at synchronizing operation. If no in step P188, the process returns to step P170.

Next, in step P190, the reset and enable signals are outputted to the acceleration/deceleration counter 76, and in step P191, the output of the reset signal to the acceleration/deceleration counter 76 is stopped.

Next, in step P192, it is judged whether the current state of the printing press, the current setting rotational speed and the corrected virtual current upstream rotational phase are sent from the virtual master generator 60. If yes in step P192, in step P193, the current state of the printing press, the current setting rotational speed, and the corrected virtual current upstream rotational phase are received from the virtual master generator 60, and are stored in the memory M59 for storing the current state of the printing press, the memory M33 for storing the current setting rotational speed, and the memory M34 for storing the virtual current upstream rotational phase, respectively.

On the other hand, if no in step P192, in step P194, it is judged whether the deceleration signal is sent from the virtual master generator 60. If yes in step P194, in step P195, the reset and enable signals are outputted to the acceleration/deceleration counter 76, and in step P196, the output of the reset signal to the acceleration/deceleration counter 76 is stopped. The process then proceeds to later-described step P223. If no in step P194, the process returns to step P192.

Next, in step P197, the current state of the printing press is read from the memory M59, and in step P198, it is judged whether the current state of the press is equal to 1. If yes in step P198, in P199, the setting rotational speed at synchronizing operation is read from the memory M58.

Next, in step P200, the count value is read from the acceleration/deceleration counter 76 and is stored in the memory M48. In step P201, the rotational speed of the upstream load motor 18A is read from an address position of the memory M55 for storing the rotational speed of the upstream load motor at the acceleration, the address position corresponding to the count value of the acceleration/deceleration counter 76 for the setting rotational speed at synchronizing operation. Then, the rotational speed of the upstream load motor 18A is stored in the memory M44. Note that, the address position of the memory M55 for storing the rotational speed of the upstream load motor at the acceleration, the address position, the address position corresponding to the count value of the acceleration/deceleration counter 76 for the setting rotational speed at synchronizing operation, corresponds to the address position of the memory M55, the address position corresponding to the count value of the acceleration/deceleration counter 76 for the setting rotational speed at teaching, the memory M55 storing the compensated rotational speed of the load motor 18A in step P47 when the setting rotational speed at teaching is equal to the setting rotational speed at synchronizing operation and when the count value of the acceleration/deceleration counter 76 has a same count value.

Next, in step P202, the rotational speed of the upstream load motor 18A is outputted to the upstream load motor driver 79, and the process proceeds to later-described step P208.

On the other hand, if no in step P198, in step P203, the setting rotational speed at synchronizing operation is read from the memory M58. In step P204, the count value is read from the current upstream rotational phase detection counter 74 and is stored in the memory M35.

Next, in step P205, the current upstream rotational phase is calculated from the count value of the current upstream rotational phase detection counter 74 and is stored in the memory M36. In step P206, the rotational speed of the upstream load motor 18A is read from an address position of the memory M56 for storing the rotational speed of the upstream load motor at constant-speed operation, the address position corresponding to the current upstream rotational phase for the setting rotational speed at synchronizing operation. Then, the rotational speed of the upstream load motor 18A is stored in the memory M44. Note that, the address position of the memory M56 for storing the rotational speed of the upstream load motor at constant-speed operation, the address position corresponding to the current upstream rotational phase for the setting rotational speed at synchronizing operation, corresponds to the address position of the memory M56, the address position corresponding to the setting rotational speed at teaching for the current upstream rotational phase, the memory M56 storing the compensated rotational speed of the load motor 18A in step P87 when the setting rotational speed at teaching is equal to the setting rotational speed at synchronizing operation and when the current upstream rotational phase is the same.

Next, in step P207, the rotational speed of the upstream load motor 18A is outputted to the upstream load motor driver 79. In step P208, the count value is read from the current upstream rotational phase detection counter 74 and is stored in the memory M35.

Next, in step P209, the current upstream rotational phase is calculated from the count value of the current upstream rotational phase detection counter 74 and is stored in the memory M36. In step P210, the current upstream rotational phase is subtracted from the virtual current upstream rotational phase to calculate the current upstream rotational phase difference, which is then stored in the memory M37.

Subsequently, in step P211, the absolute value of the current upstream rotational phase difference is calculated from the current upstream rotational phase difference and is stored in the memory M38. In step P212, the tolerance of the current upstream rotational phase difference is read from the memory M39.

Next, in step P213, it is judged whether the absolute value of the current upstream rotational phase difference is equal to or less than the tolerance of the current upstream rotational phase difference. If yes in step P213, in step P214, the current setting rotational speed is read from the memory M33.

Next, in step P215, the memory M40 for storing the instruction rotational speed is overwritten with the current setting rotational speed, and in step P216, the instruction rotational speed is outputted to the upstream drive motor driver 72. The process then returns to step P192.

On the other hand, if no in step P213, in step P217, the current upstream rotational phase difference-setting rotational speed compensation value conversion table is read from the memory M41. In step P218, the current upstream rotational phase difference is then read from the memory M37.

Next, in step P219, by using the current upstream rotational phase difference-setting rotational speed compensation value conversion table, the setting rotational speed compensation value is obtained from the current upstream rotational phase difference and is stored in the memory M42. In step P220, the current setting rotational speed is read from the memory M33.

Next, in step P221, the current setting rotational speed is added to the setting rotational speed compensation value to calculate the instruction rotational speed, which is then stored in the memory M40. In step P222, the instruction rotational speed is outputted to the upstream drive motor driver 72, and the process returns to step P192.

Next, in step P223 to which the process proceeds from step P196, it is judged whether the current state of the printing press, the current setting rotational speed and the corrected virtual current upstream rotational phase are sent from the virtual master generator 60. If yes in step P223, the process proceeds to step P224, and if no, it is judged in step P225 whether the instruction to stop synchronizing operation is sent from the virtual master generator 60. If yes in this step P225, the process returns to step P168, and if no, the process returns to step P223.

Next, in step P224, the current state of the printing press, the current setting rotational speed, and the corrected virtual current upstream rotational phase are received from the virtual master generator 60, and are stored in the memory M59 for storing the current state of the printing press, the memory M33 for storing the current setting rotational speed and the memory M34 for storing the virtual current upstream rotational phase, respectively. In step P226, the setting rotational speed at synchronizing operation is then read from the memory M58.

Next, in step P227, the count value is read from the acceleration/deceleration counter 76 and is stored in the memory M48. In step P228, the rotational speed of the upstream load motor 18A is read from an address position of the memory M57 for storing the rotational speed of the upstream load motor at deceleration, the address position corresponding to the count value of the acceleration/deceleration counter 76 for the setting rotational speed at synchronizing operation. Then, the rotational speed of the upstream load motor 18A is stored in the memory M44. Herein, the address position of the memory M57 for storing the rotational speed of the upstream load motor at deceleration, the address position corresponding to the count value of the acceleration/deceleration counter 76 for the setting rotational speed at synchronizing operation, corresponds to the address position of the memory M57, the address position corresponding to the count value of the acceleration/deceleration counter 76 for the setting rotational speed at synchronizing operation, the memory M57 storing the compensated rotational speed of the load motor 18A in step P148 when the setting rotational speed at teaching is equal to the setting rotational speed at synchronizing operation and when the count value of the acceleration/deceleration counter 76 is the same.

Next, in step P229, the rotational speed of the upstream load motor 18A is outputted to the upstream load motor driver 79. In step P230, the count value is read from the current upstream rotational phase detection counter 74 and is stored in the memory M35.

Next, in step P231, the current upstream rotational phase is calculated from the count value of the current upstream rotational phase detection counter 74 and is stored in the memory M36. In step P232, the current upstream rotational phase is subtracted from the virtual current upstream rotational phase to calculate the current upstream rotational phase difference, which is then stored in the memory M37.

Next, in step P233, the absolute value of the current upstream rotational phase difference is calculated from the current upstream rotational phase difference and is stored in the memory M38. In step P234, the tolerance of the current upstream rotational phase difference is read from the memory M39.

Next, in step P235, it is judged whether the absolute value of the current upstream rotational phase difference is equal to or less than the tolerance of the current upstream rotational phase difference. If yes in step P235, in step P236, the current setting rotational speed is read from the memory M33.

Next, in step P237, the memory M40 for storing the instruction rotational speed is overwritten with the current setting rotational speed, and in step P238, the instruction rotational speed is outputted to the upstream drive motor driver 72. The process then returns to step P223.

On the other hand, if no in step P235, in step P239, the current upstream rotational phase difference-setting rotational speed compensation value conversion table is read from the memory M41, and in step P240, the current upstream rotational phase difference is read from the memory M37.

Next, in step P241, by using the current upstream rotational phase difference-setting rotational speed compensation value conversion table, the setting rotational speed compensation value is obtained from the current upstream rotational phase difference and is stored in the memory M42. In step P242, the current setting rotational speed is read from the memory M33.

Next, in step P243, the current setting rotational speed is added to the setting rotational speed compensation value to calculate the instruction rotational speed, which is then stored in the memory M40. In step P244, the instruction rotational speed is outputted to the upstream drive motor driver 72, and the process returns to step P223.

Next, in step P245 to which the process proceeds from step P167, it is judged whether the setting rotational speed is inputted to the upstream single drive rotational speed setting unit 80. If yes in step P245, in step P246, the setting rotational speed is read from the upstream single drive rotational speed setting unit 80 and is stored in the memory M33 for storing the current setting rotational speed. The process then proceeds to step P247. If no in step P245, the process directly proceeds to step P247.

Next, in step P247, it is judged whether the upstream single drive switch 81 is turned on. If yes in step P247, in step P248, the current setting rotational speed is read from the memory M33, and if no, the process returns to step P1.

Next, in step P249, the current setting rotational speed is written in the memory M40 for storing the instruction rotational speed, and in step P250, the instruction rotational speed is outputted to the upstream drive motor driver 72.

Next, in step P251, the upstream stop switch 82 is turned on, and in step P252, a stop instruction is then outputted to the upstream drive motor driver 72. The process then returns to step P1. Hereinafter, the aforementioned processes are repeated.

According to the above-described operational flows, upon the instructions from the virtual master generator 60, by the upstream printing unit group drive controller 70A, the teaching processing and synchronizing operation processing of the upstream drive motor 10A are performed, and the breaking force control is carried out by the upstream load motor 18A at the synchronizing operation.

The downstream printing unit group drive controller 90A operates according to the operational flows shown in FIGS. 25A and 25B, 26A to 26C, 27A to 27C, 28A and 28B, 29A to 29C, 30A and 30B, 31A and 31B, 32A and 32B, and 33.

Specifically, in step P1, it is judged whether the teaching instruction is sent from the virtual master generator 60. If yes in step P1, the process proceeds to step P2. When the instruction to start home position alignment is sent from the virtual master generator 60 in step P2, in step P3, it is judged whether the current setting rotational speed (slow) and the corrected virtual current downstream rotational phase are sent from the virtual master generator 60. If no in step P1, the process proceeds to later-described step P167.

If yes in step P3, in step P4, the current setting rotational speed (slow) and the corrected virtual current downstream rotational phase are received from the virtual master generator 60, and are stored in the memory M60 for storing the current setting rotational speed and the memory M61 for storing the virtual current rotational phase of the downstream printing unit group, respectively. In step P5, the count value is read from the current downstream rotational phase detection counter 94 and is stored in the memory M62.

Next, in step P6, the current downstream rotational phase is calculated from the count value of the current downstream rotational phase detection counter 94 and is stored in the memory M63. In step P7, the current downstream rotational phase is subtracted from the virtual current downstream rotational phase to calculate a current downstream rotational phase difference, which is then stored in the memory M64.

Next, in step P8, the absolute value of the current downstream rotational phase difference is calculated from the current downstream rotational phase difference and is stored in the memory M65. In step P9, a tolerance of the current downstream rotational phase difference is read from the memory M66.

Next, in step P10, it is judged whether the absolute value of the current downstream rotational phase difference is equal to or less than the tolerance of the current downstream rotational phase difference. If yes in step P10, in step Pl1, the current setting rotational speed (slow) is read from the memory M60, and if no, the process proceeds to later-described step P15.

Next, in step P12, the memory M67 for storing the instruction rotational speed is overwritten with the current setting rotational speed (slow). In step P13, the instruction rotational speed is outputted to the downstream drive motor driver 92. In step P14, a home position alignment completion signal is sent to the virtual master generator 60, and the process returns to step P3.

Next, in step P15, the current downstream rotational phase difference-setting rotational speed compensation value conversion table is read from the memory M68, and in step P16, the current downstream rotational phase difference is read from the memory M64.

Next, in step P17, by using the current downstream rotational phase difference-setting rotational speed compensation value conversion table, the setting rotational speed compensation value is obtained from the current downstream rotational phase difference and is stored in the memory M69. In step P18, the current setting rotational speed (slow) is read from the memory M60.

Next, in step P19, the current setting rotational speed (slow) is added to the setting rotational speed compensation value to calculate the instruction rotational speed, which is then stored in the memory M67. In step P20, the instruction rotational speed is outputted to the downstream drive motor driver 92, and the process returns to step P3.

If no in step P3, in step P21, it is judged whether the acceleration signal and the setting rotational speed at teaching are sent from the virtual master generator 60. If yes in step P21, in step P22, the setting rotational speed at teaching is received from the virtual master generator 60 and is stored in the memory M70 for storing the setting rotational speed at teaching. If no in step P21, the process returns to step P3.

Next, in step P23, reset and enable signals are outputted to the acceleration/deceleration counter 96, and in step P24, the output of the reset signal to the acceleration/deceleration counter 96 is stopped.

Next, in step P25, it is judged whether a clock pulse is outputted from the downstream rotational phase detection rotary encoder 20B. If yes in step P25, in step P26, standard rotational speed of the downstream load motor 18B is read from the load motor standard rotational speed setting unit 97 and is stored in the memory M71 for storing setting rotational speed at teaching.

Next, in step P27, the count value is read from the current downstream rotational phase detection counter 94 and is stored in the memory M62. In step P28, the current downstream rotational phase is calculated from the count value of the current downstream rotational phase detection counter 94 and is stored in the memory M63.

Next, in step P29, the suction cylinder-notch move-up start rotational phase is read from the memory M72. In step P30, the suction cylinder-notch move-up finish rotational phase is read from the memory M73.

Next, in step P31, it is judged whether the current downstream rotational phase is equal to or more than the suction cylinder-notch move-up start rotational phase, and is equal to or less than the suction cylinder-notch move-up finish rotational phase. If yes in step P31, in step P32, the rotational speed of the downstream load motor 18B is read from the memory M71, and if no, the process proceeds to later-described step P35.

Next, in step P33, the load motor rotational speed compensation value related to move-up of the notch of the suction cylinder 7 of the convertible press mechanism 2 is read from the memory M74. In step P34, the load motor rotational speed compensation value related to move-up of the notch of the suction cylinder 7 of the convertible press mechanism 2 is subtracted from the rotational speed of the downstream load motor 18B. The memory M71 for storing the rotational speed of the downstream load motor is overwritten by the obtained result.

Next, the rotational speed of the downstream load motor 18B is read from the memory M71 in step P35, and is then outputted to the downstream load motor driver 99 in step P36.

Next, in step P37, a count value is read from the acceleration/deceleration counter 96 and is stored in the memory M75. In step P38, the electric current value is read from the downstream drive motor driver 92 and is stored in the memory M76.

Next, in step P39, a standard electric current value is read from the memory M77. In step P40, the standard electric current value is subtracted from the electric current value to calculate an electric current value difference, which is then stored in the memory M78.

Next, in step P41, an electric current value difference-load motor rotational speed compensation value conversion table is read from the memory M79. In step P42, by using the electric current value difference-load motor rotational speed compensation value conversion table, the load motor rotational speed compensation value is obtained from the electric current value difference and is stored in the memory M80.

Next, in step P43, rotational speed of the downstream load motor 18B is read from the memory M71. In step P44, the load motor rotational speed compensation value is subtracted from the rotational speed of the downstream load motor 18B to calculate compensated rotational speed of the downstream load motor 18B, which is then stored in the memory M81.

Next, in step P45, the setting rotational speed at teaching is read from the memory M70, and in step P46, the count value of the acceleration/deceleration counter 96 is read from the memory M75. Next, in step P47, the compensated rotational speed of the downstream load motor 18B is stored at an address position of the memory M82 for storing the rotational speed of the downstream load motor at acceleration, the address position corresponding to the count value of the acceleration/deceleration counter 96 for the setting rotational speed at teaching, and the process returns to step P25.

Next, if no in step P25, in step P48, it is judged whether the current setting rotational speed and the corrected virtual current downstream rotational phase are sent from the virtual master generator 60. If yes in step P25, in step P49, the current setting rotational speed and the corrected virtual current downstream rotational phase are received from the virtual master generator 60, and are stored in the memory M60 for storing the current setting rotational speed and the memory M61 for storing the virtual current downstream rotational phase, respectively.

On the other hand, if no in step P48, it is judged in step P50 whether the constant-speed operation load detection start signal for the printing unit groups is sent from the virtual master generator 60. If yes in step P50, the process proceeds to later-described step P66, and if no, the process returns to step P25.

Next, in step PS1, the count value is read from the current downstream rotational phase detection counter 94 and is stored in the memory M62. In step P52, the current downstream rotational phase is calculated from the count value of the current downstream rotational phase detection counter 94 and is stored in the memory M63.

Next, in step P53, the current downstream rotational phase is subtracted from the virtual current downstream rotational phase to calculate a current downstream rotational phase difference, which is stored in the memory M64. In step P54, from the current downstream rotational phase difference, the absolute value of the current downstream rotational phase difference is calculated and then stored in the memory M65.

Next, in step P55, the tolerance of the current downstream rotational phase difference is read from the memory M66. In step P56, it is judged whether the absolute value of the current downstream rotational phase difference is equal to or less than the tolerance of the current downstream rotational phase difference.

Next, if yes in step P56, the current setting rotational speed is read from the memory M60 in step P57. The memory M67 for storing the instruction rotational speed is overwritten with the current setting rotational speed in step P58. Subsequently, in step P59, the instruction rotational speed is outputted to the downstream drive motor driver 92, and the process returns to step P25.

On the other hand, if no in step P56, in step P60, the current downstream rotational phase difference-setting rotational speed compensation value conversion table is read from the memory M68. In step P61, the current downstream rotational phase difference is read from the memory M64.

Next, in step P62, by using the current downstream rotational phase difference-setting rotational speed compensation value conversion table, the setting rotational speed compensation value is obtained from the current downstream rotational phase difference and is stored in the memory M69. In step P63, the current setting rotational speed is read from the memory M60.

Next, in step P64, the current setting rotational speed is added to the setting rotational speed compensation value to calculate the instruction rotational speed, which is then stored in the memory M67. In step P65, the instruction rotational speed is outputted to the downstream drive motor driver 92, and the process returns to step P25.

Next, in step P66 to which the process proceeds from step P50, it is judged whether the clock pulse is outputted from the downstream rotational phase detection rotary encoder 20B. If yes in step P66, in step P67, the standard rotational speed of the downstream load motor 18B is read from the load motor standard rotational speed setting unit 97 and is stored in the memory M71 for storing the rotational speed of the downstream load motor.

Next, in step P68, the count value is read from the current downstream rotational phase detection counter 94 and is stored in the memory M62. In step P69, the current downstream rotational phase is calculated from the count value of the current downstream rotational phase detection counter 94 and is stored in the memory M63.

Next, in step P70, the suction cylinder-notch move-up start rotational phase is read from the memory M72. In step P71, the suction cylinder-notch move-up finish rotational phase is read from the memory M73.

Next, in step P72, it is judged whether the current downstream rotational phase is equal to or more than the suction cylinder-notch move-up start rotational phase, and is equal to or less than the suction cylinder-notch move-up finish rotational phase. If yes in step P72, in step P73, the rotational speed of the downstream load motor 18B is read from the memory M71, and if no, the process proceeds to later-described step P76.

Next, in step P74, the downstream load motor rotational speed compensation value related to move-up of the notch of the suction cylinder 7 of the convertible press mechanism 2 is read from the memory M74. In step P75, the load motor rotational speed compensation value related to move-up of the notch of the suction cylinder 7 of the convertible press mechanism 2 is subtracted from the rotational speed of the downstream load motor 18B, and the memory M71 for storing the rotational speed of the downstream load motor is over written with the obtained result.

Next, the rotational speed of the downstream load motor 18B is read from the memory M71 in step P76, and is then outputted to the downstream load motor driver 99 in step P77.

Next, in step P78, the electric current value is read from the downstream drive motor driver 92 and is stored in the memory M76. In step P79, the standard electric current value is read from the memory M77. Subsequently, in step P80, the standard electric current value is subtracted from the electric current value to calculate the electric current value difference, which is then stored in the memory M78.

Next, in step P81, the electric current value difference-load motor rotational speed compensation value conversion table is read from the memory M79. In step P82, by using the electric current value difference-load motor rotational speed compensation value conversion table, the load motor rotational speed compensation value is obtained from the electric current value difference and is stored in the memory M80.

Next, in step P83, the rotational speed of the downstream load motor 18B is read from the memory M71. In step P84, the load motor rotational speed compensation value is subtracted from the rotational speed of the downstream load motor 18B to calculate the compensated rotational speed of the downstream load motor 18B, which is then stored in the memory M81.

Next, in step P85, the setting rotational speed at teaching is read from the memory M70, and in step P86, the current downstream rotational phase is read from the memory M63. Subsequently, in step P87, the compensated rotational speed of the downstream load motor 18B is stored at an address position of the memory M83 for storing the rotational speed of the downstream load motor at constant-speed operation, the address position corresponding to the current upstream rotational phase for the setting rotational speed at teaching. Then, the process returns to step P66.

Next, if no in step P66, in step P88, it is judged whether the current setting rotational speed and the corrected virtual current downstream rotational phase are sent from the virtual master generator 60. If yes in step P88, in step P89, the current setting rotational speed and the corrected virtual current downstream rotational phase are received from the virtual master generator 60, and are stored in the memory M60 for the storing current setting rotational speed and the memory M61 for storing the virtual current downstream rotational phase, respectively.

If no in step P88, in step P90, it is judged whether the constant-speed operation load detection finish signal for the printing unit groups is sent from the virtual master generator 60. If yes in step P90, the process proceeds to later-described step P106, and if no, the process returns to step P66.

Next, in step P91, the count value is read from the current downstream rotational phase detection counter 94 and is stored in the memory M62. In step P92, from the count value of the current downstream rotational phase detection counter 94, the current downstream rotational phase is calculated and stored in the memory M63.

Next, in step P93, the current downstream rotational phase is subtracted from the virtual current downstream rotational phase to calculate the current downstream rotational phase difference, which is then stored in the memory M64. In step P94, from the current downstream rotational phase difference, the absolute value of the current downstream rotational phase difference is calculated and stored in the memory M65.

Next, in step P95, the tolerance of the current downstream rotational phase difference is read from the memory M66. In step P96, it is judged whether the absolute value of the current downstream rotational phase difference is equal to or less than the tolerance of the current downstream rotational phase difference.

Next, if yes in step P96, in step P97, the current setting rotational speed is read from the memory M60. In step P98, the memory M67 for storing the instruction rotational speed is overwritten with the current setting rotational speed. Subsequently, in step P99, the instruction rotational speed is outputted to the downstream drive motor driver 92, and the process returns to step P66.

On the other hand, if no in step P96, in step P100, the current downstream rotational phase difference-setting rotational speed compensation value conversion table is read from the memory M68, in step P101, the current downstream rotational phase difference is read from the memory M64.

Next, in step P102, by using the current downstream rotational phase difference-setting rotational speed compensation value conversion table, the setting rotational speed compensation value is obtained from the current downstream rotational phase difference and is stored in the memory M69. In step P103, the current setting rotational speed is read from the memory M60.

Next, in step P104, the current setting rotational speed is added to the setting rotational speed compensation value to calculate the instruction rotational speed, which is then stored in the memory M67. In step P105, the instruction rotational speed is outputted to the downstream drive motor driver 92, and the process returns to step P66.

Next, in step P106 to which the process proceeds from step P90, it is judged whether the current setting rotational speed and the corrected virtual current downstream rotational phase are sent from the virtual master generator 60. If yes in step P106, in step P107, the current setting rotational speed and the corrected virtual current downstream rotational phase are received from the virtual master generator 60 and are stored in the memory M60 for storing the current setting rotational speed and the memory M61 for storing the virtual current downstream rotational phase, respectively. The process then proceeds to later-described step P111.

On the other hand, if no in step P106, in step P108, it is judged whether the deceleration signal is sent from the virtual master generator 60. If yes in step P108, in step P109, reset and enable signals are outputted to the acceleration/deceleration counter 96, and if no, the process returns to step P106. Subsequently, in step P110, the output of the reset signal to the acceleration/deceleration counter 96 is stopped, and the process proceeds to later-described step P126.

Next, in step P111, the count value is read from the current downstream rotational phase detection counter 94 and is stored in the memory M62. In step P112, from the count value of the current downstream rotational phase detection counter 94, the current downstream rotational phase is calculated and then stored in the memory M63.

Next, in step P113, the current downstream rotational phase is subtracted from the virtual current downstream rotational phase to calculate the current downstream rotational phase difference, which is then stored in the memory M64. In step P114, from the current downstream rotational phase difference, the absolute value of the current downstream rotational phase difference is calculated and then stored in the memory M65.

Next, in step P115, the tolerance of the current downstream rotational phase difference is read from the memory M66. In step P116, it is judged whether the absolute value of the current downstream rotational phase difference is equal to or less than the tolerance of the current downstream rotational phase difference.

Next, if yes in step P116, the current setting rotational speed is read from the memory M60 in step P117. Thereafter in step P118, the memory M67 for storing the instruction rotational speed is overwritten with the current setting rotational speed. Subsequently, in step P119, the instruction rotational speed is outputted to the downstream drive motor driver 92, and the process returns to step P106.

If no in step P116, in step P120, the current downstream rotational phase difference-setting rotational speed compensation value conversion table is read from the memory M68, and in step P121, the current downstream rotational phase difference is read from the memory M64.

Next, in step P122, by using the current downstream rotational phase difference-setting rotational speed compensation value conversion table, the setting rotational speed compensation value is obtained from the current downstream rotational phase difference and is stored in the memory M69. In step P123, the current setting rotational speed is read from the memory M60.

Next, in step P124, the current setting rotational speed is added to the setting rotational speed compensation value to calculate the instruction rotational speed, which is then stored in the memory M67. In step P125, the instruction rotational speed is outputted to the downstream drive motor driver 92, and the process returns to step P106.

Next, in step P126 to which the process proceeds from step P110, it is judged whether the clock pulse is outputted from the downstream rotational phase detection rotary encoder 20B. If yes in step P126, in step P127, the standard rotational speed of the downstream load motor 18B is read from the load motor standard rotational speed setting unit 97, and is stored in the memory M71 for storing the rotational speed of the downstream load motor.

Next, in step P128, the count value is read from the current downstream rotational phase detection counter 94 and is stored in the memory M62. In step P129, from the count value of the current downstream rotational phase detection counter 94, the current downstream rotational phase is calculated and then stored in the memory M63.

Next, in step P130, the suction cylinder-notch move-up start rotational phase is read from the memory M72, and in step P131, the suction cylinder-notch move-up finish rotational phase is read from the memory M73.

Next, in step P132, it is judged whether the current downstream rotational phase is equal to or more than the suction cylinder-notch move-up start rotational phase, and is equal to or less than the suction cylinder-notch move-up finish rotational phase. If yes in step P132, in step P133, the rotational speed of the downstream load motor 18B is read from the memory M71, and if no, the process proceeds to later-described step P136.

Next, in step P134, the load motor rotational speed compensation value related to move-up of the notch of the suction cylinder 7 of the convertible press mechanism 2 is read from the memory M74 and, in step P135, is then subtracted from the rotational speed of the downstream load motor 18B. The memory M71 for storing the rotational speed of the downstream load motor is overwritten with the obtained value.

Next, the rotational speed of the downstream load motor 18B is read from the memory M71 in step P136, and is then outputted to the downstream load motor driver 99 in step P137.

Next, in step P138, the count value is read from the acceleration/deceleration counter 96 and is stored in the memory M75. In step P139, the electric current value is read from the downstream drive motor driver 92 and is stored in the memory M76.

Next, the standard electric current value is read from the memory M77 in step P140, and is subtracted from the electric current value to calculate the electric current value difference in step P141, which is then stored in the memory M78.

Next, in step P142, the electric current value difference-load motor rotational speed compensation value conversion table is read from the memory M79. In step P143, by using the electric current value difference-load motor rotational speed compensation value conversion table, the load motor rotational speed compensation value is obtained from the electric current value difference and is stored in the memory M80.

Next, in step P144, the rotational speed of the downstream load motor 18B is read from the memory M71. In step P145, the load motor rotational speed compensation value is subtracted from the rotational speed of the downstream load motor 18B to calculate the compensated rotational speed of the downstream load motor 18B, which is then stored in the memory M81.

Next, in step P146, the setting rotational speed at teaching is read from the memory M70, and in step P147, the count value of the acceleration/deceleration counter 96 is read from the memory M75. Subsequently, in step P148, the compensated rotational speed of the downstream load motor 18B is stored at the address position of the memory M84 for storing the rotational speed of the downstream load motor at deceleration, the address position corresponding to the count value of the acceleration/deceleration counter 96 for the setting rotational speed at teaching. Then, the process returns to step P126.

If no in step P126, in step P149, it is judged whether the current setting rotational speed and the corrected virtual current downstream rotational phase are sent from the virtual master generator 60. If yes in step P149, in step P150, the current setting rotational speed and the corrected virtual current downstream rotational phase are received from the virtual master generator 60, and are stored in the memory M60 for storing the current setting rotational speed and the memory M61 for storing the virtual current downstream rotational phase, respectively.

If no in step P149, in step P151, it is judged whether the teaching finish signal is sent from the virtual master generator 60. If yes in step P151, the process returns to step P1, and if no, the process returns to step P126.

Next, in step P152, the count value is read from the current downstream rotational phase detection counter 94 and is stored in the memory M62. In step P153, from the count value of the current downstream rotational phase detection counter 94, the current downstream rotational phase is calculated and then stored in the memory M63.

Next, in step P154, the current downstream rotational phase is subtracted from the virtual current downstream rotational phase to calculate the current downstream rotational phase difference, which is then stored in the memory M64. In step P155, from the current downstream rotational phase difference, the absolute value of the current downstream rotational phase difference is calculated and then stored in the memory M65.

Next, in step P156, the tolerance of the current downstream rotational phase difference is read from the memory M66. In step P157, it is judged whether the absolute value of the current downstream rotational phase difference is equal to or less than the tolerance of the current downstream rotational phase difference.

If yes in step P157, the current setting rotational speed is read from the memory M60 in step P158. Thereafter, the memory M67 for storing the instruction rotational speed is overwritten with the current setting rotational speed in step P159. Subsequently, in step P160, the instruction rotational speed is outputted to the downstream drive motor driver 92, and the process returns to step P126.

On the other hand, if no in step P157, in step P161, the current downstream rotational phase difference-setting rotational speed compensation value conversion table is read from the memory M68. In step P162, the current downstream rotational phase difference is then read from the memory M64.

Next, in step P163, by using the current downstream rotational phase difference-setting rotational speed compensation value conversion table, the setting rotational speed compensation value is obtained from the current downstream rotational phase difference and is stored in the memory M69. In step P164, the current setting rotational speed is then read from the memory M60.

Next, in step P165, the current setting rotational speed is added to the setting rotational speed compensation value to calculate the instruction rotational speed, which is then stored in the memory M67. In step P166, the instruction rotational speed is outputted to the downstream drive motor driver 92, and the process returns to step P126.

Next, in step P167 to which the process proceeds from step P1, it is judged whether the instruction to start synchronizing operation is sent from the virtual master generator 60. If yes, in step P168, it is judged whether the instruction to start home position alignment is sent from the virtual master generator 60. If no, the process proceeds to later-described step P245.

If yes in step P168, in step P170, it is judged whether the current setting rotational speed (slow) and the corrected virtual current downstream rotational phase are sent from the virtual master generator 60. If no in step P168, in step P169, it is judged whether the instruction to stop synchronizing operation is sent from the virtual master generator 60. If yes in step P169, the process proceeds to later-described step P245, and if no, the process returns to step P168.

If yes in step P170, in step P171, the current setting rotational speed (slow) and the corrected virtual current downstream rotational phase are received from the virtual master generator 60, and are stored in the memory M60 for storing the current setting rotational speed and the memory M61 for storing the virtual current downstream rotational phase, respectively. In step P172, the count value is read from the current downstream rotational phase detection counter 94 and is stored in the memory M62.

Next, in step P173, from the count value of the current downstream rotational phase detection counter 94, the current downstream rotational phase is calculated and then stored in the memory M63. In step P174, the current downstream rotational phase is subtracted from the virtual current downstream rotational phase to calculate the current downstream rotational phase difference, which is then stored in the memory M64.

Next, in step P175, from the current downstream rotational phase difference, the absolute value of the current downstream rotational phase difference is calculated and then stored in the memory M65. In step P176, the tolerance of the current downstream rotational phase difference is read from the memory M66.

Next, in step P177, it is judged whether the absolute value of the current downstream rotational phase difference is equal to or less than the tolerance of the current downstream rotational phase difference. If yes in step P177, in step P178, the current setting rotational speed (slow) is read from the memory M60, and if no, the process proceeds to later-described step P182.

Next, in step P179, the memory M67 for storing the instruction rotational speed is overwritten with the current setting rotational speed (slow), and in step P180, the instruction rotational speed is outputted to the downstream drive motor driver 92. Subsequently, in step P181, the home position alignment completion signal is sent to the virtual master generator 60. The process then returns to step P170.

Next, in step P182, the current downstream rotational phase difference-setting rotational speed compensation value conversion table is read from the memory M68. In step P183, the current downstream rotational phase difference is read from the memory M64.

Next, in step P184, by using the current downstream rotational phase difference-setting rotational speed compensation value conversion table, the setting rotational speed compensation value is obtained from the current downstream rotational phase difference and is stored in the memory M69. In step P185, the current setting rotational speed (slow) is read from the memory M60.

Next, in step P186, the current setting rotational speed (slow) is added to the setting rotational speed compensation value to calculate the instruction rotational speed, which is then stored in the memory M67. In step P187, the instruction rotational speed is outputted to the downstream drive motor driver 92, and the process returns to step P170.

On the other hand, if no in step P170, in step P188, it is judged whether the acceleration signal and the setting rotational speed at synchronizing operation are sent from the virtual master generator 60. If yes in step P188, in step P189, the setting rotational speed at synchronizing operation is received from the virtual master generator 60, and is stored in the memory M85 for storing the setting rotational speed at synchronizing operation. If no in step P188, the process returns to step P170.

Next, in step P190, the reset and enable signals are outputted to the acceleration/deceleration counter 96, and in step P191, the output of the reset signal to the acceleration/deceleration counter 96 is stopped.

In step P192, it is judged whether the current state of the printing press, the current setting rotational speed and the corrected virtual current downstream rotational phase are sent from the virtual master generator 60. If yes in step P192, in step P193, the current state of the printing press, the current setting rotational speed and the corrected virtual current downstream rotational phase are received from the virtual master generator 60, and are stored in the memory M86 for storing the current state of the printing press, the memory M60 for storing the current setting rotational speed and the memory M61 for storing the virtual current downstream rotational phase, respectively.

If no in step P192, in step P194, it is judged whether the deceleration signal is sent from the virtual master generator 60. If yes in step P194, in step P195, the reset and enable signals are outputted to the acceleration/deceleration counter 96, and in step P196, the output of the reset signal to the acceleration/deceleration counter 96 is then stopped. The process then proceeds to later-described step P223. If no in step P194, the process returns to step P192.

Next, in step P197, the current state of the printing press is read from the memory M86, and in step P198, it is judged whether the current state of the printing press is equal to 1. If yes in step P198, in step P199, the setting rotational speed at synchronizing operation is read from the memory M85.

Next, in step P200, the count value is read from the acceleration/deceleration counter 96 and is stored in the memory M75. In step P201, the rotational speed of the downstream load motor 18B is read from an address position of the memory M82 for storing the rotational speed of the downstream load motor at acceleration, the address position corresponding to the count value of the acceleration/deceleration counter 96 for the setting rotational speed at synchronizing operation. Then the rotational speed of the downstream load motor 18B is stored in the memory M71. Note that, the address position of the memory M82 for storing the rotational speed of the downstream load motor at acceleration, the address position corresponding to the count value of the acceleration/deceleration counter 96 for the setting rotational speed at synchronizing operation, corresponds to the address position of the memory M82, the address position corresponding to the count value of the acceleration/deceleration counter 96 for the setting rotational speed at teaching, the memory M55 storing the compensated rotational speed of the downstream load motor 18B in step P47 when the setting rotational speed at teaching is the same as that at synchronizing operation and when the acceleration/deceleration counter 96 has a same count value.

Next, in step P202, the rotational speed of the downstream load motor 18B is outputted to the downstream load motor driver 99, and the process proceeds to later-described step P208.

If no in step P198, in step P203, the setting rotational speed at synchronizing operation is read from the memory M85. In step P204, the count value is read from the current downstream rotational phase detection counter 94 and is stored in the memory M62.

Next, in step P205, from the count value of the current downstream rotational phase detection counter 94, the current downstream rotational phase is calculated and then stored in the memory M63. In step P206, the rotational speed of the downstream load motor 18B is read from an address position of the memory M83 for storing the rotational speed of the downstream load motor at constant-speed operation, the address position corresponding to the setting rotational speed at synchronizing operation for the current downstream rotational phase. Then, the rotational speed of the downstream load motor 18B is stored in the memory M71. Note that, the address position of the memory M83 for storing the rotational speed of the downstream load motor at constant-speed operation, the address position corresponding to the current downstream rotational phase for the setting rotational speed at synchronizing operation, corresponds to the address position of the memory M83, the address position corresponding to the setting rotational speed at teaching for the current downstream rotational phase, the memory M83 storing the compensated rotational speed of the downstream load motor 18B in step P87 when the setting rotational speed at teaching is the same as that at synchronizing operation and when the current downstream rotational phase is the same.

Next, in step P207, the rotational speed of the downstream load motor 18B is outputted to the downstream load motor driver 99. In step P208, the count value is read from the downstream rotational phase detection counter 94 and is stored in the memory M62.

Next, in step P209, from the count value of the current downstream rotational phase detection counter 94, the current downstream rotational phase is calculated and then stored in the memory M63. In step P210, the current downstream rotational phase is subtracted from the virtual current downstream rotational phase to calculate the current downstream rotational phase difference, which is then stored in the memory M64.

Next, in step P211, from the current downstream rotational phase difference, the absolute value of the current downstream rotational phase difference is calculated and then stored in the memory M65. In step P212, the tolerance of the current downstream rotational phase difference is read from the memory M66.

Next, in step P213, it is judged whether the absolute value of the current downstream rotational phase difference is equal to or less than the tolerance of the current downstream rotational phase difference. If yes in step P213, in step P214, the current setting rotational speed is read from the memory M60.

Next, in step P215, the current setting rotational speed is overwritten in the memory M67 for storing the instruction rotational speed. In step P216, the instruction rotational speed is outputted to the downstream drive motor driver 92, and the process then returns to step P192.

On the other hand, if no in step P213, in step P217, the current downstream rotational phase difference-setting rotational speed compensation value conversion table is read from the memory M68. In step P218, the current downstream rotational phase difference is then read from the memory M64.

Next, in step P219, by using the current downstream rotational phase difference-setting rotational speed compensation value conversion table, the setting rotational speed compensation value is calculated from the current downstream rotational phase difference and is stored in the memory M69. In step P220 the current setting rotational speed is read from the memory M60.

Next, in step P221, the current setting rotational speed is added to the setting rotational speed compensation value to calculate the instruction rotational speed, which is then stored in the memory M67. In step P222, the instruction rotational speed is outputted to the downstream drive motor driver 92, and the process returns to step P192.

Next, in step P223 to which the process proceeds from step P196, it is judged whether the current state of the printing press, the current setting rotational speed and the corrected virtual current downstream rotational phase are sent from the virtual master generator 60. If yes in step P223, the process proceeds to step P224, and if no, it is judged in step P225 whether the instruction to stop synchronizing operation is sent from the virtual master generator 60. If yes in this step P225, the process returns to step P168, and if no, the process returns to step P223.

Next, in step P224, the current state of the printing press, the current setting rotational speed and the corrected virtual current downstream rotational phase are received from the virtual master generator 60, and are stored in the memory M86 for storing the current state of the printing press, the memory M60 for storing the current setting rotational speed and the memory M61 for storing the virtual current downstream rotational phase, respectively. In step P226, the setting rotational speed at synchronizing operation is then read from the memory M85.

Next, in step P227, the count value is read from the acceleration/deceleration counter 96 and is stored in the memory M75. In step P228, the rotational speed of the downstream load motor 18B is read from an address position of the memory M84 for storing the rotational speed of the downstream load motor at deceleration, the address position corresponding to the count value of the acceleration/deceleration counter 96 for the rotational speed of the downstream load motor 18B at deceleration. Then, the rotational speed of the downstream load motor 18B is stored in the memory M71. Note that, the address position of the memory M84 for storing the rotational speed of the downstream load motor at deceleration, the address position corresponding to the count value of the acceleration/deceleration counter 96 for the rotational speed of the downstream load motor 18B at deceleration, corresponds to the address position of the memory M84, the address position corresponding to the count value of the acceleration/deceleration counter 96 for the setting rotational speed at teaching, the memory M84 storing the compensated rotational speed of the downstream load motor 18B in step P148 when the setting rotational speed at teaching is the same as that at synchronizing operation and when the acceleration/deceleration counter 96 has a same count value.

Next, in step P229, the rotational speed of the downstream load motor 18B is outputted to the downstream load motor driver 99. In step P230, the count value is read from the current downstream rotational phase detection counter 94 and is stored in the memory M62.

Next, in step P231, from the count value of the current downstream rotational phase detection counter 94, the current downstream rotational phase is calculated and then stored in the memory M63. In step P232, the current downstream rotational phase is subtracted from the virtual current downstream rotational phase to calculate the current downstream rotational phase difference, which is then stored in the memory M64.

Next, in step P233, from the current downstream rotational phase difference, the absolute value of the current downstream rotational phase difference is calculated and then stored in the memory M65. In step P234, the tolerance of the current downstream rotational phase difference is read from the memory M66.

Next, in step P235, it is judged whether the absolute value of the current downstream rotational phase difference is equal to or less than the tolerance of the current downstream rotational phase difference. If yes in step P235, in step P236, the current setting rotational speed is read from the memory M60.

Next, in step P237, the memory M67 for storing the instruction rotational speed is overwritten with the current setting rotational speed. In step P238, the instruction rotational speed is outputted to the downstream drive motor driver 92, and the process then returns to step P223.

If no in step P235, in step P239, the current downstream rotational phase difference-setting rotational speed compensation value conversion table is read from the memory M68. In step P240, the current downstream rotational phase difference is read from the memory M64.

Next, in step P241, by using the current downstream rotational phase difference-setting rotational speed compensation value conversion table, the setting rotational speed compensation value is obtained from the current downstream rotational phase difference and is stored in the memory M69. In step P242, the current setting rotational speed is read from the memory M60.

Next, in step P243, the current setting rotational speed is added to the setting rotational speed compensation value to calculate the instruction rotational speed, which is then stored in the memory M67. In step P244, the instruction rotational speed is outputted to the downstream drive motor driver 92, and the process returns to step P223.

Next, in step P245 to which the process proceeds from step P167, it is judged whether the setting rotational speed is inputted to the downstream single drive rotational speed setting unit 100. If yes in step P245, in step P246, the setting rotational speed is read from the downstream single drive rotational speed setting unit 100, and is stored in the memory M60 for storing the current setting rotational speed. The process then proceeds to step P247. If no in step P245, the process directly proceeds to step P247.

Next, in step P247, it is judged whether the downstream single drive switch 101 is turned on. If yes in step P247, in step P248, the current setting rotational speed is read from the memory M60, and if no, the process returns to step P1.

Next, in step P249, the current setting rotational speed is written in the memory M67 for storing the instruction rotational speed, and in step P250, the instruction rotational speed is outputted to the downstream drive motor driver 92.

Next, when the downstream stop switch 102 is turned on in step P251, in step P252, the stop instruction is outputted to the downstream drive motor driver 92. The process then returns to step P1. Hereinafter, the aforementioned processes are repeated.

According to the above-described operational flows, by the instructions from the virtual master generator 60, through the downstream printing unit group drive controller 90A, the teaching processing and synchronizing operation processing of the downstream drive motor 10B are performed, and the braking force control is carried out by the downstream load motor 18B at the synchronizing operation.

As described above, in this embodiment, the upstream and downstream drive motors 10A and 10B separately provide driving forces in such a way that the upstream printing unit group 1A and the transfer cylinder 6 of the convertible press mechanism 2 are driven by the upstream drive motor 10A and the downstream printing unit group 1B and the suction cylinder 7 and convertible cylinder 8 of the convertible press mechanism 2 are driven by the downstream drive motor 10B. Accordingly, the upstream and downstream drive motors 10A and 10B can be reduced in size and capacity, and the printing press of the present invention can achieve lower cost and operation in higher speed. Furthermore, the upstream and downstream load motors 18A and 18B as the braking units are provided to eliminate non-uniform rotation of the transfer cylinder 6 and suction cylinder 7 of the convertible press mechanism 2. This makes it possible to prevent occurrence of printing faults such as mackle.

Moreover, the braking units are composed of the load motors (torque motors) 18A and 18B. This eliminates the need to replace the components, unlike in the case of brakes, and the braking units can be made maintenance-free. Moreover, the electric power generated by the load motors (torque motors) 18A and 18B are recovered as electric power for driving the drive motors 10A and 10B, thus achieving energy savings.

[Embodiment 2]

Figure 34A:
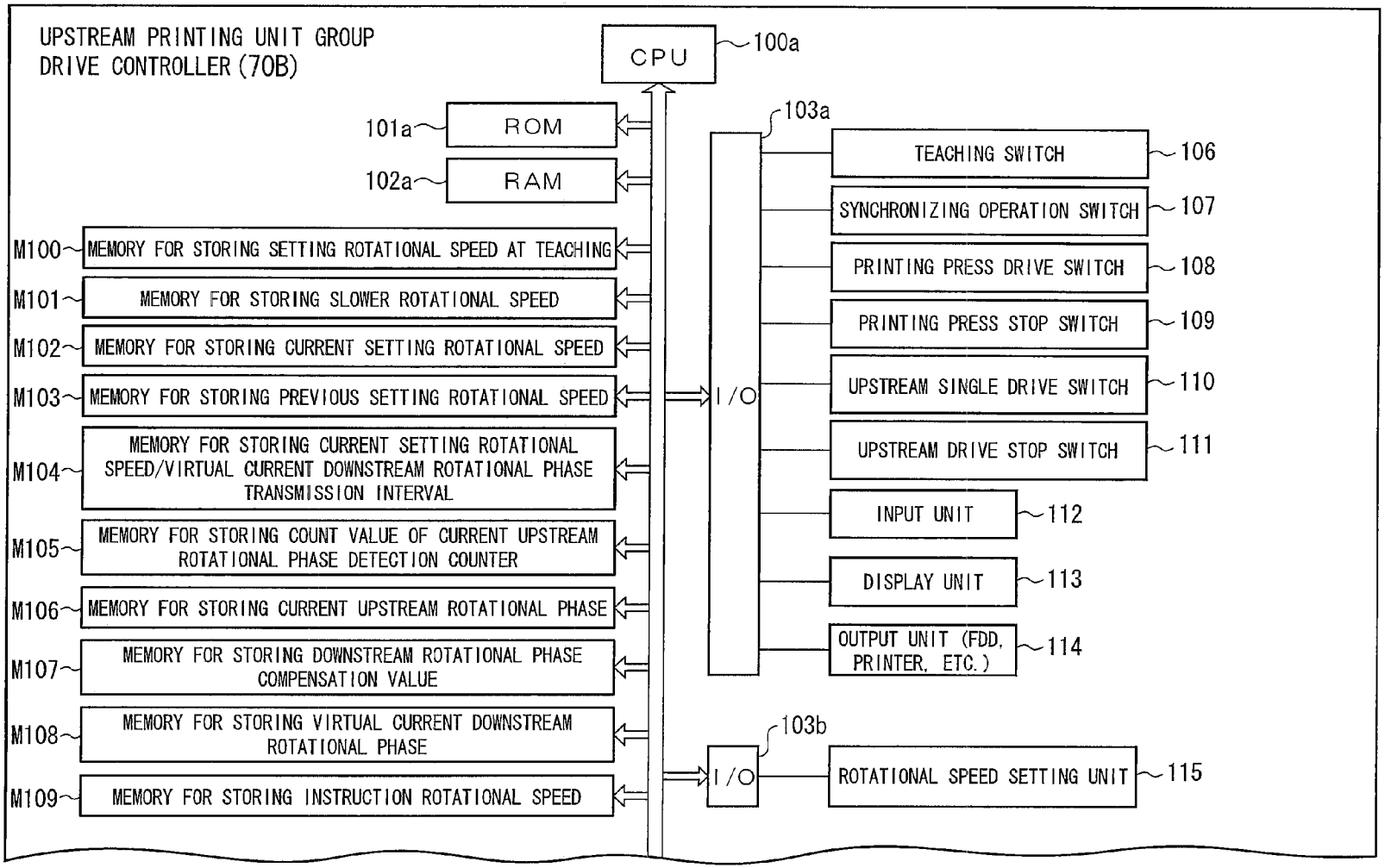
FIG. 34A is a hardware block diagram of an upstream printing unit group drive controller according to Embodiment 2 of the present invention.
Figure 34B:
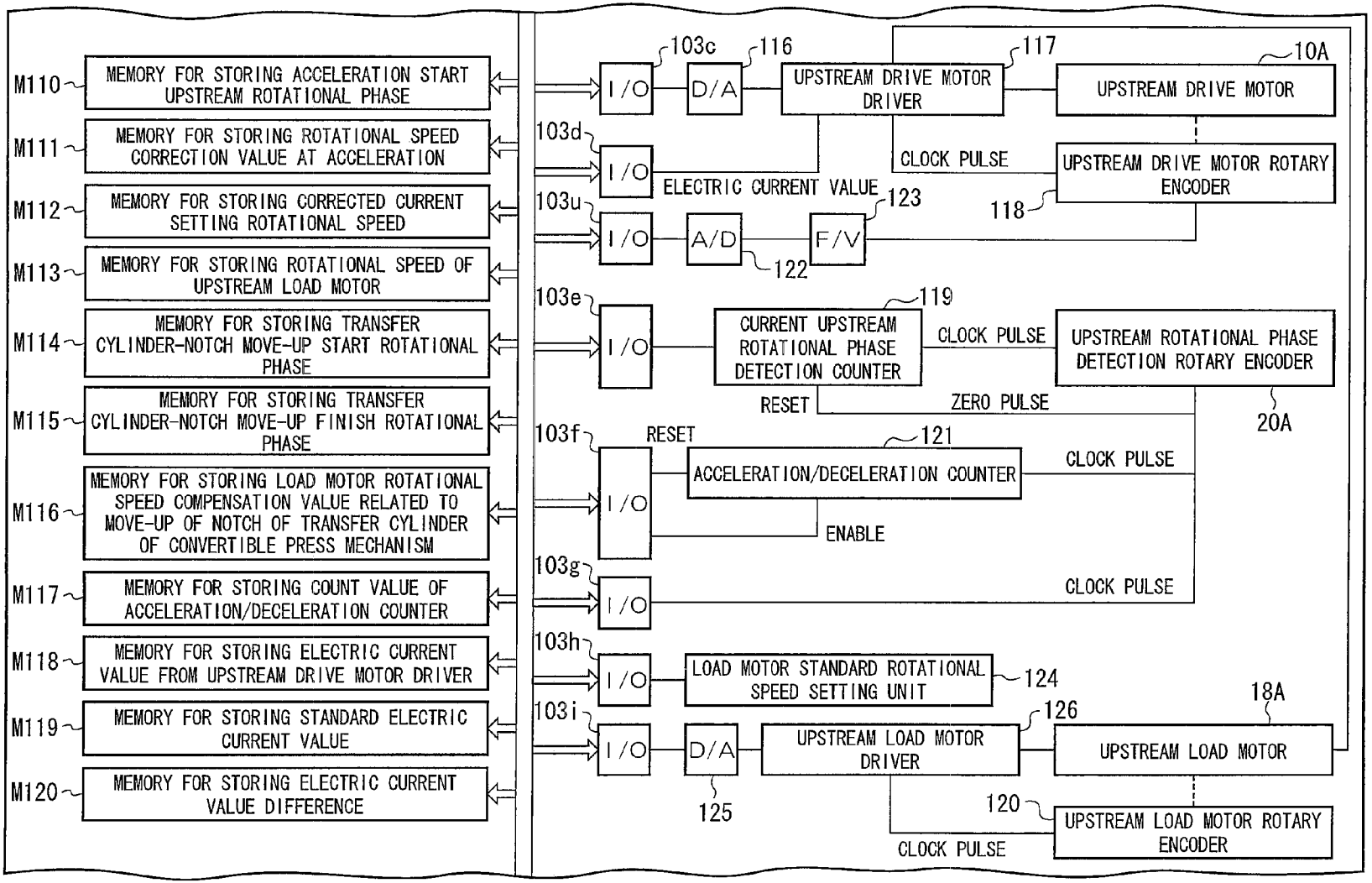
FIG. 34B is a hardware block diagram of the upstream printing unit group drive controller according to Embodiment 2 of the present invention.
Figure 34C:
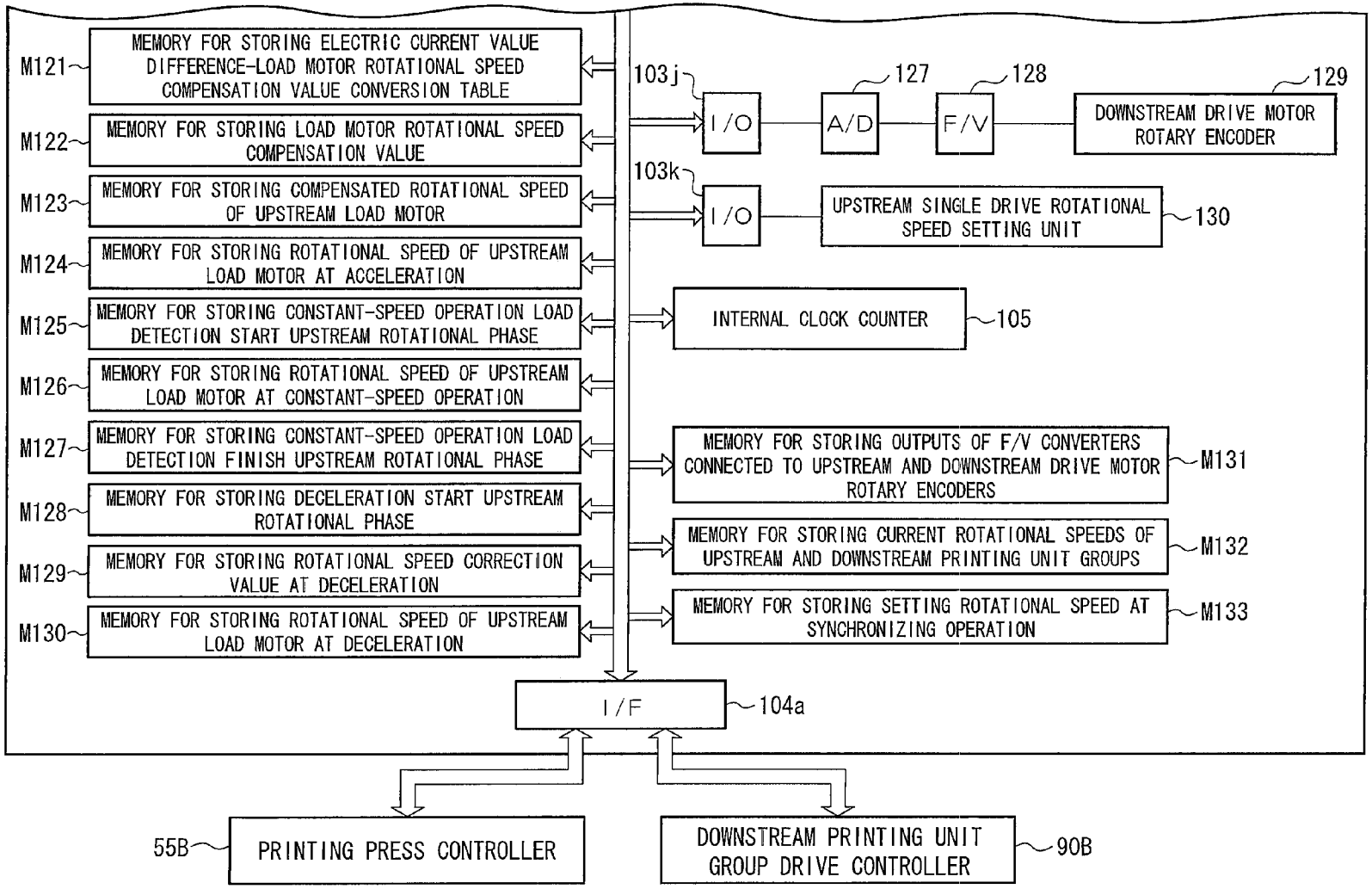
FIG. 34C is a hardware block diagram of the upstream printing unit group drive controller according to Embodiment 2 of the present invention.
Figure 35A:
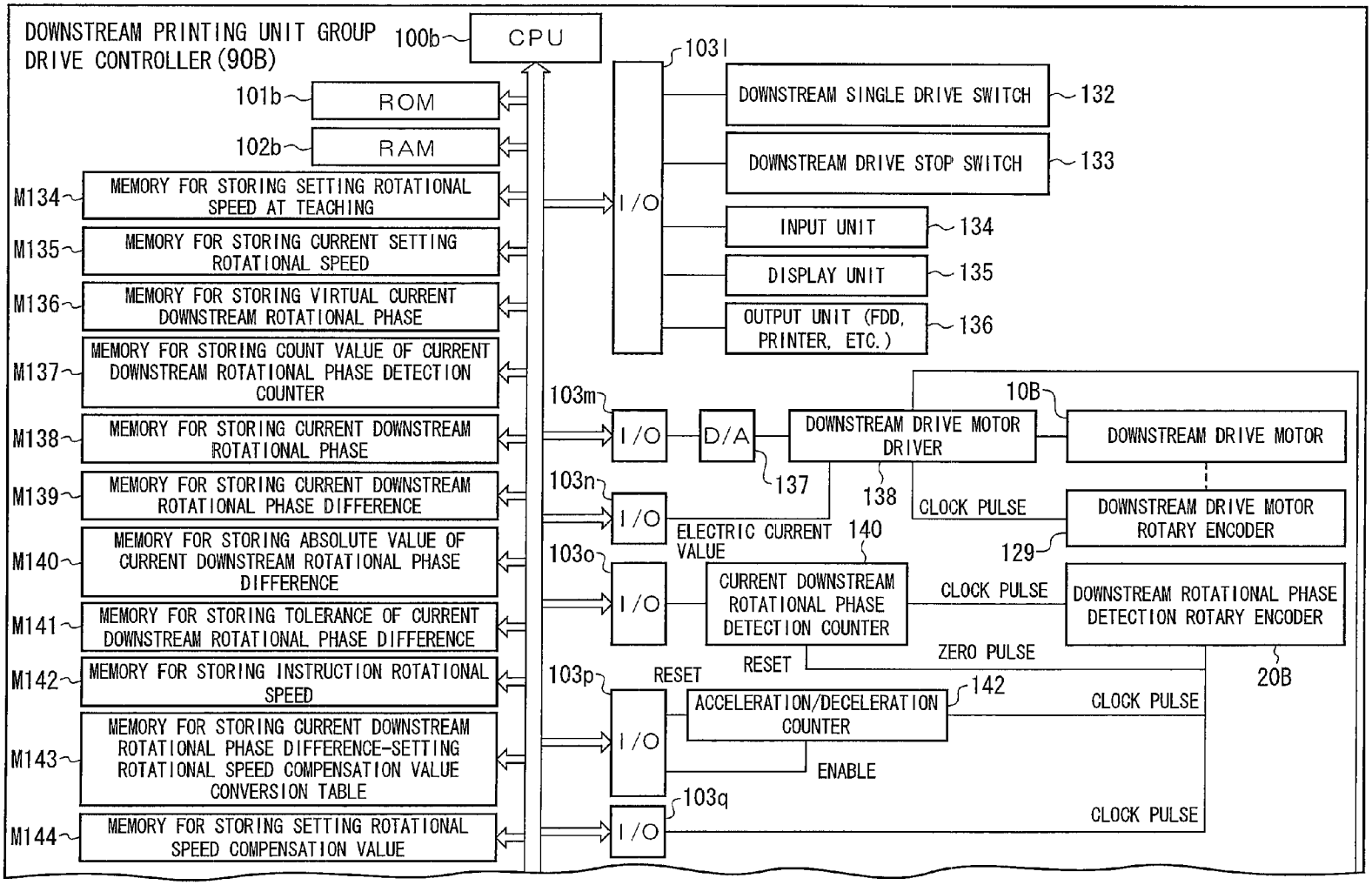
FIG. 35A is a hardware block diagram of a downstream printing unit group drive controller.
Figure 35B:
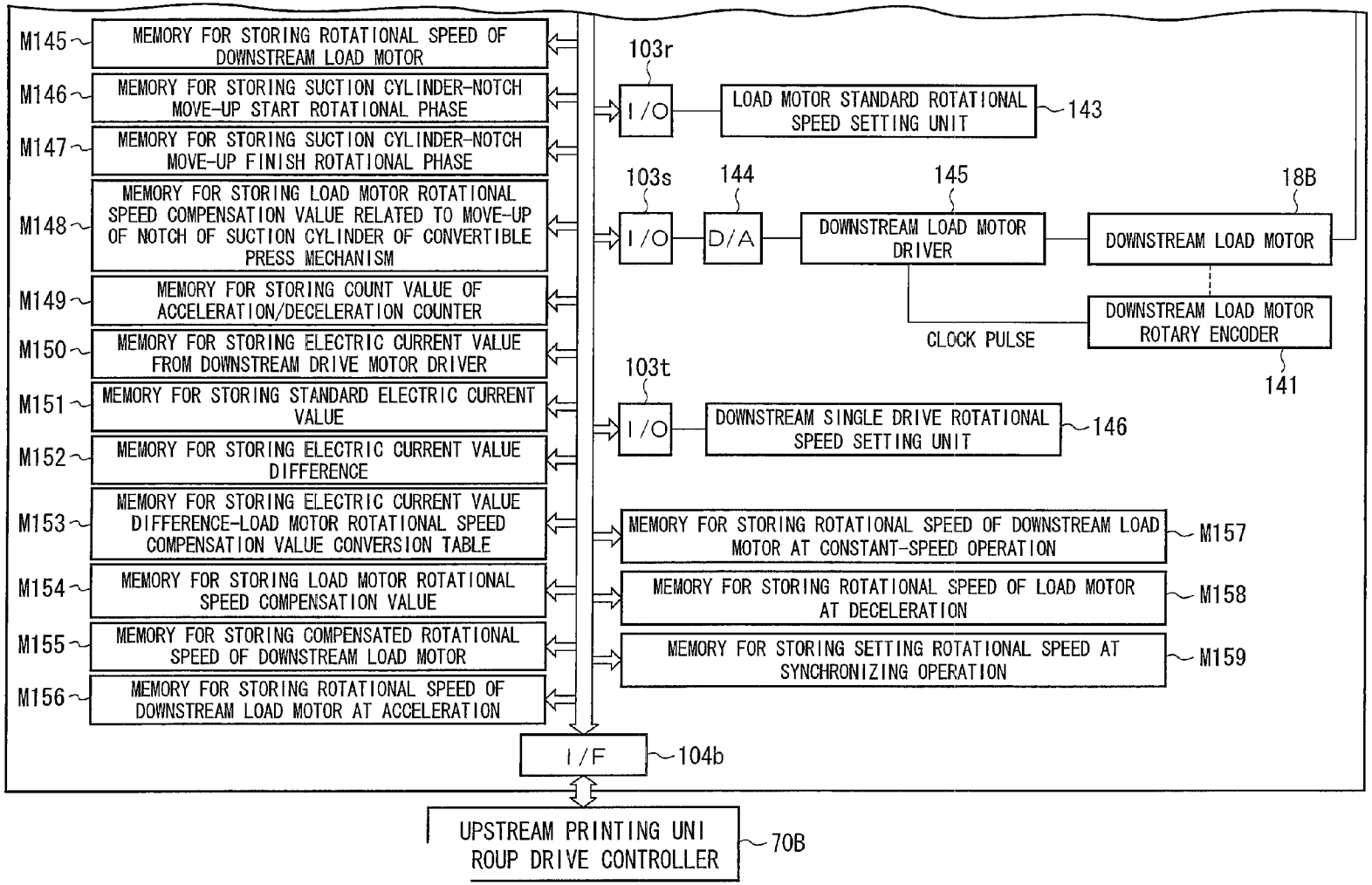
FIG. 35B is a hardware block diagram of a downstream printing unit group drive controller.
Figure 36A:
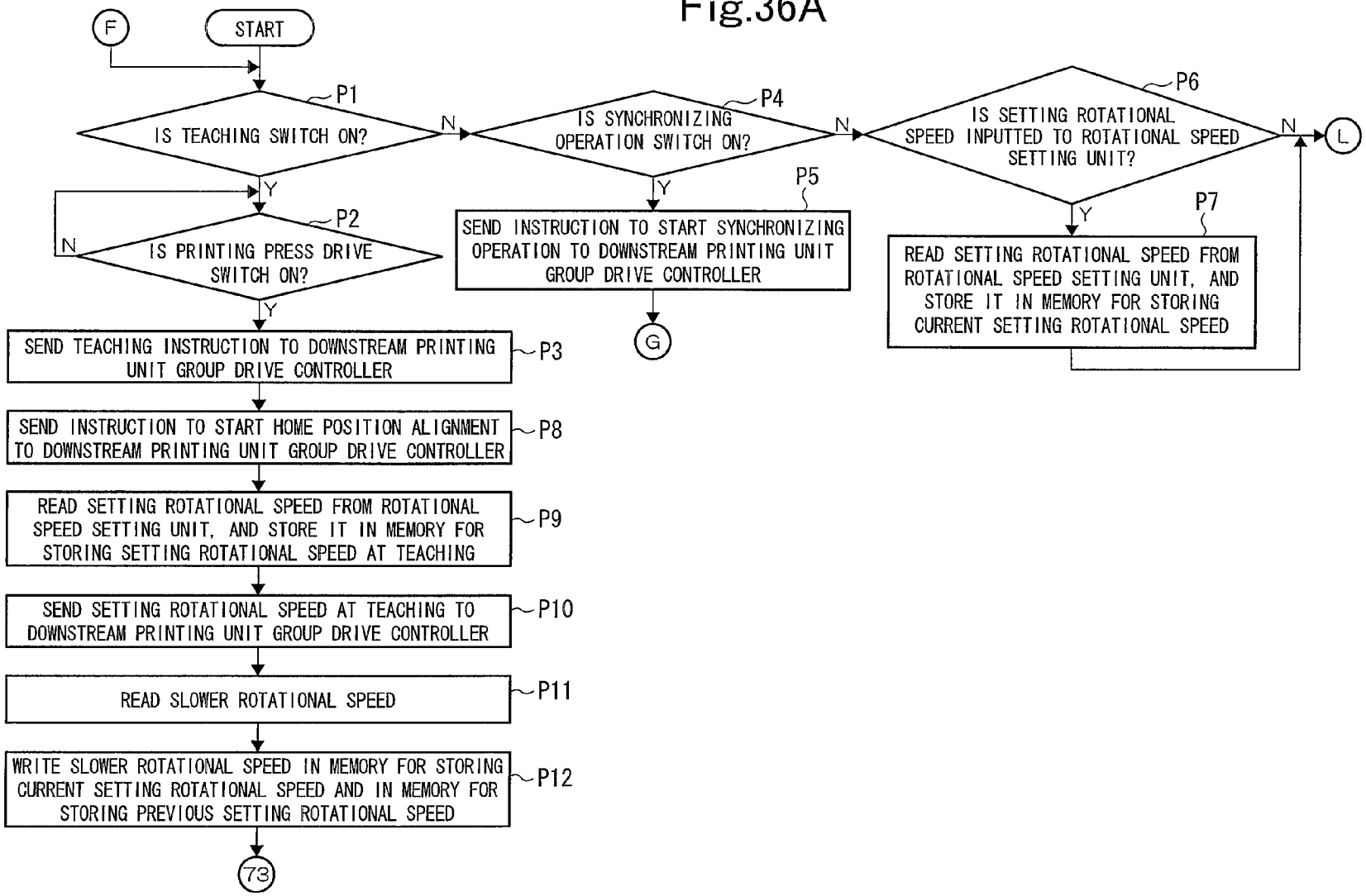
FIG. 36A is an operational flowchart of the upstream printing unit group drive controller.
Figure 36B:
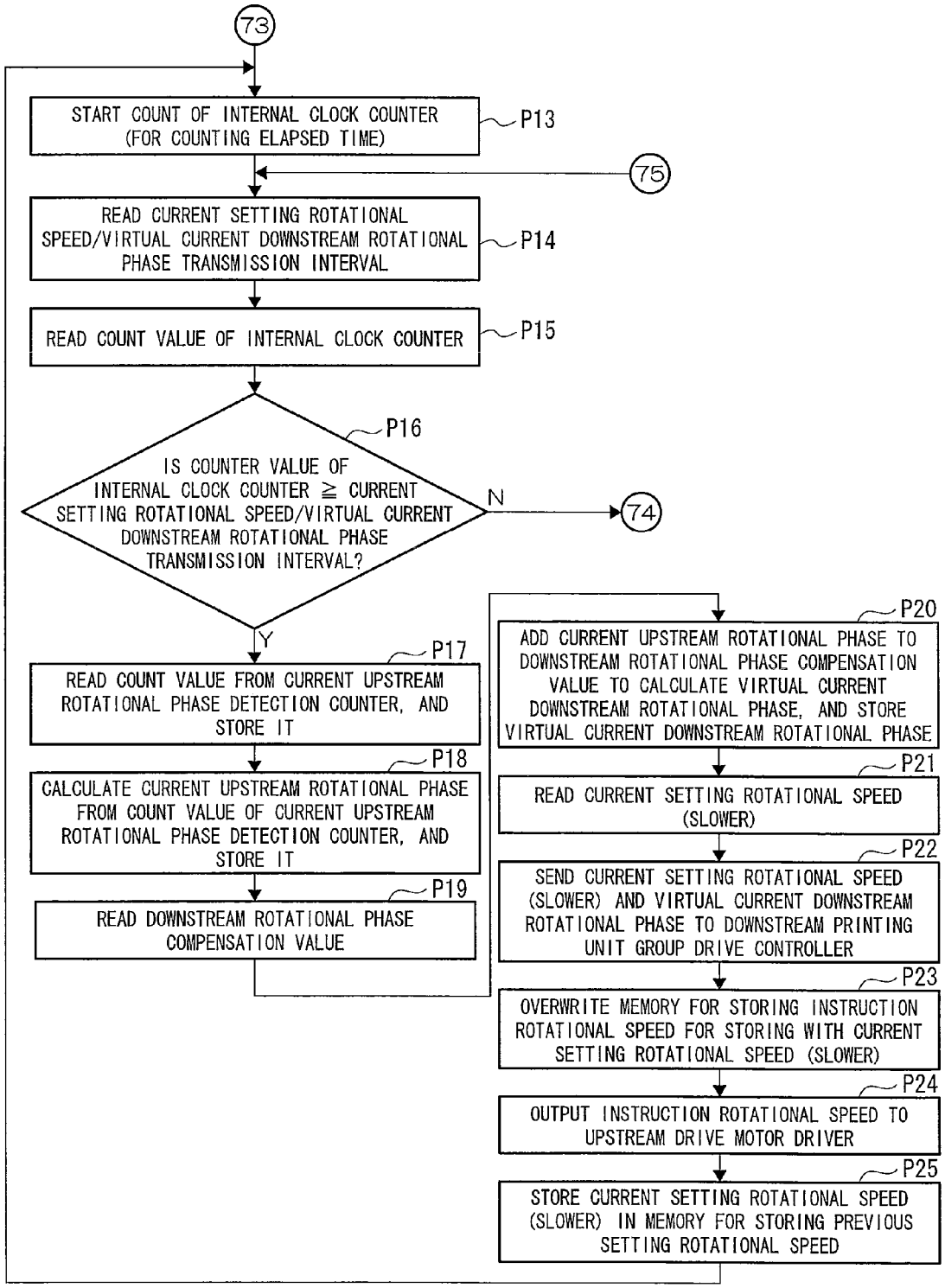
FIG. 36B is an operational flowchart of the upstream printing unit group drive controller.
Figure 36C:
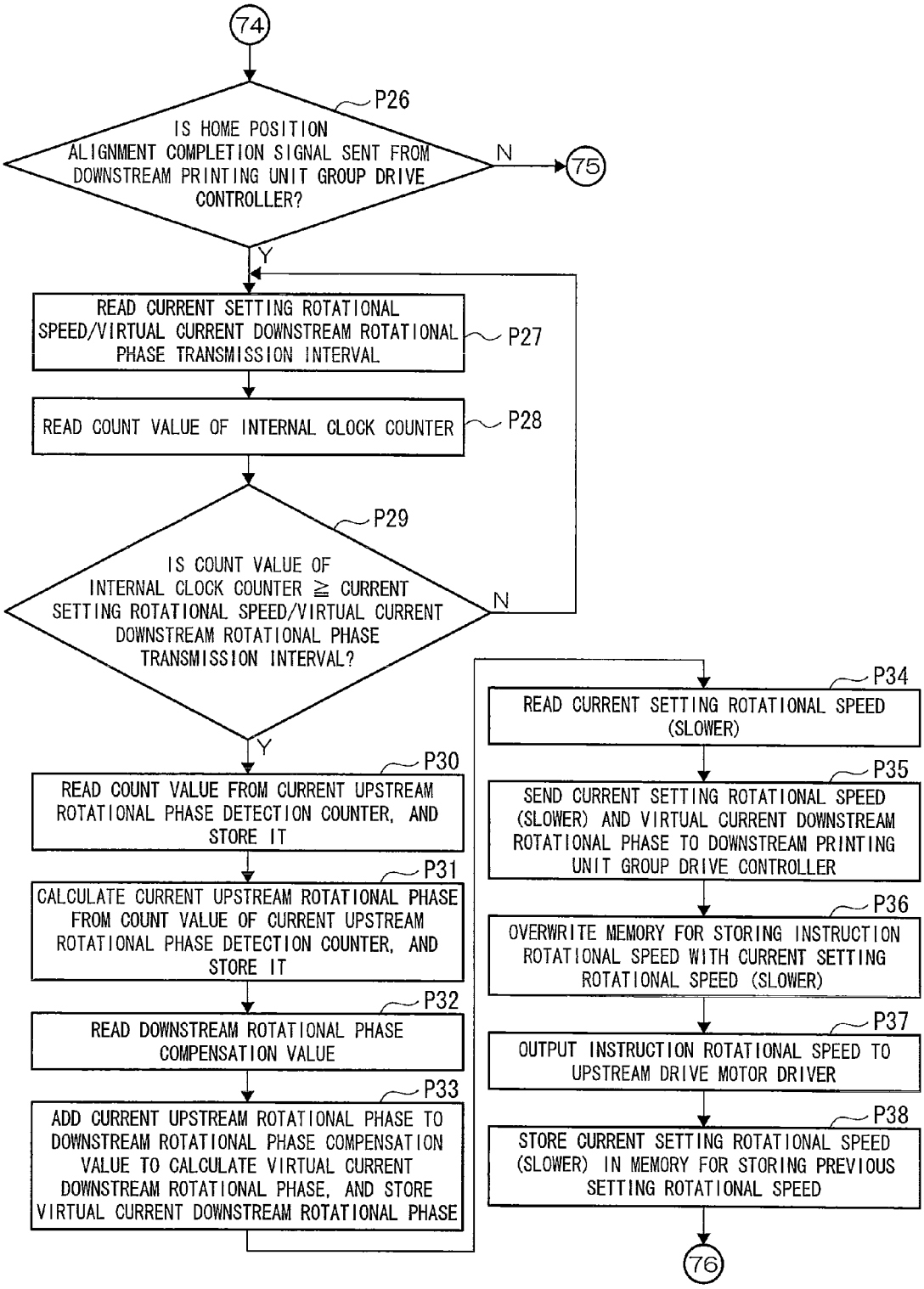
FIG. 36C is an operational flowchart of the upstream printing unit group drive controller.
Figure 36D:
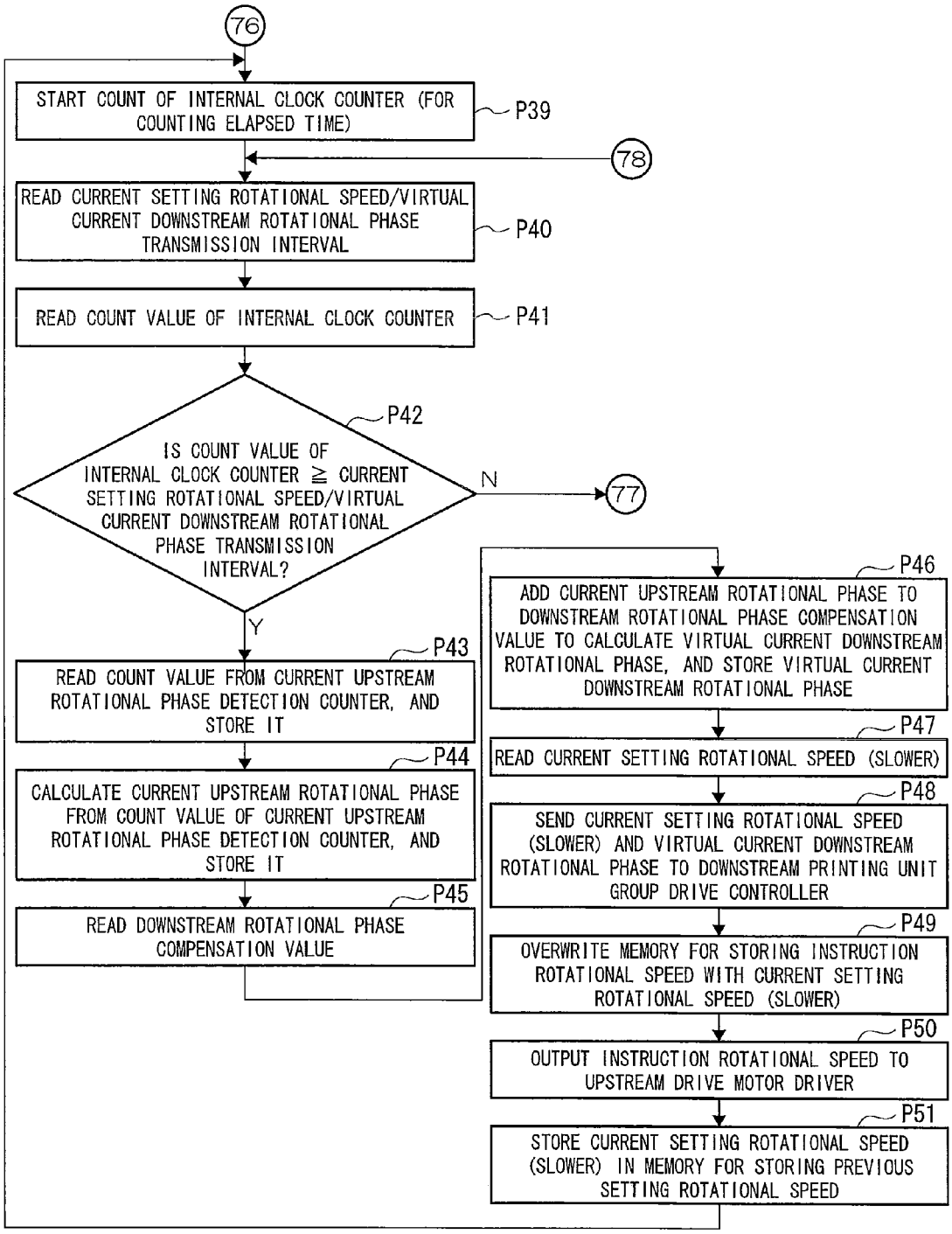
FIG. 36D is an operational flowchart of the upstream printing unit group drive controller.
Figure 36E:
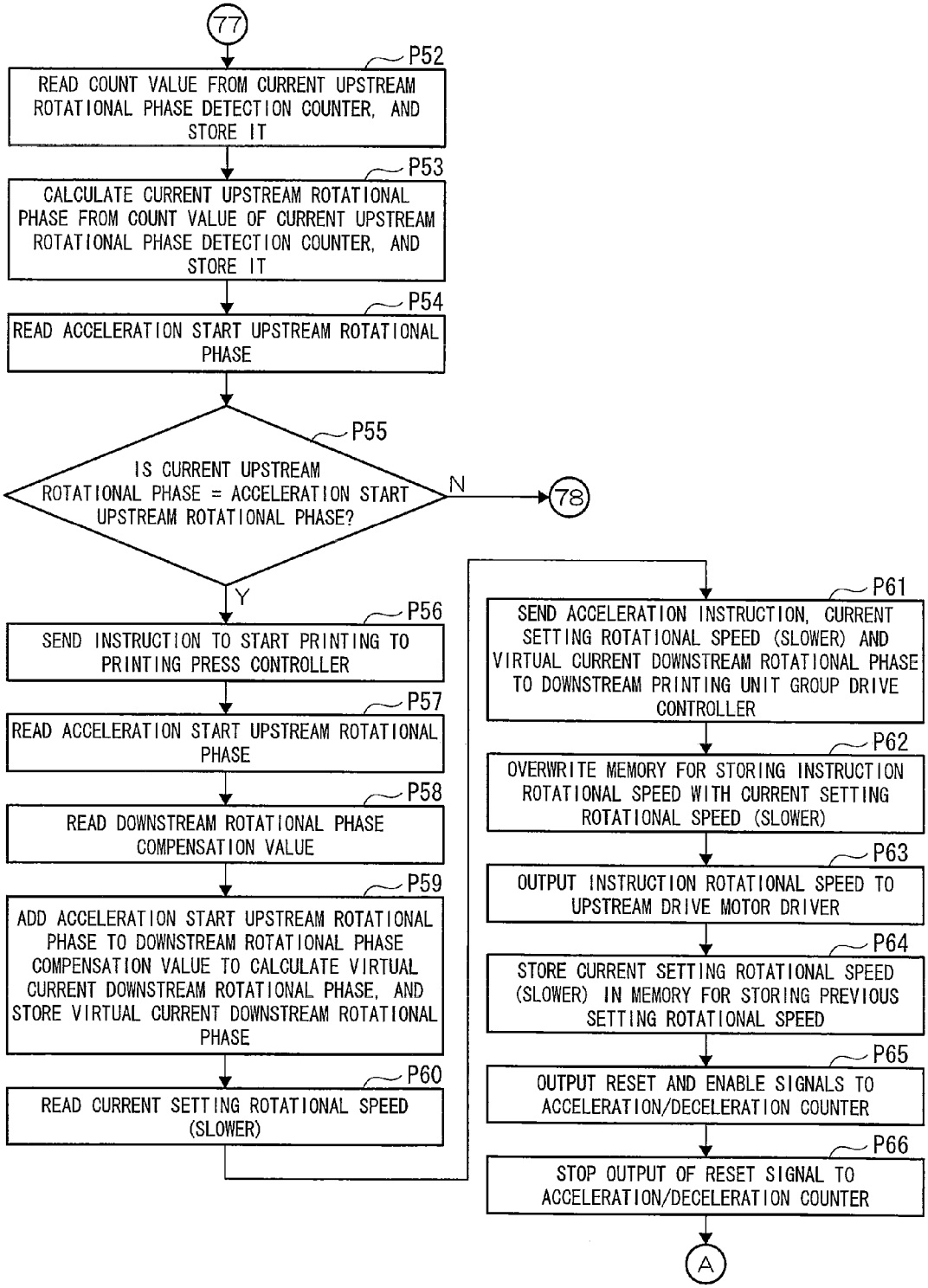
FIG. 36E is an operational flowchart of the upstream printing unit group drive controller.

FIGS. 34A to 35B show Embodiment 2 of the present invention. FIGS. 34A to 34C are hardware block diagrams of an upstream printing unit group drive controller. FIGS. 35A and 35B are hardware block diagrams of a downstream printing unit group drive controller.

Figure 37A:
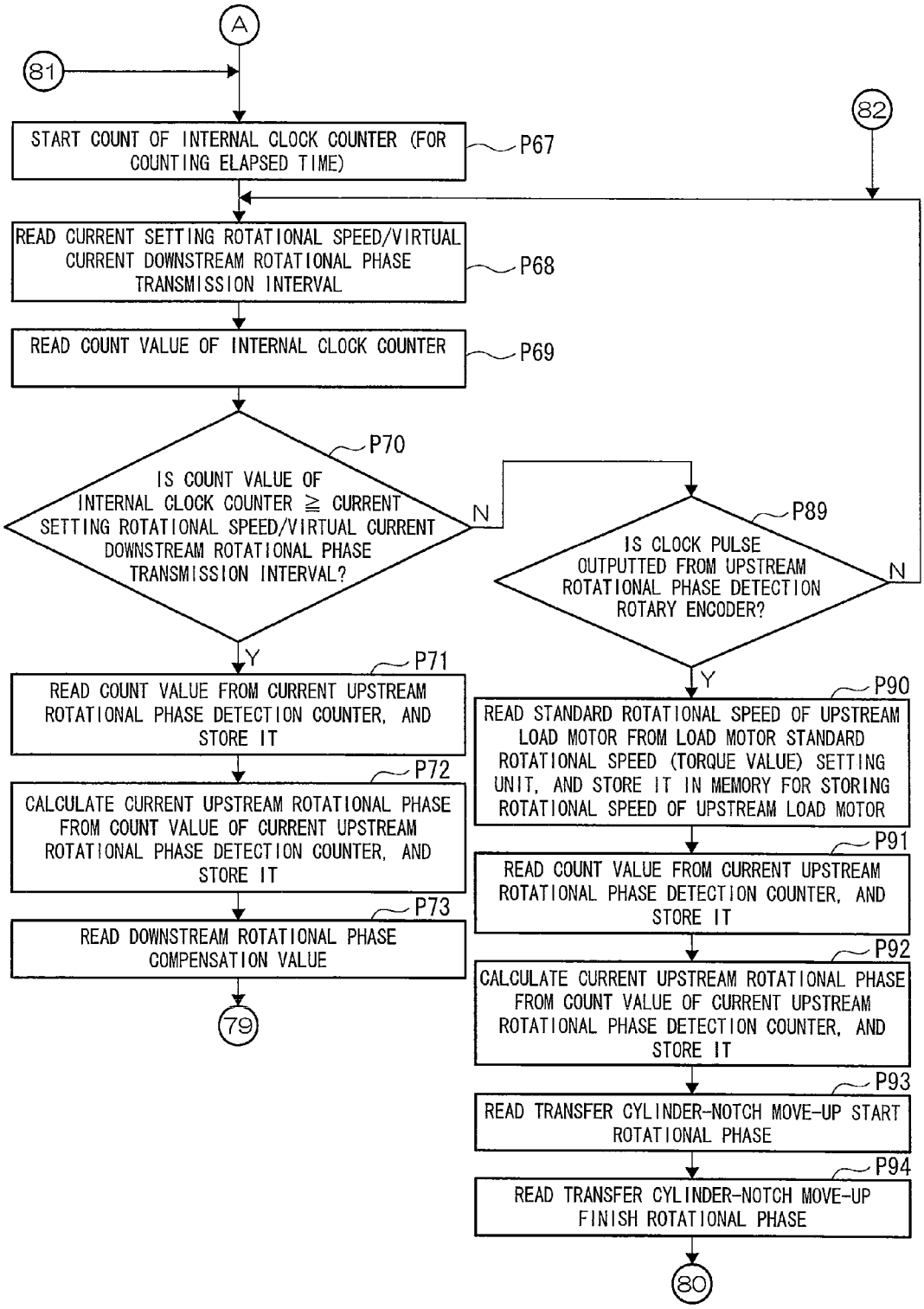
FIG. 37A is an operational flowchart of the upstream printing unit group drive controller.
Figure 37B:
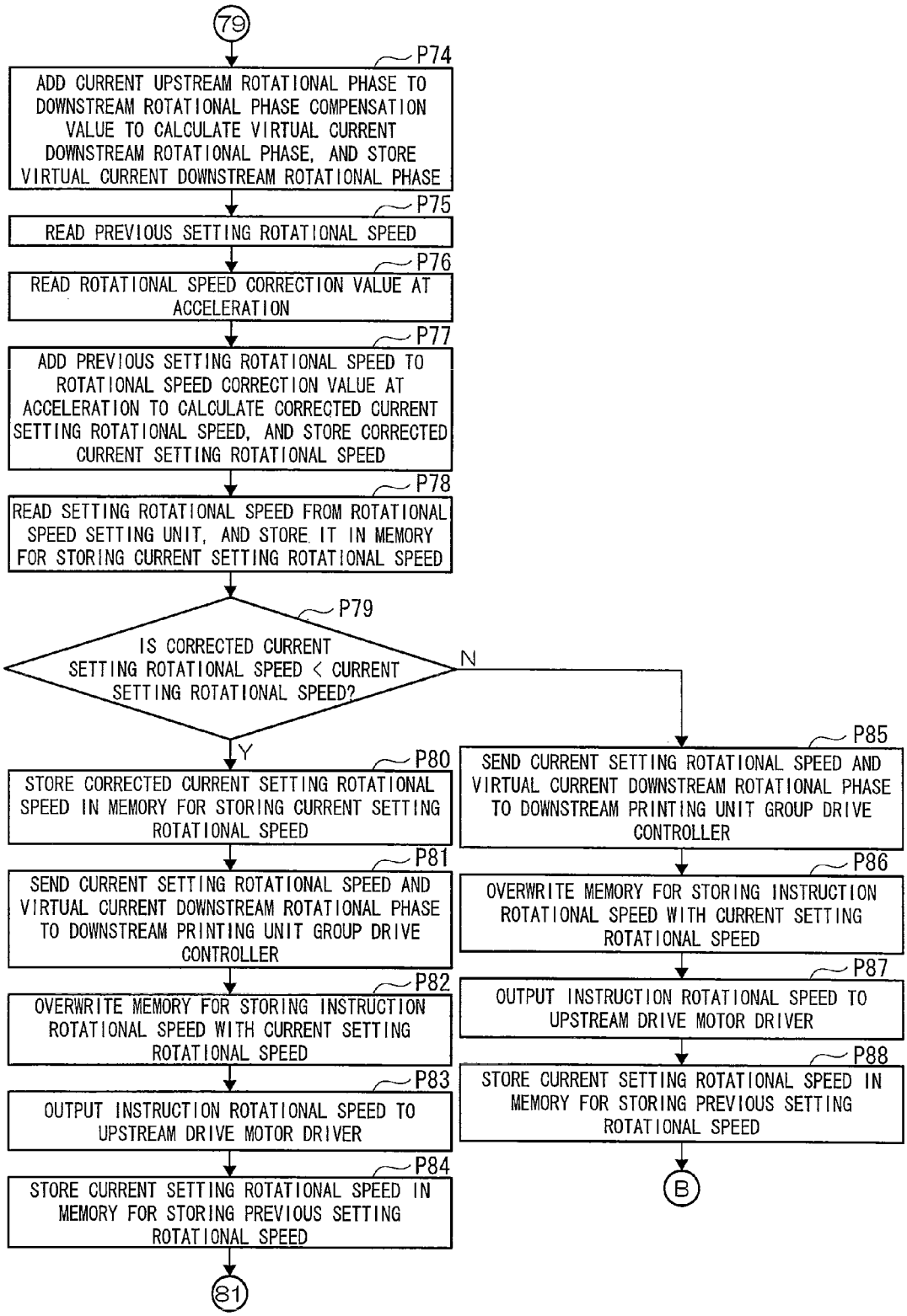
FIG. 37B is an operational flowchart of the upstream printing unit group drive controller.
Figure 37C:
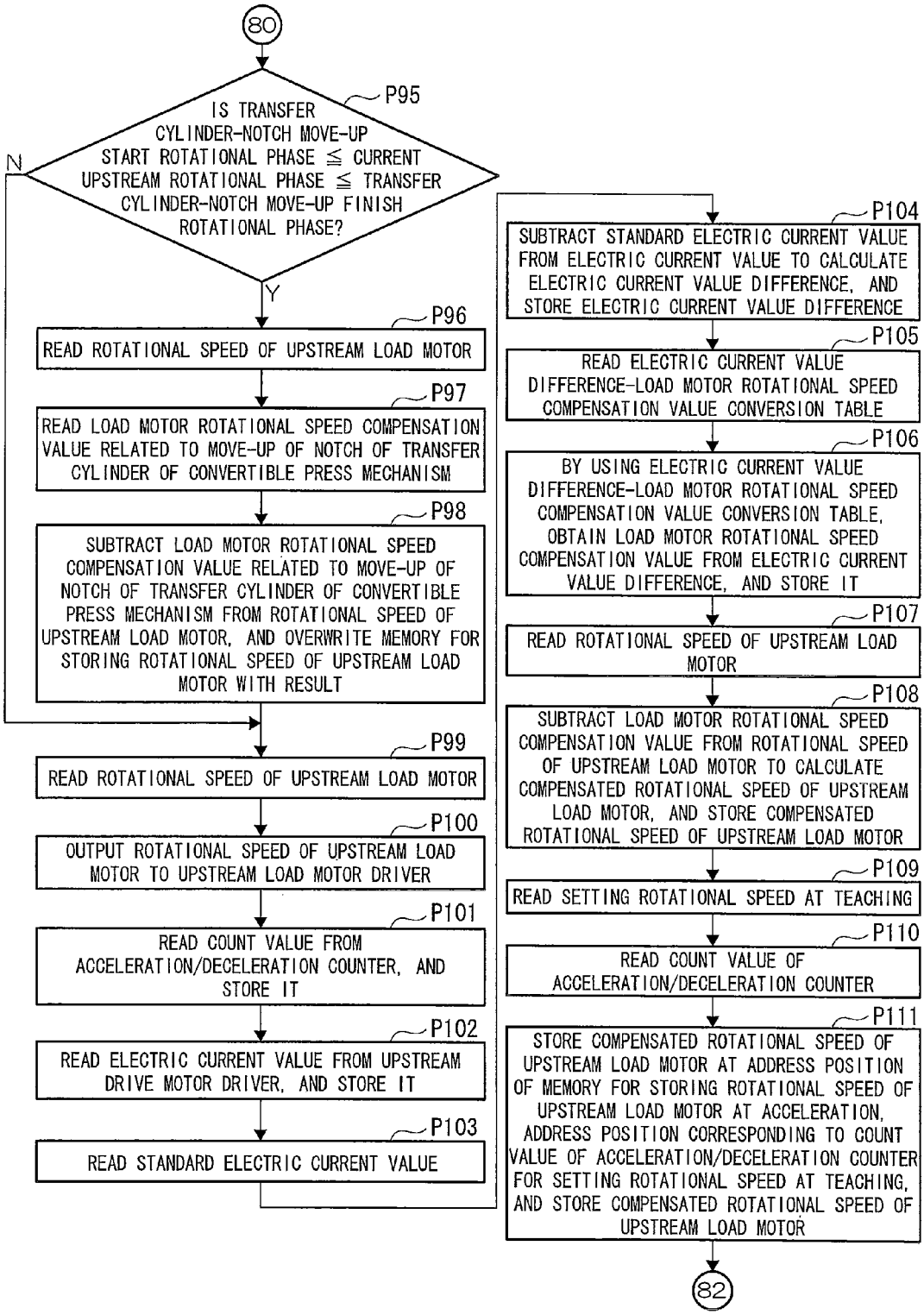
FIG. 37C is an operational flowchart of the upstream printing unit group drive controller.
Figure 38A:
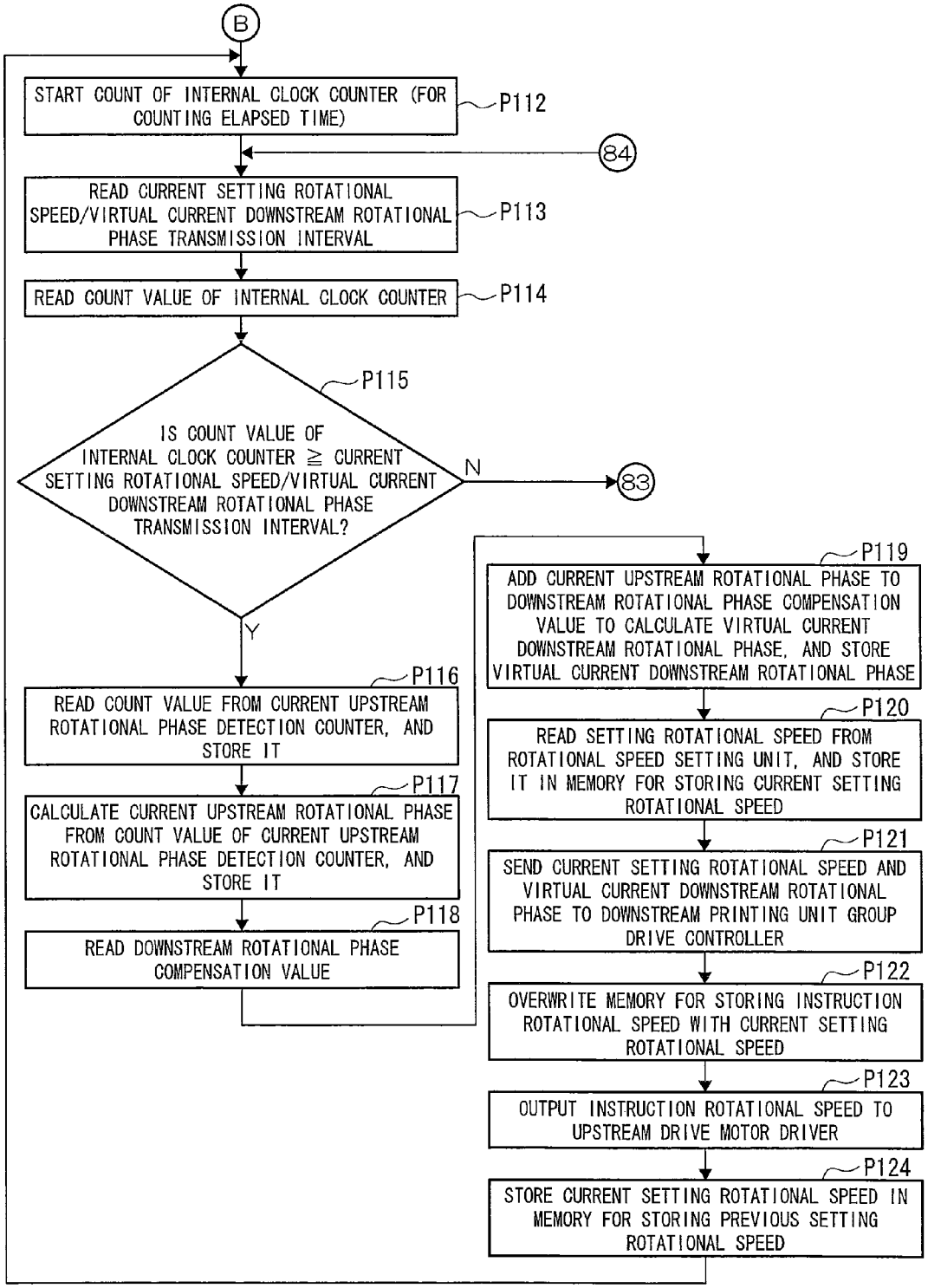
FIG. 38A is an operational flowchart of the upstream printing unit group drive controller.
Figure 38B:
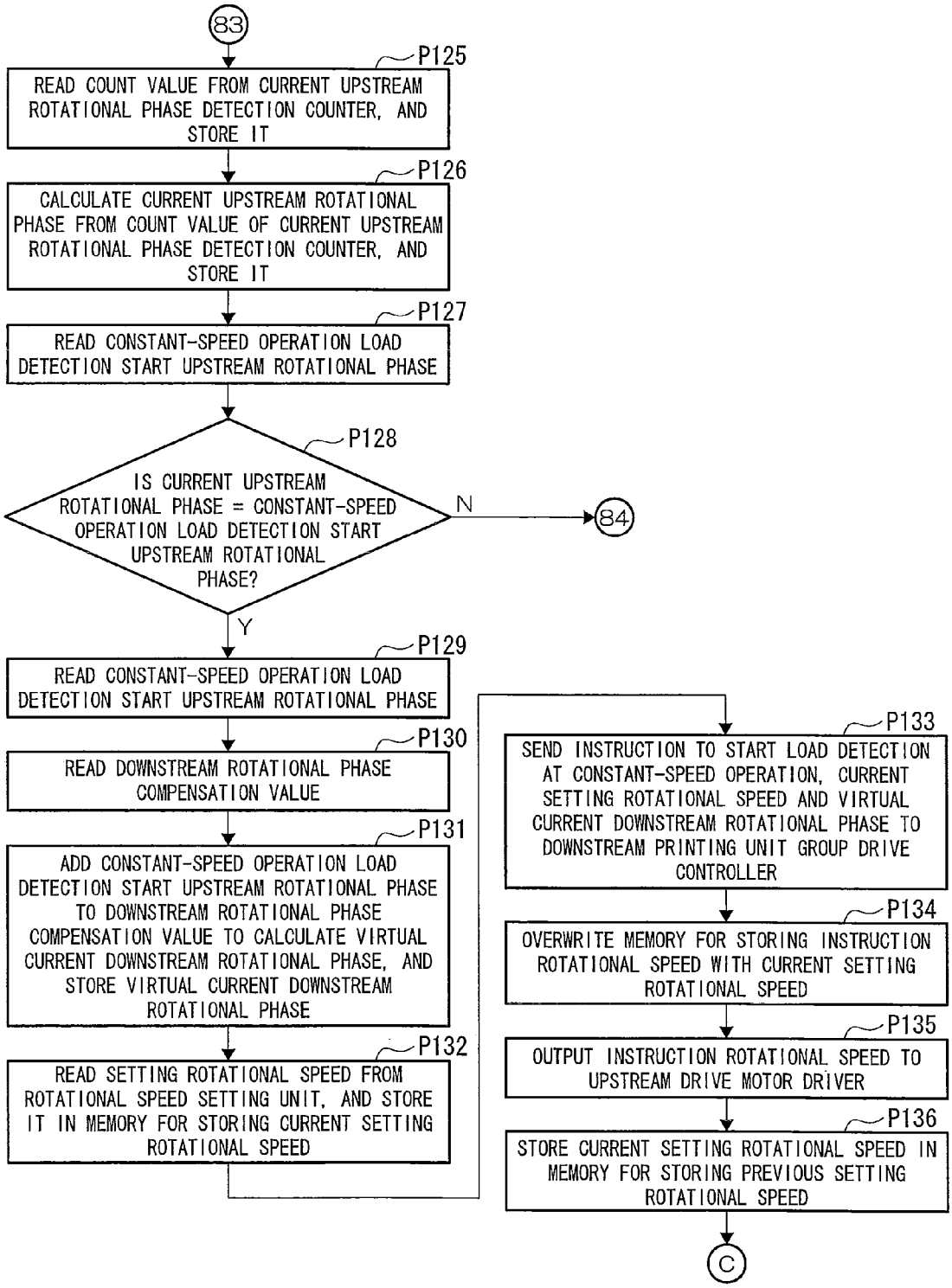
FIG. 38B is an operational flowchart of the upstream printing unit group drive controller.
Figure 39A:
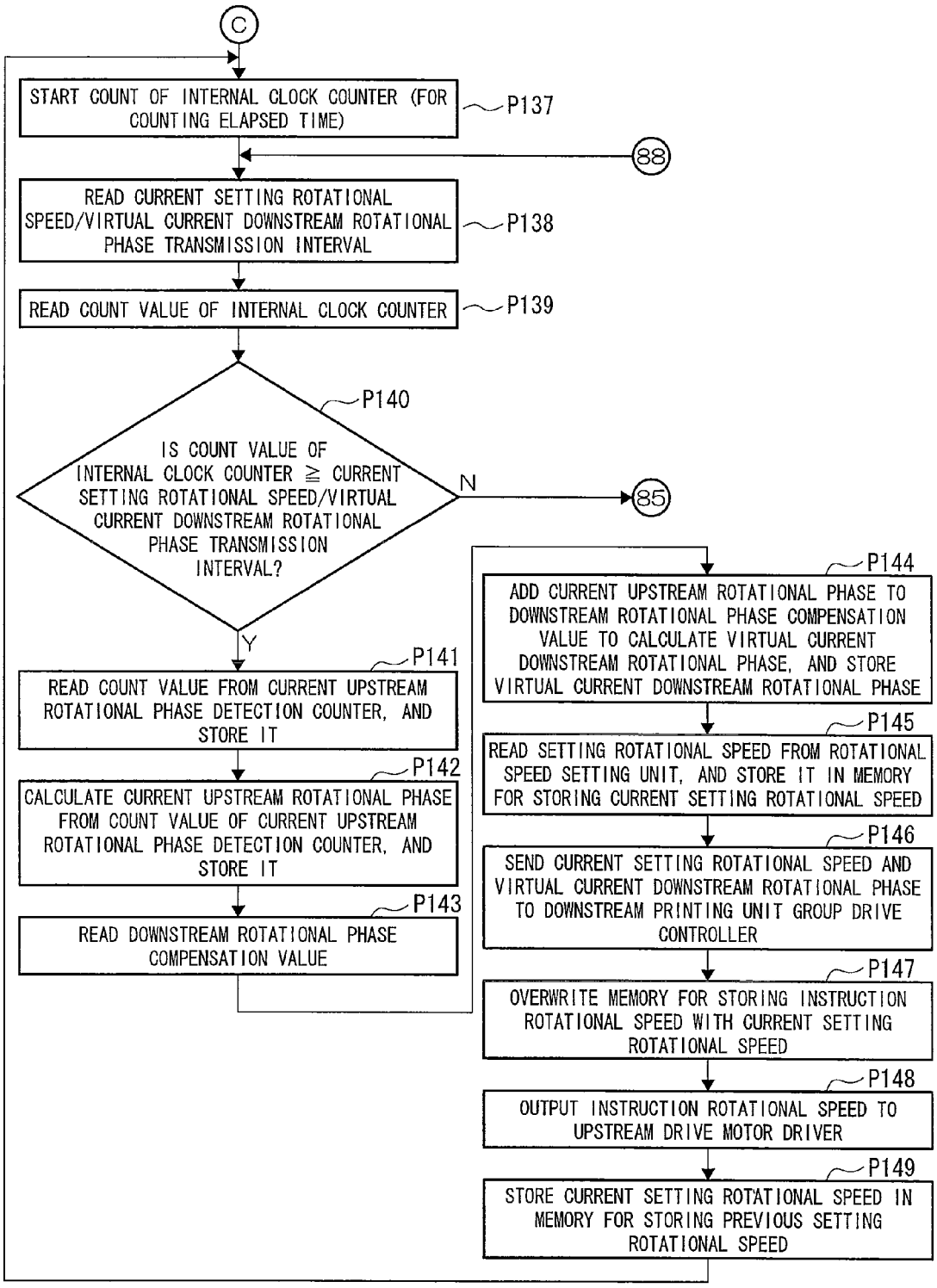
FIG. 39A is an operational flowchart of the upstream printing unit group drive controller.
Figure 39B:
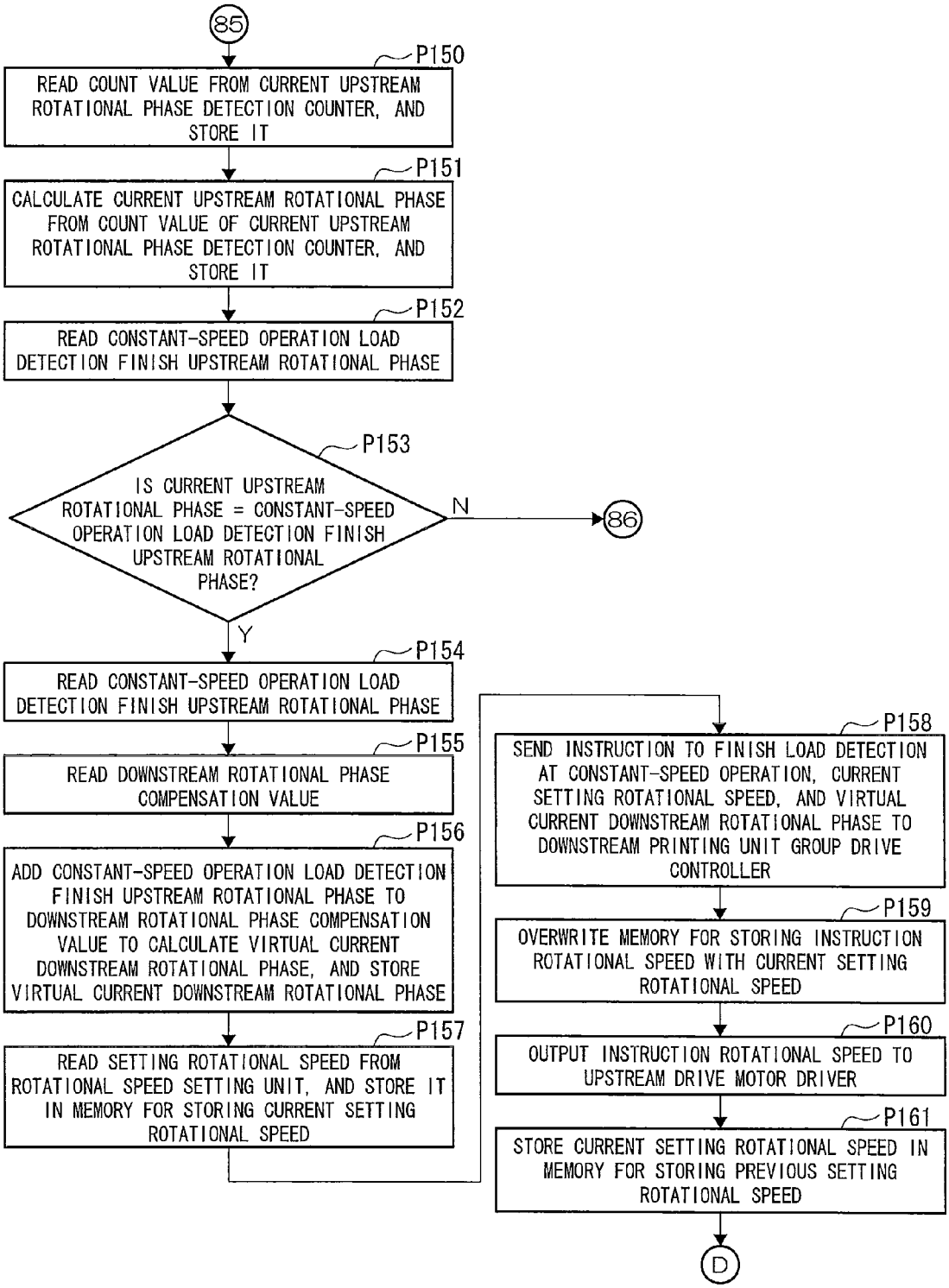
FIG. 39B is an operational flowchart of the upstream printing unit group drive controller.
Figure 39C:
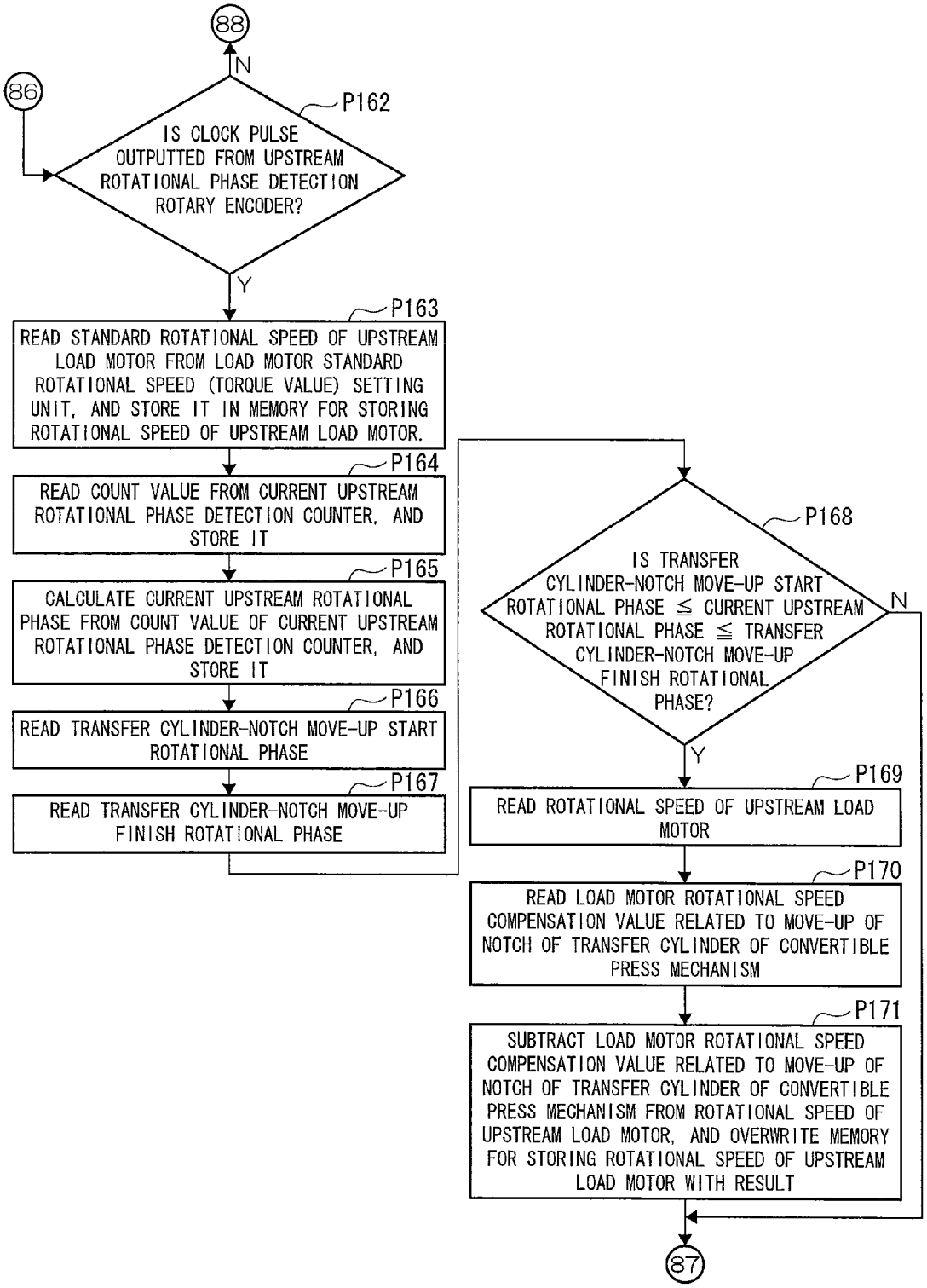
FIG. 39C is an operational flowchart of the upstream printing unit group drive controller.
Figure 39D:
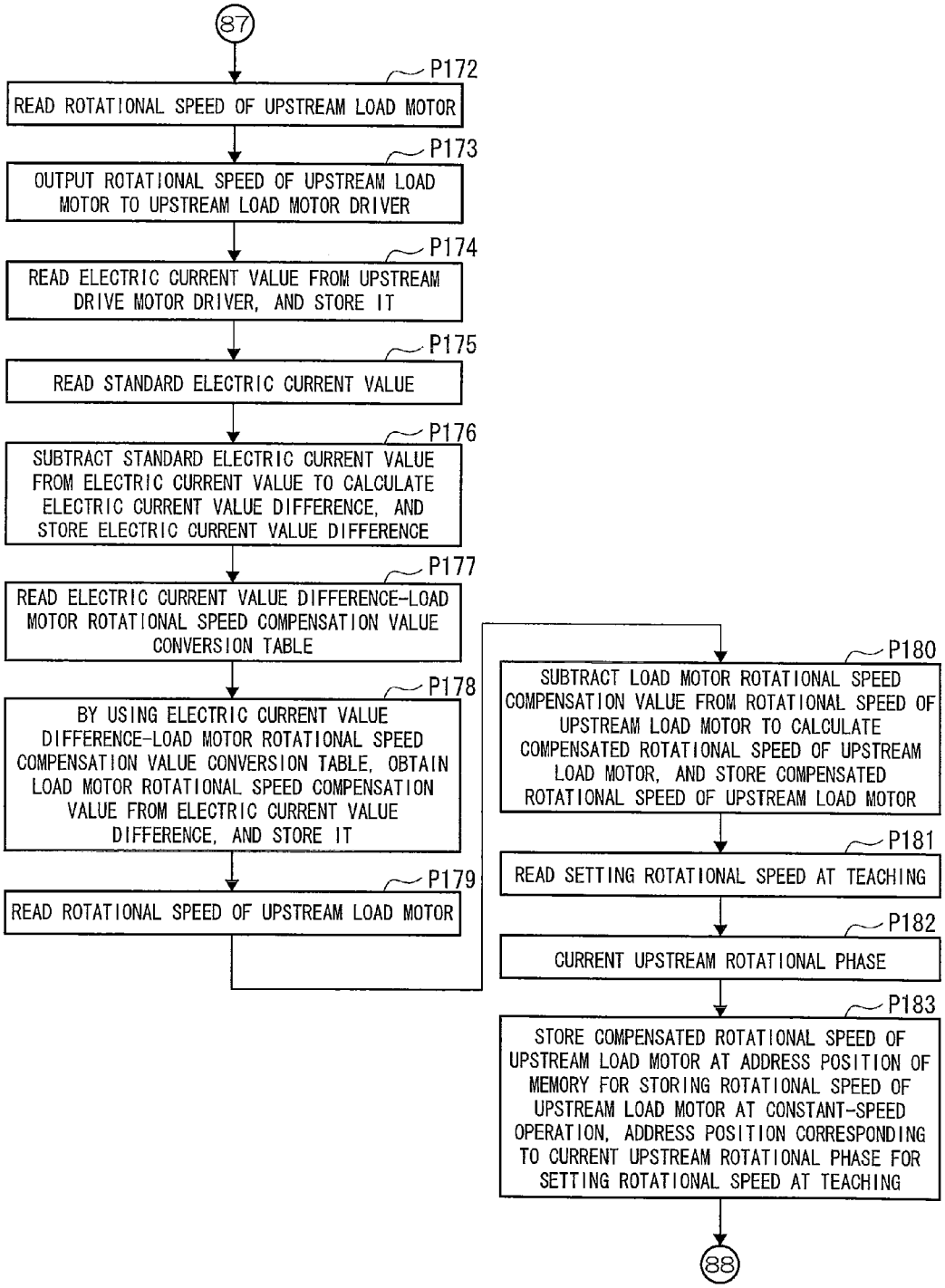
FIG. 39D is an operational flowchart of the upstream printing unit group drive controller.
Figure 40A:
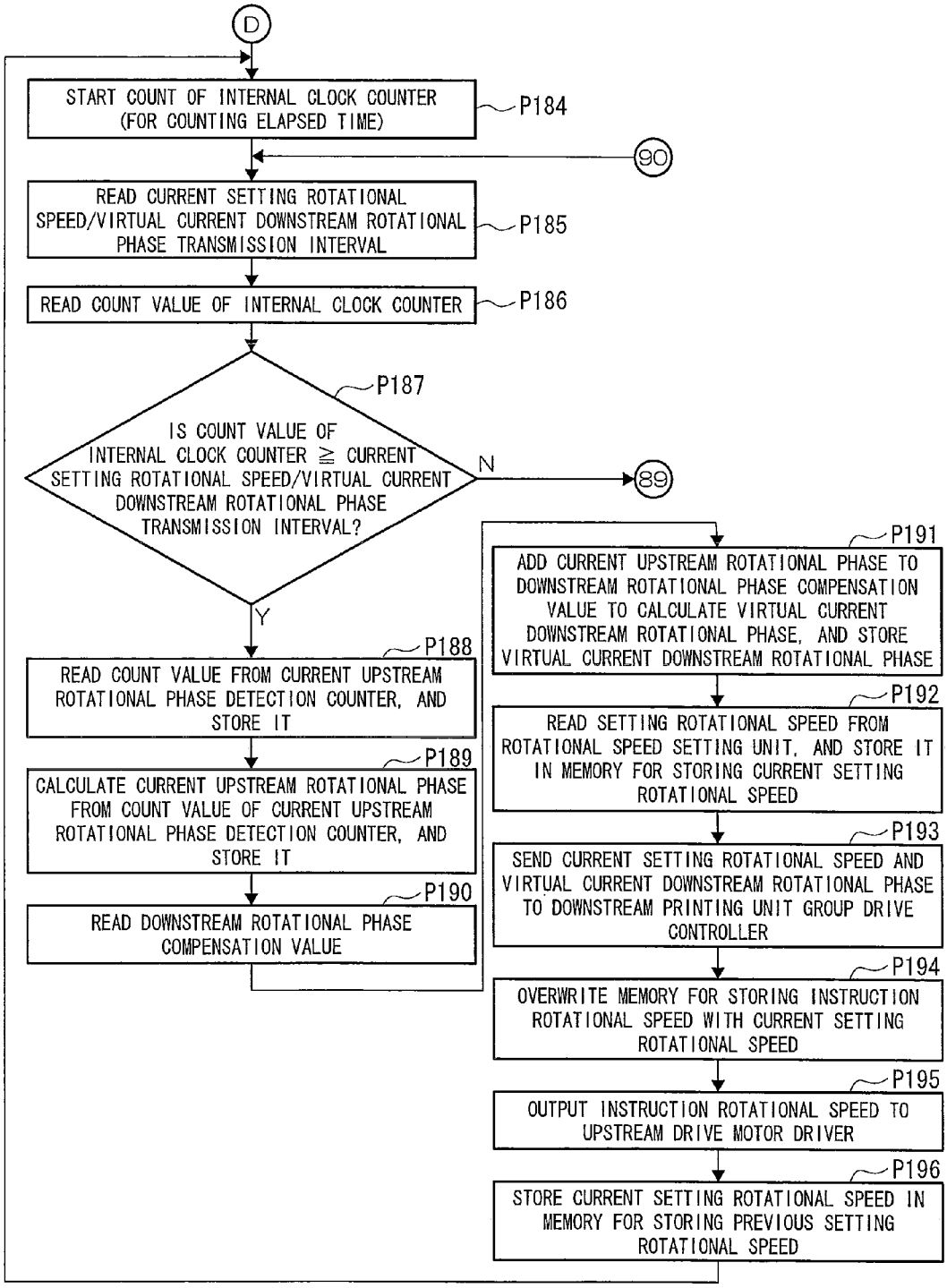
FIG. 40A is an operational flowchart of the upstream printing unit group drive controller.
Figure 40B:
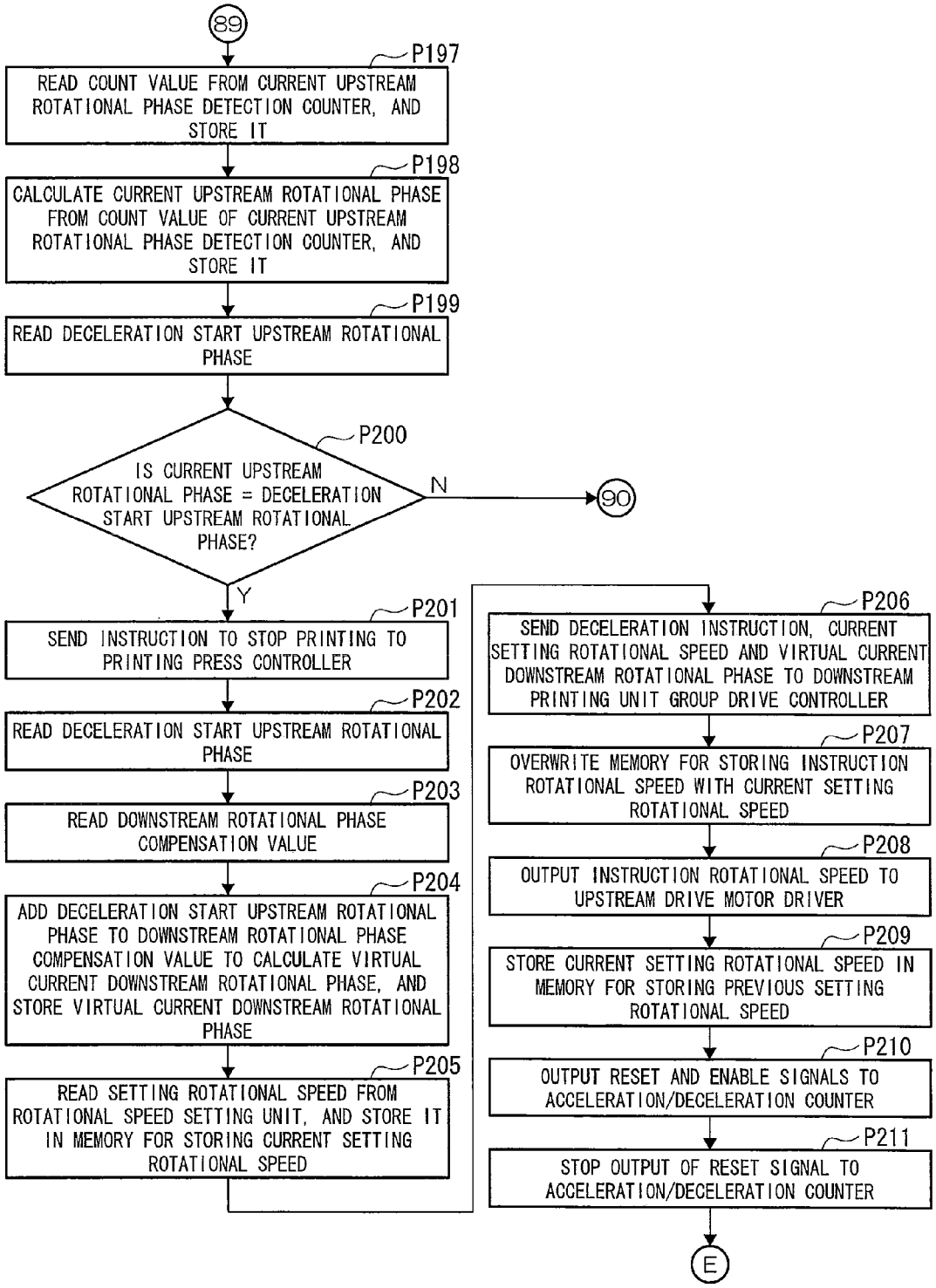
FIG. 40B is an operational flowchart of the upstream printing unit group drive controller.
Figure 41A:
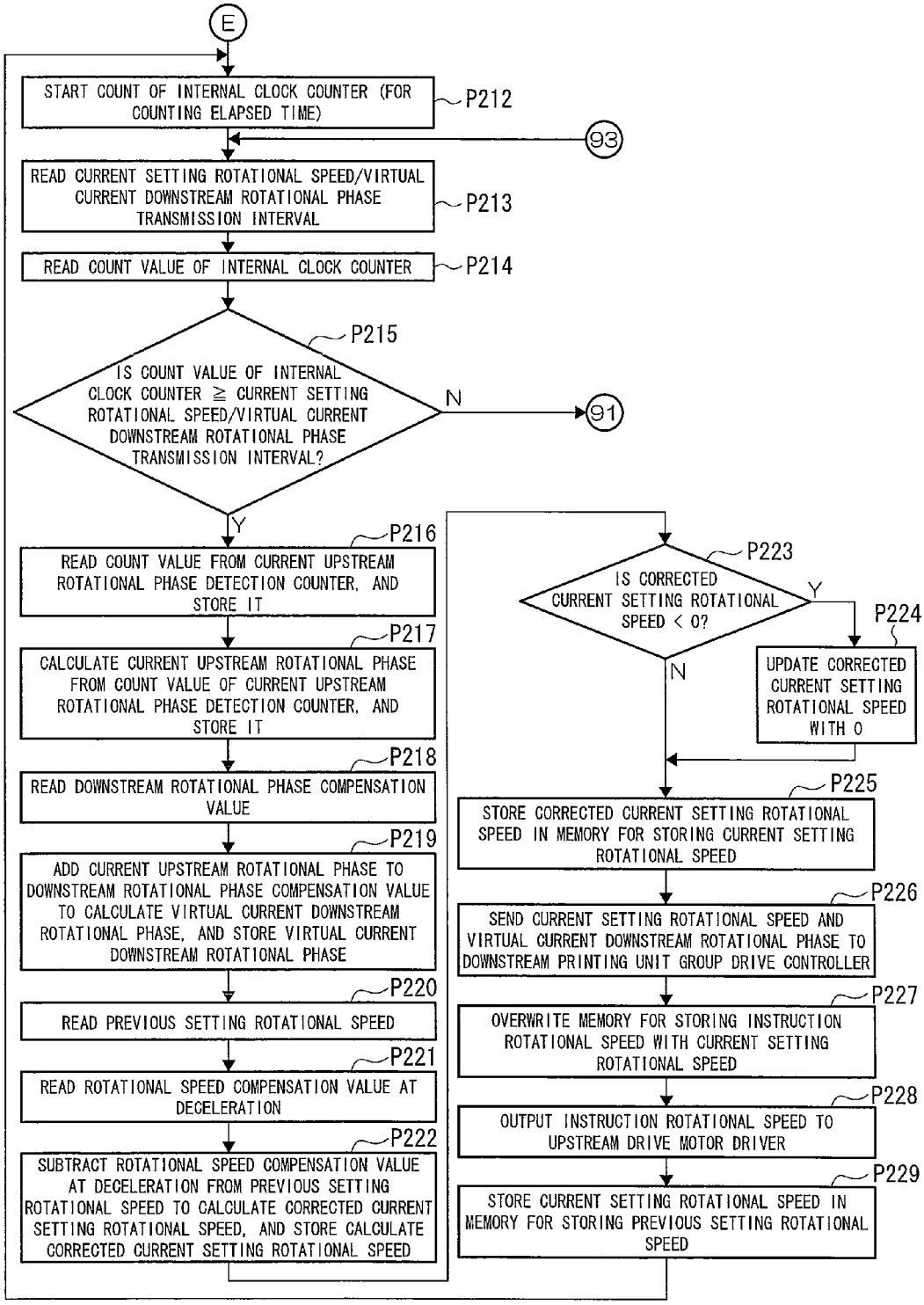
FIG. 41A is an operational flowchart of the upstream printing unit group drive controller.
Figure 41B:
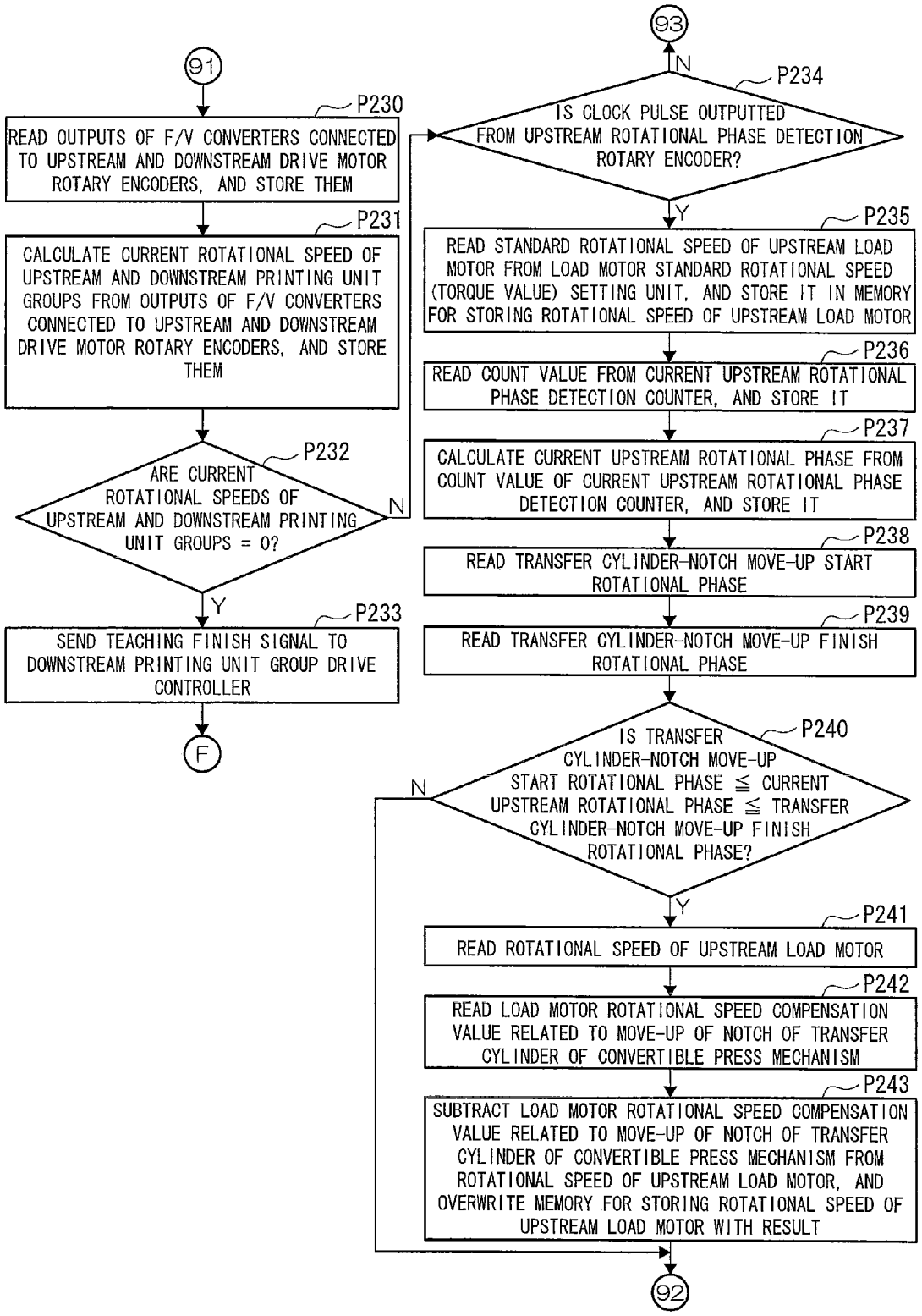
FIG. 41B is an operational flowchart of the upstream printing unit group drive controller.
Figure 41C:
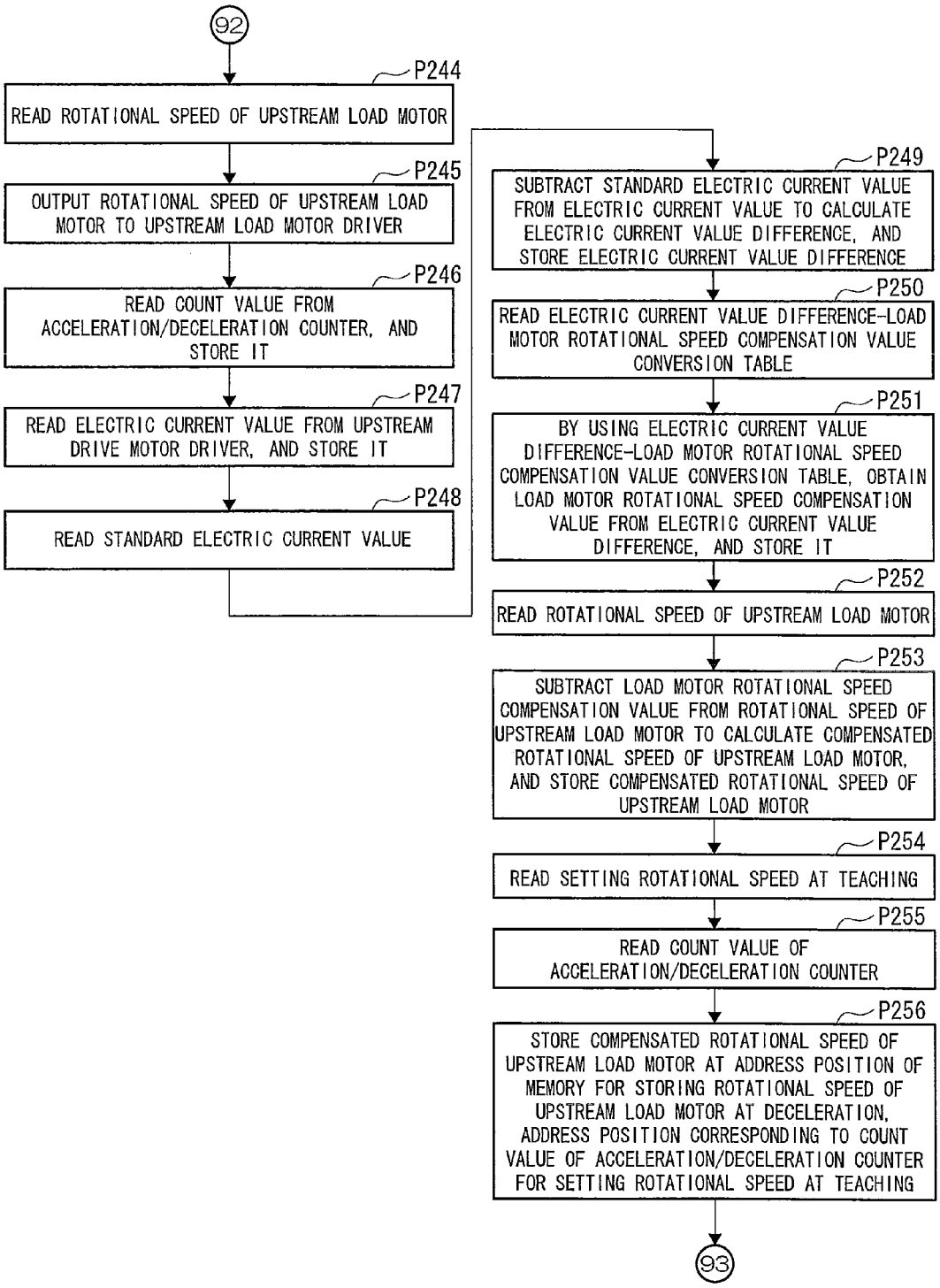
FIG. 41C is an operational flowchart of the upstream printing unit group drive controller.
Figure 42A:
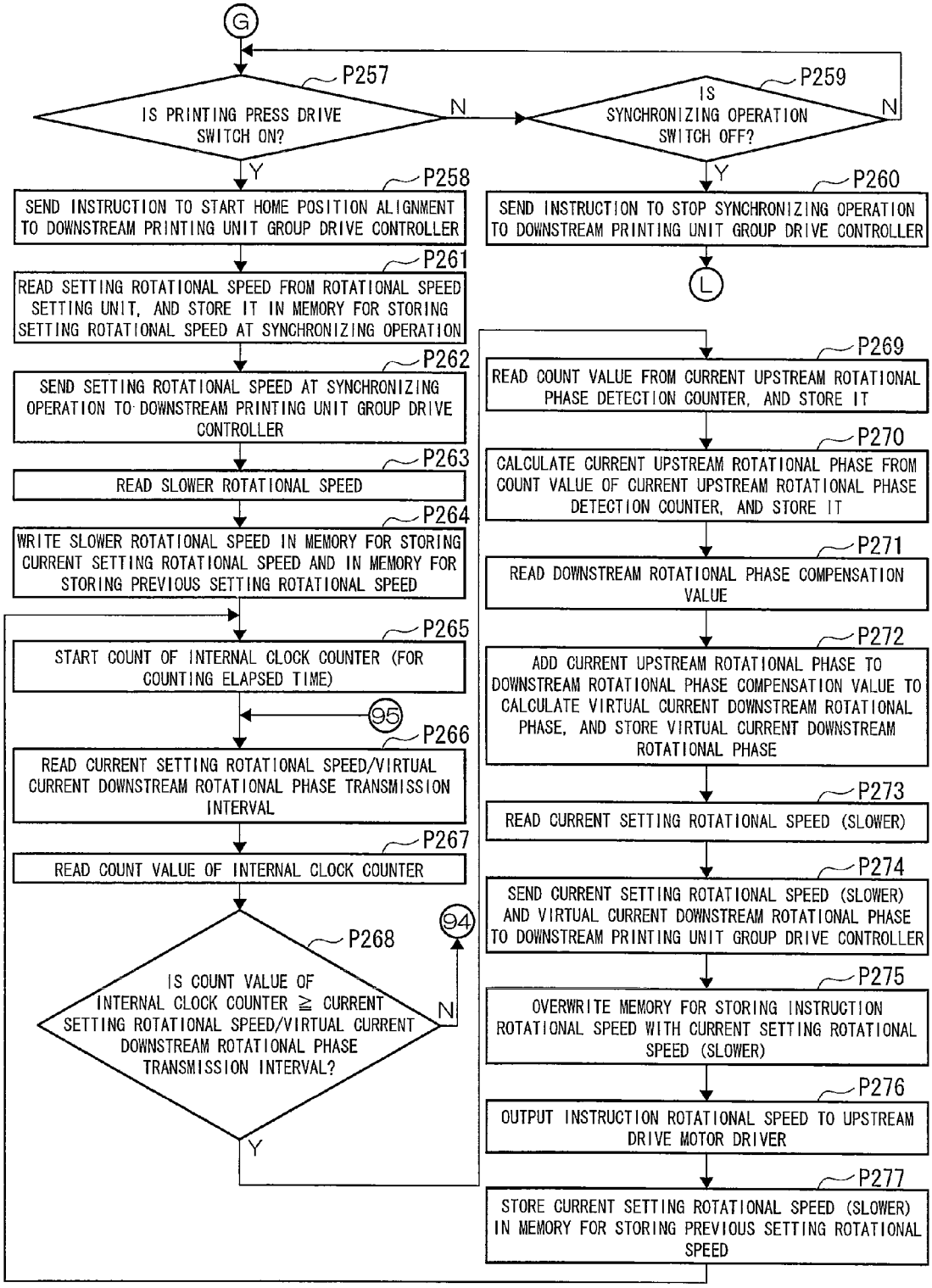
FIG. 42A is an operational flowchart of the upstream printing unit group drive controller.
Figure 42B:
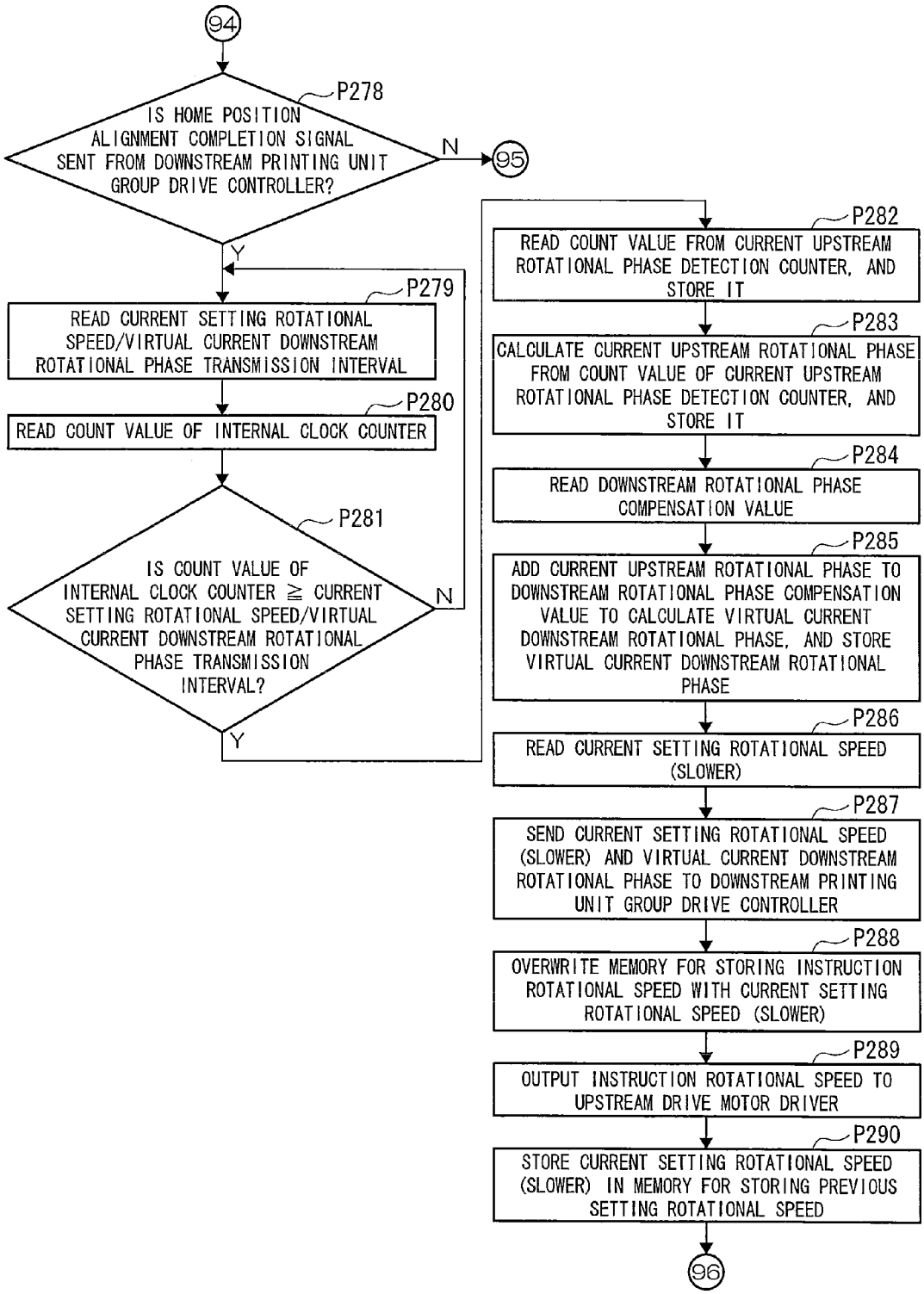
FIG. 42B is an operational flowchart of the upstream printing unit group drive controller.
Figure 42C:
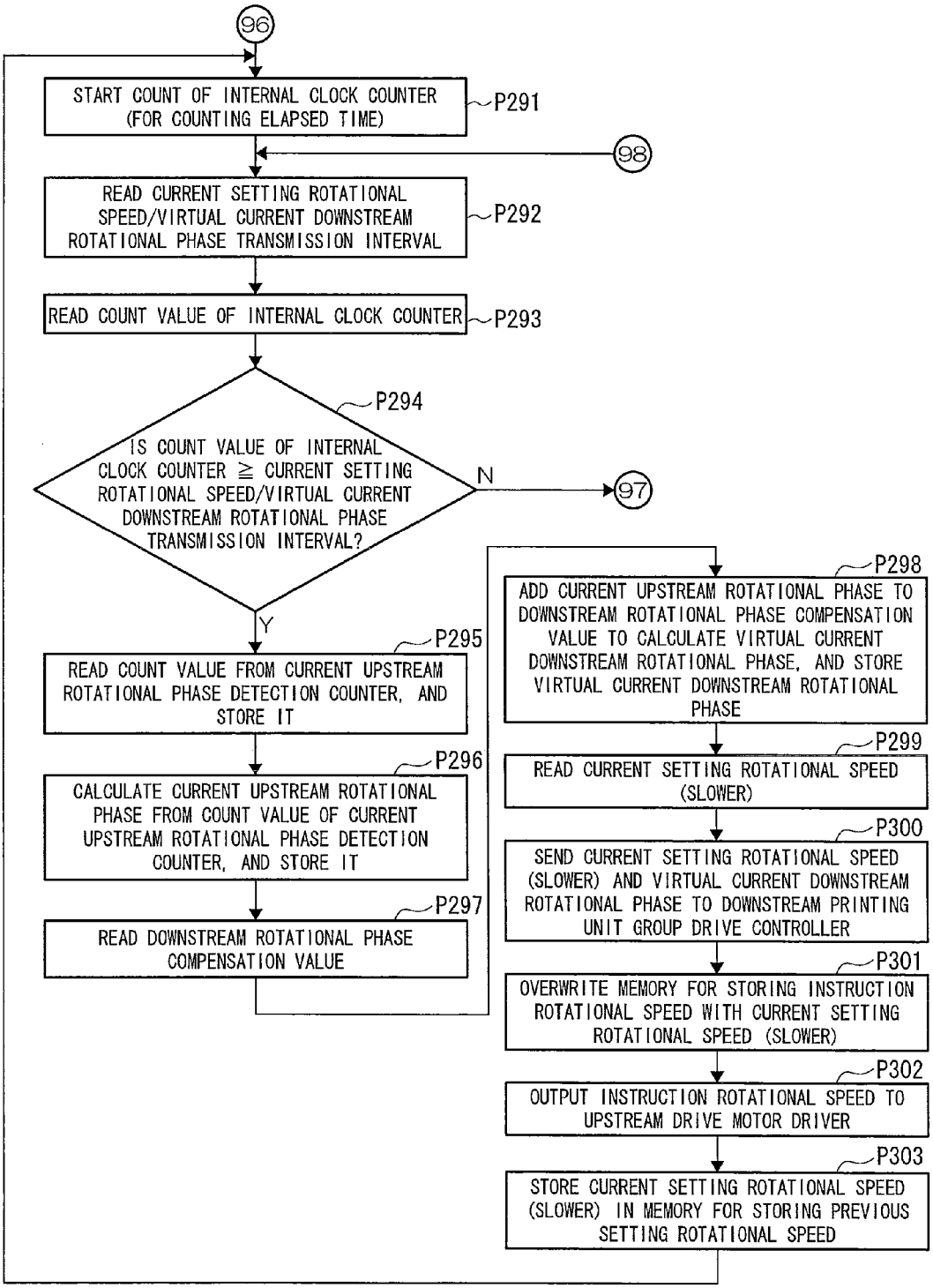
FIG. 42C is an operational flowchart of the upstream printing unit group drive controller.
Figure 42D:
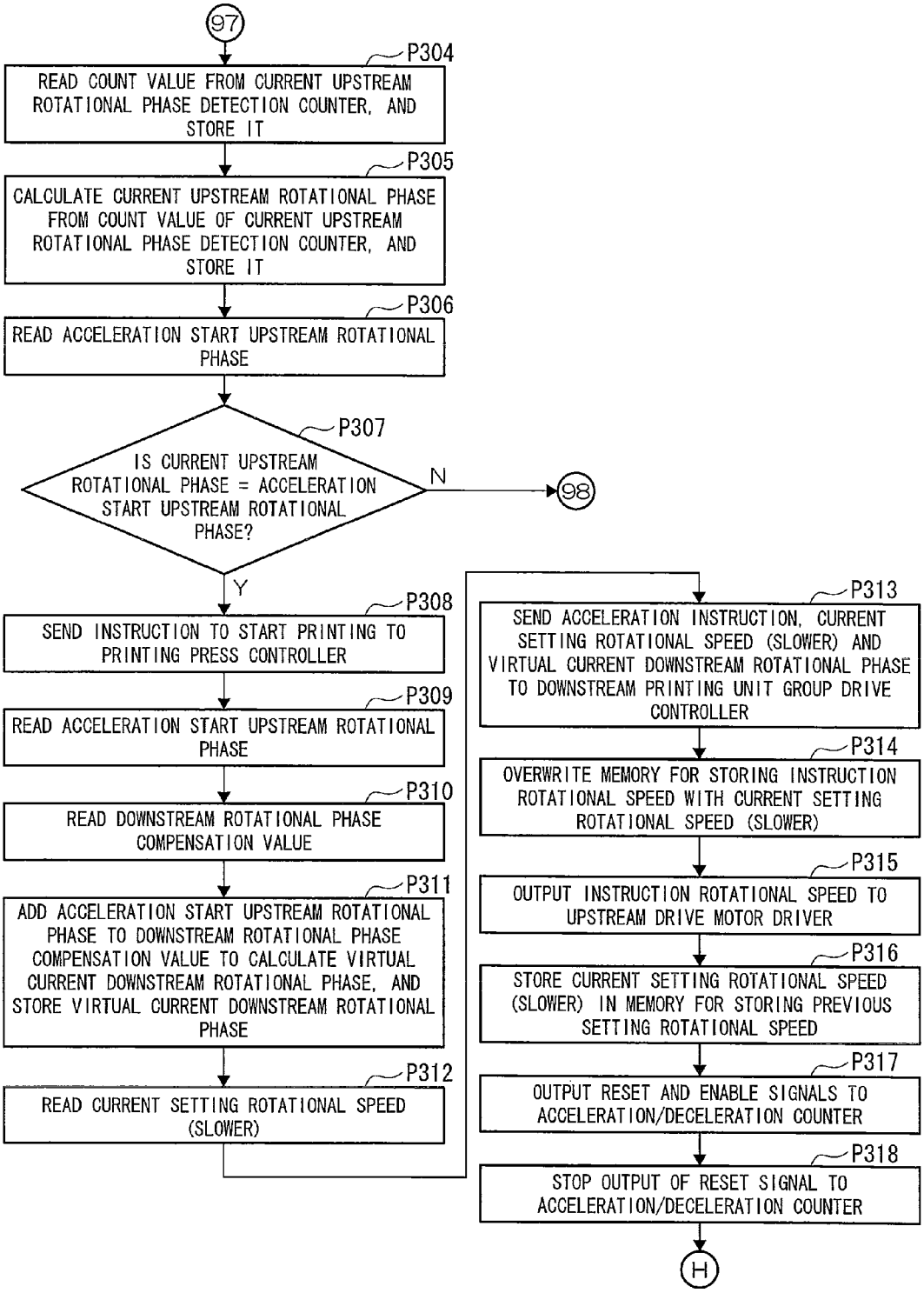
FIG. 42D is an operational flowchart of the upstream printing unit group drive controller.
Figure 43A:
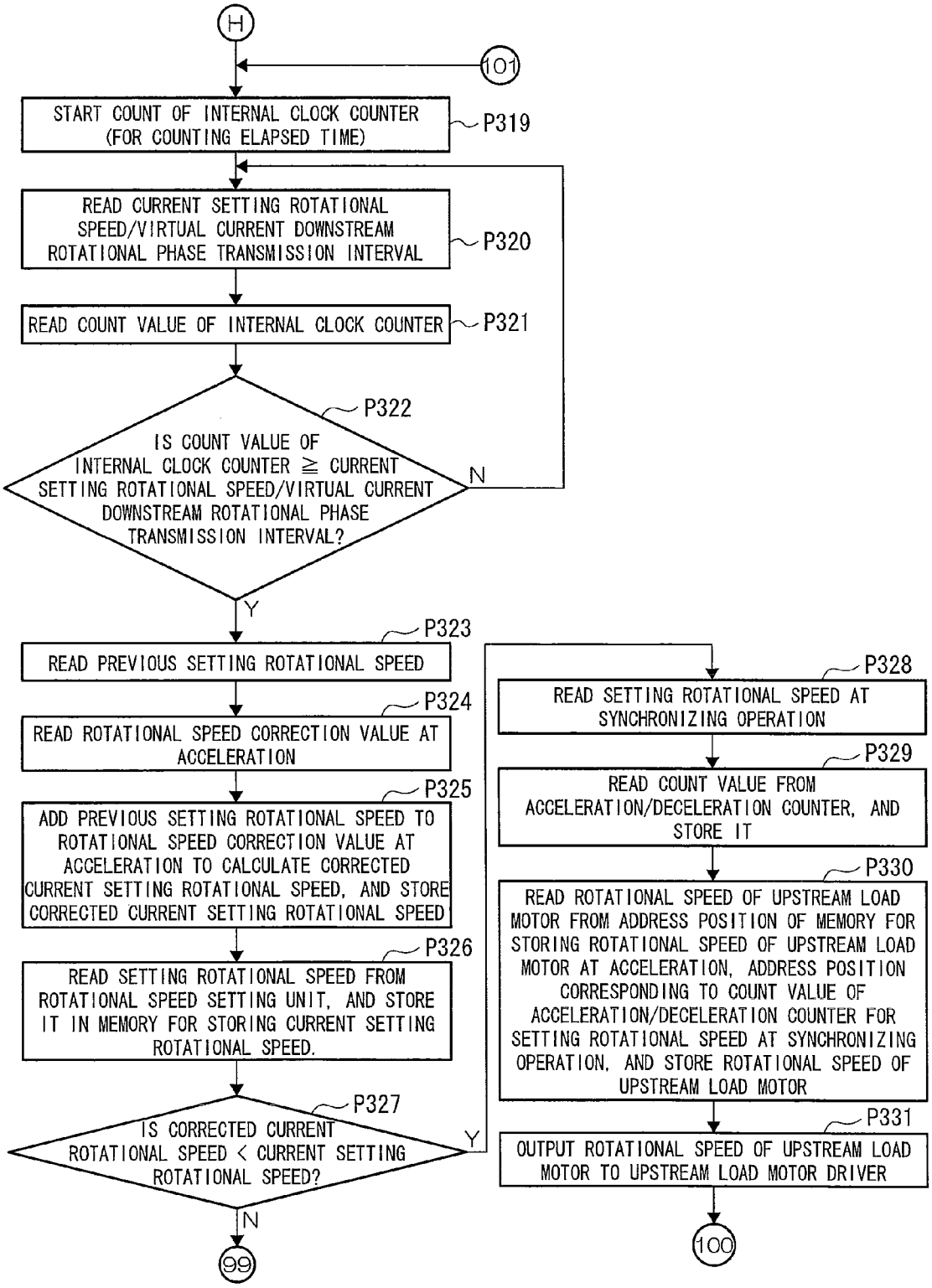
FIG. 43A is an operational flowchart of the upstream printing unit group drive controller.
Figure 43B:
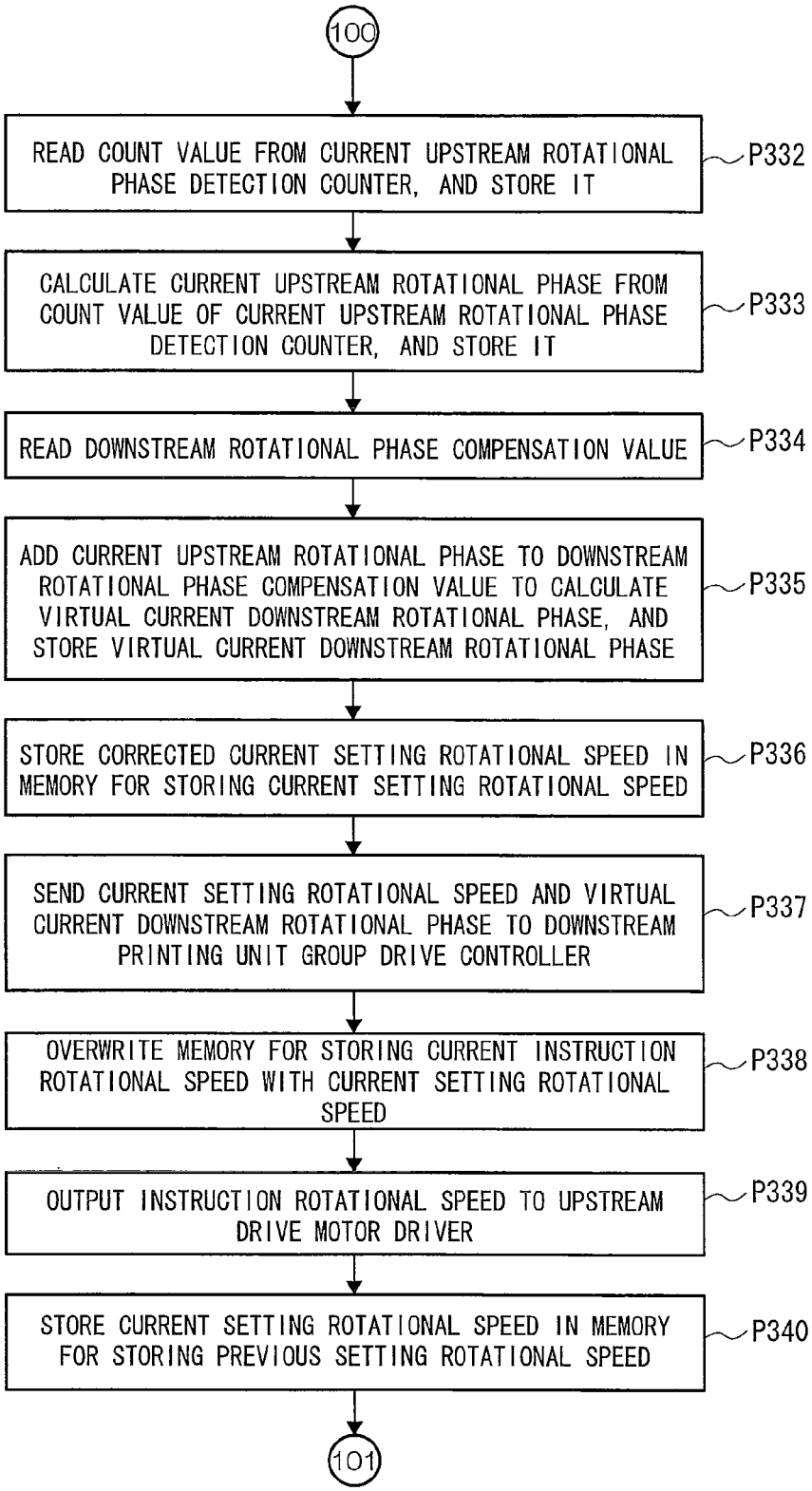
FIG. 43B is an operational flowchart of the upstream printing unit group drive controller.
Figure 43C:
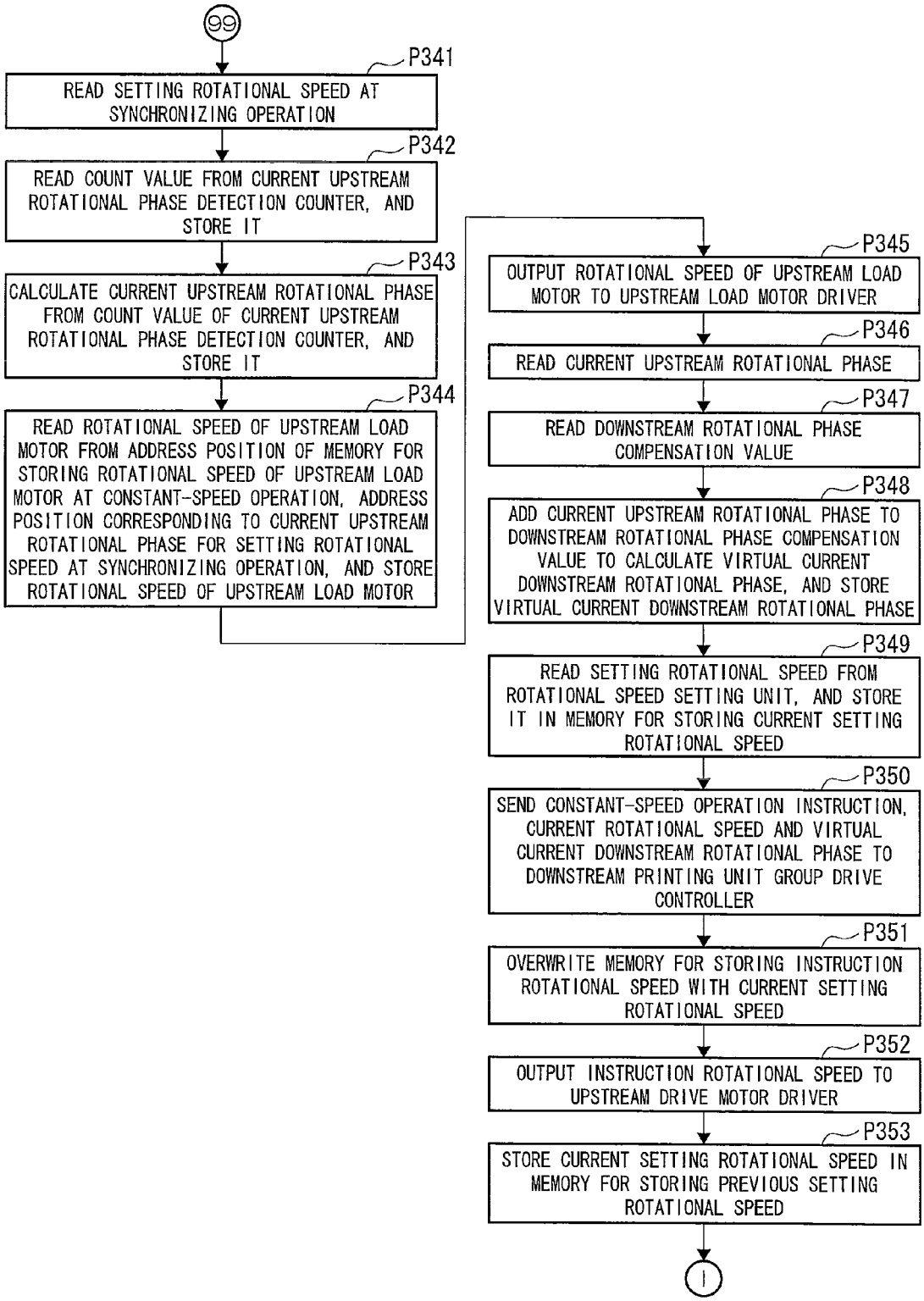
FIG. 43C is an operational flowchart of the upstream printing unit group drive controller.
Figure 44A:
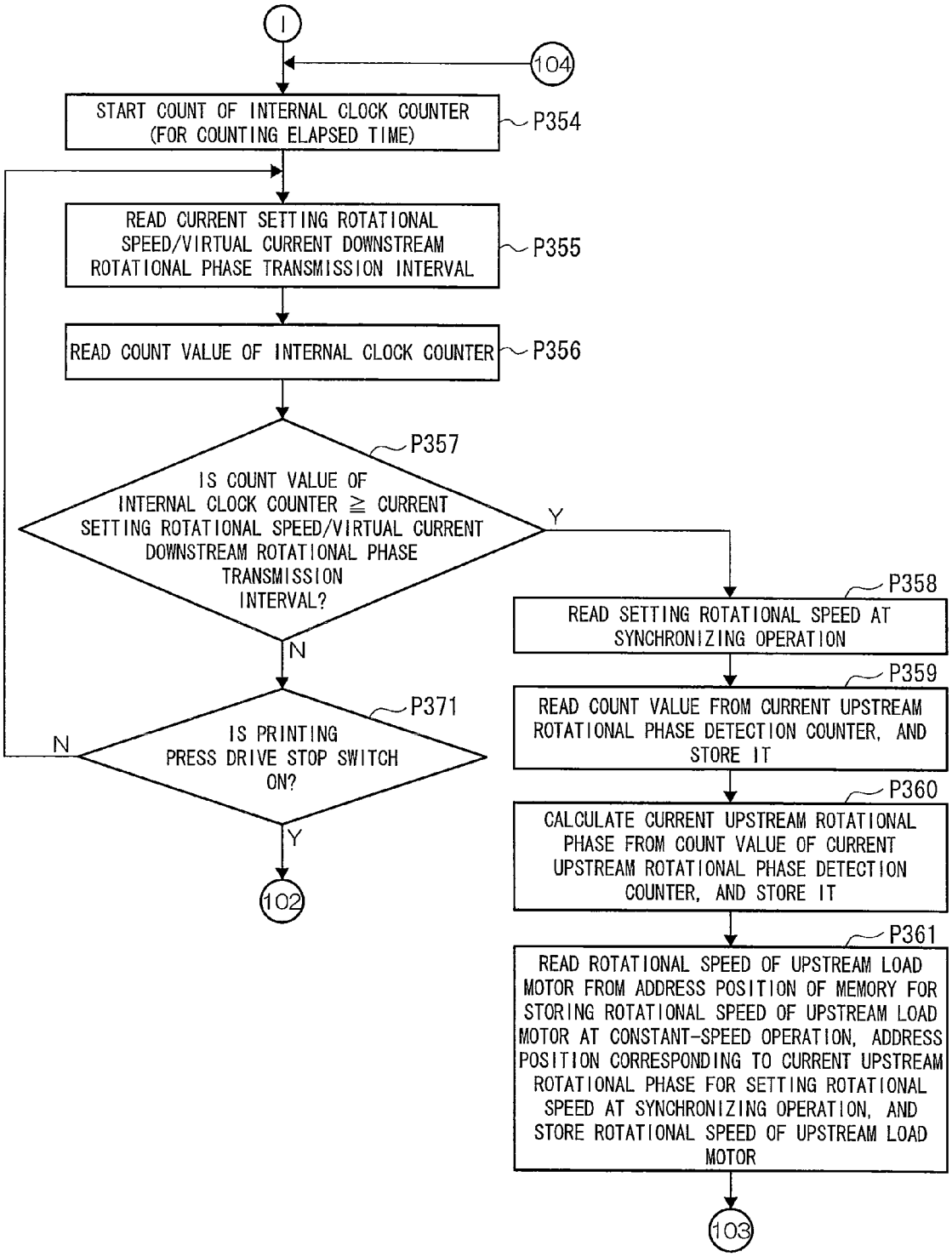
FIG. 44A is an operational flowchart of the upstream printing unit group drive controller.
Figure 44B:
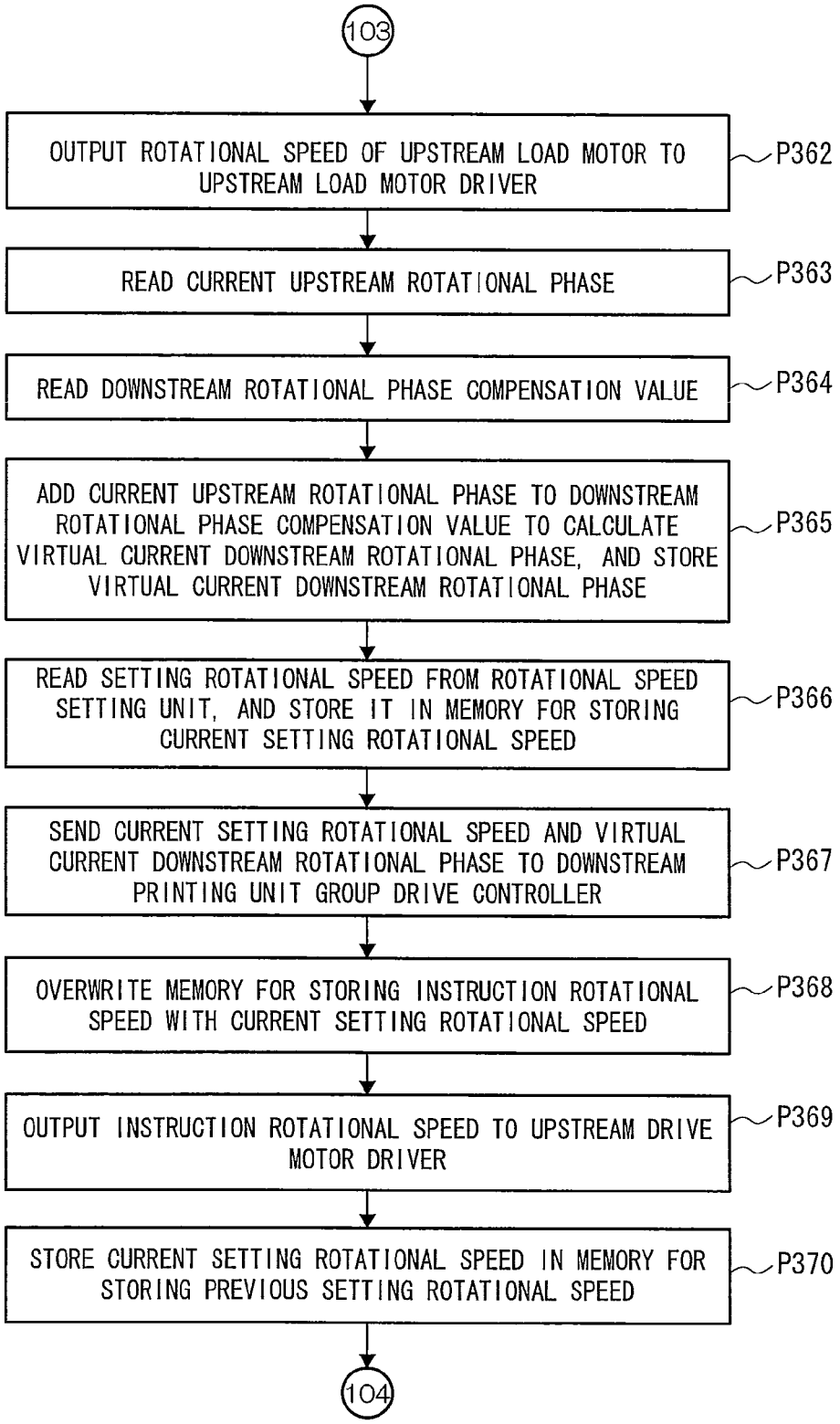
FIG. 44B is an operational flowchart of the upstream printing unit group drive controller.
Figure 44C:
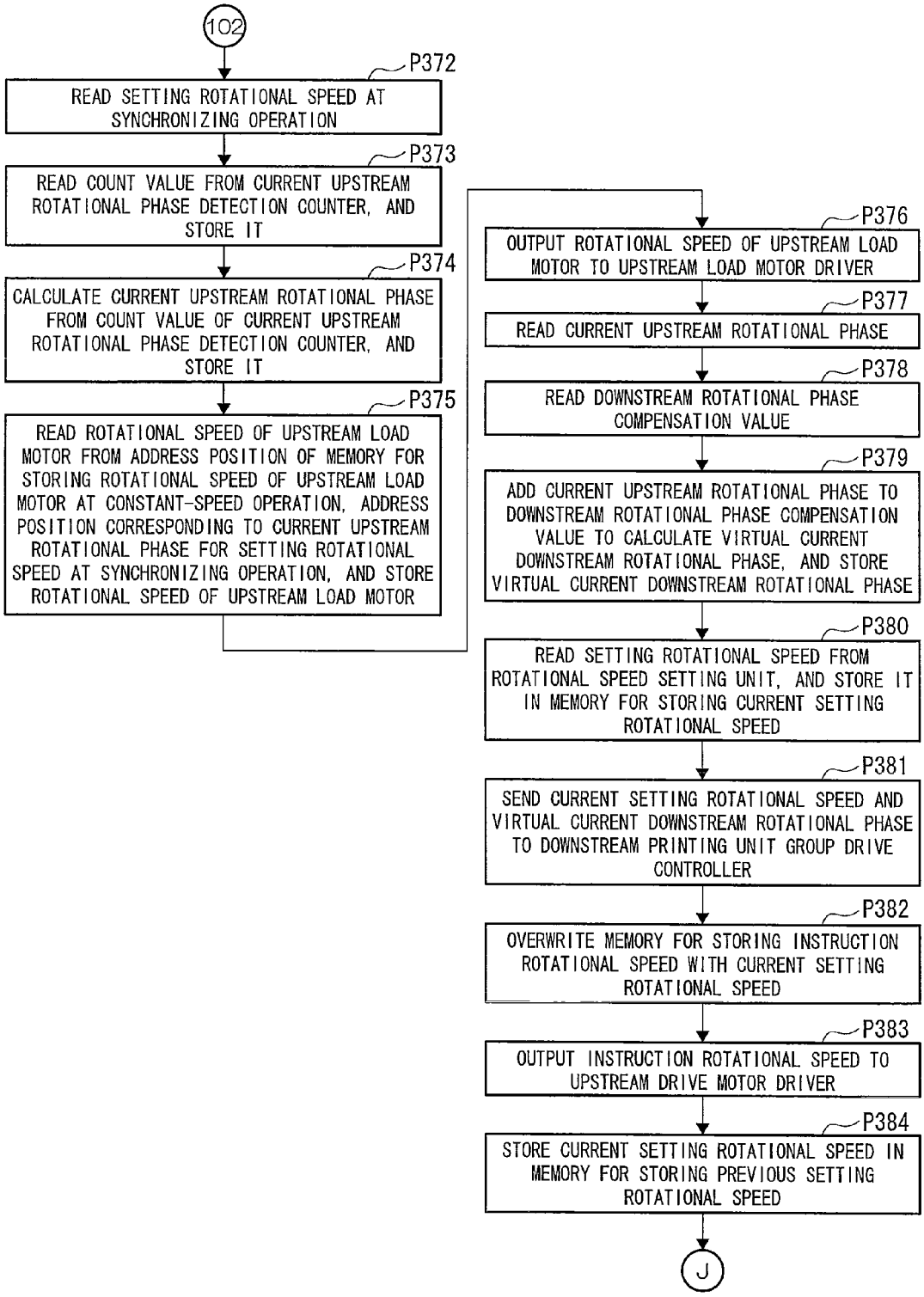
FIG. 44C is an operational flowchart of the upstream printing unit group drive controller.
Figure 45A:
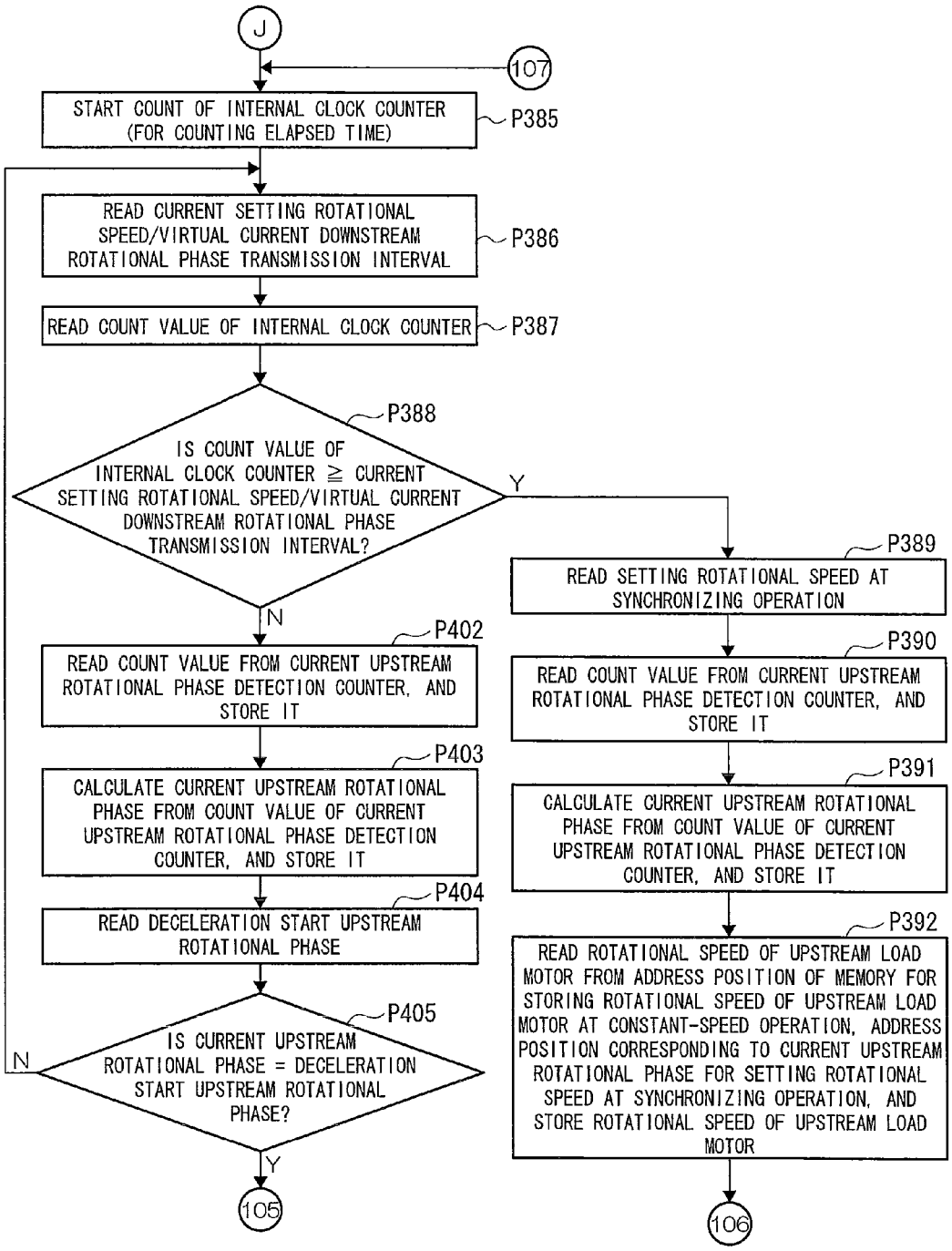
FIG. 45A is an operational flowchart of the upstream printing unit group drive controller.
Figure 45B:
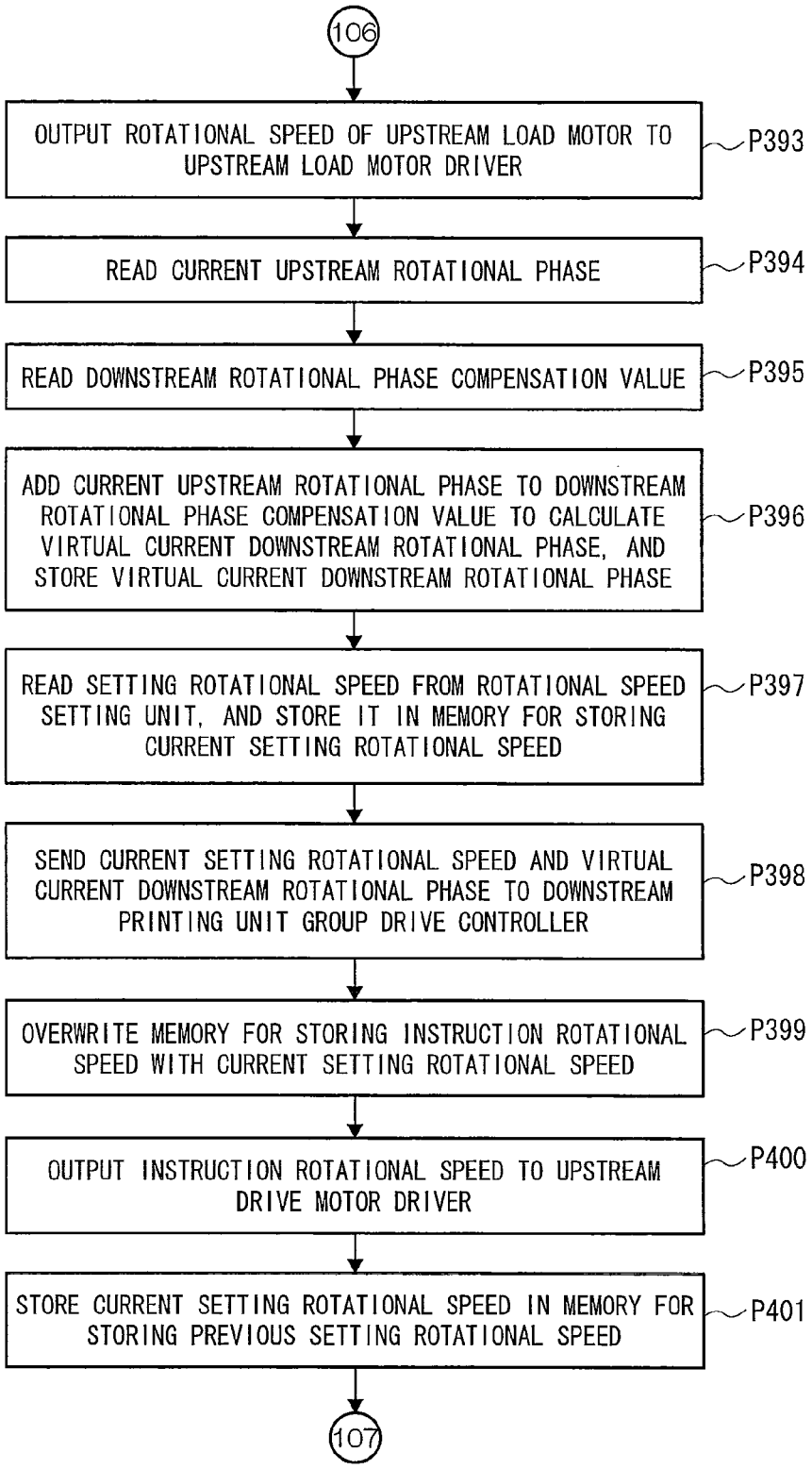
FIG. 45B is an operational flowchart of the upstream printing unit group drive controller.
Figure 45C:
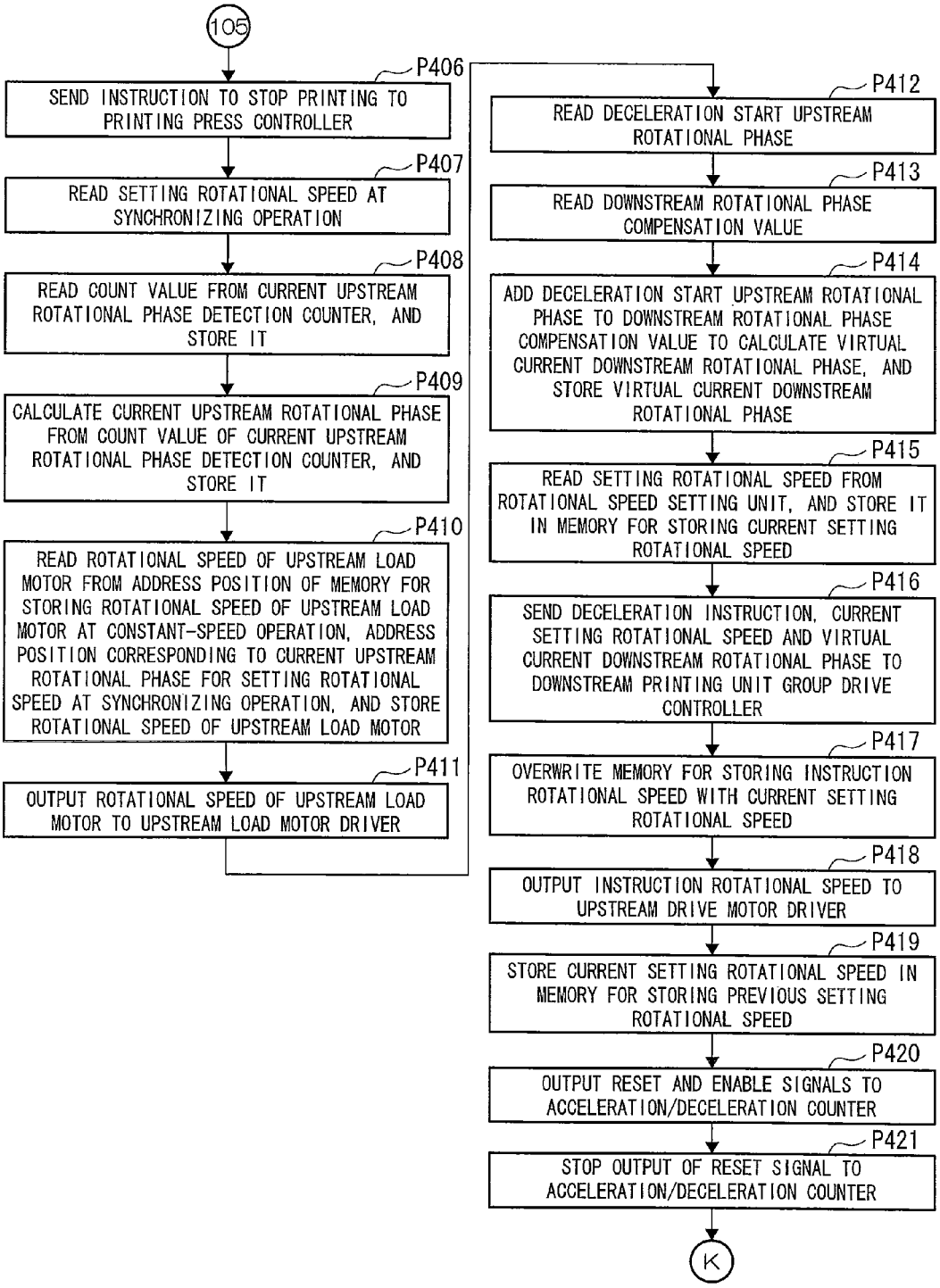
FIG. 45C is an operational flowchart of the upstream printing unit group drive controller.
Figure 46A:
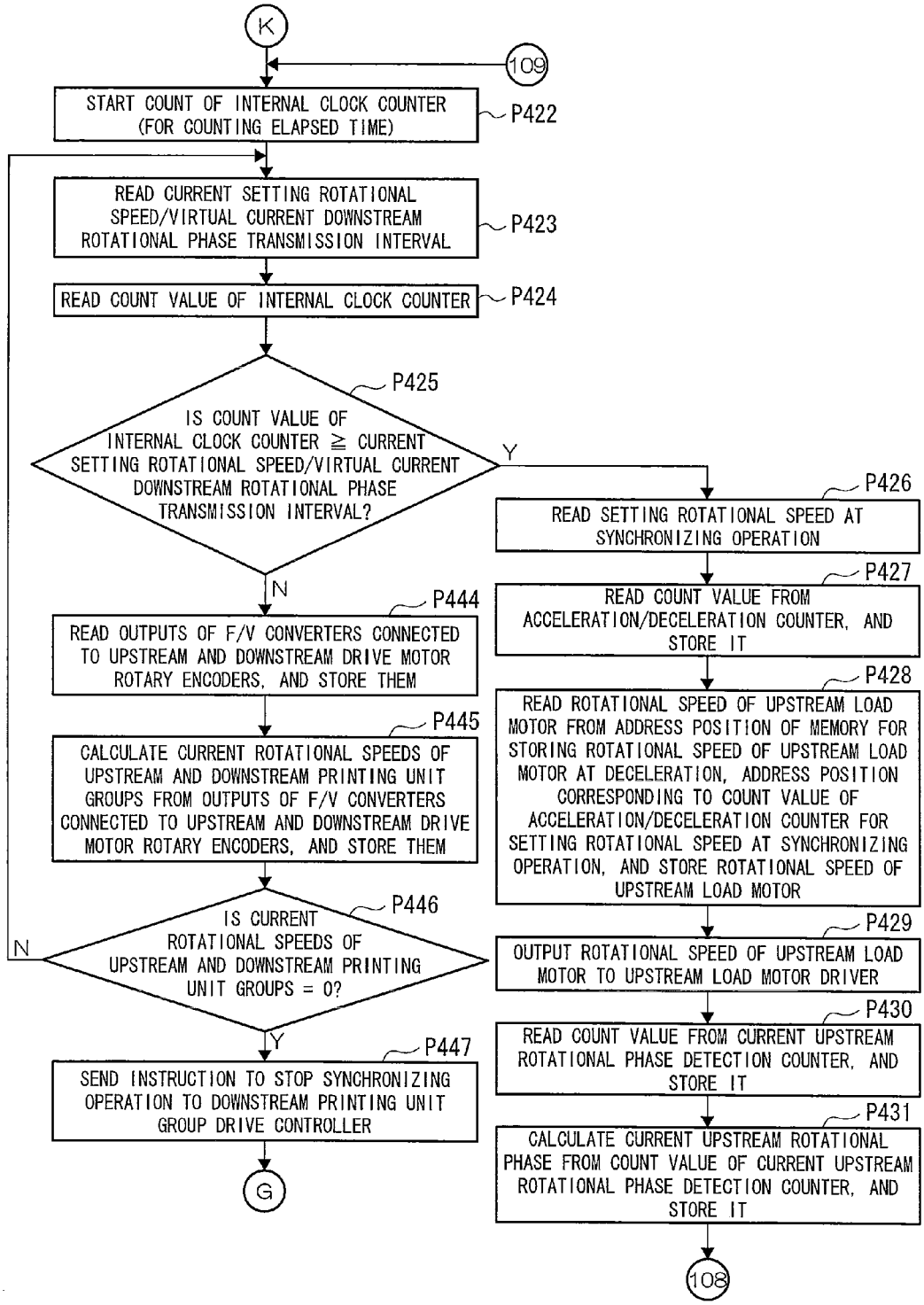
FIG. 46A is an operational flowchart of the upstream printing unit group drive controller.
Figure 46B:
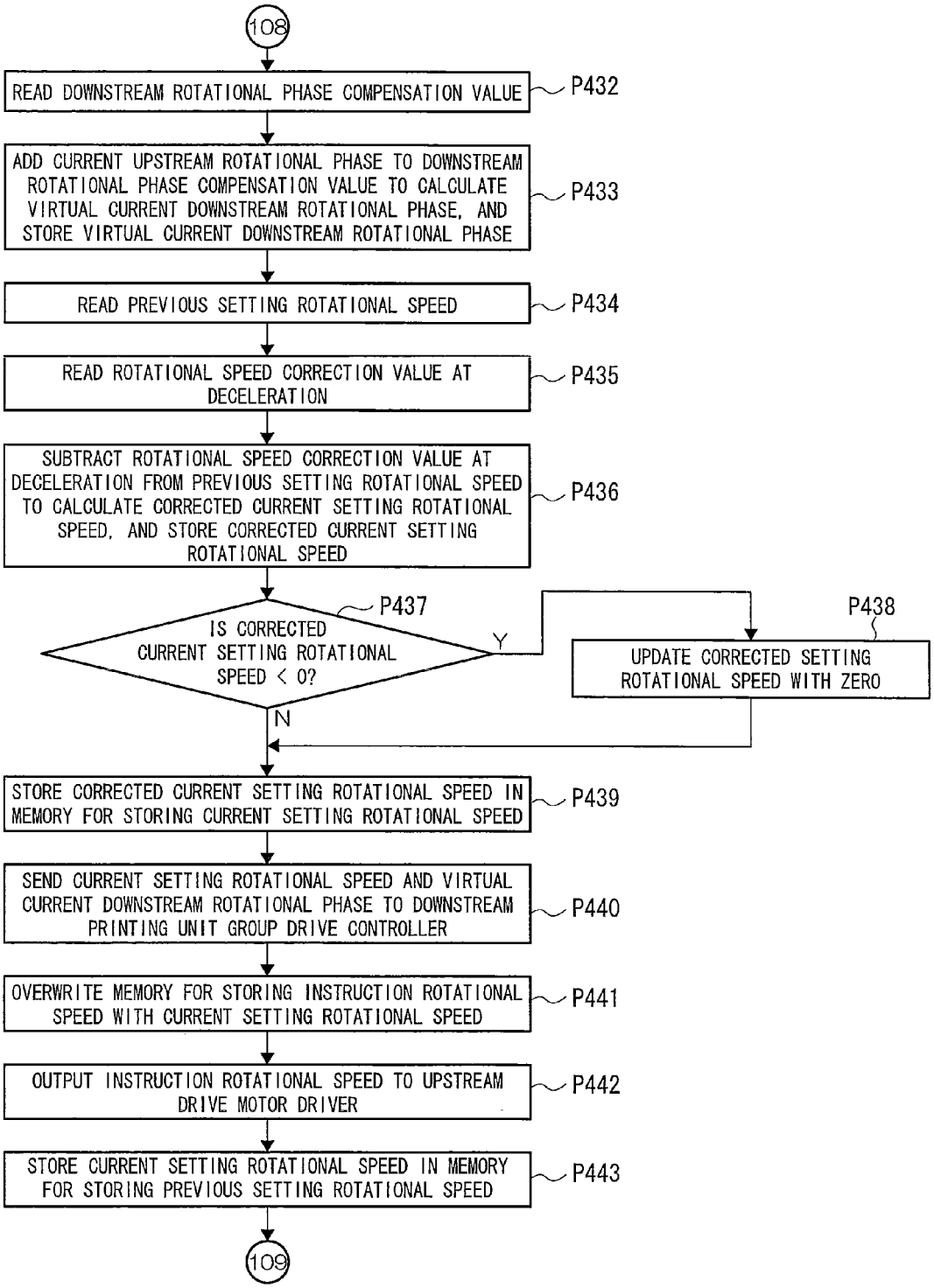
FIG. 46B is an operational flowchart of the upstream printing unit group drive controller.
Figure 47:
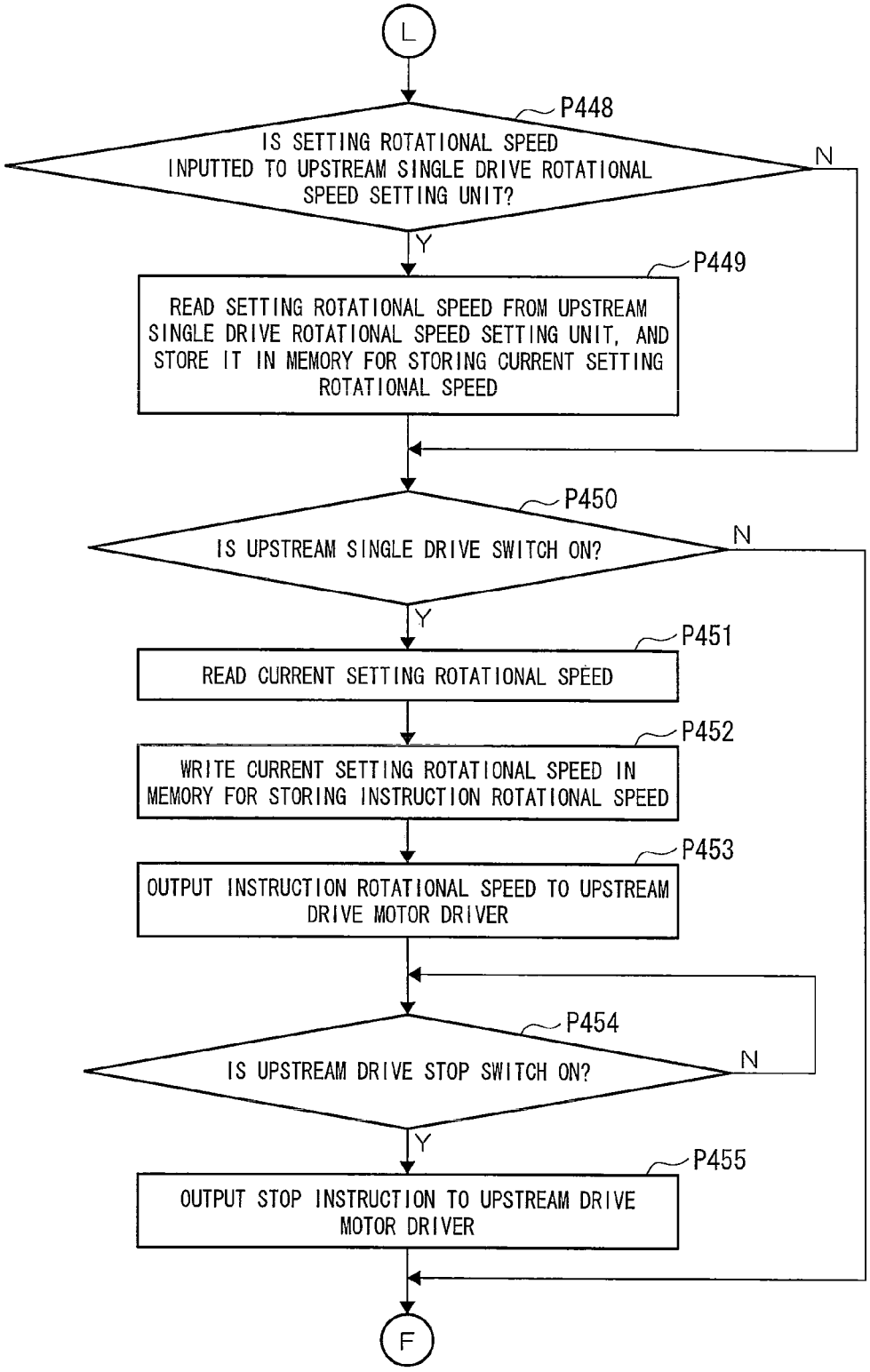

FIGS. 36A to 36E are operational flowcharts of the upstream printing unit group drive controller. FIGS. 37A to 37C are operational flowcharts of the upstream printing unit group drive controller. FIGS. 38A and 38B are operational flowcharts of the upstream printing unit group drive controller. FIGS. 39A to 39D are operational flowcharts of the upstream printing unit group drive controller. FIGS. 40A and 40B are operational flowcharts of the upstream printing unit group drive controller. FIGS. 41A to 41C are operational flowcharts of the upstream printing unit group drive controller. FIGS. 42A to 42D are operational flowcharts of the upstream printing unit group drive controller. FIGS. 43A to 43C are operational flowcharts of the upstream printing unit group drive controller. FIGS. 44A to 44C are operational flowcharts of the upstream printing unit group drive controller. FIGS. 45A to 45C are operational flowcharts of the upstream printing unit group drive controller. FIGS. 46A and 46B are operational flowcharts of the upstream printing unit group drive controller. FIG. 47 is an operational flowchart of the upstream printing unit group drive controller.

Figure 48A:
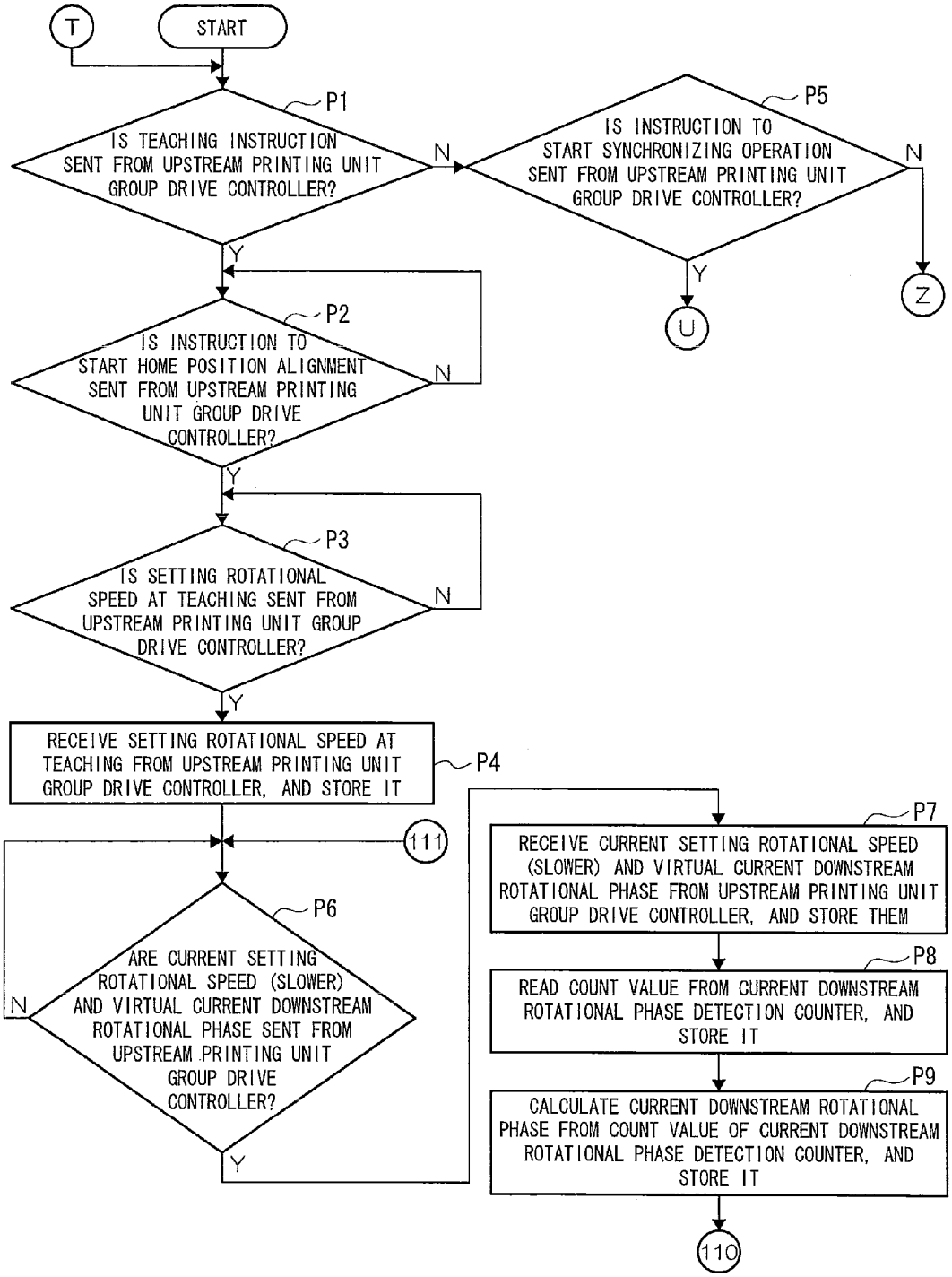
Figure 48B:
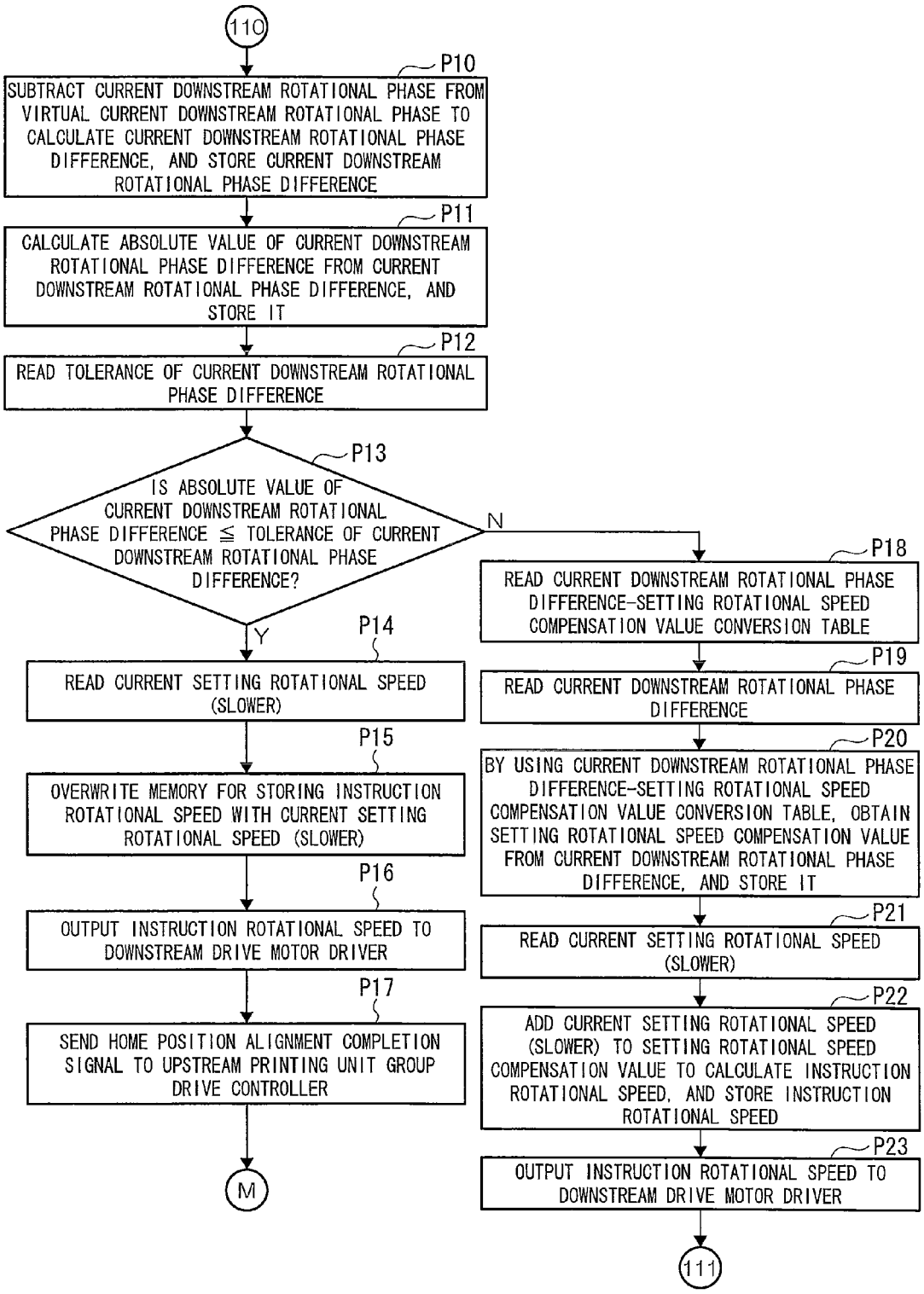
Figure 49A:
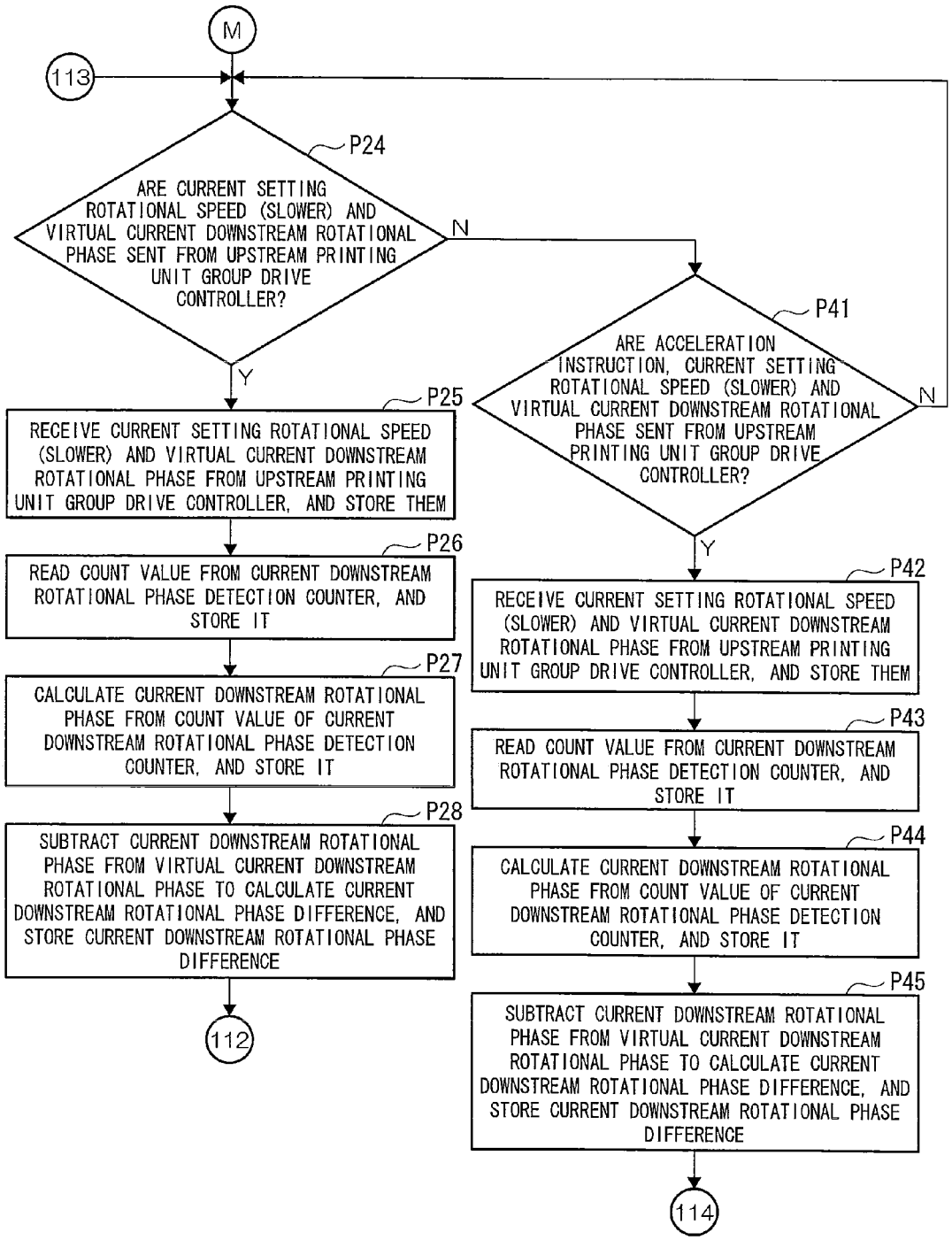
Figure 49B:
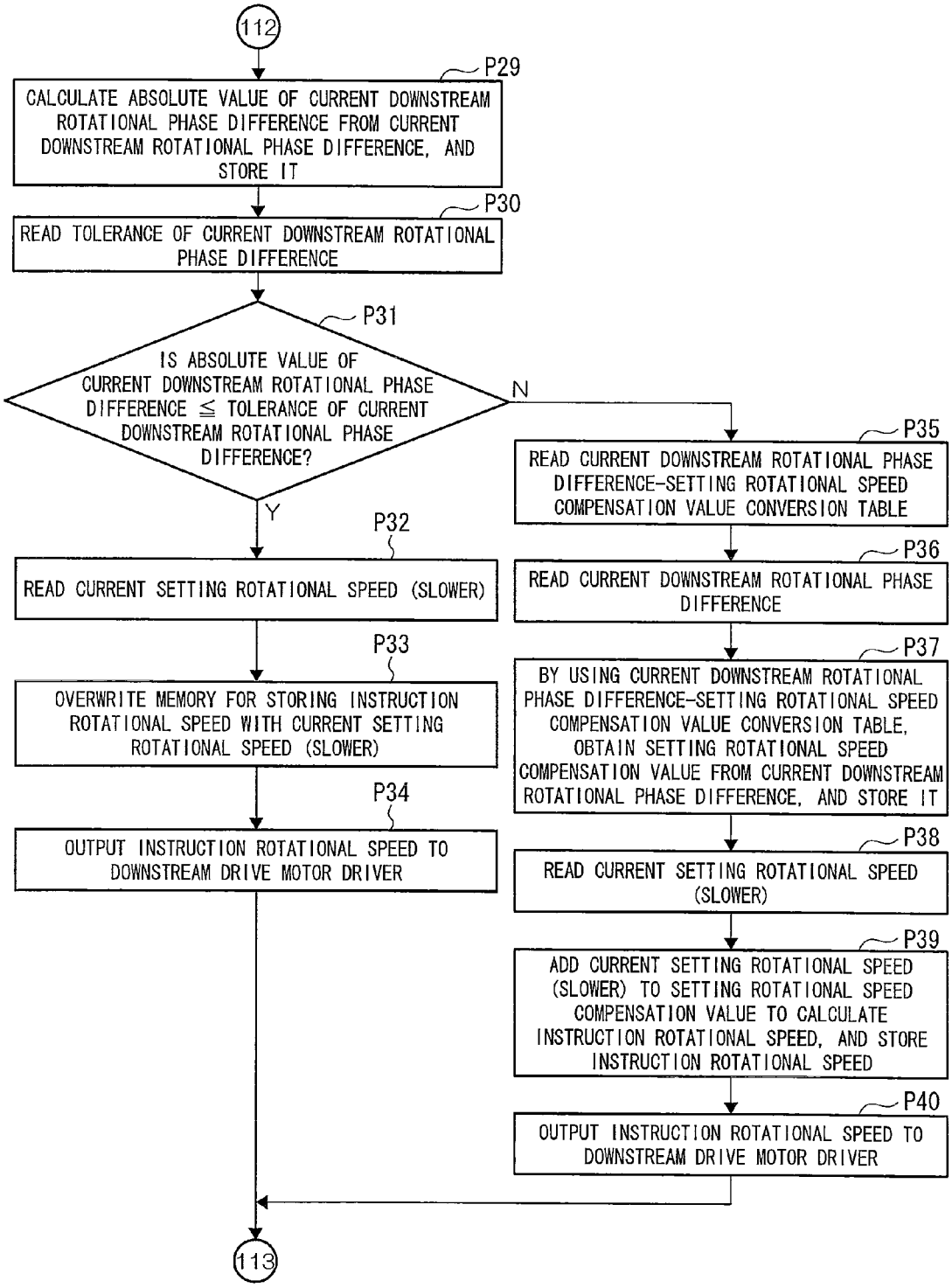
Figure 49C:
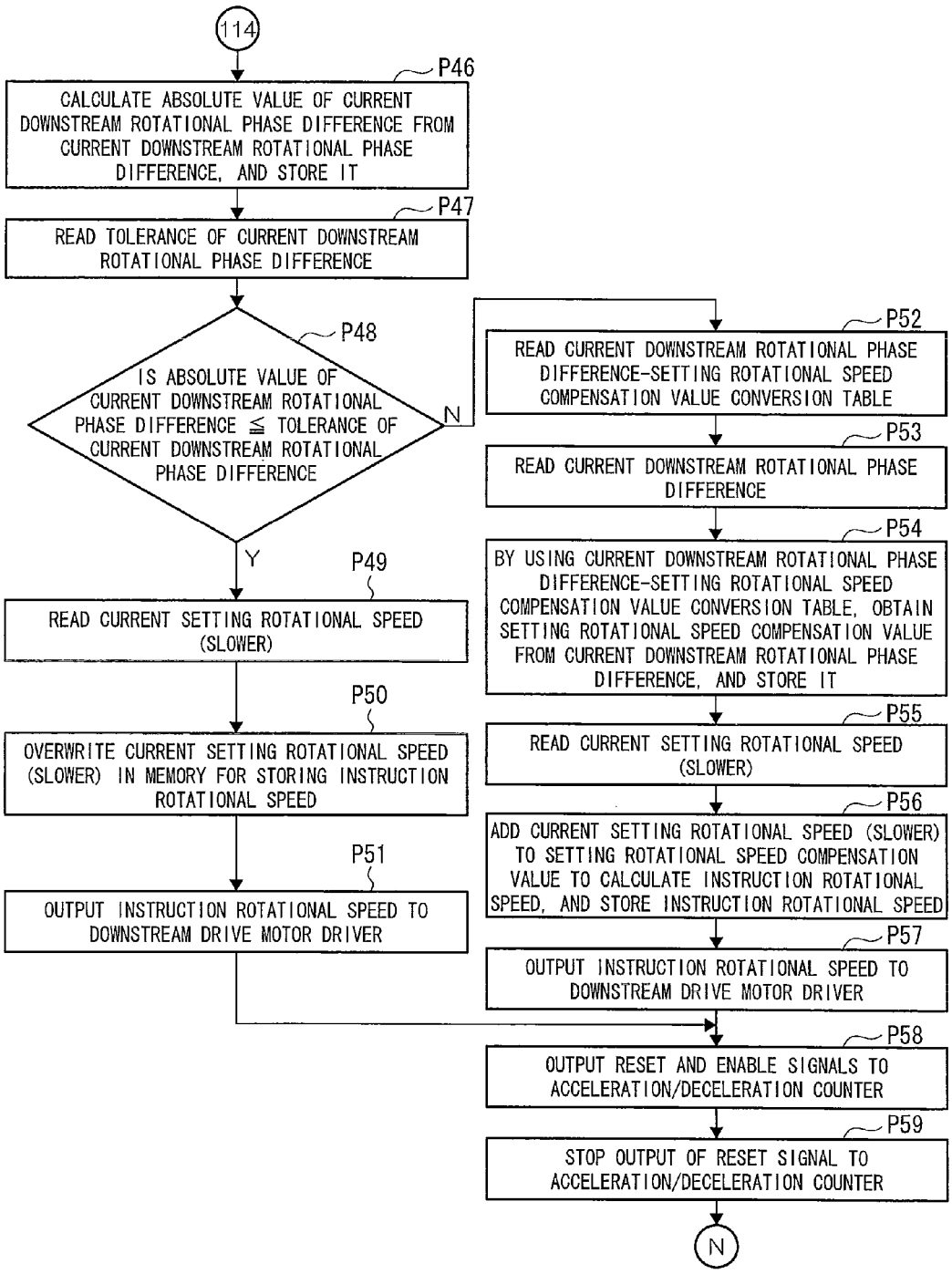
Figure 50A:
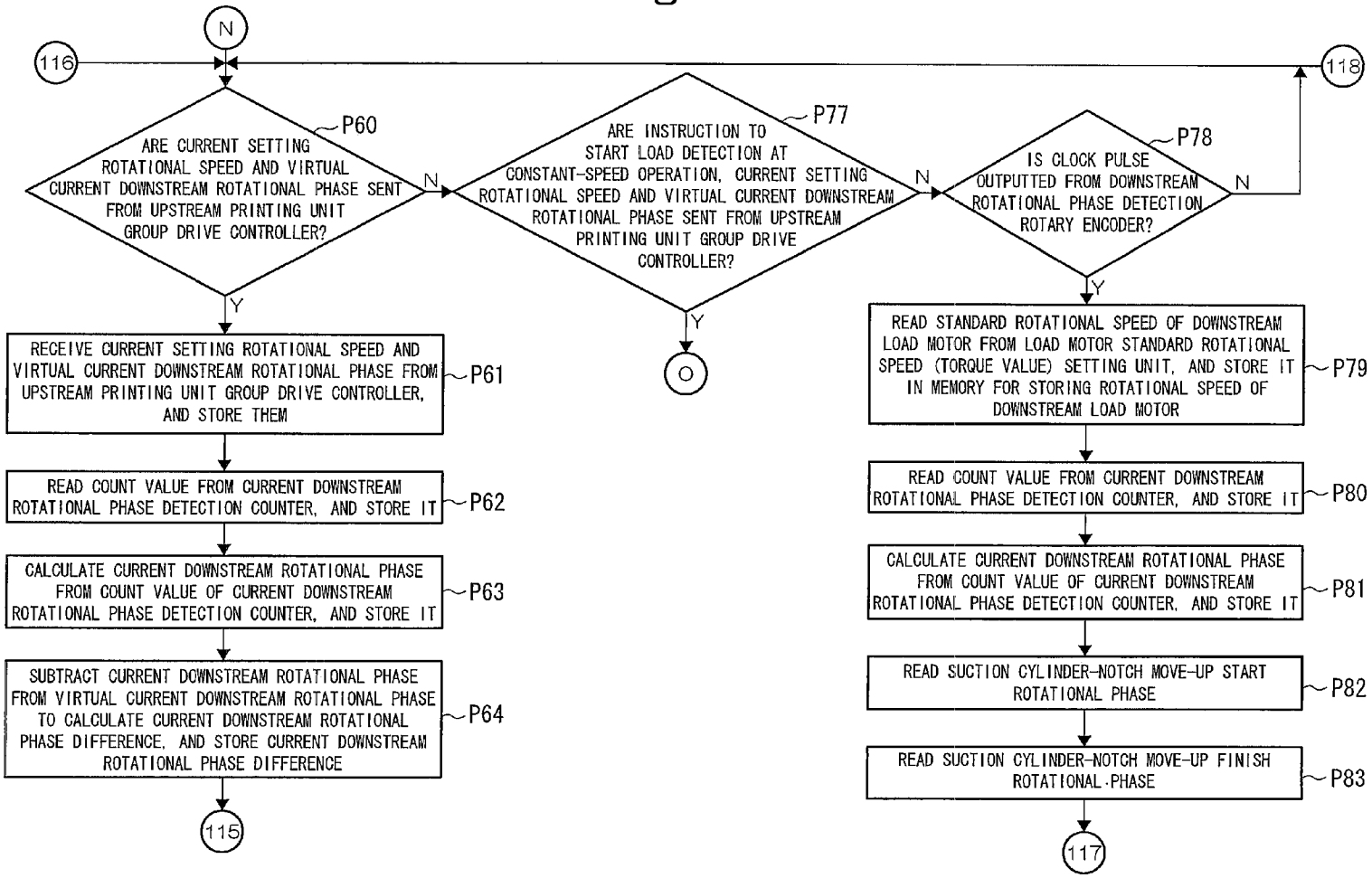
Figure 50B:
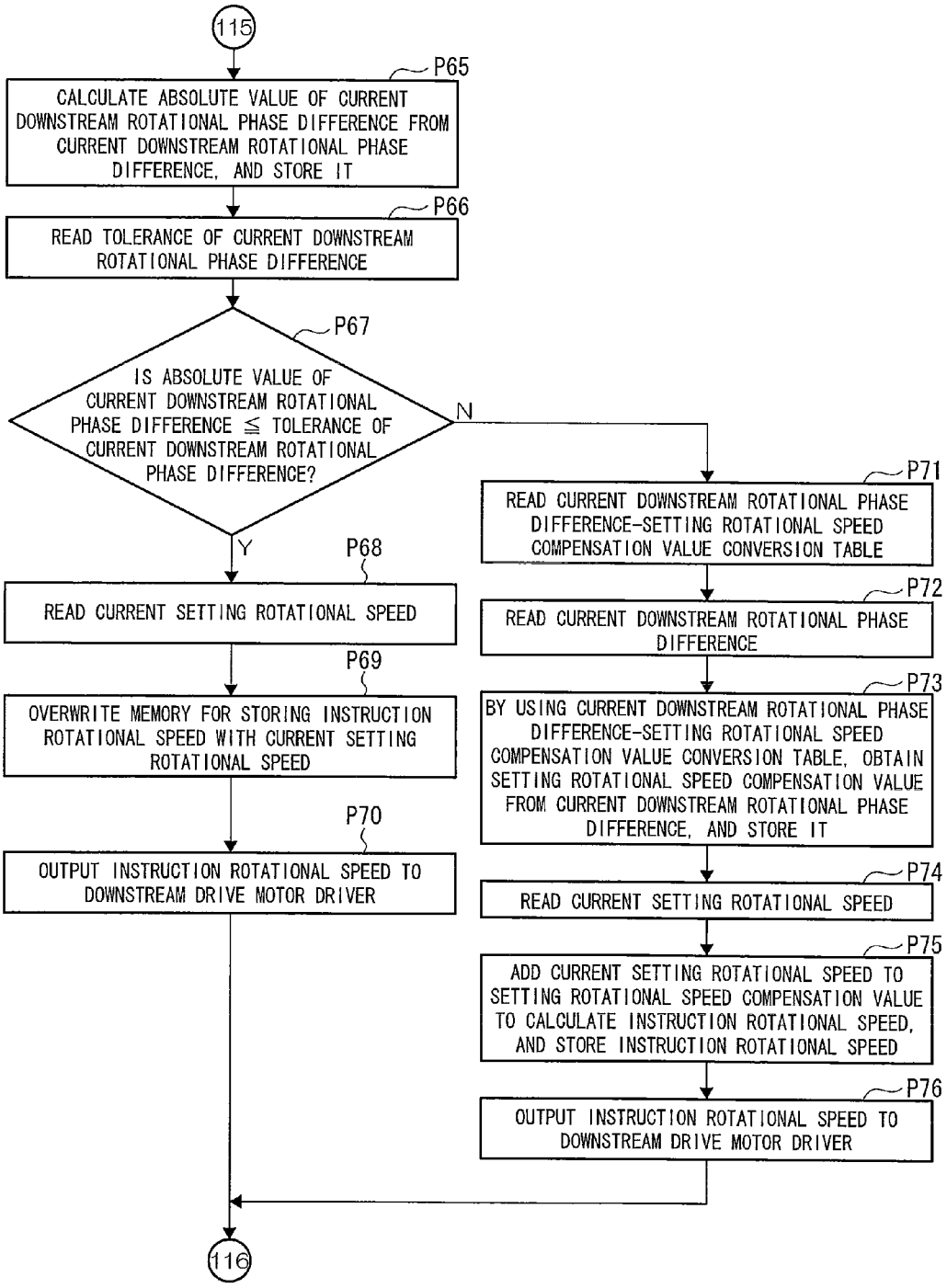
Figure 50C:
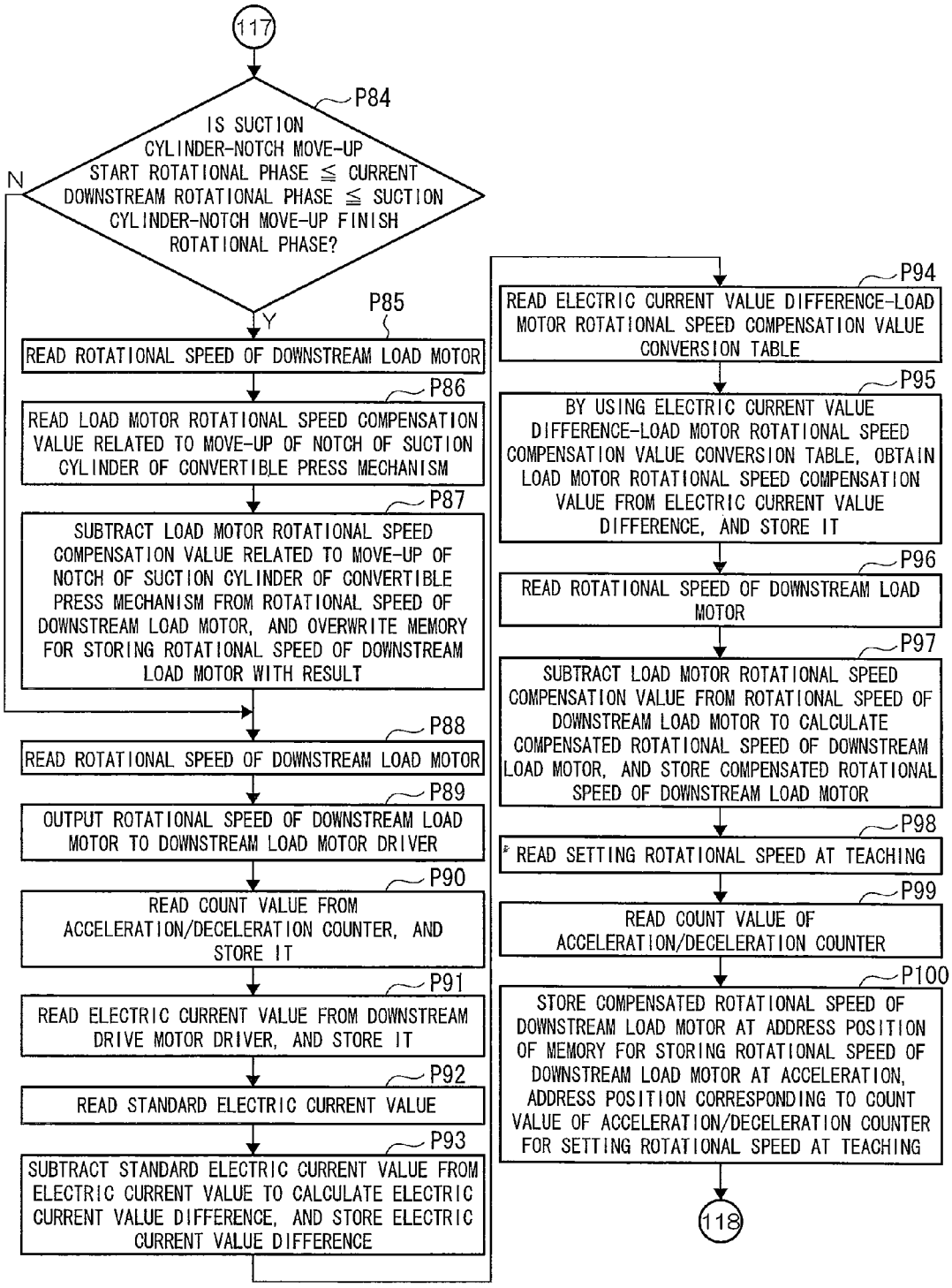
Figure 51:
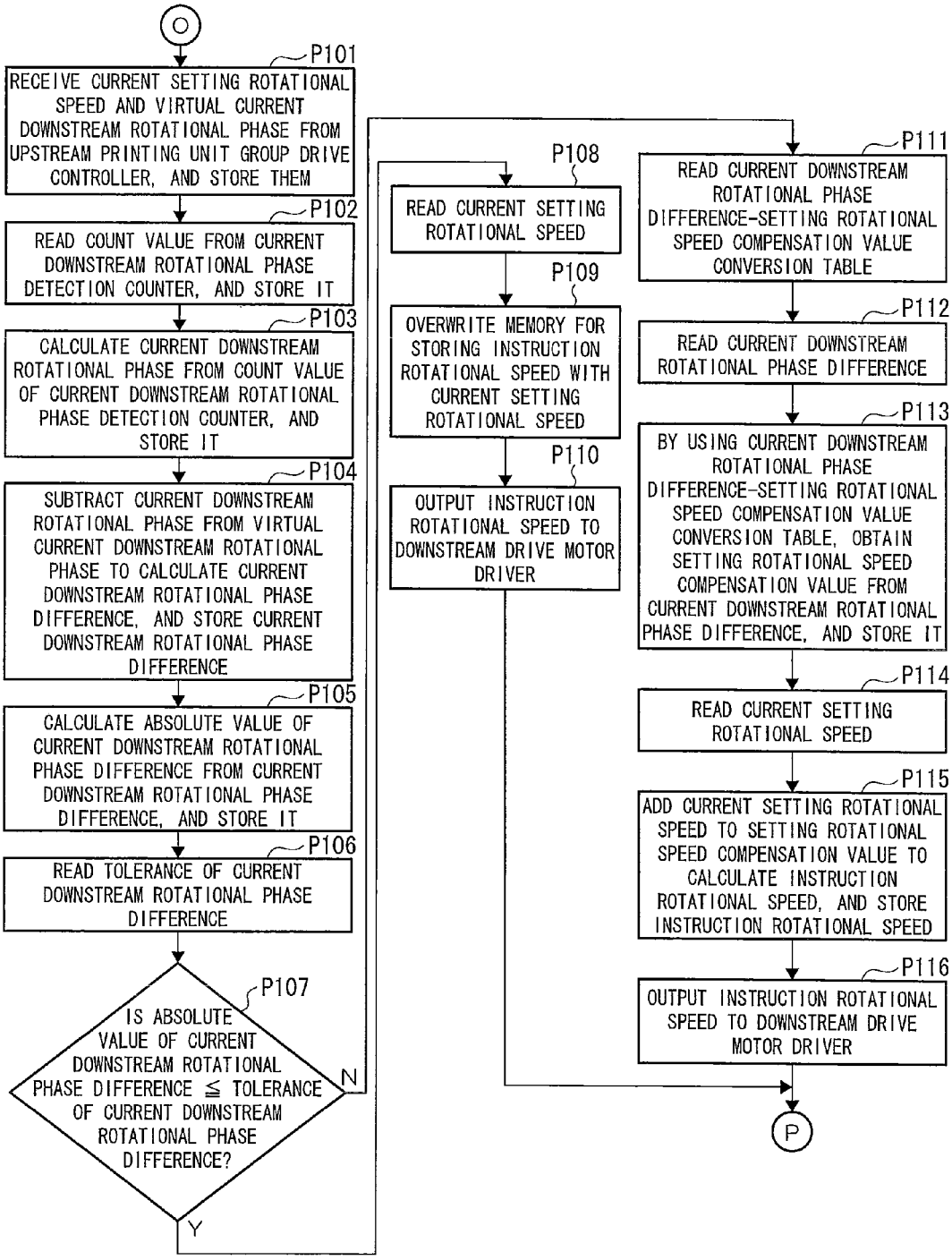

FIGS. 48A and 48B are operational flowcharts of the downstream printing unit group drive controller. FIGS. 49A to 49C are operational flowcharts of the downstream printing unit group drive controller. FIGS. 50A to 50C are operational flowcharts of the downstream printing unit group drive controller. FIG. 51 is an operational flowchart of the downstream printing unit group drive controller. FIGS. 52A to 52C are operational flowcharts of the downstream printing unit group drive controller. FIGS. 53A to 53C are operational flowcharts of the downstream printing unit group drive controller. FIG. 54 is an operational flowchart of the downstream printing unit group drive controller. FIGS. 55A to 55C are operational flowcharts of the downstream printing unit group drive controller. FIGS. 56A and 56B are operational flowcharts of the downstream printing unit group drive controller. FIGS. 57A to 57C are operational flowcharts of the downstream printing unit group drive controller. FIGS. 58A to 58C are operational flowcharts of the downstream printing unit group drive controller. FIGS. 59A to 59C are operational flowcharts of the downstream printing unit group drive controller. FIGS. 60A and 60B are operational flowcharts of the downstream printing unit group drive controller. FIG. 61 is an operational flowchart of the downstream printing unit group drive controller.

In this embodiment, the upstream printing unit group 1A (the upstream drive motor 10A thereof) and downstream printing unit group 1B (the downstream drive motor 10B thereof) are configured to be synchronously controlled (operated), without using the virtual master generator 60 (and the central controller 30) in Embodiment 1, by directly connecting upstream and downstream printing unit group drive controllers 70B and 90B. The other constitution is the same as that of Embodiment 1, so the description thereof with reference to FIGS. 62 to 64 is omitted.

As shown in FIGS. 34A to 34C, the upstream printing unit group drive controller 70B includes a CPU 100*a*, a ROM 101*a*, a RAM 102*a*, input/output units 103*a* to 103*d*, 103*u*, and 103*e* to 103*k*, an interface 104*a*, and an internal clock counter 105, which are connected via a BUS.

The BUS is also connected to: a memory M100 for storing setting rotational speed at teaching; a memory M101 for storing slow rotational speed; a memory M102 for storing current setting rotational speed; a memory M103 for storing previous setting rotational speed; a memory M104 for storing a time interval at which the current setting rotational speed and virtual current downstream rotational phase are sent to the downstream printing unit group drive controller (hereinafter, current setting rotational speed/virtual current downstream rotational phase transmission interval); a memory M105 for storing a count value of a current rotational phase detection counter of the upstream printing unit group (hereinafter, current upstream rotational phase detection counter); a memory M106 for storing current upstream rotational phase; a memory M107 for storing a downstream rotational phase compensation value; and a memory M108 for storing virtual current downstream rotational phase.

The BUS is also connected to: a memory M109 for storing instruction rotational speed; a memory M110 for storing acceleration start upstream rotational phase; a memory M111 for storing a rotational speed correction value at acceleration; a memory M112 for storing corrected current setting rotational speed; a memory M113 for storing rotational speed of the upstream load motor; a memory M114 for storing transfer-cylinder notch move-up start rotational phase; a memory M115 for storing transfer-cylinder notch move-up finish rotational phase; a memory M116 for storing a load motor rotational speed compensation value related to the move-up of the notch of the transfer cylinder of the convertible press mechanism; a memory M117 for storing a count value of the acceleration/deceleration counter; and a memory M118 for storing a electric current value from the upstream drive motor driver.

The BUS is also connected to; a memory M119 for storing a standard electric current value; a memory M120 for storing an electric current value difference; a memory M121 for storing a electric current value difference-load motor rotational speed compensation value conversion table; a memory M122 for storing a rotational speed compensation value of the load motor; a memory M123 for storing compensated rotational speed of the upstream load motor; a memory M124 for storing rotational speed of the upstream load motor at acceleration; a memory M125 for storing constant-speed operation load detection start upstream rotational phase; a memory M126 for storing rotational speed of the upstream load motor at constant-speed operation; a memory M127 for storing rotational phase of the upstream printing unit group at which load detection at constant-speed operation is finished; and a memory M128 for storing deceleration start upstream rotational phase.

The BUS is also connected to: a memory M129 for storing a rotational speed correction value at deceleration; a memory M130 for storing rotational speed of the upstream load motor at deceleration; a memory M131 for storing outputs of the F/V converters connected to the upstream and downstream drive motor rotary encoders, respectively; a memory M132 for storing current rotational speeds of the upstream and downstream printing unit groups, respectively; a memory M133 for storing setting rotational speed at synchronizing operation.

The input/output unit 103*a* is connected to a teaching switch 106, a synchronizing operation switch 107, a printing press drive switch 108, a printing press stop switch 109, a single drive switch 110 for the upstream printing unit group (hereinafter, upstream single drive switch 110), a drive stop switch 111 for the upstream printing unit group (hereinafter, upstream drive stop switch 111), an input unit 112 such as a keyboard and various types of switches and buttons, a display unit 113 such as a CRT and a lamp, and an output unit 114 such as a printer and a floppy disk (registered trademark) drive.

The input/output unit 103*b* is connected to a rotational speed setting unit 115.

The input/output unit 103*c* is connected to the upstream drive motor 10A through a D/A converter 116 and an upstream drive motor driver 117. The upstream drive motor driver 117 is also connected to an upstream drive motor rotary encoder 118 coupled to and driven by the upstream drive motor 10A. The upstream drive motor driver 117 is also connected to the upstream load motor 18A later described.

The input/output unit 103*d* is connected to the upstream drive motor driver 117. The input/output unit 103*u* is connected to the upstream drive motor rotary encoder 118 through the A/D converter 122 and the F/V converter 123.

The input/output unit 103*e* is connected to an upstream rotational phase detection rotary encoder 20A through the current upstream rotational phase detection counter 119. The input/output unit 103*f* is connected to the upstream rotational phase detection rotary encoder 20A through the acceleration/deceleration counter 121. The input/output unit 103*g* is connected to the upstream rotational phase detection rotary encoder 20A.

The input/output unit 103*h* is connected to a load motor standard rotational speed setting unit 124.

The input/output unit 103*i* is connected to the upstream load motor 18A through a D/A converter 125 and an upstream load motor driver 126. The upstream load motor driver 126 is connected to the upstream load motor rotary encoder 120 coupled to and driven by the upstream load motor 18A.

The input/output unit 103*j* is connected to the downstream drive motor rotary encoder 129 through an A/D converter 127 and an F/V converter 128.

The input/output unit 103*k* is connected to a single drive rotational speed setting unit for the upstream printing unit group 130 (hereinafter, upstream single drive rotational speed setting unit 130).

The interface 104*a* is connected to a printing press controller 55B and the downstream printing unit group drive controller 90B.

As shown in FIGS. 35A and 35B, the downstream printing unit group drive controller 90B includes a CPU 100*b*, a ROM 101*b*, a RAM 102*b*, input/output units 1031 to 103*t*, and an interface 104*b*, which are connected via a BUS.

The BUS is also connected to: a memory M134 for storing setting rotational speed at teaching; a memory M135 for storing current setting rotational speed; a memory M136 for storing virtual current downstream rotational phase; a memory M137 for storing a count value of a current rotational phase detection counter of the downstream printing unit group (hereinafter, current downstream rotational phase detection counter); a memory M138 for storing current downstream rotational phase; a memory M139 for storing a current downstream rotational phase difference; a memory M140 for storing an absolute value of the current downstream rotational phase difference; and a memory M141 for storing a tolerance of the current downstream rotational phase difference.

The BUS is also connected to: a memory M142 for storing instruction rotational speed; a memory M143 for storing a current downstream rotational phase difference-setting rotational speed compensation value conversion table; a memory M144 for storing a setting rotational speed compensation value; a memory M145 for storing rotational speed of the downstream load motor; a memory M146 for storing suction cylinder-notch move-up start rotational phase; a memory M147 for storing suction cylinder-notch move-up finish rotational phase; a memory M148 for storing a load motor rotational speed compensation value related to move-up of the notch of the suction cylinder of the convertible press mechanism; a memory M149 for storing a count value of the acceleration/deceleration counter; and a memory M150 for storing an electric current value from the downstream drive motor driver.

The BUS is also connected to; a memory M151 for storing a standard electric current value; a memory M152 for storing an electric current value difference; a memory M153 for storing an electric current value difference-load motor rotational speed compensation value conversion table; a memory M154 for storing a load motor rotational speed compensation value; a memory M155 for storing compensated rotational speed of the downstream load motor; a memory M156 for storing rotational speed of the downstream load motor at acceleration; a memory M157 for storing rotational speed of the downstream load motor at constant-speed operation; a memory M158 for storing rotational speed of the downstream load motor at deceleration; and a memory M159 for storing setting rotational speed at synchronizing operation.

The input/output unit 1031 is connected to a printing press stop switch 131, a single drive switch 132 for the downstream printing unit group (hereinafter, downstream single drive switch 132), a drive stop switch 133 for the downstream printing unit group (hereinafter, downstream drive stop switch 133), an input unit 134 such as a keyboard and various types of switches and buttons, a display unit 135 such as a CRT and a lamp, and an output unit 136 such as a printer and a floppy disk (registered trademark) drive.

The input/output unit 103*m* is connected to the downstream drive motor 10B through a D/A converter 137 and a downstream drive motor driver 138. The downstream drive motor driver 138 is connected to input/output unit 103*n* and a downstream drive motor rotary encoder 129 coupled to and driven by the downstream drive motor 10B. The downstream drive motor driver 138 is also connected to the downstream load motor 18B later described.

The input/output unit 103*o* is connected to a downstream rotational phase detection rotary encoder 20B through the current downstream rotational phase detection counter 140. The input/output unit 103*p* is connected to the downstream rotational phase detection rotary encoder 20B through an acceleration/deceleration counter 142. The input/output unit 103*q* is connected to the downstream rotational phase detection rotary encoder 20B.

The input/output unit 103*r* is connected to a load motor standard rotational speed setting unit 143.

The input/output unit 103*s* is connected to the downstream load motor 18B through a D/A converter 144 and a downstream load motor driver 145. The downstream load motor driver 145 is connected to the downstream load motor rotary encoder 141 coupled to and driven by the downstream load motor 18B.

The input/output unit 103*t* is connected to a single drive rotational speed setting unit of the downstream printing unit group (hereinafter, downstream single drive rotational speed setting unit 146).

The interface 104*b* is connected to the upstream printing unit group drive controller 70B.

The upstream printing unit group drive controller 70B is configured as described above and operates according to the operational flows shown in FIGS. 36A to 36E, 37A to 37C, 38A and 38B, 39A to 39D, 40A and 40B, 41A to 41C, 42A to 42D, 43A to 43C, 44A to 44C, 45A to 45C, 46A and 46B, and 47.

Specifically, in step P1, it is judged whether the teaching switch 106 is turned on. If the teaching switch 106 is turned on, the process proceeds to step P2. When the printing press drive switch 108 is turned on in step P2, in step P3, a teaching instruction is sent to the downstream printing unit group drive controller 90B. If no in step P1, in step P4, it is judged whether the synchronizing operation switch 107 is turned on.

If yes in step P4, in step P5, an instruction to start synchronizing operation is sent to the downstream printing unit group drive controller 90B, and then the process proceeds to later-described step P257. If no in step P4, in step P6, it is judged whether setting rotational speed is inputted to the rotational speed setting unit 115.

If yes in step P6, in step P7, the setting rotational speed is read from the rotational speed setting unit 115, and is stored in the memory M102 for storing the current setting rotational speed. Then, the process proceeds to later-described step P448. If no in step P6, the process directly proceeds to later-described step P448.

In step P8, an instruction to start home position alignment is sent to the downstream printing unit group drive controller 90B. In step P9, the setting rotational speed is read from the rotational speed setting unit 115, and is stored in the memory M100 for storing the setting rotational speed at teaching. Subsequently, in step P10, the setting rotational speed at teaching is sent to the downstream printing unit group drive controller 90B.

Next, slow rotational speed is read form the memory M101 in step P11, and is written in the memory M102 for storing the current setting rotational speed and the memory M103 for storing the previous setting rotational speed in step P12.

In step P13, the internal clock counter 105 (for counting elapsed time) starts to count. In step P14, the current setting rotational speed/virtual current downstream rotational phase transmission interval is read from the memory M104.

Next, in step P15, the count value of the internal clock counter 105 is read, and in step P16, it is judged whether the counter value of the internal clock counter 105 is equal to or more than the current setting rotational speed/virtual current downstream rotational phase transmission interval.

If yes in step P16, in step P17, the count value is read from the current upstream rotational phase detection counter 119 and is stored in the memory M105. In step P18, from the count value of the current upstream rotational phase detection counter 119, the current upstream rotational phase is calculated and stored in the memory M106.

Next, in step P19, the downstream rotational phase compensation value is read from the memory M107. In step P20, the current upstream rotational phase is added to the downstream rotational phase compensation value to calculate the virtual current downstream rotational phase, which is then stored in the memory M108.

Next, in step P21, the current setting rotational speed (slow) is read from the memory M102, and in step P22, the current setting rotational speed (slow) and virtual current downstream rotational phase are sent to the downstream printing unit group drive controller 90B.

Next, in step P23, the memory M109 for storing the instruction rotational speed is overwritten with the current setting rotational speed (slow). Thereafter, in step P24, the instruction rotational speed is outputted to the upstream drive motor driver 117. Subsequently, in step P25, the current setting rotational speed (slow) is stored in the memory M103 for storing the previous setting rotational speed, and the process returns to step P13.

On the other hand, if no in step P16, in step P26, it is judged whether a home position alignment completion signal is sent from the downstream printing unit group drive controller 90B. If yes in step P26, in step P27, the current setting rotational speed/virtual current downstream rotational phase transmission interval is read from the memory M104, and if no, the process returns to step P14.

Next, in step P28, the count value of the internal clock counter 105 is read, and in step P29, it is judged whether the count value of the internal clock counter 105 is equal to or more than the current setting rotational speed/virtual current downstream rotational phase transmission interval.

If yes in step P29, in step P30, the count value is read from the current upstream rotational phase detection counter 119 and is stored in the memory M105. If no in step P29, the process returns to step P27.

Next, in step P31, from the count value of the current upstream rotational phase detection counter 119, the current upstream rotational phase is calculated and stored in the memory M106. In step P32, the downstream rotational phase compensation value is read from the memory M107.

Next, in step P33, the current upstream rotational phase is added to the downstream rotational phase compensation value to calculate the virtual current downstream rotational phase, which is then stored in the memory M108. In step P34, the current setting rotational speed (slow) is read from the memory M102.

Next, in step P35, the current setting rotational speed (slow) and the virtual current downstream rotational phase are sent to the downstream printing unit group drive controller 90B. In step P36, the memory M109 for storing the instruction rotational speed is overwritten with the current setting rotational speed (slow).

Next, in step P37, the instruction rotational speed is outputted to the upstream drive motor driver 117. In step P38, the current setting rotational speed (slow) is stored in the memory M103 for storing the previous setting rotational speed.

Next, in step P39, the internal clock counter 105 (for counting elapsed time) starts to count. In step P40, the current setting rotational speed/virtual current downstream rotational phase transmission interval is read from the memory M104.

Next, in step P41, the count value of the internal clock counter 105 is read. In step P42, it is judged whether the count value of the internal clock counter 105 is equal to or more than the current setting rotational speed/virtual current downstream rotational phase transmission interval.

If yes in step P42, in step P43, the count value is read from the current upstream rotational phase detection counter 119 and is stored in the memory M105. In step P44, from the count value of the current upstream rotational phase detection counter 119, the current upstream rotational phase is calculated and then stored in the memory M106.

Next, in step P45, the downstream rotational phase compensation value is read from the memory M107. In step P46, the current upstream rotational phase is added to the downstream rotational phase compensation value to calculate the virtual current downstream rotational phase, which is then stored in the memory M108.

Next, in step P47, the current setting rotational speed (slow) is read from the memory M102. In step P48, the current setting rotational speed (slow) and the virtual current downstream rotational phase are sent to the downstream printing unit group drive controller 90B.

Next, in step P49, the memory M109 for storing the instruction rotational speed is overwritten with the current setting rotational speed (slow), and in step P50, the instruction rotational speed is outputted to the upstream drive motor driver 117. Subsequently, in step P51, the current setting rotational speed (slow) is stored in the memory M103 for storing the previous setting rotational speed, and the process returns to step P39.

On the other hand, if no in step P42, in step P52, the count value is read from the current upstream rotational phase detection counter 119 and is stored in the memory M105. In step P53, from the count value of the current upstream rotational phase detection counter 119, the current upstream rotational phase is calculated, and then stored in the memory M106.

Next, in step P54, the acceleration start upstream rotational phase is read from the memory M110. In step P55, it is then judged whether the current upstream rotational phase is equal to the acceleration start upstream rotational phase. If yes in step P55, in step P56, an instruction to start printing is sent to the printing press controller 55B, and if no, the process returns to step P40.

Next, in step P57, the acceleration start upstream rotational phase is read from the memory M110, and in step P58, the downstream rotational phase compensation value is read from the memory M107. Subsequently, in step P59, the acceleration start upstream rotational phase is added to the downstream rotational phase compensation value to calculate the virtual current downstream rotational phase, which is then stored in the memory M108.

Next, in step P60, the current setting rotational speed (slow) is read from the memory M102, and in step P61, the acceleration instruction, the current setting rotational speed (slow) and the virtual current downstream rotational phase are sent to the downstream printing unit group drive controller 90B.

Next, in step P62, the memory M109 for storing the instruction rotational speed is overwritten with the current setting rotational speed (slow), and in step P63, the instruction rotational speed is outputted to the upstream drive motor driver 117. Subsequently, in step P64, the current setting rotational speed (slow) is stored in the memory M103 for storing the previous setting rotational speed.

Next, in step P65, reset and enable signals are outputted to the acceleration/deceleration counter 121, and in step P66, the output of the reset signal to the acceleration/deceleration counter 121 is stopped.

Next, in step P67, the internal clock counter (for counting elapsed time) 105 starts to count. In step P68, the current setting rotational speed/virtual current downstream rotational phase transmission interval is read from the memory M104.

In step P69, the count value of the internal clock counter 105 is read. In step P70, it is judged whether the count value of the internal clock counter 105 is equal to or more than the current setting rotational speed/virtual current downstream rotational phase transmission interval.

If yes in step P70, in step P71, the count value is read from the current upstream rotational phase detection counter 119 and is stored in the memory M105. In step P72, from the count value of the current upstream rotational phase detection counter 119, the current upstream rotational phase is calculated and then stored in the memory M106.

Next, in step P73, the downstream rotational phase compensation value is read from the memory M107. In step P74, the current upstream rotational phase is added to the downstream rotational phase compensation value to calculate the virtual current downstream rotational phase, which is stored in the memory M108.

Next, in step P75, the previous setting rotational speed is read from the memory M103, and in step P76, the rotational speed correction value at acceleration is read from the memory M111. Subsequently, in step P77, the previous setting rotational speed is added to the rotational speed correction value at acceleration to calculate the corrected current setting rotational speed, which is then stored in the memory M112.

Next, in step P78, the setting rotational speed is read from the rotational speed setting unit 115 and is stored in the memory M102 for storing the current setting rotational speed. In step P79, it is judged whether the corrected current setting rotational speed is less than the current setting rotational speed.

Next, if yes in step P79, in step P80, the corrected current setting rotational speed is stored in the memory M102 for storing the current setting rotational speed. In step P81, the current setting rotational speed and the virtual current downstream rotational phase are sent to the downstream printing unit group drive controller 90B.

Next, in step P82, the memory M109 for storing the instruction rotational speed is overwritten with the current setting rotational speed, and in step P83, the instruction rotational speed is outputted to the upstream drive motor driver 117. Subsequently, in step P84, the current setting rotational speed is stored in the memory M103 for storing the previous setting rotational speed, and the process returns to step P67.

On the other hand, if no in step P79, in step P85, the current setting rotational speed and the virtual current downstream rotational phase are sent to the downstream printing unit group drive controller 90B. In step P86, the memory M109 for storing the instruction rotational speed is overwritten with the current setting rotational speed.

Next, in step P87, the instruction rotational speed is outputted to the upstream drive motor driver 117, and in step P88, the current setting rotational speed is stored in the memory M103 for storing the previous setting rotational speed. The process then proceeds to step P112.

If no in step P70, in step P89, it is judged whether a clock pulse is outputted from the upstream rotational phase detection rotary encoder 20A. If yes in step P89, in step P90, the standard rotational speed of the upstream load motor 18A is read from the load motor standard rotational speed (torque value) setting unit 124, and is then stored in the memory M113 for storing the rotational speed of the upstream load motor. If no in step P89, the process returns to step P68.

Next, in step P91, the count value is read from the current upstream rotational phase detection counter 119 and is stored in the memory M105. In step P92, from the count value of the current upstream rotational phase detection counter 119, the current upstream rotational phase is calculated and then stored in the memory M106.

Next, in step P93, the transfer cylinder notch move-up start rotational phase is read from the memory M114, and in step P94, the transfer cylinder-notch move-up finish rotational phase is read from the memory M115.

Next, in step P95, it is judged whether the current upstream rotational phase is equal to or more than the transfer cylinder-notch move-up start rotational phase, and is equal to or less than the transfer cylinder-notch move-up finish rotational phase. If yes in step P95, in step P96, the rotational speed of the upstream load motor 18A is read from the memory M113, and if no, the process proceeds to later-described step P99.

Next, the load motor rotational speed compensation value related to move-up of the notch of the transfer cylinder 6 of the convertible press mechanism 2 is read from the memory M116 in step P97, and is then subtracted from the rotational speed of the upstream load motor 18A in step P98. The memory M113 for storing the rotational speed of the upstream load motor is overwritten with the obtained result.

Next, the rotational speed of the upstream load motor 18A is read from the memory M113 in step P99, and is then outputted to the upstream load motor driver 126 in step P100.

Next, in step P101, the count value is read from the acceleration/deceleration counter 121 and is stored in the memory M117. In step P102, the electric current value is read from the upstream drive motor driver 117 and is stored in the memory M118.

Next, in step P103, the standard electric current value is read from the memory M119. In step P104, the standard electric current value is subtracted from the electric current value to calculate the electric current value difference, which is then stored in the memory M120.

Next, in step P105, the electric current value difference-load motor rotational speed compensation value conversion table is read from the memory M121. In step P106, by using the electric current value difference-load motor rotational speed compensation value conversion table, the load motor rotational speed compensation value is obtained from the electric current value difference and is stored in the memory M122.

Next, in step P107, the rotational speed of the upstream load motor 18A is read from the memory M113. In step P108, the load motor rotational speed compensation value is subtracted from the rotational speed of the upstream load motor 18A to calculate the compensated rotational speed of the upstream load motor 18A, which is then stored in the memory M123.

Next, in step P109, the setting rotational speed at teaching is read from the memory M100, and in step P110, the count value of the acceleration/deceleration counter 121 is read from the memory M117. Next, in step P111, the compensated rotational speed of the upstream load motor 18A is stored at an address position of the memory M124 for storing the rotational speed of the upstream load motor at acceleration, the address position corresponding to the count value of the acceleration/deceleration counter 121 for the setting rotational speed at teaching. Then, the process returns to step P68.

Next, in step P112 to which the process proceeds from step P88, the internal clock counter 105 (for counting elapsed time) starts to count. In step P113, the current setting rotational speed/virtual current downstream rotational phase transmission interval is read from the memory M104.

Next, in step P114, the count value of the internal clock counter 105 is read, and in step P115, it is judged whether the count value of the internal clock counter 105 is equal to or more than the current setting rotational speed/virtual current downstream rotational phase transmission interval.

If yes in step P115, in step P116, the count value is read from the current upstream rotational phase detection counter 119 and is stored in the memory M105. In step P117, the current upstream rotational phase is calculated from the count value of the current upstream rotational phase detection counter 119 and is stored in the memory M106.

Next, in step P118, the downstream rotational phase compensation value is read from the memory M107. In step P119, the current upstream rotational phase is added to the downstream rotational phase compensation value to calculate the virtual current downstream rotational phase, which is then stored in the memory M108.

Next, in step P120, the setting rotational speed is read from the rotational speed setting unit 115, and is stored in the memory M102 for storing the current setting rotational speed. In step P121, the current setting rotational speed and the virtual current downstream rotational phase are sent to the downstream printing unit group drive controller 90B.

Next, in step P122, the memory M109 for storing the instruction rotational speed is overwritten with the current setting rotational speed, and in step P123, the instruction rotational speed is outputted to the upstream drive motor driver 117. Subsequently, in step P124, the current setting rotational speed is stored in the memory M103 for storing the previous setting rotational speed, and the process returns to step P112.

On the other hand, if no in step P115, in step P125, the count value is read from the current upstream rotational phase detection counter 119 and is stored in the memory M105. In step P126, from the count value of the current upstream rotational phase detection counter 119, the current upstream rotational phase is calculated and then stored in the memory M106.

Next, in step P127, the constant-speed operation load detection start upstream rotational phase is read from the memory M125. In step P128, it is judged whether the current upstream rotational phase is equal to the constant-speed operation load detection start upstream rotational phase.

Next, if yes in step P128, in step P129, the constant-speed operation load detection start upstream rotational phase is read from the memory M125. If no in step P128, the process returns to step P113. In step P130, the downstream rotational phase compensation value is read from the memory M107.

Next, in step P131, the constant-speed operation load detection start upstream rotational phase is added to the downstream rotational phase compensation value to calculate the virtual current downstream rotational phase, which is then stored in the memory M108. In step P132, the setting rotational speed is read from the rotational speed setting unit 115 and is stored in the memory M102 for storing the current setting rotational speed.

Next, in step P133, the instruction to start load detection at constant-speed operation, the current setting rotational speed, and the virtual current downstream rotational phase are sent to the downstream printing unit group drive controller 90B. In step P134, the memory M109 for storing the instruction rotational speed is overwritten with the current setting rotational speed.

Next, in step P135, the instruction rotational speed is outputted to the upstream drive motor driver 117, and in step P136, the current setting rotational speed is stored in the memory M103 for storing the previous setting rotational speed.

Next, in step P137, the internal clock counter 105 (for counting elapsed time) starts to count. In step P138, the current setting rotational speed/virtual current downstream rotational phase transmission interval is read from the memory M104.

Next, in step P139, the count value of the internal clock counter 105 is read. In step P140, it is judged whether the count value of the internal clock counter 105 is equal to or more than the current setting rotational speed/virtual current downstream rotational phase transmission interval.

If yes in step P140, in step P141, the count value is read from the current upstream rotational phase detection counter 119 and is stored in the memory M105. In step P142, from the count value of the current upstream rotational phase detection counter 119, the current upstream rotational phase is calculated and then stored in the memory M106.

Next, in step P143, the downstream rotational phase compensation value is read from the memory M107. In step P144, the current upstream rotational phase is added to the downstream rotational phase compensation value to calculate the virtual current downstream rotational phase, which is then stored in the memory M108.

Next, in step P145, the setting rotational speed is read from the rotational speed setting unit 115 and is stored in the memory M102 for storing the current setting rotational speed. In step P146, the current setting rotational speed and the virtual current downstream rotational phase are then sent to the downstream printing unit group drive controller 90B.

Next, in step P147, the memory M109 for storing the instruction rotational speed is overwritten with the current setting rotational speed. In step P148, the instruction rotational speed is outputted to the upstream drive motor driver 117. Subsequently, in step P149, the current setting rotational speed is stored in the memory M103 for storing the previous setting rotational speed, and the process returns to step P137.

On the other hand, if no in step P140, in step P150, the count value is read from the current upstream rotational phase detection counter 119 and is stored in the memory M105. In step P151, the current upstream rotational phase is calculated from the count value of the current upstream rotational phase detection counter 119 and is stored in the memory M106.

Next, in step P152, the constant-speed operation load detection finish upstream rotational phase is read from the memory M127. In step P153, it is judged whether the current upstream rotational phase is equal to the constant-speed operation load detection finish upstream rotational phase.

If yes in step P153, in step P154, the constant-speed operation load detection finish upstream rotational phase is read from the memory M127. If no in step P153, the process proceeds to later-described step P162. In step P155, the downstream rotational phase compensation value is read from the memory M107.

Next, in step P156, the constant-speed operation load detection finish upstream rotational phase is added to the downstream rotational phase compensation value to calculate the virtual current downstream rotational phase, which is then stored in the memory M108. In step P157, the setting rotational speed is read from the rotational speed setting unit 115 and is stored in the memory M102 for storing the current setting rotational speed.

Next, in step P158, the instruction to finish load detection at constant-speed operation, the current setting rotational speed and the virtual current downstream rotational phase are sent to the downstream printing unit group drive controller 90B. In step P159, the memory M109 for storing the instruction rotational speed is overwritten with the current setting rotational speed.

Next, in step P160, the instruction rotational speed is outputted to the upstream drive motor driver 117, and in step P161, the current setting rotational speed is stored in the memory M103 for storing the previous setting rotational speed. The process then proceeds to later-described step P184.

Next, in step P162, it is judged whether the clock pulse is outputted from the upstream rotational phase detection rotary encoder 20A. If yes in step P162, in step P163, the standard rotational speed of the upstream load motor 18A is read from the load motor standard rotational speed (torque value) setting unit 124, and is then stored in the memory M113 for storing the rotational speed of the upstream load motor. If no in step P162, the process returns to step P138.

Next, in step P164, the count value is read from the current upstream rotational phase detection counter 119 and is stored in the memory M105. In step P165, the current upstream rotational phase is calculated from the count value of the current upstream rotational phase detection counter 119 and is stored in the memory M106.

Next, in step P166, the transfer cylinder-notch move-up start rotational phase is read from the memory M114, and in step P167, the transfer cylinder-notch move-up finish rotational phase is read from the memory M115.

Next, in step P168, it is judged whether the current upstream rotational phase is equal to or more than the transfer cylinder-notch move-up start rotational phase, and is equal to or less than the transfer cylinder-notch move-up finish rotational phase. If yes in step P168, in step P169, the rotational speed of the upstream load motor 18A is read from the memory M113, and if no, the process proceeds to later-described step P172.

Next, the load motor rotational speed compensation value related to move-up of the notch of the transfer cylinder 6 of the convertible press mechanism 2 is read from the memory M116 in step P170, and is then subtracted from the rotational speed of the upstream load motor 18A in step P171. Then, the memory M113 for storing the rotational speed of the upstream load motor is overwritten with the obtained result.

Next, in step P172, the rotational speed of the upstream load motor 18A is read from the M113. Then in step P173, the rotational speed of the upstream load motor 18A is outputted to the upstream load motor driver 126. Subsequently, in step P174, the electric current value is read from the upstream drive motor driver 117 and is stored in the memory M118.

Next, in step P175, the standard electric current value is read from the memory M119. In step P176, the standard electric current value is subtracted from the electric current value to calculate the electric current value difference, which is then stored in the memory M120.

Next, in step P177, the electric current value difference-load motor rotational speed compensation value conversion table is read from the memory M121. In step P178, by using the electric current value difference-load motor rotational speed compensation value conversion table, the load motor rotational speed compensation value is obtained from the electric current value difference and is then stored in the memory M122.

Next, in step P179, the rotational speed of the upstream load motor 18A is read from the memory M113. In step P180, the rotational speed compensation value of the upstream load motor 18A is subtracted from the rotational speed of the upstream load motor 18A to calculate the compensated rotational speed of the upstream load motor 18A, which is then stored in the memory M123.

Next, in step P181, the setting rotational speed at teaching is read from the memory M100, and in step P182, the current upstream rotational phase is read from the M106. Next, in step P183, the compensated rotational speed of the upstream load motor 18A is stored at an address position of the memory M126 for storing the rotational speed of the upstream load motor at constant-speed operation, the address position corresponding to the current upstream rotational phase for the setting rotational speed at teaching. Then, the process returns to step P138.

Next, in step P184 to which the process proceeds from step P161, the internal clock counter 105 (for counting elapsed time) starts to count. In step P185, the current setting rotational speed/virtual current downstream rotational phase transmission interval is read from the memory M104.

Next, in step P186, the count value of the internal clock counter 105 is read. In step P187, it is then judged whether the count value of the internal clock counter 105 is equal to or more than the current setting rotational speed/virtual current downstream rotational phase transmission interval.

If yes in step P187, in step P188, the count value is read from the current upstream rotational phase detection counter 119 and is stored in the memory M105. In step P189, from the count value of the current upstream rotational phase detection counter 119, the current upstream rotational phase is calculated and then stored in the memory M106.

Next, in step P190, the downstream rotational phase compensation value is read from the memory M107. In step P191, the current upstream rotational phase is added to the downstream rotational phase compensation value to calculate the virtual current downstream rotational phase, which is stored in the memory M108.

Next, in step P192, the setting rotational speed is read from the rotational speed setting unit 115 and is then stored in the memory M102 for storing the current setting rotational speed. In step P193, the current setting rotational speed and the virtual current downstream rotational phase are sent to the downstream printing unit group drive controller 90B.

Next, in step P194, the memory M109 for storing the instruction rotational speed is overwritten with the current setting rotational speed, and in step P195, the instruction rotational speed is outputted to the upstream drive motor driver 117. Subsequently, in step P196, the current setting rotational speed is stored in the memory M103 for storing the previous setting rotational speed, and the process returns to step P184.

If no in step P187, in step P197, the count value is read from the current upstream rotational phase detection counter 119 and is stored in the memory M105. In step P198, from the count value of the current upstream rotational phase detection counter 119, the current upstream rotational phase is calculated and is then stored in the memory M106.

Next, in step P199, the deceleration start upstream rotational phase is read from the memory M128. In step P200, it is then judged whether the current upstream rotational phase is equal to the deceleration start upstream rotational phase.

If yes in step P200, in step P201, an instruction to stop printing is sent to the printing press controller 55B. Then, in step P202, the deceleration start upstream rotational phase is read from the memory M128. If no in step P200, the process returns to step P185. In step P203, the downstream rotational phase compensation value is read from the memory M107.

Next, in step P204, the deceleration start upstream rotational phase is added to the downstream rotational phase compensation value to calculate the virtual current downstream rotational phase, which is then stored in the memory M108. In step P205, the setting rotational speed is read from the rotational speed setting unit 115 and is stored in the memory M102 for storing the current setting rotational speed.

Next, in step P206, a deceleration instruction, the current setting rotational speed, and the virtual current downstream rotational phase are sent to the downstream printing unit group drive controller 90B. In step P207, the memory M109 for storing the instruction rotational speed is overwritten with the current setting rotational speed.

Next, in step P208, the instruction rotational speed is outputted to the upstream drive motor driver 117. In step P209, the current setting rotational speed is stored in the memory M103 for storing the previous setting rotational speed.

Next, in step P210, the reset and enable signals are outputted to the acceleration/deceleration counter 121, and in step P211, the output of the reset signal to the acceleration/deceleration counter 121 is then stopped.

Next, in step P212, the internal clock counter 105 (for counting elapsed time) starts to count. In step P213, the current setting rotational speed/virtual current downstream rotational phase transmission interval is read from the memory M104.

Next, in step P214, the count value of the internal clock counter 105 is read. In step P215, it is judged whether the count value of the internal clock counter 105 is equal to or more than the current setting rotational speed/virtual current downstream rotational phase transmission interval.

If yes in step P215, in step P216, the count value is read from the current upstream rotational phase detection counter 119 and is stored in the memory M105. In step P217, from the count value of the current upstream rotational phase detection counter 119, the current upstream rotational phase is calculated and then stored in the memory M106.

Next, in step P218, the downstream rotational phase compensation value is read from the memory M107. In step P219, the current upstream rotational phase is added to the downstream rotational phase compensation value to calculate the virtual current downstream rotational phase, which is then stored in the memory M108.

Next, in step P220, the previous setting rotational speed is read from the memory M103, and in step P221, the rotational speed correction value at deceleration is read from the memory M129. Subsequently, in step P222, the rotational speed correction value at deceleration is subtracted from the previous setting rotational speed to calculate the corrected current setting rotational speed, which is then stored in the memory M112.

Next, in step P223, it is judged whether the corrected current setting rotational speed is less than 0. If yes in step P223, in step P224, the corrected current setting rotational speed is updated with 0, and in step P225, the corrected current setting rotational speed is stored in the memory M102 for storing the current setting rotational speed. If no in step P223, the process directly proceeds to step P225.

Next, in step P226, the current setting rotational speed and virtual current downstream rotational phase are sent to the downstream printing unit group drive controller 90B. In step P227, the memory M109 for storing the instruction rotational speed is overwritten with the current setting rotational speed.

Next, in step P228, the instruction rotational speed is outputted to the upstream drive motor driver 117. In step P229, the current setting rotational speed is stored in the memory M103 for storing the previous setting rotational speed, and the process returns to step P212.

On the other hand, if no in step P215, in step P230, outputs of the F/V converters 123 and 128, which are connected to the upstream and downstream drive motor rotary encoders 118 and 129, respectively, are read, and are stored in the memory M131. In step P231, from the outputs of the F/V converters 123 and 128, which are connected to the upstream and downstream drive motor rotary encoders 118 and 129, the current rotational speeds of the upstream and downstream printing unit groups, respectively, are calculated and stored in the memory M132.

Next, in step P232, it is judged whether the current rotational speeds of the upstream and downstream printing unit groups are equal to 0. If yes in step P232, in step P233, the teaching finish signal is sent to the downstream printing unit group drive controller 90B, and the process returns to step P1. If no in step P252, the process proceeds to step P234.

Next, in step P234, it is judged whether clock pulse is outputted from the upstream rotational phase detection rotary encoder 20A. If yes in step P234, in step P235, the standard rotational speed of the upstream load motor 18A is read from the load motor standard rotational speed (torque value) setting unit 124 and then stored in the memory M113 for storing the rotational speed of the upstream load motor. If no in step P234, the process returns to step P213.

Next, in step P236, the count value is read from the current upstream rotational phase detection counter 119 and is stored in the memory M105. In step P237, from the count value of the current upstream rotational phase detection counter 119, the current upstream rotational phase is calculated and then stored in the memory M106.

Next, in step P238, the transfer cylinder-notch move-up start rotational phase is read from the memory M114, and in step P239, the transfer cylinder-notch move-up finish rotational phase is read from the memory M115.

Next, in step P240, it is judged whether the current upstream rotational phase is equal to or more than the transfer cylinder-notch move-up start rotational phase, and is equal to or less than the transfer cylinder-notch move-up finish rotational phase. If yes in step P240, in step P241, the rotational speed of the upstream load motor 18A is read from the memory M113, and if no, the process proceeds to later-described step P244.

Next, the load motor rotational speed compensation value related to move-up of the notch of the transfer cylinder 6 of the convertible press mechanism 2 is read from the memory M116 in step P242, and is then subtracted from the rotational speed of the upstream load motor 18A in step P243. The memory M113 for storing the rotational speed of the upstream load motor is overwritten with the obtained result.

Next, in step P244, the rotational speed of the upstream load motor 18A is read from the memory M113, and in step P245, the rotational speed of the upstream load motor 18A is outputted to the upstream load motor driver 126.

Next, in step P246, the count value is read from the acceleration/deceleration counter 121 and is then stored in the memory M117. In step P247, the electric current value is read from the upstream drive motor driver 117 and is then stored in the memory M118.

Next, in step P248, the standard electric current value is read from the memory M119. In step P249, the standard electric current value is subtracted from the electric current value to calculate the electric current value difference, which is then stored in the memory M120.

Next, in step P250, the electric current value difference-load motor rotational speed compensation value conversion table is read from the memory M121. In step P251, by using the electric current value difference-load motor rotational speed compensation value conversion table, the load motor rotational speed compensation value is obtained from the electric current value difference and is stored in the memory M122.

Next, in step P252, the rotational speed of the upstream load motor 18A is read from the memory M113. In step P253, the load motor rotational speed compensation value is subtracted from the rotational speed of the upstream load motor 18A to calculate the compensated rotational speed of the upstream load motor 18A, which is then stored in the memory M123.

Next, in step P254, the setting rotational speed at teaching is read from the memory M100, and in step P255, the count value of the acceleration/deceleration counter 121 is read from the memory M117. Next, in step P256, the compensated rotational speed of the upstream load motor 18A is stored at the address position of the memory M130 for storing the rotational speed of the upstream load motor at deceleration, the address position corresponding to the count value of the acceleration/deceleration counter 121 for the setting rotational speed at teaching. Then, the process returns to step P213.

Next, in step P257 to which the process proceeds from step P5, it is judged whether the printing press drive switch 108 is turned on. If yes in step P257, in step P258, the instruction to start home position alignment is sent to the downstream printing unit group drive controller 90B. If no in step P257, in step P259, it is judged whether the synchronizing operation switch 107 is turned off.

Next, if yes in step P259, in step P260, the instruction to stop synchronizing operation is sent to the downstream printing unit group drive controller 90B, and the process proceeds to later-described step P448. If no in step P259, the process returns to step P257.

Next, in step P261, the setting rotational speed is read from the rotational speed setting unit 115 and is stored in the memory M133 for storing the setting rotational speed at synchronizing operation. In step P262, the setting rotational speed at synchronizing operation is sent to the downstream printing unit group drive controller 90B.

Next, the slow rotational speed is read from the memory M101 in step P263, and is written in the memory M102 for storing the current setting rotational speed and the memory M103 for storing the previous setting rotational speed in step P264.

Next, in step P265, the internal clock counter 105 (for counting elapsed time) starts to count. In step P266, the current setting rotational speed/virtual current downstream rotational phase transmission interval is read from the memory M104.

Next, in step P267, the count value of the internal clock counter 105 is read. In step P268, it is judged whether the count value of the internal clock counter 105 is equal to or more than the current setting rotational speed/virtual current downstream rotational phase transmission interval.

If yes in step P268, in step P269, the count value is read from the current upstream rotational phase detection counter 119 and is stored in the memory M105. In step P270, from the count value of the current upstream rotational phase detection counter 119, the current upstream rotational phase is calculated and then stored in the memory M106.

Next, in step P271, the downstream rotational phase compensation value is read from the memory M107. In step P272, the current upstream rotational phase is added to the downstream rotational phase compensation value to calculate the virtual current downstream rotational phase, which is then stored in the memory M108.

Next, in step P273, the current setting rotational speed (slow) is read from the memory M102. In step P274, the current setting rotational speed (slow) and the virtual current downstream rotational phase are sent to the downstream printing unit group drive controller 90B.

Next, in step P275, the memory M109 for storing the instruction rotational speed is overwritten with the current setting rotational speed (slow). In step P276, the instruction rotational speed is outputted to the upstream drive motor driver 117. In step P277, the current setting rotational speed (slow) is then stored in the memory M103 for storing the previous setting rotational speed, and the process returns to step P265.

On the other hand, if no in step P268, in step P278, it is judged whether the home position alignment completion signal is sent from the downstream printing unit group drive controller 90B. If yes in step P278, in step P279, the current setting rotational speed/virtual current downstream rotational phase transmission interval is read from the memory M104, and if no, the process returns to step P266.

Next, in step P280, the count value of the internal clock counter 105 is read, and in step P281, it is judged whether the count value of the internal clock counter 105 is equal to or more than the current setting rotational speed/virtual current downstream rotational phase transmission interval.

If yes in step P281, in step P282, the count value is read from the current upstream rotational phase detection counter 119 and is stored in the memory M105. If no in step P281, the process returns to step P279.

Next, in step P283, from the count value of the current upstream rotational phase detection counter 119, the current upstream rotational phase is calculated and then stored in the memory M106. In step P284, the downstream rotational phase compensation value is read from the memory M107.

Next, in step P285, the current upstream rotational phase is added to the downstream rotational phase compensation value to calculate the virtual current downstream rotational phase, which is then stored in the memory M108. In step P286, the current setting rotational speed (slow) is read from the memory M102.

Next, in step P287, the current setting rotational speed (slow) and the virtual current downstream rotational phase are sent to the downstream printing unit group drive controller 90B. In step P288, the memory M109 for storing the instruction rotational speed is overwritten with the current setting rotational speed (slow).

Next, in step P289, the instruction rotational speed is outputted to the upstream drive motor driver 117. In step P290, the current setting rotational speed (slow) is stored in the memory M103 for storing the previous setting rotational speed.

Next, in step P291, the internal clock counter 105 (for counting elapsed time) starts to count. In step P292, the current setting rotational speed/virtual current downstream rotational phase transmission interval is read from the memory M104.

Next, in step P293, the count value of the internal clock counter 105 is read. In step P294, it is judged whether the count value of the internal clock counter 105 is equal to or more than the current setting rotational speed/virtual current downstream rotational phase transmission interval.

If yes in step P294, in step P295, the count value is read from the current upstream rotational phase detection counter 119 and is stored in the memory M105. In step P296, from the count value of the current upstream rotational phase detection counter 119, the current upstream rotational phase is calculated and then stored in the memory M106.

Next, in step P297, the downstream rotational phase compensation value is read from the memory M107. In step P298, the current upstream rotational phase is added to the downstream rotational phase compensation value to calculate the virtual current downstream rotational phase, which is then stored in the memory M108.

Next, in step P299, the current setting rotational speed (slow) is read from the memory M102. In step P300, the current setting rotational speed (slow) and the virtual current downstream rotational phase are sent to the downstream printing unit group drive controller 90B.

Next, in step P301, the memory M109 for storing the instruction rotational speed is overwritten with the current setting rotational speed (slow), and in step P302, the instruction rotational speed is outputted to the upstream drive motor driver 117. Subsequently, in step P303, the current setting rotational speed (slow) is stored in the memory M103 for storing the previous setting rotational speed, and the process returns to step P291.

If no in step P294, in step P304, the count value is read from the current upstream rotational phase detection counter 119 and is stored in the memory M105. In step P305, from the count value of the current upstream rotational phase detection counter 119, the current upstream rotational phase is calculated and then stored in the memory M106.

Next, in step P306, the acceleration start upstream rotational phase is read from the memory M110. In step P307, it is then judged whether the current upstream rotational phase is equal to the acceleration start upstream rotational phase. If yes in step P307, in step P308, the instruction to start printing is sent to the printing press controller 55B, and if no, the process returns to step P292.

Next, in step P309, the acceleration start upstream rotational phase is read from the memory M110, and in step P310, the downstream rotational phase compensation value is read from the memory M107. Subsequently, in step P311, the acceleration start upstream rotational phase is added to the downstream rotational phase compensation value to calculate the virtual current downstream rotational phase, which is then stored in the memory M108.

Next, in step P312, the current setting rotational speed (slow) is read from the memory M102, and in step P313, the acceleration instruction, the current setting rotational speed (slow), and the virtual current downstream rotational phase are sent to the downstream printing unit group drive controller 90B.

Next, in step P314, the memory M109 for storing the instruction rotational speed is overwritten with the current setting rotational speed (slow), and in step P315, the instruction rotational speed is outputted to the upstream drive motor driver 117. Subsequently, in step P316, the current setting rotational speed (slow) is stored in the memory M103 for storing the previous setting rotational speed.

Next, in step P317, the reset and enable signals are outputted to the acceleration/deceleration counter 121, and in step P318, the output of the reset signal to the acceleration/deceleration counter 121 is stopped.

Next, in step P319, the internal clock counter 105 (for counting elapsed time) starts to count. In step P320, the current setting rotational speed/virtual current downstream rotational phase transmission interval is read from the memory M104.

In step P321, the count value of the internal clock counter 105 is read. In step P322, it is judged whether the count value of the internal clock counter 105 is equal to or more than the current setting rotational speed/virtual current downstream rotational phase transmission interval.

If yes in step P322, in step P323, the previous setting rotational speed is read from the memory M103, and if no, the process returns to step P320. In step P324, the rotational speed correction value at acceleration is read from the memory M111.

Next, in step P325, the previous setting rotational speed is added to the rotational speed correction value at acceleration to calculate the corrected current setting rotational speed, which is then stored in the memory M112. In step P326, the setting rotational speed is read from the rotational speed setting unit 115 and is stored in the memory M102 for storing the current setting rotational speed.

Next, in step P327, it is judged whether the corrected current rotational speed is less than the current setting rotational speed. If yes in step P327, in step P328, the setting rotational speed at synchronizing operation is read from the memory M133, and if no, the process proceeds to step P341.

Next, in step P329, the count value is read from the acceleration/deceleration counter 121 and is stored in the memory M117. In step P330, the rotational speed of the upstream load motor 18A is read from an address position of the memory M124 for storing the rotational speed of the upstream load motor at acceleration, the address position corresponding to the count value of the acceleration/deceleration counter 121 for the setting rotational speed at synchronizing operation. The rotational speed of the upstream load motor 18A is then stored in the memory M113. Note that, the address position of the memory M124 for storing the rotational speed of the upstream load motor at acceleration, the address position corresponding to the count value of the acceleration/deceleration counter 121 for the setting rotational speed at synchronizing operation i, corresponds to the address position of the memory M124, the address position corresponding to the count value of the acceleration/deceleration counter 121 for the setting rotational speed at teaching, the memory M124 storing the compensated rotational speed of the upstream load motor 18A in step P111 when the setting rotational speed at teaching is equal to that at synchronizing operation and when the acceleration/deceleration counter 121 has a same count value.

Next, in step P331, the rotational speed of the upstream, load motor 18A is outputted to the upstream load motor driver 126. In step P332, the count value is read from the current upstream rotational phase detection counter 119 and is stored in the memory M105.

Next, in step P333, from the count value of the current upstream rotational phase detection counter 119, the current upstream rotational phase is calculated and then stored in the memory M106. In step P334, the downstream rotational phase compensation value is read from the memory M107.

Next, in step P335, the current upstream rotational phase is added to the downstream rotational phase compensation value to calculate the virtual current downstream rotational phase, which is then stored in the memory M108. In step P336, the corrected current setting rotational speed is stored in the memory M102 for storing the current setting rotational speed.

Next, in step P337, the current setting rotational speed and the virtual current downstream rotational phase are sent to the downstream printing unit group drive controller 90B. In step P338, the memory M109 for storing the instruction rotational speed is overwritten with the current setting rotational speed.

Next, in step P339, the instruction rotational speed is outputted to the upstream drive motor driver 117. In step P340, the current setting rotational speed is stored in the memory M103 for storing the previous setting rotational speed. The process then returns to step P319.

Next, in step P341, the setting rotational speed at synchronizing operation is read from the memory M133. In step P342, the count value is read from the current upstream rotational phase detection counter 119 and is then stored in the memory M105.

Next, in step P343, from the count value of the current upstream rotational phase detection counter 119, the current upstream rotational phase is calculated and then stored in the memory M106. In step P344, the rotational speed of the upstream load motor 18A is read from the address position of the memory M126 for storing the rotational speed of the upstream load motor at constant-speed operation, the address position corresponding to the current upstream rotational phase for the setting rotational speed at synchronizing operation. The rotational speed of the upstream load motor 18A is then stored in the memory M113. Note that, the address position of the memory M126 for storing the rotational speed of the upstream load motor at constant-speed operation, the address position corresponding to the current upstream rotational phase for the setting rotational speed at synchronizing operation, corresponds to the address position of the memory M126, the address position corresponding to the current upstream rotational phase for the setting rotational speed at teaching, the memory M126 storing the compensated rotational speed of the upstream load motor 18A in step P183 when the setting rotational speed at teaching is equal to that at synchronizing operation and when the current upstream rotational phase is the same.

Next, in step P345, the rotational speed of the upstream load motor 18A is outputted to the upstream load motor driver 126. In step P346, the current upstream rotational phase is read from the memory M106.

Next, in step P347, the downstream rotational phase compensation value is read from the memory M107. In step P348, the current upstream rotational phase is added to the downstream rotational phase compensation value to calculate the virtual current downstream rotational phase, which is then stored in the memory M108.

In step P349, the setting rotational speed is read from the rotational speed setting unit 115 and is stored in the memory M102 for storing the current rotational speed. In step P350, a constant-speed operation instruction, the current setting rotational speed and the virtual current downstream rotational phase are sent to the downstream printing unit group drive controller 90B.

Next, in step P351, the memory M109 for storing the instruction rotational speed is overwritten with the current setting rotational speed, and in step P352, the instruction rotational speed is outputted to the upstream drive motor driver 117. Subsequently, in step P353, the current setting rotational speed is stored in the memory M103 for storing the previous setting rotational speed.

Next, in step P354, the internal clock counter 105 (for counting elapsed time) starts to count. In step P355, the current setting rotational speed/virtual current downstream rotational phase transmission interval is read from the memory M104.

Next, in step P356, the count value of the internal clock counter 105 is read, and in step P357, it is judged whether the count value of the internal clock counter 105 is equal to or more than the current setting rotational speed/virtual current downstream rotational phase transmission interval.

If yes in step P357, in step P358, the setting rotational speed at synchronizing operation is read from the memory M133, and if no, the process proceeds to later-described step P371.

Next, in step P359, the count value of the current upstream rotational phase detection counter 119 is read and stored in the memory M105. In step P360, from the count value of the current upstream rotational phase detection counter 119, the current upstream rotational phase is calculated and then stored in the memory M106.

In step P361, the rotational speed of the upstream load motor 18A is read from the address position of the memory M126 for storing the rotational speed of the upstream load motor at constant-speed operation, the address position corresponding to the current upstream rotational phase for the setting rotational speed at synchronizing operation. The rotational speed of the upstream load motor 18A is then stored in the memory M113. In step P362, the rotational speed of the upstream load motor 18A is outputted to the upstream load motor driver 126.

Next, in step P363, the current upstream rotational phase is read from the memory M106, and in step P364, the downstream rotational phase compensation value is read from the memory M107.

Next, in step P365, the current upstream rotational phase is added to the downstream rotational phase compensation value to calculate the virtual current downstream rotational phase, which is then stored in the memory M108. In step P366, the setting rotational speed is read from the rotational speed setting unit 115 and is stored in the memory M102 for storing the current setting rotational speed.

Next, in step P367, the current setting rotational speed and the virtual current downstream rotational phase are sent to the downstream printing unit group drive controller 90B. In step P368, the memory M109 for storing the instruction rotational speed is overwritten with the current setting rotational speed.

In step P369, the instruction rotational speed is outputted to the upstream drive motor driver 117. Subsequently, in step P370, the current setting rotational speed is stored in the memory M103 for storing the previous setting rotational speed, and the process returns to step P354.

Next, in step P371, it is judged whether the printing press drive stop switch 109 is turned on. If yes in step P371, in step P372, the setting rotational speed at synchronizing operation is read from the memory M133. If no in step P371, the process returns to step P355.

Next, in step P373, the count value is read from the current upstream rotational phase detection counter 119 and is stored in the memory M105. In step P374, from the count value of the current upstream rotational phase detection counter 119, the current upstream rotational phase is calculated and then stored in the memory M106.

Next, in step P375, the rotational speed of the upstream load motor 18A is read from the address position of the memory M126 for storing the rotational speed of the upstream load motor at constant-speed operation, the address position corresponding to the current upstream rotational phase for the setting rotational speed at synchronizing operation. The rotational speed of the upstream load motor 18A is then stored in the memory M113. In step P376, the rotational speed of the upstream load motor 18A is outputted to the upstream load motor driver 126.

Next, in step P377, the current upstream rotational phase is read from the memory M106, and in step P378, the downstream rotational phase compensation value is read from the memory M107.

Next, in step P379, the current upstream rotational phase is added to the downstream rotational phase compensation value to calculate the virtual current downstream rotational phase, which is then stored in the memory M108. In step P380, the setting rotational speed is read from the rotational speed setting unit 115 and is stored in the memory M102 for storing the current setting rotational speed.

In step P381, the current setting rotational speed and the virtual current downstream rotational phase are sent to the downstream printing unit group drive controller 90B. Next, in step P382, the memory M109 for storing the instruction rotational speed is overwritten with the current setting rotational speed.

In step P383, the instruction rotational speed is outputted to the upstream drive motor driver 117. In step P384, the current setting rotational speed is stored in the memory M103 for storing the previous setting rotational speed.

Next, in step P385, the internal clock counter 105 (for counting elapsed time) starts to count. In step P386, the current setting rotational speed/virtual current downstream rotational phase transmission interval is read from the memory M104.

Next, in step P387, the count value of the internal clock counter 105 is read. In step P388, it is judged whether the count value of the internal clock counter 105 is equal to or more than the current setting rotational speed/virtual current downstream rotational phase transmission interval.

Next, if yes in step P388, in step P389, the setting rotational speed at synchronizing operation is read from the memory M133. In step P390, the count value is read from the current upstream rotational phase detection counter 119 and is then stored in the memory M105.

Next, in step P391, from the count value of the current upstream rotational phase detection counter 119, the current upstream rotational phase is calculated and then stored in the memory M106. In step P392, the rotational speed of the upstream load motor 18A is read from the address position of the memory M126 for storing the rotational speed of the upstream load motor at constant-speed operation, the address position corresponding to the current upstream rotational phase for the setting rotational speed at synchronizing operation. The rotational speed of the upstream load motor 18A is then stored in the memory M113.

Next, in step P393, the rotational speed of the upstream load motor 18A is outputted to the upstream load motor driver 126, and in step P394, the current upstream rotational phase is read from the memory M106.

Next, in step P395, the downstream rotational phase compensation value is read from the memory M107. In step P396, the current upstream rotational phase is added to the downstream rotational phase compensation value to calculate the virtual current downstream rotational phase, which is stored in the memory M108.

Next, in step P397, the setting rotational speed is read from the rotational speed setting unit 115 and is stored in the memory M102 for storing the current setting rotational speed. In step P398, the current setting rotational speed and the virtual current downstream rotational phase are sent to the downstream printing unit group drive controller 90B.

Next, in step P399, the memory M109 for storing the instruction rotational speed is overwritten with the current setting rotational speed, and in step P400, the instruction rotational speed is outputted to the upstream drive motor driver 117. Subsequently, in step P401, the current setting rotational speed is stored in the memory M103 for storing the previous setting rotational speed, and the process returns to step P385.

On the other hand, if no in step P388, in step P402, the count value is read from the current upstream rotational phase detection counter 119 and is stored in the memory M105. In step P403, from the count value of the current upstream rotational phase detection counter 119, the current upstream rotational phase is calculated and stored in the memory M106.

Next, in step P404, the deceleration start upstream rotational phase is read from the memory M128. In step P405, it is judged whether the current upstream rotational phase is equal to the deceleration start upstream rotational phase.

If yes in step P405, in step P406, the instruction to stop printing is sent to the printing press controller 55B, and if no, the process returns to step P386. Next, in step P407, the setting rotational speed at synchronizing operation is read from the memory M133.

In step P408, the count value is read from the current upstream rotational phase detection counter 119 and is stored in the memory M105. In step P409, from the count value of the current upstream rotational phase detection counter 119, the current upstream rotational phase is calculated and then stored in the memory M106.

Next, in step P410, the rotational speed of the upstream load motor 18A is read from the address position of the memory M126 for storing the rotational speed of the upstream load motor at constant-speed operation, the address position corresponding to the current upstream rotational phase for the setting rotational speed at synchronizing operation. Then, the rotational speed of the upstream load motor 18A is stored in the memory M113. In step P411, the rotational speed of the upstream load motor 18A is outputted to the upstream load motor driver 126.

Next, in step P412, the deceleration start upstream rotational phase is read from the memory M128, and in step P413, the downstream rotational phase compensation value is read from the memory M107.

Next, in step P414, the deceleration start upstream rotational phase is added to the downstream rotational phase compensation value to calculate the virtual current downstream rotational phase, which is then stored in the memory M108. In step P415, the setting rotational speed is read from the rotational speed setting unit 115, and is then stored in the memory M102 for storing the current setting rotational speed.

Next, in step P416, the deceleration instruction, the current setting rotational speed and the virtual current downstream rotational phase are sent to the downstream printing unit group drive controller 90B. In step P417, the memory M109 for storing the instruction rotational speed is overwritten with the current setting rotational speed.

Next, in step P418, the instruction rotational speed is outputted to the upstream drive motor driver 117. Subsequently, in step P419, the current setting rotational speed is stored in the memory M103 for storing the previous setting rotational speed.

Next, in step P420, the reset and enable signals are outputted to the acceleration/deceleration counter 121, and in step P421, the output of the reset signal to the acceleration/deceleration counter 121 is stopped.

Next, in step P422, the internal clock counter 105 (for counting elapsed time) starts to count. In step P423, the current setting rotational speed/virtual current downstream rotational phase transmission interval is read from the memory M104.

Next, in step P424, the count value of the internal clock counter 105 is read. In step P425, it is then judged whether the count value of the internal clock counter 105 is equal to or more than the current setting rotational speed/virtual current downstream rotational phase transmission interval.

If yes in step P425, in step P426, the setting rotational speed at synchronizing operation is read from the memory M133. In step P427, the count value is read from the acceleration/deceleration counter 121 and is stored in the memory M117.

Next, in step P428, the rotational speed of the upstream load motor 18A is read from the address position of the memory M130 for storing the rotational speed of the upstream load motor at deceleration, the address position corresponding to the count value of the acceleration/deceleration counter 121 for the setting rotational speed at synchronizing operation. The rotational speed of the upstream load motor 18A is then stored in the memory M113. In step P429, the rotational speed of the upstream load motor 18A is outputted to the upstream load motor driver 126. Note that the address position of the memory M130 for storing the rotational speed of the upstream load motor at deceleration, the address position corresponding to the count value of the acceleration/deceleration counter 121 for the setting rotational speed at synchronizing operation, corresponds to the address position of the memory M130, the address position corresponding to the count value of the acceleration/deceleration counter 121 for the setting rotational speed at teaching, the memory M130 storing the compensated rotational speed of the upstream load motor 18A in step P256 when the setting rotational speed at teaching is equal to that at synchronizing operation and when the acceleration/deceleration counter 121 has a same count value.

Next, in step P430, the count value is read from the current upstream rotational phase detection counter 119 and is stored in the memory M105. In step P431, from the count value of the current upstream rotational phase detection counter 119, the current upstream rotational phase is calculated and then stored in the memory M106.

Next, in step P432, the downstream rotational phase compensation value is read from the memory M107. In step P433, the current upstream rotational phase is added to the downstream rotational phase compensation value to calculate the virtual current downstream rotational phase, which is stored in the memory M108.

Next, in step P434, the previous setting rotational speed is read from the memory M103, and in step P435, the rotational speed correction value at deceleration is read from the memory M129. In step P436, the rotational speed correction value at deceleration is subtracted from the previous setting rotational speed to calculate the corrected current setting rotational speed, which is then stored in the memory M112.

Next, in step P437, it is judged whether the corrected current setting rotational speed is less than 0. If yes in step P437, in step P438, the corrected current setting rotational speed is updated with 0. In step P439, the corrected current setting rotational speed is then stored in the memory M102 for storing the current setting rotational speed. If no in step P437, the process directly proceeds to step P439.

Next, in step P440, the current setting rotational speed and the virtual current downstream rotational phase are sent to the downstream printing unit group drive controller 90B, and in step P441, the memory M109 for storing the instruction rotational speed is overwritten with the current setting rotational speed.

Next, in step P442, the instruction rotational speed is outputted to the upstream drive motor driver 117. Subsequently, in step P443, the current setting rotational speed is stored in the memory M103 for storing the previous setting rotational speed, and the process returns to step P422.

On the other hand, if no in step P425, in step P444, the outputs of the F/V converters 123 and 128, which are connected to the upstream and downstream drive motor rotary encoders 118 and 129, respectively, are read, and then stored in the memory M131. In step P445, from the outputs of the F/V converters 123 and 128, which are connected to the upstream and downstream drive motor rotary encoders 118 and 129, the current rotational speeds of the upstream and downstream printing unit groups, respectively, are calculated and then stored in the memory M132.

Next, in step P446, it is judged whether the current rotational speeds of the upstream and downstream printing unit groups are equal to 0. If yes in step P446, in step P447, the instruction to stop synchronizing operation is sent to the downstream printing unit group drive controller 90B, and the process returns to step P257. If no in step P446, the process returns to step P423.

Next, in step P448 to which the process proceeds from step P6 or P7, it is judged whether the setting rotational speed is inputted to the upstream single drive rotational speed setting unit 130. If yes in step P448, in step P449, the setting rotational speed is read from the upstream single drive rotational speed setting unit 130, and is then stored in the memory M102 for storing the current setting rotational speed. Then, the process proceeds to step P450. If no in step P448, the process directly proceeds to step P450.

In step P450, it is judged whether the upstream single drive switch 110 is turned on. If yes in step P450, in step P451, the current setting rotational speed is read from the memory M102, and if no, the process returns to step P1.

In step P452, the current setting rotational speed is written in the memory M109 for storing the instruction rotational speed, and in step P453, the instruction rotational speed is outputted to the upstream drive motor driver 117.

Next, when the upstream drive stop switch 111 is turned on in step P454, in step P455, the stop instruction is outputted to the upstream drive motor driver 117, and the process returns to step P1. Hereinafter, these operations are repeated.

According to the aforementioned operational flows, the teaching processing and synchronizing operation processing in the upstream drive motor 10A of the upstream printing unit group 1A are performed, and during the synchronizing operation, the braking force of the transfer cylinder 6 of the convertible press mechanism 2 is controlled by the upstream load motor 18A.

The downstream printing unit group drive controller 90B operates according to the operational flows shown in FIGS. 48A and 48B, 49A to 49C, 50A to 50C, 51, 52A to 52C, 53A to 53C, 54, 55A to 55C, 56A and 56B, 57A to 57C, 58A to 58C, 59A to 59C 60A and 60B, and 61.

Specifically, in step P1, it is judged whether the teaching instruction is sent from the upstream printing unit group drive controller 70B. If yes in step P1, the process proceeds to step P2. When the instruction to start home position alignment is sent from the upstream printing unit group drive controller 70B in step P2, and the setting rotational speed at teaching is sent from the upstream printing unit group drive controller 70B in step P3, in step P4, the setting rotational speed at teaching is received from the upstream printing unit group drive controller 70B and is stored in the memory M134.

If no in step P1, in step P5, it is judged whether the instruction to start synchronizing operation is sent from the upstream printing unit group drive controller 70B. If yes in step P5, the process proceeds to later-described step P250, and if no, the process proceeds to later-described step P419.

Next, when the current setting rotational speed (slow) and the virtual current downstream rotational phase are sent from the upstream printing unit group drive controller 70B in step P6, in step P7, the current setting rotational speed (slow) and virtual current downstream rotational phase are received from the upstream printing unit group drive controller 70B, and are stored in the memories M135 and M136, respectively.

Next, in step P8, the count value is read from the current downstream rotational phase detection counter 140 and is stored in the memory M137. In step P9, from the count value of the current downstream rotational phase detection counter 140, the current downstream rotational phase is calculated and then stored in the memory M138.

Next, in step P10, the current downstream rotational phase is subtracted from the virtual current downstream rotational phase to calculate a current downstream rotational phase difference, which is then stored in the memory M139. In step P1, from the current downstream rotational phase difference, the absolute value of the current downstream rotational phase difference is calculated and then stored in the memory M140.

Next, in step P12, a tolerance of the current downstream rotational phase difference is read from the memory M141. In step P13, it is judged whether the absolute value of the current downstream rotational phase difference is equal to or less than the tolerance of the current downstream rotational phase difference.

If yes in step P13, the current setting rotational speed (slow) is read from the memory M135 in step P14. In step P15, the memory M142 for storing the instruction rotational speed is overwritten with the current setting rotational speed (slow).

Next, in step P16, the instruction rotational speed is outputted to the downstream drive motor driver 138. In step P17, the home position alignment completion signal is sent to the upstream printing unit group drive controller 70B, and the process proceeds to later-described step P24.

If no in step P13, in step P18, the current downstream rotational phase difference-setting rotational speed compensation value conversion table is read from the memory M143, and in step P19, the current downstream rotational phase difference is read from the memory M139.

Next, in step P20, by using the current downstream rotational phase difference-setting rotational speed compensation value conversion table, the setting rotational speed compensation value is obtained from the current downstream rotational phase difference and is stored in the memory M144. In step P21, the current setting rotational speed (slow) is read from the memory M135.

Next, in step P22, the current setting rotational speed (slow) is added to the setting rotational speed compensation value to calculate the instruction rotational speed, which is then stored in the memory M142. In step P23, the instruction rotational speed is outputted to the downstream drive motor driver 138, and the process returns to step P6.

Next, in step P24 to which the process proceeds from step P17, it is judged whether the current setting rotational speed (slow) and the virtual current downstream rotational phase are sent from the upstream printing unit group drive controller 70B. If yes in step P24, in step P25, the current setting rotational speed (slow) and the virtual current downstream rotational phase are received from the upstream printing unit group drive controller 70B, and are stored in the memories M135 and M136, respectively.

Next, in step P26, the count value is read from the current downstream rotational phase detection counter 140 and is stored in the memory M137. In step P27, from the count value of the current downstream rotational phase detection counter 140, the current downstream rotational phase is calculated and then stored in the memory M138.

Next, in step P28, the current downstream rotational phase is subtracted from the virtual current downstream rotational phase to calculate the current downstream rotational phase difference, which is then stored in the memory M139. In step P29, from the current downstream rotational phase difference, the absolute value of the current downstream rotational phase difference is calculated and then stored in the memory M140.

Next, in step P30, the tolerance of the current downstream rotational phase difference is read from the memory M141. In step P31, it is judged whether the absolute value of the current downstream rotational phase difference is equal to or less than the tolerance of the current downstream rotational phase difference.

If yes in step P31, the current setting rotational speed (slow) is read from the memory M135 in step P32. In step P33, the memory M142 for storing the instruction rotational speed is overwritten with the current setting rotational speed (slow) In step P34, the instruction rotational speed is outputted to the downstream drive motor driver 138, and the process returns to step P24.

If no in step P31, in step P35, the current downstream rotational phase difference-setting rotational speed compensation value conversion table is read from the memory M143, and in step P36, the current downstream rotational phase difference is read from the memory M139.

Next, in step P37, by using the current downstream rotational phase difference-setting rotational speed compensation value conversion table, the setting rotational speed compensation value is obtained from the current downstream rotational phase difference and is stored in the memory M144. In step P38, the current setting rotational speed (slow) is read from the memory M135.

Next, in step P39, the current setting rotational speed (slow) is added to the setting rotational speed compensation value to calculate the instruction rotational speed, which is then stored in the memory M142. In step P40, the instruction rotational speed is outputted to the downstream drive motor driver 132, and the process returns to step P24.

Next, if no in step P24, in step P41, it is judged whether the acceleration instruction, the current setting rotational speed (slow) and the virtual current downstream rotational phase are sent from the upstream printing unit group drive controller 70B. If yes in step P41, in step P42, the current setting rotational speed (slow) and virtual current downstream rotational phase are received from the upstream printing unit group drive controller 70B, and are stored in the memories M135 and M136, respectively. If no in step P41, the process returns to step P24.

Next, in step P43, the count value is read from the current downstream rotational phase detection counter 140 and is stored in the memory M137. In step P44, from the count value of the current downstream rotational phase detection counter 140, the current downstream rotational phase is calculated and then stored in the memory M138.

Next, in step P45, the current downstream rotational phase is subtracted from the virtual current downstream rotational phase to calculate the current downstream rotational phase difference, which is then stored in the memory M139. In step P46, from the current downstream rotational phase difference, the absolute value of the current downstream rotational phase difference is calculated and then stored in the memory M140.

Next, in step P47, the tolerance of the current downstream rotational phase difference is read from the memory M141. In step P48, it is judged whether the absolute value of the current downstream rotational phase difference is equal to or less than the tolerance of the current downstream rotational phase difference.

If yes in step P48, the current setting rotational speed (slow) is read from the memory M135 in step P49. In step P50, the memory M142 for storing the instruction rotational speed is overwritten with the current setting rotational speed (slow) In step P51, the instruction rotational speed is then outputted to the downstream drive motor driver 138, and the process proceeds to later-described step P58.

On the other hand, if no in step P48, in step P52, the current downstream rotational phase difference-setting rotational speed compensation value conversion table is read from the memory M143, and in step P53, the current downstream rotational phase difference is read from the memory M139.

Next, in step P54, by using the current downstream rotational phase difference-setting rotational speed compensation value conversion table, the setting rotational speed compensation value is obtained from the current downstream rotational phase difference and is stored in the memory M144. In step P55, the current setting rotational speed (slow) is read from the memory M135.

Next, in step P56, the current setting rotational speed (slow) is added to the setting rotational speed compensation value to calculate the instruction rotational speed, which is then stored in the memory M142. In step P57, the instruction rotational speed is outputted to the downstream drive motor driver 138.

Next, in step P58, reset and enable signals are outputted to the acceleration/deceleration counter 142, and in step P59, the output of the reset signal to the acceleration/deceleration counter 142 is stopped.

Next, in step P60, it is judged whether the current setting rotational speed and the virtual current downstream rotational phase are sent from the upstream printing unit group drive controller 70B. If yes in step P60, in step P61, the current setting rotational speed and the virtual current downstream rotational phase are received from the upstream printing unit group drive controller 70B and are stored in the memories M135 and M136, respectively.

Next, in step P62, the count value is read from the current downstream rotational phase detection counter 140 and is stored in the memory M137. In step P63, from the count value of the current downstream rotational phase detection counter 140, the current downstream rotational phase is calculated and then stored in the memory M138.

Next, in step P64, the current downstream rotational phase is subtracted from the virtual current downstream rotational phase to calculate the current downstream rotational phase difference, which is then stored in the memory M139. In step P65, from the current downstream rotational phase difference, the absolute value of the current downstream rotational phase difference is calculated and then stored in the memory M140.

Next, in step P66, the tolerance of the current downstream rotational phase difference is read from the memory M141. In step P67, it is judged whether the absolute value of the current downstream rotational phase difference is equal to or less than the tolerance of the current downstream rotational phase difference.

If yes in step P67, the current setting rotational speed is read from the memory M135 in step P68. In step P69, the memory M142 for storing the instruction rotational speed is overwritten with the current setting rotational speed. In step P70, the instruction rotational speed is then outputted to the downstream drive motor driver 138, and the process returns to step P60.

On the other hand, if no in step P67, in step P71, the current downstream rotational phase difference-setting rotational speed compensation value conversion table is read from the memory M143, and in step P72, the current downstream rotational phase difference is read from the memory M139.

Next, in step P73, by using the current downstream rotational phase difference-setting rotational speed compensation value conversion table, the setting rotational speed compensation value is obtained from the current downstream rotational phase difference and is stored in the memory M144. In step P74, the current setting rotational speed is read from the memory M135.

Next, in step P75, the current setting rotational speed is added to the setting rotational speed compensation value to calculate the instruction rotational speed, which is then stored in the memory M142. In step P76, the instruction rotational speed is outputted to the downstream drive motor driver 138, and the process returns to step P60.

If no in step P60, in step P77, it is judged whether the instruction to start load detection at constant-speed operation, the current setting rotational speed and the virtual current downstream rotational phase are sent from the upstream printing unit group drive controller 70B. If yes in step P77, the process proceeds to later-described step P101, and if no, the process proceeds to step P78.

Next, in step P78, it is judged whether clock pulse is outputted from the downstream rotational phase detection rotary encoder 20B. If yes in step P78, in step P79, standard rotational speed of the downstream load motor 18B is read from the load motor standard rotational speed (torque value) setting unit 143, and is stored in the memory M145 for storing the rotational speed of the downstream load motor. If no in step P78, the process returns to step P60.

Next, in step P80, the count value is read from the current downstream rotational phase detection counter 140 and is stored in the memory M137. In step P81, from the count value of the current downstream rotational phase detection counter 140, the current downstream rotational phase is calculated and then stored in the memory M138.

Next, in step P82, the suction cylinder-notch move-up start rotational phase is read from the memory M146. In step P83, the suction cylinder-notch move-up finish rotational phase is read from the memory M147.

Next, in step P84, it is judged whether the current downstream rotational phase is equal to or more than the suction cylinder-notch move-up start rotational phase, and is equal to or less than the suction cylinder-notch move-up finish rotational phase. If yes in step P84, in step P85, the rotational speed of the downstream load motor 18B is read from the memory M145, and if no, the process proceeds to later-described step P88.

Next, in step P86, the load motor rotational speed compensation value related to move-up of the notch of the suction cylinder 7 of the convertible press mechanism 2 is read from the memory M148. In step P87, the load motor rotational speed compensation value related to move-up of the notch of the suction cylinder 7 of the convertible press mechanism 2 is subtracted from the rotational speed of the downstream load motor 18B. Then, the memory M145 for storing the rotational speed of the downstream load motor is overwritten with the obtained result.

Next, the rotational speed of the downstream load motor 18B is read from the memory M145 in step P88, and is then outputted to the downstream load motor driver 145 in step P89.

Next, in step P90, the count value is read from the acceleration/deceleration counter 142 and is stored in the memory M149. In step P91, the electric current value is read from the downstream drive motor driver 138 and is stored in the memory M150. Next, in step P92, the standard electric current value is read from the memory M151.

Next, in step P93, the standard electric current value is subtracted from the electric current value to calculate the electric current value difference, which is then stored in the memory M152. In step P94, the electric current value difference-load motor rotational speed compensation value conversion table is read from the memory M153.

Next, in step P95, by using the electric current value difference-load motor rotational speed compensation value conversion table, the load motor rotational speed compensation value is obtained from the electric current value difference and is stored in the memory M154. In step P96, the rotational speed of the downstream load motor 18B is read from the memory M145.

Next, in step P97, the load motor rotational speed compensation value is subtracted from the rotational speed of the downstream load motor 18B to calculate the compensated rotational speed of the downstream load motor 18B, which is then stored in the memory M155. In step P98, the setting rotational speed at teaching is read from the memory M134.

Next, in step P99, the count value of the acceleration/deceleration counter 142 is read from the memory M149. In step P100, the compensated rotational speed of the downstream load motor 18B is stored at an address position of the memory M156 for storing the rotational speed of the downstream load motor at acceleration, the address position corresponding to a place where the count value of the acceleration/deceleration counter 142 for the setting rotational speed at teaching is stored. Then, the process returns to step P60.

Next, in step P101 to which the process proceeds from step P77, the current setting rotational speed and the virtual current downstream rotational phase are received from the upstream printing unit group drive controller 70B and are stored in the memories M135 and M136, respectively. In step P102, the count value is read from the current downstream rotational phase detection counter 140 and is stored in the memory M137.

Next, in step P103, from the count value of the current downstream rotational phase detection counter 140, the current downstream rotational phase is calculated and then stored in the memory M138. In step P104, the current downstream rotational phase is subtracted from the virtual current downstream rotational phase to calculate the current downstream rotational phase difference, which is stored in the memory M139.

Next, in step P105, from the current downstream rotational phase difference, the absolute value of the current downstream rotational phase difference is calculated and then stored in the memory M140. Next, in step P106, the tolerance of the current downstream rotational phase difference is read from the memory M141.

Next, in step P107, it is judged whether the absolute value of the current downstream rotational phase difference is equal to or less than the tolerance of the current downstream rotational phase difference. If yes in step P107, in step P108, the current setting rotational speed is read from the memory M135.

Next, in step P109, the memory M142 for storing the instruction rotational speed is overwritten with the current setting rotational speed. Next, in step P110, the instruction rotational speed is outputted to the downstream drive motor driver 138, and the process proceeds to later-described step P116.

On the other hand, if no in step P107, in step P1ll, the current downstream rotational phase difference-setting rotational speed compensation value conversion table is read from the memory M143. In step P112, the current downstream rotational phase difference is read from the memory M139.

Next, in step P113, by using the current downstream rotational phase difference-setting rotational speed compensation value conversion table, the setting rotational speed compensation value is obtained from the current downstream rotational phase difference and is stored in the memory M144. In step P114, the current setting rotational speed is read from the memory M135.

Next, in step P115, the current setting rotational speed is added to the setting rotational speed compensation value to calculate the instruction rotational speed, which is then stored in the memory M142. In step P116, the instruction rotational speed is outputted to the downstream drive motor driver 138.

Next, in step P117, it is judged whether the current setting rotational speed and the virtual current downstream rotational phase are sent from the upstream printing unit group drive controller 70B. If yes in step P117, in step P118, the current setting rotational speed and the virtual current downstream rotational phase are received from the upstream printing unit group drive controller 70B, and are stored in the memories M135 and M136, respectively.

Next, in step P119, the count value is read from the current downstream rotational phase detection counter 140 and is stored in the memory M137. In step P120, from the count value of the current downstream rotational phase detection counter 140, the current downstream rotational phase is calculated and then stored in the memory M138.

Next, in step P121, the current downstream rotational phase is subtracted from the virtual current downstream rotational phase to calculate the current downstream rotational phase difference, which is then stored in the memory M139. In step P122, from the current downstream rotational phase difference, the absolute value of the current downstream rotational phase difference is calculated and then stored in the memory M140.

Next, in step P123, the tolerance of the current downstream rotational phase difference is read from the memory M141. In step P124, it is judged whether the absolute value of the current downstream rotational phase difference is equal to or less than the tolerance of the current downstream rotational phase difference.

If yes in step P124, in step P125, the current setting rotational speed is read from the memory M135. In step P126, the memory M142 for storing the instruction rotational speed is overwritten with the current setting rotational speed. Subsequently, in step P127, the instruction rotational speed is outputted to the downstream drive motor driver 138, and the process returns to step P117.

On the other hand, if no in step P124, in step P128, the current downstream rotational phase difference-setting rotational speed compensation value conversion table is read from the memory M143, and in step P129, the current downstream rotational phase difference is read from the memory M139.

Next, in step P130, by using the current downstream rotational phase difference-setting rotational speed compensation value conversion table, the setting rotational speed compensation value is obtained from the current downstream rotational phase difference and is stored in the memory M144. In step P131, the current setting rotational speed is read from the memory M135.

Next, in step P132, the current setting rotational speed is added to the setting rotational speed compensation value to calculate the instruction rotational speed, which is then stored in the memory M142. In step P133, the instruction rotational speed is outputted to the downstream drive motor driver 138, and the process returns to step P117.

If no in step P117, in step P134, it is judged whether the instruction to finish load detection at constant-speed operation, the current setting rotational speed and the virtual current downstream rotational phase are sent from the upstream printing unit group drive controller 70B. If yes in step P134, the process proceeds to later-described step P157, and if no, the process proceeds to step P135.

Next, in step P135, it is judged whether the clock pulse is outputted from the downstream rotational phase detection rotary encoder 20B. If yes in step P135, in step P136, the standard rotational speed of load motor is read from the load motor standard rotational speed (torque value) setting unit 143, and is stored in the memory M145 for storing the rotational speed of the downstream load motor. If no in step P135, the process returns to step P117.

Next, in step P137, the count value is read from the current downstream rotational phase detection counter 140 and is stored in the memory M137. In step P138, from the count value of the current downstream rotational phase detection counter 140, the current downstream rotational phase is calculated and then stored in the memory M138.

Next, in step P139, the suction cylinder-notch move-up start rotational phase is read from the memory M146. In step P140, the suction cylinder-notch move-up finish rotational phase is read from the memory M147.

Next, in step P141, it is judged whether the current downstream rotational phase is equal to or more than the suction cylinder-notch move-up start rotational phase, and is equal to or less than the suction cylinder-notch move-up finish rotational phase. If yes in step P141, in step P142, the rotational speed of the downstream load motor 18B is read from the memory M145, and if no in step P141, the process proceeds to later-described step P145.

Next, in step P143, the load motor rotational speed compensation value related to move-up of the notch of the suction cylinder 7 of the convertible press mechanism 2 is read from the memory M148. In step P144, the load motor rotational speed compensation value related to move-up of the notch of the suction cylinder 7 of the convertible press mechanism 2 is subtracted from the rotational speed of the downstream load motor 18B, and the memory M145 storing the rotational speed of the downstream load motor is overwritten with the obtained result.

Next, the rotational speed of the downstream load motor 18B is read from the memory M145 in step P145, and is then outputted to the downstream load motor driver 145 in step P146.

Next, in step P147, the electric current value is read from the downstream drive motor driver 138 and is stored in the memory M150. In step P148, the standard electric current value is read from the memory M151.

Next, in step P149, the standard electric current value is subtracted from the electric current value to calculate the electric current value difference, which is then stored in the memory M152. Next, in step P150, the electric current value difference-load motor rotational speed compensation value conversion table is read from the memory M153.

Next, in step P151, by using the electric current value difference-load motor rotational speed compensation value conversion table, the load motor rotational speed compensation value is obtained from the electric current value difference and is stored in the memory M154. In step P152, the rotational speed of the downstream load motor 18B is read from the memory M145.

Next, in step P153, the load motor rotational speed compensation value is subtracted from the rotational speed of the downstream load motor 18B to calculate the compensated rotational speed of the downstream load motor 18B, which is then stored in the memory M155. In step P154, the setting rotational speed at teaching is read from the memory M134.

Next, in step P155, the current downstream rotational phase is read from the memory M138. In step P156, the compensated rotational speed of the downstream load motor 18B is stored at an address position of the memory M157 for storing the rotational speed of the downstream load motor at constant-speed operation, the address position corresponding to the current downstream rotational phase for the setting rotational speed at teaching. The process then returns to step P117.

Next, in step P157 to which the process proceeds from step P134, the current setting rotational speed and virtual current downstream rotational phase are received from the upstream printing unit group drive controller 70B, and are stored in the memories M135 and M136, respectively. In step P158, the count value is read from the current downstream rotational phase detection counter 140 and is stored in the memory M137.

Next, in step P159, from the count value of the current downstream rotational phase detection counter 140, the current downstream rotational phase is calculated and then stored in the memory M138. In step P160, the current downstream rotational phase is subtracted from the virtual current downstream rotational phase to calculate the current downstream rotational phase difference, which is then stored in the memory M139.

Next, in step P161, from the current downstream rotational phase difference, the absolute value of the current downstream rotational phase difference is calculated and then stored in the memory M140. In step P162, the tolerance of the current downstream rotational phase difference is read from the memory M141.

Next, in step P163, it is judged whether the absolute value of the current downstream rotational phase difference is equal to or less than the tolerance of the current downstream rotational phase difference. If yes in step P163, in step P164, the current setting rotational speed is read from the memory M135.

Next, in step P165, the memory M142 for storing the instruction rotational speed is overwritten with the current setting rotational speed. Subsequently, in step P166, the instruction rotational speed is outputted to the downstream drive motor driver 138, and the process proceeds to later-described step P172.

On the other hand, if no in step P163, in step P167, the current downstream rotational phase difference-setting rotational speed compensation value conversion table is read from the memory M143, and in step P168, the current downstream rotational phase difference is read from the memory M139.

Next, in step P169, by using the current downstream rotational phase difference-setting rotational speed compensation value conversion table, the setting rotational speed compensation value is obtained from the current downstream rotational phase difference, and is stored in the memory M144. In step P170, the current setting rotational speed is read from the memory M135.

Next, in step P171, the current setting rotational speed is added to the setting rotational speed compensation value to calculate the instruction rotational speed, which is then stored in the memory M142. In step P172, the instruction rotational speed is outputted to the downstream drive motor driver 138.

Next, in step P173, it is judged whether the current setting rotational speed and the virtual current downstream rotational phase are sent from the upstream printing unit group drive controller 70B. If yes in step P173, in step P174, the current setting rotational speed and the virtual current downstream rotational phase are received from the upstream printing unit group drive controller 70B and are stored in the memories M135 and M136, respectively.

If no in step P173, in step P175, it is judged whether the deceleration instruction, the current setting rotational speed, and the virtual current downstream rotational phase are sent from the upstream printing unit group drive controller 7OB. If yes in step P175, the process proceeds to later-described step P191, and if no, the process returns to step P173.

Next, in step P176, the count value is read from the current downstream rotational phase detection counter 140 and is stored in the memory M137. In step P177, from the count value of the current downstream rotational phase detection counter 140, the current downstream rotational phase is calculated and then stored in the memory M138.

Next, in step P178, the current downstream rotational phase is subtracted from the virtual current downstream rotational phase to calculate the current downstream rotational phase difference, which is then stored in the memory M139.

Next, in step P179, from the current downstream rotational phase difference, the absolute value of the current downstream rotational phase difference is calculated and then stored in the memory M140. In step P180, the tolerance of the current downstream rotational phase difference is read from the memory M141.

Next, in step P181, it is judged whether the absolute value of the current downstream rotational phase difference is equal to or less than the tolerance of the current downstream rotational phase difference. If yes in step P181, in step P182, the current setting rotational speed is read from the memory M135.

Next, in step P183, the memory M142 for storing the instruction rotational speed is overwritten with the current setting rotational speed. In step P184, the instruction rotational speed is outputted to the downstream drive motor driver 138, and the process returns to step P173.

On the other hand, if no in step P181, in step P185, the current downstream rotational phase difference-setting rotational speed compensation value conversion table is read from the memory M143, and in step P186, the current downstream rotational phase difference is read from the memory M139.

Next, in step P187, by using the current downstream rotational phase difference-setting rotational speed compensation value conversion table, the setting rotational speed compensation value is obtained from the current downstream rotational phase difference and is stored in the memory M144. In step P188, the current setting rotational speed is read from the memory M135.

Next, in step P189, the current setting rotational speed is added to the setting rotational speed compensation value to calculate the instruction rotational speed, which is then stored in the memory M142. In step P190, the instruction rotational speed is outputted to the downstream drive motor driver 138, and the process returns to step P173.

Next, in step P191 to which the process proceeds from step P175, the current setting rotational speed and the virtual current downstream rotational phase are received from the upstream printing unit group drive controller 70B, and are stored in the memories M135 and M136, respectively.

Next, in step P192, the count value is read from the current downstream rotational phase detection counter 140 and is stored in the memory M137. In step P193, from the count value of the current downstream rotational phase detection counter 140, the current downstream rotational phase is calculated and then stored in the memory M138.

Next, in step P194, the current downstream rotational phase is subtracted from the virtual current downstream rotational phase to calculate the current downstream rotational phase difference, which is then stored in the memory M139. In step P195, from the current downstream rotational phase difference, the absolute value of the current downstream rotational phase difference is calculated and then stored in the memory M140.

Next, in step P196, the tolerance of the current downstream rotational phase difference is read from the memory M141. In step P197, it is judged whether the absolute value of the current downstream rotational phase difference is equal to or less than the tolerance of the current downstream rotational phase difference.

Next, if yes in step P197, the current setting rotational speed is read from the memory M135 in step P198. Then, in step P199, the memory M142 for storing the instruction rotational speed is overwritten with the current setting rotational speed. Subsequently, in step P200, the instruction rotational speed is outputted to the downstream drive motor driver 138, and the process proceeds to step P207.

On the other hand, if no in step P197, in step P201, the current downstream rotational phase difference-setting rotational speed compensation value conversion table is read from the memory M143. In step P202, the current downstream rotational phase difference is then read from the memory M139.

Next, in step P203, by using the current downstream rotational phase difference-setting rotational speed compensation value conversion table, the setting rotational speed compensation value is obtained from the current downstream rotational phase difference and is stored in the memory M144. In step P204, the current setting rotational speed is then read from the memory M135.

Next, in step P205, the current setting rotational speed is added to the setting rotational speed compensation value to calculate the instruction rotational speed, which is then stored in the memory M142. In step P206, the instruction rotational speed is outputted to the downstream drive motor driver 138.

Next, in step P207, the reset and enable signals are outputted to the acceleration/deceleration counter 142, and in step P208, the output of the reset signal to the acceleration/deceleration counter 142 is stopped.

Next, in step P209, it is judged whether the current setting rotational speed and the virtual current downstream rotational phase are sent from the upstream printing unit group drive controller 70B. If yes in step P209, in step P210, the current setting rotational speed and the virtual current downstream rotational phase are received from the upstream printing unit group drive controller 70B, and are stored in the memories M135 and M136, respectively.

Next, in step P211, the count value is read from the current downstream rotational phase detection counter 140 and is stored in the memory M137. In step P212, from the count value of the current downstream rotational phase detection counter 140, the current downstream rotational phase is calculated and then stored in the memory M138.

Next, in step P213, the current downstream rotational phase is subtracted from the virtual current downstream rotational phase to calculate the current downstream rotational phase difference, which is then stored in the memory M139. In step P214, from the current downstream rotational phase difference, the absolute value of the current downstream rotational phase difference is calculated and then stored in the memory M140.

Next, in step P215, the tolerance of the current downstream rotational phase difference is read from the memory M141. In step P216, it is judged whether the absolute value of the current downstream rotational phase difference is equal to or less than the tolerance of the current downstream rotational phase difference.

If yes in step P216, the current setting rotational speed is read from the memory M135 in step P217. Then, in step P218, the memory M142 for storing the instruction rotational speed is overwritten with the current setting rotational speed. Subsequently, in step P219, the instruction rotational speed is outputted to the downstream drive motor driver 138, and the process returns to step P209.

If no in step P216, in step P220, the current downstream rotational phase difference-setting rotational speed compensation value conversion table is read from the memory M143 In step P221, the current downstream rotational phase difference is then read from the memory M139.

Next, in step P222, by using the current downstream rotational phase difference-setting rotational speed compensation value conversion table, the setting rotational speed compensation value is obtained from the current downstream rotational phase difference and is stored in the memory M144. In step P223, the current setting rotational speed is then read from the memory M135.

Next, in step P224, the current setting rotational speed is added to the setting rotational speed compensation value to calculate the instruction rotational speed, which is then stored in the memory M142. In step P225, the instruction rotational speed is outputted to the downstream drive motor driver 138, and the process returns to step P209.

If no in step P209, in step P226, it is judged whether the teaching finish signal is sent from the upstream printing unit group drive controller 70B. If yes in step P226, the process returns to step P1, and if no, the process proceeds to step P227.

Next, in step P227, it is judged whether clock pulse is outputted from the downstream rotational phase detection rotary encoder 20B. If yes in step P227, in step P228, the standard rotational speed of the load motor is read from the load motor standard rotational speed (torque value) setting unit 143, and is stored in the memory M145 for storing the rotational speed of the downstream load motor. If no in step P227, the process returns to step P209.

Next, in step P229, the count value is read from the current downstream rotational phase detection counter 140 and is stored in the memory M137. In step P230, from the count value of the current downstream rotational phase detection counter 140, the current downstream rotational phase is calculated and then stored in the memory M138.

Next, in step P231, the suction cylinder-notch move-up start rotational phase is read from the memory M146. In step P232, the suction cylinder-notch move-up finish rotational phase is read from the memory M147.

Next, in step P233, it is judged whether the current downstream rotational phase is equal to or more than the suction cylinder-notch move-up start rotational phase, and is equal to or less than the suction cylinder-notch move-up finish rotational phase. If yes in step P233, in step P234, the rotational speed of the downstream load motor 18B is read from the memory M145, and if no, the process proceeds to later-described step P237.

Next, in step P235, the load motor rotational speed compensation value related to move-up of the notch of the suction cylinder 7 of the convertible press mechanism 2 is read from the memory M148. In step P236, the load motor rotational speed compensation value related to move-up of the notch of the suction cylinder 7 of the convertible press mechanism 2 is subtracted from the rotational speed of the downstream load motor 18B. Then, the memory M145 for storing the rotational speed of the downstream load motor is overwritten with the obtained result.

Next, in step P237, the rotational speed of the downstream load motor 18B is read from the memory M145, and is then outputted to the downstream load motor driver 145 in step P238.

Next, in step P239, the count value is read from the acceleration/deceleration counter 142 and is stored in the memory M149. In step P240, the electric current value is read from the downstream drive motor driver 138 and is stored in the memory M150. In step P241, the standard electric current value is read from the memory M151.

Next, in step P242, the standard electric current value is subtracted from the electric current value to calculate the electric current value difference, which is then stored in the memory M152. In step P243, the electric current value difference-load motor rotational speed compensation value conversion table is read from the memory M153.

Next, in step P244, by using the electric current value difference-load motor rotational speed compensation value conversion table, the load motor rotational speed compensation value is obtained from the electric current value difference and is stored in the memory M154. In step P245, the rotational speed of the downstream load motor 18B is read from the memory M145.

Next, in step P246, the load motor rotational speed compensation value is subtracted from the rotational speed of the downstream load motor 18B to calculate the compensated rotational speed of the downstream load motor 18B, which is then stored in the memory M155. In step P247, the setting rotational speed at teaching is read from the memory M134.

Next, in step P248, the count value of the acceleration/deceleration counter 142 is read from the memory M149. In step P249, the compensated rotational speed of the downstream load motor 18B is stored at the address position of the memory M158 for storing the rotational speed of the downstream load motor at deceleration, the address position corresponding to the count value of the acceleration/deceleration counter 142 for the setting rotational speed at teaching. Then, the process returns to step P209.

Next, in step P250 to which the process proceeds from step P5, it is judged whether the instruction to start home position alignment is sent from the upstream printing unit group drive controller 70B. If yes, the process proceeds to step P251. In step P251, when the setting rotational speed at synchronizing operation is sent from the upstream printing unit group drive controller 70B, in step P252, the setting rotational speed at synchronizing operation is received from the upstream printing unit group drive controller 70B and is then stored in the memory M159.

Next, if no in step P250, in step P253, it is judged whether the instruction to stop synchronizing operation is sent from the upstream printing unit group drive controller 70B. If yes in step P253, the process proceeds to step P419, and if no, the process returns to step P250.

Next, when the current setting rotational speed (slow) and the virtual current downstream rotational phase are sent from the upstream printing unit group drive controller 70B in step P254, in step P255, the current setting rotational speed and the virtual current downstream rotational phase are received from the upstream printing unit group drive controller 70B and are stored in the memories M135 and M136, respectively.

Next, in step P256, the count value is read from the current downstream rotational phase detection counter 140 and is stored in the memory M137. In step P257, from the count value of the current downstream rotational phase detection counter 140, the current downstream rotational phase is calculated and stored in the memory M138.

Next, in step P258, the current downstream rotational phase is subtracted from the virtual current downstream rotational phase to calculate the current downstream rotational phase difference, which is then stored in the memory M139. In step P259, from the current downstream rotational phase difference, the absolute value of the current downstream rotational phase difference is calculated and stored in the memory M140.

Next, in step P260, the tolerance of the current downstream rotational phase difference is read from the memory M141. In step P261, it is judged whether the absolute value of the current downstream rotational phase difference is equal to or less than the tolerance of the current downstream rotational phase difference.

If yes in step P261, in step P262, the current setting rotational speed (slow) is read from the memory M135, and in step P263, the memory M142 for storing the instruction rotational speed is overwritten with the current setting rotational speed (slow).

Next, in step P264, the instruction rotational speed is outputted to the downstream drive motor driver 138. Subsequently, in step P265, the home position alignment completion signal is sent to the upstream printing unit group drive controller 70B. The process then proceeds to later-described step P272.

If no in step P261, in step P266, the current downstream rotational phase difference-setting rotational speed compensation value conversion table is read from the memory M143. In step P267, the current downstream rotational phase difference is read from the memory M139.

Next, in step P268, by using the current downstream rotational phase difference-setting rotational speed compensation value conversion table, the setting rotational speed compensation value is obtained from the current downstream rotational phase difference and is stored in the memory M144. In step P269, the current setting rotational speed (slow) is read from the memory M135.

Next, in step P270, the current setting rotational speed (slow) is added to the setting rotational speed compensation value to calculate the instruction rotational speed, which is then stored in the memory M142. In step P271, the instruction rotational speed is outputted to the downstream drive motor driver 138, and the process returns to step P254.

Next, in step P272 to which the process proceeds from step P265, it is judged whether the current setting rotational speed (slow) and the virtual current downstream rotational phase are sent from the upstream printing unit group drive controller 70B. If yes in step P272, in step P273, the current setting rotational speed (slow) and the virtual current downstream rotational phase are received from the upstream printing unit group drive controller 70B and are stored in the memories M135 and M136, respectively.

Next, in step P274, the count value is read from the current downstream rotational phase detection counter 140 and is stored in the memory M137. In step P275, from the count value of the current downstream rotational phase detection counter 140, the current downstream rotational phase is calculated and stored in the memory M138.

Next, in step P276, the current downstream rotational phase is subtracted from the virtual current downstream rotational phase to calculate the current downstream rotational phase difference, which is then stored in the memory M139. In step P277, from the current downstream rotational phase difference, the absolute value of the current downstream rotational phase difference is calculated and stored in the memory M140.

Next, in step P278, the tolerance of the current downstream rotational phase difference is read from the memory M141. Next, in step P279, it is judged whether the absolute value of the current downstream rotational phase difference is equal to or less than the tolerance of the current downstream rotational phase difference.

If yes in step P279, in step P280, the current setting rotational speed (slow) is read from the memory M135, and in step P281, the memory M142 for storing the instruction rotational speed is overwritten with the current setting rotational speed (slow). Next, in step P282, the instruction rotational speed is outputted to the downstream drive motor driver 138, and the process then returns to step P272.

On the other hand, if no in step P279, in step P283, the current downstream rotational phase difference-setting rotational speed compensation value conversion table is read from the memory M143, and in step P284, the current downstream rotational phase difference is read from the memory M139.

Next, in step P285, by using the current downstream rotational phase difference-setting rotational speed compensation value conversion table, the setting rotational speed compensation value is obtained from the current downstream rotational phase difference and is stored in the memory M144. In step P286, the current setting rotational speed (slow) is read from the memory M135.

Next, in step P287, the current setting rotational speed (slow) is added to the setting rotational speed compensation value to calculate the instruction rotational speed, which is then stored in the memory M142. In step P288, the instruction rotational speed is outputted to the downstream drive motor driver 138, and the process returns to step P272.

If no in step P272, in step P289, it is judged whether the acceleration instruction, the current setting rotational speed (slow) and the virtual current downstream rotational phase are sent from the upstream printing unit group drive controller 70B. If yes in step P289, in step P290, the current setting rotational speed (slow) and virtual current downstream rotational phase are received from the upstream printing unit group drive controller 70B and are stored in the memories M135 and M136, respectively. If no in step P289, the process returns to step P272.

Next, in step P291, the count value is read from the current downstream rotational phase detection counter 140 and is stored in the memory M137. In step P292, from the count value of the current downstream rotational phase detection counter 140, the current downstream rotational phase is calculated and is stored in the memory M138.

Next, in step P293, the current downstream rotational phase is subtracted from the virtual current downstream rotational phase to calculate the current downstream rotational phase difference, which is then stored in the memory M139. In step P294, from the current downstream rotational phase difference, the absolute value of the current downstream rotational phase difference is calculated and stored in the memory M140.

In step P295, the tolerance of the current downstream rotational phase difference is read from the memory M141. In step P296, it is judged whether the absolute value of the current downstream rotational phase difference is equal to or less than the tolerance of the current downstream rotational phase difference.

If yes in step P296, in step P297, the current setting rotational speed (slow) is read from the memory M135. In step P298, the memory M142 for storing the instruction rotational speed is overwritten with the current setting rotational speed (slow). In step P299, the instruction rotational speed is outputted to the downstream drive motor driver 138.

Next, in step P300, the reset and enable signals are outputted to the acceleration/deceleration counter 142, and in step P301, the output of the reset signal to the acceleration/deceleration counter 142 is then stopped.

On the other hand, if no in step P296, in step P302, the current downstream rotational phase difference-setting rotational speed compensation value conversion table is read from the memory M143. In step P303, the current downstream rotational phase difference is then read from the memory M139.

Next, in step P304, by using the current downstream rotational phase difference-setting rotational speed compensation value conversion table, the setting rotational speed compensation value is obtained from the current downstream rotational phase difference and is stored in the memory M144. In step P305, the current setting rotational speed (slow) is read from the memory M135.

Next, in step P306, the current setting rotational speed (slow) is added to the setting rotational speed compensation value to calculate the instruction rotational speed, which is then stored in the memory M142. In step P307, the instruction rotational speed is outputted to the downstream drive motor driver 138, and the process returns to step P300.

Next, in step P308, it is judged whether the current setting rotational speed and the virtual current downstream rotational phase are sent from the upstream printing unit group drive controller 70B. If yes in step P308, in step P309, the current setting rotational speed (slow) and virtual current downstream rotational phase are received from the upstream printing unit group drive controller 70B and are stored in the memories M135 and M136, respectively. If no in step P308, the process proceeds to later-described step P329.

Next, in step P310, the setting rotational speed at synchronizing operation is read from the memory M159, and in step P311, the count value is read from the acceleration/deceleration counter 142 and is stored in the memory M149.

Next, in step P312, the rotational speed of the downstream load motor is read from an address position of the memory M156 for storing the rotational speed of the downstream load motor at acceleration, the address position corresponding to the count value of the acceleration/deceleration counter 142 for the setting rotational speed at synchronizing operation. Then, the rotational speed of the downstream load motor is stored in the memory M145. In step P313, the rotational speed of the downstream load motor is outputted to the downstream load motor driver 145. Note that, the address position of the memory M156 for storing the rotational speed of the downstream load motor at acceleration, the address position corresponding to the count value of the acceleration/deceleration counter 142 for the setting rotational speed at synchronizing operation, corresponds to the address position of the memory M156, the address position corresponding to the count value of the acceleration/deceleration counter 142 for the setting rotational speed at teaching, the memory M156 storing the compensated rotational speed of the downstream load motor 18B in step P100 when the setting rotational speed at teaching is the same as the setting rotational speed at synchronizing operation and when the acceleration/deceleration counter 142 has a same count value.

Next, in step P314, the count value is read from the current downstream rotational phase detection counter 140 and is stored in the memory M137. In step P315, from the count value of the current downstream rotational phase detection counter 140, the current downstream rotational phase is calculated and stored in the memory M138.

Next, in step P316, the current downstream rotational phase is subtracted from the virtual current downstream rotational phase to calculate the current downstream rotational phase difference, which is then stored in the memory M139. In step P317, from the current downstream rotational phase difference, the absolute value of the current downstream rotational phase difference is calculated and is stored in the memory M140.

Next, in step P318, the tolerance of the current downstream rotational phase difference is read from the memory M141. In step P319, it is judged whether the absolute value of the current downstream rotational phase difference is equal to or less than the tolerance of the current downstream rotational phase difference.

If yes in step P319, in step P320, the current setting rotational speed is read from the memory M135. Next, in step P321, the memory M142 for storing the instruction rotational speed is overwritten with the current setting rotational speed. In step P322, the instruction rotational speed is outputted to the downstream drive motor driver 138, and the process then returns to step P308.

On the other hand, if no in step P319, in step P323, the current downstream rotational phase difference-setting rotational speed compensation value conversion table is read from the memory M143, and in step P324, the current downstream rotational phase difference is read from the memory M139.

Next, in step P325, by using the current downstream rotational phase difference-setting rotational speed compensation value conversion table, the setting rotational speed compensation value is obtained from the current downstream rotational phase difference and is stored in the memory M144. In step P326, the current setting rotational speed is read from the memory M135.

Next, in step P327, the current setting rotational speed is added to the setting rotational speed compensation value to calculate the instruction rotational speed, which is then stored in the memory M142. In step P328, the instruction rotational speed is outputted to the downstream drive motor driver 138, and the process returns to step P308.

Next, in step P329, it is judged whether the constant-speed operation instruction, the current setting rotational speed and the virtual current downstream rotational phase are sent from the upstream printing unit group drive controller 70B. If yes in step P329, in step P330, the current setting rotational speed and the virtual current downstream rotational phase are received from the upstream printing unit group drive controller 70B and are stored in the memories M135 and M136, respectively. If no in step P329, the process returns to step P308.

Next, in step P331, the setting rotational speed at synchronizing operation is read from the memory M159, and in step P332, the count value is read from the current downstream rotational phase detection counter 140 and is stored in the memory M137.

Next, in step P333, from the count value of the current downstream rotational phase detection counter 140, the current downstream rotational phase is calculated and stored in the memory M138. In step P334, the rotational speed of the downstream load motor 18B is read from an address position of the memory M157 for storing the rotational speed of the downstream load motor at constant-speed operation, the address position corresponding to the current downstream rotational phase for the setting rotational speed at synchronizing operation. Then, the rotational speed of the downstream load motor 18B is stored in the memory M145. Note that, the address position of the memory M157 for storing the rotational speed of the downstream load motor at constant-speed operation, the address position corresponding to the current downstream rotational phase for the setting rotational speed at synchronizing operation, corresponds to the address position of the memory M157, the address position corresponding to the current downstream rotational phase for the setting rotational speed at teaching, the memory M157 storing the compensated rotational speed of the downstream load motor in step P156 when the setting rotational speed at teaching is the same as that at synchronizing operation and when the current downstream rotational phase is the same.

Next, in step P335, the rotational speed of the downstream load motor 18B is outputted to the downstream load motor driver 145.

Next, in step P336, the count value is read from the current downstream rotational phase detection counter 140 and is stored in the memory M137. In step P337, from the count value of the current downstream rotational phase detection counter 140, the current downstream rotational phase is calculated and then stored in the memory M138.

In step P338, the current downstream rotational phase is subtracted from the virtual current downstream rotational phase to calculate the current downstream rotational phase difference, which is then stored in the memory M139. In step P339, from the current downstream rotational phase difference, the absolute value of the current downstream rotational phase difference is calculated and then stored in the memory M140.

Next, in step P340, the tolerance of the current downstream rotational phase difference is read from the memory M141. In step P341, it is judged whether the absolute value of the current downstream rotational phase difference is equal to or less than the tolerance of the current downstream rotational phase difference.

If yes in step P341, the current setting rotational speed is read from the memory M135 in step P342, and the memory M142 for storing the instruction rotational speed is overwritten with the current setting rotational speed in step P343. In step P344, the instruction rotational speed is outputted to the downstream drive motor driver 138, and the process proceeds to later-described step P351.

On the other hand, if no in step P341, in step P345, the current downstream rotational phase difference-setting rotational speed compensation value conversion table is read from the memory M143, and in step P346, the current downstream rotational phase difference is read from the memory M139.

Next, in step P347, by using the current downstream rotational phase difference-setting rotational speed compensation value conversion table, the setting rotational speed compensation value is obtained from the current downstream rotational phase difference and is stored in the memory M144. In step P348, the current setting rotational speed is read from the memory M135.

Next, in step P349, the current setting rotational speed is added to the setting rotational speed compensation value to calculate the instruction rotational speed, which is then stored in the memory M142. In step P350, the instruction rotational speed is outputted to the downstream drive motor driver 138, and the process proceeds to step P351.

Next, in step P351, it is judged whether the current setting rotational speed and the virtual current downstream rotational phase are sent from the upstream printing unit group drive controller 70B. If yes in step P351, in step P352, the current setting rotational speed and the virtual current downstream rotational phase are received from the upstream printing unit group drive controller 70B and are stored in the memories M135 and M136, respectively.

Next, in step P353, the setting rotational speed at synchronizing operation is read from the memory M159. In step P354, the count value is read from the current downstream rotational phase detection counter 140 and is stored in the memory M137.

Next, in step P355, from the count value of the current downstream rotational phase detection counter 140, the current downstream rotational phase is calculated and then stored in the memory M138. In step P356, the rotational speed of the downstream load motor 18B is read from the address position of the memory M157 for storing the for storing the rotational speed of the downstream load motor at constant-speed operation, the address position corresponding to the current downstream rotational phase for the setting rotational speed at synchronizing operation. Then, the rotational speed of the downstream load motor 18B is stored in the memory M145.

Next, in step P357, the rotational speed of the downstream load motor 18A is outputted to the downstream load motor driver 145.

Next, in step P358, the count value is read from the current downstream rotational phase detection counter 140 and is stored in the memory M137. In step P359, from the count value of the current downstream rotational phase detection counter 140, the current downstream rotational phase is calculated and then stored in the memory M138.

Next, in step P360, the current downstream rotational phase is subtracted from the virtual current downstream rotational phase to calculate the current downstream rotational phase difference, which is then stored in the memory M139. In step P361, from the current downstream rotational phase difference, the absolute value of the current downstream rotational phase difference is calculated and then stored in the memory M140.

Next, in step P362, the tolerance of the current downstream rotational phase difference is read from the memory M141. In step P363, it is judged whether the absolute value of the current downstream rotational phase difference is equal to or less than the tolerance of the current downstream rotational phase difference.

If yes in step P363, the current setting rotational speed is read from the memory M135 in step P364, and the memory M142 for storing the instruction rotational speed is overwritten with the current setting rotational speed in step P365. Next, in step P366, the instruction rotational speed is outputted to the downstream drive motor driver 138, and the process returns to step P351.

On the other hand, if no in step P363, in step P367, the current downstream rotational phase difference-setting rotational speed compensation value conversion table is read from the memory M143, and in step P368, the current downstream rotational phase difference is read from the memory M139.

Next, in step P369, by using the current downstream rotational phase difference-setting rotational speed compensation value conversion table, the setting rotational speed compensation value is obtained from the current downstream rotational phase difference and is stored in the memory M144. In step P370, the current setting rotational speed is read from the memory M135.

Next, in step P371, the current setting rotational speed is added to the setting rotational speed compensation value to calculate the instruction rotational speed, which is then stored in the memory M142. In step P372, the instruction rotational speed is outputted to the downstream drive motor driver 138, and the process returns to step P351.

Next, in step P373, it is judged whether the deceleration instruction, the current setting rotational speed and the virtual current downstream rotational phase are sent from the upstream printing unit group drive controller 70B. If yes in step P373, in step P374, the current setting rotational speed and the virtual current downstream rotational phase are received from the upstream printing unit group drive controller 70B and are stored in the memories M135 and M136, respectively. If no in step P373, the process returns to step P351.

Next, in step P375, the setting rotational speed at synchronizing operation is read from the memory M159. In step P376, the count value is read from the current downstream rotational phase detection counter 140 and is stored in the memory M137.

In step P377, from the count value of the current downstream rotational phase detection counter 140, the current downstream rotational phase is calculated and then stored in the memory M138. In step P378, the rotational speed of the downstream load motor 18B is read from the address position of the memory M157 for storing the rotational speed of the downstream load motor at constant-speed operation, the address position corresponding to the current downstream rotational phase for the setting rotational speed at synchronizing operation. Then, the rotational speed of the downstream load motor 18B is stored in the memory M145.

Next, in step P379, the rotational speed of the downstream load motor 18B is outputted to the downstream load motor driver 145.

Next, in step P380, the count value is read from the current downstream rotational phase detection counter 140 and is stored in the memory M137. In step P381, from the count value of the current downstream rotational phase detection counter 140, the current downstream rotational phase is calculated and then stored in the memory M138.

Next, in step P382, the current downstream rotational phase is subtracted from the virtual current downstream rotational phase to calculate the current downstream rotational phase difference, which is then stored in the memory M139. In step P383, from the current downstream rotational phase difference, the absolute value of the current downstream rotational phase difference is calculated and then stored in the memory M140.

Next, in step P384, the tolerance of the current downstream rotational phase difference is read from the memory M141. In step P385, it is judged whether the absolute value of the current downstream rotational phase difference is equal to or less than the tolerance of the current downstream rotational phase difference.

If yes in step P385, the current setting rotational speed is read from the memory M135 in step P386, and the memory M142 for storing the instruction rotational speed is overwritten with the current setting rotational speed in step P387. Next, in step P388, the instruction rotational speed is outputted to the downstream drive motor driver 138, and the process proceeds to step P395.

On the other hand, if no in step P385, in step P389, the current downstream rotational phase difference-setting rotational speed compensation value conversion table is read from the memory M143, and in step P390, the current downstream rotational phase difference is read from the memory M139.

Next, in step P391, by using the current downstream rotational phase difference-setting rotational speed compensation value conversion table, the setting rotational speed compensation value is obtained from the current downstream rotational phase difference and is stored in the memory M144. In step P392, the current setting rotational speed is read from the memory M135.

Next, in step P393, the current setting rotational speed is added to the setting rotational speed compensation value to calculate the instruction rotational speed, which is then stored in the memory M142. In step P394, the instruction rotational speed is outputted to the downstream drive motor driver 138.

Next, in step P395, the reset and enable signals are outputted to the acceleration/deceleration counter 142, and in step P396, the output of the reset signal to the acceleration/deceleration counter 142 is stopped.

Next, in step P397, it is judged whether the current setting rotational speed and the virtual current downstream rotational phase are sent from the upstream printing unit group drive controller 70B. If yes in step P397, in step P398, the current setting rotational speed and the virtual current downstream rotational phase are received from the upstream printing unit group drive controller 70B and are stored in the memories M135 and M136, respectively. If no in step P397, the process proceeds to later-described step P418.

Next, in step P399, the setting rotational speed at synchronizing operation is read from the memory M159, and in step P400, the count value is read from the acceleration/deceleration counter 142 and is stored in the memory M149.

Next, in step P401, the rotational speed of the downstream load motor 18B is read from the address position of the memory M158 for storing the rotational speed of the downstream load motor at deceleration, the address position corresponding to the count value of the acceleration/deceleration counter 142 for the setting rotational speed at synchronizing operation. Then, the rotational speed of the downstream load motor 18B is stored in the memory M145. In step P402, the rotational speed of the downstream load motor 18B is outputted to the downstream load motor driver 145. Note that, the address position of the memory M158 for storing the rotational speed of the downstream load motor at deceleration, the address position corresponding to the count value of the acceleration/deceleration counter 142 for the setting rotational speed at synchronizing operation, corresponds to the address position of the memory M158, the address position corresponding to the count value of the acceleration/deceleration counter 142 for the setting rotational speed at teaching, the memory M158 storing the compensated rotational speed of the downstream load motor 18B in step P249 when the setting rotational speed at teaching is equal to that at synchronizing operation and when the acceleration/deceleration counter 142 has a same count value.

Next, in step P403, the count value is read from the current downstream rotational phase detection counter 140 and is stored in the memory M137. In step P404, from the count value of the current downstream rotational phase detection counter 140, the current downstream rotational phase is calculated and then stored in the memory M138.

Next, in step P405, the current downstream rotational phase is subtracted from the virtual current downstream rotational phase to calculate the current downstream rotational phase difference, which is then stored in the memory M139. In step P406, from the current downstream rotational phase difference, the absolute value of the current downstream rotational phase difference is calculated and then stored in the memory M140.

Next, in step P407, the tolerance of the current downstream rotational phase difference is read from the memory M141. In step P408, it is judged whether the absolute value of the current downstream rotational phase difference is equal to or less than the tolerance of the current downstream rotational phase difference.

If yes in step P408, the current setting rotational speed is read from the memory M135 in step P409, and the memory M142 for storing the instruction rotational speed is overwritten with the current setting rotational speed in step P410. Next, in step P411, the instruction rotational speed is outputted to the downstream drive motor driver 138, and the process returns to step P397.

If no in step P408, in step P412, the current downstream rotational phase difference-setting rotational speed compensation value conversion table is read from the memory M143, and in step P413, the current downstream rotational phase difference is read from the memory M139.

Next, in step P414, by using the current downstream rotational phase difference-setting rotational speed compensation value conversion table, the setting rotational speed compensation value is obtained from the current downstream rotational phase difference and is stored in the memory M144. In step P415, the current setting rotational speed is read from the memory M135.

Next, in step P416, the current setting rotational speed is added to the setting rotational speed compensation value to calculate the instruction rotational speed, which is then stored in the memory M142. In step P417, the instruction rotational speed is outputted to the downstream drive motor driver 138, and the process returns to step P397.

Next, in step P418, it is judged whether the instruction to stop synchronizing operation is sent from the upstream printing unit group drive controller 70B. If yes in step P418, the process returns to step P250, and if no, the process returns to step P397.

Next, in step P419 to which the process proceeds from step P5, it is judged whether the setting rotational speed is inputted to the downstream single drive rotational speed setting unit 146. If yes in step P419, in step P420, the setting rotational speed is read from the downstream single drive rotational speed setting unit 146 and is stored in the memory M135 for storing the current setting rotational speed. The process then proceeds to step P421. If no in step P419, the process directly proceeds to step P421.

Next, in step P421, it is judged whether the downstream single drive switch 132 is turned on. If yes in step P421, in step P422, the current setting rotational speed is read from the memory M135, and if no, the process returns to step P1.

Next, in step P423, the current setting rotational speed is written in the memory M142 for storing the instruction rotational speed. In step P424, the instruction rotational speed is outputted to the downstream drive motor driver 138.

Next, when the downstream drive stop switch 133 is turned on in step P425, in step P426, the stop instruction is then outputted to the downstream drive motor driver 138. The process then returns to step P1. Hereinafter, the aforementioned processes are repeated.

According to the above-described operational flows, by the instructions from the upstream printing unit group drive controller 70B, the teaching processing and synchronizing operation processing of the downstream drive motor 10B are performed through the downstream printing unit group drive controller 90B.

As described above, in this embodiment, the upstream and downstream drive motors 10A and 10B separately provide driving forces in such a way that the upstream and downstream printing unit groups 1A and 1B are driven by the upstream and downstream drive motors 10A and 10B, respectively. Accordingly, the upstream and downstream drive motors 10A and 10B can be reduced in size and capacity, and the printing press of the present invention can achieve lower cost and operation in higher speed. Furthermore, the upstream and downstream load motors 18A and 18B as the braking units are provided to eliminate non-uniform rotation of the transfer and suction cylinders 6 and 7 of the convertible press mechanism 2. This makes it possible to prevent occurrence of printing faults such as mackle.

Moreover, the braking units are composed of the load motors (torque motors) 18A and 18B. This eliminates the need to replace the components, unlike in the case of brakes, and the braking units can be made maintenance-free. Moreover, the electric power generated by the load motors (torque motors) 18A and 18B are recovered as electric power for driving the drive motors 10A and 10B, thus achieving energy savings.

It is obvious that the present invention is not limited to the aforementioned embodiments, and various changes can be made without departing from the sprit of the present invention. For example, the example shown in the drawings is a sheet-fed offset printing press, but the present invention can be applied other processers such as coating machines which perform not only printing but also coating.

REFERENCE SIGNS LIST

1A UPSTREAM PRINTING UNIT GROUP
1B DOWNSTREAM PRINTING UNIT GROUP
2 CONVERTIBLE PRESS MECHANISM
3*a*, 3*b* IMPRESSION CYLINDER
4*a*, 4*b* BLANKET CYLINDER
5*a*, 5*b* PLATE CYLINDER
6 TRANSFER CYLINDER
7 SUCTION CYLINDER
8 CONVERTIBLE CYLINDER
10A UPSTREAM DRIVE MOTOR
10B DOWNSTREAM DRIVE MOTOR
11 TRANSFER CYLINDER GEAR
12 SUCTION CYLINDER GEAR
13 IMPRESSION CYLINDER GEAR
14 CONVERTIBLE CYLINDER GEAR
15 IMPRESSION CYLINDER GEAR
18A UPSTREAM LOAD MOTOR
18B DOWNSTREAM LOAD MOTOR
30 CENTRAL CONTROLLER
60 VIRTUAL MASTER GENERATOR

55A, 55B PRINTING PRESS CONTROLLER

70A, 70B UPSTREAM PRINTING UNIT GROUP DRIVE CONTROLLER

90A, 90B DOWNSTREAM PRINTING UNIT GROUP DRIVE CONTROLLER

The invention claimed is:

1. A method for driving a processor, the processor including:

first driven means driven by first driving means;

second driven means rotationally driven by the first driving means through the first driven means;

a first rotating body including a notch provided with a first holder holding a processed member, the first rotating body being rotationally driven by the second driven means; and a second rotating body including a notch provided with a second holder which receives the processed member from the first holder of the first rotating body, the method comprising the steps of:

providing second driving means rotationally driving the second rotating body;

providing first braking means to any one of the first rotating body, the second driven means and third driven means rotationally driven by the second driven means;

detecting load of the first driving means to rotationally drive the first rotating body;

obtaining a correction value from the detected load; and controlling a braking force of the first braking means according to the obtained correction value.

2. The method according to claim 1, wherein the braking force of the first braking means is larger when the notch of the first rotating body moves down than when the notch of the first rotating body moves up.

3. The method according to claim 1, wherein the first braking means is a load motor.

4. The method according to claim 3, wherein each of the first and second driving means is an electric motor, and electric power generated by the load motors is used to drive the electric motors.

5. The method according to claim 1, wherein the load is obtained from an electric current value of the first driving means rotationally driving the first rotating body.

6. A method for driving a processor, the processor including:

first driving means;

a first rotating body including a notch provided with a first holder holding a processed member, the first rotating body being rotationally driven by the first driving means;

a second rotating body including a notch provided with a second holder which receives the processed member from the first holder of the first rotating body, the method comprising the steps of:

providing second driving means, fourth driven means driven by the second driving means, fifth driven means which is rotationally driven by the second driving means through the fourth driven means and rotationally drives the second rotating body, and second braking means provided to any one of the second rotating body, the fifth driven means and sixth driven means rotationally driven by the fifth driven means;

detecting load of the second driving means to rotationally drive the second rotating body;

obtaining a correction value from the detected load; and controlling a braking force of the second braking means according to the obtained correction value.

7. The method according to claim 6, wherein the braking force of the second braking means is larger when the notch of the second rotating body moves down than when the notch of the second rotating body moves up.

8. The method according to claim 6, wherein the second braking means is a load motor.

9. The method according to claim 8, wherein each of the first and second driving means is an electric motor, and electric power generated by the load motors is used to drive the electric motors.

10. The method according to claim 6, wherein the load is obtained from an electric current value of the second driving means rotationally driving the second rotating body.

11. An apparatus for driving a processor, the processor including:

first driven means driven by first driving means;

second driven means rotationally driven by the first driving means through the first driven means;

a first rotating body including a notch provided with a first holder holding a processed member, the first rotating body being rotationally driven by the second driven means; and a second rotating body including a notch provided with a second holder which receives the processed member from the first holder of the first rotating body, the apparatus comprising:

second driving means rotationally driving the second rotating body;

first braking means provided to any one of the first rotating body, the second driven means and third driven means rotationally driven by the second driven means; and control means detecting load of first means to rotationally drive the first rotating body, obtaining a correction value from the detected load, and controlling a braking force of the first braking means according to the obtained correction value.

12. The driving apparatus according to claim 11, wherein the control means controls the braking force of the first braking means so that the braking force of the first braking means is larger when the notch of the first rotating body moves down than when the notch of the first rotating body moves up.

13. The driving apparatus according to claim 11, wherein the first braking means is a load motor.

14. The driving apparatus according to claim 13, wherein each of the first and second driving means is an electric motor, and electric power generated by the load motors is used to drive the electric motors.

15. The driving apparatus according to claim 11, wherein the control means obtains the load from an electric current value of the second driving means rotationally driving the second rotating body.

16. An apparatus for driving a processor, the processor including:

first driving means;

first rotating body including a notch provided with a first holder holding a processed member, the first rotating body being rotationally driven by the first driving means;

a second rotating body including a notch provided with a second holder which receives the processed member from the first holder of the first rotating body, the apparatus comprising:

second driving means;

fourth driven means driven by the second driving means;

fifth driven means which is rotationally driven by the second driving means through the fourth driven means, and rotationally drives the second rotating body;

second braking means provided to any one of the second rotating body, the fifth driven means and sixth driven means rotationally driven by the fifth driven means; and control means detecting load to the second driving means to rotationally drive the second rotating body, obtaining a correction value from the detected load, and controlling a braking force of the second braking means according to the obtained correction value.

17. The driving apparatus according to claim 16, wherein the control means controls the braking force of the second braking means so that the braking force of the second braking means is larger when the notch of the second rotating body moves down than when the notch of the second rotating body moves up.

18. The driving apparatus according to claim 16, wherein the second braking means is a load motor.

19. The driving apparatus according to claim 18, wherein each of the first and second driving means is an electric motor, and electric power generated by the load motors is used to drive the electric motors.

20. The driving apparatus according to claim 16, wherein the control means obtains the load from an electric current value of the second driving means rotationally driving the second rotating body.

* * * * *